US011445710B2

(12) United States Patent
Logtenberg et al.

(10) Patent No.: US 11,445,710 B2
(45) **Date of Patent: *Sep. 20, 2022**

(54) ANTIBODY PRODUCING NON-HUMAN ANIMALS

(71) Applicant: Merus N.V., Utrecht (NL)

(72) Inventors: Ton Logtenberg, Driebergen (NL); Mark Throsby, Utrecht (NL); Robert A. Kramer, Utrecht (NL); Rui D. Pinto, Utrecht (NL); Cornelis A. De Kruif, De Bilt (NL); Erwin Houtzager, Zeist (NL)

(73) Assignee: Merus N.V., Utrecht (NL)

( * ) Notice: Subject to any disclaimer, the term of this patent is extended or adjusted under 35 U.S.C. 154(b) by 199 days.

This patent is subject to a terminal disclaimer.

(21) Appl. No.: 15/870,621

(22) Filed: Jan. 12, 2018

(65) Prior Publication Data

US 2018/0134770 A1 May 17, 2018

Related U.S. Application Data

(63) Continuation of application No. 12/589,181, filed on Oct. 19, 2009, now Pat. No. 10,966,411, which is a continuation of application No. 12/459,285, filed on Jun. 29, 2009, now abandoned.

(60) Provisional application No. 61/133,274, filed on Jun. 27, 2008.

(51) Int. Cl.

| | |
|---|---|
| ***A01K 67/027*** | (2006.01) |
| ***C12N 15/85*** | (2006.01) |
| ***C07K 16/00*** | (2006.01) |
| ***C07K 16/46*** | (2006.01) |
| *C07K 14/47* | (2006.01) |
| *C07K 16/10* | (2006.01) |
| *C07K 16/22* | (2006.01) |
| *C07K 16/28* | (2006.01) |
| *C07K 16/32* | (2006.01) |
| *G01N 33/569* | (2006.01) |
| *C07K 16/24* | (2006.01) |
| *C12P 21/00* | (2006.01) |
| *C07K 16/12* | (2006.01) |

(52) U.S. Cl.

CPC ..... *A01K 67/0275* (2013.01); *A01K 67/027* (2013.01); *A01K 67/0278* (2013.01); *C07K 16/00* (2013.01); *C07K 16/462* (2013.01); *C12N 15/8509* (2013.01); *A01K 2207/15* (2013.01); *A01K 2217/052* (2013.01); *A01K 2217/075* (2013.01); *A01K 2217/15* (2013.01); *A01K 2217/206* (2013.01); *A01K 2227/105* (2013.01); *A01K 2267/01* (2013.01); *C07K 14/47* (2013.01); *C07K 16/005* (2013.01); *C07K 16/10* (2013.01); *C07K 16/1282* (2013.01); *C07K 16/22* (2013.01); *C07K 16/248* (2013.01); *C07K 16/2863* (2013.01); *C07K 16/32* (2013.01); *C07K 2317/10* (2013.01); *C07K 2317/14* (2013.01); *C07K 2317/21* (2013.01); *C07K 2317/24* (2013.01); *C07K 2317/31* (2013.01); *C07K 2317/34* (2013.01); *C07K 2317/51* (2013.01); *C07K 2317/515* (2013.01); *C07K 2317/52* (2013.01); *C07K 2317/55* (2013.01); *C07K 2317/56* (2013.01); *C07K 2317/622* (2013.01); *C07K 2317/64* (2013.01); *C07K 2317/76* (2013.01); *C07K 2317/94* (2013.01); *C07K 2319/00* (2013.01); *C12P 21/00* (2013.01); *G01N 33/56966* (2013.01)

(58) Field of Classification Search

CPC ..... A01K 67/0275; A01K 67/027; A01K 67/0278; A01K 2207/15; A01K 2217/052; A01K 2217/075; A01K 2217/15; A01K 2217/206; A01K 2227/105; A01K 2267/01; C07K 16/00; C07K 16/462; C07K 2317/24; C12N 15/8509

USPC ..... 800/18, 13, 6; 530/387.1, 387.3

See application file for complete search history.

(56) References Cited

U.S. PATENT DOCUMENTS

| | | | |
|---|---|---|---|
| 5,565,332 | A | 10/1996 | Hoogenboom et al. |
| 5,614,396 | A | 3/1997 | Bradley et al. |
| 5,770,429 | A | 6/1998 | Lonberg et al. |
| 5,789,215 | A | 8/1998 | Berns et al. |
| 5,885,827 | A | 3/1999 | Wabl |

(Continued)

FOREIGN PATENT DOCUMENTS

| | | |
|---|---|---|
| EP | 0 814 159 | 8/1991 |
| EP | 0469025 | 2/1992 |

(Continued)

OTHER PUBLICATIONS

De Wildt et al. (1999) J. Mol. Biol., vol. 285, 895-901.*

(Continued)

*Primary Examiner* — Anne Marie S Wehbe

(74) *Attorney, Agent, or Firm* — Morrison & Foerster LLP

(57) ABSTRACT

Described are transgenic, non-human animals comprising a nucleic acid encoding an immunoglobulin light chain, whereby the immunoglobulin light chain is human, human-like, or humanized. The nucleic acid is provided with a means that renders it resistant to DNA rearrangements and/or somatic hypermutations. In one embodiment, the nucleic acid comprises an expression cassette for the expression of a desired molecule in cells during a certain stage of development in cells developing into mature B cells. Further provided is methods for producing an immunoglobulin from the transgenic, non-human animal.

7 Claims, 82 Drawing Sheets
(3 of 82 Drawing Sheet(s) Filed in Color)

Specification includes a Sequence Listing.

(56) References Cited

U.S. PATENT DOCUMENTS

| | | | |
|---|---|---|---|
| 5,939,598 | A | 8/1999 | Kycherlapati et al. |
| 6,069,010 | A | 5/2000 | Choi |
| 6,114,598 | A | 9/2000 | Kucherlapati et al. |
| 6,596,541 | B2 | 7/2003 | Murphy |
| 7,105,348 | B2 | 9/2006 | Murphy |
| 7,262,028 | B2 | 8/2007 | Van |
| 7,329,530 | B2 | 2/2008 | Houtzager |
| 7,429,486 | B2 | 9/2008 | Van |
| 7,579,446 | B2 | 8/2009 | Bakker |
| 7,696,330 | B2 | 4/2010 | Meulen |
| 7,740,852 | B2 | 6/2010 | Bakker |
| 7,777,010 | B2 | 8/2010 | Logtenberg |
| 7,858,086 | B2 | 12/2010 | Geuijen |
| 7,901,919 | B2 | 3/2011 | Houtzager |
| 7,919,257 | B2 | 4/2011 | Hoogenboom |
| 7,927,834 | B2 | 4/2011 | Van |
| 7,932,360 | B2 | 4/2011 | Van |
| 7,960,518 | B2 | 6/2011 | Throsby |
| 7,968,092 | B2 | 6/2011 | Throsby |
| 8,052,974 | B2 | 11/2011 | Throsby |
| 8,106,170 | B2 | 1/2012 | Ter |
| 8,148,497 | B2 | 4/2012 | Bakker |
| 8,192,927 | B2 | 6/2012 | Van |
| 8,211,431 | B2 | 7/2012 | Throsby |
| 8,241,631 | B2 | 8/2012 | Throsby |
| 8,268,756 | B2 | 9/2012 | Logtenberg |
| 8,470,327 | B2 | 6/2013 | Throsby et al. |
| 8,502,018 | B2 | 8/2013 | Murphy et al. |
| 8,642,513 | B2 | 2/2014 | Throsby et al. |
| 8,911,738 | B2 | 12/2014 | Throsby et al. |
| 9,012,371 | B2 | 4/2015 | Logtenberg et al. |
| 9,145,588 | B2 | 9/2015 | Throsby et al. |
| 9,248,182 | B2 | 2/2016 | De Kruif et al. |
| 9,738,701 | B2 | 8/2017 | Hogenboom et al. |
| 9,765,133 | B2 * | 9/2017 | Logtenberg ..... A01K 67/0278 |
| 9,908,946 | B2 | 3/2018 | Throsby et al. |
| 9,944,695 | B2 | 4/2018 | Logtenberg et al. |
| 9,944,965 | B2 * | 4/2018 | Lee ..... C12P 19/18 |
| 9,951,124 | B2 * | 4/2018 | Logtenberg ..... C07K 16/1282 |
| 10,605,808 | B2 | 3/2020 | Logtenberg et al. |
| 10,647,781 | B2 | 5/2020 | Throsby et al. |
| 10,670,599 | B2 | 6/2020 | Hoogenboom et al. |
| 2002/0138857 | A1 | 9/2002 | Ghayur |
| 2003/0093820 | A1 | 5/2003 | Green |
| 2003/0096225 | A1 | 5/2003 | Logtenberg |
| 2003/0096226 | A1 | 5/2003 | Logtenberg |
| 2005/0170398 | A1 | 8/2005 | Van |
| 2006/0015949 | A1 | 1/2006 | Lonberg |
| 2006/0015957 | A1 * | 1/2006 | Lonberg ..... A01K 67/0275 800/18 |
| 2006/0121580 | A1 | 6/2006 | Ter Meulen et al. |
| 2006/0160184 | A1 | 7/2006 | Hoogenboom et al. |
| 2006/0205077 | A1 | 9/2006 | Schwenk et al. |
| 2006/0257397 | A1 | 11/2006 | Throsby |
| 2007/0054362 | A1 | 3/2007 | Van Berkel et al. |
| 2007/0059766 | A1 | 3/2007 | Logtenberg et al. |
| 2007/0280945 | A1 | 12/2007 | Stevens et al. |
| 2008/0014204 | A1 | 1/2008 | Ter Meulen et al. |
| 2008/0070799 | A1 | 3/2008 | Bakker |
| 2008/0095780 | A1 | 4/2008 | Geuijen et al. |
| 2008/0226652 | A1 | 9/2008 | Bakker et al. |
| 2009/0017521 | A1 | 1/2009 | Houtzager et al. |
| 2009/0054254 | A1 | 2/2009 | Throsby |
| 2009/0104204 | A1 | 4/2009 | Throsby et al. |
| 2009/0130652 | A1 | 5/2009 | Throsby |
| 2009/0169562 | A1 | 7/2009 | Throsby et al. |
| 2009/0181855 | A1 | 7/2009 | Vasquez |
| 2009/0263864 | A1 | 10/2009 | Van Berkel et al. |
| 2009/0311265 | A1 | 12/2009 | van den Brink et al. |
| 2010/0069614 | A1 | 3/2010 | Houtzager |
| 2010/0146647 | A1 | 6/2010 | Logtenberg |
| 2010/0172917 | A1 | 7/2010 | Ter |
| 2010/0272724 | A1 | 10/2010 | Bakker et al. |
| 2010/0297153 | A1 | 11/2010 | Geuijen |
| 2010/0303801 | A1 | 12/2010 | Throsby et al. |
| 2010/0310572 | A1 | 12/2010 | Bakker |
| 2010/0310586 | A1 | 12/2010 | Dolcetti |
| 2010/0331527 | A1 | 12/2010 | Davis |
| 2011/0177073 | A1 | 7/2011 | Van |
| 2011/0195454 | A1 | 8/2011 | Mcwhirter |
| 2011/0268739 | A1 | 11/2011 | Throsby |
| 2012/0021409 | A1 | 1/2012 | Mcwhirter |
| 2012/0039898 | A1 | 2/2012 | Throsby |
| 2012/0058907 | A1 | 3/2012 | Logtenberg |
| 2012/0076794 | A1 | 3/2012 | Throsby |
| 2012/0093823 | A1 | 4/2012 | Van |
| 2012/0101000 | A1 | 4/2012 | Zhou et al. |
| 2012/0141493 | A1 | 6/2012 | Throsby |
| 2012/0177637 | A1 | 7/2012 | Hoogenboom et al. |
| 2012/0192300 | A1 | 7/2012 | Babb |
| 2012/0276115 | A1 | 11/2012 | Van Den Brink |
| 2012/0315278 | A1 | 12/2012 | Throsby |
| 2013/0096020 | A1 | 4/2013 | Throsby et al. |
| 2013/0145484 | A1 | 6/2013 | Logtenberg et al. |
| 2014/0245468 | A1 * | 8/2014 | McWhirter ..... A01K 67/0278 800/18 |
| 2014/0314755 | A1 | 10/2014 | Logtenberg et al. |
| 2014/0317766 | A1 | 10/2014 | Logtenberg et al. |
| 2016/0130367 | A1 | 5/2016 | Throsby et al. |
| 2016/0238600 | A1 | 8/2016 | Houtzager et al. |
| 2018/0002404 | A1 | 1/2018 | Hoogenboom et al. |
| 2018/0002405 | A1 | 1/2018 | Hoogenboom et al. |
| 2018/0031555 | A1 | 2/2018 | Hoogenboom et al. |
| 2018/0134770 | A1 | 5/2018 | Logtenberg et al. |
| 2018/0142002 | A1 | 5/2018 | Logtenberg et al. |
| 2018/0142003 | A1 | 5/2018 | Logtenberg et al. |
| 2018/0142004 | A1 | 5/2018 | Logtenberg et al. |
| 2018/0142005 | A1 | 5/2018 | Logtenberg et al. |
| 2018/0142006 | A1 | 5/2018 | Logtenberg et al. |
| 2018/0179300 | A1 | 6/2018 | Throsby et al. |
| 2020/0247908 | A1 | 8/2020 | Throsby et al. |

FOREIGN PATENT DOCUMENTS

| | | |
|---|---|---|
| EP | 1 399 575 | 3/2004 |
| EP | 1 439 234 | 7/2004 |
| EP | 1 204 740 | 9/2005 |
| EP | 1204740 | 9/2005 |
| EP | 2147594 | 11/2013 |
| JP | 2004-008218 | 1/2004 |
| JP | 2006-109711 | 4/2006 |
| RU | 2236127 | 9/2004 |
| RU | 2559524 | 8/2015 |
| RU | 2731084 | 12/2015 |
| WO | WO-90/04036 | 4/1990 |
| WO | WO 199012878 | 11/1990 |
| WO | WO-91/00906 | 1/1991 |
| WO | WO-92/03918 | 3/1992 |
| WO | WO-94/02602 | 2/1994 |
| WO | WO-94/04667 | 3/1994 |
| WO | WO-96/30498 | 10/1996 |
| WO | WO-98/24893 | 6/1998 |
| WO | WO-98/50431 | 11/1998 |
| WO | WO 199852976 | 11/1998 |
| WO | WO-99/45962 | 9/1999 |
| WO | WO 199950657 | 10/1999 |
| WO | WO-02/36789 | 5/2002 |
| WO | WO 02/066630 | * 8/2002 |
| WO | WO-02/66630 | 8/2002 |
| WO | WO-03/47336 | 6/2003 |
| WO | WO 2003052416 | 6/2003 |
| WO | WO 2004009618 | 11/2004 |
| WO | WO-04/106375 | 12/2004 |
| WO | WO-2004/106375 | 12/2004 |
| WO | WO 2005068622 | 3/2006 |
| WO | WO-06/68953 | 6/2006 |
| WO | WO-06/117699 | 11/2006 |
| WO | WO-08/54606 | 5/2008 |
| WO | WO 2008/054606 | 5/2008 |
| WO | WO-08/76379 | 6/2008 |
| WO | WO 2008/076379 | 6/2008 |
| WO | WO 2007117410 | 9/2008 |
| WO | WO-09/18411 | 2/2009 |
| WO | WO-09/23540 | 2/2009 |

(56) References Cited

FOREIGN PATENT DOCUMENTS

| | | |
|---|---|---|
| WO | WO 2009/018411 | 2/2009 |
| WO | WO 2009/023540 | 2/2009 |
| WO | WO 2009100896 | 8/2009 |
| WO | WO 2009157771 | 2/2010 |
| WO | WO 2010136598 | 12/2010 |
| WO | WO-11/014469 | 2/2011 |
| WO | WO 2011097603 | 8/2011 |
| WO | WO-12/141798 | 10/2012 |
| WO | WO 2011146514 | 11/2012 |
| WO | WO-2013/184761 | 12/2013 |
| WO | WO-16/081926 | 5/2016 |
| WO | WO2016/081923 | 5/2016 |

OTHER PUBLICATIONS

Sun et al. (2012) J. Animal Sci Biotechnol., vol. 3:18 , http://www.jasbsci.com/content/3/1/18, pp. 1-5.*
O'Brien et al. (1987) Nature, vol. 326, 405-409.*
Peled et al. (2008) Annu. Rev. Immunol., vol. 26, 481-511.*
Clark et al. (2003) Nature Reviews: Genetics, vol. 4, 825-833.*
Niemann et al (2005) Rev. Sci, Tech. Off. Int. Spiz. vol. 24, 285-298.*
Wheeler (2001) Theriogenology, vol. 56, 1345-1369.*
Prelle (2002) Anat. Histol. Embryol., vol. 31, 169-186.*
Chenouard et al. (2021) Front. Genet. vol. 12:615491. doi:10.3389/fgene.2021.6615491, pp. 1-38.*
Protest under 37 CFR § 1.291 in Re-issue U.S. Appl. No. 15/158,543, filed Oct. 14, 2016, 45 pages.
Amendment for U.S. Appl. No. 12/932,719, filed Oct. 8, 2013, 12 pages.
Amendment under AFCP 2.0 for U.S. Appl. No. 12/932,719, filed Jun. 11, 2014, 12 pages.
Amendment for U.S. Appl. No. 12/932,719, filed Feb. 27, 2012, 10 pages.
Teaching of U.S. Appl. No. 12/589,181, presented May 24, 2012, 30 pages.
Notice of Opposition to a European Patent in EP 1360287 from Kymab Limited, filed Jun. 12, 2013, 8 pages.
Notice of Opposition to a European Patent in EP 1360287 from Merus B.V, filed Jun. 12, 2013, 8 pages.
Notice of Opposition to a European Patent in EP 1360287 from Merus B.V, filed Jun. 12, 2013, 4 pages.
Communication of a notice of opposition in EP 02709544.7, mailed Jun. 12, 2013, 1 page.
Payment of fees and expenses in EP 02709544.7, filed Jun. 12, 2013, 1 page.
Authorisation for filing an opposition in EP 02709544.7, filed Jun. 11, 2013, 1 page.
Third party observations filed during prosecution (D12) in EP 02709544.7, filed Jun. 12, 2013, 20 pages.
Thykjaer et al., "Gene targeting approaches using positive-negative selection and large flanking regions," Plant Molecular Biology (1997) 35:523-530.
Deng et al., "Reexamination of gene targeting frequency as a function of the extent of homology between the targeting vector and the target locus," Mol Cell Biol (1992) 12(8):3365-3371.
Taki et al., "Targeted insertion of a variable region gene into the immunoglobulin heavy chain locus," Science (1993) 262:1268.
Zhang et al., "A new logic for DNA engineering using recombination in *Escherichia coli*," Nature Genetics (1998) (20):123-128.
Houldsworth et al., "Comparative genomic hybridization: an overview," AJP (1994) 145(6):1253-1260.
Shi et al., "The mapping of transgenes by fluorescence in situ hybridization on G-branded mouse chromosomes," Mammalian Genome (1994) 5:337-341.
Wilke et al., "Diagnosis of haploidy and triploidy based on measurement of gene copy number by real-time PCR," Human Mutation (2000) 16:431-436.
Bruggemann et al., "Strategies for expressing human antibody repertoires in transgenic mice," Immunol Today (1996) 17(8):391-397.
Zou et al., "Cre-loxP-mediated gene replacement: a mouse strain producing humanized antibodies," Current Biology (1994) 4:1099-1103.
Jessen et al., "Modification of bacterial artificial chromosomes through Chi-stimulated homologous recombination and its application in zebrafish transgenesis," Proc Natl Acad Sci USA (1998) 95:5121-5126.
IMGT Repertoire (IG and TR) Locus representation: Human (*Homo sapiens*) IGH, retrieved from http://www.imgt.org/IMGTrepertoire/index.php?section=LocusGenes&repertoire=locus&species=human&group=IGH on Apr. 2, 2012, 6 pages.
IMGT Repertoire (IG and TR) Locus representation: Human (*Homo sapiens*) IGL, retrieved from http://www.imgt.org/IMGTrepertoire/index.php?section=LocusGenes&repertoire=locus&species=human&group=IGL on Apr. 4, 2012, 3 pages.
Narayanan et al., "Efficient and precise engineering of a 200kb β-globin human/bacterial artificial chromosome in *E. coli* DH10B using an inducible homologous recombination system," Gene Therapy (1999) 6:442-447.
Muyrers et al., "Rapid modification of bacterial artificial chromosomes by ET-recombination," Nucleic Adds Research (1999) 27(6):1555-1557.
Schlake et al., "Use of mutated FLP recognition target (FRT) sites for the exchange of expression cassettes at defined chromosomal loci," Biochemistry (1994) 33:12746-12751.
Waterhouse et al., "Combinatorial infection and in vivo recombination: a strategy for making large phage antibody repertoires," Nucleic Acids Research (1993) 21(9):2265-2266.
Gu et al., "Independent control of immunoglobulin switch recombination at individual switch regions evidenced through Cre-loxP-Mediated gene targeting," Cell (1993) 73:1155-1164.
Mendez et al., "Functional transplant of megabase human immunoglobulin loci recapitulates human antibody response in mice," Nature Genetics (1997) 15:146-156.
Neuberger et al., "Isotype exclusion and transgene down-regulation in immunoglobulin-λtransgenic mice," Nature (1989) 338:350-352.
Bogen et al., "A rearranged λ2 light gene chain retards but does not exclude κ and λ1 expression," Eur J Immunol (1991) 24:2391-2395.
Davies et al., "Creation of mice expressing human antibody light chains by introduction of a yeast artificial chromosome containing the core region of the human immunoglobulin κ locus," Biotechnology.
Takeda et al., "Construction of chimaeric processed immunoglobulin genes containing mouse variable and human constant region sequences," Nature (1985) 314(4):452-454.
Taylor et al., "Human immunoglobulin transgenes undergo rearrangement, somatic mutation and class switching in mice that lack endogenous IgM," Int Immunol (1994) 6(4):579-591.
Bruggemann, "Human antibody expression in transgenic mice," Archivum Immunologiae et Therapiae Experimentalis (2001) 49:203-208.
Statement of Sean Stevens, PHD in EP 02709544.7, filed Aug. 7, 2009, 14 pages.
U.S. Appl. No. 09/732,234, filed Dec. 7, 2000, 57 pages.
U.S. Appl. No. 60/244,665, filed Oct. 31, 2000, 51 pages.
Appendix 1: The claims of the patent, dated Jun. 12, 2013, 5 pages.
List of evidence, dated Jun. 12, 2013, 2 pages.
Opposition against EP 1360287, dated Jun. 12, 2013, 2 pages.
Statement of facts and arguments, dated Jun. 12, 2013, 22 pages.
Statement of facts and arguments against EP 1360287, dated Jun. 12, 2013, 40 pages.
Acknowledgment of receipt for EP 1360287, dated Jun. 12, 2013, 2 pages.
Acknowledgment of receipt for EP 1360287, dated Jun. 12, 2013, 3 pages.
Submission in opposition proceedings in EP 1360287, dated Jun. 20, 2013, 2 pages.
Brief communication in EP1360287, dated Jun. 20, 2013, 1 page.
Smith et al., "Genomic analysis of transgenic animals," Methods in Molecular Biology (1993) 18:323-327.

(56) References Cited

OTHER PUBLICATIONS

Letter regarding the opposition procedure in EP 02709544.7, filed Jun. 14, 2013, 1 page.
Acknowledgment of receipt for EP 1360287, dated Jun. 20, 2013, 2 pages.
Communication of notices of opposition in EP 1360287, dated Jul. 18, 2013, 1 page.
Communication of further notices of opposition pursuant to Rule 79(2) EPC in EP 1360287, dated Jul. 18, 2013, 1 page (Stephen, Robert John).
Communication of further notices of opposition pursuant to Rule 79(2) EPC in EP 1360287, dated Jul. 18, 2013, 1 page (EP&C).
Letter accompanying subsequently filed items in EP 02709544.7, dated Sep. 16, 2013, 1 page.
Acknowledgment of receipt in EP 02709544.7, dated Sep. 16, 2013, 1 page.
Request for extension of time limit in EP 02709544.7, dated Sep. 16, 2013, 1 page.
Brief communication for EP 02709544.7, dated Sep. 17, 2013, 1 page (Stephen, Robert John).
Brief communication for EP 02709544.7, dated Sep. 17, 2013, 1 page (EP&C).
Grant of extension of time limit pursuant to Rule 132 EPC, dated Sep. 17, 2013, 1 page.
Submission in opposition proceedings in EP 02709544.7, dated Oct. 11, 2013, 2 pages.
Opposition proceedings for EP 1360287, dated Oct. 11, 2013, 1 page.
Acknowledgment of receipt in EP 02709544.7, dated Oct. 11, 2013, 1 page.
Brief communication for EP 02709544.7, dated Oct. 14, 2013, 1 page (Bentham, Andrew).
Brief communication for EP 02709544.7, dated Oct. 14, 2013, 1 page (EP&C).
Submission in opposition proceedings for EP 02709544.7, dated Jan. 28, 2014, 2 pages.
Letter accompanying subsequently filed items in EP 02709544.7, dated Jan. 28, 2014, 2 pages.
Brief communication for EP 02709544.7, dated Jan. 28, 2014, 1 page (Bentham, Andrew).
Brief communication for EP 02709544.7, dated Jan. 28, 2014, 1 page (Stephen, Robert John).
Bruggemann, "Human monoclonal antibodies from translocus mice," Molecular Biology of B Cells (2004) Chapter 34 pp. 547-561.
Honjo et al., "Molecular Biology of B Cells," 1st Edition (2004) 1 page.
Open Monoclonal Technology, Inc, "OmniRat, OmniMouse and OmniFlic, Natually optimized human antibodies," (2013) 3 pages.
Ma et al., "Human antibody expression in transgenic rats: Comparison of chimeric IgH loci with human VH, D and JN but bearing different rat C-gene regions," J Immunol Methods (2013) 400-401:78-86.
Green et al., "Antigen-specific human monoclonal antibodies from mice engineered with human Ig heavy and light chain YACs," Nature Genetics (1994) 7:13-21.
Green et al., "Regulation of B cell development by variable gene complexity in mice reconstituted with human immunoglobulin yeast artificial chromosomes," J Exp Med (1998) 188(3):483-495.
Hansen, "Kymab: More mAb diversity," BioCentury (2012) 2 pages.
Mccallister, "Still on the lookout," (2013) 21(48) pp. A1 and A13.
News in Brief, "Big Pharma vies for mice," Nature Biotechnology (2007) 25(6):613-614.
Nagle, "Regeneron helps make Sanofi VelocImmune to its "weak" pipeline," (2007) Retrieved on http://www.outsourcing-pharma.com/Preclinical-Research/Regeneron-helps-make-Sanofi-VelocImmune-to-its-weak-pipeline. Retrieved on Oct. 11, 2013.
"AstraZeneca licenses Regeneron's VelocImmune technology for discovering human monoclonal antibodies," (2007) Retrieved on https://www.drugs.com/news/astrazeneca-licenses-regeneron-s-velocimmune-technology-discovering-human-monoclonal-antibodies-5221.html. Retrieved on Jan. 23, 2014.
The Barnes Report, "A new target and technology have Regeneron's future looking bright," (2007) 1(4):1-2.
Business Wire, "Astellas licenses Regeneron's VelocImmune technology for discovering human monoclonal antibodies," (2007) Retrieved on http://www.businesswire.com/news/home/20070329006182/en/Astellas-Licenses-Regenerons-Velocimmune-Technology-Discovering-Human. Retrieved on Dec. 16, 2016.
Business Wire, "Regeneron and Columbia University enter into a strategic VelocImmune agreement to discover human monoclonal antibodies," (2008) Retrieved on http://www.businesswire.com/news/home/20080916005336/en/Regeneron-Columbia-University-Enter-Strategic-VelocImmune-Agreement. Retrieved on Jan. 23, 2014.
"Regeneron partners VelocImmune with University of Texas," Elsevier Business Intelligence (2009) 1 page.
Statement of Sue Klapholz, M.D., Ph.D, dated Jan. 27, 2014, 14 pages.
Jakobovits, "Production of fully human antibodies by transgenic mice," Current Opinion in Biotechnology (1995) 6:561-566.
Glanville et al., "Niave antibody gene-segment frequencies are heritable and unaltered by chronic lymphocyte ablation," PNAS (2011) 108(50):20066-20071.
Tomizuka et al., "Double trans-chromosomic mice: Maintenance of two individual human chromosome fragments containing Ig heavy and κ loci and expression of fully human antibodies," PNAS (2000) 97(2)722-727.
Green, "Antibody engineering via genetic engineering of the mouse: XenoMouse strains are a vehicle for the facile generation of therapeutic human monoclonal antibodies," Journal of Immunological Methods (1999) 231:11-23.
Statement of Andrew Murphy, dated Jan. 27, 2014, 33 pages.
First auxiliary request, dated Jan. 28, 2014, 8 pages.
Second auxiliary request, dated Jan. 28, 2014, 8 pages.
Amended claims (First auxiliary request), dated Jan. 28, 2014, 8 pages.
Amended claims (Second auxiliary request), dated Jan. 28, 2014, 8 pages.
Patentee's response to Oppositions in EP 1360287, dated Jan. 28, 2014, 1 page.
Patentee's response to Opposition in EP 1360287, dated Jan. 28, 2014, 47 pages.
Letter regarding Opposition proceedings in EP 1360287, dated Jan. 28, 2014, 1 page.
Acknowledgment of receipt in EP 02709544.7, dated Jan. 28, 2014, 1 page.
Acknowledgment of receipt in EP 02709544.7 by Andrew Bentham, dated Jan. 28, 2014, 2 pages.
Brief Communication in EP 027099544.7, dated Jan. 29, 2014, 1 page (Stephen, Robert & John).
Brief Communication in EP 027099544.7, dated Jan. 29, 2014, 1 page (EP&C).
Submission in opposition proceedings in EP 02709544.7, dated Feb. 10, 2014, 2 pages.
Tan et al., "A human-mouse chimeric immunoglobulin gene with a human variable region is expressed in mouse myeloma cell," The Journal of Immunology (1985) 135(5):3564-3567.
Kouskoff et al., "Cassette vectors directing expression of T cell receptor genes in transgenic mice," J Immunological Methods (1995) 180:273-280.
Fleischer et al., "Reactivity of mouse T-cell hybridomas expressing human Vbeta gene segments with staphylococcal and streptococcal superantigens," Infect Immun (1996) 64(3):987.
Vollmer et al., "Antigen contacts by Ni-reactive TCR: typical αβ chain cooperation versus α chain-dominated specificity," International Immunology (2000) 12(12):1723-1731.
Opposition against EP 1360287, dated Feb. 10, 2014, 6 pages.
Acknowledgment of receipt in EP 02709544.7, dated Feb. 10, 2014, 2 pages.
Brief Communication in EP 02709544.7, dated Feb. 11, 2014, 1 page (Bentham, Andrew).

(56) References Cited

OTHER PUBLICATIONS

Brief Communication in EP 02709544.7, dated Feb. 13, 2014, 1 page (EP&C).
Submission in opposition proceedings in EP 1360287, dated Feb. 11, 2014, 2 pages.
Letter accompanying subsequently filed items in EP 02709544.7, dated Feb. 12, 2014, 1 page.
Baker et al., "Adaptation of TCR expression vectors for the construction of mouse-human chimeric MBP-Specific TCR transgenes," Journal of Neuroscience Research (1996) 45:487-491.
Opposition against EP 1360287, dated Feb. 11, 2014, 1 page.
Request for acceleration of the opposition procedure in EP 1360287, dated Feb. 12, 2014, 2 pages.
Acknowledgement of receipt in EP 02709544.7, dated Feb. 12, 2014, 2 pages.
Acknowledgement of receipt in EP 02709544.7, dated Feb. 12, 2014, 1 page (James Nicholls).
Designation of inventor in EP 02709544.7, dated Feb. 24, 2014, 2 pages (Margaret Karow).
Designation of inventor in EP 02709544.7, dated Feb. 24, 2014, 2 pages (Lynn Macdonald).
Designation of inventor in EP 02709544.7, dated Feb. 24, 2014, 2 pages (Aris Economides).
Designation of inventor in EP 02709544.7, dated Feb. 24, 2014, 2 pages (Sean Stevens).
Designation of inventor in EP 02709544.7, dated Feb. 24, 2014, 2 pages (David Valenzuela).
Letter accompanying subsequently filed items in EP 02709544.7, dated Feb. 26, 2014, 1 page.
Letter concerning the inventors in EP 02709544.7, dated Feb. 26, 2014, 1 page.
Acknowledgement of receipt in EP 02709544.7, dated Feb. 26, 2014, 2 pages.
Preparation for oral proceedings in EP 02709544.7, dated Feb. 18, 2014, 2 pages.
Information concerning oral proceedings in EP 02709544.7, dated Apr. 30, 2014, 3 pages.
Summons to attend oral proceedings pursuant to Rule 115(1) in EP 02709544.7, dated Feb. 28, 2014, 1 page (Stephen, Robert John).
Summons to attend oral proceedings pursuant to Rule 115(1) in EP 02709544.7, dated Feb. 28, 2014, 1 page (EP&C).
Summons to attend oral proceedings pursuant to Rule 115(1) in EP 02709544.7, dated Feb. 28, 2014, 1 page (Bentham, Andrew).
Facts and Submissions in EP 02709544.7, dated Feb. 28, 2014, 7 pages.
Acknowledgement of receipt in EP 02709544.7, dated Feb. 28, 2014, 1 page (Stephen, Robert John).
Acknowledgement of receipt in EP 02709544.7, dated Feb. 28, 2014, 1 page (Andrew Bentham).
Acknowledgement of receipt in EP 02709544.7, dated Feb. 28, 2014, 1 page (EP&C).
Notification of the data mentioned in Rule 19(3) EPC in EP 02709544.7, dated Mar. 5, 2014, 1 page (Sean Stevens).
Notification of the data mentioned in Rule 19(3) EPC in EP 02709544.7, dated Mar. 5, 2014, 1 page (Margaret Karow).
Notification of the data mentioned in Rule 19(3) EPC in EP 02709544.7, dated Mar. 5, 2014, 1 page (David Valenzuela).
Notification of the data mentioned in Rule 19(3) EPC in EP 02709544.7, dated Mar. 5, 2014, 1 page (Lynn Macdonald).
Notification of the data mentioned in Rule 19(3) EPC in EP 02709544.7, dated Mar. 5, 2014, 1 page (Aris Economides).
Bibliographical data of European patent application No. 02709544.7, dated Feb. 28, 2014, 1 page.
Brief Communication in EP 02709544.7, dated Mar. 5, 2014, 1 page (Stephens, Robert John).
Brief Communication in EP 02709544.7, dated Mar. 5, 2014, 1 page (EP&C).
Brief Communication in EP 02709544.7, dated Mar. 5, 2014, 1 page (Andrew Bentham).
Acknowledgement of receipt of the document 2310 in EP 02709544.7, dated Feb. 28, 2014, 1 page (Stephen, Robert John).
Acknowledgement of receipt of the document 2310 in EP 02709544.7, dated Feb. 28, 2014, 1 page (EPC).
Letter accompanying subsequently filed items in EP 02709544.7, dated Mar. 10, 2014, 1 page.
Letter concerning inventor's name in EP 02709544.7, dated Mar. 10, 2014, 1 page.
Acknowledgement of receipt in EP 02709544.7, dated Mar. 10, 2014, 1 page.
Bibliographical data of European patent application No. 02709544.7, dated Mar. 11, 2014, 1 page.
Brief Communication in EP 02709544.7, dated Mar. 14, 2014, 1 page (Andrew Bentham).
Brief Communication in EP 02709544.7, dated Mar. 14, 2014, 1 page (EP&C).
Brief Communication in EP 02709544.7, dated Mar. 14, 2014, 1 page (Stephens, Robert John).
Letter accompanying subsequently filed items in EP 02709544.7, dated Mar. 18, 2014, 1 page.
Letter concerning inventor's address in EP 02709544.7, dated Mar. 18, 2014, 1 page.
Advice of delivery in EP 02709544.7, dated Feb. 28, 2014, 2 pages.
Acknowledgement of receipt in EP 02709544.7, dated Mar. 18, 2014, 1 page.
Bibliographical data of European patent application No. 02709544.7, dated Mar. 19, 2014, 1 page.
Acknowledgement of receipt of the document 2310 in EP 02709544.7, dated Feb. 28, 2014, 1 page (Andrew Bentham).
Brief Communication in EP 02709544.7, dated Mar. 24, 2014, 1 page (Andrew Bentham).
Brief Communication in EP 02709544.7, dated Mar. 24, 2014, 1 page (Stephen, Robert John).
Brief Communication in EP 02709544.7, dated Mar. 24, 2014, 1 page (EPC).
Notice of Opposition to a European patent in EP 02709544.7, dated Apr. 3, 2014, 4 pages.
Cover sheet for fax transmission in EP 02709544.7, dated Apr. 3, 2014, 1 page.
Online fee payment in EP 02709544.7, dated Apr. 2, 2014, 1 page.
Notice of Intervention by Novo Nordisk in EP 02709544.7, dated Apr. 3, 2014, 13 pages.
Particulars of Infringement in EP 02709544.7, dated Apr. 3, 2014, 8 pages.
Soukharev et al., "Segmental genomic replacement in embryonic stem cells by double lox targeting," (1999) 27(18):e21.
Letter regarding Notice of Intervention in EP 02709544.7, dated Apr. 3, 2014, 1 page.
Notice of opposition to a European patent in EP 02709544.7, dated Apr. 4, 2014, 4 pages.
Brief Communication in EP 02709544.7, dated Apr. 10, 2014, 1 page (Andrew Bentham).
Brief Communication in EP 02709544.7, dated Apr. 10, 2014, 1 page (Stephen, Robert John).
Brief Communication in EP 02709544.7, dated Apr. 10, 2014, 1 page (EP&C).
Maintenance of oral proceedings in EP 02709544.7, dated Apr. 7, 2014, 2 pages.
Brief Communication in EP 02709544.7, dated Apr. 22, 2014, 1 page (Stephen, Robert John).
Brief Communication in EP 02709544.7, dated Apr. 22, 2014, 1 page (EP&C).
Brief Communication in EP 02709544.7, dated Apr. 22, 2014, 1 page (Andrew Bentham).
Preparation for oral proceedings in EP 02709544.7, dated Apr. 17, 2014, 2 pages.
Information concerning oral proceedings in EP 02709544.7, dated Jul. 16, 2014, 3 pages.
Summons to attend oral proceedings pursuant to Rule 115(1) in EP 02709544.7, dated Apr. 24, 2014, 1 page (Stephen, Robert John).
Summons to attend oral proceedings pursuant to Rule 115(1) in EP 02709544.7, dated Apr. 24, 2014, 1 page (EP&C).

(56) References Cited

OTHER PUBLICATIONS

Summons to attend oral proceedings pursuant to Rule 115(1) in EP 02709544.7, dated Apr. 24, 2014, 1 page (Bentham, Andrew).
Summons to attend oral proceedings pursuant to Rule 115(1) in EP 02709544.7, dated Apr. 24, 2014, 1 page (Thomas, Philip John Duval).
Facts and Submissions in EP 02709544.7, dated Apr. 24, 2014, 3 pages.
Acknowledgement of receipt of the document 2310 in EP 02709544.7, dated Apr. 24, 2014, 1 page (Andrew Bentham).
Acknowledgement of receipt of the document 2310 in EP 02709544.7, dated Apr. 24, 2014, 1 page (Stephen, Robert John).
Acknowledgement of receipt of the document 2310 in EP 02709544.7, dated Apr. 24, 2014, 1 page (EP&C).
Acknowledgement of receipt of the document 2310 in EP 02709544.7, dated Apr. 24, 2014, 1 page (Thomas, Philip John Duval).
Advice of delivery in EP 02709544.7, dated Apr. 24, 2014, 2 pages (Thomas, Philip John Duval).
Letter accompanying subsequently filed items in EP 02709544.7, dated May 2, 2014, 1 page.
Acknowledgement of receipt of the document 2310 in EP 02709544.7, dated May 2, 2014, 1 page.
Opposition to EP 1360287, dated Jul. 15, 2014, 3 pages.
Authorisation of representative in EP 1360287, dated Jul. 15, 2014, 1 page.
Letter accompanying subsequently filed items in EP 02709544.7, dated Jul. 16, 2014, 1 page.
First auxiliary request in EP 1360287, dated Jul. 16, 2014, 7 pages.
Second auxiliary request in EP 1360287, dated Jul. 16, 2014, 7 pages.
Third auxiliary request in EP 1360287, dated Jul. 16, 2014, 7 pages.
Fourth auxiliary request in EP 1360287, dated Jul. 16, 2014, 7 pages.
Fifth auxiliary request in EP 1360287, dated Jul. 16, 2014, 7 pages.
Sixth auxiliary request in EP 1360287, dated Jul. 16, 2014, 7 pages.
Seventh auxiliary request in EP 1360287, dated Jul. 16, 2014, 7 pages.
Eighth auxiliary request in EP 1360287, dated Jul. 16, 2014, 7 pages.
Ninth auxiliary request in EP 1360287, dated Jul. 16, 2014, 7 pages.
Tenth auxiliary request in EP 1360287, dated Jul. 16, 2014, 7 pages.
Eleventh auxiliary request in EP 1360287, dated Jul. 16, 2014, 7 pages.
Twelfth auxiliary request in EP 1360287, dated Jul. 16, 2014, 7 pages.
Thirteenth auxiliary request in EP 1360287, dated Jul. 16, 2014, 7 pages.
Fourteenth auxiliary request in EP 1360287, dated Jul. 16, 2014, 7 pages.
Mcmurry et al., "Enhancer control of local accessibility to V(D)J recombinase," Molecular and Cellular Biology (1997) 17(8):4553-4561.
Johnston et al., "Complete sequence assembly and characterization of the C57BL/6 mouse Ig heavy chain V region," J Immunol (2006) 176:4221-4234.
Xu et al., "Deletion of the IgK light chain intronic enhancer/matrix attachment region impaires but does not abolish VkJk Rearrangement," Immunity (1996) 4:377-385.
Meier et al., "Short DNA sequences inserted for gene targeting can accidentally interfere with off-target gene expression," The FASEB Journal (2010) 24:1714-1724.
Ren et al., "Targeted insertion results in a rhombomere 2-specific Hoxa2 knockdown and ectopic activation of Hoxal expression," Developmental Dynamics (2002) 225:305-315.
Tucker et al., "Mouse IgA heavy chain gene sequence: Implications forevolution of immunoglobulin hinge exons," Proc Natl Acad Sci USA (1981) 78(12):7684-7688.
Blankenstein et al., "Immunoglobulin VH region genes of the mouse are organized in overlapping clusters," Eur. J. Immunol. 1987.17: 1351-1357.
Rathbun et al., "Organization and expression of the mammalian heavy-chain variable-region locus," (1989) Chapter 4, 9 pages.
Amended claims (First auxiliary request), dated Jul. 16, 2014, 8 pages.
Amended claims (Second auxiliary request), dated Jul. 16, 2014, 8 pages.
Amended claims (Third auxiliary request), dated Jul. 16, 2014, 8 pages.
Amended claims (Fourth auxiliary request), dated Jul. 16, 2014, 8 pages.
Amended claims (Fifth auxiliary request), dated Jul. 16, 2014, 8 pages.
Amended claims (Sixth auxiliary request), dated Jul. 16, 2014, 8 pages.
Amended claims (Seventh auxiliary request), dated Jul. 16, 2014, 8 pages.
Amended claims (Eighth auxiliary request), dated Jul. 16, 2014, 8 pages.
Amended claims (Ninth auxiliary request), dated Jul. 16, 2014, 8 pages.
Amended claims (Tenth auxiliary request), dated Jul. 16, 2014, 8 pages.
Amended claims (Eleventh auxiliary request), dated Jul. 16, 2014, 8 pages.
Amended claims (Twelfth auxiliary request), dated Jul. 16, 2014, 8 pages.
Amended claims (Thirteenth auxiliary request), dated Jul. 16, 2014, 8 pages.
Amended claims (Fourteenth auxiliary request), dated Jul. 16, 2014, 8 pages.
Witness statement of Nicole Helen Dagg, dated Jan. 31, 2014, 5 pages.
Office action (third-party submission), dated Apr. 3, 2014, 17 pages.
Statement of Victor L J Tybulewicz, dated Jul. 15, 2014, 26 pages.
Statement of Daniel J. Capon, dated Jul. 7, 2014, 4 pages.
Documents list (D78-D107), dated Jul. 16, 2014, 1 page.
Curriculum Vitae Hidde L. Ploegh, dated Jul. 16, 2014, 33 pages.
Statement Of Craig H. Bassing, dated Jul. 16, 2014, 34 pages.
Document 89, dated Jul. 16, 2014, 1 page.
Document 93 (ANNEX—MOA), dated Jul. 16, 2014, 6 pages.
Document 95a (Statement of Prof. Dr. Hendriks), dated Jul. 16, 2014, 21 pages.
Curriculum Vitae Prof. Dr. Rudi W. Hendriks, dated Jul. 16, 2014, 24 pages.
Response to substantive Examination Report in EP 02709544.7, dated Dec. 22, 2008, 6 pages.
D80 (Examination in EP 02709544.7), dated Jul. 16, 2014, 2 pages.
Kingzette et al., "Trans-chromosomal recombination within the Ig heavy chain switch region in B lymphocytes," Proc Natl Acad Sci USA (1998) 95:11840-11845.
Karu et al., "Recombinant antibody technology," ILAR Journal (1995) 37(3):132-141.
Giusti et al., "Hypermutation is observed only in antibody H chain V region transgenes that have recombined with endogenous immunoglobulin H DNA: Implications for the location of cis-acting elements required for somatic mutation," J Exp Med (1993) 177:797-809.
Bruggemann et al., "The immunogenicity of chimeric antibodies," J Exp Med (1989) 170:2153-2157.
Seidl et al., "Position-dependent inhibition of class-switch recombination by PGK-neor cassettes inserted into the immunoglobulin heavy chain constant region locus," Proc. Natl. Acad. Sci. USA (1999) 96:3000-3005.
Jakobovits, "The long-awaited magic bullets: therapeutic human monoclonal antibodies from transgenic mice," Exp Opin Invest Drugs (1998) 7(4):607-614.
Jakobovits et al., "From XenoMouse technology to panitumumab, the first fully human antibody product from transgenic mice," Nature Biotechnology (2007) 25(10):1134-1143.
Gavilondo et al., "Antibody engineering at the millennium," BioTechniques (2000) 29:128-145.
Clark, "IgG effector mechanisms," Chem Immunol Basel Karger (1997) 65:88-110.

(56) References Cited

OTHER PUBLICATIONS

Yang et al., "Homologous recombination based modification in *Esherichia coli* and germline transmission in transgenic mice of a bacterial artificial chromosome," Nature Biotechnology (1997) 15:859-865.
Thomas et al., "Site-directed mutagenesis by gene targeting in mouse embryo-derived stem cells," Cell (1987) 51:503-512.
Spanopoulou et al., "Functional immunoglobulin transgenes guide ordered B-cell differentiation in Rag-1-deficient mice," Genes & Development (1994) 8:1030-1042.
Monaco et al., "YACs, BACs, PACs and MACs: artificial chromosomes as research tools," TIB Tech (1994) 12:280-286.
Giraldo et al., "Size matters: use of YACs, BACs and PACs in transgenic animals," Transgenic Research (2001) 10:83-103.
Clark,"Antibody humanization: a case of the 'Emperor's new clothes'?" Immunology Today (2000) 21(8):397-402.
D82 (Summary of product characteristics), dated Jul. 16, 2014, 39 pages.
D83 (Summary of product characteristics), dated Jul. 16, 2014, 29 pages.
D84 (Summary of product characteristics), dated Jul. 16, 2014, 63 pages.
Muller et al., "Ten years of gene targeting: targeted mouse mutants, from vector design to phenotype analysis," Mechanisms of Development (1999) 82:3-21.
D86 (Gene Targeting), dated Jul. 16, 2014, 98 pages.
D78 (Datasheet for the decision of the Enlarged Board of Appeal of Apr. 6, 2009 for EP 94115175.5), dated Jul. 16, 2014, 25 pages.
U.S. Appl. No. 09/784,859, filed Feb. 16, 2001, 69 pages.
D91 (Datasheet for the decision of Sep. 12, 2012), dated Jul. 16, 2014, 28 pages.
D92 (European patent specification for EP 1 399 575), dated Jul. 16, 2014, 26 pages.
Opposition against EP 1360287, dated Jul. 16, 2014, 34 pages.
Letter regarding references part 1 dated Jul. 16, 2014, 1 page.
Letter regarding references part 2, dated Jul. 16, 2014, 1 page.
Letter regarding references part 3, dated Jul. 16, 2014, 1 page.
Submission in opposition proceedings in EP 1360287, dated Jul. 16, 2014, 2 pages (Olswang).
Submission in opposition proceedings in EP 1360287, dated Jul. 16, 2014, 2 pages (EPC).
Letter regarding Merus' written submission, dated Jul. 16, 2014, 2 pages, 2 pages.
The alleged invention, dated Jul. 16, 2016, 79 pages.
Response to the Summons to oral proceedings, dated Jul. 16, 2014, 24 pages.
Acknowledgement of receipt in EP 1360287, dated Jul. 16, 2014, 2 pages (Jane Hollywood).
Acknowledgement of receipt in EP 1360287, dated Jul. 16, 2014, 2 pages (Groeneveld).
Acknowledgement of receipt in EP 1360287, dated Jul. 16, 2014, 3 pages (Andrew Bentham).
Joyner, "Gene targeting", dated Jul. 17, 2014, 196 pages.
Letter regarding references part 4, dated Jul. 17, 2014, 1 page.
Letter regarding references part 5, dated Jul. 17, 2014, 1 page.
Brief Communication in EP 02709544.7, dated Jul. 21, 2014, 1 page (Andrew Bentham).
Brief Communication in EP 02709544.7, dated Jul. 21, 2014, 1 page (Stephen, Robert John).
Brief Communication in EP 02709544.7, dated Jul. 21, 2014, 1 page (EP&C).
Brief Communication in EP 02709544.7 (Letter from the opponent 01 of Jul. 16, 2014 with non patent literature only), dated Jul. 21, 2014, 1 page (Andrew Bentham).
Brief Communication in EP 02709544.7, dated Jul. 25, 2014, 1 page (Thomas, Philip John Duval).
Brief Communication in EP 02709544.7, dated Jul. 25, 2014, 1 page (Stephen, Robert John).
Brief Communication in EP 02709544.7, dated Jul. 25, 2014, 1 page (EP&C).
Brief Communication in EP 02709544.7, dated Jul. 28, 2014, 1 page (Andrew Bentham).
Brief Communication in EP 02709544.7, dated Jul. 28, 2014, 1 page (Thomas, Philip John Duval).
Brief Communication in EP 02709544.7, dated Jul. 28, 2014, 1 page (Stephen, Robert John).
Submission in opposition proceedings in EP 1360287, dated Aug. 12, 2014, 2 pages.
Consolidated document list for EP 1360287, dated Aug. 12, 2014, 11 pages.
Letter regarding consolidated document list for EP 1360287, dated Aug. 12, 2014, 1 page.
Acknowledgement of receipt for EP 1360287, dated Aug. 12, 2014, 2 pages.
Brief Communication in EP 02709544.7, dated Aug. 19, 2014, 1 page (Stephen, Robert John).
Brief Communication in EP 02709544.7, dated Aug. 19, 2014, 1 page (EP&C).
Brief Communication in EP 02709544.7, dated Aug. 19, 2014, 1 page (Thomas, Philip John Duval).
Authorisation in EP 1360287, dated Aug. 12, 2014, 1 page.
Submission in opposition proceedings in EP 1360287, dated Aug. 20, 2014, 2 pages.
Acknowledgement of receipt for EP 1360287, dated Aug. 20, 2014, 1 page (Jane Hollywood).
Letter accompanying subsequently filed items in EP 02709544.7, dated Aug. 22, 2014, 1 page.
Murphy et al., "Mice with megabase humanization of their immunoglobulin genes generate antibodies as efficiently as normal mice," PNAS (2014) 111(14):5153-5158.
Macdonald et al., "Precise and in situ genetic humanization of 6 Mb of mouse immunoglobulin genes," 111(14):5147-5152.
Letter with scientific publications, dated Aug. 22, 2014, 2 pages (Olswang).
Acknowledgement of receipt for EP 1360287, dated Aug. 22, 2014, 1 page (Jane Hollywood).
Brief Communication in EP 02709544.7, dated Aug. 28, 2014, 1 page (EP&C).
Brief Communication in EP 02709544.7, dated Aug. 28, 2014, 1 page (Thomas, Philip John Duval).
Brief Communication in EP 02709544.7, dated Aug. 28, 2014, 1 page (Andrew Bentham).
Letter accompanying subsequently filed items in EP 02709544.7, dated Sep. 2, 2014, 1 page.
Submission in opposition proceedings in EP 1360287, dated Sep. 2, 2014, 2 pages.
Practising Certificate (Dr James Richard Cleland Whyte), dated Apr. 1, 2014, 1 page.
Letter regarding practicing certificate, dated Sep. 2, 2014, 1 page.
Wuerffel et al., "S—S synapsis during class switch recombination is promoted by distantly located transcriptional elements and activation-induced deaminase," Immunity (2007) 27:711-722.
Seidl et al., "An expressed neo$^r$ cassette provides required functions of the Iy2b exon for class switching," International Immunology (1998) 10(11):1683-1692.
Kenter et al., "Three-dimensional architecture of the IgH locus facilitates class switch recombination," Ann N.Y. Acad Sci (2012) 1267:86-94.
Kitamura et al., "A B cell-deficient mouse by targeted disruption of the membrane exon of the immunoglobulin μ chain gene," Nature (1991) 350:423-426.
Scapini et al., "Myeloid cells, BAFF, and IFN-$_7$ establish an inflammatory loop that exacerbates autoimmunity in Lyn-deficient mice," J Exp Med (2010) 207(8):1757-1773.
Geuijen, "Full length human IgG bispecific antibodies for cancer therapy," Merus-RABs and Bispecific Antibodies (2013) 33 pages.
Merus, "MeMo—the ingenious mouse for improved antibody therapeutics," Retrieved on Oct. 2011. Retrieved on www.merus.nl.
Merus, "MeMo transgenic mouse for improved antibody therapeutics," Retrieved on Sep. 2012. Retrieved on www.merus.nl.
Lee et al., "Complete humanization of the mouse immunoglobulin loci enables efficient therapeutic antibody discovery," Nature Biotechnology (2014) 32:356-363.

(56) References Cited

OTHER PUBLICATIONS

Second statement of Craig H. Bassing Ph.D., dated Sep. 2, 2014, 5 pages.
Written submissions in response to the summons to attend oral proceedings, dated Apr. 23, 2013, 24 pages.
Statement of Prof. Dr. Anthony Defranco, dated Sep. 2, 2014, 19 pages.
Letter regarding submissions made by opponents, dated Sep. 2, 2014, 8 pages.
Acknowledgement of receipt for EP 1360287, dated Sep. 2, 2014, 1 page (Jane Hollywood).
Acknowledgement of receipt for EP 1360287, dated Sep. 2, 2014, 1 page (Andrew Bentham).
Submission in opposition proceedings, dated Sep. 5, 2014, 2 pages.
Consolidated documents list for EP 1360287, dated Sep. 3, 2014, 12 pages.
Letter regarding consolidated documents, dated Sep. 5, 2014, 1 page.
Acknowledgement of receipt for EP 1360287, dated Sep. 5, 2014, 2 pages.
Brief Communication in EP 02709544.7, dated Sep. 8, 2014, 1 page (Stephen, Robert John).
Brief Communication in EP 02709544.7, dated Sep. 8, 2014, 1 page (Thomas, Philip John Duval).
Brief Communication in EP 02709544.7, dated Sep. 8, 2014, 1 page (EP&C).
Submission in opposition proceedings, dated Sep. 9, 2014, 2 pages.
Practising Certificate (Justin John Turner QC), dated Apr. 1, 2014, 1 page.
Letter regarding practicing certificate, dated Sep. 9, 2014, 1 page.
Acknowledgement of receipt for EP 1360287, dated Sep. 9, 2014, 2 pages.
Brief Communication in EP 02709544.7, dated Sep. 10, 2014, 1 page (Stephen, Robert John).
Brief Communication in EP 02709544.7, dated Sep. 10, 2014, 1 page (EP&C).
Brief Communication in EP 02709544.7, dated Sep. 10, 2014, 1 page (Thomas, Philip John Duval).
Letter accompanying subsequently filed items in EP 02709544.7, dated Sep. 11, 2014, 1 page.
Letter regarding attending oral proceedings, dated Sep. 11, 2014, 1 page.
Acknowledgement of receipt for EP 1360287, dated Sep. 11, 2014, 1 page.
Letter accompanying subsequently filed items in EP 02709544.7, dated Sep. 12, 2014, 1 page.
Brief Communication in EP 02709544.7, dated Sep. 15, 2014, 1 page (Stephen, Robert John).
Brief Communication in EP 02709544.7, dated Sep. 15, 2014, 1 page (EP&C).
Brief Communication in EP 02709544.7, dated Sep. 15, 2014, 1 page (Thomas, Philip John Duval).
Brief Communication in EP 02709544.7, dated Sep. 18, 2014, 1 page (Stephen, Robert John).
Brief Communication in EP 02709544.7, dated Sep. 18, 2014, 1 page (Bentham, Andrew).
Brief Communication in EP 02709544.7, dated Sep. 18, 2014, 1 page (Thomas, Philip John Duval).
Letter regarding Opposition proceedings, dated Sep. 15, 2014, 2 pages.
Acknowledgement of receipt for EP 1360287, dated Sep. 15, 2014, 1 page.
Information regarding oral proceedings, dated Sep. 18, 2014, 1 page.
Brief Communication in EP 02709544.7, dated Sep. 17, 2014, 1 page (Stephen, Robert John).
Brief Communication in EP 02709544.7, dated Sep. 17, 2014, 1 page (Andrew Bentham).
Brief Communication in EP 02709544.7, dated Sep. 17, 2014, 1 page (Thomas, Philip John Duval).
Letter regarding Notice of Appeal, dated Sep. 18, 2014, 2 pages.
Payment of fees and costs, dated Sep. 18, 2014, 1 page.
Communication for EP 02709544.7, dated Nov. 28, 2014, 1 page.
Provision of the minutes in accordance with Rule 124(4) EPC, dated Nov. 28, 2014, 1 page.
Minutes of the oral proceedings before the opposition division, dated Nov. 28, 2014, 1 page.
Minutes of the oral proceedings before the opposition division sheet 2, dated Nov. 28, 2014, 1 page.
Decision revoking the European Patent (Art 101(3)(b) EPC), dated Nov. 28, 2014, 2 pages.
Revocation of the European Patent (Art 101(3)(b) EPC), dated Nov. 21, 2014, 1 page.
Appeal against the decision, dated Nov. 28, 2014, 2 pages.
Annex to the communication in EP 02709544.7, dated Nov. 28, 2014, 17 pages.
Facts and submissions in EP 02709544.7, dated Nov. 28, 2014, 25 pages.
Acknowledgement of receipt of the document 2331 in EP 02709544.7, dated Nov. 28, 2014, 1 page (Thomas, Philip John Duval).
Acknowledgement of receipt of the document 2331 in EP 02709544.7, dated Nov. 28, 2014, 1 page (EP&C).
Acknowledgement of receipt of the document 2331 in EP 02709544.7, dated Nov. 28, 2014, 1 page (Andrew Bentham).
Acknowledgement of receipt of the document 2331 in EP 02709544.7, dated Nov. 28, 2014, 1 page (Stephen, Robert John).
New sixth auxiliary request, dated Sep. 17, 2014, 11 pages.
New sixth auxiliary request (Annex), dated Sep. 17, 2014, 12 pages.
Advice of payment in EP 02709544.7, dated Apr. 12, 2014, 2 pages.
Letter accompanying subsequently filed items, dated Dec. 9, 2014, 1 page.
Acknowledgement of receipt for EP 1360287, dated Dec. 9, 2014, 1 page.
Commencement of proceedings before the Board of Appeal, dated Dec. 10, 2014, 4 pages.
Advice of payment in EP 02709544.7, dated Mar. 12, 2014, 2 pages (EP&C).
Appeal order for T2220/14-3.3.08, dated Dec. 12, 2014, 1 page.
Letter accompanying subsequently filed items, dated Dec. 23, 2016, 1 page.
Trial for 2015 from The Patents Court, dated Dec. 18, 2014, 15 pages.
Request for accelerated processing, dated Dec. 23, 2014, 5 pages.
Acknowledgement of receipt in EP 02709544.7, dated Dec. 9, 2014, 1 page.
Letter from Boards of Appeal for T2220/14-3.3.08, dated Jan. 9, 2015, 1 page (Stephen, Robert John).
Letter from Boards of Appeal for T2220/14-3.3.08, dated Jan. 9, 2015, 1 page (Thomas, Philip John Duval).
Letter from Boards of Appeal for T2220/14-3.3.08, dated Jan. 9, 2015, 1 page (EP&C).
Letter from Boards of Appeal for T2220/14-3.3.08, dated Jan. 20, 2015, 1 page (Andrew Bentham).
Letter accompanying subsequently filed items, dated Jan. 22, 2015, 1 page (Andrew Bentham).
Letter accompanying subsequently filed items, dated Jan. 22, 2015, 1 page (Jane Hollywood).
Letter in response to Communication, dated Jan. 22, 2015, 1 page (Andrew Bentham).
Letter in response to Communication from the Board of Appeal, dated Jan. 22, 2015, 1 page (Robert Stephen).
Acknowledgement of receipt in EP 02709544.7, dated Jan. 22, 2015, 1 page (Andrew Bentham).
Acknowledgement of receipt in EP 02709544.7, dated Jan. 22, 2015, 1 page (Jane Hollywood).
Letter from Boards of Appeal for T2220/14-3.3.08, dated Jan. 23, 2015, 1 page (Stephen, Robert John).
Letter from Boards of Appeal for T2220/14-3.3.08, dated Jan. 23, 2015, 1 page (Andrew Bentham).
Letter accompanying subsequently filed items, dated Jan. 30, 2015, 1 page (Andrew Bentham).
Letter accompanying subsequently filed items, dated Jan. 30, 2015, 1 page (Robert Stephen).

(56) References Cited

OTHER PUBLICATIONS

Explanation regarding documents disclosed in proceedings, dated Jan. 29, 2015, 2 pages.
Letter regarding acceleration of appeal proceedings, dated Jan. 30, 2015, 2 pages (EP&C).
Letter in response to the communication, dated Jan. 30, 2015, 2 pages (Robert Stephen).
Letter in response to the communication, dated Jan. 30, 2015, 2 pages (Philip Thomas).
Submission in opposition proceedings, dated Jan. 30, 2015, 2 pages (Philip Thomas).
Acknowledgement of receipt in EP 02709544.7, dated Jan. 30, 2015, 1 page (Olivier Brake).
Acknowledgement of receipt in EP 02709544.7, dated Jan. 30, 2015, 1 page (Stephen).
Acknowledgement of receipt in EP 02709544.7, dated Jan. 30, 2015, 1 page (Helen Stanbrook).
Letter from Boards of Appeal for T2220/14-3.3.08, dated Feb. 5, 2015, 3 pages.
Letter from Boards of Appeal for T2220/14-3.3.08, dated Feb. 5, 2015, 3 pages (with EP&C).
Letter accompanying subsequently filed items, dated Feb. 9, 2015, 1 page (Andrew Bentham).
Letter regarding acceleration of the proceedings, dated Feb. 9, 2015, 6 pages.
Acknowledgement of receipt in EP 02709544.7, dated Feb. 9, 2015, 1 page (Andrew Bentham).
Letter from Boards of Appeal for T2220/14-3.3.08, dated Feb. 13, 2015, 1 page (Stephen, Robert John).
Letter from Boards of Appeal for T2220/14-3.3.08, dated Feb. 13, 2015, 1 page (Thomas, Philip John Duval).
Letter from Boards of Appeal for T2220/14-3.3.08, dated Feb. 13, 2015, 1 page (EP&C).
Letter accompanying subsequently filed items, dated Feb. 15, 2015, 3 pages (Andrew Bentham).
Consolidated document list (D1-D155), dated Sep. 12, 2014, 12 pages.
Reichert, "Monoclonal antibodies in the clinic," Nature Biotechnology (2001) 19:819-822.
Jones et al., "Replacing the complementarity-determining regions in a human antibody with those from a mouse," Nature (1986) 321:522-525.
Hurle et al., "Protein engineering techniques for antibody humanization," Current Opinion in Biotechnology (1994) 5:428-433.
Xu et al., "Diversity in the CDR3 region of $V_h$ is sufficient formost antibody specificities," Immunity (2000) 13:37-45.
Figini et al., "Panning phage antibody libraries on cells: isolation of human fab fragments against ovarian carcinoma using guided selection[1]," Cancer Research (1998) 58:991-996.
Mortuza et al., "Immunoglobulin heavy-chain gene rearrangement in adult acute lymphoblastic leukemia reveals preferential usage of $J_H$-proximal variable gene segments," Blood (2001) 97(9):2716-2726.
Fujieda et al., "Multiple types of chimeric germ-line Ig heavy chain transcript in human B cells: evidence for trans-splicing of human Ig RNA," J Immunol (1996) 157(8):3450-3459.
Shimizu et al., "Trans-splicing as a possible molecular mechanism for the multiple isotype expression of the immunoglobulin gene," J. Exp. Med (1991) 173:1385-1393.
Yancopoulos et al., "Preferential utilization of the most $J_H$-proximal $V_H$ gene segments in pre-B-cell lines," Nature (1984) 311:727-733.
Letter regarding grounds of Appeal, dated Feb. 15, 2015, 41 pages.
Main Request, dated Feb. 15, 2015, 5 pages.
Auxiliary Request 1, dated Feb. 15, 2015, 5 pages.
Auxiliary Request 2, dated Feb. 15, 2015, 5 pages.
Auxiliary Request 3, dated Feb. 15, 2015, 5 pages.
Auxiliary Request 4, dated Feb. 15, 2015, 5 pages.
Auxiliary Request 5, dated Feb. 15, 2015, 5 pages.
Auxiliary Request 6, dated Feb. 15, 2015, 5 pages.
Auxiliary Request 7, dated Feb. 15, 2015, 5 pages.
Auxiliary Request 8, dated Feb. 15, 2015, 5 pages.
Auxiliary Request 9, dated Feb. 15, 2015, 5 pages.
Auxiliary Request 10, dated Feb. 15, 2015, 5 pages.
Auxiliary Request 11, dated Feb. 15, 2015, 5 pages.
Auxiliary Request 12, dated Feb. 15, 2015, 5 pages.
Auxiliary Request 13, dated Feb. 15, 2015, 5 pages.
Auxiliary Request 14, dated Feb. 15, 2015, 5 pages.
Auxiliary Request 15, dated Feb. 15, 2015, 5 pages.
Auxiliary Request 16, dated Feb. 15, 2015, 5 pages.
Auxiliary Request 17, dated Feb. 15, 2015, 5 pages.
Auxiliary Request 18, dated Feb. 15, 2015, 6 pages.
Auxiliary Request 19, dated Feb. 15, 2015, 4 pages.
Auxiliary Request 20, dated Feb. 15, 2015, 5 pages.
Auxiliary Request 21, dated Feb. 15, 2015, 5 pages.
Amended claims (main request), dated Feb. 15, 2015, 8 pages.
Amended claims (Auxiliary request 1), dated Feb. 15, 2015, 8 pages.
Amended claims (Auxiliary request 2), dated Feb. 15, 2015, 8 pages.
Amended claims (Auxiliary request 3), dated Feb. 15, 2015, 8 pages.
Amended claims (Auxiliary request 4), dated Feb. 15, 2015, 8 pages.
Amended claims (Auxiliary request 5), dated Feb. 15, 2015, 8 pages.
Amended claims (Auxiliary request 6), dated Feb. 15, 2015, 8 pages.
Amended claims (Auxiliary request 7), dated Feb. 15, 2015, 8 pages.
Amended claims (Auxiliary request 8), dated Feb. 15, 2015, 8 pages.
Amended claims (Auxiliary request 9), dated Feb. 15, 2015, 8 pages.
Amended claims (Auxiliary request 10), dated Feb. 15, 2015, 8 pages.
Amended claims (Auxiliary request 11), dated Feb. 15, 2015, 8 pages.
Amended claims (Auxiliary request 12), dated Feb. 15, 2015, 12 pages.
Amended claims (Auxiliary request 13), dated Feb. 15, 2015, 13 pages.
Amended claims (Auxiliary request 14), dated Feb. 15, 2015, 11 pages.
Amended claims (Auxiliary request 15), dated Feb. 15, 2015, 12 pages.
Amended claims (Auxiliary request 16), dated Feb. 15, 2015, 12 pages.
Amended claims (Auxiliary request 17), dated Feb. 15, 2015, 12 pages.
Amended claims (Auxiliary request 18), dated Feb. 15, 2015, 13 pages.
Amended claims (Auxiliary request 19), dated Feb. 15, 2015, 11 pages.
Amended claims (Auxiliary request 20), dated Feb. 15, 2015, 11 pages.
Amended claims (Auxiliary request 21), dated Feb. 15, 2015, 8 pages.
Acknowledgement of receipt in EP 02709544.7, dated Feb. 15, 2015, 1 page (James Nicholls).
Letter accompanying subsequently filed items, dated Feb. 20, 2015, 1 page (Jane Hollywood).
Letter accompanying subsequently filed items, dated Feb. 20, 2015, 1 page (EP&C).
Letter from Boards of Appeal for T2220/14-3.3.08, dated Feb. 20, 2015, 1 page (Stephen, Robert John).
Letter from Boards of Appeal for T2220/14-3.3.08, dated Feb. 20, 2015, 1 page (Thomas, Philip John Duval).
Letter from Boards of Appeal for T2220/14-3.3.08, dated Feb. 20, 2015, 1 page (EP&C).
Letter regarding prior art documents, dated Feb. 20, 2015, 2 pages (Robert Stephen).
Letter regarding representation of Merus, dated Feb. 20, 2015, 1 page.

(56) References Cited

OTHER PUBLICATIONS

Letter regarding representation of Merus, dated Feb. 20, 2015, 3 pages (Raphael Bosl).
Acknowledgement of receipt in EP 02709544.7, dated Feb. 20, 2015, 1 page (Jane Hollywood).
Acknowledgement of receipt in EP 02709544.7, dated Feb. 20, 2015, 1 page (Olivier Ter Brake).
Letter from Boards of Appeal for T2220/14-3.3.08, dated Feb. 24, 2015, 1 page (Thomas, Philip John Duval).
Letter from Boards of Appeal for T2220/14-3.3.08, dated Feb. 24, 2015, 1 page (Fritz Lahrtz).
Letter from Boards of Appeal for T2220/14-3.3.08, dated Feb. 25, 2015, 1 page (Andrew Bentham).
Letter from Boards of Appeal for T2220/14-3.3.08 (Opponent 1), dated Feb. 26, 2015, 1 page (Andrew Bentham).
Letter from Boards of Appeal for T2220/14-3.3.08 (Opponent 1), dated Feb. 26, 2015, 1 page (Thomas, Philip John Duval).
Letter from Boards of Appeal for T2220/14-3.3.08 (Opponent 2), dated Feb. 26, 2015, 1 page (EP&C).
Letter from Boards of Appeal for T2220/14-3.3.08 (Opponent 2), dated Feb. 26, 2015, 1 page (Andrew Bentham).
Letter from Boards of Appeal for T2220/14-3.3.08 (Opponent 2), dated Feb. 26, 2015, 1 page (Thomas, Philip John Duval).
Letter from Boards of Appeal for T2220/14-3.3.08 (Opponent 2), dated Feb. 26, 2015, 1 page (Stephen, Robert John).
Letter from Boards of Appeal for T2220/14-3.3.08 (form 3575), dated Feb. 26, 2015, 1 page (Andrew Bentham).
Letter from Boards of Appeal for T2220/14-3.3.08 (form 3575), dated Feb. 26, 2015, 1 page (Thomas, Philip John Duval).
Letter from Boards of Appeal for T2220/14-3.3.08 (form 3575), dated Feb. 26, 2015, 1 page (Stephen, Robert John).
Communication of amended entries for T2220/14-3.3.08, dated Feb. 26, 2015, 1 page (Fritz Lahrtz).
Letter accompanying subsequently filed items, dated Mar. 2, 2015, 1 page (Fritz Lahrtz).
Letter accompanying subsequently filed items, dated Mar. 2, 2015, 1 page (Andrew Bentham).
Communication of the Board of Appeal for T2220/14-3.3.08, dated Mar. 2, 2015, 10 pages (Andrew Bentham).
Further to the Communication of the Board of Appeal, dated Mar. 2, 2015, 1 page (Fritz Lahrtz).
Letter regarding communication, dated Mar. 2, 2015, 1 page (Andrew Bentham).
Acknowledgement of receipt in EP 02709544.7, dated Mar. 2, 2015, 1 page (Verena Behre).
Acknowledgement of receipt in EP 02709544.7, dated Mar. 2, 2015, 1 page (Andrew Bentham).
Letter confirming proposed dates, dated Mar. 4, 2015, 2 pages (Philip Thomas).
Letter accompanying subsequently filed items, dated Mar. 9, 2015, 1 page (Robert Stephen).
Letter from Boards of Appeal for T2220/14-3.3.08 (Opponent 2), dated Mar. 9, 2015, 1 page (Andrew Bentham).
Letter from Boards of Appeal for T2220/14-3.3.08 (Opponent 2), dated Mar. 9, 2015, 1 page (Thomas, Philip John Duval).
Letter from Boards of Appeal for T2220/14-3.3.08 (Opponent 2), dated Mar. 9, 2015, 1 page (Stephen, Robert John).
Letter from Boards of Appeal for T2220/14-3.3.08 (Patent proprietor), dated Mar. 9, 2015, 1 page (Stephen, Robert John).
Letter from Boards of Appeal for T2220/14-3.3.08 (Patent proprietor), dated Mar. 9, 2015, 1 page (Thomas, Philip John Duval).
Letter from Boards of Appeal for T2220/14-3.3.08 (Patent proprietor), dated Mar. 9, 2015, 1 page (Fritz Lahrtz).
Letter from Boards of Appeal for T2220/14-3.3.08 (Opponents), dated Mar. 9, 2015, 1 page (Andrew Bentham).
Letter from Boards of Appeal for T2220/14-3.3.08 (Opponents), dated Mar. 9, 2015, 1 page (Fritz Lahrtz).
Letter from Boards of Appeal for T2220/14-3.3.08 (Opponents), dated Mar. 9, 2015, 1 page (Stephen, Robert John).
Letter in response to the EPO communication, dated Mar. 9, 2015, 1 page (Robert Stephen).
Acknowledgement of receipt in EP 02709544.7, dated Mar. 9, 2015, 1 page (Stephen).
Letter from Boards of Appeal for T2220/14-3.3.08 (Opponent 1), dated Mar. 16, 2015, 1 page (Andrew Bentham).
Letter from Boards of Appeal for T2220/14-3.3.08 (Opponent 1), dated Mar. 16, 2015, 1 page (Thomas, Philip John Duval).
Letter from Boards of Appeal for T2220/14-3.3.08 (Opponent 1), dated Mar. 16, 2015, 1 page (Fritz Lahrtz).
Authorisation for EP02709544.7, dated Mar. 8, 2015, 1 page.
Letter regarding power of attorney, dated Mar. 19, 2015, 1 page.
Letter accompanying subsequently filed items, dated Mar. 26, 2015, 2 pages (Andrew Bentham).
Letter from Boards of Appeal for T2220/14-3.3.08 (Opponent 2), dated Mar. 26, 2015, 1 page (Andrew Bentham).
Letter from Boards of Appeal for T2220/14-3.3.08 (Opponent 2), dated Mar. 26, 2015, 1 page (Thomas, Philip John Duval).
Letter from Boards of Appeal for T2220/14-3.3.08 (Opponent 2), dated Mar. 26, 2015, 1 page (Stephen, Robert John).
Letter regarding typographical errors, dated Mar. 26, 2015, 2 pages.
Auxiliary Request 15, dated Mar. 26, 2015, 5 pages.
Auxiliary Request 11, dated Mar. 26, 2015, 5 pages.
Auxiliary Request 10, dated Mar. 26, 2015, 5 pages.
Auxiliary Request 6, dated Mar. 26, 2015, 5 pages.
Auxiliary Request 1, dated Mar. 26, 2015, 5 pages.
Amend claims (Auxiliary Request 1), dated Mar. 26, 2015, 8 pages.
Amend claims (Auxiliary Request 6), dated Mar. 26, 2015, 8 pages.
Amend claims (Auxiliary Request 10), dated Mar. 26, 2015, 8 pages.
Amend claims (Auxiliary Request 11), dated Mar. 26, 2015, 8 pages.
Amend claims (Auxiliary Request 15), dated Mar. 26, 2015, 8 pages.
Acknowledgement of receipt in EP 02709544.7, dated Mar. 26, 2015, 2 pages (Andrew Bentham).
Letter from Boards of Appeal for T2220/14-3.3.08 (Patent proprietor), dated Apr. 1, 2015, 1 page (Stephen, Robert John).
Letter from Boards of Appeal for T2220/14-3.3.08 (Patent proprietor), dated Apr. 1, 2015, 1 page (Thomas, Philip John Duval).
Letter from Boards of Appeal for T2220/14-3.3.08 (Patent proprietor), dated Apr. 1, 2015, 1 page (Fritz Lahrtz).
Letter accompanying subsequently filed items, dated Jul. 2, 2015, 2 pages (Robert Stephen).
Rule 80 EPC document, dated Jul. 2, 2015, 8 pages.
Submission in response to EPO communication, dated Mar. 23, 2015, 3 pages.
Response to the examination report, dated Apr. 2, 2015, 7 pages (Andrew Bentham).
Opinion & Order, dated Nov. 21, 2014, 59 pages.
Document regarding lack of sufficiency, dated Jul. 2, 2015, 1 page.
Document regarding application documents in application 11728509.8, dated Mar. 4, 2015, 6 pages.
Document regarding application documents in application 10010741.6, dated May 30, 2014, 2 pages.
Submission in response to the third party observations, dated Jul. 1, 2014, 5 pages.
Letter regarding response to application, dated Jun. 23, 2015, 4 pages.
Bruggemann, "The preparation of human antibodies from mice harbouring human immunoglobulin loci," Transgenic animals: generation and use (1997) pp. 397-402.
Dougier et al., "Interallelic class switch recombination can reverse allelic exclusion and allow trans-complementation of an IgH locus switching defect," Eur J Immunol (2006) 36:2181-2191.
Gerstein et al., "Isotype switching of an immunoglobulin heavy chain transgene occurs by DNA recombination between different chromosomes," Cell (1990) 63:537-548.
Decision of technical board of appeal, dated Feb. 3, 2015, 21 pages.
Letter regarding grounds of appeal, dated Jul. 2, 2015, 1 page (Robert Stephen).
Acknowledgement of receipt in EP 02709544.7, dated Jul. 2, 2015, 2 pages.

(56) References Cited

OTHER PUBLICATIONS

Request and admissibility, dated Jul. 2, 2015, 64 pages.
Letter regarding a response to the grounds of appeal, dated Jul. 2, 2015, 19 pages (Philip Thomas).
Letter in response to Patentee's grounds of appeal, dated Jul. 2, 2015, 85 pages (Fritz Lahrtz).
Letter in response to Patentee's grounds of appeal, dated Jul. 2, 2015, 44 pages (Philip Thomas).
Letter from Boards of Appeal for T2220/14-3.3.08 (Opponent 1), dated Jul. 8, 2015, 1 page (Andrew Bentham).
Letter from Boards of Appeal for T2220/14-3.3.08 (Opponent 1), dated Jul. 8, 2015, 1 page (Thomas, Philip John Duval).
Letter from Boards of Appeal for T2220/14-3.3.08 (Opponent 1), dated Jul. 8, 2015, 1 page (Fritz Lahrtz).
Letter from Boards of Appeal for T2220/14-3.3.08 (Opponent 3), dated Jul. 8, 2015, 1 page (Andrew Bentham).
Letter from Boards of Appeal for T2220/14-3.3.08 (Opponent 3), dated Jul. 8, 2015, 1 page (Fritz Lahrtz).
Letter from Boards of Appeal for T2220/14-3.3.08 (Opponent 3), dated Jul. 8, 2015, 1 page (Stephen, Robert John).
Letter from Boards of Appeal for T2220/14-3.3.08 (Opponent 2), dated Jul. 9, 2015, 1 page (Andrew Bentham).
Letter from Boards of Appeal for T2220/14-3.3.08 (Opponent 2), dated Jul. 9, 2015, 1 page (Thomas, Philip John Duval).
Letter from Boards of Appeal for T2220/14-3.3.08 (Opponent 2), dated Jul. 9, 2015, 1 page (Stephen, Robert John).
Letter from Boards of Appeal for T2220/14-3.3.08 (Patent proprietor), dated Jul. 14, 2015, 1 page (Andrew Bentham).
Letter from Boards of Appeal for T2220/14-3.3.08 (Patent proprietor), dated Jul. 14, 2015, 1 page (Fritz Lahrtz).
Letter from Boards of Appeal for T2220/14-3.3.08 (Patent proprietor), dated Jul. 14, 2015, 1 page (Stephen, Robert John).
Letter accompanying subsequently filed items, dated Aug. 3, 2015, 1 page (Andrew Bentham).
Consolidated document list for appeal (D1-D168), dated Aug. 3, 2015, 14 pages.
Letter in response to grounds of appeal, dated Aug. 3, 2015, 1 page.
Acknowledgement of receipt in EP 02709544.7, dated Aug. 3, 2015, 1 page.
Letter from Boards of Appeal for T2220/14-3.3.08 (Patent proprietor), dated Aug. 7, 2015, 1 page (Stephen, Robert John).
Letter from Boards of Appeal for T2220/14-3.3.08 (Patent proprietor), dated Aug. 7, 2015, 1 page (Thomas, Philip John Duval).
Letter from Boards of Appeal for T2220/14-3.3.08 (Patent proprietor), dated Aug. 7, 2015, 1 page (Fritz Lahrtz).
Document regarding oral proceedings, dated Aug. 13, 2015, 1 page.
Summons to oral proceedings pursuant to Rule 115(1) EPC, dated Aug. 14, 2015, 26 pages.
Acknowledgement of receipt of the document 3011, dated Aug. 17, 2015, 1 page (Fritz Lahrtz).
Tracking information, dated Aug. 17, 2015, 1 page.
Letter regarding transfer of all cases, dated Aug. 20, 2015, 2 pages.
Advice of delivery, dated Aug. 24, 2015, 2 pages (Thomas).
Letter accompanying subsequently filed items, dated Aug. 27, 2015, 1 page.
Acknowledgement of receipt of the document 3011, dated Aug. 14, 2015, 1 page.
Acknowledgement of receipt in EP 02709544.7, dated Aug. 27, 2015, 1 page.
Letter from Boards of Appeal for T2220/14-3.3.08 (Board's communication), dated Aug. 31, 2015, 1 page (Andrew Bentham).
Letter from Boards of Appeal for T2220/14-3.3.08 (Opponents and Board's communication), dated Aug. 31, 2015, 1 page (Fritz Lahrtz).
Letter from Boards of Appeal for T2220/14-3.3.08 (Opponents and Board's communication), dated Aug. 31, 2015, 1 page (Stephen, Robert John).
Acknowledgement of receipt of the document 3011, dated Aug. 14, 2015, 1 page (Stephen, Robert John).
Letter in relation to appeal proceedings, dated Sep. 8, 2015, 4 pages.
Velocimmune history narrative—from Drew's memory, dated Sep. 8, 2015, 6 pages.
Letter in relation to Appeal proceedings, dated Sep. 16, 2015, 2 pages.
Letter regarding representative of opponent 1, dated Sep. 21, 2015, 1 page.
Communication of the Board of Appeal, dated Sep. 22, 2015, 1 page (Andrew Bentham).
Communication of the Board of Appeal, dated Sep. 22, 2015, 1 page (Potter Clarkson LLP).
Communication of the Board of Appeal, dated Sep. 22, 2015, 1 page (Fritz Lahrtz).
Communication of the Board of Appeal, dated Sep. 22, 2015, 1 page (Stephen, Robert John).
Letter accompanying subsequently filed items, dated Sep. 25, 2015, 2 pages (Andrew Bentham).
Letter from Boards of Appeal for T2220/14-3.3.08 (Opponent 2), dated Sep. 25, 2015, 1 page (Andrew Bentham).
Letter from Boards of Appeal for T2220/14-3.3.08 (Opponent 2), dated Sep. 25, 2015, 1 page (Potter Clarkson LLP).
Letter from Boards of Appeal for T2220/14-3.3.08 (Opponent 2), dated Sep. 25, 2015, 1 page (Stephen, Robert John).
Letter in relation to Appeal Proceedings, dated Sep. 25, 2015, 19 pages.
Letter in response to the summons to oral proceedings pursuant to Rule 115(1) EPC, dated Sep. 25, 2015, 9 pages.
Main Request, dated Sep. 25, 2015, 5 pages.
Auxiliary Request 4, dated Sep. 25, 2015, 5 pages.
Auxiliary Request 5, dated Sep. 25, 2015, 5 pages.
Auxiliary Request 6, dated Sep. 25, 2015, 5 pages.
Auxiliary Request 8, dated Sep. 25, 2015, 5 pages.
Auxiliary Request 9, dated Sep. 25, 2015, 5 pages.
Auxiliary Request 10, dated Sep. 25, 2015, 5 pages.
Auxiliary Request 11, dated Sep. 25, 2015, 5 pages.
Auxiliary Request 7, dated Sep. 25, 2015, 5 pages.
Auxiliary Request 1, dated Sep. 25, 2015, 5 pages.
Auxiliary Request 2, dated Sep. 25, 2015, 5 pages.
Auxiliary Request 3, dated Sep. 25, 2015, 5 pages.
Amend claims (Main Request), dated Sep. 25, 2015, 8 pages.
Amend claims (Auxiliary Request 1), dated Sep. 25, 2015, 8 pages.
Amend claims (Auxiliary Request 2), dated Sep. 25, 2015, 8 pages.
Amend claims (Auxiliary Request 4), dated Sep. 25, 2015, 8 pages.
Amend claims (Auxiliary Request 5), dated Sep. 25, 2015, 8 pages.
Amend claims (Auxiliary Request 6), dated Sep. 25, 2015, 8 pages.
Amend claims (Auxiliary Request 7), dated Sep. 25, 2015, 8 pages.
Amend claims (Auxiliary Request 8), dated Sep. 25, 2015, 8 pages.
Amend claims (Auxiliary Request 9), dated Sep. 25, 2015, 8 pages.
Amend claims (Auxiliary Request 11), dated Sep. 25, 2015, 8 pages.
Amend claims (Auxiliary Request 10), dated Sep. 25, 2015, 8 pages.
Acknowledgement of receipt in EP 02709544.7, dated Sep. 25, 2015, 2 pages.
Letter from Boards of Appeal for T2220/14-3.3.08 (Patent proprietor), dated Oct. 1, 2015, 1 page (Stephen, Robert John).
Letter from Boards of Appeal for T2220/14-3.3.08 (Patent proprietor), dated Oct. 1, 2015, 1 page (Potter Clarkson LLP).
Letter from Boards of Appeal for T2220/14-3.3.08 (Patent proprietor), dated Oct. 1, 2015, 1 page (Fritz Lahrtz).
Further to the Submission of Sep. 21, 2015, dated Oct. 1, 2015, 3 pages.
Communication of the Board of Appeal, dated Oct. 2, 2015, 5 pages (Andrew Bentham).
Letter in relation to appeal, dated Oct. 5, 2015, 2 pages.
Letter from Boards of Appeal for T2220/14-3.3.08 (Patent proprietor), dated Oct. 9, 2015, 1 page (Stephen, Robert John).
Letter from Boards of Appeal for T2220/14-3.3.08 (Patent proprietor), dated Oct. 9, 2015, 1 page (Potter Clarkson LLP).
Letter from Boards of Appeal for T2220/14-3.3.08 (Patent proprietor), dated Oct. 9, 2015, 1 page (Fritz Lahrtz).
Letter accompanying subsequently filed items, dated Oct. 12, 2015, 1 page.
Letter from Boards of Appeal for T2220/14-3.3.08 (Opponent 2), dated Oct. 12, 2015, 1 page (Andrew Bentham).

(56) References Cited

OTHER PUBLICATIONS

Letter from Boards of Appeal for T2220/14-3.3.08 (Opponent 2), dated Oct. 12, 2015, 1 page (Potter Clarkson LLP).
Letter from Boards of Appeal for T2220/14-3.3.08 (Opponent 2), dated Oct. 12, 2015, 1 page (Stephen, Robert John).
Letter regarding issue of insufficiency, dated Oct. 9, 2015, 1 page.
Letter in relation to appeal, dated Oct. 12, 2015, 3 pages (Andrew Bentham).
Consolidated document list, dated Oct. 12, 2015, 13 pages.
Acknowledgement of receipt in EP 02709544.7, dated Oct. 12, 2015, 1 page.
Letter regarding Oral Proceedings, dated Oct. 13, 2015, 1 page (Fritz Lahrtz).
Letter from Boards of Appeal for T2220/14-3.3.08 (Opponent 1), dated Oct. 16, 2015, 6 pages (Andrew Bentham).
Letter from Boards of Appeal for T2220/14-3.3.08 (Patent Proprietor), dated Oct. 16, 2015, 6 pages (Stephen, Robert John).
Letter from Boards of Appeal for T2220/14-3.3.08 (Opponent 2), dated Oct. 16, 2015, 1 page (Andrew Bentham).
Letter from Boards of Appeal for T2220/14-3.3.08 (Opponent 2), dated Oct. 16, 2015, 1 page (Potter Clarkson LLP).
Letter from Boards of Appeal for T2220/14-3.3.08 (Opponent 2), dated Oct. 16, 2015, 1 page (Stephen, Robert John).
Letter in relation to Appeal proceedings, dated Oct. 22, 2015, 5 pages.
Notice of electronic filing, dated Oct. 25, 2015, 1 page.
Memorandum decision and order, dated Oct. 25, 2015, 11 pages.
Letter regarding decision in US proceedings, dated Oct. 25, 2015, 2 pages.
Letter from Boards of Appeal for T2220/14-3.3.08 (Opponent 2), dated Oct. 26, 2015, 5 pages (Andrew Bentham).
Letter enclosing 0173 and 0174, dated Oct. 26, 2015, 1 page.
Letter from Boards of Appeal for T2220/14-3.3.08 (Opponent 1), dated Oct. 27, 2015, 1 page (Andrew Bentham).
Letter from Boards of Appeal for T2220/14-3.3.08 (Opponent 1), dated Oct. 27, 2015, 1 page (Potter Clarkson LLP).
Letter from Boards of Appeal for T2220/14-3.3.08 (Opponent 1), dated Oct. 27, 2015, 1 page (Fritz Lahrtz).
Letter from Boards of Appeal for T2220/14-3.3.08 (Patent Proprietor), dated Oct. 28, 2015, 6 pages (Stephen, Robert John).
Letter in relation to appeal, dated Oct. 23, 2015, 3 pages (Andrew Bentham).
Oral proceedings notice, dated Oct. 30, 2015, 1 page.
Acknowledgement of receipt of the document 3011, dated Oct. 30, 2015, 1 page (Potter Clarkson LLP).
Acknowledgement of receipt of the document 3011, dated Oct. 30, 2015, 1 page (Fritz Lahrtz).
Acknowledgement of receipt of the document 3011, dated Oct. 30, 2015, 1 page (Stephen, Robert John).
Opinion and order, dated Nov. 2, 2015, 114 pages.
Letter regarding decision of the court (D175), dated Nov. 3, 2015, 41 pages.
Letter accompanying subsequently filed items, dated Nov. 4, 2015, 1 page (Andrew Bentham).
Summons to oral proceedings pursuant to Rule 115(1) EPC, dated Nov. 4, 2015, 12 pages.
Letter in preparation of the fourth day of oral proceedings, dated Nov. 4, 2015, 6 pages.
Letter regarding amendments, dated Nov. 4, 2015, 2 pages.
First Auxiliary Request, dated Nov. 3, 2015, 2 pages.
Main request, dated Oct. 28, 2015, 4 pages.
New first auxiliary request, dated Nov. 3, 2015, 5 pages.
Acknowledgement of receipt of the document 3011, dated Nov. 4, 2015, 2 pages (Andrew Bentham).
Letter from Boards of Appeal for T2220/14-3.3.08 (Opponent 2), dated Nov. 5, 2015, 5 pages (Andrew Bentham).
Letter from Boards of Appeal for T2220/14-3.3.08 (Patent proprietor), dated Nov. 5, 2015, 6 pages (Stephen, Robert John).
Tracking information, dated Nov. 4, 2015, 1 page.
Acknowledgement of receipt of the document 3011, dated Nov. 5, 2015, 1 page (Fritz Lahrtz).
Letter from Boards of Appeal for T2220/14-3.3.08 (Opponent 2), dated Nov. 6, 2015, 3 pages (Andrew Bentham).
Minutes of oral proceedings, dated Nov. 9, 2015, 11 pages.
Main request, dated Nov. 9, 2015, 5 pages.
Description of EP 1360287, date Nov. 9, 2015, 24 pages.
Advice of delivery, dated Nov. 16, 2015, 2 pages.
Minutes of the oral proceedings, dated Nov. 18, 2015, 4 pages.
Request for correction of minutes, dated Nov. 25, 2015, 2 pages.
Letter from Boards of Appeal for T2220/14-3.3.08 (Opponent 2), dated Dec. 3, 2015, 1 pages (Andrew Bentham).
Letter from Boards of Appeal for T2220/14-3.3.08 (Opponent 2), dated Dec. 3, 2015, 1 page (Potter Clarkson LLP).
Letter from Boards of Appeal for T2220/14-3.3.08 (Opponent 2), dated Dec. 3, 2015, 1 page (Stephen, Robert John).
Communication of the Board of Appeal, dated Dec. 4, 2015, 7 pages.
Datasheet for the decision, dated Nov. 9, 2015, 83 pages.
Decision, dated Mar. 11, 2016, 1 page (Andrew Bentham).
Decision, dated Mar. 11, 2016, 1 page (Potter Clarkson LLP).
Decision, dated Mar. 11, 2016, 1 page (Fritz Lahrtz).
Decision, dated Mar. 11, 2016, 1 page (Stephen, Robert John).
Tracking information, dated Mar. 11, 2016, 1 page (Fritz Lahrtz).
Acknowledgement of receipt of the document 3032, dated Mar. 14, 2016, 1 page (Fritz Lahrtz).
Acknowledgement of receipt of the document 3032, dated Mar. 14, 2016, 1 page (Stephen, Robert John).
Advice of delivery, dated Mar. 16, 2016, 2 pages.
Letter accompanying subsequently filed items, dated Mar. 21, 2016, 1 page (James R Nicholls).
Acknowledgement of receipt of the document 3032, dated Mar. 11, 2016, 1 page (Andrew Bentham).
Acknowledgement of receipt in EP 02709544.7, dated Mar. 21, 2016, 1 page (James Nicholls).
Notification of the communication, dated May 24, 2016, 1 page.
Communication pursuant to Article 101(1) and Rule 81(2) to (3) EPC, dated May 24, 2016, 2 pages (Andrew Bentham).
Application documents, dated May 24, 2016, 1 page.
Request for recordal, dated May 30, 2016, 1 page.
Deed of conversion and amendment of the articles of association, dated May 19, 2016, 53 pages.
Payment of fees and expenses, dated May 30, 2016, 1 page.
Communication of amended entries in register of European patents, dated Jun. 20, 2016, 2 pages (Fritz Lahrtz).
Brief Communication, dated Jun. 20, 2016, 3 pages (Andrew Bentham).
Brief Communication, dated Jun. 20, 2016, 3 pages (Potter Clarkson LLP).
Brief Communication, dated Jun. 20, 2016, 3 pages (Stephen, Robert John).
Submission in opposition proceedings, dated Sep. 19, 2016, 2 pages.
Comments on amendments (opponent 1), dated Sep. 19, 2016, 4 pages.
Response to communication, dated May 24, 2016, 1 page (Robert Stephen).
Acknowledgement of receipt in EP 02709544.7, dated Sep. 19, 2016, 2 pages.
Brief communication, dated Sep. 23, 2016, 1 page (Andrew Bentham).
Brief communication, dated Sep. 23, 2016, 1 page (Fritz Lahrtz).
Brief communication, dated Sep. 23, 2016, 1 page (Potter Clarkson LLP).
Submission in opposition proceedings, dated Sep. 30, 2016, 2 pages (James Nicholls).
Description of U.S. Appl. No. 09/784,859, dated Sep. 30, 2016, 21 pages.
Response to the Communication, dated Sep. 30, 2016, 2 pages.
Acknowledgement of receipt in EP 02709544.7, dated Sep. 30, 2016, 2 pages.
Submission in opposition proceedings, dated Oct. 3, 2016, 1 page (Philip Thomas).
Letter in response to communication, dated Oct. 3, 2016, 1 page (Philip Thomas).

(56) References Cited

OTHER PUBLICATIONS

Acknowledgement of receipt in EP 02709544.7, dated Oct. 3, 2016, 1 page (Rebecca Hamilton).
Brief communication, dated Oct. 7, 2016, 1 page (Stephen, Robert John).
Brief communication (enclosed letter from proprietor of the patent), dated Oct. 7, 2016, 1 page (Fritz Lahrtz).
Brief communication, dated Oct. 7, 2016, 1 page (Potter Clarkson LLP).
Brief communication, dated Oct. 7, 2016, 1 page (Andrew Bentham).
Brief communication (enclosed letter from opponent 3), dated Oct. 7, 2016, 1 page (Stephen, Robert John).
Brief communication (enclosed letter from opponent 3), dated Oct. 7, 2016, 1 page (Fritz Lahrtz).
Communication, dated Oct. 14, 2016, 1 page.
Communication pursuant to Article 101(1) and Rule 82(1) EPC, dated Oct. 14, 2016, 2 pages.
Information of the oral proceedings, dated Oct. 28, 2016, 1 page.
Decision on opposition, dated Sep. 7, 2016, 50 pages.
Abedi et al., "Green fluorescent protein as a scaffold for intracellular presentation of peptides," Nucleic Acids Res (1998) 26(2):623-630.
Abidor et al., "Studies of cell pellets: II. Osmotic properties, electroporation, and related phenomena: membrane interactions," Biophysical Joural (1994) 67:427-435.
Akerstrom et al., "On the interaction between single chain Fv antibodies and bacterial immunoglobulin-binding proteins," J Immunol Methods (1994) 177:151-163.
Alber et al., "Nucleotide sequence of the triose phosphate isomerase gene of *Saccharomyces cerevisiae*," J Mol Appl Genet (1982) 1(5):419-434.
Al-Lazikani et al., "Standard conformations for the Canonical structures of immunoglobulins," J Mol Biol (1997) 273:927-948.
Allen, "Ligand-targeted therapeutics in anticancer therapy," Nat Rev Cancer (2002) 2(10):750-763.
Almagro et al., "Humanization of antibodies," Front Biosci (2008) 13:1619-1633.
Ammerer, "Expression of Genes in Yeast Using the ADCI Promoter," Methods in Enzymology (1983) 101:192-201.
Antica et al., "Thymic Stem Cells in Mouse Bone Marrow," Blood (1994) 84(1):111-117.
Appel et al., "A new generation of information retrieval tools for biologists: the example of the ExPASy WWW server," Trends Biochem Sci (1994) 19(6):258-260.
Approved judgment, dated Feb. 1, 2016, 87 pages.
Arai et al., "Antibody responses induced by immunization with a Japanese rabies vaccine determined by neutralization test and enzyme-linked immunosorbent assay," Vaccine (2002) 20(19-20):2448-2453.
Aramda et al., "Nuclear Hormone Receptors and Gene Expression," Physiol Rev (2001) 81(3):1269-1304.
Arnold et al., "Development of B-1 cells: segregation of phosphatidyl choline-specific B cells to the B-1 population occurs after immunoglobulin gene expression," J Exp Med (1994) 179(5): 1585-1595.
Attaelmannan et al., "Understanding and identifying monoclonal gammopathies," Clin Chem (2000) 46(8 Pt 2):1230-1238.
Atwell et al., "Stable Heterodimers from Remodeling the Domain Interface of a Homodimer using a Phage Display Library," J Mol Biol (1997) 270:26-35.
Aucouturier et al., "Monoclonal Ig L chain and L chain V domain fragment crystallization in myeloma-associated Fanconi's syndrome," J Immunol (1993) 150(8) 3561-3568.
Auerbach et al., "Angiogenesis Assays: A Critical Overview," Clin Chem (2003) 49(1):32-40.
Babcook et al., "A novel strategy for generating monoclonal antibodies from single, isolated lymphocytes producing antibodies of defined specificities," Proc Natl Acad Sci USA (1996) 93:7843-7848.
Banchereau et al., "Long-term human B cell lines dependent on interleukin-4 and antibody to CD40," Science (1991) 251(4989):70-72.
Barbas et al., "Assembly of combinatorial antibody libraries on phage surfaces: The gene III site," Proc Natl Acad Sci U S A (1991) 88(18):7978-7982.
Barnes et al., "Characterization of the Stability of Recombinant Protein Production in the GS-NS0 Expression System," Biotechnol Bioeng (2001) 73(4):261-270.
BD Biosciences, "CD Marker Handbook," (2010) 4 pages.
Bebbington et al., "High-level expression of a recombinant antibody from myeloma cells using a glutamine synthetase gene as an amplifiable selectable marker," Biotechnology (N Y) (1992) 10(2):169-175.
Bell et al., "Insulators and boundaries: versatile regulatory elements in the eukaryotic genome," Science (2001) 291(5503):447-450.
Bengig, "The production of foreign proteins in mammalian cells," Genet Eng (1988) 7:91-127.
Bertagnolli et al., "IL-12 augments antigen-dependent proliferation of activation lymphocytes," J Immunol (1992) 149:3778-3783.
Bertagnolli et al., "IL-4-Supported Induction of Cytolytic T Lymphocytes Requires IL-2 and IL-6," Cell Immunol (1991) 133:327-341.
Bertagnolli et al., "IL-7 supports the generation of cytotoxic T lymphocytes from thymocytes. Multiple lymphokines required for proliferation and cytotoxicity," J Immunol (1990) 145:1706-1712.
Betz et al., "Elements regulating somatic hypermutation of an immunoglobulin kappa gene: critical role for the intron enhancer/matrix attachment region," Cell (1994) 77(2):239-248 (Abstract).
Bhardwaj et al., "Influenza virus-infected dendritic cells stimulate strong proliferative and cytolytic responses from human CD8+ T cells," J Clin Invest (1994) 94(2):797-807.
Bins et al., "A rapid and potent DNA vaccination strategy defined by in vivo monitoring of antigen expression," Nature Medicine (2005) 11(8):899-904.
Binz et al., "Designing Repeat Proteins: Well-expressed, Soluble and Stable Proteins from Combinatorial Libraries of Consensus Ankyrin Repeat Proteins," J Mol Biol (2003) 332:489-503.
Birchmeier et al., "Met, metastasis, motility and more," Nat Rev Mol Cell Biol (2003) 4(12):915-925.
Bitter et al.,"Expression and secretion vectors for yeast," Methods Enzymol (1987) 153:516-544.
Bitter, "Heterologous gene expression in yeast," Methods Enzymol (1987) 152:673-684.
Bode et al., "The Hitchhiking principle: Optimizing episomal vectors for the use in gene therapy and biotechnology," Gene Ther Mol Biol (2001) 6:33-46.
Boder et al., "Yeast surface display for screening combinatorial polypeptide libraries," Nat Biotechnol (1997) 15(6):553-557.
Boel et al., "Functional human monoclonal antibodies of all isotypes constructed from phage display library-derived single-chain Fv antibody fragments," J Immunol Methods (2000) 239(1-2):153-166.
Bowman et al., "The cloning of CD70 and its identification as the ligand for CD27," J Immunol (1994) 152:1756-1761.
Brady et al., "Rapid specific amplification of rat antibody cDNA from nine hybridomas in the presence of myeloma light chains," J Immunol Methods (2006) 315(1-2):61-67.
Brezinsky et al., "A simple method for enriching populations of transfected CHO cells for cells of higher specific productivity," J Immunol Methods (2003) 277(1-2):141-155.
Brink et al., "Developing efficient strategies for the generation of transgenic cattle which produce biopharmaceuticals in milk," Theriogenology (2000) 53(1):139-148.
Broach et al., "Transformation in yeast: development of a hybrid cloning vector and isolation of the CAN1 gene," Gene (1979) 8(1):121-133.
Burger et al., "An integrated strategy for the process development of a recombinant antibody-cytokine fusion protein expressed in BHK cells," Appl Microbiol Biotechnol (1999) 52(3):345-353.
Burioni et al., Nonneutralizing human antibody fragments against hepatitis C virus E2 glycoprotein modulate neutralization of binding activity of human recombinant Fabs, Virology (2001) 288:29-335.
Campbell et al., "Sheep cloned by nuclear transfer from a cultured cell line," Nature (1996) 380(6569):64-66.

(56) References Cited

OTHER PUBLICATIONS

Cao et al., "Neutralizing monoclonal antibodies to hepatocyte growth factor/scatter factor (HGF/SF) display antitumor activity in animal models," Proc Natl Acad Sci U S A (2001) 98(13):7443-7448.
Carmack et al. "Influence of a V kappa 8 L chain transgene on endogenous rearrangements and the immune response to the HA(Sb) determinant on influenza virus," J Immunol (1991) 147(6):2024-2033.
Carter et al. "Humanization of an anti-p185HER2 antibody for human cancer therapy," Proc Natl Acad Sci U S A (1992) 89(10)4285-4289.
Carter, "Bispecific human IgG by design" J Immunol Methods (2001 248(1-2):7-15.
Cascalho et al., "A quasi-monoclonal mouse," Science (1996) 272(5268):1649-1652.
Casellas et al., "Contribution of receptor editing to the antibody repertoire" Science (2001) 291(5508):1541-1544.
Castelli et al., "HLA-DP4, the most frequent HLA II molecule, defines a new supertype of Peptide-binding specificity," J Immunol (2002) 169(12):6928-6934.
Champion et al., "The development of monoclonal human rabies virus-neutralizing antibodies as a substitute for pooled human immune globulin in the prophylactic treatment of rabies virus exposure," J Immunol Methods (2000) 235(1-2):81-90.
Chan et al., "Genomic Organization of the T Cell Receptor," Cancer Detect Prev (1989) 14(2):261-267.
Chao et al., "Isolating and engineering human antibodies using yeast surface display," Nature Protocols (2006) 1(2):755-769.
Chen et al., "Selection and Analysis of an Optimized Anti-VEGF Antibody: Crystal Structure of an Affinity-matured Fab in Complex with Antigen," J Mol Biol (1999) 293(4):865-881.
Cheong et al., "Affinity enhancement of bispecific antibody against two different epitopes in the same antigen," Biochem Biophys Res Commun (1990) 173(3):795-800.
Cherrington et al., "New paradigms for the treatment of cancer: the role of antiangiogenesis agents," Adv Cancer Res (2000) 79:1-38.
Chesnut et al., "Selective isolation of transiently transfected cells from a mammalian cell population with vectors expressing a membrane anchored single-chain antibody," J Immunol Methods (1996) 193(1):17-27.
Cheung et al., "A Recombinant Human Fab Expressed in *Escherichia coli* Neutralizes Rabies Virus," J Virol (1992) 66(11):6714-6720.
Chothia et al., "Canonical Structures for the Hypervariable Regions of Immunoglobulins," J Mol Biol (1987) 196:901-917.
Clackson et al., "Making antibody fragments using phage display libraries," Nature (1991) 352(6336):624-628.
Cobaugh et al., "Synthetic antibody libraries focused towards peptide ligands," J Mol Biol (2008) 378(3):622-633.
Cockett et al., "High level expression of tissue inhibitor of metalloproteinases in Chinese hamster ovary cells using glutamine synthetase gene amplification," Biotechnology (N Y) (1990) 8(7):662-667.
Conn et al., "Purification of a glycoprotein vascular endothelial cell mitogen from a rat glioma-derived cell line," Proc Natl Acad Sci U S A (1990) 87(4):1323-1327.
Conrath et al., "Camel Single-domain Antibodies as Modular Building Units in Bispecific and Bivalent Antibody Constructs," J Biol Chem (2001) 276(10):7346-7350.
Conrath et al., "Emergence and evolution of functional heavy-chain antibodies in Camelidae," Dev Comp Immunol (2003) 27(2):87-103.
Corsaro et al., "Enhancing the Efficiency of DNA-Mediated Gene Transfer in Mammalian Cells," Somatic Cell Genetics (1981) 7(5):603-616.
Crowe, "Recent advances in the study of human antibody responses to influenza virus using optimized human hybridoma approaches," Vaccine (2009) 27S:G47-51.
Cvetkovic et al., "Appropriate Tissue- and Cell-specific Expression of a Single Copy Human Angiotensinogen Transgene Specifically Targeted Upstream of the HPRT Locus by Homologous Recombination," J Biol Chem (2000) 275(2):1073-1078.
Dammacco et al., "Immunoglobulin secretion by peripheral blood and bone marrow B cells in patients with multiple myeloma. Studies by the reverse haemolytic plaque assay," Clin exp Immunol (1984) 87:743-751.
Darzynkiewicz et al., "Features of Apoptotic Cells Measured by Flow Cytometry," Cytometry (1992) 13:795-808.
Davies et al., "Antibody VH Domains as Small Recognition Units," Nature (1995) 13:475-479.
De Chiara et al., "Producing fully ES cell-derived mice from eight-cell stage embryo injections," Methods Enzymol (2010) 476:285-294.
Declaration of Andrew Murphy, dated Dec. 19, 2014, 18 pages.
Declaration of Anthony DeFranco, dated Aug. 24, 2016, 22 pages.
Declaration of Anthony DeFranco, dated Oct. 18, 2015, 31 pages.
Declaration of Christopher Goodnow, dated Oct. 16, 2015, 81 pages.
Declaration of David Tarlinton, dated Oct. 15, 2015, 24 pages.
Declaration of Joel Martin, dated May 18, 2016, 13 pages.
Declaration of John McWhirter, dated Aug. 2, 2016, 4 pages.
Declaration of Peter Hudson, dated Jun. 2, 2015, 7 pages.
Declaration of Peter Hudson, dated May 1, 2015, 52 pages.
Declaration of Robert Brink, dated Jun. 2, 2015, 38 pages.
Declaration of Robert Brink, dated Oct. 19, 2016, 19 pages.
Declaration of Robert Brink, dated Apr. 30, 2015, 34 pages.
Declaration of Ton Logtenberg, dated Sep. 15, 2015, 5 pages.
Second declaration of Ton Logtenberg, dated Dec. 18, 2015, 10 pages.
De Graaf et al., "Expression of scFvs and scFv Fusion Proteins in Eukaryotic Cells," Methods Mol Biol (2002) 178:379-387.
De Kruif et al., "Human immunoglobulin repertoires against tetanus toxoid contain a large and diverse fraction of high-affinity promiscuous V(H) genes," J Mol Biol (2009) 387(3):548-558.
De Kruif et al., "Rapid selection of cell subpopulation-specific human monoclonal antibodies from a synthetic phage antibody library," Proc. Natl. Acad. Sci. USA (1995) 92:3939-3942.
De Kruif et al., "Selection and Application of Human Single Chain Fv Antibody Fragments from a Semi-synthetic Phage Antibody Display Library with Designed CDR3 Regions," J Mol Biol (1995) 248:97-105.
Desmet et al., "Anchor profiles of HLA-specific peptides: analysis by a novel affinity scoring methods and experimental validation," Protein (2005) 58:53-69.
Desmet et al., "Computation of the binding of fully flexible peptides to proteins with flexible side chains," FASEB Journal (2016) 11(2):164-172.
Desmet et al., "Fast and accurate side-chain topology and energy refinement (FASTER) as a new method for protein structure optimization," Protein (2002) 48:31-43.
Desmet et al., "The dead-end elimination theorem and its use in protein side-chain positioning," Nature (1992) 356:539-542.
De Vries et al., "The Effect of Recombinant Mast Cell Growth Factor on Purified Murine Hematopoietic Stem Cells," J Exp Med (1991) 173(5):1205-1211.
De Wildt et al., "Analysis of Heavy and Light Chain Pairings Indicates that Receptor Editing Shapes the Human Antibody Repertoire," J Mol Biol (1999) 285:895-901.
Declaration of Christopher Carl Goodnow, Oct. 4, 2016, 13 pages.
Declaration of Prof Logtenberg, dated May 4, 2016, 7 pages.
Dejong et al., "Mammalian Artificial Chromosome Pilot Production Facility: Large-Scale Isolation of Functional Satellite DNA-Based Artificial Chromosomes," Cytometry (1999) 35:129-133.
Desmyter et al., "Crystal structure of a camel single-domain VH antibody fragment in complex with lysozyme," Nat Struct Biol (1996) 3(9):803-811.
Detailed results for the IMGT/V-QUEST analysed sequences, IMGT, (2016) 7 pages.
Dinnyes et al., "Somatic Cell Nuclear Transfer: Recent Progress and Challenges," Cloning Stem Cells (2002) 4(1):81-90.
Dumoulin et al., "A camelid antibody fragment inhibits the formation of amyloid fibrils by human lysozyme," Nature (2003) 424(6950):783-788.

(56) References Cited

OTHER PUBLICATIONS

Dumoulin et al., "Single-domain antibody fragments with high conformational stability," Protein Sci (2002) 11(3):500-515.
Eggan et al., "Hybrid vigor, fetal overgrowth, and viability of mice derived by nuclear cloning and tetrapioid embryo complementation," PNAS (2001) 98(11):6209-6214.
Esposito et al., "Phage display of a human antibody against *Clostridium tetani* toxin," Gene (1994) 148:167-168.
Ettinger et al., "IL-21 induces differentiation of human naïve and memory B cells into antibody-secreting plasma cells[1]," The Journal of Immunology (2005) 176:7867-7879.
Ewert et al., "Biophysical Properties of Camelid VHH Domains Compared to Those of Human VH3 Domains," Biochemistry (2002) 41:3628-3636.
Ewert et al., "Biophysical properties of human antibody variable domains," J Mol Biol (2003) 325:531-553.
Ezzell, "Molecular guided missiles called monoclonal antibodies were poised to shoot down cancer and a host of other diseases—until they crashed and burned. Now a new generation is soaring to market," Scientific American (2001) pp. 35-41.
Fasta, Immunoglobulin light chain variable region, partial [*Homo sapiens*] (2014) 1 page.
Fecteau et al., "A new memory CD27'IgG+ B cell population in peripheral blood expressing $V_H$ genes with low frequency of somatic mutation[1]," The Journal of Immunology (2006) 177:3728-3736.
Feldhaus et al., "Flow-cytometric isolation of human antibodies from a nonimmune *Saccharomyces cerevisiae* surface display library," Natura Biotechnology (2003) 21:163-170.
Feige et al., "Anti-interleukin-1 and anti-tumor necrosis factor-alpha synergistically inhibit adjuvant arthritis in Lewis rats," Cell Mol Life Sci (2000) 57(10):1457-1470.
Ferrara, "Vascular endothelial growth factor: molecular and biological aspects," Curr Top Microbiol Immunol (1999) 237:1-30.
Figini et al., "In Vitro Assembly of Repertoires of Antibody Chains on the Surface of Phage by Renaturation," J Mol Biol (1994) 239(1):68-78.
Fine et al., "Interleukin-10 Enhances γδ T Cell Development in the Murine Fetal Thymus," Cellular Immunol (1994) 155:111-122.
Fischer, "Sequencing antibody repertoires: The next generation," mAbs (2011) 3:17-20.
Fishwild et al., "High-avidity human IgG kappa monoclonal antibodies from a novel strain of minilocus transgenic mice," Nat Biotechnol (1996) 14(7):845-851.
Flavell et al., "Systemic therapy with 3BIT, a triple combination cocktail of anti-CD19, -CD22, and -CD38-saporin immunotoxins, is curative of human B-cell lymphoma in severe combined immunodeficient mice," Cancer Res (1997) 57(21):4824-4829.
Flavell et al., "Therapy of human T-cell acute lymphoblastic leukaemia with a combination of anti-CD7 and anti-CD38-SAPORIN immunotoxins is significantly better than therapy with each individual immunotoxin," Br J Cancer (2001) 84(4):571-578.
Folkman, "Angiogenesis in cancer, vascular, rheumatoid and other disease," Nat Med (1995) 1(1):27-31.
Franconi et al., "Functional expression in bacteria and plants of an scFv antibody fragment against tospoviruses," Immunotechnology (1999) 4(3-4):189-201.
Freken et al., "Isolation of antigen specific Llama VHH antibody fragments and their high level secretion by *Saccharomyces cerevisiae*," J Biotechnol (2000) 78(1):11-21.
French et al., "Cooperative Mixtures of Bispecific F(ab')2 Antibodies for Delivering Saporin to Lymphoma in Vitro and in Vivo," Cancer Res (1991) 51:2353-2361.
Friedenson et al., "Immunoglobulin G antibodies from an individual rabbit in which several heavy chain variants are paired with one light chain sequence," J Biol Chem (1973) 248(20):7073-7079.
Frykman et al., "Quantitating secretion rates of individual cells: design of secretion assays," Biotechnol Bioeng (1998) 59(2):214-226.
Fuchs et al., "Targeting recombinant antibodies to the surface of *Escherichia coli*: fusion to a peptidoglycan associated lipoprotein," Biotechnology (N Y) (1991) 9(12):1369-1372.
Fussenegger et al., "Genetic optimization of recombinant glycoprotein production by mammalian cells," Trends Biotechnol (1999) 17(1):35-42.
Garber, "Biotech industry faces new bottleneck," Nat Biotechnol (2001) 19:183-185.
Garnick, "Peptide Mapping For Detecting Variants in Protein Products," Develop biol Standard (1992) 76:117-130.
Garrard et al., "Fab assembly and enrichment in a monovalent phage display system," Biotechnology (N Y) (1991) 9(12):1373-1377.
Gascan et al., "Human B cell clones can be induced to proliferate and to switch to IgE and IgG4 synthesis by interleukin 4 and a signal provided by activated CD4+ T cell clones," J Exp Med (1991) 173:747-750.
Ge et al., "Rapid construction and characterization of synthetic antibody libraries without DNA amplification," Biotechnology and Bioengineering (2010) 106(3):347-357.
Genbank, ABA26122.1, dated Dec. 31, 2005, 1 page.
Genbank, DQ187586.1, dated Jul. 26, 2016, 1 page.
Genbank, M87478.1, dated Oct. 28, 1994, 1 page.
Gerstner et al., "Sequence Plasticity in the Antigen-binding Site of a Therapeutic Anti-HER2 Antibody," J Mol Biol (2002) 321:851-862.
Giddings et al., "Transgenic plants as factories for biopharmaceuticals," Nat Biotechnol (2000) 18(11):1151-1155.
Gluzman, "SV40-Transformed Simian Cells Support the Replication of Early SV40 Mutants," Cell (1981) 23:175-I 82.
Gonzalez-Fernandez et al., "Analysis of somatic hypermutation in mouse Peyer's patches using immunoglobulin κ light-chain transgenes," Proc Natl Acad Sci USA (1993) 90:9862-9866.
Good et al., "Kinetics of human B cell behavior and amplification of proliferative responses following stimulation with IL-21," J Immunol (2006) 177:5236-5247.
Gorczyca et al., "DNA strand breaks occurring during apoptosis: Their early in situ detection by the terminal deoxynucleotidyl transferase and nick translation assays and prevention by serine protease inhibitors," Int J Oncol (1992) 1(6):639-648.
Gorczyca et al., "Induction of DNA Strand Breaks Associated with Apoptosis during Treatment of Leukemias," Leukemia (1993) 7(5 ):659-670.
Gorman et al., "Site-specific gene targeting for gene expression in eukaryotes," Curr Opin Biotechnol (2000) 11(5):455-460.
Goyenechea et al., "Modifying the sequence of an immunoglobulin V-gene alters the resulting pattern of hypermutation," Proc Natl Acad Sci USA (1996) 93:13979-13984.
Goyenechea et al., "Cells strongly expressing IgK transgenes show clonal recruitment of hypermutation: a role for both MAR and the enhancers," The EMBO Journal (1997) 16(13):3987-3994.
Graham et al., "A New Technique for the Assay of Infectivity of Human Adenovirus 5 DNA," Virology (1973) 52:456-467.
Gram et al., "In vitro selection and affinity maturation of antibodies from a naive combinatorial immunoglobulin library," Proc. Natl. Acad. Sci. USA (1992) 89:3576-3580.
Graslund et al., "Integrated strategy for selective expanded bed ion-exchange adsorption and site-specific protein processing using gene fusion technology," J Biotechnol (2002) 96(1):93-102.
Gray et al., "Secretion capture and report web: use of affinity derivatized agarose microdroplets for the selection of hybridoma cells," J Immunol Methods (1995) 182(2):155-63.
Greenberger et al., "Demonstration of permanent factor-dependent multipotential (erythroid/neutrophil/basophil) hematopoietic progenitor cell lines," Proc. Natl Acad. Sci. USA (1983) 80:2931-2935.
Griffiths et al., "Human anti-self antibodies with high specificity from phage display libraries," EMBO J (1993) 12(2):725-734.
Griffiths et al., "Isolation of high affinity human antibodies directly from large synthetic repertoires," EMBO J (1994) 13(14):3245-3260.
Groeneveld et al., "Bone morphogenetic proteins in human bone regeneration," Eur J Endocrinol (2000)142(1):9-21.
Grosveld, "Activation by locus control regions?" Curr Opin Genet Dev (1999) 9(2):152-7.

(56) References Cited

OTHER PUBLICATIONS

Guery et al., "Dendritic cells are the most efficient in presenting endogenous naturally processed self-epitopes to class II-restricted T cells," J Immunol (1995) 154(2):536-544.
Guilli et al., "Epidermal growth factor-induced apoptosis in A431 cells can be reversed by reducing the tyrosine kinase activity[1]," Cell Growth and Differentiation (1996) 7:173-178.
Gunasekaran et al., "Enhancing antibody Fc heterodimer formation through electrostatic steering effects," Journal of Biological Chemistry (2010) 285(25):19637-19646 (enclosing supplementary tables and figures).
Hamers-Casterman et al., "Naturally occurring antibodies devoid of light chains," Nature (1993) 363(6428):446-8.
Hanes et al., "Picomolar affinity antibodies from a fully synthetic naive library selected and evolved by ribosome display," Nat Biotechnol (2000) 18(12):1287-92.
Hanes et al., "Selecting and evolving functional proteins in vitro by ribosome display," Methods Enzymol (2000) 328:404-430.
Harding et al., "The immunogenicity of humanize and fully human antibodies," mAbs (2010) 2:3:256-265.
Hardy et al., "B cell development pathways," Annu Rev Immunol (2001) 19:595-621.
Harjunpaa et al., "Rituximab (Anti-CD20) Therapy of B-Cell Lymphomas: Direct Complement Killing is Superiorto Cellular Effector Mechanisms," Scand J Immunol (2000) 51(6):634-41.
Harvey et al., "Anchored periplasmic expression, a versatile technology for the isolation of high-affinity antibodies from *Escherichia coli*-expressed libraries," PNAS (2004) 101(25):9193-9198.
Hawkins et al., "Selection of Phage Antibodies by Binding Affinity Mimicking Affinity Maturation," J Mol Biol (1992) 226:889-896.
Hay et al., "Bacteriophage cloning and *Escherichia coli* expression of a human IgM Fab," Hum Antibod Hybridomas (1992) 3:81-85.
Heintges et al., "Cloning, bacterial expression and sequencing of human antibody fragments against hepatitis Virus NS3 by Phage display of a combinatorial Phagemid Library," Hepatology (1998) 28(4 Pt 2):227A.
Hengstchlager et al., "AA1 transgene underthe control of a heavy chain promoter and enhancer does not undergo somatic hypermutation," Eur J Immunol (1994) 24:1649-1656.
Hiatt et al., "Production of antibodies in transgenic plants," Nature (1989) 342(6245):76-8.
Hitzeman et al., "Isolation and Characterization of the Yeast 3-Phosphoglycerokinase Gene (PGK) by an Immunological Screening Technique" J Biol Chem (1980) 255(24):12073-12080.
Hochedlinger et al., "Monoclonal mice generated by nuclear transfer from mature B and T donor cells," Nature (2002) 415:1035-1038.
Holliger et al., ""Diabodies": Small bivalent and bispecific antibody fragments," Proc. Natl. Acad. Sci. USA (1993) 90:6444-6448.
Holmes et al., "Improved cell line development by a high throughput affinity capture surface display technique to select for high secretors," J Immunol Methods (1999) 230(1-2):141-147.
Holt et al., "Domain antibodies: proteins for Therapy," Trends Biotechnol (2003) 21(11):484-490.
Homig-Holzel et al., "Constitutive CD40 signaling in B cells selectively activates the noncanonical NF-κB pathway and promotes lymphomagenesis," J Exp Med (2008) 205(6):1317-1329.
Hoogenboom et al., "Antibody phage display technology and its applications," Immunotechnology (1998) 4(1):1-20.
Hoogenboom et al., "By-passing immunisation. Human antibodies from synthetic repertoires of germline VH gene segments rearranged in vitro," J Mol Biol (1992) 227(2):381-388.
Hoogenboom et al., "Multi-subunit proteins on the surface of filamentous phage: methodologies for displaying antibody (Fab) heavy and light chains," Nucleic Acids Research (1991) 19(15):4133-4137.
Hoogenboom et al., "Natural and designer binding sites made by phage display technology," Immunol Today (2000) 21(8):371-378.
Hoogenboom, "Designing and optimizing library selection strategies for generating high-affinity antibodies," Trends Biotechnol (1997) 15(2):62-70.
Hoogenboom, "Selecting and screening recombinant antibody libraries," Nature Biotechnology (2005) 23(9):1105-1116.
Hooper, "Rabies Virus," Manual of Clinical Laboratory Immunology (1997) 5:755-760.
Houshmand et al., "Use of bacteriophage T7 displayed peptides for determination of monoclonal antibody specificity and biosensor analysis of the binding reaction," Anal Biochem (1999) 268(2):363-370.
Houston JR et al., "Use of a Conformationally Restricted Secondary Structural Element to Display Peptide Libraries: A Two-stranded α-Helical Coiled-coil Stabilized by Lactam Bridges," J Mol Biol (1996) 262:270-282.
Huang et al., "Role of Bone Marrow-Derived Cells in Presenting MHC Class I-Restricted Tumor Antigens," Science (1994) 264:961-965.
Hudziak et al., "p185$^{HER2}$ Monoclonal Antibody Has Antiproliferative Effects In Vitro and Sensitizes Human Breast Tumor Cells to Tumor Necrosis Factor," Mol Cell Biol (1989) 9(3):1165-1172.
Huls et al., "A recombinant, fully human monoclonal antibody with antitumor activity constructed from phage-displayed antibody fragments," Nat Biotechnol (1999) 17(3):276-281.
Huls et al., "Antitumor Immune Effector Mechanisms Recruited by Phage Display-derived Fully Human IgG1 and IgA1 Monoclonal Antibodies," (1999) Cancer Res 59:1778-5784.
Huse et al., "Generation of a Large Combinatorial Library of the Immunoglobulin Repertoire in Phage Lambda," Science (1989) 246(4935):1275-1281.
Huse et al., "Purification of antibodies by affinity chromatography," J Biochem Biophys Methods (2002) 51:217-231.
Hwang et al., "Immunogenicity of engineered antibodies," Methods (2005) 36:3-10.
Hynes, "Cell adhesion: old and new questions," Trends Cell Biol (1999) 9(12):M33-M37.
Inaba et al., "Dendritic Cells Pulsed with Protein Antigens In Vitro Can Prime Antigen-specific, MHC-restricted T Cells In Situ," J Exp Med (1990) 172:631-640.
Inaba et al., "Distinct Mechanisms of Neonatal Tolerance Induced by Dendritic Cells and Thymic B Cells," J Exp Med (1991) 173:549-559.
Important information regarding oral proceedings, dated Jul. 16, 2014, 3 pages.
Inlay et al., "Essential roles of the κ light chain intronic enhancer and 3' enhancer in κ rearrangement and demethylation," Nature Immunology (2002) 3-5:463-468.
Inlay et al., "Roles of the Ig κ light chain intronic and 3' enhancers in IgK somatic hypermutation," Journal of Immunology (2006) 177:1146-1151.
Ishii et al., "TANK-binding kinase-1 delineates innate and adaptive immune responses to DNA vaccines," Nature (2008) 451:725-730.
Itoh et al., "The Polypeptide Encoded by the cDNA for Human Cell Surface Antigen Fas Can Mediate Apoptosis," Cell (1991) 66:233-243.
Jacob et al., "Activity of DNA vaccines encoding self or heterologous Her-2/neu in Her-2 or neu transgenic mice," Cellular Immunology (2006) 240:96-106.
Jacob et al., "Combining human and rat sequences in Her-2 DNA vaccines blunts immune tolerance and drives antitumor immunity," Cancer Research (2010) Cancer Res 70(1):119-128.
Jain et al., "Engineering antibodies for clinical applications," Trends in Biotechnology (2007) 25(7):309-316.
Jakobovits et al., "Analysis of homozygous mutant chimeric mice: Deletion of the immunoglobulin heavy-chain joining region blocks B-cell development and antibody production," Proc Natl Acad Sci USA (1993) 90:2551-2555.
Jakobovits et al., "From XenoMouse technology to panitumumab, the first fully human antibody product from transgenic mice," Nat Biotechnol (2007) 25(10):1134-1143.
Jakobovits et al., "Germ-line transmission and expression of a human-derived yeast artificial chromosome," Nature (1993) 362(6417):255-258.

(56) References Cited

OTHER PUBLICATIONS

Janeway, "Immuno biology the immune system in health and disease," 4th edition (1999) 21 pages.
Janeway, "The development and survival of lymphocytes," pp. 275-290.
Janeway's immunology, "Antigen presentation to T lymphocytes," (2012) 31 pages.
Jechlinger, "Optimization and delivery of plasmid DNA for vaccination," Expert Rev Vaccines (2006) 5(6):803-825.
Jeffers et al., "Enhanced Tumorigenicity and Invasion-Metastasis by Hepatocyte Growth Factor/Scatter Factor-Met Signalling in Human Cells Concomitant with Induction of the Urokinase Proteolysis Network," Mol Cell Biol (1996) 16(3):1115-1125.
Jespers et al., "Guiding the selection of human antibodies from phage display repertoires to a single epitope of an antigen," Biotechnology (N Y) (1994) 12(9):899-903.
Jiang et al., "A novel strategy for generation of monoclonal antibodies from single B cells using RT-RCR technique and in vitro expression," Biotechnol Prog (2006) 22(4):979-988.
Jin et al., "A rapid and efficient single-cell manipulation method for screening antigen-specific antibody-secreting cells from human peripheral blood," Nature Medicine (2009) 15(9):1088-1093.
Johansson et al., "Evidence for Involvement of Activin A and Bone Morphogenetic Protein 4 in Mammalian Mesoderm and Hematopoietic Development," Mol Cell Biol (1995) 15(1):141-151.
Jolly et al., "Rapid methods for the analysis of immunoglobulin gene hypermutation: application to transgenic and gene targeted mice," Nucleic Acids Research (1997) 25(10):1913-1919.
Jonasson et al., "Genetic design for facilitated production and recovery of recombinant proteins in *Escherichia coli*," Biotechnol Appl Biochem (2002) 35:91-105.
Jones et al., "High Level Expression of Recombinant IgG in the Human Cell Line PER.C6," Biotechnol Prog (2003) 19:163-168.
Kang et al., "Linkage of recognition and replication functions by assembling combinatorial antibody Fab libraries along phage surfaces," Proc Natl Acad Sci USA (1991) 88:4363-4366.
Kakitani et al., "A novel transgenic chimaeric mouse system for the rapid functional evaluation of genes encoding secreted proteins," Nucleic Acids Research (2005) 33(9):e85 8 pages.
Kasprzyk et al., "Therapy of an Animal Model of Human Gastric Cancer Using a Combination of Anti-erbB-2 Monoclonal Antibodies," Cancer Res (1992) 52:2771-2776.
Kato et al., "Cell activation by CpG ODN leads to improved electrofusion in hybridoma production," J Immunological Methods (2011) 373:102-110.
Kaufman et al., "Amplification and Expression of Sequences Cotransfected with a Modular Dihydrofolate Reductase Complementary DNA Gene," J Mol Biol (1982) 159:601-621.
Kaufman, "Overview of Vector Design for Mammalian Gene Expression," Mol Biotechnol (2000) 16(2):151-160.
Keller et al., "Hematopoietic Commitment during Embryonic Stem Cell Differentiation in Culture," Mol Cell Biol (1993) 13(1): 473-486.
Kelley et al., "Antigen binding thermodynamics and antiproliferative effects of chimeric and humanized anti-p185HER2 antibody Fab fragments," Biochemistry (1992) 31(24):5434-541.
Kim et al., "Characterization of chimeric antibody producing CHO cells in the course of dihydrofolate reductase-mediated gene amplification and their stability in the absence of selective pressure," Biotechnol Bioeng (1998) 58(1):73-84.
Kim et al., "Comparative analyses of complex formation and binding sites between human tumor necrosis factor-alpha and its three antagonists elucidate their different neutralizing mechanisms," J Mol Biol (2007) 374:1374-1388.
Kim et al., "Subspecialization of CXCR5+ T Cells: B helper activity is focused in a germinal center-localized subset of CXCR5+ T cells," J Exp Med (2001) 193(12):1373-1381.
Klagsbrun et al., "Vascular endothelial growth factor and its receptors," Cytokine Growth Factor Rev (1996) 7(3):259-270.
Kling et al., "Big Pharma vies for mice," Nature Biotechnology (2007) 25:613-614.
Klitz et al., "New HLA haplotype frequency reference standards: High-resolution and large sample typing of HLA DR-DQ haplotypes in a sample of European Americans," Tissue Antigens (2003) 62:296-307.
Klohn et al., "IBC's 23rd annual antibody engineering, 10th annual antibody therapeutics international conferences and the 2012 annual meeting of the antibody society," mAbs (2013) 5(2):178-201.
Klotz et al., "Somatic hypermutation of a $\lambda_2$ transgene under the control of the λ enhancer or the heavy chain intron enhancer[1]," Journal of Immunology (1996) 157:4458-4463.
Klotz et al., "Somatic hypermutation of an artificial test substrate within an IgK transgene[1]," The Journal of Immunology (1998) 161:782-790.
Kohler et al., "Continuous cultures of fused cells secreting antibody of predefined specificity," Nature (1975) 256:495-497.
Kong et al., "A λ 3' enhancer drives active and untemplated somatic hypermutation of a $\lambda_1$ transgene[1]," The Journal of Immunology (1998) 161:294-301.
Koide et al., "The Fibronectin Type III Domain as a Scaffold for Novel Binding Proteins," J Mol Biol (1998) 284:1141-1151.
Kontermann, "Dual targeting strategies with bispecific antibodies," MAbs (2012) 4(2):182-97.
Koochekpour et al., "Met and Hepatocyte Growth Factor/Scatter Factor Expression in Human Gliomas," Cancer Res (1997) 57:5391-5398.
Koopman et al., "Annexin V for Flow Cytometric Detection of Phosphatidylserine Expression on B Cells Undergoing Apoptosis," Blood (1994) 84(5):1415-1420.
Korndorfer et al., "Crystallographic analysis of an "anticalin" with tailored specificity for fluorescein reveals high structural plasticity of the lipocalin loop region," Proteins (2003) 53(1):121-129.
Korndorfer et al., "Structural Mechanism of Specific Ligand Recognition by a Lipocalin Tailored for the Complexation of Digoxigenin," J Mol Biol (2003) 330:385-396.
Kortt et al., "Dimeric and trimeric antibodies: high avidity scFvs for cancer targeting," Biomol Eng (2001) 18(3):95-108.
Kramer et al., "A novel helper phage that improves phage display selection efficiency by preventing the amplification of phages without recombinant protein," Nucleuic Acids Research (2003) 31(11):e59.
Krebs et al., "High-throughput generation and engineering of recombinant human antibodies," J Immunol Methods (2001) 254(1-2):67-84.
Krosen et al., "Bispecific antibodies for treatment of cancer in experimental animal models and man," Advanced Drug Delivery Reviews (1998) 31:105-129.
Kruse et al., "Tissue Culture, Methods and Applications," Academic Press, New York (1973) p. 868.
Ku et al., "Alternate protein frameworks for molecular recognition," Proc Natl Acad Sci USA (1995) 92:6552-6556.
Kuhlman et al., "Design of a Novel Globular Protein Fold with Atomic-Level Accuracy," Science (2003) 302:1364-1368.
Kunkel et al., "Rapid and efficient site-specific mutagenesis without phenotypic selection," Proc Natl Acad Sci USA (1985) 82:488-492.
Kwakkenbos et al., "Generation of stable monoclonal antibody-producing BCR+ human memory B cells by genetic programming," Nat Med (2010) 16(1):123-128.
Kwaks et al., "Employing epigenetics to augment the expression of the therapeutic proteins in mammalian cells," Trends in Biotechnology (2006) 24(3):137-142.
Kwaks et al., "Identification of anti-repressor elements that confer high and stable protein production in mammalian cells," Nat Biotechnol (2003) 21(5):553-558.
Lang et al., "Immunotherapy with Human Monoclonal Antibodies," J Immunol (1993) 151(1):466-472.
Larbouret et al., "In vivo therapeutic synergism of anti-epidermal growth factor receptor and anti-HER2 monoclonal antibodies against pancreatic carcinomas," Clin Cancer Res (2007) 13(11):3356-3362.
Larrick et al., "Producing proteins in transgenic plants and animals," Curr Opin Biotechnol (2001) 12(4):411-418.

(56) References Cited

OTHER PUBLICATIONS

Lazar et al., "A molecular immunology approach to antibody humanization and functional optimization," Molecular Immunology (2007) 44:1986-1998.
Lefranc et al., "Nomenclature of the human immunoglobulin kappa (IGK) genes," Exp Clin Immunogenet (2001) 18:161-174.
Lekkerkerker et al., "Phage antibodies against human dendritic cell subpopulations obtained by flow cytometry-based selection on freshly isolated cells," J Immunol Methods (1999) 231(1-2):53-63.
Lenz et al., "Expression of heterobispecific antibodies by genes transfected into producer hybridoma cells," Gene (1990) 87(2):213-218.
Li et al., "Stable expression of three genes from a tricistronic retroviral vector containing a picornavirus and 9-nt cellular internal ribosome entry site elements," J Virol Methods (2004) 115(2):137-144.
Lie et al., "Advances in quantitative PCR technology: 5' nuclease assays," Current Opinion in Biotechnology (1998) 9:43-48.
Lindhofer et al., "Preferential species-restricted heavy/light chain pairing in rat/mouse quadromas. Implications for a single-step purification of bispecific antibodies," J Immunol (1995) 55(1):219-225.
Ling et al., "Modulation of the murine immune response to human IgG by complexing with monoclonal antibodies," Immunology (1987) 62:1-6.
Little et al., "Human antibody libraries in *Escherichia coli*," J Biotechnol (1995) 41(2-3):187-195.
Little, "Recombinant Antibodies For Immunotherapy," Cambridge University Press (2009) 1st edition, 21 pages.
Lobato et al., "Intracellular antibodies and challenges facing their use as therapeutic agents," Trends Mol Med (2003) 9(9):390-396.
Lofgren et al., "Comparing ELISA and surface plasmon resonance for assessing clinical immunogenicity of panitumumab," The Journal of Immunology (2007) 178:7467-7472.
Logtenberg, "Antibody cocktails: next-generation biopharmaceuticals with improved potency," Trends Biotechnol (2007) 25(9):390-394.
Lonberg et al., "Antigen-specific human antibodies from mice comprising four distinct genetic modifications," Nature (1994) 368:856-859.
Lonberg, "Human antibodies from transgenic animals," Nature Biotechnology (2005) 23(9):1117-1125.
Lonberg, "Fully human antibodies from transgenic mouse and phage display platforms," Curr Opin Immunol (2008) 20(4):450-459.
Love et al., "A microengraving method for rapid selection of single cells producing antigen-specific antibodies," Nature Biotechnology (2006) 24(6):703-707.
Lu et al., "Acquired antagonistic activity of a bispecific diabody directed against two different epitopes on vascular endothelial growth factor receptor 2," J Immunol Methods (1999) 230(1-2):159-171.
Lu et al., "Complete Inhibition of Vascular Endothelial Growth Factor (VEGF) Activities with a Bifunctional Diabody Directed against Both VEGF Kinase Receptors, fms-like Tyrosine Kinase Receptor and Kinase Insert Domain-containing Receptor," Cancer Res (2001) 61:7002-7008.
Lu et al., "Identification of the Residues in the Extracellular Region of KDR Important for Interaction with Vascular Endothelial Growth Factor and Neutralizing Anti-KDR Antibodies," J Biol Chem (2000) 275(19):14321-14330.
Lu et al., "Selection Of High Affinity Human Neutralizing Antibodies To VEGFR2 From A Large Antibody Phage Display Library For Antiangiogenesis Therapy," Int. J. Cancer (2002) 97:393-399.
Lucas et al., "High-level production of recombinant proteins in CHO cells using a dicistronic DHFR intron expression vector," Nucleic Acids Res (1996) 24(9):1774-1779.
Ma et al., "Assembly of monoclonal antibodies with IgGI and IgA heavy chain domains in transgenic tobacco plants," Eur J Immunol (1994) 24:131-138.
Macatonia et al., "Dendritic cells produce IL-12 and direct the development of Th1 cells from naive CD4+ T cells," J Immunol (1995) 154(10):5071-5079.
Macatonia et al., "Primary stimulation by dendritic cells induces antiviral proliferative and cytotoxic T cell responses in vitro," J Exp Med (1989) 169(4):1255-1264.
Macdonald et al., "Precise and in situ genetic humanization of 6 Mb of mouse immunoglobulin genes," Proc Natl Acad Sci U S A (2014) 111(14):5147-5152.
Macejak et al., "Internal initiation of translation mediated by the 5' leader of a cellular mRNA," Nature (1991) 353(6339):90-94.
Manen et al., "A sensitive reporter gene system using bacterial luciferase based on a series of plasmid cloning vectors compatible with derivatives of pBR322," Gene (1997) 186:197-200.
Manz et al., "Maintenance of serum antibody levels," Annu Rev Immunol (2005) 23:367-286.
Mao et al., "Activation of EGFP expression by cre-mediated excision in a new ROSA26 reporter mouse strain," Blood (2001) 97(1):324-326.
Marasco, "Intrabodies as antiviral agents," Curr Top Microbiol Immunol (2001) 260:247-270.
Marks et al., "By-passing Immunization Human Antibodies from V-gene Libraries Displayed on Phage," J Mol Biol (1991) 222:581-597.
Marks, "Deciphering antibody properties that lead to potent botulinum neurotoxin neutralization," Mov Disord (2004) 19(Suppl 8):S101-S108.
Marvin et al., "Recombinant approaches to IgG-like bispecific antibodies," Acta Pharmacol Sin (2005) 26(6):649-658.
Massengale et al., "CD20-negative relapse of cutaneous B-cell lymphoma after anti-CD20 monoclonal antibody therapy," J Am Acad Dermatol (2002) 46(3):441-443.
Matsuda et al., "The Complete Nucleotide Sequence of the Human Immunoglobulin Heavy Chain Variable Region Locus," J Exp Med (1998) 188(11):2151-2162.
Mattheakis et al., "An in vitro polysome display system for identifying ligands from very large peptide libraries," Proc Natl Acad Sci U S A (1994) 91:9022-9026.
Mayer, "A new set of useful cloning and expression vectors derived from pBlueScript," Gene (1995) 163(1):41-46.
Mcburney et al., "Evidence for Repeat-Induced Gene Silencing in Cultured Mammalian Cells: Inactivation of Tandem Repeats of Transfected Genes," Exp Cell Res (2002) 274(1):1-8.
Mccafferty et al., "Antibody engineering," (1996) Oxford University Press 178 pages.
Mcclanahan et al., "Hematopoietic Growth Factor Receptor Genes as Markers of Lineage Commitment During In Vitro Development of Hematopoietic Cells," Blood (1993) 81(11):2903-2915.
Mcconnell et al., "Tendamistat as a Scaffold for Conformationally Constrained Phage Peptide Libraries," J Mol Biol (1995) 250:460-470.
Mcginnes et al., "B-Lineage colonies from normal, human bone marrow are initiated by B cells and their progenitors," Blood (1991) 77(5):961-970.
Meijer et al., "Isolation of human antibody repertoires with preservation of the natural heavy and light chain pairing," J Mol Biol (2006) 358:764-772.
Mendel et al., "The Angiogenesis Inhibitor SU5416 Has Long-lasting Effects on Vascular Endothelial Growth Factor Receptor Phosphorylation and Function," Clin Cancer Res (2000) 6:4848-4858.
Merchant et al., "An efficient route to human bispecific IgG," Nat Biotechnol (1998) 16(7):677-681.
Merus prior art P61090-/P6498-/P67824, dated Jul. 12, 2016, 4 pages.
Merus prior art P61090-/P6498-/P67824, dated Oct. 18, 2016, 39 pages.
Merus prior art P85261, dated Jul. 19, 2016, 4 pages.
Merus prior art P85261, dated Oct. 21, 2016, 17 pages.
Merus prior art P99390, dated Sep. 30, 2016, 9 pages.
Meyer et al., "The importance of the 3'-enhancer region in immunoglobulin κ gene expression," Nucleic Acids Research (1990) 18(19):5609-5615.

(56) References Cited

OTHER PUBLICATIONS

Meyer et al., "The IgK 3'-enhancer triggers gene expression in early B lymphocytes but its activity is enhanced on B cell activation," International Immunology (1996) 8(10):1561-1568.
Middendorp et al., "Cellular maturation defects in Bruton's tyrosine kinase-deficient immature B cells are amplified by premature B cell receptor expression and reduced by receptor editing[1]," The Journal of Immunology (2004) 172:1371-1379.
Middendorp et al., "Impaired precursor cell differentiation in Bruton's tyrosine kinase-deficient mice[1]," The Journal of Immunology (2002) 168:2695-2703.
Mirick et al., A review of human anti-globulin antibody (HAGA, HAMA, HACA, HAHA) responses to monoclonal antibodies not four letter words, QJ Nucl Med Mol Imaging (2004) 48:251-257.
Mohapatra et al., "Designer monoclonal antibodies as drugs: the state of the art," Expert Rev Clin Immunol (2008) 4(3):305-307.
Morimoto et al., "High level expression of a human rabies virus-neutralizing monoclonal antibody by a rhabdovirus-based vector," J Immunol Methods (2001) 252(1-2):199-206 (Abstract).
Morrison, "Transfectomas Provide Novel Chimeric Antibodies," Science (1985) 229(4719):1202-1207.
Mostoslavsky et al., "Asynchronous replication and allelic exclusion in the immune system," Nature (2001) 414:221-225.
Murakami et al., "Splenic $CD19^{-}cd35^{+}B220^{+}$ cells function as an inducer of follicular dendritic cell network formation," Blood (2007) 110(4):1215-1224.
Muyldermans, "Single domain camel antibodies: current status," J Biotechnol (2001) 74(4):277-302.
Nahta et al., "The HER-2-Targeting Antibodies Trastuzumab and Pertuzumab Synergistically Inhibit the Survival of Breast Cancer Cells," Cancer Res (2004) 64:2343-2346.
Nair et al., "Induction of Primary, Antiviral Cytotoxic, and Proliferative Responses with Antigens Administered via Dendritic Cells," J Virol (1993) 67(7):4062-4069.
Nanbru et al., "Alternative Translation of the Proto-oncogene c-myc by an Internal Ribosome Entry Site," J Biol Chem (1997) 272(51):32061-32066.
Nelson et al., "Development trends for human monoclonal antibody therapeutics," Nat Rev Drug Discov (2010) 9(10):767-774.
Nemazee, "Receptor Editing in B Cells," Advances in Immunology (2000)74:89-126.
Nemazee, "Receptor editing in lymphocyte development and central tolerance," Nat Rev Immunol (2006) 6(10):728-740.
Neufeld et al., "Vascular endothelial growth factor (VEGF) and its receptors," FASEB J (1999) 13(1):9-22.
Ngo et al., "Identification of functional synergism between monoclonal antibodies. Application to the enhancement of plasminogen activator inhibitor-1 neutralizing effects," FEBS (1997) 416:373-376.
Nicholson et al., "Antibody repertoires of four- and five-feature translocus mice carrying human immunoglobulin heavy chain and kappa and lambda light chain yeast artificial chromosomes," J Immunol (1999) 163(12):6898-6906.
Nikolic et al., "A subtraction of $B220^{+}$ cells in murine bone marrow and spleen does not belong to the B cell lineage but has dendritic cell characteristics," Eur J Immunol (2002) 32:686-692.
Nissim et al., "Antibody fragments from a 'single pot' phage display library as immunochemical reagents," EMBO J (1994) 13(3):692-698.
Nord et al., "A combinatorial library of an a-helical bacterial receptor domain," Protein Engineering (1995) 8(6):601-608.
Nord et al., "Recombinant human factor VIII-specific affinity ligands selected from phage-displayed combinatorial libraries of protein A," Eur J Biochem (2001) 268:4269-4277.
Norderhaug et al., "Balanced expression of single subunits in a multisubunit protein, achieved by cell fusion of individual transfectants," Eur J Biochem (2002) 269:3205-3210.
Novimmune SA, "Therapeutic Bispecific Antibodies, The Fully-Human Kappa-Lambda Body: Simple, Stable, Smart," (2013) 2 pages.
Novobrantseva et al., "Rearrangement and expression of immunoglobulin light chain genes can precede heavy chain expression during normal B cell development in mice," J Exp Med (1999) 189(1):75-87.
Nowakowski et al., "Potent neutralization of botulinum neurotoxin by recombinant oligoclonal antibody," Proc Natl Acad Sci U S A (2002) 99(17):11346-11350.
Nuemann et al., "Gene transfer into mouse lyoma cells by electroporation in high electric fields," EMBO J (1982) 1(7):841-845.
O'Brien et al., "Somatic hypermutation of an immunoglobulin transgene in κ transgenic mice," Nature (1987) 326:405-409.
Odegard et al., "Targeting of somatic hypermutation," Nat Rev Immunol (2006) 6(8):573-583.
Ogunniyi et al., "Screening individual hybridomas by microengraving to discover monoclonal antibodies," Nature Protocols (2009) 4(5):767-782.
Oh et al., "Homeotic gene Antennapedia mRNA contains 5'-noncoding sequences that confer translational initiation by internal ribosome binding," Genes Dev (1992) 6(9):1643-1653.
Opposition against European Patent in EP 2314629 from Merus B.V., filed May 18, 2013, 13 pages.
Orban et al., "Tissue- and site-specific DNA recombination in transgenic mice," Proc Natl Acad Sci USA (1992) 89:6861-6865.
Padlan, "A possible procedure for reducing the immunogenicity of antibody variable domains while preserving their ligand-binding properties," Molecular Immunology (1991) 28(4-5):489-498.
Pasqualucci et al., "BCL-6 mutations in normal germinal center B cells: Evidence of somatic hypermutation acting outside Ig loci," Proc Natl Acad Sci USA (1998) 95:11816-11821.
Patel et al., "An improved assay for antibody dependent cellular cytotoxicity based on time resolved fluorometry," J Immunol Methods (1995)184(1):29-38.
Pau et al., "The human cell line PER.C6 provides a new manufacturing system for the production of influenza vaccines," Vaccines (2001) 19:2716-2721.
Peeters et al., "Production of Antibodies and Antibody Fragments in Plants," Vaccine (2001) 19 (17-19):2756-2761.
Pelanda et al., "A prematurely expressed IgK transgene, but not a VkJk gene segment targeted into the IgK locus, can rescue B cell development in λ5-deficient mice," Immunity (1996) 5:229-239.
Peled et al., "The biochemistry of somatic hypermutation," Annu Rev Immunol (2008) 26:481-511.
Perrin et al., "In vitro rabies vaccine potency appraisal by ELISA: advantages of the immunocapture method with a neutralizing anti-glycoprotein monoclonal antibody," Biologicals. (1990) 18(4):321-330.
Persic et al., "An integrated vector system for the eukaryotic expression of antibodies or their fragments after selection from phage display libraries," Gene (1997) 187(1):9-18.
Persson et al., "A focused antibody library for improved hapten recognition," J Mol Biol (2006) 357:607-620.
Phan et al., "High affinity germinal center B cells are actively selected into the plasma cell compartment," J Exp Med (2006) 203(11):2419-2424.
Phelps et al., "Expression and characterization of a chimeric bifunctional antibody with therapeutic applications," J Immunol (1990) 145(4):1200-1204.
Pluckthun et al., "In vitro selection and evolution of proteins," Adv Protein Chem (2000) 55:367-403.
Ponsel et al., "High Affinity, developability and functional size: the holy grail of combinatorial antibody library generation," Molecules (2011) 16:3675-3700.
Pollock et al., "Transgenic milk as a method for the production of recombinant antibodies," J Immunol Methods (1999) 231(1-2):147-157.
Popov et al., "A human immunoglobulin λ locus is similarly well expressed in mice and humans," J Exp Med (1999) 189(10):1611-1619.
Porgador et al., "Bone Marrow-generated Dendritic Cells Pulsed with a Class I-restricted Peptide Are Potent Inducers of Cytotoxic T Lymphocytes," J Exp Med (1995) 182(1): 255-260.

(56) References Cited

OTHER PUBLICATIONS

Poulsen et al., "Limits for antibody affinity maturation and repertoire diversification in hypervaccinated humans," The Journal of Immunology (2011) 187:4229-4235.
Prak et al., "Light chain replacement: A new model for antibody gene rearrangement," J Exp Med (1995) 182:541-548.
Presta et al., "Engineering of therapeutic antibodies to minimize immunogenicity and optimize function," Advanced Drug Delivery Reviews (2006) 58:640-656.
Queen et al., "A humanized antibody that binds to the interleukin 2 receptor," Proc Natl Acad Sci USA (1989) 86:10029-10033.
Radic et al., "Ig H and L chain contributions to autoimmune specificities," J Immunol (1991) 146(1):176-182.
Rajewsky et al., "Perspectives series: molecular medicine in genetically engineered animals," J Clin Invest (1996) 98(3):600-603.
Ravn et al., "By-passing in vitro screening-next generation sequencing technologies applied to antibody display and in silico candidate selection," Necleic Acids Research (2010) 38(21):e193.
Rebar et al., "Phage display methods for selecting zinc finger proteins with novel DNA-binding specificities," Methods Enzymol (1996) 267:129-149.
Reddy et al., "Monoclonal antibodies isolated without screening by analyzing the variable-gene repertoire of plasma cells," Nature Biotechnology (2010) 28(9):965-971.
Reddy et al., "Systems analysis of adaptive immunity by utilization of high-throughput technologies," Current Opinion in Biotechnology (2011) 22:584-589.
Rees et al., "Bicistronic Vector for the Creation of Stable Mammalian Cell Lines that Predisposes All Antibiotic-Resistant Cells to Express Recombinant Protein," BioTechniques (1996) 20:102-110.
Reiter et al., "An Antibody Single-domain Phage Display Library of a Native Heavy Chain Variable Region: Isolation of Functional Single-domain VH Molecules with a Unique Interface," J Mol Biol (1999) 290:685-698.
Repp et al., "Phase I clinical trial of the bispecific antibody MDX-H210 (anti-FcgammaRI x anti-HER-2/neu) in combination with Filgrastim (G-CSF) for treatment of advanced breast cancer," Br J Cancer (2003) 89(12):2234-2243.
Retter et al., "Receptor editing occurs frequently during normal B cell development," J Exp Med (1998) 188(7):1231-1238.
Retter et al., "Receptor editing: genetic reprogramming of autoreactive lymphocytes," Cell Biochemistry and Biophysics (1999) 31:81-88.
Riechmann et al., "Novel folded protein domains generated by combinatorial shuffling of polypeptide segments," Proc Natl Acad Sci U S A (2000) 97(18):10068-10073.
Rickert et al., "B lymphocyte-specific, cre-mediated mutagenesis in mice," Nucleic Acids Research (1997) 25(6):1317-1318.
Ritchie et al., "Allelic exclusion and control of endogenous immunoglobulin gene rearrangement in kappa transgenic mice," Nature (1984) 312(5994):517-520.
Roberts et al., "RNA-peptide fusions for the in vitro selection of peptides and proteins," Proc Natl Acad Sci USA (1997) 94:12297-12302.
Roholt et al., "Antibodies of limited heterogeneity: L chains of a single mobility," Immunochemistry (1970) 7(4):329-340.
Roitt et al., "Anti-idiotypes as surrogate antigens: structural considerations," Immunol Today (1985) 6(9):265-267.
Roitt, Immunology translation, (2000) 3 pages.
Rojas et al., "Phage antibody fragments library combining a single human light chain variable region with immune mouse heavy chain variable regions," J Biotechnol (2002) 94(3):287-298.
Rong et al., "Tumorigenesis induced by coexpression of human hepatocyte growth factor and the human met protooncogene leads to high levels of expression of the ligand and receptor," Cell Growth Differ (1993) 4(7):563-569.
Rong et al., "Tumorigenicity of the met Proto-Oncogene and the Gene for Hepatocyte Growth Factor," Mol Cell Biol (1992) 12(11):5152-5158.
Rosenberg et al., "T7Select® Phage Display System: A powerful new protein display System based on bacteriophage T7," (1996) 7 pages.
Rottgen et al., "A human pancreatic secretory trypsin inhibitor presenting a hypervariable highly constrained epitope via monovalent phagemid display," Gene (1995) 164:243-250.
Ruuls et al., "Novel human antibody therapeutics: The age of the Umabs," Biotechnol journal (2008) 3:1157-1171.
Sanger et al., "DNA sequencing with chain-terminating inhibitors," Proc Natl Acad Sci USA (1977) 74(12):5463-5467.
Santini et al., "Efficient Display of an HCV cDNA Expression Library as C-terminal Fusion to the Capsid Protein D of Bacteriophage Lambda," J Mol Biol (1998) 282:125-135.
Sasaki et al., "Canonical NF-κB activity, dispensable for B cell development, replaces BAFF-receptor signals and promotes B cell proliferation upon activation," Immunity (2006) 24:729-739.
Schaffitzel et al., "In Vitro Selection and Evolution of Protein-Ligand Interactions by Ribosome Display" Protein-Ligand Interactions and Ribosome Display (2001) 27:517-548.
Schaffitzel et al., "Ribosome display: an in vitro method for selection and evolution of antibodies from libraries," J Immunol Methods (1999) 231(1-2):119-135.
Schmidlin et al., "New insights in the regulation of human B cell differentiation," Trends Immunol (2009) 30(6):277-285.
Schlehuber et al., "Tuning ligand affinity, specificity, and folding stability of an engineered lipocalin variant—a so-called 'anticalin'—using a molecular random approach," Biophys Chem (2002) 96(2-3):213-328.
Schmitz et al., "Phage Display: A Molecular Tool for the Generation of Antibodies—A Review," Placenta (2000) 21(A):S106-112.
Schnieke et al., "Human factor IX transgenic sheep produced by transfer of nuclei from transfected fetal fibroblasts," Science (1997) 278(5346):2130-2133.
Schoonjans et al., "A new model for intermediate molecular weight recombinant bispecific and trispecific antibodies by efficient heterodimerization of single chain variable domains through fusion to a Fab-chain," Biomol Eng (2001) 17(6):193-202.
Scott, "Mice with a human touch," Nat Biotechnol (2007) 25(10):1075-1077.
Segal et al., "Introduction: bispecific antibodies," J Immunol Methods (2001) 248(1-2):1-6.
Seibler et al., "Rapid generation of inducible mouse mutants," Nucleic Acids Research (2003) 31(4):e12.
Shaffer et al., "In vivo occupancy of the κ light chain enhancer in primary pro- and pre-B cells: A model for κ locus activation," Immunity (1997) 6:131-143.
Sharpe et al., "Somatic hypermutation of immunoglobulin ϰ may depend on sequences 3' of Cϰ and occurs on passenger transgenes," The EMBO Journal (1991) 10(8):2139-2145.
Shapiro-Shelef et al., "Regulation of plasma-cell development," Nature Review Immunol (2005) 5:230-242.
Shields et al., "High resolution mapping of the binding site on human IgGI for Fc gamma RI, Fc gamma RII, Fc gamma RIII, and FcRn and design of IgGI variants with improved binding to the Fc gamma R," J Biol Chem (2001) 276(9):6591-6604.
Shvarts et al., "A senescence rescue screen identifies BCL6 as an inhibitor of anti-proliferative $p19^{ARF}$-P53 signaling," Genes & Development (2002) 16:681-686.
Sidhu et al., "Phage-displayed antibody libraries of synthetic heavy chain complementarity determining regions," J Mol Biol (2004) 338(2):299-310.
Simmons et al., "Expression of full-length immunoglobulins in *Escherichia coli*: rapid and efficient production of aglycosylated antibodies," J Immunol Methods (2002) 263(1-2):133-147.
Singer, "Genes & Genomes: A changing perspective," University Sceince Books (1991) pp. 134-145.
Sirac et al., "Light chain inclusion permits terminal B cell differentiation and does not necessarily result in autoreactivity," PNAS (2006) 103(20):7747-7752.
Sirac et al., "Role of the monoclonal κ chain V domain and reversibility of renal damage in a transgenic model of acquired Fanconi syndrome," Blood (2006) 108:536-543.

(56) References Cited

OTHER PUBLICATIONS

Sirac et al., "Toward understanding renal fanconi syndrome: step by step advances through experimental models," Contrib Nephrol (2011) 169:247-261.
Sjolander et al., "Integrated Fluid Handling System for Biomolecular Interaction Analysis," Anal Chem (1991) 63:2338-2345.
Skerra. "'Anticalins': a new class of engineered ligand-binding proteins with antibody-like properties," J Biotechnol (2001) 74(4):257-275.
Smith et al., "A novel, native-format bispecific antibody triggering T-cell killing of B-cells is robustly active in mouse tumor models and cynomolgus monkeys," Sci Rep (2015) 5:17943.
Smith et al., "Characterization of a murine lymphokine distinct from interleukin 2 and interleukin 3 (IL-3) possessing a T-cell growth factor activity and a mast-cell growth factor activity that synergizes with IL-3," Proc Natl Acad Sci USA (1986) 83:1857-1861.
Smith et al., "Small Binding Proteins Selected from a Combinatorial Repertoire of Knottins Displayed on Phage," J Mol Biol (1998) 277:317-332.
Smith et al., "Rapid generation of fully human monoclonal antibodies specific to a vaccinating antigen," Nature Protocols (2009) 4(3):372-385.
Smith-Gill et al., "Contributions of immunoglobulin heavy and light chains to antibody specificity for lysozyme and two haptens[1]," J Immunol (1987) 139:4135-4144.
Soriano, "Generalized IacZ expression with the ROSA26 cre reporter strain," Nature Genetics (1999) 21:70-71.
Spillner et al., "Paratope-based protein identification by antibody and peptide phage display," Anal Biochem (2003) 321(1):96-104.
Spiridon et al., "Targeting multiple Her-2 epitopes with monoclonal antibodies results in improved antigrowth activity of a human breast cancer cell line in vitro and in vivo," Clin Cancer Res (2002) 8(6):1720-1730.
M70120EPEIN opposition documents (P22), dated Jun. 21, 2016, 108 pages.
Srinivas et al., "Cre reporter strains produced by targeted insertion of EYFP and ECFP into the ROSA26 locus," BMC Developmental Biology (2001) 1:4 8 pages.
Stein et al., "Translation of vascular endothelial growth factor mRNA by internal ribosome entry: implications for translation under hypoxia," Mol Cell Biol (1998) 18(6):3112-3119.
Stevens, "Human Antibody Discovery, VelocImmune—A novel platform," Pharma Focus Asia (2008) 8:72-74.
Stevenson et al., "DNA vaccines to attack cancer," PNAS (2004) 101(sup 2):14646-14652.
Stijlemans et al., "Efficient Targeting of Conserved Cryptic Epitopes of Infectious Agents by Single Domain Antibodies," J Biol Chem (2004) 279(2):1256-1261.
Stoneley et al., "C-Myc 5' untranslated region contains an internal ribosome entry segment," Oncogene (1998) 16, 423-428.
Storb et al., "Transgenic mice with μ and κ genes encoding antiphosphorylcholine antibodies," J Exp Med (1986) 164:627-641.
Storb et al., "Immunoglobulin transgenes as targets for somatic hypermutation," Int J Dev Biol (1998) 42:977-982.
Story et al., "Profiling antibody responses by multiparametric analysis of primary B cells," PNAS (2008) 105(46):17902-17907.
Strelkauskas et al., "Human monoclonal antibody: 2. Simultaneous expression of IgG and IgM with similar binding specificities by a human hybrid done," Hybridoma (1987) 6(5):479-487.
Struhl et al., "High-frequency transformation of yeast: Autonomous replication of hybrid DNA molecules," Proc Natl Acad Sci USA (1979) 76( 3):1035-1039.
Szabo et al., "Surface plasmon resonance and its use in biomolecular interaction analysis (BIA)," Curr Opin Struct Biol (1995) 5(5):699-705.
Tada et al., "Expression and characterization of a chimeric bispecific antibody against fibrin and against urokinase-type plasminogen activator," J Biotechnol (1994) 33(2):157-174.
Tajiri et al., "Cell-microarray analysis of antigen-specific B-cells: single cell analysis of antigen receptor expression and specificity," Cytometry (2007) 71A:961-967.
Takahashi et al., "Role of thrombospondin-1 in hypoxia-induced migration of human vascular smooth muscle cells," Yakugaku Zasshi (2008) 128(3):377-383 (English abstract included).
Takai et al., "B cell stimulatory factor-2 is involved in the differentiation of cytotoxic T lymphocytes," J Immunol (1988) 140(2):508-512.
Takai et al., "Requirement for three distinct lymphokines for the induction of cytotoxic T lymphocytes from thymocytes," J Immunol (1986) 137(11):3494-3500.
Tan et al., "Superhumanized" Antibodies: Reduction of immunogenic potential by complementarity-determining region grafting with human germline sequences: Application to anti-CD28[1], The Journal of Immunology (2002) 169:1119-1125.
Tanaka et al., "De novo production of diverse intracellular antibody libraries," Nucleic Acids Res (2003) 31(5):e23.
Tanha et al., "Selection by phage display of llama conventional $V_H$ fragments with heavy chain antibody $V_H$H properties," J Immunol Methods (2002) 263:97-109.
Taylor et al., "A transgenic mouse that expresses a diversity of human sequence heavy and light chain immunoglobulins," Nucleic Acids Research (1992) 20(23):6287-6295.
Thiebe et al., "The variable genes and gene families of the mouse immunoglobulin ϰ locus," Eur J Immunol (1999) 29:2072-2081.
Thomassen et al., "Large-scale production of $V_{HH}$ antibody fragments by *Saccharomyces cerevisiae*," Enzyme and Microbial Technology (2002) 30:273-278.
Thotakura et al., "Glycoprotein hormones: glycobiology of gonadotrophins, thyrotrophin and free α subunit," Glycoblology (1995) 5(1):3-10.
Throbsy et al., "Isolation and characterization of human monoclonal antibodies from individuals infected with west nile virus §," Journal of Virology (2006) 80(14):6982-6992.
Tiller et al., "Efficient generation of monoclonal antibodies from single human B cells by single cell RT-PCR and expression vector cloning," Journal of Immunological Methods (2008) 329:112-124.
Toki et al., "Analyses of T-cell differentiation from hemopoietic stem cells in the $G_0$ phase by an in vitro method," Proc Natl Acad Sci USA (1991) 88:7548-7551.
Tokimitsu et al., "Single lymphocyte analysis with a Microwell array chip," Cytometry (2007) 71A:1003-1010.
Torres et al., "Laboratory protocols for conditional gene targeting," Oxford University Press (1997) 15 pages.
Traggai et al., "An efficient method to make human monoclonal antibodies from memory B cells: potent neutralization of SARS coronavirus," Nature Medicine (2004) 10(8):871-875.
Transue et al., "Camel single-domain antibody inhibits enzyme by mimicking carbohydrate substrate," Proteins (1998) 32(4):515-522.
Urlaub et al., "Isolation of Chinese hamster cell mutants deficient in dihydrofolate reductase activity," Proc Natl Acad Sci USA (1980) 77(7): 4216-4220.
Vagner et al., "Alternative Translation of Human Fibroblast Growth Factor 2 mRNA Occurs by Internal Entry of Ribosomes," Mol Cell Biol (1995) 15(1): 35-44.
Vajdos et al., "Comprehensive functional maps of the antigen-binding site of an anti-ErbB2 antibody obtained with shotgun scanning mutagenesis," J Mol Biol (2002) 320(2):415-428.
Valenzuela et al., "High-throughput engineering of the mouse genome coupled with high-resolution expression analysis," Nat Biotechnol (2003) 21(6):652-659.
Van Den Berg, "Formulation and delivery of dermal DNA vaccines," Gildeprint Drukkerijen B.V (2009) 160 pages.
Van Den Beunken et al., "Building Novel Binding Ligands to B7.1 and B7.2 Based on Human Antibody Single Variable Light Chain Domains," J Mol Biol (2001) 310:591-601.
Van Der Heijden et al., "Structural and functional studies on a unique linear neutralizing antigenic site (G5) of the rabies virus glycoprotein," J Gen Virol (1993) 74(Pt 8):1539-1545.
Van Der Vuurst De Vries et al., "Dissecting the human peripheral B-cell compartment with phage display-derived antibodies," Immunology (1999) 98:55-62.

(56) References Cited

OTHER PUBLICATIONS

Vaughan et al., "Human antibodies with sub-nanomolar affinities isolated from a large nonimmunized phage display library," Nat Biotechnol (1996) 14(3):309-314.
Verma et al., "Antibody engineering: Comparison of bacterial, yeast, insect and mammalian expression systems," J Immunol Methods (1998) 216:165-181.
Wang et al., "A T cell-independent antitumor response in mice with bone marrow cells retrovirally transduced with an antibody/Fc-gamma chain chimeric receptor gene recognizing a human ovarian cancer antigen," Nat Med (1998) 4(2):168-172.
Ward et al., "Binding activities of a repertoire of single immunoglobulin variable domains secreted from *Escherichia coli*," Nature (1989) 341:544-546.
Warnaar et al., "Purification of Bispecific F(ab')2 from Murine Trinoma OC/TR with Specificity for CD3 and Ovarian Cancer," Hybridoma (1994) 13(6):519-526.
Weeratna et al., "CPG ODN allows lower dose of antigen against hepatitis B surface antigen in BALB/c mice," Immunology and Cell Biology (2003) 81:59-62.
Weinberger et al., "Cellular interactions in the generation of cytolytic T lymphocyte responses: Role of Ia-positive splenic adherent cells in presentation of H-2 antigen," Proc Natl Acad Sci USA (1980) 77(10):6091-6095.
Weinberger et al., "Cellular interactions in the generation of cytolytic T lymphocyte responses. Analysis of the helper T cell pathway," Eur J Immunol (1981) 11(5):405-411.
Weiner et al., "Fully human therapeutic monoclonal antibodies," J Immunother (2006) 29(1):1-9.
Wen et al., "Tricistronic viral vectors co-expressing interleukin-12 (1L-12) and CD80 (B7-1) for the immunotherapy of cancer: Preclinical studies in myeloma," Cancer Gene Ther (2001) 8(5):361-370.
Whittington et al., "DNA vaccination controls Her-$2^+$ tumors that are refractory to targeted therapies," Cancer Res (2008) 68(18):7502-7511.
Wigler et al., "Biochemical Transfer of Single-Copy Eucaryotic Genes Using Total Cellular DNA as Donor," Cell (1978) 14:725-731.
Wilmut et al., "Basic techniques for transgenesis," J Reprod Fertil Suppl (1991) 43:265-275.
Wilmut et al., "Viable offspring derived from fetal and adult mammalian cells," Nature (1997) 385(6619):810-813.
Winter et al., "Insertion of 2 KB of bacteriophage DNA between an immunoglobulin promoter and leader exon stops somatic hypermutation in a κ transgene," Molecular Immunology (1997) 34(5):359-366.
Wrammert et al., "Rapid cloning of high-affinity human monoclonal antibodies against influenza virus," Nature (2008) 453:667-672.
Wright et al., "Effect of glycosylation on antibody function: implications for genetic engineering," Trends Biotechnol (1997) 15(1):26-32.
Wu et al., "Simultaneous targeting of multiple disease mediators by a dual-variable-domain immunoglobulin," Nature Biotechnology (2007) 25(11):1290-1297.
Wunderlich et al., "Generation of inducible Cre systems for conditional gene inactivation in mice," der Universitat zu Koln (2004) 413 pages.
X59315 Annotation, "IMGT/LIGM-DB sequence," (2016) 13 pages.
Xiang et al., "The downstream transcriptional enhancer, Ed, positively regulates mouse IgK gene expression and somatic hypermutation[1]," The Journal of Immunology(2008) 180:6725-6732.
Yang et al., "Control of gene conversion and somatic hypermutation by immunoglobulin promoter and enhancer sequences," J Exp Med (2006) 203(13):2919-2928.
Yarlin, "Fundamentals of Immunology," Meditsina (1999) 2 pages.
Ye et al., "Ultrabithorax and Antennapedia 5' Untranslated Regions Promote Developmentally Regulated Internal Translation Initiation," Mol Cell Biol (1997) 17(3):1714-1721.
Yelverton et al., "Rabies virus glycoprotein analogs: biosynthesis in *Escherichia coli*," Science (1983) 219(4585):614-620.
Yu et al., "An optimized electrofusion-based protocol for generating virus-specific human monoclonal antibodies," Journal of Immunological Methods (2008) 336:142-151.
Yoo et al., "Structural Requirements for Polymeric Immunoglobulin Assembly and Association with J Chain," J Biol Chem (1999) 274(47): 33771-33777.
Yoshio-Hoshino et al., "Establishment of a new interleukin-6 (IL-6) receptor inhibitor applicable to the gene therapy for IL-6-dependent tumor," Cancer Res (2007) 67(3):871-875.
Zacharchuk et al., "Programmed T lymphocyte death. Cell activation- and steroid-induced pathways are mutually antagonistic," J Immunol (1990) 145(12):4037-4045.
Zamai et al., "Optimal Detection of Apoptosis by Flow Cytometry Depends on Cell Morphology," Cytometry (1993)14:891-897.
Zhan-Zabel et al., "Development of stable cell lines for production or regulated expression using matrix attachment regions," J Biotech (2001) 87:29-42.
Zhu et al., "Inhibition of tumor growth and metastasis by targeting tumor-associated angiogenesis with antagonists to the receptors of vascular endothelial growth factor," Invest New Drugs (1999) 17(3):195-212.
Zhu et al., "Inhibition of Vascular Endothelial Growth Factor-induced Receptor Activation with Anti-Kinase Insert Domain-containing Receptor Single-Chain Antibodies from a Phage Display Library," Cancer Res (1998) 58:3209-3214.
Zhu et al., "Remodeling domain interfaces to enhance heterodimer formation," Protein Science (1997) 6:781-788.
Zou et al., "Generation of mouse strain that produces immunoglobulin κ chains with human constant regions," Science (1993) 262:1271-1274.
Zubler et al., "Theoretical and practical aspects of B-cells activation: murine and human systems," Immunological Reviews (1987) 99:281-299.
Abstract of Japanese patent application 2006109711, dated Apr. 27, 2006, 1 page.
First witness statement of Andrew Joseph Murphy, dated Oct. 2, 2015, 19 pages.
Mazor et al., "Isolation of engineered, full-length antibodies from libraries expressed in *Escherichia coli*," Nature Biotechnology (2007) 25(5):563-565.
Documents cited in opposition to Merus B.V. AU application No. 2009263082 by Regeneron Pharmaceuticals, Inc, dated Oct. 10, 2016, 5 pages.
Opposition against Japanese Patent application 5749161, dated Jan. 15, 2016, 55 pages.
Notice of Reasons for Revocation for JP 5749161, dated Mar. 17, 2016, 8 pages.
Third party observations under article 115 EPC against European Parent Application No. 09075279.1 in the name of Merus BV, dated Apr. 25, 2012, 6 pages.
Third party observation against European Parent Application No. 09075279.1 in the name of Merus BV, dated Aug. 28, 2013, 11 pages.
Patent Oppositions Application No. 2009263082, dated May 4, 2015, 3 pages.
Information sheet for submitted publications for JP Application No. 2011-516168, dated Apr. 25, 2012, 3 pages.
Patent applicant's outline of submissions for Australian patent application 2009263082, dated Sep. 6, 2016, 49 pages.
Australian opposition procedure, dated Jun. 27, 2014, 1 page.
Communication pursuant to Rule 114(2) EPC, dated Nov. 5, 2012, 7 pages.
Notification of material filed under section 27, dated Apr. 1, 2014, 1 page.
Content of Arguments, dated Jun. 21, 2016, 25 pages.
Documents regarding Opposition (Declaration of Peter Hudson and Robert Brink), dated Jun. 2, 2015, 1 page.
Opponent's final supplementary submissions, dated Oct. 19, 2016, 4 pages.
Declaration of Christopher Goodnow, dated Oct. 16, 2016, 13 pages.
Opponent's initial supplementary submissions, dated Oct. 5, 2016, 7 pages.

(56) References Cited

OTHER PUBLICATIONS

Letter enclosing written submissions and fee, dated May 18, 2015, 1 page.
M70120EPEIN opposition documents (P1), dated Jun. 21, 2016, 80 pages.
M70120EPEIN opposition documents (P2), dated Jun. 21, 2016, 61 pages.
M70120EPEIN opposition documents (P3), dated Jun. 21, 2016, 71 pages.
M70120EPEIN opposition documents (P4), dated Jun. 21, 2016, 80 pages.
M70120EPEIN opposition documents (P5), dated Jun. 21, 2016, 100 pages.
M70120EPEIN opposition documents (P6), dated Jun. 21, 2016, 100 pages.
M70120EPEIN opposition documents (P7), dated Jun. 21, 2016, 60 pages.
M70120EPEIN opposition documents (P8), dated Jun. 21, 2016, 60 pages.
M70120EPEIN opposition documents (P9), dated Jun. 21, 2016, 60 pages.
M70120EPEIN opposition documents (P10), dated Jun. 21, 2016, 60 pages.
M70120EPEIN opposition documents (P11), dated Jun. 21, 2016, 60 pages.
M70120EPEIN opposition documents (P12), dated Jun. 21, 2016, 100 pages.
M70120EPEIN opposition documents (P13), dated Jun. 21, 2016, 100 pages.
M70120EPEIN opposition documents (P14), dated Jun. 21, 2016, 100 pages.
M70120EPEIN opposition documents (P15), dated Jun. 21, 2016, 100 pages.
M70120EPEIN opposition documents (P16), dated Jun. 21, 2016, 80 pages.
M70120EPEIN opposition documents (P17), dated Jun. 21, 2016, 70 pages.
M70120EPEIN opposition documents (P18), dated Jun. 21, 2016, 70 pages.
M70120EPEIN opposition documents (P19), dated Jun. 21, 2016, 100 pages.
M70120EPEIN opposition documents (P20), dated Jun. 21, 2016, 100 pages.
M70120EPEIN opposition documents (P21), dated Jun. 21, 2016, 80 pages.
M70120EPEIN Proprietor documents (P1), dated Jul. 27, 2016, 100 pages.
M70120EPEIN Proprietor documents (P2), dated Jul. 27, 2016, 100 pages.
M70120EPEIN Proprietor documents (P3), dated Jul. 27, 2016, 80 pages.
M70120EPEIN Proprietor documents (P4), dated Jul. 27, 2016, 57 pages.
M70120EPEIN Proprietor EPA document, dated Jan. 12, 2016, 51 pages.
M70121EPEIN Oppo EPA (P1), dated Jul. 27, 2016, 60 pages.
M70121EPEIN Oppo EPA (P2), dated Jul. 27, 2016, 60 pages.
M70121EPEIN Oppo EPA (P3), dated Jul. 27, 2016, 50 pages.
M70121EPEIN Oppo EPA (P4), dated Jul. 27, 2016, 60 pages.
M70121EPEIN Oppo EPA (P5), dated Jul. 27, 2016, 80 pages.
M70121EPEIN Oppo EPA (P6), dated Jul. 27, 2016, 90 pages.
M70121EPEIN Oppo EPA (P7), dated Jul. 27, 2016, 100 pages.
M70121EPEIN Oppo EPA (P8), dated Jul. 27, 2016, 80 pages.
M70121EPEIN Oppo EPA (P9), dated Jul. 27, 2016, 100 pages.
M70121EPEIN Oppo EPA (P10), dated Jul. 27, 2016, 120 pages.
M70121EPEIN Oppo EPA (P11), dated Jul. 27, 2016, 100 pages.
M70121EPEIN Oppo EPA (P12), dated Jul. 27, 2016, 60 pages.
M70121EPEIN Oppo EPA (P13), dated Jul. 27, 2016, 59 pages.
M70121EPEIN Proprietor document (P1), dated Aug. 31, 2016, 100 pages.
M70121EPEIN Proprietor document (P2), dated Aug. 31, 2016, 80 pages.
M70121EPEIN Proprietor document (P3), dated Aug. 31, 2016, 60 pages.
M70121EPEIN Proprietor document (P4), dated Aug. 31, 2016, 60 pages.
M70121EPEIN Proprietor document (P5), dated Aug. 31, 2016, 100 pages.
M70121EPEIN Proprietor document (P6), dated Aug. 31, 2016, 100 pages.
M70121EPEIN Proprietor document (P7), dated Aug. 31, 2016, 80 pages.
M70121EPEIN Proprietor document (P8), dated Aug. 31, 2016, 80 pages.
M70121EPEIN Proprietor document (P9), dated Aug. 31, 2016, 90 pages.
M70121EPEIN Proprietor document (P10), dated Aug. 31, 2016, 70 pages.
M70121EPEIN Proprietor document (P11), dated Aug. 31, 2016, 58 pages.
Canada Office Action for CA 2,729,095, dated Nov. 10, 2015, 8 pages.
Response to Office Action for CA 2,729,095, dated May 10, 2016, 12 pages.
Documents to CA Patent Office, Sep. 16, 2015, 15 pages.
Voluntary Amendment, dated May 12, 2016, 2 pages.
M70121PCEPT1 documents(PI), dated Aug. 8, 2016, 100 pages.
M70121PCEPT1documents (P2), dated Aug. 8, 2016, 100 pages.
M70121PCEPT1 documents (P3), dated Aug. 8, 2016, 100 pages.
M70121PCEPT1 documents (P4), dated Aug. 8, 2016, 100 pages.
M70121PCEPT1 documents (P5), dated Aug. 8, 2016, 100 pages.
M70121PCEPT1 documents (P6), dated Aug. 8, 2016, 90 pages.
Roitt et al., "Really Essential Medical Immunology," Blackwell Science (2000) 17 pages.
Response to Communication, dated Sep. 29, 2014, 7 pages.
Declaration of Peter Hudson, dated Jun. 17, 2016, 15 pages.
Non-final Office Action for JP 2015-097258, dated Apr. 11, 2016, 7 pages.
Communication of notices of opposition (R. 79(1) EPC), dated Sep. 25, 2014, 1 page.
Notice of Opposition, dated Jun. 20, 2014, 1 page.
Notification for JP 2011-516168, dated May 20, 2014, 1 page.
Third Party Observations, dated Jun. 27, 2013, 16 pages.
Third Party Observations, dated May 16, 2013, 82 pages.
Letter regarding Notice of Opposition, dated Jun. 23, 2014, 1 page.
Opponent counterargument, dated Aug. 22, 2016, 19 pages.
Canada Office Action for CA 2,729,095, dated Apr. 16, 2014, 1 page (Protest section 10).
Canada Office Action for CA 2,729,095, dated Apr. 16, 2014, 1 page (Letter).
Correspondence from Canadian Patent Office, dated Apr. 8, 2014, 16 pages.
Correspondence from Canadian Patent Office, dated Sep. 16, 2015, 15 pages.
Statement of Grounds and Particulars, dated Sep. 22, 2014, 35 pages.
Information in EP 09075279.1, dated Oct. 28, 2016, 1 page.
Communication of a notice of opposition, dated Aug. 20, 2014, 1 page.
Response to Communication under Rule 79(1) EPC, dated Apr. 2, 2015, 32 pages.
Opposition against EP 2147594, dated Aug. 11, 2014, 55 pages.
Annexure PH-4 (P1), dated Jul. 13, 2009, 37 pages.
Annexure PH-4 (P2), dated Jul. 13, 2009, 37 pages.
Carrion et al., "Light chain inclusion permits terminal B cell differentiation and does not necessarily result in autoreactivity," PANS (2006) 103(20):7747-7752.
Patent applicant's outline of submissions, dated Sep. 16, 2016, 15 pages.
Letter regarding new prior art documents, dated Mar. 18, 2014, 8 pages.
Notification of Material filed under Section 27, dated Oct. 28, 2013, 25 pages.

(56) References Cited

OTHER PUBLICATIONS

Summary of submissions on behalf of Merus B.V, dated May 18, 2015, 6 pages.
Third party observation, dated May 9, 2014, 14 pages.
Communication pursuant to Rule 114(2) EPC, dated Oct. 10, 2013, 4 pages.
Office Action for U.S. Appl. No. 15/140,321, dated Sep. 2, 2016, 58 pages.
Translation of the pertinent portions of the Action, dated 2016, 11 pages.
Payment of fees and expenses, dated Nov. 10, 2016, 1 page.
Notice of Opposition in EP 2701499, dated Nov. 10, 2016, 27 pages.
Extension of time limit pursuant to Rule 132 EPC, dated Jul. 5, 2016, 6 pages.
Communication of further notices of opposition pursuant to Rule 79(2) EPC, dated Jun. 29, 2016, 1 page (Fritz Lahrtz).
Notice of Opposition in EP 2501817, dated May 25, 2016, 28 pages.
Payment of fees and expenses, dated May 25, 2016, 1 page.
Annex in EP 14163642.3, dated Jan. 29, 2016, 3 pages.
Third party observation for application EP 20120783456, dated Jun. 16, 2016, 3 pages.
Joint Stipulation and Proposed order of invalidity and non-infringement of U.S. Pat. No. 8,502,018, dated Feb. 24, 2015, 7 pages.
Documents filed by proprietor during opposition, dated Aug. 26, 2016, 8 pages.
Communication of further notices of opposition pursuant to Rule 79(2) EPC, dated Aug. 23, 2016, 100 pages (P1).
Communication of further notices of opposition pursuant to Rule 79(2) EPC, dated Aug. 23, 2016, 100 pages (P2).
Communication of further notices of opposition pursuant to Rule 79(2) EPC, dated Aug. 23, 2016, 100 pages (P3).
Communication of further notices of opposition pursuant to Rule 79(2) EPC, dated Aug. 23, 2016, 100 pages (P4).
Communication of further notices of opposition pursuant to Rule 79(2) EPC, dated Aug. 23, 2016, 120 pages (P5).
Communication of further notices of opposition pursuant to Rule 79(2) EPC, dated Aug. 23, 2016, 100 pages (P6).
Communication of further notices of opposition pursuant to Rule 79(2) EPC, dated Aug. 23, 2016, 100 pages (P7).
Communication of further notices of opposition pursuant to Rule 79(2) EPC, dated Aug. 23, 2016, 80 pages (P8).
Communication of further notices of opposition pursuant to Rule 79(2) EPC, dated Aug. 23, 2016, 80 pages (P9).
Communication of further notices of opposition pursuant to Rule 79(2) EPC, dated Aug. 23, 2016, 70 pages (P10).
Communication of further notices of opposition pursuant to Rule 79(2) EPC, dated Aug. 23, 2016, 100 pages (P11).
Communication of further notices of opposition pursuant to Rule 79(2) EPC, dated Aug. 23, 2016, 150 pages (P12).
Communication of further notices of opposition pursuant to Rule 79(2) EPC, dated Aug. 23, 2016, 150 pages (P13).
Communication of further notices of opposition pursuant to Rule 79(2) EPC, dated Aug. 23, 2016, 150 pages (P14).
Communication of further notices of opposition pursuant to Rule 79(2) EPC, dated Aug. 23, 2016, 100 pages (P15).
Communication of further notices of opposition pursuant to Rule 79(2) EPC, dated Aug. 23, 2016, 100 pages (P16).
Communication of further notices of opposition pursuant to Rule 79(2) EPC, dated Aug. 23, 2016, 50 pages (P17).
Communication of further notices of opposition pursuant to Rule 79(2) EPC, dated Aug. 23, 2016, 50 pages (P18).
Communication of further notices of opposition pursuant to Rule 79(2) EPC, dated Aug. 23, 2016, 50 pages (P19).
Communication of further notices of opposition pursuant to Rule 79(2) EPC, dated Aug. 23, 2016, 50 pages (P20).
Communication of further notices of opposition pursuant to Rule 79(2) EPC, dated Aug. 23, 2016, 100 pages (P21).
Communication of further notices of opposition pursuant to Rule 79(2) EPC, dated Aug. 23, 2016, 100 pages (P22).
Communication of further notices of opposition pursuant to Rule 79(2) EPC, dated Aug. 23, 2016, 100 pages (P23).
Communication of further notices of opposition pursuant to Rule 79(2) EPC, dated Aug. 23, 2016, 150 pages (P24).
Communication of further notices of opposition pursuant to Rule 79(2) EPC, dated Aug. 23, 2016, 100 pages (P25).
Communication of further notices of opposition pursuant to Rule 79(2) EPC, dated Aug. 23, 2016, 150 pages (P26).
Communication of further notices of opposition pursuant to Rule 79(2) EPC, dated Aug. 23, 2016, 139 pages (P27).
Communication of further notices of opposition pursuant to Rule 79(2) EPC, dated Aug. 23, 2016, 150 pages (Potter Clarkson LLP) (P1).
Communication of further notices of opposition pursuant to Rule 79(2) EPC, dated Aug. 23, 2016, 150 pages (Potter Clarkson LLP) (P2).
Communication of further notices of opposition pursuant to Rule 79(2) EPC, dated Aug. 23, 2016, 140 pages (Potter Clarkson LLP) (P3).
Communication of further notices of opposition pursuant to Rule 79(2) EPC, dated Aug. 23, 2016, 110 pages (Potter Clarkson LLP) (P4).
Communication of further notices of opposition pursuant to Rule 79(2) EPC, dated Aug. 23, 2016, 150 pages (Potter Clarkson LLP) (P5).
Communication of further notices of opposition pursuant to Rule 79(2) EPC, dated Aug. 23, 2016, 150 pages (Potter Clarkson LLP) (P6).
Communication of further notices of opposition pursuant to Rule 79(2) EPC, dated Aug. 23, 2016, 150 pages (Potter Clarkson LLP) (P7).
Communication of further notices of opposition pursuant to Rule 79(2) EPC, dated Aug. 23, 2016, 150 pages (Potter Clarkson LLP) (P8).
Communication of further notices of opposition pursuant to Rule 79(2) EPC, dated Aug. 23, 2016, 120 pages (Potter Clarkson LLP) (P9).
Communication of further notices of opposition pursuant to Rule 79(2) EPC, dated Aug. 23, 2016, 85 pages (Potter Clarkson LLP) (P10).
Request for exclusion of file inspection, dated Jul. 12, 2016, 3 pages.
Bruggemann et al., "A repertoire of monoclonal antibody with human heavy chains from transgenic mice," PNAS USA (1989) 86:6709-6713.
Smith et al., "Filamentous fusion phage: Novel expression factors that display cloned antigens on the Virion surface," Science (1985) 228:1315-1317.
Declaration of Anthony L. DeFranco, Dec. 21, 2014, 56 pages.
Declaration of David Tarlinton, Dec. 21, 2014, 40 pages.
Third party pre-issuance submission in U.S. Appl. No. 15/140,321, dated Feb. 10, 2017, 19 pages.
Third party pre-issuance submission in U.S. Appl. No. 15/090,505, dated Feb. 24, 2017, 30 pages.
Moldenhauer, "Bispecific antibodies from hybrid hybridoma," Bispecific Antibodies (2011) pp. 29-46.
Staerz et al., "Hybrid hybridoma producing a bispecific monoclonal antibody that can focus effector T-cell activity," Proc Natl Acad Sci USA (1986) 83(5):1453-1457.
Opinion of In re Chu, United States Court of Appeals for the Federal Circuit, decided on Sep. 14, 1995.
Reply letter of proprietor in response to the opposition proceedings against EP 2264163 B1, dated Dec. 30, 2016.
Osoegawa et al., "Bacterial Artificial Chromosome Libraries for Mouse Sequencing and Functional Analysis," Genome Research (2000) 10(1):116-28.
Herring, CD., "Vector-Hexamer PCR Isolation of All Insert Ends from a YAC Contig of the Mouse Igh Locus," Genome Research (1998) 8(6):673-81.
DNA Sequencing Core Website, dated Nov. 21, 2015.
Schedl et al., "Transgenic mice generated by pronuclear injection of a yeast artificial chromosome," Nucleic Acids Re (1992) 20(12):3073-3077.

(56) References Cited

OTHER PUBLICATIONS

Mejia et al., "Retrofitting Vectors for *Escherichia coli*-Based Artificial Chromosomes (PACs and BACs) with Markers for Transfection Studies," Genome Research (1997) 7(2):179-186.
Sambrook 3rd ed pp. 2.110-2.111 (2001).
Sambrook 3rd ed Chapter 5 Protocols 15 and 19.
NEB 1-Ceul datasheet and heat inactivation table.
Schindelhauer et al., "Efficient combination of large DNA in vitro: in gel site specific recombination (IGSSR) of PAC fragments containing a satellite DNA and the human HPRT gene locus," Nucleic Acids Research (1997) 25(11):2241-3.
Mejia et al., "The Assembly of Large BACs by in Vivo Recombination," Genomics (2000) 70(2):165-70.
Shizuya et al., "Cloning and stable maintenance of 300-kilobase-pair fragments of human DNA in *Escherichia coli* using an F-factor-based vector," Proc Natl Acad Sci U S A (1992) 89(18):8794-7.
Sambrook 3rd ed, vol. 1 p. 6.3.
Sambrook 3rd ed, Chapter 5, Protocol 13.
Sambrook 3rd ed, Chapter 6, Protocol 2.
Boren et al., "A Simple and Efficient Method for Making Site-directed Mutants, Deletions, and Fusions of Large DNA Such as PI and BAC Clones," Genome Res (1996) 6(11): 1123-30.
DNA Cloning 3, A Practical Approach, 2nd Ed, pp. 112-114.
Trucksis et al., "The Vibrio cholerae genome contains two unique circular chromosomes," Proc Natl Acad Sci USA, (1998) 95(24): 14464-9.
Potter et al., "Enhancer-dependent expression of human Kc immunoglobulin genes introduced into mouse pre-B lymphocytes by electroporation," Proc Natl Acad Sci USA, 1984, 81(22), 7161-5.
Sambrook 3rd ed, Chapter 16.34, protocol 5.
Bio-Rad Cat No. 165-2105—Gene Pulser® II Electroporation System Instruction Manual.
Potter et al., "Transfection by Electroporation," Curr Prot Mol Biol (2003) Chapter 9:Unit9.3. doi: 10.1002/0471142727.mb0903s92.
Yang et al., Site-specific gene targeting in mouse embryonic stem cells with intact bacterial artificial chromosomes, Nat Biotechnol., 2003, 21(4):447-51.
Glaser et al., Current issues in mouse genome engineering, Nat Genet (2005) 37(11):1187-1193.
Bethke et al., "Segmental genomic replacement by ere-mediated recombination: genotoxic stress activation of the p53 promoter in single-copy transformants," Nucleic Acids Res (1997) 25(14):2828-2834.
Mansour, SL., "Disruption of the proto-oncogene int-2 in mouse embryo-derived stem cells: a general strategy for targeting mutations to non-selectable genes," Nature (1988) 336(6197):348-352.
Muyrers et al., "ET-cloning: think recombination first," Genetic Engineering (2000) 22:77-98.
Orford et al., "Engineering EGFP reporter constructs into a 200 kb human beta-globin BAC clone using GET Recombination," Nucleic Acids Res (2000) 28(18): E84.
Nefedov et al., "Insertion of disease-causing mutations in BACs by homologous recombination in *E. coli*," Nucleic Acids Res (2000) 28(17): E79.
Call et al., "A Cre-lox recombination system for the targeted integration of circular yeast artificial chromosomes into embryonic stem cells," Hum Mol Genet (2000) 9(12):1745-1751.
Sambrook 3rd ed Chapter 5.3.
Angrand, PO et al.; Simplified generation of targeting constructs using ET recombination, Nucleic Acids Res., 1999, 27(17), e16.
Sambrook 3rd ed Protocol 7 4.48-4.52.
Nagy., "Cre Recombinase: The Universal Reagent for Genome Tailoring," Genesis "2000" 26(2):99-109.
Fox et al., "Fluorescent in situ hybridization (FISH) to mouse chromosomes, Mouse Genetics and Transgenics: A practical approach," LJ. Jackson, C.M. Abbott (Eds.), Oxford University Press, London (2000), pp. 154-168.
Rideout et al., "Generation of mice from wild-type and targeted ES cells by nuclear cloning," Nat Genetics (2000) 24(2):109-110.
Ramirez-Solis, "Gene Targeting in Embryonic Stem Cells," Methods Enzymol (1993) 225:855-78.
Zhang et al., "DNA cloning by homologous recombination in *Escherichia coli*," Nat Biotechnol (2000) 18(12):1314-1317.
Eppig, "Mouse Genome Informatics (MGI): reflecting on 25 years," Mamm Genome (2015) 26(7-8):272-84. doi: 10.1007/S00335-015-9589-4. Epub Aug. 4, 2015.
Mouse Genetics and Transgenics: A Practical Approach. I. J. Jackson and C. M. Abbott (eds). Oxford University Press, Oxford. 2000, chapter 7.
Dietrich et al., "A comprehensive genetic map of the mouse genome," Nature (1996) vol. 380, pp. 149-152.
Nusbaum et al., "A YAC-based physical map of the mouse genome," Nature Genetics (1999) 22(4):388-93.
Van Etten et al., "Radiation hybrid map of the mouse genome," Nature Genetics (1999) 22(4):384-7.
Muyrers et al., "Point mutation of bacterial artificial chromosomes by ET recombination," EMBO Reports (2000) 1(3):239-43.
Lee et al., "A Highly Efficient *Escherichia coli*-Based Chromosome Engineering System Adapted for Recombinogenic Targeting and Subcloning of BAC DNA," Genomics (2001) 73(1):56-65.
Sambrook 3rd Ed Chapter 1.21.
Hill et al., "BAC Trimming: Minimizing Clone Overlaps," Genomics (2000) 64(1):111-3.
Sheng et al., "Transformation of *Escherichia coli* with large DNA molecules by electroporation," Nucleic Acids Res (1995) 23(11):1990-6.
NEB Pl-Scel datasheet.
NIH website—Mouse BAC end sequencing project.
Reyrat et al., "Counterselectable Markers: Untapped Tools for Bacterial Genetics and Pathogenesis," Infect Immun (1998) 66(9):4011-4017.
Yu et al., "An efficient recombination system for chromosome engineering in *Escherichia coli*," Proc Natl Acad Sci U S A (2000) 97(11):5978-83.
Murphy; KC., "Use of Bacteriophage Lambda Recombination Functions To Promote Gene Replacement in *Escherichia coli*," J Bacteriol (1998) 180(8):2063-71.
Mouse Genome Data available in public databases, Feb. 2001, NIH.
Zhao, S., "A Comprehensive BAC Resource," Nucleic Acids Research (2001) 29(1):141-3.
Knight, "Mouse genome effort 'on course'," Nature (2001) vol. 411, p. 121.
Waterston et al., "Initial sequencing and comparative analysis of the mouse genome," Nature (2002) 420(6915):520-62.
Herring et al., "Vector-Hexamer PCR Isolation of All Insert engds from a YAC Contig of the Mouse Igh Locus," Genome Research (1998) 8(6): 673-81.
Factsheet from Opponent1 re MeMo mouse dated 2012.
MeMo™ the ingenious mouse for improved antibody therapeutics, www.merus.nl.
Presentation by Cecile Geuijen, May 27, 2013: Full length human IgG bispecific antibodies for cancer therapy.
Feeney et al., "Dst4: a new, and probably the last, functional Dh gene in the BALB/c mouse," Immunogenetics (1993) 37(3):217-21.
Mainville et al., "Deletion al Mapping of Fifteen Mouse VH Gene Families Reveals a Common Organization for Three Igh Haplotypes," Journal of Immunology (1996) 156(3):1038-46.
D'Eustachio et al., "Mouse Chromosome 12," Mammalian Genome (1998) 8:S241-S257.
Weigert et al., "The genetic control of antibody variable regions in the mouse," Springer Seminars in Immunopathology (1978) 1:133-169.
Riblet et al., "Polymorphism and evolution of Igh-V gene families," Curr. Top. Microbial. Immunol. (1986) 127:168.
Thiebe et al., The variable genes and gene families of the mouse immunoglobulin kappa locus, Eur J Immunol (1999) 29(7):2072-81.
Richards-Smith, BA. et al., "Deletion mapping of the mouse ornithine decarboxylase-related locus Odc-rs8 within Igh-V," Mammalian Genom (1992) 3(10):568-74.
Extract from Fundamental Immunology, 4th Edition, Paul, W.E., Lippincott-Raven (1999).

(56) References Cited

OTHER PUBLICATIONS

Materials from examination of a European Patent Application No. 09075279.1 in the name of O1, Apr. 23, 2013.
Kawasaki et al., "Evolutionary dynamics of the human immunoglobulin k locus and the germ line repertoire of the Vk genes," Eur J Immunol (2001) 31(4):1017-28.
O'Connor et al., "Construction of Large DNA Segments in *Escherichia coli*," Science (1989) 244(4910):1307-12.
Red/ET Recombination guide (Gene Bridges).
Sambrook 3rd ed vol. 3 p. 16.54-16.57.
Zheng et al., "Engineering Mouse Chromosomes with Cre-loxP: Range, Efficiency, and Somatic Applications," Mol Cel Bio (2000) 20(2):648-55.
Wade-Martins et al., "Long-term stability of large insert genomic DNA episomal shuttle vectors in human cells," Nucleic Acids Res (1999) 27(7):1674-82.
Macdonald et al., Poster 2006—Velocigene® Technology Extended to Humanization of Several Megabases of Complex.
Abstract to 2006 Macdonald poster (1st International Mugen Conference Sep. 2006, Athens).
Stevens et al., Poster 2006—VelocImmune™: Humanization of immunoglobulin loci using VelociGene® technology.
Abstract to 2006 Stevens poster (1st International Mugen Conference Sep. 2006, Athens).
Sambrook 3d Ed 4.82-4.85.
Sauer, "Inducible gene targeting in mice using the Cre/loxSystem", Methods (1998) 14(4):381-392.
Sambrook 3rd Ed 12.10-12.13, protocol 1.
Presentation by Open Monoclonal Technology, Inc (Nov. 3, 2013), http://www.openmonoclonaltechnology.com/downloads.html.
Lonberg, "Human Monoclonal Antibodies from Transgenic Mice," Handb Exp Pharmacol (2008) 181:69-97.
Vasicek et al., "B-less: a Strain of Profoundly B Cell-deficient Mice Expressing a Human lambda Transgene," J Exp Med (1992) 175(5):1169-80.
Declaration of Sir Martin Evans dated Dec. 23, 2016 in opposition proceedings EP2264163.
Declaration of Professor Kenan Murphy dated Dec. 29, 2016 in opposition proceedings EP2264163.
Declaration of Dr Werner Muller dated Dec. 22, 2016 in opposition proceedings EP2264163.
Declaration of Dr Andrew Murphy dated Dec. 21, 2016 in opposition proceedings EP2264163.
Declaration of Dr Lynn Macdonald dated Dec. 20, 2016 in opposition proceedings EP2264163.
Declaration of Professor Hidde Ploegh dated Dec. 23, 2016 in opposition proceedings EP2264163.
Declaration of Andrew Murphy originally submitted for the EP1360287 Opposition (including appendices), dated Jan. 27, 2014.
Declaration and CV of Anthony De Franco originally submitted for the EP1360287 Opposition, dated Sep. 2, 2014.
Statement of Professor Ishida submitted in the UK High Court, first witness statement in UK litigation (The High Court of Justice, Chancery Division, Patents Court, Case No. HP-2013-000001/HP-2014-000001 dated Sep. 3, 2015, Report relates to a patent owned by Regeneron Pharmaceuticals, Inc., EP2264163).
Statement of Professor Anthony De Franco, first witness statement in UK litigation (The High Court of Justice, Chancery Division, Patents Court, Case No. HP-2013-000001/HP-2014-000001 dated Oct. 3, 2015, Report relates to a patent owned by Regeneron Pharmaceuticals, Inc., EP 2264163).
Statement of Dr Yancopoulos, first witness statement in UK litigation (The High Court of Justice, Chancery Division, Patents Court, Case No. HP-2013-000001/HP-2014-000001 dated Oct. 2, 2015, Report relates to a patent owned by Regeneron Pharmaceuticals, Inc., EP 2264163).
Hansen et al., "Crescendo's Cash Fragments," BioCentury, The BernsteinReport on BioBusiness, Dec. 23, 2013, p. A13.
Declaration and CV of Craig Bassing, originally submitted for the EP1360287 Opposition.
Honjo et al., (Eds), Immunoglobulin Genes, Academic Press: London, 2nd Edition, (1990) pp. 71, 74-76.
Declaration of Sue Klapholz, originally submitted for the EP1360287 Opposition (including appendicies), Jan. 27, 2014.
Second Declaration of Craig Bassing (Bassing II), originally submitted for the EP1360287 Opposition, dated Sep. 2, 2014.
Kirschbaum et al., The 3' part of the immunoglobulin kappa locus of the mouse, Eur J Immunol (1998) 28(5):1458-66.
Kirschbaum et al., "The central part of the mouse immunoglobulin kappa locus," Eur J Immunol (1999) 29(7):2057-64.
Roschenthaler et al., "The 5' part of the mouse immunoglobulin kappa locus as a continuously cloned structure," Eur J Immunol (2000) 30(12):3349-3354.
Roschenthaler et al., "The 5' part of the mouse immunoglobulin kappa locus," Eur J Immunol (1999) 29(7):2065-2071.
Sambrook 3rd Ed 8.95, Real time PCR.
Huetz et al., "Targeted disruption of the V(H) 81X gene: influence on the B cell repertoire," Eur J Immunol (1997) 27(1):307-314.
Fukita et al., "Somatic hypermutation in the heavy chain locus correlates with transcription," Immunity (1998) 9(1):105-114.
Gu et al., "Most Peripheral B Cells in Mice Are Ligand Selected," J Exp Med (1991) 173(6):1357-71.
The mouse genome, Nature 420, 510, Dec. 5, 2002, p. 510-511 (Nature Genome Timeline).
Lefranc et al., The Immunoglobulin Facts Book Academic press (2001) p. 52-58.
Kawasaki et al., "One-megabase sequence analysis of the human immunoglobulin lambda gene locus," Genome Res (1997) 7(3):250-261.
Carson and Wu (1989) A linkage map of the mouse immunoglobulin lambda light chain.
Bruggemann et al., "Human antibody production in transgenic mice: expression from 100 kb of the human IgH locus," Eur J Immunol (1991) 21(5):1323-1326.
Sambrook 3rd ed pp. 4.1-4.8 (2001).
Sambrook 3rd ed pp. 1.2-1.16 (2001).
Xu et al., "Structure of the bacteriophage lambda cohesive end site. Genetic analysis of the site (cosN) at which nicks are introduced by terminase," J Mol Biol (1991) 220(2):281-92.
Catalano et al., "Virus DNA packaging: the strategy used by phage lambda," Molecular Microbiology (1995) 16(6):1075-1086.
Aggarwal et al., "Novel site-specific DNA endonucleases," Curr Opin Struct Biol (1998) 8(1):19-25.
Frengen et al., "A modular, positive selection bacterial artificial chromosome vector with multiple cloning sites," Genomics (1999) 58(3):250-3.
Naryanan et al., "Efficient and precise engineering of a 200 kb beta-globin human/bacterial artificial chromosome in *E. coli* DH10B using an inducible homologous recombination system," Gene Ther (1999) 6(3):442-7.
Email relating to Gene Bridges course on RedET recombination.
GeneBridges course invitation, 2003.
Reply letter of proprietor in response to the opposition proceedings against EP 2501817 B1, dated Dec. 23, 2016.
Janeway et al., "Immunobiology: the immune system in health and disease," Current Biology Publications, 4th edition, 1999, chapter 3, pp. 79-113.
Rickert et al., "Impairment of T-cell-dependent B-cell responses and B-1 cell development in CD19-deficient mice," Nature (1995) 376(6538):352-355.
Pokorna et al., "DNA-vaccination via tattooing induces stronger humoral and cellular immune responses than intramuscular delivery supported by molecular adjuvants," Genetic Vaccines and Therapy (2008) 6:4.
Third Party Observations against EP 12186010.0, dated Mar. 13, 2017, 8 pages.
Mead et al., "Detection of Bence Jones myeloma and monitoring of myeloma chemotherapy using immunoassays specific for free immunoglobulin light chains," Clinical Laboratory (2003) 49(1-2):25-27.
Roebroek et al., "Mutant Lrp1 Knock-In mice generated by recombinase-mediated cassette exchange reveal differential importance of the

(56) References Cited

OTHER PUBLICATIONS

NPXY motifs in the intracellular domain on LRP1 for normal fetal development," Molecular and Cellular Biology (2006) 26(2):605-616.
Shmerling et al., "Strong and ubiquitous expression of transgenes targeted into the beta-actin locus by Cre/lox cassette replacement," Genesis (2005) 42(4):229-235.
Toledo et al., "RMCE-ASAP: a gene targeting method for ES and somatic cells to accelerate phenotype analyses," Nucleic Acids Research (2006) 34(13):e92.
Aggarwal and Wah, Novel site-specific DNA endonucleases., Curr Opin Struct Biol., Feb. 1998, 8 (1), pp. 19-25.
Anderson and Potter, Induction of plasma cell tumours in BALB-c mice with 2,6,10,14-tetramethylpentadecane (pristane)., Nature, Jun. 1969, 222 (5197), pp. 994-995.
Andrew Murphy, Recombinant Antibodies for Immunotherapy, New York: Cambridge University Press, 2009, chapters, pp. 100-107.
Angrand et al., Simplified generation of targeting constructs using ET recombination, NAR, Sep. 1999, 27(17):e16 i-iv.
Bethke and Sauer, Segmental genomic replacement by Cre-mediated recombination genotoxic stress activation of the p53 promoter in single-copy transformants, NAR, Jul. 1997, 25 (14), pp. 2828-2834.
Blankenstein & Krawinkel, Immunoglobulin VH region genes of the mouse are organized in overlapping clusters., Eur J Immunol., Sep. 1987, 17(9), pp. 1351-1357.
Borén et al., A Simple and Efficient Method for Making Site-directed Mutants, Deletions, and Fusions of Large DNA Such as P1 and BAC Clones, Genome Research, Nov. 1996, 6 (11), pp. 1123-1130.
Brüggemann and Neuberger, Strategies for expressing human antibody repertoires in transgenic mice., Immunology Today, Aug. 1996, vol. 17, No. 8, pp. 391-397.
Brüggemann et al., Human antibody production in transgenic mice: expression from 100 kb of the human IgH locus., Eur J Immunol., May 1991, 21 (5), pp. 1323-1326.
Brüggemann M., Molecular Biology of B Cells, Elsevier Science, 2004, Chapter 34: Human Monoclonal Antibodies from Translocus Mice, pp. 547-561.
Brüggemann, Human Antibody Expression in Transgenic Mice., Archivum Immunologiae et Therapiae Experimentalis, 2001, 49 (3), pp. 203-208.
Call et al., A Cre-lox recombination system for the targeted integration of circular yeast artificial chromosomes into embryonic stem cells, HMG, Jul. 2000, 9 (12), pp. 1745-1751).
Carson and Wu, A linkage map of the mouse immunoglobulin lambda light chain locus, Immunogenetics, Mar. 1989, 29(3), pp. 173-179.
Catalano et al., Virus DNA packaging: the strategy used by phage lambda., Mol Microbiol., Jun. 1995, 16(6), pp. 1075-1086.
Cohn et al., Characterization of the antibody to the C-carbohydrate produced by a transplantable mouse plasmacytoma.,Immunochemistry, Jan. 1969, 6 (1), pp. 111-114.
Crescendo's cash fragments, Biocentury, Dec. 2013, vol. 21, No. 48, p. A3.
Decision of the UK Court of Appeal dated Mar. 28, 2018.
D'Eustachio P. and Riblet R., Mouse Chromosome 12, Mammalian Genome, 1998, 8, pp. S241-S257.
Dietrich et al., A comprehensive genetic map of the mouse genome, Nature, Mar. 1996, 380 (6570), pp. 149-152.
Eggan et al., Hybrid vigor, fetal overgrowth, and viability of mice derived by nuclear cloning and tetrapioid embryo complementation, PNAS, May 2001, 98 (11), pp. 6209-6214.
Eppig et al., Mouse Genome Informatics (MGI): reflecting on 25 years, Mamm Genome, Aug. 2015, 26 (7-8), pp. 272-284.
Eppig J., Mouse Genetics and Transgenics a practical approach, New York: Oxford University Press, 2000, chapter 7, pp. 170-183.
Extract from: Paul, W.E., Fundamental Immunology, Philadelphia: Lippincott-Raven, 1999, 4th edition, chapters, p. 140, figure 16.
Feeney, A. J. and Riblet R., DST4: a new, and probably the last, functional DH gene in the BALB/c mouse, Immunogenetics, Jan. 1993 ,37 (3), pp. 217-221.
Fox and Povey, Mouse Genetics and Transgenics a practical approach, New York Oxford University Press, 2000, chapter: Fluorescent in situ hybridization (FISH) to mouse chromosomes, pp. 154-169.
Frengen et al., A modular, positive selection bacterial artificial chromosome vector with multiple cloning sites., Genomics, Jun. 1999, 58 (3), pp. 250-253.
Fukita et al., Somatic Hypermutation in the Heavy Chain Locus correlates with transcription., Immunity, Jul. 1998, 9 (1), 105-114.
Giraldo and Montoliu, Size matters: use of YACs, BACs and PACs in transgenic animals,Transgenic Research, Apr. 2001, 10 (2), pp. 83-103.
Glanville et al., Naive antibody gene-segment frequencies are heritable and unaltered by chronic lymphocyte ablation., PNAS, Dec. 2011, 108 (50), pp. 20066-20071.
Glaser et al., Current issues in mouse genome engineering, Nat Genetics, Nov. 2005, 37 (11), 1187-1193.
Green and Jakobovits, Regulation of B Cell Development by Variable Gene Complexity in Mice Reconstituted with Human Immunoglobulin Yeast Artificial Chromosomes, JEM, Aug. 1998, 188 (3), pp. 483-495.
Green et al., Antigen-specific human monoclonal antibodies from mice engineered with human Ig heavy and light chain YACs., Nature Genetics, May 1994, 7 (1), pp. 13-21.
Green, Antibody engineering via genetic engineering of the mouse: XenoMouse strains are a vehicle for the facile generation of therapeutic human monoclonal antibodies., Journal of Immunological Methods, Dec. 1999, 231 (1-2), pp. 11-23.
Gu et al., Most Peripheral B Cells in Mice Are Ligand Selected, J Exp Med. Jun. 1991, 173(6), pp. 1357-1371.
Herring et al., Vector-Hexamer PCR Isolation of All Insert Ends from a YAC Contig of the Mouse Igh Locus, Genome Research, Jun. 1998, 8 (6), pp. 673-681.
Hill et al., BAC Trimming: Minimizing Clone Overlaps, Genomics, Feb. 2000, 64 (1), pp. 111-113.
Huetz et al., Targeted disruption of the VH 81X gene: influence on the B cell repertoire., Eur J Immunol., Jan. 1997, 27 (1), pp. 307-314.
Jessen et al., Modification of bacterial artificial chromosomes through chi-stimulated homologous recombination and its application in zebrafish transgenesis., PNAS USA, Apr. 1998, vol. 95, issue 9, pp. 5121-5126.
Jonathan Knight, Mouse genome effort 'on course', Nature, May 2001, vol. 411, p. 121.
Kawasaki et al., Evolutionary dynamics of the human immunoglobulin k locus and the germline repertoire of the Vk genes, Eur J Immunol, Apr. 2001, 31 (4), pp. 1017-1028.
Kawasaki et al., One-megabase sequence analysis of the human immunoglobulin lambda gene locus, Genome research, Mar. 1997, 7(3), pp. 250-261.
Kirschbaum et al., The 3' part of the Ig kappa locus of the mouse, Eur J Immunol., May 1998, 28 (5), pp. 1458-1466.
Kirschbaum et al., The central part of the mouse immunoglobulin kappa locus, Eur J Immunol., Jul. 1999, 29 (7), pp. 2057-2064.
Kymab: More mAb diversity, Biocentury, Feb. 2012.
Lee et al., A Highly Efficient *Escherichia coli*-Based Chromosome Engineering System Adapted for Recombinogenic Targeting and Subcloning of BAC DNA, Genomics, Apr. 2001, 73 (1), pp. 56-65.
Lefranc and Lefranc, The Immunoglobulin FactsBook, London: Academic Press, 2001, pp. 52-58.
Lefranc M P, Nomenclature of the Human Immunoglobulin Lambda (IGL) Genes, Exp Clin Immunogenetics, 2001 18 (4), pp. 242-254.
Lonberg, Human antibodies from transgenic animals, nature biotechnology, Sep. 2005, 23 (9), pp. 1117-1125.
Lonberg, Human Monoclonal Antibodies from Transgenic Mice, Therapeutic Antibodies. Handb Exp Pharmacol., 2008, 181, pp. 69-97.
Mainville et al., Deletional Mapping of Fifteen Mouse VH Gene Families Reveals a Common Organization for Three Igh Haplotypes, Journal of Immunology, Feb. 1996, 156 (3), pp. 1038-1046.

(56) References Cited

OTHER PUBLICATIONS

Mansour et al., Disruption of the proto-oncogene int-2 in mouse embryo-derived stem cells: a general strategy for targeting mutations to non-selectable genes, Nature, Nov. 1988, 336 (6197), pp. 348-352.
Matsuda et al., The complete nucleotide sequence of the human immunoglobulin heavy chain variable region locus., J. Exp. Med., Dec. 1998, 188 (11), pp. 2151-2162.
McMurry et al., Enhancer control of local accessibility to V(D)J recombinase., Mol Cell Biol, Aug. 1997, 17 (8), pp. 4553-4561.
Mejía and Lakrin, The Assembly of Large BACs by in Vivo Recombination, Genomics, Dec. 2000, 70 (2), pp. 165-170.
Mejía and Monaco, Retrofitting Vectors for *Escherichia coli*-Based Artificial Chromosomes (PACs and BACs) with Markers for Transfection Studies, Genome Research, Feb. 1997, 7 (2), pp. 179-186.
Mouse Genome Sequencing Consortium, Waterston, et al., Initial sequencing and comparative analysis of the mouse genome, Nature, Dec. 2002, 420(6915), pp. 520-562.
Murphy, Use of Bacteriophage Lambda Recombination Functions To Promote Gene Replacement in *Escherichia coli*, Journal of Bacteriology, Apr. 1998, 180 (8), pp. 2063-2071.
Muyrers et al., ET-Cloning: Think Recombination First, Genetic Engineering, 2000, pp. 77-98.
Muyrers et al., Point mutation of bacterial artificial chromosomes by ET recombination, EMBO Reports, Sep. 2000, 1 (3), pp. 239-243.
Muyrers et al., Rapid modification of bacterial artificial chromosomes by ET-recombination, NAR, Mar. 1999, 27 (6), pp. 1555-1557.
Nagy, A., Cre Recombinase: The Universal Reagent for Genome Tailoring, Genesis, Feb. 2000, 26 (2), pp. 99-109.
Naryanan et al., Efficient and precise engineering of a 200 kb beta-globin human/bacterial artificial chromosome in *E. coli* DH10B using an inducible homologous recombination system., Gene Ther., Mar. 1999, 6 (3), pp. 442-447.
Nefedov et al., Insertion of disease-causing mutations in BACs by homologous recombination in Ecoli, NAR, Sep. 2000, 28 (17):e79.
News in brief, Nature Biotechnology, Jun. 2007, vol. 25, No. 6, pp. 613-614.
Nusbaum et al., A YAC-based physical map of the mouse genome, Nature Genetics, Aug. 1999, 22 (4), pp. 388-393.
O'Connor et al., Construction of Large DNA Segments in *E. coli*, Science, Jun. 1989, 244 (4910), pp. 1307-1312.
Orford et al., Engineering EGFP reporter constructs into a 200 kb human beta-globin BAC clone using GET Recombination, NAR, Sep. 2000, 28 (18):e84.
Osoegawa et al., Bacterial Artificial Chromosome Libraries for Mouse Sequencing and Functional Analysis, Genome Research, Jan. 2000, 10 (1), pp. 116-128.
Perlmutter et al., The generation of diversity in phosphorylcholine-binding antibodies., Adv Immunol., 1984, vol. 35, pp. 1-37.
Potter and Heller, Transfection by Electroporation, Curr Prot Mol Biol, May 2010, vol. 92, issue 1, chapter: unit-9.3.
Potter et al., Enhancer-dependent expression of human Kc immunoglobulin genes introduced into mouse pre-B lymphocytes by electroporation., PNAS, Nov. 1984, 81 (22), pp. 7161-7165.
Rakesh Anand, DNA Cloning 3 A Practical Approach 2nd Ed, New York: Oxford University Press, 1995, 2nd edition, pp. 112-114.
Ramírez-Solis et al., Gene Targeting in Embryonic Stem Cells, Meth. In Enzymology, 1993, vol. 225, pp. 855-878.
Rathbun et al., Immunoglobulin Genes, London: Academic Press Limited, 1990, 2nd ed., pp. 71-76.
Reyrat et al., Counterselectable Markers: Untapped Tools for Bacterial Genetics and Pathogenesis, Infection and Immunity, Sep. 1998, 66 (9), pp. 4011-4017.
Riblet R., Tutter A. and Brodeur P.,Polymorphism and evolution of Igh-V gene families., Curr. Top. Microbiol. Immunol., 1986, vol. 127, pp. 167-172.
Richards-Smith et al., Deletion mapping of the mouse ornithine decarboxylase-related locus Odc-rs8 within Igh-V, Mammalian Genome, Oct. 1992, 3 (10), pp. 568-574.
Rideout et al., Generation of mice from wild-type and targeted ES cells by nuclear cloning, Nat Genetics, Feb. 2000, 24 (2), pp. 109-110.
Robertson E.J. and Bradley A., Teratocarcinomas and embryonic stem cells a practical approach, Oxford: IRL Press Limited, 1987, chapters 4 and 5, pp. 71 to 151.
Röschenthaler et al., The 51 part of the mouse Ig k locus as a continuously cloned structure, Eur J Immunol., Dec. 2000, 30(12), pp. 3349-3354.
Röschenthaler et al., The 5 part of the mouse immunoglobulin kappa locus, Eur J Immunol., Jul. 1999, 29(7), pp. 2065-2071.
Sambrook and Russell, Molecular Cloning: A Laboratory Manual, New York: Cold Spring Harbor Laboratory Press, 2001, 3rd edition, vol. 1, pp. 2.110-2.111.
Sambrook and Russell, Molecular Cloning: A Laboratory Manual, New York: Cold Spring Harbor Laboratory Press, 2001, 3rd edition, vol. 1, chapter 5, protocols 15 and 19, pp. 5.68-5.70 and 5.83-5.85.
Sambrook and Russell, Molecular Cloning: A Laboratory Manual, New York: Cold Spring Harbor Laboratory Press, 2001, 3rd edition, vol. 1, p. 6.3.
Sambrook and Russell, Molecular Cloning: A Laboratory Manual, New York: Cold Spring Harbor Laboratory Press, 2001, 3rd edition, vol. 1, chapters, protocol 13, pp. 5.61-5.64.
Sambrook and Russell, Molecular Cloning: A Laboratory Manual, New York: Cold Spring Harbor Laboratory Press, 2001, 3rd edition, vol. 1, chapter 6, protocol 2, pp. 6.13-6.15.
Sambrook and Russell, Molecular Cloning: A Laboratory Manual, New York: Cold Spring Harbor Laboratory Press, 2001, 3rd edition, vol. 3, protocol 5, pp. 16.33-16.36.
Sambrook and Russell, Molecular Cloning: A Laboratory Manual, New York: Cold Spring Harbor Laboratory Press, 2001, 3rd edition, vol. 1, chapter 5, pp. 5.2-5.3.
Sambrook and Russell, Molecular Cloning: A Laboratory Manual, New York: Cold Spring Harbor Laboratory Press, 2001, 3rd edition, vol. 1, protocol 7, pp. 4.48-4.52.
Sambrook and Russell, Molecular Cloning: A Laboratory Manual, New York: Cold Spring Harbor Laboratory Press, 2001, 3rd edition, vol. 1, pp. 1.18-1.25.
Sambrook and Russell, Molecular Cloning: A Laboratory Manual, New York: Cold Spring Harbor Laboratory Press, 2001, 3rd edition, vol. 3, chapter 16, pp. 16.54-16.57.
Sambrook and Russell, Molecular Cloning: A Laboratory Manual, New York: Cold Spring Harbor Laboratory Press, 2001, 3rd edition, vol. 1, pp. 4.82-4.85.
Sambrook and Russell, Molecular Cloning: A Laboratory Manual, New York: Cold Spring Harbor Laboratory Press, 2001, 3rd edition, vol. 2, pp. 12.10-12.13.
Sambrook and Russell, Molecular Cloning: A Laboratory Manual, New York: Cold Spring Harbor Laboratory Press, 2001, 3rd edition, vol. 2, pp. 8.94-8.95.
Sambrook and Russell, Molecular Cloning: A Laboratory Manual, New York: Cold Spring Harbor Laboratory Press, 2001, 3rd edition, vol. 1, pp. 4.1-4.8.
Sambrook and Russell, Molecular Cloning: A Laboratory Manual, New York: Cold Spring Harbor Laboratory Press, 2001, 3rd edition, vol. 1, pp. 1.2-1.16.
Sauer, B., Inducible gene targeting in mice using the Cre/loxSystem, Methods, Apr. 1998, 14 (4), pp. 381-392.
Schedl et al., Transgenic mice generated by pronuclear injection of a yeast artificial chromosome, NAR, Jun. 1992, vol. 20, Issue 12, pp. 3073-3077.
Schindelhauer and Cooke, Efficient combination of large DNA in vitro: in gel site specific recombination (IGSSR) of PAC fragments containing alpha satellite DNA and the human HPRTgene locus., NAR, Jun. 1997, 25 (11), pp. 2241-2243.
Sheng et al., Transformation of *Escherichia coli* with large DNA molecules by electroporation, NAR, Jun. 1995, 23 (11), pp. 1990-1996.
Shizuya et al., Cloning and stable maintenance of 300-kilobase-pair fragments of human DNA in *Escherichia coli* using an F-factor-based vector, PNAS, Sep. 2012, 89 (18), pp. 8794-8797.

(56) References Cited

OTHER PUBLICATIONS

Soukharev et al., Segmental genomic replacement in embryonic stem cells by double lox targeting, NAR, Sep. 1999, 27 (18):e21 i-viii.
Stevens, Human Antibody Discovery—VelocImmune—A novel platform, Pharma Focus Asia, 2008, issue 8, pp. 72-74.
Supporting information of Murphy et al., Mice with megabase humanization of their immunoglobulin genes generate antibodies as efficiently as normal mice., PNAS, Apr. 2014, 111( 14), pp. 5153-5158.
The life history of the mouse in genetics, Nature, Dec. 2002, vol. 120, pp. 510-511.
Thiebe et al., The variable genes and gene families of the mouse immunoglobulin kappa locus., Eur J Immunol., Jul. 1999, 29(7), pp. 2072-2081.
Tomizuka et al., Double trans-chromosomic mice: maintenance of two individual human chromosome fragments containing Ig heavy and kappa loci and expression of fully human antibodies., PNAS, Jan. 2000, 97 (2), pp. 722-727.
Trucksis M et al., The Vibrio cholerae genome contains two unique circular chromosomes.,PNAS, Nov. 1998, 95 (24), pp. 14464-14469.
Van Etten et al., Radiation hybrid map of the mouse genome, Nature Genetics, Aug. 1999, 22 (4), pp. 384-387.
Vasicek et al., B-less: a Strain of Profoundly B Cell-deficient Mice Expressing a Human lambda Transgene, JEM, May 1992, 175 (5), pp. 1169-1180.
Wade-Martins et al., Long-term stability of large insert genomic DNA episomal shuttle vectors in human cells, NAR, Apr. 1999, 27 (7), pp. 1674-1682.
Weigert M. and Riblet R.,The genetic control of antibody variable regions in the mouse, Springer Seminars in Immunopathology, Jun. 1978, 1 (2), pp. 133-169.
Xu and Feiss, Structure of the bacteriophage lambda cohesive end site. Genetic analysis of the site (cosN) at which nicks are introduced by terminase., J Mol Biol., Jul. 1991, 220(2), pp. 281-292.
Yang and Seed, Site-specific gene targeting in mouse embryonic stem cells with intact bacterial artificial chromosomes, Nature Biotechnol, Apr. 2003, 21 (4), pp. 447-451.
Yang. X. W., et al., Homologous recombination based modification in *Esherichia coli* and germline transmission in transgenic mice of a bacterial artificial chromosome, Nat. Biotechnol.,Sep. 1997, vol. 15, issue 9, pp. 859-865.
Yu et al., An efficient recombination system for chromosome engineering in *Escherichia coli*, PNAS, May 2000, 97 (11), pp. 5978-5983.
Zhang et al., A new logic for DNA engineering using recombination in *Escherichia coli*, Nature Genetics, Oct. 1998, 20 (2), pp. 123-128.
Zhang et al., DNA cloning by homologous recombination in *Escherichia coli*, Nature Biotech, Dec. 2000, 18 (12), pp. 1314-1317.
Zhao S., A Comprehensive BAC Resource, Nucleic Acids Research, Jan. 2001, vol. 29, No. 1, pp. 141-143.
Zheng et al., Engineering Mouse Chromosomes with Cre-loxP: Range, Efficiency, and Somatic Applications, Mol Cell Biol., Jan. 2000, 20 (2), pp. 648-655.
Adderson et al., "Restricted immunoglobulin VH Usage and VDJ combinations in the human response to haermophilus influenza type b capsular polysaccharide," J Clin Invest (1993) 91(6):2734-2743.
Gallo et al., "The human immunoglobulin loci introduced into mice: V (D) and J gene segment usage similar to that of adult humans," Eur J Immunol (2000) 30:534-540.
Wang et al., "Ab-origin: an enhanced tool to identify the sourcing gene segments in germline for rearranged antibodies," BMC Bioinformatics (2008) 9(Suppl 12):S20.
Zhang et al., "Discrimination of germline V genes at different sequencing lengths and mutational burdens: A new tool for identifying and evaluating the reliability of V gene assignment," Journal of Immunological Methods (2015) 427:105-116.
U.S. Appl. No. 16/852,184, filed Apr. 17, 2020, by Throsby et al.
Australian Office Action for Application No. 2009263082, 8 pages, dated Mar. 18, 2014.
Canadian Protest and Submission of Prior Art for Application No. 2,729,095, 16 pages, dated Apr. 8, 2014.
Carter, Paul, "Bispecific human IgG by design," Journal of Immunological Methods, vol. 248:7-15 (2001).
Dechiara, Thomas M. et al., "VelociMouse: Fully ES Cell-Derived F0-Generation Mice Obtained from the Injection of ES Cells into Eight-Cell-Stage Embryos," Gene Knockout Protocols: Second Edition, Ralf Kuhn (Ed.), Humana Press, vol. 530, Chapter 16, pp. 311-324 (2009).
Declaration of Peter Hudson, May 1, 2015, 52 pages.
Declaration of Robert Brink, Apr. 30, 2015, 34 pages.
Defranco, Anthony L., Declaration filed Against Australian Application No. 2009263082 in the name of Merus B.V., executed Dec. 21, 2014.
European Patent Office Action/Communication for Application No. 09075279.1 dated May 8, 2012, 1 page.
European Patent Office Action/Communication for Application No. 09075279.1 dated Nov. 5, 2012, 1 page.
Friedrich et al., "Promoter traps in embryonic stem cells: a genetic screen to identify, and mutate developmental genes in mice," Genes & Development (1991) 5:1513-1523.
GenBank Accession No. DQ187586-1, Protein ID ABA26122.1, Rabquer, B.J. et al., "Differential variable gene usage between pneumococcal polysaccharide specific B cells isolated 5-10 days and 4-6 weeks post-vaccination," 1 page (2005).
ImMunoGeneTics Information System, for analysed sequence CHEB VK, http://www.imgt.org/IMGT_vquest/vquest, at least as early as Apr. 25, 2012.
International Preliminary Report on Patentability and Written Opinion for Application No. PCT/NL2009/050381, 11 pages, dated Jan. 5, 2011.
Murphy, Andrew, Declaration filed Against Australian Application No. 2009263082 in the name of Merus B.V., executed Dec. 19, 2014.
Murphy, Kenneth, The Development and Survival of Lymphocytes, Janeway's Immunobioloby, 8th Edition, Taylor & Francis, Chapter 8, pp. 275-290 (2011).
PCT International Preliminary Report on Patentability, PCT/NL2009/050381 dated Jan. 5, 2011.
PCT International Search Report, PCT/NL2009/050381 dated Dec. 7, 2009, 5 pages.
Roitt, A. , Immunology, Mir, Moscow, pp. 134, 214 (2000).
Second Declaration of Robert Brink, Jun. 2, 2015, 38 pages.
Second Declaration of Peter Hudson, Jun. 2, 2015, 81 pages.
Singer, Maxine et al., "Transcription: The Transfer of DNA Sequence Information to RNA," Genes & Genomes: A Changing Perspective, University Science Books, CA, Chapter 3.2, pp. 134-145 (1991).
Statement of Facts and Arguments in Support of Opposition, Patent No. EP2147594 B1, 46 pages, dated Aug. 11, 2014.
Storb et al., J. Exp. Ed., 1986, pp. 627-641, vol. 164.
Tarlinton, David, Declaration filed Against Australian Application No. 2009263082 in the name of Merus B.V., executed Dec. 21, 2014.
Third Party Observation for Application No. 09075279.1, 12 pages, dated Sep. 12, 2013.
Third Party Observation for Application No. 09075279.1, 4 pages, dated Oct. 10, 2013.
Third Party Observation for Application No. AU 2009263082, 25 pages, dated Oct. 21, 2013.
Third Party Observation for Application No. EP20090075279, 12 pages (2013).
Third Party Observation for Application No. EP20090075279, 16 pages, dated Jun. 14, 2013.
Third Party Observations Against European Parent Application No. 09075279.1 in the Name of Merus BV, 3 pages, dated Jul. 1, 2013.
Third Party Observations Against European Parent Application No. 09075279.1 in the Name of Merus BV, 8 pages, dated May 16, 2013.
Third Party Observations Under Article 115 EPC Against European Parent Application No. 09075279.1 in the name of Merus B.V., dated Oct. 25, 2012, 6 pages.

(56) References Cited

OTHER PUBLICATIONS

Torres et al., Laboratory Protocols for Conditional Gene Targeting, Oxford University Press, Oxford, Chapters 10-11, pp. 42-53 (1997).
Van Doorn, S.T., Additional post-filing data and letter filed by the patentee, 1 page, dated Jun. 13, 2013.
Yarilin, A.A., Osnovy Immunologii, [Fundamentals of Immunology], Meditsina, Moscow, p. 194 (1999).
Yarilin, A.A., Osnovy Immunologii, [Fundamentals of Immunology], Meditsina, Moscow, p. 195 (1999).
"Murinae" Encyclopedia of Life 2018 http://eoLorg/pages/2847355/hierarchy_entries/57454206/overview.
"Murine." Merriam-Webster.com. Merriam-Webster, n.d. Web. Apr. 2, 2018.https://www.merriam-webster.com/dictionary/murine.
Betz et al., "Elements regulating somatic hypermutation of an immunoglobulin kappa gene: critical role for the intron enhancer/matrix attachment region," Cell (1994) 77(2):239-248.
Clark et al. "A future for transgenic livestock," (2003) Nat. Rev. Gen. 4:825-833.
Niemann et al., "Transgenic farm animals: present and future," (2005) Rev. Sci, Tech. Off. Int. Spiz. 24:285-298.
Prelle et al., "Pluripotent Stem Cells—Model of Embryonic Development, Tools for Gene Targeting, and Basis of Cell Therapy," (2002) Anat. Histol. Embryol. 31:169-186.
Wheeler et al., "Transgenic Technology and Applications in Swine," (2001) Theriogenology, 56:1345-1369.
Agca et al., "Development of transgenic rats producing human β-amyloid precursor protein as a model for Alzheimer's disease: Transgene and endogenous APP genes are regulated tissue-specifically," BMC Neuroscience (2008) 9:28.
Buehr et al., "Capture of Authentic Embryonic Stem Cells from Rat Blastocysts," Cell (2008) 135:1287-1298.
Cronkhite et al., "Male and female germline specific expression of an EGFP reporter gene in a unique strain of transgenic rats," Developmental Biology (2005) 284:171-183.
Gordon, "Transgenic technology and laboratory animal science," ILAR Journal (1997) 38:32-41.
Hamra et al.,m "Production of transgenic rats by lentiviral transduction of male germ-line stem cells," PNAS USA (2002) 99:14931-14936.
Li et al., "Germline Competent Embryonic Stem Cells Derived from Rat Blastocysts," Cell (2008) 135(7):1299-1310.
Mullins et al., "Fulminant hypertension in transgenic rats harbouring the mouse Ren-2 gene," Nature (1990) 344:541-544.
Ueda et al., "Establishment of Rat Embryonic Stem Cells and Making of Chimera Rats," (2008) PLoS ONE 3(7):e2800.
Breiner et al., "Somatic DNA rearrangement generates functional rat immunoglobulin kappa chain genes: the J kappa gene cluster is longer in rat than in mouse," Gene. (1982) 18(2): 165-174.
Dammers et al., "Organization of the Immunoglobulin Heavy- and Light-Chain Loci in the Rat," In Azad K. Kaushik and Yfke Pasman (Eds.) 2014, Comparative Immunoglobulin Genetics (pp. 108-130). New Jersey, US: Apple Academic Press. Inc.
Goodnow et al., "Altered immunoglobulin expression and functional silencing of self-reactive B lymphocytes in transgenic mice," Nature (1988) 334:676-682.
Larrick et al., "Rapid Cloning of Rearranged Immunoglobulin genes from human hybridoma cells using mixed primers and the polymerase chain reaction," Biochemical and Biophysical Resarch Communication (1989) 160(3):1250-1256.
Mccreath et al., "Production of gene-targeted sheep by nuclear transfer from cultured somatic cells," Nature. (2000) 405(6790): 1066-1069.
Sheppard et al., "Rat kappa-chain J-segment genes: two recent gene duplications separate rat and mouse," Cell. (1982) 29(1):121-7.
Brevini et al., "No shortcuts to pig embryonic stem cells." Embryonic Stem Cells in Domestic Animals, Theriogenology. (2010) vol. 74, 544-550.
Cao et al., "Isolation and Culture of Primary Bovine Embryo Stem Cell Colonies bya Novel Method." Journal of Experimental Zoology. (2009) vol. 311A, 368-376.
Dennis et al., "Welfare issues of genetically modified animals," ILAR Journal, 2002, vol. 43, No. 2, pp. 100-109.
Houdebine, "Methods of Generate Transgenic Animals, Genetic Engineering in Livestock, New Applications and Interdisciplinary Perspectives." (2009) XVI, I 46, pp. 31-47.
Paris et al., "Equine embryos and embryonic stem cells: Defining reliable markers of pluripotency." Embryonic Stem Cells in Domestic Animals, Theriogenology. (2010) vol. 74, 516-524.
Zhou et al., "Developing tTA transgenic rats for inducible and reversible gene expression." International Journal of Biological Sciences (2009) 5, pp. 171-181.
Mullins et al. "Nuclear transfer in rodents." The Journal of physiology 554.1 (2004): 4-12.

* cited by examiner

Fig. 12 human germline IGKV1-39/J DNA

```
  1   GAC ATC CAG ATG ACC CAG AGC CCC AGC AGC CTG AGC GCC AGC GTG GGC GAC AGA GTG ACC ATC ACC TGC AGA GCC AGC
 79   CAG AGC ATC AGC AGC TAC CTG AAC TGG TAT CAG CAG AAG CCC GGC AAG GCC CCC AAG CTG CTG ATC TAC GCC GCC AGC
157   TCC CTG CAG AGC GGC GTG CCC AGC AGA TTC AGC GGC AGC GGC TCC GGC ACC GAC TTC ACC CTG ACC ATC AGC AGC CTG
235   CAG CCC GAG GAC TTC GCC ACC TAC TAC TGC CAG CAG AGC TAC AGC ACC CCC CCC ACC TTC GGC CAG GGC ACC AAG GTG
313   GAG ATC AAG
```

human germline IGKV1-39/J Protein

```
  1   DIQMTQSPSS LSASVGDRVT ITCRASQSIS SYLNWYQQKP GKAPKLLIYA
 51   ASSLQSGVPS RFSGSGSGTD FTLTISSLQP EDFATYYCQQ SYSTPPTFGQ
101   GTKVEIK
```

human germline IGLV2-14/J DNA

```
  1   CAG TCT GCC CTG ACC CAG CCC GCC TCT GTG TCT GGC AGC CCT GGC CAG AGC ATC ACC ATC AGC TGC ACC GGC ACC AGC
 79   AGC GAC GTG GGC GGC TAC AAC TAC GTG TCC TGG TAT CAG CAG CAC CCC GGC AAG GCC CCC AAG CTG ATG ATC TAC GAG
157   GTG TCC AAC AGA CCC AGC GGC GTG AGC AAC AGA TTC AGC GGC AGC AAG AGC GGC AAC ACC GCC AGC CTG ACC ATC AGC
235   GGC CTC CAG GCT GAG GAC GAG GCC GAC TAC TAC TGC AGC AGC TAC ACC AGC AGC TCC ACC CTG GTG TTT GGC GGC GGA
313   ACA AAG CTG ACC GTG CTG
```

human germline IGLV2-14/J Protein

```
  1   QSALTQPASV SGSPGQSITI SCTGTSSDVG GYNYVSWYQQ HPGKAPKLMI
 51   YEVSNRPSGV SNRFSGSKSG NTASLTISGL QAEDEADYYC SSYTSSSTLV
101   FGGGTKLTVL
```

Rat IGCK allele a DNA

```
  1   AGA GCC GAC GCC GCT CCC ACC GTG TCC ATC TTC CCC CCC AGC ATG GAA CAG CTG ACC TCT GGC GGA GCC ACC GTG GTC
 79   TGC TTC GTG AAC AAC TTC TAC CCC AGA GAC ATC AGC GTG AAG TGG AAG ATC GAC GGC AGC GAG CAG AGG GAC GGC GTG
157   CTG GAC AGC GTG ACC GAC CAG GAC AGC AAG GAC TCC ACC TAC AGC ATG AGC AGC ACC CTG AGC CTG ACC AAG GTG GAG
235   TAC GAG AGG CAC AAC CTG TAC ACC TGC GAG GTG GTG CAC AAG ACC AGC TCC AGC CCC GTG GTC AAG TCC TTC AAC CGG
313   AAC GAG TGT
```

Fig. 12, contd.

Rat IGCK allele a protein

```
  1   RADAAPTVSI FPPSMEQLTS GGATVVCFVN NFYPRDISVK WKIDGSEQRD
 51   GVLDSVTDQD SKDSTYSMSS TLSLTKVEYE RHNLYTCEVV HKTSSSPVVK
101   SFNRNEC
```

IGKV1-39/J-Ck

```
  1   GGT ACC GCG GCC GCC ACC ATG GAC ATG AGA GTG CCC GCC CAG CTC CTG GGG CTC CTG CTA CTC TGG CTC CGA GGT AAG
 79   GAT GGA GAA CAC TAG GAA TTT ACT CAG CCA GTG TGC TCA GTA CTG ACT GGA ACT TCA GGG AAG TTC TCT GAT AAC ATG
157   ATT AAT AGT AAG AAT ATT TGT TTT TAT GTT TCC AAT CTC AGG TGC CAG ATG TGA CAT CCA GAT GAC CCA GAG CCC CAG
235   CAG CCT GAG CGC CAG CGT GGG CGA CAG AGT GAC CAT CAC CTG CAG AGC CAG CCA GAG CAT CAG CAG CTA CCT GAA CTG
313   GTA TCA GCA GAA GCC CGG CAA GGC CCC CAA GCT GCT GAT CTA CGC CGC CAG CTC CCT GCA GAG CGG CGT GCC CAG CAG
391   ATT CAG CGG CAG CGG CTC CGG CAC CGA CTT CAC CCT GAC CAT CAG CAG CCT GCA GCC CGA GGA CTT CGC CAC CTA CTA
469   CTG CCA GCA GAG CTA CAG CAC CCC CCC CAC CTT CGG CCA GGG CAC CAA GGT GGA GAT CAA GAG AGC CGA CGC CGC TCC
547   CAC CGT GTC CAT CTT CCC CCC CAG CAT GGA ACA GCT GAC CTC TGG CGG AGC CAC CGT GGT CTG CTT CGT GAA CAA CTT
625   CTA CCC CAG AGA CAT CAG CGT GAA GTG GAA GAT CGA CGG CAG CGA GCA GAG GGA CGG CGT GCT GGA CAG CGT GAC CGA
703   CCA GGA CAG CAA GGA CTC CAC CTA CAG CAT GAG CAG CAC CCT GAG CCT GAC CAA GGT GGA GTA CGA GAG GCA CAA CCT
781   GTA CAC CTG CGA GGT GGT GCA CAA GAC CAG CTC CAG CCC CGT GGT CAA GTC CTT CAA CCG GAA CGA GTG TTG AGC TAG
859   CGA GCT C
```

IGLV2-14/J-Ck

```
  1   GGT ACC GCG GCC GCC ACC ATG GAC ATG AGA GTG CCC GCC CAG CTC CTG GGG CTC CTG CTA CTC TGG CTC CGA GGT AAG
 79   GAT GGA GAA CAC TAG GAA TTT ACT CAG CCA GTG TGC TCA GTA CTG ACT GGA ACT TCA GGG AAG TTC TCT GAT AAC ATG
157   ATT AAT AGT AAG AAT ATT TGT TTT TAT GTT TCC AAT CTC AGG TGC CAG ATG TCA GTC TGC CCT GAC CCA GCC CGC CTC
235   TGT GTC TGG CAG CCC TGG CCA GAG CAT CAC CAT CAG CTG CAC CGG CAC CAG CAG CGA CGT GGG CGG CTA CAA CTA CGT
313   GTC CTG GTA TCA GCA GCA CCC CGG CAA GGC CCC CAA GCT GAT GAT CTA CGA GGT GTC CAA CAG ACC CAG CGG CGT GAG
391   CAA CAG ATT CAG CGG CAG CAA GAG CGG CAA CAC CGC CAG CCT GAC CAT CAG CGG CCT CCA GGC TGA GGA CGA GGC CGA
469   CTA CTA CTG CAG CAG CTA CAC CAG CAG CTC CAC CCT GGT GTT TGG CGG CGG AAC AAA GCT GAC CGT GCT GAG AGC CGA
547   CGC CGC TCC CAC CGT GTC CAT CTT CCC CCC CAG CAT GGA ACA GCT GAC CTC TGG CGG AGC CAC CGT GGT CTG CTT CGT
625   GAA CAA CTT CTA CCC CAG AGA CAT CAG CGT GAA GTG GAA GAT CGA CGG CAG CGA GCA GAG GGA CGG CGT GCT GGA CAG
703   CGT GAC CGA CCA GGA CAG CAA GGA CTC CAC CTA CAG CAT GAG CAG CAC CCT GAG CCT GAC CAA GGT GGA GTA CGA GAG
781   GCA CAA CCT GTA CAC CTG CGA GGT GGT GCA CAA GAC CAG CTC CAG CCC CGT GGT CAA GTC CTT CAA CCG GAA CGA GTG
859   TTG AGC TAG CGA GCT C
```

Fig. 12, contd.

VkP-IGKV1-39/J-Ck

```
   1 GGC CGG CCC ACA TGA AAC AAT GGG AAC CAT GTG ACA ATC ACA GAG GTG TTG TTA CTA TAG CAA AAG GGA TTG TTA CTC
  79 TCC ACA TCC CTT TAA GTA ACT TGA AGG CCT GAT AGA CCC ACC CTC TAA GAC TTC ATT AGA CAT TCC CTA CGA ATG GTT
 157 ATA CTC TCC TGT ATA CTC CCA ATA CAA CTC TAA AAT ATA TTA TTC CAT ATA GTC CTT AGG TTT GTA TTA AAG TTT GAC
 235 TTT TTT CCT TCA AAA TAT CTC TTG TCA CAA CAG CGG CTC TAG AGA GAA ATA CAT TCC CTC CAG GCA AAT CTA TGC TGC
 313 GCT GGT CTG ACC TGG GAC CCT GGG GAC ATT GCC CCT GTG CTG AGT TAC TAA GAT GAG CCA GCC CTG CAG CTG TGC TCA
 391 GCC TGC CCC ATG CCC TGC TGA TTG ATT TGC ATG TTC CAG AGC ACA GCC CCC TGC CCT GAA GAC TTT TTT ATG GGC TGG
 469 TCG CAC CCT GTG CAG GAG TCA GTC TCA GTC AGG AGC CAC CAT GGA CAT GAG AGT GCC CGC CCA GCT CCT GGG GCT CCT
 547 GCT ACT CTG GCT CCG AGG TAA GGA TGG AGA ACA CTA GGA ATT TAC TCA GCC AGT GTG CTC AGT ACT GAC TGG AAC TTC
 625 AGG GAA GTT CTC TGA TAA CAT GAT TAA TAG TAA GAA TAT TTG TTT TTA TGT TTC CAA TCT CAG GTG CCA GAT GTG ACA
 703 TCC AGA TGA CCC AGA GCC CCA GCA GCC TGA GCG CCA GCG TGG GCG ACA GAG TGA CCA TCA CCT GCA GAG CCA GCC AGA
 781 GCA TCA GCA GCT ACC TGA ACT GGT ATC AGC AGA AGC CCG GCA AGG CCC CCA AGC TGC TGA TCT ACG CCG CCA GCT CCC
 859 TGC AGA GCG GCG TGC CCA GCA GAT TCA GCG GCA GCG GCT CCG GCA CCG ACT TCA CCC TGA CCA TCA GCA GCC TGC AGC
 937 CCG AGG ACT TCG CCA CCT ACT ACT GCC AGC AGA GCT ACA GCA CCC CCC CCA CCT TCG GCC AGG GCA CCA AGG TGG AGA
1015 TCA AAC GTA AGT ACA CTT TTC TCA TCT TTT TTT ATG TGT AAG ACA CAG GTT TTC ATG TTA GGA GTT AAA GTC AGT TCA
1093 GAA AAT CTT GAG AAA ATG GAG AGG GCT CAT TAT CAG TTG ACG TGG CAT ACA GTG TCA GAT TTT CTG TTT ATC AAG CTA
1171 GTG AGA TTA GGG GCA AAA AGA GGC TTT AGT TGA GAG GAA AGT AAT TAA TAC TAT GGT CAC CAT CCA AGA GAT TGG ATC
1249 GGA GAA TAA GCA TGA GTA GTT ATT GAG ATC TGG GTC TGA CTG CAG GTA GCG TGG TCT TCT AGA CGT TTA AGT GGG AGA
1327 TTT GGA GGG GAT GAG GAA TGA AGG AAC TTC AGG ATA GAA AAG GGC TGA AGT CAA GTT CAG CTC CTA AAA TGG ATG TGG
1405 GAG CAA ACT TTG AAG ATA AAC TGA ATG ACC CAG AGG ATG AAA CAG CGC AGA TCA AAG AGG GGC CTG GAG CTC TGA GAA
1483 GAG AAG GAG ACT CAT CCG TGT TGA GTT TCC ACA AGT ACT GTC TTG AGT TTT GCA ATA AAA GTG GGA TAG CAG AGT TGA
1561 GTG AGC CGT AGG CTG AGT TCT CTC TTT TGT CTC CTA AGT TTT TAT GAC TAC AAA AAT CAG TAG TAT GTC CTG AAA TAA
1639 TCA TTA AGC TGT TTG AAA GTA TGA CTG CTT GCC ATG TAG ATA CCA TGG CTT GCT GAA TAA TCA GAA GAG GTG TGA CTC
1717 TTA TTC TAA AAT TTG TCA CAA AAT GTC AAA ATG AGA GAC TCT GTA GGA ACG AGT CCT TGA CAG ACA GCT CAA GGG GTT
1795 TTT TTC CTT TGT CTC ATT TCT ACA TGA AAG TAA ATT TGA AAT GAT CTT TTT TAT TAT AAG AGT AGA AAT ACA GTT GGG
1873 TTT GAA CTA TAT GTT TTA ATG GCC ACG GTT TTG TAA GAC ATT TGG TCC TTT GTT TTC CCA GTT ATT ACT CGA TTG TAA
1951 TTT TAT ATC GCC AGC AAT GGA CTG AAA CGG TCC GCA ACC TCT TCT TTA CAA CTG GGT GAC CTC GCG GCT GTG CCA GCC
2029 ATT TGG CGT TCA CCC TGC CGC TAA GGG CCA TGT GAA CCC CCG CGG TAG CAT CCC TTG CTC CGC GTG GAC CAC TTT CCT
2107 GAG GCA CAG TGA TAG GAA CAG AGC CAC TAA TCT GAA GAG AAC AGA GAT GTG ACA GAC TAC ACT AAT GTG AGA AAA ACA
2185 AGG AAA GGG TGA CTT ATT GGA GAT TTC AGA AAT AAA ATG CAT TTA TTA TTA TAT TCC CTT ATT TTA ATT TTC TAT TAG
2263 GGA ATT AGA AAG GGC ATA AAC TGC TTT ATC CAG TGT TAT ATT AAA AGC TTA ATG TAT ATA ATC TTT TAG AGG TAA AAT
2341 CTA CAG CCA GCA AAA GTC ATG GTA AAT ATT CTT TGA CTG AAC TCT CAC TAA ACT CCT CTA AAT TAT ATG TCA TAT TAA
2419 CTG GTT AAA TTA ATA TAA ATT TGT GAC ATG ACC TTA ACT GGT TAG GTA GGA TAT TTT TCT TCA TGC AAA AAT ATG ACT
2497 AAT AAT AAT TTA GCA CAA AAA TAT TTC CCA ATA CTT TAA TTC TGT GAT AGA AAA ATG TTT AAC TCA GCT ACT ATA ATC
2575 CCA TAA TTT TGA AAA CTA TTT ATT AGC TTT TGT GTT TGA CCC TTC CCT AGC CAA AGG CAA CTA TTT AAG GAC CCT TTA
2653 AAA CTC TTG AAA CTA CTT TAG AGT CAT TAA GTT ATT TAA CCA CTT TTA ATT ACT TTA AAA TGA TGT CAA TTC CCT TTT
2731 AAC TAT TAA TTT ATT TTA AGG GGG GAA AGG CTG CTC ATA ATT CTA TTG TTT TTC TTG GTA AAG AAC TCT CAG TTT TCG
2809 TTT TTA CTA CCT CTG TCA CCC AAG AGT TGG CAT CTC AAC AGA GGG GAC TTT CCG AGA GGC CAT CTG GCA GTT GCT TAA
2887 GAT CAG AAG TGA AGT CTG CCA GTT CCT CCC AGG CAG GTG GCC CAG ATT ACA GTT GAC CTG TTC TGG TGT GGC TAA AAA
2965 TTG TCC CAT GTG GTT ACA AAC CAT TAG ACC AGG GTC TGA TGA ATT GCT CAG AAT ATT TCT GGA CAC CCA AAT ACA GAC
```

Fig. 12, contd.

3043 CCT GGC TTA AGG CCC TGT CCA TAC AGT AGG TTT AGC TTG GCT ACA CCA AAG GAA GCC ATA CAG AGG CTA ATA TCA GAG
3121 TAT TCT TGG AAG AGA CAG GAG AAA ATG AAA GCC AGT TTC TGC TCT TAC CTT ATG TGC TTG TGT TCA GAC TCC CAA ACA
3199 TCA GGA GTG TCA GAT AAA CTG GTC TGA ATC TCT GTC TGA AGC ATG GAA CTG AAA AGA ATG TAG TTT CAG GGA AGA AAG
3277 GCA ATA GAA GGA AGC CTG AGA ATA TCT TCA AAG GGT CAG ACT CAA TTT ACT TTC TAA AGA AGT AGC TAG GAA CTA GGG
3355 AAT AAC TTA GAA ACA ACA AGA TTG TAT ATA TGT GCA TCC TGG CCC CAT TGT TCC TTA TCT GTA GGG ATA AGC GTG CTT
3433 TTT TGT GTG TCT GTA TAT AAC ATA ACT GTT TAC ACA TAA TAC ACT GAA ATG GAG CCC TTC CTT GTT ACT TCA TAC CAT
3511 CCT CTG TGC TTC CTT CCT CAG GGG CCG ACG CCG CTC CCA CCG TGT CCA TCT TCC CCC CCA GCA TGG AAC AGC TGA CCT
3589 CTG GCG GAG CCA CCG TGG TCT GCT TCG TGA ACA ACT TCT ACC CCA GAG ACA TCA GCG TGA AGT GGA AGA TCG ACG GCA
3667 GCG AGC AGA GGG ACG GCG TGC TGG ACA GCG TGA CCG ACC AGG ACA GCA AGG ACT CCA CCT ACA GCA TGA GCA GCA CCC
3745 TGA GCC TGA CCA AGG TGG AGT ACG AGA GGC ACA ACC TGT ACA CCT GCG AGG TGG TGC ACA AGA CCA GCT CCA GCC CCG
3823 TGG TCA AGT CCT TCA ACC GGA ACG AGT GTT GAA GAC AAA GGT CCT GAG ACG CCA CCA CCA GCT CCC CAG CTC CAT CCT
3901 ATC TTC CCT TCT AAG GTC TTG GAG GCT TCC CCA CAA GCG ACC TAC CAC TGT TGC GGT GCT CCA AAC CTC CTC CCC ACC
3979 TCC TTC TCC TCC TCC TCC CTT TCC TTG GCT TTT ATC ATG CTA ATA TTT GCA GAA AAT ATT CAA TAA AGT GAG TCT TTG
4057 CAC TTG AGA TCT CTG TCT TTC TTA CTA AAT GGT AGT AAT CAG TTG TTT TTC CAG TTA CCT GGG TTT CTC TTC TAA AGA
4135 AGT TAA ATG TTT AGT TGC CCT GAA ATC CAC CAC ACT TAA AGG ATA AAT AAA ACC CTC CAC TTG CCC TGG TTG GCT GTC
4213 CAC TAC ATG GCA GTC CTT TCT AAG GTT CAC GAG TAC TAT TCA TGG CTT ATT TCT CTG GGC CAT GGT AGG TTT GAG GAG
4291 GCA TAC TTC CTA GTT TTC TTC CCC TAA GTC GTC AAA GTC CTG AAG GGG GAC AGT CTT TAC AAG CAC ATG TTC TGT AAT
4369 CTG ATT CAA CCT ACC CAG TAA ACT TGG CGA AGC AAA GTA GAA TCA TTA TCA CAG GAA GCA AAG GCA ACC TAA ATG TGC
4447 AAG CAA TAG GAA AAT GTG GAA GCC CAT CAT AGT ACT TGG ACT TCA TCT GCT TTT GTG CCT TCA CTA AGT TTT TAA ACA
4525 TGA GCT GGC TCC TAT CTG CCA TTG GCA AGG CTG GGC ACT ACC CAC AAC CTA CTT CAA GGA CCT CTA TAC CGT GAG ATT
4603 ACA CAC ATA CAT CAA AAT TTG GGA AAA GTT CTA CCA AGC TGA GAG CTG ATC ACC CCA CTC TTA GGT GCT TAT CTC TGT
4681 ACA CCA GAA ACC TTA AGA AGC AAC CAG TAT TGA GAG ACT CAT TTA TGA AAG TCT AAA ACT GGA TAC AAC CAA AAT GTC
4759 CAC CAA CAG TTA AAT TAT GAC ATG TTC ACA ATT GAG CTA TTA CTT AAT AAG GAG AAT TAA TAA AAT AAA ACT TAA GAG
4837 CAT AGT TTA ATC TCA TAA ACA AGA TAA TAA GCA AAA CAA AAC ATT TTT TCA TCC ATG TAA GTT TAA AAG CAG GTA AAA
4915 TTT AAA ATT AAG AGA GAC ATA AGT TTT GAG GTA GCA AGA TGG AAA CTC TGG GGC TTG GGG AAT GTT CTG TCT CTC TGT
4993 ATG GGA TGT GAA AGT TAC TAT TGT GGA ATT GGG ATC TAT GTT CTT CCT GTA TAT ATT GTA TAC TTC ATA ATA ACT TCA
5071 CCT AAA GAA ATA TCT AAT ACC CAG TGC ATA CAT AAA AGA GGA TAC AAG GAA TGA ATC ATA CGT CAA GGC CAG AAA GAC
5149 AAT AAA GTA GGG GAT CCA GGA TCA AAT CTC CCA CAA CCT TGA GCC TTC TAC TAT TCT GCC TTC CAG AGC TCA AAG TAC
5227 AAA ACA CAT AAT TCA AAC ACA TGA TCC CTC CTT GGG GTC TCT TCC TTC ATG CAT CGA ATT AGA AAT AGC CAT GTA TAA
5305 AAT GAG ATA GAA GAG ACC TTC ATC AAC AGG TCA AAG AAT ATA GGT AAT TTT GTC TGG GTA TGA AGA GCC CAC GTA TCA
5383 AAG GTT ACA TTA GGG AAG GAA GAG GAC ACT AAC AGT GAC TTT CAT TCT CCC CCT CTT CCT GGA GGC CCC TGC ATT TAG
5461 TCC CTC GTG GGC TCA TCC ACT CAG CAC ACA TTT ACT AAG CAT CTT CTC AGC CTA CAC TCT GAA GGC AGT GCA GAA TAA
5539 TGT TAG TGT CCC TTC CCC CAG TTA ATA TGC AGT CCA GTT TCC CTG CTC CTT CCC TTT CTC AGT CCA CAT AAG GAT GAT
5617 GGG AAA GGA CAG TCA CCA AAT AGG AGA GGG CAA CCC TTT GCC TTC CTA CCT CTT GAG AAT GTA CAT TAT TAT CCA CTT
5695 TTT GAA ACT TCT TTT AAT TGC TTT TCT TTA ATT TGT CTT TTC AAA TAG CAT AAC CTT GTT CAT CCA TTT CTG GGA ACC
5773 AAA TTT ATC AAT CAA CAG TGC CTC TAA TCT GGC TAT TAA TAC AAA AAT GCC TCC TCA AAA TAT ATA TGT TCG AGT CTT
5851 ATC TAA AAC AGA ACC CAC AAT AAA AAA GAA GAA AGA ATA CAT ATA AGC ATT TAT ATA ATT CTG AGC AAC CTT GTG CTT
5929 TGT GAA AAA AAT ATA ATC TAA TGT CAC ATG CTG TAT TCT TTT TAT TTA ACA CTG GTG AAA TTA TAC CAT TAG AGA GAA
6007 AGA GGA CAG ATC ACT GAT CCT AGG ATC TAG GGA TGT TAC AGA TAA GAA AAC AAA TGT GAC AAA GAG CTG TCA CAA GGA
6085 GGA TCT TCA AGG TCA CAG AAT CAC TGT CTT GAT TTC AGT GGT GGT TAC ATA CAT TTA AAT ATG TGA TAA AAT GTT GTT
6163 GAA CTA TAT TCA TAT ATT GTA CCA ATG TCA AAT GCT TAA TTT TGG CTC TAT AGT ATA ATT ATG CAC TAA ATA ACT ATT

Fig. 12, contd.

6241 TGG ACA AAG AAA ATG ATG TTT ACA TCA AAG GTG AGG CCA TAT TTG TTA GGA ACA TAA CTT AAA AAC CAT TTT GGA TAA
6319 CTA ATG AAA AGC CAT TTT GTG TGC CTT GGC ATA TCA TGC CTA AGC TGT CAC CAG ATA GAT CTA ATA AGA CCT AAG CCT
6397 CAG AAG CAA GCC CCT GCC CAG CAA GCA GGC AGC ACA GAT AAG AGC TAA ACC CAG GAC AGG CCA TGA TAT GCT AAT GAA
6475 CTA CCT TCA AGG TGG TGT TGC TGA CCT AGT GAA CCA GCC CCA AGC TGT GAG CCC CAA TAG CAC AAA GCT ACT GCC CAA
6553 AGA AAT TAT ACA AAA ATT GGA ACT TTG GGA ATG GTG TGC AGG ATC GCT CTG CTG TAT GCC TGG AAC ACA GCT TCT CTA
6631 TGT TTT GTA TTG ATA CCA GTC TAG AAG CTT CCA AAA CTT TCT CAC TGA AGA AGA TTC CCC ATG TGG GAC CCC TAC AGA
6709 CTC TTT TGC CCA AAC AAC TGC TTC CCT CCT GGT GTG ATA TCT GTT TTG CTT TTA TGT TAG CAT AAT ATT ATA AGG AAT
6787 GTT TGT GTG AAT AAA CCA AAC ATA TTT TAA AAG CAA ATA TTG TAT GCA CAT CCT AAT TGC TAA AAA GTT TAC AGC TAA
6865 TAG TCC CAT GCT CTC CAC AAT ACT GGA TCC AAA TAA GTC CTA ATT TCA ATG TTG GGC ATC TTT ACA GAG AGA AAG ACA
6943 TTA AAA ATG AAG AGA CAT GCA GAG AGT GCA CCA TGC CAT CGT GGA GAC AGA CTG AAG TGA CAC AAC TGT TAG TCA AAG
7021 AGG ATT AAG GAC TTC CAG AAG CCA CCA AAG GAA GGA GGT ATG AAG TGG TTT CTC CCT CAG AGT ATC CAG AGG AGA CTA
7099 AAC CAA CCA ACA CCT TTT TGC TTA AGA CTT CTT GCC TTC AGG ACT GTG AGA AGG TAG CTT CCT ATT GTT CTA AGC CCC
7177 AGT ATG TGG CAT TTT GTT AAG GTA GAG TCA AGA AAC CAA TAA AAT GCA GAC AGA CAA AAG GAT AGC TGA GTT TTC CAG
7255 GCC CTT CCT TCT TAT TTT TGG TTT TGT TGG TGG TGG TGG TGG TGG TGG TGA TGG TGG TGG TTT TGT TTA TGT TTT GTT
7333 TGG GGA GTT TTT TGG GGT TTT TTT GGG TTT TGT TTT TGT TGT TGT TTT GGG GGT TTT TGT TGT TGT TGT TGT TTG CTT
7411 TTT TGT TTT TTG TTT TTT GTT TTT TTG AGA CAG TGT TTC TCT GTA TAG CCC TGG CTG TCC TGG AGT TCC TTC TAT CTC
7489 TAA TGT CTA CAT CTC AGA GGG GAT CCT CTA ATT TCA AAT GAG CAG TAG CTC TCC ATT TTT AGC TCT TAT TTA TTC ATT
7567 TAT TTA CTT ACT TAC TTA TTG TCT GTA GAT GAA AGA ATT TTG GAG TGG GAA AGG GTT CAT GAG CCC CCA GCA ACT AAT
7645 GAG GAG CTA CAG ACA ATT GAT GTT TCT GGG GAA AGG AGA CTC AGT TTC TTT GAG AGT ATA GCT TCT GAT GGG TCA ACC
7723 ATG TTC CTG TGG CTG ATG TCA CAC CCA GGA GTA TGC AGA CAA CAG AAA CTG GAG TTA ATG AGT TGT TTT AAA AAT AAA
7801 AAA GGG CAT GAA GCT TGG GAT AGA AAT TAA GGA TAA ATA CAA TTA AAT ACA GGA AAT TCT GAA AGA ATT AAT AAA AAC
7879 ATT TCT TTT TTT AAA AAA AAA TCC AGA ATT AGC TAT GCT TCT TCA AAA TTG CTT CTG GAG AAC TTT ACA AGT TAA ATA
7957 AGT TAT ATT GTA GAA AAG GTA GAG AGG AGA ATA GTG GAA GAG AGA GAT AAG GAG ACT TCA AAA GGA GTG GAG GGA GAT
8035 AGA GGA GGA GAA AGC AGA AGC AAT GGC TGA TAG ACA CAG GAT AAG AGG GAA CAG AAA GGA GAA AGA GGA AGC CAG GAT
8113 GGG TAT TTC TTT GCC TAT CTG TGA CTT GCA CAT GGT CTT GGC AAT TAT TGA TGA GTT CAA GGC TTA ATT CTT CAC TTG
8191 TGC CAA CTC AAC AGA GTC TTT CTT TCT TAT AAC CAG GCC CCC AGT ATG CTC ATG TAT GTA TCA GGT CCT CTT ATC TCC
8269 TTA TAG CAA TCC TGT TTA TAA CTG GGT AAC TTT GTG AAG GGA AGG AAG TGC ACA CTG AGA TGT GCT ACA ACT TTT TAA
8347 TAC AAA ATT TTG AAG AGT TTG TAC AAT GTA TGT ATA ATT AAT AAT TAA TAT TAT GCA CTT TAG ATT TTG ATT TCA ACT
8425 CAA GAT ACT AAT TCT ATA TAT ATG GGT TAA ATC AAT ATA TTA ATA AGT TTA ATT TCA CAT GCT TAT TTT TAT TGT GGT
8503 TTT CGA GAC AGG GTT TCT CTG TAT AGC CCT GGC TGT CCT GGA ACC CAC TTT GTA GAC CAG GCT GGC CTC AAA CTC AGA
8581 AAC CTA CCT GCC TCT GCC TCT GCC TCT GCC TCT GCC TCT GCC TCT GCC TCT GCC TCT GCC TCT GCC TCT GCC TCT GCC
8659 TCT GCC TCT GCC TCT GCC TCT GCC TCT GCC TCT GCC TCT GCC TCT GCC TCT GCC TCT GCC TCT GCC TCT GCC TCT GCC
8737 TCT GCC TCT GCC TCT GCC TCT GCC TCT GCC TAG TGC TGG AAT TAA AGG TTT GCG CCA CCA CGC CCG GTG AAA TTT TTA
8815 AAC TTT ATA TAT GTC TCA TTC TAT TTC TAT CAG ATA GGA CTG TGT AGA CTG TGC TAA ACT AAT AAA TGT GCC CTC AAA
8893 AGT AAT CGC AAG TTG TAT TGT TGT TGT TTT GCT TTG CTT TGC TTT GCT TTG CTT TGC TTT GCT TTG CTT TGC TTT GCT
8971 TTG CTT TGC TTT GCT TTG CTT TGC TTT GCT TTG CTT TGC TTT GCT TTG CTT TGC TTT TTT GTT TTG GGT TTT TTT CCG
9049 GGG GAG GGA GGG TGG AGA AAG AAT CTT ACT ATG AAG CTC TGA CTG TCC TGG GAA CTC ACT ATA TAG ATC AGG CTT GAT
9127 TCA ACT CAT AGA GAT CTG CCT TCT TCT GCC TCC CAA GTG CTG GGA ATA AAG GCA TAC ACC TCC ATG CCC AGA TAG TGA
9205 TCC CAA GTT TTA GCA AAA GTT TCT AGA CTT GAC ATT AAT CGA TGG AGA TAG ACA TGA ATT ACA CAA AGA ACT AAT GTG
9283 GAG TTT ACC TGA ATC ATA CTC TAT ACT TTA TCA GAG ATT AAA TTA ACA TTT AAT AAT CCA GTG CCA GGC TAG AGG CAC
9361 CAT TCA ATG GCA GTG TTT GCC ATC ATG CAT AGG CTT AGT CTT CAG TGC TGA AAG GCA TTG GGG GCA ATA TTA CTC ATT

Fig. 12, contd.

```
 9439 ATA CAG ATG AGA AAC TGG GAA AGA CTT GCC TCA GAT TCT CTA CTG AAA GGC TGA GTT TGT GGC TTC TAG AAA ATC TTT
 9517 TAC TTT CAA TAT TTT TAA TGT ATA ATT TTT TTA TTT CCA CTG ATT TTA TTT TTT ATT TTT AAC ATT TAT AAG AAA TAA
 9595 ATG CAA TAA ACC AAA TAC ATG GAC AAA AAA ATA CAA GAA TCA TAT GAT CAC CTC AAT GGA AGG AAA AAA AAA GAA AGA
 9673 AAA AGT CTT TGA TAA GAT TCA ACA TTC ATT CTT TTT TTA TTA GAT ATT TTC TTC ATT TAC ATT TCA AAT GCT ATC CCC
 9751 AAA GCC CCC TAT ACC TTC CCC TGC CCT GCT CCC CAA CCC ACC CAC TCC TGC TTT CTG GCC CTG GCA TTC CTC TGT ACT
 9829 GAG GCA TAT GAT CTT CAA AAA ACC AAG GGC CTC TCC TCT CAT TGG TGG CCG ACT ATT AGG CCA TCT TTT GCT ACA TAT
 9907 GCA ACT AGA GAC ACA GCT CTG GGG GTT ACT GGT TAG TTC ATA TTG TTA GTC CTC CTA TAG AGT TGC AGA CCC CTT TAG
 9985 CTC CTT GGA TAC TTT CTC TAG TTC CTT CAT TAG GGG CCC TGT GTC CCA TCC AAT AGA TGA CTG TGA GCA TCC ACT TCT
10063 GTA TTT GCC AGG CAC TGG CAT AGC CTC ACG AGA AAG AGA GAG CTA TGT CAG GAT CCT GTC AGT AAA ATC TTT CTG GCA
10141 TAT GCA ATA GTA TCT GGG TTT GGT GGT TGT ATA TGG GAT GGA TCC CCA AGT GGA GCA GTC TCT GAA TGG TCC TTC CTT
10219 CCA TCT CAG CTC CAA ACT TTG TCT CTA TAA CTC CTT CCA TGG GTA TTT TGT TCC CCA TTC TAA GAA GGA GTG AAG AAT
10297 CCA CAC TTT GGT CTT CCT TCT TCT TGA GTT TCA TAT GTT GCA TCT TGG ATA TTC TAA GTT TCT GGG TTA ATA TCC ACG
10375 TAT CAG TGA GTG CAT ATC ATG CGT GTT ATT TTG TGA TTA GTT TAC CTC ACT CAG GAT GAT ATC CTC CAG ATG CAT CCA
10453 TTT GCC TAA GAA TTT CAT TAA TTC ACT GTT TTT AAT TGC TGA ATA GTA CTC CAT TGT GTA AAT GTA CCA CAT TTT CTG
10531 TAT CCA TTC CTC TGT TGA GGG GCA TCT GGG TTC TTT CCA GCT TCT GGC TAT TAT AAA TAA GGC TGC TAT GAG CAT AGC
10609 GGA GCA TGT GTC CTT ATC AAG TTG GAA CAT CTT CTA GGT ATA TGC CCA GGA GAG GAA TTG CTG GAT CTT CCG GTA GTA
10687 CCA TCA ACA TGC ATT CTT AAT AAA AGC CCT AGA ACA AGG AGG ACT GTA GGA AAC ATA TTC CAA CAT AAT AAA GGT TAT
10765 GTA TGA CAA ACT CAT GAC CAA TAT CAT CCT AAA TGA ATG AAA CCA TTA ATA AGC TCC ATT AAA ATC AGA GGA CTG CCC
10843 ACT ATC CCT ACT TCT CAT CCA TAA TGA GAT TGA AGC ATT AGC TGG AGC AAT AAG GCA AGA GAA GGG ATA CAA ATG GGA
10921 AAA TAT TAA GTC AAA TTG TTT TCA ATT GAA GAT TAT ATT ATC TTA TAC CCA ATG ACC TCA AAT TTT GAC TAG AAA AAT
10999 TGT AGA AAT TAT CAA TAA TTT CAG CAA AGT GTT ATG ATG CAC CAC ATC CTT ATT CTT CTC CCC AGC TTC TGC TTG CTT
11077 CTC TCT TCT TGC TCT TCA TCC TTT CTG TCC TTC CAT CTG CCT GCA CTC TTG TCT CAA GAC TGA GTG CAG CGT GTA ACT
11155 CTC CTG TGA CTG AGT ATC TCA CAA AAC GTT CTA CCT GCC AAA CCT GGA TGA GCC CTT TGT CTT TCT GAA GCT ATG AGG
11233 CTC TCT ACA TAG ACT CAA GAA GGA AAT GAC AGG GAG GAG GTA ATA ATG AAG TGG GGA AGG CTG ACA TTA GCA TTG CTC
11311 CTG TGT GGC TCC TTA ATT TCT CAT ACT TCA CAC TGA GAT GTT ATT AAC TGT GAC TCA TAG GTG AAG AAG CCA GAG CTA
11389 AGG TTC TCA TAT TTG AGT GTT ATA GAA TGA GTA GAG CAG TAG TTC TCA AAC TAT GGG TCA TGA CTC CTT TAT GGG TCA
11467 AAC TAC CCT TTC ACA CAG GTT GCA TAT CAG ATA TCC TAA TTT TAT ATA CAT ATA TAT ATG CAT ATG TAT ATA TAT ATA
11545 TTT CAC AAC AGT AGG AAA ATT ATT TAG TAA TCA TTT TAT AGT TGT GGG TCA TGG CAA CAT GAG GAA CTG TAT TAA AGG
11623 GTT GCA GCA TTA GGA ATG TTG AGA CCC ACT GTA ATA GAG AAT GAG GCT TAA GGC AGG GCT ATA AAG CCC AAT GGA CCA
11701 TGT GCC TTT TCC AAC ATT TGC CAC ATG GTA AGC TCT GTA TAG ACT TTT TAA AGA ACA TTG GTT TGT AAT TTT AAA TGG
11779 ATA AGG GTC TTC ACT GTC TAT CAC CCA TCT ATA TAA TAA ATA CAT AAG TTT TGA TTC CAC CAT GGA TTC AAA TGC AAA
11857 AAT CCT CAA CCT AAG ACA TAG CAG TGA AAC ATT GAT GAC CAA ATA GGA AAT CCA TGT AGA GAC CTT CTA TCT TCT GAT
11935 GGC TCC ACA GGC ACC ATC TTG CAA CAG AGT TCT ACT TTG CTA CCA GTA ATG AAT ACA GTG TCT CAA CTC CTG CCA TTG
12013 AAT CTT CAG GAA GCC CCT GAA ATG ACT TGT ACT ACA CCA TTT CTT AAA GAC AGA AAA GCT AAG ACT TAG AGG GAA TAA
12091 ATG TCA TGC CTG AGA TCA TGC AAC CAA TTA AGT CCA ACT TGG CCT GAT CAA GAG GCA CAA TTC AAA AGC AAT GTT GTT
12169 CCT TCA CTA GCT CTT GTG TAT GGT TGC TGA TTC CGG AAG CAA AGT ATC AGT GAA TAT CCC TAG TGG GAA AAG ACT TGG
12247 AAA TCA AAT GTC TCA TTT AAC AGA TTA GGA GAT GAA ACG GTA GAC TCT GTG TAG TTG TAC ACC CCT GTG ATC CCA TCG
12325 CTA GGA AGA CTG AGG CAG GAA GTC CTC GAG CTC AAA CCA GCT TAG GCT ACA CAG AGA AAC TAT CTA AAA AAT AAT TAC
12403 TAA CTA CTT AAT AGG AGA TTG GAT GTT AAG ATC TGG TCA CTA AGA GGC AGA ATT GAG ATT CGA AGC CAG TAT TTT CTA
12481 CCT GGT ATG TTT TAA ATT GCA GTA AGG ATC TAA GTG TAG ATA TAT AAT AAT AAG ATT CTA TTG ATC TCT GCA ACA ACA
12559 GAG AGT GTT AGA TTT GTT TGG AAA AAA ATA TTA TCA GCC AAC ATC TTC TAC CAT TTC AGT ATA GCA CAG AGT ACC CAC
```

Fig. 12, contd.

```
12637 CCA TAT CTC CCC ACC CAT CCC CCA TAC CAG ACT GGT TAT TGA TTT TCA TGG TGA CTG GCC TGA GAA GAT TAA AAA AAG
12715 TAA TGC TAC CTT ATT GGG AGT GTC CCA TGG ACC AAG ATA GCA ACT GTC ATA GCT ACC GTC ACA CTG CTT TGA TCA AGA
12793 AGA CCC TTT GAG GAA CTG AAA ACA GAA CCT TAG GCA CAT CTG TTG CTT TCG CTC CCA TCC TCC TCC AAC AGC CTG GGT
12871 GGT GCA CTC CAC ACC CTT TCA AGT TTC CAA AGC CTC ATA CAC CTG CTC CCT ACC CCA GCA CCT GGC CAA GGC TGT ATC
12949 CAG CAC TGG GAT GAA AAT GAT ACC CCA CCT CCA TCT TGT TTG ATA TTA CTC TAT CTC AAG CCC CAG GTT AGT CCC CAG
13027 TCC CAA TGC TTT TGC ACA GTC AAA ACT CAA CTT GGA ATA ATC AGT ATC CTT GAA GAG TTC TGA TAT GGT CAC TGG GCC
13105 CAT ATA CCA TGT AAG ACA TGT GGA AAA GAT GTT TCA TGG GGC CCA GAC ACG TTC TAG AAG TAC CTG AGA GTG GCA AAA
13183 AAT AGT TGT GCT AAA TAG TTT GGC CAT CTT TAG GCT GAG AGA CTA GGA AAT ACA GCG ATG GAC TAT ATC AGC ATT GCA
13261 GGA TAG TTG TCA GTA AAC ACC CCA CAA CCC ATA ACA GAA GTA TTC TCT TCT TTC TAT ATC CCT TTT CCA TCC ATG TAG
13339 ATG GCT GTC TTC ATA TTT GTT CTA GAC GGC CGG CC
```

VkP-IGKV1-39/J-Ck-Δ1

```
   1 GGC CGG CCC ACA TGA AAC AAT GGG AAC CAT GTG ACA ATC ACA GAG GTG TTG TTA CTA TAG CAA AAG GGA TTG TTA CTC
  79 TCC ACA TCC CTT TAA GTA ACT TGA AGG CCT GAT AGA CCC ACC CTC TAA GAC TTC ATT AGA CAT TCC CTA CGA ATG GTT
 157 ATA CTC TCC TGT ATA CTC CCA ATA CAA CTC TAA AAT ATA TTA TTC CAT ATA GTC CTT AGG TTT GTA TTA AAG TTT GAC
 235 TTT TTT CCT TCA AAA TAT CTC TTG TCA CAA CAG CGG CTC TAG AGA GAA ATA CAT TCC CTC CAG GCA AAT CTA TGC TGC
 313 GCT GGT CTG ACC TGG GAC CCT GGG GAC ATT GCC CCT GTG CTG AGT TAC TAA GAT GAG CCA GCC CTG CAG CTG TGC TCA
 391 GCC TGC CCC ATG CCC TGC TGA TTG ATT TGC ATG TTC CAG AGC ACA GCC CCC TGC CCT GAA GAC TTT TTT ATG GGC TGG
 469 TCG CAC CCT GTG CAG GAG TCA GTC TCA GTC AGG AGC CAC CAT GGA CAT GAG AGT GCC CGC CCA GCT CCT GGG GCT CCT
 547 GCT ACT CTG GCT CCG AGG TAA GGA TGG AGA ACA CTA GGA ATT TAC TCA GCC AGT GTG CTC AGT ACT GAC TGG AAC TTC
 625 AGG GAA GTT CTC TGA TAA CAT GAT TAA TAG TAA GAA TAT TTG TTT TTA TGT TTC CAA TCT CAG GTG CCA GAT GTG ACA
 703 TCC AGA TGA CCC AGA GCC CCA GCA GCC TGA GCG CCA GCG TGG GCG ACA GAG TGA CCA TCA CCT GCA GAG CCA GCC AGA
 781 GCA TCA GCA GCT ACC TGA ACT GGT ATC AGC AGA AGC CCG GCA AGG CCC CCA AGC TGC TGA TCT ACG CCG CCA GCT CCC
 859 TGC AGA GCG GCG TGC CCA GCA GAT TCA GCG GCA GCG GCT CCG GCA CCG ACT TCA CCC TGA CCA TCA GCA GCC TGC AGC
 937 CCG AGG ACT TCG CCA CCT ACT ACT GCC AGC AGA GCT ACA GCA CCC CCC CCA CCT TCG GCC AGG GCA CCA AGG TGG AGA
1015 TCA AAC GTA AGT ACA CTT TTC TCA TCT TTT TTT ATG TGT AAG ACA CAG GTT TTC ATG TTA GGA GTT AAA GTC AGT TCA
1093 GAA AAT CTT GAG AAA ATG GAG AGG GCT CAT TAT CAG TTG ACG TGG CAT ACA GTG TCA GAT TTT CTG TTT ATC AAG CTA
1171 GTG AGA TTA GGG GCA AAA AGA GGC TTT AGT TGA GAG GAA AGT AAT TAA TAC TAT GGT CAC CAT CCA AGA GAT TGG ATC
1249 GGA GAA TAA GCA TGA GTA GTT ATT GAG ATC TGG GTC TGA CTG CAG GTA GCG TGG TCT TCT AGA CGT TTA AGT GGG AGA
1327 TTT GGA GGG GAT GAG GAA TGA AGG AAC TTC AGG ATA GAA AAG GGC TGA AGT CAA GTT CAG CTC CTA AAA TGG ATG TGG
1405 GAG CAA ACT TTG AAG ATA AAC TGA ATG ACC CAG AGG ATG AAA CAG CGC AGA TCA AAG AGG GGC CTG GAG CTC TGA GAA
1483 GAG AAG GAG ACT CAT CCG TGT TGA GTT TCC ACA AGT ACT GTC TTG AGT TTT GCA ATA AAA GTG GGA TAG CAG AGT TGA
1561 GTG AGC CGT AGG CTG AGT TCT CTC TTT TGT CTC CTA AGT TTT TAT GAC TAC AAA AAT CAG TAG TAT GTC CTG AAA TAA
1639 TCA TTA AGC TGT TTG AAA GTA TGA CTG CTT GCC ATG TAG ATA CCA TGG CTT GCT GAA TAA TCA GAA GAG GTG TGA CTC
1717 TTA TTC TAA AAT TTG TCA CAA AAT GTC AAA ATG AGA GAC TCT GTA GGA ACG AGT CCT TGA CAG ACA GCT CAA GGG GTT
1795 TTT TTC CTT TGT CTC ATT TCT ACA TGA AAG TAA ATT TGA AAT GAT CTT TTT TAT TAT AAG AGT AGA AAT ACA GTT GGG
1873 TTT GAA CTA TAT GTT TTA ATG GCC ACG GTT TTG TAA GAC ATT TGG TCC TTT GTT TTC CCA GTT ATT ACT CGA TTG TAA
1951 TTT TAT ATC GCC AGC AAT GGA CTG AAA CGG TCC GCA ACC TCT TCT TTA CAA CTG GGT GAC CTC GCG GCT GTG CCA GCC
2029 ATT TGG CGT TCA CCC TGC CGC TAA GGG CCA TGT GAA CCC CCG CGG TAG CAT CCC TTG CTC CGC GTG GAC CAC TTT CCT
2107 GAG GCA CAG TGA TAG GAA CAG AGC CAC TAA TCT GAA GAG AAC AGA GAT GTG ACA GAC TAC ACT AAT GTG AGA AAA ACA
```

Fig. 12, contd.

2185 AGG AAA GGG TGA CTT ATT GGA GAT TTC AGA AAT AAA ATG CAT TTA TTA TTA TAT TCC CTT ATT TTA ATT TTC TAT TAG
2263 GGA ATT AGA AAG GGC ATA AAC TGC TTT ATC CAG TGT TAT ATT AAA AGC TTA ATG TAT ATA ATC TTT TAG AGG TAA AAT
2341 CTA CAG CCA GCA AAA GTC ATG GTA AAT ATT CTT TGA CTG AAC TCT CAC TAA ACT CCT CTA AAT TAT ATG TCA TAT TAA
2419 CTG GTT AAA TTA ATA TAA ATT TGT GAC ATG ACC TTA ACT GGT TAG GTA GGA TAT TTT TCT TCA TGC AAA AAT ATG ACT
2497 AAT AAT AAT TTA GCA CAA AAA TAT TTC CCA ATA CTT TAA TTC TGT GAT AGA AAA ATG TTT AAC TCA GCT ACT ATA ATC
2575 CCA TAA TTT TGA AAA CTA TTT ATT TGG CTA CAC CAA AGG AAG CCA TAC AGA GGC TAA TAT CAG AGT ATT CTT GGA AGA
2653 GAC AGG AGA AAA TGA AAG CCA GTT TCT GCT CTT ACC TTA TGT GCT TGT GTT CAG ACT CCC AAA CAT CAG GAG TGT CAG
2731 ATA AAC TGG TCT GAA TCT CTG TCT GAA GCA TGG AAC TGA AAA GAA TGT AGT TTC AGG GAA GAA AGG CAA TAG AAG GAA
2809 GCC TGA GAA TAT CTT CAA AGG GTC AGA CTC AAT TTA CTT TCT AAA GAA GTA GCT AGG AAC TAG GGA ATA ACT TAG AAA
2887 CAA CAA GAT TGT ATA TAT GTG CAT CCT GGC CCC ATT GTT CCT TAT CTG TAG GGA TAA GCG TGC TTT TTT GTG TGT CTG
2965 TAT ATA ACA TAA CTG TTT ACA CAT AAT ACA CTG AAA TGG AGC CCT TCC TTG TTA CTT CAT ACC ATC CTC TGT GCT TCC
3043 TTC CTC AGG GGC CGA CGC CGC TCC CAC CGT GTC CAT CTT CCC CCC CAG CAT GGA ACA GCT GAC CTC TGG CGG AGC CAC
3121 CGT GGT CTG CTT CGT GAA CAA CTT CTA CCC CAG AGA CAT CAG CGT GAA GTG GAA GAT CGA CGG CAG CGA GCA GAG GGA
3199 CGG CGT GCT GGA CAG CGT GAC CGA CCA GGA CAG CAA GGA CTC CAC CTA CAG CAT GAG CAG CAC CCT GAG CCT GAC CAA
3277 GGT GGA GTA CGA GAG GCA CAA CCT GTA CAC CTG CGA GGT GGT GCA CAA GAC CAG CTC CAG CCC CGT GGT CAA GTC CTT
3355 CAA CCG GAA CGA GTG TTG AAG ACA AAG GTC CTG AGA CGC CAC CAC CAG CTC CCC AGC TCC ATC CTA TCT TCC CTT CTA
3433 AGG TCT TGG AGG CTT CCC CAC AAG CGA CCT ACC ACT GTT GCG GTG CTC CAA ACC TCC TCC CCA CCT CCT TCT CCT CCT
3511 CCT CCC TTT CCT TGG CTT TTA TCA TGC TAA TAT TTG CAG AAA ATA TTC AAT AAA GTG AGT CTT TGC ACT TGA GAT CTC
3589 TGT CTT TCT TAC TAA ATG GTA GTA ATC AGT TGT TTT TCC AGT TAC CTG GGT TTC TCT TCT AAA GAA GTT AAA TGT TTA
3667 GTT GCC CTG AAA TCC ACC ACA CTT AAA GGA TAA ATA AAA CCC TCC ACT TGC CCT GGT TGG CTG TCC ACT ACA TGG CAG
3745 TCC TTT CTA AGG TTC ACG AGT ACT ATT CAT GGC TTA TTT CTC TGG GCC ATG GTA GGT TTG AGG AGG CAT ACT TCC TAG
3823 TTT TCT TCC CCT AAG TCG TCA AAG TCC TGA AGG GGG ACA GTC TTT ACA AGC ACA TGT TCT GTA ATC TGA TTC AAC CTA
3901 CCC AGT AAA CTT GGC GAA GCA AAG TAG AAT CAT TAT CAC AGG AAG CAA AGG CAA CCT AAA TGT GCA AGC AAT AGG AAA
3979 ATG TGG AAG CCC ATC ATA GTA CTT GGA CTT CAT CTG CTT TTG TGC CTT CAC TAA GTT TTT AAA CAT GAG CTG GCT CCT
4057 ATC TGC CAT TGG CAA GGC TGG GCA CTA CCC ACA ACC TAC TTC AAG GAC CTC TAT ACC GTG AGA TTA CAC ACA TAC ATC
4135 AAA ATT TGG GAA AAG TTC TAC CAA GCT GAG AGC TGA TCA CCC CAC TCT TAG GTG CTT ATC TCT GTA CAC CAG AAA CCT
4213 TAA GAA GCA ACC AGT ATT GAG AGA CTC ATT TAT GAA AGT CTA AAA CTG GAT ACA ACC AAA ATG TCC ACC AAC AGT TAA
4291 ATT ATG ACA TGT TCA CAA TTG AGC TAT TAC TTA ATA AGG AGA ATT AAT AAA ATA AAA CTT AAG AGC ATA GTT TAA TCT
4369 CAT AAA CAA GAT AAT AAG CAA AAC AAA ACA TTT TTT CAT CCA TGT AAG TTT AAA AGC AGG TAA AAT TTA AAA TTA AGA
4447 GAG ACA TAA GTT TTG AGG TAG CAA GAT GGA AAC TCT GGG GCT TGG GGA ATG TTC TGT CTC TCT GTA TGG GAT GTG AAA
4525 GTT ACT ATT GTG GAA TTG GGA TCT ATG TTC TTC CTG TAT ATA TTG TAT ACT TCA TAA TAA CTT CAC CTA AAG AAA TAT
4603 CTA ATA CCC AGT GCA TAC ATA AAA GAG GAT ACA AGG AAT GAA TCA TAC GTC AAG GCC AGA AAG ACA ATA AAG TAG GGG
4681 ATC CAG GAT CAA ATC TCC CAC AAC CTT GAG CCT TCT ACT ATT CTG CCT TCC AGA GCT CAA AGT ACA AAA CAC ATA ATT
4759 CAA ACA CAT GAT CCC TCC TTG GGG TCT CTT CCT TCA TGC ATC GAA TTA GAA ATA GCC ATG TAT AAA ATG AGA TAG AAG
4837 AGA CCT TCA TCA ACA GGT CAA AGA ATA TAG GTA ATT TTG TCT GGG TAT GAA GAG CCC ACG TAT CAA AGG TTA CAT TAG
4915 GGA AGG AAG AGG ACA CTA ACA GTG ACT TTC ATT CTC CCC CTC TTC CTG GAG GCC CCT GCA TTT AGT CCC TCG TGG GCT
4993 CAT CCA CTC AGC ACA CAT TTA CTA AGC ATC TTC TCA GCC TAC ACT CTG AAG GCA GTG CAG AAT AAT GTT AGT GTC CCT
5071 TCC CCC AGT TAA TAT GCA GTC CAG TTT CCC TGC TCC TTC CCT TTC TCA GTC CAC ATA AGG ATG ATG GGA AAG GAC AGT
5149 CAC CAA ATA GGA GAG GGC AAC CCT TTG CCT TCC TAC CTC TTG AGA ATG TAC ATT ATT ATC CAC TTT TTG AAA CTT CTT
5227 TTA ATT GCT TTT TTT TAA TTT GTC TTT TCA AAT AGC ATA ACC TTG TTC ATC CAT TTC TGG GAA CCA AAT TTA TCA ATC
5305 AAC AGT GCC TCT AAT CTG GCT ATT AAT ACA AAA ATG CCT CCT CAA AAT ATA TAT GTT CGA GTC TTA TCT AAA ACA GAA

Fig. 12, contd.

5383 CCC ACA ATA AAA AAG AAG AAA GAA TAC ATA TAA GCA TTT ATA TAA TTC TGA GCA ACC TTG TGC TTT GTG AAA AAA ATA
5461 TAA TCT AAT GTC ACA TGC TGT ATT CTT TTT ATT TAA CAC TGG TGA AAT TAT ACC ATT AGA GAG AAA GAG GAC AGA TCA
5539 CTG ATC CTA GGA TCT AGG GAT GTT ACA GAT AAG AAA ACA AAT GTG ACA AAG AGC TGT CAC AAG GAG GAT CTT CAA GGT
5617 CAC AGA ATC ACT GTC TTG ATT TCA GTG GTG GTT ACA TAC ATT TAA ATA TGT GAT AAA ATG TTG TTG AAC TAT ATT CAT
5695 ATA TTG TAC CAA TGT CAA ATG CTT AAT TTT GGC TCT ATA GTA TAA TTA TGC ACT AAA TAA CTA TTT GGA CAA AGA AAA
5773 TGA TGT TTA CAT CAA AGG TGA GGC CAT ATT TGT TAG GAA CAT AAC TTA AAA ACC ATT TTG GAT AAC TAA TGA AAA GCC
5851 ATT TTG TGT GCC TTG GCA TAT CAT GCC TAA GCT GTC ACC AGA TAG ATC TAA TAA GAC CTA AGC CTC AGA AGC AAG CCC
5929 CTG CCC AGC AAG CAG GCA GCA CAG ATA AGA GCT AAA CCC AGG ACA GGC CAT GAT ATG CTA ATG AAC TAC CTT CAA GGT
6007 GGT GTT GCT GAC CTA GTG AAC CAG CCC CAA GCT GTG AGC CCC AAT AGC ACA AAG CTA CTG CCC AAA GAA ATT ATA CAA
6085 AAA TTG GAA CTT TGG GAA TGG TGT GCA GGA TCG CTC TGC TGT ATG CCT GGA ACA CAG CTT CTC TAT GTT TTG TAT TGA
6163 TAC CAG TCT AGA AGC TTC CAA AAC TTT CTC ACT GAA GAA GAT TCC CCA TGT GGG ACC CCT ACA GAC TCT TTT GCC CAA
6241 ACA ACT GCT TCC CTC CTG GTG TGA TAT CTG TTT TGC TTT TAT GTT AGC ATA ATA TTA TAA GGA ATG TTT GTG TGA ATA
6319 AAC CAA ACA TAT TTT AAA AGC AAA TAT TGT ATG CAC ATC CTA ATT GCT AAA AAG TTT ACA GCT AAT AGT CCC ATG CTC
6397 TCC ACA ATA CTG GAT CCA AAT AAG TCC TAA TTT CAA TGT TGG GCA TCT TTA CAG AGA GAA AGA CAT TAA AAA TGA AGA
6475 GAC ATG CAG AGA GTG CAC CAT GCC ATC GTG GAG ACA GAC TGA AGT GAC ACA ACT GTT AGT CAA AGA GGA TTA AGG ACT
6553 TCC AGA AGC CAC CAA AGG AAG GAG GTA TGA AGT GGT TTC TCC CTC AGA GTA TCC AGA GGA GAC TAA ACC AAC CAA CAC
6631 CTT TTT GCT TAA GAC TTC TTG CCT TCA GGA CTG TGA GAA GGT AGC TTC CTA TTG TTC TAA GCC CCA GTA TGT GGC ATT
6709 TTG TTA AGG TAG AGT CAA GAA ACC AAT AAA ATG CAG ACA GAC AAA AGG ATA GCT GAG TTT TCC AGG CCC TTC CTT CTT
6787 ATT TTT GGT TTT GTT GGT GGT GGT GGT GGT GGT GGT GAT GGT GGT GGT TTT GTT TAT GTT TTG TTT GGG GAG TTT TTT
6865 GGG GTT TTT TTG GGT TTT GTT TTT GTT GTT GTT TTG GGG GTT TTT GTT GTT GTT GTT GTT TGC TTT TTT GTT TTT TGT
6943 TTT TTG TTT TTT TGA GAC AGT GTT TCT CTG TAT AGC CCT GGC TGT CCT GGA GTT CCT TCT ATC TCT AAT GTC TAC ATC
7021 TCA GAG GGG ATC CTC TAA TTT CAA ATG AGC AGT AGC TCT CCA TTT TTA GCT CTT ATT TAT TCA TTT ATT TAC TTA CTT
7099 ACT TAT TGT CTG TAG ATG AAA GAA TTT TGG AGT GGG AAA GGG TTC ATG AGC CCC CAG CAA CTA ATG AGG AGC TAC AGA
7177 CAA TTG ATG TTT CTG GGG AAA GGA GAC TCA GTT TCT TTG AGA GTA TAG CTT CTG ATG GGT CAA CCA TGT TCC TGT GGC
7255 TGA TGT CAC ACC CAG GAG TAT GCA GAC AAC AGA AAC TGG AGT TAA TGA GTT GTT TTA AAA ATA AAA AAG GGC ATG AAG
7333 CTT GGG ATA GAA ATT AAG GAT AAA TAC AAT TAA ATA CAG GAA ATT CTG AAA GAA TTA ATA AAA ACA TTT CTT TTT TTA
7411 AAA AAA AAT CCA GAA TTA GCT ATG CTT CTT CAA AAT TGC TTC TGG AGA ACT TTA CAA GTT AAA TAA GTT ATA TTG TAG
7489 AAA AGG TAG AGA GGA GAA TAG TGG AAG AGA GAG ATA AGG AGA CTT CAA AAG GAG TGG AGG GAG ATA GAG GAG GAG AAA
7567 GCA GAA GCA ATG GCT GAT AGA CAC AGG ATA AGA GGG AAC AGA AAG GAG AAA GAG GAA GCC AGG ATG GGT ATT TCT TTG
7645 CCT ATC TGT GAC TTG CAC ATG GTC TTG GCA ATT ATT GAT GAG TTC AAG GCT TAA TTC TTC ACT TGT GCC AAC TCA ACA
7723 GAG TCT TTC TTT CTT ATA ACC AGG CCC CCA GTA TGC TCA TGT ATG TAT CAG GTC CTC TTA TCT CCT TAT AGC AAT CCT
7801 GTT TAT AAC TGG GTA ACT TTG TGA AGG GAA GGA AGT GCA CAC TGA GAT GTG CTA CAA CTT TTT AAT ACA AAA TTT TGA
7879 AGA GTT TGT ACA ATG TAT GTA TAA TTA ATA ATT AAT ATT ATG CAC TTT AGA TTT TGA TTT CAA CTC AAG ATA CTA ATT
7957 CTA TAT ATA TGG GTT AAA TCA ATA TAT TAA TAA GTT TAA TTT CAC ATG CTT ATT TTT ATT GTG GTT TTC GAG ACA GGG
8035 TTT CTC TGT ATA GCC CTG GCT GTC CTG GAA CCC ACT TTG TAG ACC AGG CTG GCC TCA AAC TCA GAA ACC TAC CTG CCT
8113 CTG CCT CTG CCT CTG CCT CTG CCT CTG CCT CTG CCT CTG CCT CTG CCT CTG CCT CTG CCT CTG CCT CTG CCT CTG CCT
8191 CTG CCT CTG CCT CTG CCT CTG CCT CTG CCT CTG CCT CTG CCT CTG CCT CTG CCT CTG CCT CTG CCT CTG CCT CTG CCT
8269 CTG CCT CTG CCT CTG CCT AGT GCT GGA ATT AAA GGT TTG CGC CAC CAC GCC CGG TGA AAT TTT TAA ACT TTA TAT ATG
8347 TCT CAT TCT ATT TCT ATC AGA TAG GAC TGT GTA GAC TGT GCT AAA CTA ATA AAT GTG CCC TCA AAA GTA ATC GCA AGT
8425 TGT ATT GTT GTT GTT TTG CTT TGC TTT GCT TTG CTT TGC TTT GCT TTG CTT TGC TTT GCT TTG CTT TGC TTT GCT TTG
8503 CTT TGC TTT GCT TTG CTT TGC TTT GCT TTG CTT TGC TTT GCT TTT TTG TTT TGG GTT TTT TTC CGG GGG AGG GAG GGT

Fig. 12, contd.

8581 GGA GAA AGA ATC TTA CTA TGA AGC TCT GAC TGT CCT GGG AAC TCA CTA TAT AGA TCA GGC TTG ATT CAA CTC ATA GAG
8659 ATC TGC CTT CTT CTG CCT CCC AAG TGC TGG GAA TAA AGG CAT ACA CCT CCA TGC CCA GAT AGT GAT CCC AAG TTT TAG
8737 CAA AAG TTT CTA GAC TTG ACA TTA ATC GAT GGA GAT AGA CAT GAA TTA CAC AAA GAA CTA ATG TGG AGT TTA CCT GAA
8815 TCA TAC TCT ATA CTT TAT CAG AGA TTA AAT TAA CAT TTA ATA ATC CAG TGC CAG GCT AGA GGC ACC ATT CAA TGG CAG
8893 TGT TTG CCA TCA TGC ATA GGC TTA GTC TTC AGT GCT GAA AGG CAT TGG GGG CAA TAT TAC TCA TTA TAC AGA TGA GAA
8971 ACT GGG AAA GAC TTG CCT CAG ATT CTC TAC TGA AAG GCT GAG TTT GTG GCT TCT AGA AAA TCT TTT ACT TTC AAT ATT
9049 TTT AAT GTA TAA TTT TTT TAT TTC CAC TGA TTT TAT TTT TTA TTT TTA ACA TTT ATA AGA AAT AAA TGC AAT AAA CCA
9127 AAT ACA TGG ACA AAA AAA TAC AAG AAT CAT ATG ATC ACC TCA ATG GAA GGA AAA AAA AAG AAA GAA AAA GTC TTT GAT
9205 AAG ATT CAA CAT TCA TTC TTT TTT TAT TAG ATA TTT TCT TCA TTT ACA TTT CAA ATG CTA TCC CCA AAG CCC CCT ATA
9283 CCT TCC CCT GCC CTG CTC CCC AAC CCA CCC ACT CCT GCT TTC TGG CCC TGG CAT TCC TCT GTA CTG AGG CAT ATG ATC
9361 TTC AAA AAA CCA AGG GCC TCT CCT CTC ATT GGT GGC CGA CTA TTA GGC CAT CTT TTG CTA CAT ATG CAA CTA GAG ACA
9439 CAG CTC TGG GGG TTA CTG GTT AGT TCA TAT TGT TAG TCC TCC TAT AGA GTT GCA GAC CCC TTT AGC TCC TTG GAT ACT
9517 TTC TCT AGT TCC TTC ATT AGG GGC CCT GTG TCC CAT CCA ATA GAT GAC TGT GAG CAT CCA CTT CTG TAT TTG CCA GGC
9595 ACT GGC ATA GCC TCA CGA GAA AGA GAG AGC TAT GTC AGG ATC CTG TCA GTA AAA TCT TTC TGG CAT ATG CAA TAG TAT
9673 CTG GGT TTG GTG GTT GTA TAT GGG ATG GAT CCC CAA GTG GAG CAG TCT CTG AAT GGT CCT TCC TTC CAT CTC AGC TCC
9751 AAA CTT TGT CTC TAT AAC TCC TTC CAT GGG TAT TTT GTT CCC CAT TCT AAG AAG GAG TGA AGA ATC CAC ACT TTG GTC
9829 TTC CTT CTT CTT GAG TTT CAT ATG TTG CAT CTT GGA TAT TCT AAG TTT CTG GGT TAA TAT CCA CGT ATC AGT GAG TGC
9907 ATA TCA TGC GTG TTA TTT TGT GAT TAG TTT ACC TCA CTC AGG ATG ATA TCC TCC AGA TGC ATC CAT TTG CCT AAG AAT
9985 TTC ATT AAT TCA CTG TTT TTA ATT GCT GAA TAG TAC TCC ATT GTG TAA ATG TAC CAC ATT TTC TGT ATC CAT TCC TCT
10063 GTT GAG GGG CAT CTG GGT TCT TTC CAG CTT CTG GCT ATT ATA AAT AAG GCT GCT ATG AGC ATA GCG GAG CAT GTG TCC
10141 TTA TCA AGT TGG AAC ATC TTC TAG GTA TAT GCC CAG GAG AGG AAT TGC TGG ATC TTC CGG TAG TAC CAT CAA CAT GCA
10219 TTC TTA ATA AAA GCC CTA GAA CAA GGA GGA CTG TAG GAA ACA TAT TCC AAC ATA ATA AAG GTT ATG TAT GAC AAA CTC
10297 ATG ACC AAT ATC ATC CTA AAT GAA TGA AAC CAT TAA TAA GCT CCA TTA AAA TCA GAG GAC TGC CCA CTA TCC CTA CTT
10375 CTC ATC CAT AAT GAG ATT GAA GCA TTA GCT GGA GCA ATA AGG CAA GAG AAG GGA TAC AAA TGG GAA AAT ATT AAG TCA
10453 AAT TGT TTT CAA TTG AAG ATT ATA TTA TCT TAT ACC CAA TGA CCT CAA ATT TTG ACT AGA AAA ATT GTA GAA ATT ATC
10531 AAT AAT TTC AGC AAA GTG TTA TGA TGC ACC ACA TCC TTA TTC TTC TCC CCA GCT TCT GCT TGC TTC TCT CTT CTT GCT
10609 CTT CAT CCT TTC TGT CCT TCC ATC TGC CTG CAC TCT TGT CTC AAG ACT GAG TGC AGC GTG TAA CTC TCC TGT GAC TGA
10687 GTA TCT CAC AAA ACG TTC TAC CTG CCA AAC CTG GAT GAG CCC TTT GTC TTT CTG AAG CTA TGA GGC TCT CTA CAT AGA
10765 CTC AAG AAG GAA ATG ACA GGG AGG AGG TAA TAA TGA AGT GGG GAA GGC TGA CAT TAG CAT TGC TCC TGT GTG GCT CCT
10843 TAA TTT CTC ATA CTT CAC ACT GAG ATG TTA TTA ACT GTG ACT CAT AGG TGA AGA AGC CAG AGC TAA GGT TCT CAT ATT
10921 TGA GTG TTA TAG AAT GAG TAG AGC AGT AGT TCT CAA ACT ATG GGT CAT GAC TCC TTT ATG GGT CAA ACT ACC CTT TCA
10999 CAC AGG TTG CAT ATC AGA TAT CCT AAT TTT ATA TAC ATA TAT ATA TGC ATA TGT ATA TAT ATA TAT TTC ACA ACA GTA
11077 GGA AAA TTA TTT AGT AAT CAT TTT ATA GTT GTG GGT CAT GGC AAC ATG AGG AAC TGT ATT AAA GGG TTG CAG CAT TAG
11155 GAA TGT TGA GAC CCA CTG TAA TAG AGA ATG AGG CTT AAG GCA GGG CTA TAA AGC CCA ATG GAC CAT GTG CCT TTT CCA
11233 ACA TTT GCC ACA TGG TAA GCT CTG TAT AGA CTT TTT AAA GAA CAT TGG TTT GTA ATT TCA AAT GGA TAA GGG TCT TCA
11311 CTG TCT ATC ACC CAT CTA TAT AAT AAA TAC ATA AGT TTT GAT TCC ACC ATG GAT TCA AAT GCA AAA ATC CTC AAC CTA
11389 AGA CAT AGC AGT GAA ACA TTG ATG ACC AAA TAG GAA ATC CAT GTA GAG ACC TTC TAT CCT CTG ATG GCT CCA CAG GCA
11467 CCA TCT TGC AAC AGA GTT CTA CTT TGC TAC CAG TAA TGA ATA CAG TGT CTC AAC TCC TGC CAT TGA ATC TTC AGG AAG
11545 CCC CTG AAA TGA CTT GTA CTA CAC CAT TTC TTA AAG ACA GAA AAG CTA AGA CTT AGA GGG AAT AAA TGT CAT GCC TGA
11623 GAT CAT GCA ACC AAT TAA GTC CAA CTT GGC CTG ATC AAG AGG CAC AAT TCA AAA GCA ATG TTG TTC CTT CAC TAG CTC
11701 TTG TGT ATG GTT GCT GAT TCC GGA AGC AAA GTA TCA GTG AAT ATC CCT AGT GGG AAA AGA CTT GGA AAT CAA ATG TCT

Fig. 12, contd.

```
11779 CAT TTA ACA GAT TAG GAG ATG AAA CGG TAG ACT CTG TGT AGT TGT ACA CCC CTG TGA TCC CAT CGC TAG GAA GAC TGA
11857 GGC AGG AAG TCC TCG AGC TCA AAC CAG CTT AGG CTA CAC AGA GAA ACT ATC TAA AAA ATA ATT ACT AAC TAC TTA ATA
11935 GGA GAT TGG ATG TTA AGA TCT GGT CAC TAA GAG GCA GAA TTG AGA TTC GAA GCC AGT ATT TTC TAC CTG GTA TGT TTT
12013 AAA TTG CAG TAA GGA TCT AAG TGT AGA TAT ATA ATA ATA AGA TTC TAT TGA TCT CTG CAA CAA CAG AGA GTG TTA GAT
12091 TTG TTT GGA AAA AAA TAT TAT CAG CCA ACA TCT TCT ACC ATT TCA GTA TAG CAC AGA GTA CCC ACC CAT ATC TCC CCA
12169 CCC ATC CCC CAT ACC AGA CTG GTT ATT GAT TTT CAT GGT GAC TGG CCT GAG AAG ATT AAA AAA AGT AAT GCT ACC TTA
12247 TTG GGA GTG TCC CAT GGA CCA AGA TAG CAA CTG TCA TAG CTA CCG TCA CAC TGC TTT GAT CAA GAA GAC CCT TTG AGG
12325 AAC TGA AAA CAG AAC CTT AGG CAC ATC TGT TGC TTT CGC TCC CAT CCT CCT CCA ACA GCC TGG GTG GTG CAC TCC ACA
12403 CCC TTT CAA GTT TCC AAA GCC TCA TAC ACC TGC TCC CTA CCC CAG CAC CTG GCC AAG GCT GTA TCC AGC ACT GGG ATG
12481 AAA ATG ATA CCC CAC CTC CAT CTT GTT TGA TAT TAC TCT ATC TCA AGC CCC AGG TTA GTC CCC AGT CCC AAT GCT TTT
12559 GCA CAG TCA AAA CTC AAC TTG GAA TAA TCA GTA TCC TTG AAG AGT TCT GAT ATG GTC ACT GGG CCC ATA TAC CAT GTA
12637 AGA CAT GTG GAA AAG ATG TTT CAT GGG GCC CAG ACA CGT TCT AGA AGT ACC TGA GAG TGG CAA AAA ATA GTT GTG CTA
12715 AAT AGT TTG GCC ATC TTT AGG CTG AGA GAC TAG GAA ATA CAG CGA TGG ACT ATA TCA GCA TTG CAG GAT AGT TGT CAG
12793 TAA ACA CCC CAC AAC CCA TAA CAG AAG TAT TCT CTT CTT TCT ATA TCC CTT TTC CAT CCA TGT AGA TGG CTG TCT TCA
12871 TAT TTG TTC TAG ACG GCC GGC C
```

VkP-IGKV1-39/J-Ck-Δ2

```
   1 GGC CGG CCC ACA TGA AAC AAT GGG AAC CAT GTG ACA ATC ACA GAG GTG TTG TTA CTA TAG CAA AAG GGA TTG TTA CTC
  79 TCC ACA TCC CTT TAA GTA ACT TGA AGG CCT GAT AGA CCC ACC CTC TAA GAC TTC ATT AGA CAT TCC CTA CGA ATG GTT
 157 ATA CTC TCC TGT ATA CTC CCA ATA CAA CTC TAA AAT ATA TTA TTC CAT ATA GTC CTT AGG TTT GTA TTA AAG TTT GAC
 235 TTT TTT CCT TCA AAA TAT CTC TTG TCA CAA CAG CGG CTC TAG AGA GAA ATA CAT TCC CTC CAG GCA AAT CTA TGC TGC
 313 GCT GCT CTG ACC TGG GAC CCT GGG GAC ATT GCC CCT GTG CTG AGT TAC TAA GAT GAG CCA GCC CTG CAG CTG TGC TCA
 391 GCC TGC CCC ATG CCC TGC TGA TTG ATT TGC ATG TTC CAG AGC ACA GCC CCC TGC CCT GAA GAC TTT TTT ATG GGC TGG
 469 TCG CAC CCT GTG CAG GAG TCA GTC TCA GTC AGG AGC CAC CAT GGA CAT GAG AGT GCC CGC CCA GCT CCT GGG GCT CCT
 547 GCT ACT CTG GCT CCG AGG TAA GGA TGG AGA ACA CTA GGA ATT TAC TCA GCC AGT GTG CTC AGT ACT GAC TGG AAC TTC
 625 AGG GAA GTT CTC TGA TAA CAT GAT TAA TAG TAA GAA TAT TTG TTT TTA TGT TTC CAA TCT CAG GTG CCA GAT GTG ACA
 703 TCC AGA TGA CCC AGA GCC CCA GCA GCC TGA GCG CCA GCG TGG GCG ACA GAG TGA CCA TCA CCT GCA GAG CCA GCC AGA
 781 GCA TCA GCA GCT ACC TGA ACT GGT ATC AGC AGA AGC CCG GCA AGG CCC CCA AGC TGC TGA TCT ACG CCG CCA GCT CCC
 859 TGC AGA GCG GCG TGC CCA GCA GAT TCA GCG GCA GCG GCT CCG GCA CCG ACT TCA CCC TGA CCA TCA GCA GCC TGC AGC
 937 CCG AGG ACT TCG CCA CCT ACT ACT GCC AGC AGA GCT ACA GCA CCC CCC CCA CCT TCG GCC AGG GCA CCA AGG TGG AGA
1015 TCA AAC GTA AGT ACA CTT TTC TCA TCT TTT TTT ATG TGT AAG ACA CAG GTT TTC ATG TTA GGA GTT AAA GTC AGT TCA
1093 GAA AAT CTT GAG AAA ATG GAG AGG GCT CAT TAT CAG TTG ACG TGG CAT ACA GTG TCA GAT TTT CTG TTT ATC AAG CTA
1171 GTG AGA TTA GGG GCA AAA AGA GGC TTT AGT TGA GAG GAA AGT AAT TAA TAC TAT GGT CAC CAT CCA AGA GAT TGG ATC
1249 GGA GAA TAA GCA TGA GTA GTT ATT GAG ATC TGG GTC TGA CTG CAG GTA GCG TGG TCT TCT AGA CGT TTA AGT GGG AGA
1327 TTT GGA GGG GAT GAG GAA TGA AGG AAC TTC AGG ATA GAA AAG GGC TGA AGT CAA GTT CAG CTC CTA AAA TGG ATG TGG
1405 GAG CAA ACT TTG AAG ATA AAC TGA ATG ACC CAG AGG ATG AAA CAG CGC AGA TCA AAG AGG GGC CTG GAG CTC TGA GAA
1483 GAG AAG GAG ACT CAT CCG TGT TGA GTT TCC ACA AGT ACT GTC TTG AGT TTT GCA ATA AAA GTG GGA TAG CAG AGT TGA
1561 GTG AGC CGT AGG CTG AGT TCT CTC TTT TGT CTC CTA AGT TTT TAT GAC TAC AAA AAT CAG TAG TAT GTC CTG AAA TAA
1639 TCA TTA AGC TGT TTG AAA GTA TGA CTG CTT GCC ATG TAG ATA CCA TGG CTT GCT GAA TAA TCA GAA GAG GTG TGA CTC
1717 TTA TTC TAA AAT TTG TCA CAA AAT GTC AAA ATG AGA GAC TCT GTA GGA ACG AGT CCT TGA CAG ACA GCT CAA GGG GTT
```

Fig. 12, contd.

1795 TTT TTC CTT TGT CTC ATT TCT ACA TGA AAG TAA ATT TGA AAT GAT CTT TTT TAT TAT AAG AGT AGA AAT ACA GTT GGG
1873 TTT GAA CTA TAT GTT TTA ATG GCC ACG GTT CTG TAA GAC ATT TGG TCC TTT GTT TTC CCA GTT ATT ACT CGA TTG TAA
1951 TTT TAT ATC GCC AGC AAT GGA CTG AAA CGG TCC GCA ACC TCT TCT TTA CAA CTG GGT GAC CTC GCG GCT GTG CCA GCC
2029 ATT TGG CGT TCA CCC TGC CGC TAA GGG CCA TGT GAA CCC CCG CGG TAG CAT CCC TTG CTC CGC GTG GAC CAC TTT CCT
2107 GAG GCA CAG TGA TAG GAA CAG AGC CAC TAA TCT GAA GAG AAC AGA GAT GTG ACA GAC TAC ACT AAT GTG AGA AAA ACA
2185 AGG AAA GGG TGA CTT ATT GGA GAT TTC AGA AAT AAA ATG CAT TTA TTA TTA TAT TCC CTT ATT TTA ATT TTC TAT TAG
2263 GGA ATT AGA AAG GGC ATA AAC TGC TTT ATC CAG TGT TAT ATT AAA AGC TTA ATG TAT ATA ATC TTT TAG AGG TAA AAT
2341 CTA CAG CCA GCA AAA GTC ATG GTA AAT ATT CTT TGA CTG AAC TCT CAC TAA ACT CCT CTA AAT TAT ATG TCA TAT TAA
2419 CTG GTT AAA TTA ATA TAA ATT TGT GAC ATG ACC TTA ACT GGT TAG GTA GGA TAT TTT TCT TCA TGC AAA AAT ATG ACT
2497 AAT AAT AAT TTA GCA CAA AAA TAT TTC CCA ATA CTT TAA TTC TGT GAT AGA AAA ATG TTT AAC TCA GCT ACT ATA ATC
2575 CCA TAA TTT TGA AAA CTA TTT ATT TGG CTA CAC CAA AGG AAG CCA TAC AGA GGC TAA TAT CAG AGT ATT CTT GGA AGA
2653 GAC AGG AGA AAA TGA AAG CCA GTT TCT GCT CTT ACC TTA TGT GCT TGT GTT CAG ACT CCC AAA CAT CAG GAG TGT CAG
2731 ATA AAC TGG TCT GAA TCT CTG TCT GAA GCA TGG AAC TGA AAA GAA TGT AGT TTC AGG GAA GAA AGG CAA TAG AAG GAA
2809 GCC TGA GAA TAT CTT CAA AGG GTC AGA CTC AAT TTA CTT TCT AAA GAA GTA GCT AGG AAC TAG GGA ATA ACT TAG AAA
2887 CAA CAA GAT TGT ATA TAT GTG CAT CCT GGC CCC ATT GTT CCT TAT CTG TAG GGA TAA GCG TGC TTT TTT GTG TGT CTG
2965 TAT ATA ACA TAA CTG TTT ACA CAT AAT ACA CTG AAA TGG AGC CCT TCC TTG TTA CTT CAT ACC ATC CTC TGT GCT TCC
3043 TTC CTC AGG GGC CGA CGC CGC TCC CAC CGT GTC CAT CTT CCC CCC CAG CAT GGA ACA GCT GAC CTC TGG CGG AGC CAC
3121 CGT GGT CTG CTT CGT GAA CAA CTT CTA CCC CAG AGA CAT CAG CGT GAA GTG GAA GAT CGA CGG CAG CGA GCA GAG GGA
3199 CGG CGT GCT GGA CAG CGT GAC CGA CCA GGA CAG CAA GGA CTC CAC CTA CAG CAT GAG CAG CAC CCT GAG CCT GAC CAA
3277 GGT GGA GTA CGA GAG GCA CAA CCT GTA CAC CTG CGA GGT GGT GCA CAA GAC CAG CTC CAG CCC CGT GGT CAA GTC CTT
3355 CAA CCG GAA CGA GTG TTG AAG ACA AAG GTC CTG AGA CGC CAC CAC CAG CTC CCC AGC TCC ATC CTA TCT TCC CTT CTA
3433 AGG TCT TGG AGG CTT CCC CAC AAG CGA CCT ACC ACT GTT GCG GTG CTC CAA ACC TCC TCC CCA CCT CCT TCT CCT CCT
3511 CCT CCC TTT CCT TGG CTT TTA TCA TGC TAA TAT TTG CAG AAA ATA TTC AAT AAA GTG AGT CTT TGC ACT TGA GAT CTC
3589 TGT CTT TCT TAC TAA ATG GTA GTA ATC AGT TGT TTT TCC AGT TAC CTG GGT TTC TCT TCT AAA GAA GTT AAA TGT TTA
3667 GTT GCC CTG AAA TCC ACC ACA CTT AAA GGA TAA ATA AAA CCC TCC ACT TGC CCT GGT TGG CTG TCC ACT ACA TGG CAG
3745 TCC TTT CTA AGG TTC ACG AGT ACT ATT CAT GGC TTA TTT CTC TGG GCC ATG GTA GGT TTG AGG AGG CAT ACT TCC TAG
3823 TTT TCT TCC CCT AAG TCG TCA AAG TCC TGA AGG GGG ACA GTC TTT ACA AGC ACA TGT TCT GTA ATC TGA TTC AAC CTA
3901 CCC AGT AAA CTT GGC GAA GCA AAG TAG AAT CAT TAT CAC AGG AAG CAA AGG CAA CCT AAA TGT GCA AGC AAT AGG AAA
3979 ATG TGG AAG CCC ATC ATA GTA CTT GGA CTT CAT CTG CTT TTG TGC CTT CAC TAA GTT TTT AAA CAT GAG CTG GCT CCT
4057 ATC TGC CAT TGG CAA GGC TGG GCA CTA CCC ACA ACC TAC TTC AAG GAC CTC TAT ACC GTG AGA TTA CAC ACA TAC ATC
4135 AAA ATT TGG GAA AAG TTC TAC CAA GCT GAG AGC TGA TCA CCC CAC TCT TAG GTG CTT ATC TCT GTA CAC CAG AAA CCT
4213 TAA GAA GCA ACC AGT ATT GAG AGA CTC ATT TAT GAA AGT CTA AAA CTG GAT ACA ACC AAA ATG TCC ACC AAC AGT TAA
4291 ATT ATG ACA TGT TCA CAA TTG AGC TAT TAC TTA ATA AGG AGA ATT AAT AAA ATA AAA CTT AAG AGC ATA GTT TAA TCT
4369 CAT AAA CAA GAT AAT AAG CAA AAC AAA ACA TTT TTT CAT CCA TGT AAG TTT AAA AGC AGG TAA AAT TTA AAA TTA AGA
4447 GAG ACA TAA GTT TTG AGG TAG CAA GAT GGA AAC TCT GGG GCT TGG GGA ATG TTC TGT CTC TCT GTA TGG GAT GTG AAA
4525 GTT ACT ATT GTG GAA TTG GGA TCT ATG TTC TTC CTG TAT ATA TTG TAT ACT TCA TAA TAA CTT CAC CTA AAG AAA TAT
4603 CTA ATA CCC AGT GCA TAC ATA AAA GAG GAT ACA AGG AAT GAA TCA TAC GTC AAG GCC AGA AAG ACA ATA AAG TAG GGG
4681 ATC CAG GAT CAA ATC TCC CAC AAC CTT GAG CCT TCT ACT ATT CTG CCT TCC AGA GCT CAA AGT ACA AAA CAC ATA ATT
4759 CAA ACA CAT GAT CCC TCC TTG GGG TCT CTT CCT TCA TGC ATC GAA TTA GAA ATA GCC ATG TAT AAA ATG AGA TAG AAG
4837 AGA CCT TCA TCA ACA GGT CAA AGA ATA TAG GTA ATT TTG TCT GGG TAT GAA GAG CCC ACG TAT CAA AGG TTA CAT TAG
4915 GGA AGG AAG AGG ACA CTA ACA GTG ACT TTC ATT CTC CCC CTC TTC CTG GAG GCC CCT GCA TTT AGT CCC TCG TGG GCT

Fig. 12, contd.

4993 CAT CCA CTC AGC ACA CAT TTA CTA AGC ATC TTC TCA GCC TAC ACT CTG AAG GCA GTG CAG AAT AAT GTT AGT GTC CCT
5071 TCC CCC AGT TAA TAT GCA GTC CAG TTT CCC TGC TCC TTC CCT TTC TCA GTC CAC ATA AGG ATG ATG GGA AAG GAC AGT
5149 CAC CAA ATA GGA GAG GGC AAC CCT TTG CCT TCC TAC CTC TTG AGA ATG TAC ATT ATT ATC CAC TTT TTG AAA CTT CTT
5227 TTA ATT GCT TTT TTT TAA TTT GTC TTT TCA AAT AGC ATA ACC TTG TTC ATC CAT TTC TGG GAA CCA AAT TTA TCA ATC
5305 AAC AGT GCC TCT AAT CTG GCT ATT AAT ACA AAA ATG CCT CCT CAA AAT ATA TAT GTT CGA GTC TTA TCT AAA ACA GAA
5383 CCC ACA ATA AAA AAG AAG AAA GAA TAC ATA TAA GCA TTT ATA TAA TTC TGA GCA ACC TTG TGC TTT GTG AAA AAA ATA
5461 TAA TCT AAT GTC ACA TGC TGT ATT CTT TTT ATT TAA CAC TGG TGA AAT TAT ACC ATT AGA GAG AAA GAG GAC AGA TCA
5539 CTG ATC CTA GGA TCT AGG GAT GTT ACA GAT AAG AAA ACA AAT GTG ACA AAG AGC TGT CAC AAG GAG GAT CTT CAA GGT
5617 CAC AGA ATC ACT GTC TTG ATT TCA GTG GTG GTT ACA TAC ATT TAA ATA TGT GAT AAA ATG TTG TTG AAC TAT ATT CAT
5695 ATA TTG TAC CAA TGT CAA ATG CTT AAT TTT GGC TCT ATA GTA TAA TTA TGC ACT AAA TAA CTA TTT GGA CAA AGA AAA
5773 TGA TGT TTA CAT CAA AGG TGA GGC CAT ATT TGT TAG GAA CAT AAC TTA AAA ACC ATT TTG GAT AAC TAA TGA AAA GCC
5851 ATT TTG TGT GCC TTG GCA TAT CAT GCC TAA GCT GTC ACC AGA TAG ATC TAA TAA GAC CTA AGC CTC AGA AGC AAG CCC
5929 CTG CCC AGC AAG CAG GCA GCA CAG ATA AGA GCT AAA CCC AGG ACA GGC CAT GAT ATG CTA ATG AAC TAC CTT CAA GGT
6007 GGT GTT GCT GAC CTA GTG AAC CAG CCC CAA GCT GTG AGC CCC AAT AGC ACA AAG CTA CTG CCC AAA GAA ATT ATA CAA
6085 AAA TTG GAA CTT TGG GAA TGG TGT GCA GGA TCG CTC TGC TGT ATG CCT GGA ACA CAG CTT CTC TAT GTT TTG TAT TGA
6163 TAC CAG TCT AGA AGC TTC CAA AAC TTT CTC ACT GAA GAA GAT TCC CCA TGT GGG ACC CCT ACA GAC TCT TTT GCC CAA
6241 ACA ACT GCT TCC CTC CTG GTG TGA TCA TGG ACC AAG ATA GCA ACT GTC ATA GCT ACC GTC ACA CTG CTT TGA TCA AGA
6319 AGA CCC TTT GAG GAA CTG AAA ACA GAA CCT TAG GCA CAT CTG TTG CTT TCG CTC CCA TCC TCC TCC AAC AGC ATG GCT
6397 GTC TTC ATA TTT GTT CTA GAC GGC CGG CC

VkP-IGLV2-14/J-Ck

1 GGC CGG CCC ACA TGA AAC AAT GGG AAC CAT GTG ACA ATC ACA GAG GTG TTG TTA CTA TAG CAA AAG GGA TTG TTA CTC
79 TCC ACA TCC CTT TAA GTA ACT TGA AGG CCT GAT AGA CCC ACC CTC TAA GAC TTC ATT AGA CAT TCC CTA CGA ATG GTT
157 ATA CTC TCC TGT ATA CTC CCA ATA CAA CTC TAA AAT ATA TTA TTC CAT ATA GTC CTT AGG TTT GTA TTA AAG TTT GAC
235 TTT TTT CCT TCA AAA TAT CTC TTG TCA CAA CAG CGG CTC TAG AGA GAA ATA CAT TCC CTC CAG GCA AAT CTA TGC TGC
313 GCT GGT CTG ACC TGG GAC CCT GGG GAC ATT GCC CCT GTG CTG AGT TAC TAA GAT GAG CCA GCC CTG CAG CTG TGC TCA
391 GCC TGC CCC ATG CCC TGC TGA TTG ATT TGC ATG TTC CAG AGC ACA GCC CCC TGC CCT GAA GAC TTT TTT ATG GGC TGG
469 TCG CAC CCT GTG CAG GAG TCA GTC TCA GTC AGG AGC CAC CAT GGA CAT GAG AGT GCC CGC CCA GCT CCT GGG GCT CCT
547 GCT ACT CTG GCT CCG AGG TAA GGA TGG AGA ACA CTA GGA ATT TAC TCA GCC AGT GTG CTC AGT ACT GAC TGG AAC TTC
625 AGG GAA GTT CTC TGA TAA CAT GAT TAA TAG TAA GAA TAT TTG TTT TTA TGT TTC CAA TCT CAG GTG CCA GAT GTC AGT
703 CTG CCC TGA CCC AGC CCG CCT CTG TGT CTG GCA GCC CTG GCC AGA GCA TCA CCA TCA GCT GCA CCG GCA CCA GCA GCG
781 ACG TGG GCG GCT ACA ACT ACG TGT CCT GGT ATC AGC AGC ACC CCG GCA AGG CCC CCA AGC TGA TGA TCT ACG AGG TGT
859 CCA ACA GAC CCA GCG GCG TGA GCA ACA GAT TCA GCG GCA GCA AGA GCG GCA ACA CCG CCA GCC TGA CCA TCA GCG GCC
937 TCC AGG CTG AGG ACG AGG CCG ACT ACT ACT GCA GCA GCT ACA CCA GCA GCT CCA CCC TGG TGT TTG GCG GCG GAA CAA
1015 AGC TGA CCG TGC TGC GTA AGT ACA CTT TTC TCA TCT TTT TTT ATG TGT AAG ACA CAG GTT TTC ATG TTA GGA GTT AAA
1093 GTC AGT TCA GAA AAT CTT GAG AAA ATG GAG AGG GCT CAT TAT CAG TTG ACG TGG CAT ACA GTG TCA GAT TTT CTG TTT
1171 ATC AAG CTA GTG AGA TTA GGG GCA AAA AGA GGC TTT AGT TGA GAG GAA AGT AAT TAA TAC TAT GGT CAC CAT CCA AGA
1249 GAT TGG ATC GGA GAA TAA GCA TGA GTA GTT ATT GAG ATC TGG GTC TGA CTG CAG GTA GCG TGG TCT TCT AGA CGT TTA
1327 AGT GGG AGA TTT GGA GGG GAT GAG GAA TGA AGG AAC TTC AGG ATA GAA AAG GGC TGA AGT CAA GTT CAG CTC CTA AAA
1405 TGG ATG TGG GAG CAA ACT TTG AAG ATA AAC TGA ATG ACC CAG AGG ATG AAA CAG CGC AGA TCA AAG AGG GGC CTG GAG
1483 CTC TGA GAA GAG AAG GAG ACT CAT CCG TGT TGA GTT TCC ACA AGT ACT GTC TTG AGT TTT GCA ATA AAA GTG GGA TAG

Fig. 12, contd.

1561 CAG AGT TGA GTG AGC CGT AGG CTG AGT TCT CTC TTT TGT CTC CTA AGT TTT TAT GAC TAC AAA AAT CAG TAG TAT GTC
1639 CTG AAA TAA TCA TTA AGC TGT TTG AAA GTA TGA CTG CTT GCC ATG TAG ATA CCA TGG CTT GCT GAA TAA TCA GAA GAG
1717 GTG TGA CTC TTA TTC TAA AAT TTG TCA CAA AAT GTC AAA ATG AGA GAC TCT GTA GGA ACG AGT CCT TGA CAG ACA GCT
1795 CAA GGG GTT TTT TTC CTT TGT CTC ATT TCT ACA TGA AAG TAA ATT TGA AAT GAT CTT TTT TAT TAT AAG AGT AGA AAT
1873 ACA GTT GGG TTT GAA CTA TAT GTT TTA ATG GCC ACG GTT TTG TAA GAC ATT TGG TCC TTT GTT TTC CCA GTT ATT ACT
1951 CGA TTG TAA TTT TAT ATC GCC AGC AAT GGA CTG AAA CGG TCC GCA ACC TCT TCT TTA CAA CTG GGT GAC CTC GCG GCT
2029 GTG CCA GCC ATT TGG CGT TCA CCC TGC CGC TAA GGG CCA TGT GAA CCC CCG CGG TAG CAT CCC TTG CTC CGC GTG GAC
2107 CAC TTT CCT GAG GCA CAG TGA TAG GAA CAG AGC CAC TAA TCT GAA GAG AAC AGA GAT GTG ACA GAC TAC ACT AAT GTG
2185 AGA AAA ACA AGG AAA GGG TGA CTT ATT GGA GAT TTC AGA AAT AAA ATG CAT TTA TTA TTA TAT TCC CTT ATT TTA ATT
2263 TTC TAT TAG GGA ATT AGA AAG GGC ATA AAC TGC TTT ATC CAG TGT TAT ATT AAA AGC TTA ATG TAT ATA ATC TTT TAG
2341 AGG TAA AAT CTA CAG CCA GCA AAA GTC ATG GTA AAT ATT CTT TGA CTG AAC TCT CAC TAA ACT CCT CTA AAT TAT ATG
2419 TCA TAT TAA CTG GTT AAA TTA ATA TAA ATT TGT GAC ATG ACC TTA ACT GGT TAG GTA GGA TAT TTT TCT TCA TGC AAA
2497 AAT ATG ACT AAT AAT AAT TTA GCA CAA AAA TAT TTC CCA ATA CTT TAA TTC TGT GAT AGA AAA ATG TTT AAC TCA GCT
2575 ACT ATA ATC CCA TAA TTT TGA AAA CTA TTT ATT AGC TTT TGT GTT TGA CCC TTC CCT AGC CAA AGG CAA CTA TTT AAG
2653 GAC CCT TTA AAA CTC TTG AAA CTA CTT TAG AGT CAT TAA GTT ATT TAA CCA CTT TTA ATT ACT TTA AAA TGA TGT CAA
2731 TTC CCT TTT AAC TAT TAA TTT ATT TTA AGG GGG GAA AGG CTG CTC ATA ATT CTA TTG TTT TTC TTG GTA AAG AAC TCT
2809 CAG TTT TCG TTT TTA CTA CCT CTG TCA CCC AAG AGT TGG CAT CTC AAC AGA GGG GAC TTT CCG AGA GGC CAT CTG GCA
2887 GTT GCT TAA GAT CAG AAG TGA AGT CTG CCA GTT CCT CCC AGG CAG GTG GCC CAG ATT ACA GTT GAC CTG TTC TGG TGT
2965 GGC TAA AAA TTG TCC CAT GTG GTT ACA AAC CAT TAG ACC AGG GTC TGA TGA ATT GCT CAG AAT ATT TCT GGA CAC CCA
3043 AAT ACA GAC CCT GGC TTA AGG CCC TGT CCA TAC AGT AGG TTT AGC TTG GCT ACA CCA AAG GAA GCC ATA CAG AGG CTA
3121 ATA TCA GAG TAT TCT TGG AAG AGA CAG GAG AAA ATG AAA GCC AGT TTC TGC TCT TAC CTT ATG TGC TTG TGT TCA GAC
3199 TCC CAA ACA TCA GGA GTG TCA GAT AAA CTG GTC TGA ATC TCT GTC TGA AGC ATG GAA CTG AAA AGA ATG TAG TTT CAG
3277 GGA AGA AAG GCA ATA GAA GGA AGC CTG AGA ATA TCT TCA AAG GGT CAG ACT CAA TTT ACT TTC TAA AGA AGT AGC TAG
3355 GAA CTA GGG AAT AAC TTA GAA ACA ACA AGA TTG TAT ATA TGT GCA TCC TGG CCC CAT TGT TCC TTA TCT GTA GGG ATA
3433 AGC GTG CTT TTT TGT GTG TCT GTA TAT AAC ATA ACT GTT TAC ACA TAA TAC ACT GAA ATG GAG CCC TTC CTT GTT ACT
3511 TCA TAC CAT CCT CTG TGC TTC CTT CCT CAG GGG CCG ACG CCG CTC CCA CCG TGT CCA TCT TCC CCC CCA GCA TGG AAC
3589 AGC TGA CCT CTG GCG GAG CCA CCG TGG TCT GCT TCG TGA ACA ACT TCT ACC CCA GAG ACA TCA GCG TGA AGT GGA AGA
3667 TCG ACG GCA GCG AGC AGA GGG ACG GCG TGC TGG ACA GCG TGA CCG ACC AGG ACA GCA AGG ACT CCA CCT ACA GCA TGA
3745 GCA GCA CCC TGA GCC TGA CCA AGG TGG AGT ACG AGA GGC ACA ACC TGT ACA CCT GCG AGG TGG TGC ACA AGA CCA GCT
3823 CCA GCC CCG TGG TCA AGT CCT TCA ACC GGA ACG AGT GTT GAA GAC AAA GGT CCT GAG ACG CCA CCA CCA GCT CCC CAG
3901 CTC CAT CCT ATC TTC CCT TCT AAG GTC TTG GAG GCT TCC CCA CAA GCG ACC TAC CAC TGT TGC GGT GCT CCA AAC CTC
3979 CTC CCC ACC TCC TTC TCC TCC TCC TCC CTT TCC TTG GCT TTT ATC ATG CTA ATA TTT GCA GAA AAT ATT CAA TAA AGT
4057 GAG TCT TTG CAC TTG AGA TCT CTG TCT TTC TTA CTA AAT GGT AGT AAT CAG TTG TTT TTC CAG TTA CCT GGG TTT CTC
4135 TTC TAA AGA AGT TAA ATG TTT AGT TGC CCT GAA ATC CAC CAC ACT TAA AGG ATA AAT AAA ACC CTC CAC TTG CCC TGG
4213 TTG GCT GTC CAC TAC ATG GCA GTC CTT TCT AAG GTT CAC GAG TAC TAT TCA TGG CTT ATT TCT CTG GGC CAT GGT AGG
4291 TTT GAG GAG GCA TAC TTC CTA GTT TTC TTC CCC TAA GTC GTC AAA GTC CTG AAG GGG GAC AGT CTT TAC AAG CAC ATG
4369 TTC TGT AAT CTG ATT CAA CCT ACC CAG TAA ACT TGG CGA AGC AAA GTA GAA TCA TTA TCA CAG GAA GCA AAG GCA ACC
4447 TAA ATG TGC AAG CAA TAG GAA AAT GTG GAA GCC CAT CAT AGT ACT TGG ACT TCA TCT GCT TTT GTG CCT TCA CTA AGT
4525 TTT TAA ACA TGA GCT GGC TCC TAT CTG CCA TTG GCA AGG CTG GGC ACT ACC CAC AAC CTA CTT CAA GGA CCT CTA TAC
4603 CGT GAG ATT ACA CAC ATA CAT CAA AAT TTG GGA AAA GTT CTA CCA AGC TGA GAG CTG ATC ACC CCA CTC TTA GGT GCT
4681 TAT CTC TGT ACA CCA GAA ACC TTA AGA AGC AAC CAG TAT TGA GAG ACT CAT TTA TGA AAG TCT AAA ACT GGA TAC AAC

Fig. 12, contd.

4759 CAA AAT GTC CAC CAA CAG TTA AAT TAT GAC ATG TTC ACA ATT GAG CTA TTA CTT AAT AAG GAG AAT TAA TAA AAT AAA
4837 ACT TAA GAG CAT AGT TTA ATC TCA TAA ACA AGA TAA TAA GCA AAA CAA AAC ATT TTT TCA TCC ATG TAA GTT TAA AAG
4915 CAG GTA AAA TTT AAA ATT AAG AGA GAC ATA AGT TTT GAG GTA GCA AGA TGG AAA CTC TGG GGC TTG GGG AAT GTT CTG
4993 TCT CTC TGT ATG GGA TGT GAA AGT TAC TAT TGT GGA ATT GGG ATC TAT GTT CTT CCT GTA TAT ATT GTA TAC TTC ATA
5071 ATA ACT TCA CCT AAA GAA ATA TCT AAT ACC CAG TGC ATA CAT AAA AGA GGA TAC AAG GAA TGA ATC ATA CGT CAA GGC
5149 CAG AAA GAC AAT AAA GTA GGG GAT CCA GGA TCA AAT CTC CCA CAA CCT TGA GCC TTC TAC TAT TCT GCC TTC CAG AGC
5227 TCA AAG TAC AAA ACA CAT AAT TCA AAC ACA TGA TCC CTC CTT GGG GTC TCT TCC TTC ATG CAT CGA ATT AGA AAT AGC
5305 CAT GTA TAA AAT GAG ATA GAA GAG ACC TTC ATC AAC AGG TCA AAG AAT ATA GGT AAT TTT GTC TGG GTA TGA AGA GCC
5383 CAC GTA TCA AAG GTT ACA TTA GGG AAG GAA GAG GAC ACT AAC AGT GAC TTT CAT TCT CCC CCT CTT CCT GGA GGC CCC
5461 TGC ATT TAG TCC CTC GTG GGC TCA TCC ACT CAG CAC ACA TTT ACT AAG CAT CTT CTC AGC CTA CAC TCT GAA GGC AGT
5539 GCA GAA TAA TGT TAG TGT CCC TTC CCC CAG TTA ATA TGC AGT CCA GTT TCC CTG CTC CTT CCC TTT CTC AGT CCA CAT
5617 AAG GAT GAT GGG AAA GGA CAG TCA CCA AAT AGG AGA GGG CAA CCC TTT GCC TTC CTA CCT CTT GAG AAT GTA CAT TAT
5695 TAT CCA CTT TTT GAA ACT TCT TTT AAT TGC TTT TTT TTA ATT TGT CTT TTC AAA TAG CAT AAC CTT GTT CAT CCA TTT
5773 CTG GGA ACC AAA TTT ATC AAT CAA CAG TGC CTC TAA TCT GGC TAT TAA TAC AAA AAT GCC TCC TCA AAA TAT ATA TGT
5851 TCG AGT CTT ATC TAA AAC AGA ACC CAC AAT AAA AAA GAA GAA AGA ATA CAT ATA AGC ATT TAT ATA ATT CTG AGC AAC
5929 CTT GTG CTT TGT GAA AAA AAT ATA ATC TAA TGT CAC ATG CTG TAT TCT TTT TAT TTA ACA CTG GTG AAA TTA TAC CAT
6007 TAG AGA GAA AGA GGA CAG ATC ACT GAT CCT AGG ATC TAG GGA TGT TAC AGA TAA GAA AAC AAA TGT GAC AAA GAG CTG
6085 TCA CAA GGA GGA TCT TCA AGG TCA CAG AAT CAC TGT CTT GAT TTC AGT GGT GGT TAC ATA CAT TTA AAT ATG TGA TAA
6163 AAT GTT GTT GAA CTA TAT TCA TAT ATT GTA CCA ATG TCA AAT GCT TAA TTT TGG CTC TAT AGT ATA ATT ATG CAC TAA
6241 ATA ACT ATT TGG ACA AAG AAA ATG ATG TTT ACA TCA AAG GTG AGG CCA TAT TTG TTA GGA ACA TAA CTT AAA AAC CAT
6319 TTT GGA TAA CTA ATG AAA AGC CAT TTT GTG TGC CTT GGC ATA TCA TGC CTA AGC TGT CAC CAG ATA GAT CTA ATA AGA
6397 CCT AAG CCT CAG AAG CAA GCC CCT GCC CAG CAA GCA GGC AGC ACA GAT AAG AGC TAA ACC CAG GAC AGG CCA TGA TAT
6475 GCT AAT GAA CTA CCT TCA AGG TGG TGT TGC TGA CCT AGT GAA CCA GCC CCA AGC TGT GAG CCC CAA TAG CAC AAA GCT
6553 ACT GCC CAA AGA AAT TAT ACA AAA ATT GGA ACT TTG GGA ATG GTG TGC AGG ATC GCT CTG CTG TAT GCC TGG AAC ACA
6631 GCT TCT CTA TGT TTT GTA TTG ATA CCA GTC TAG AAG CTT CCA AAA CTT TCT CAC TGA AGA AGA TTC CCC ATG TGG GAC
6709 CCC TAC AGA CTC TTT TGC CCA AAC AAC TGC TTC CCT CCT GGT GTG ATA TCT GTT TTG CTT TTA TGT TAG CAT AAT ATT
6787 ATA AGG AAT GTT TGT GTG AAT AAA CCA AAC ATA TTT TAA AAG CAA ATA TTG TAT GCA CAT CCT AAT TGC TAA AAA GTT
6865 TAC AGC TAA TAG TCC CAT GCT CTC CAC AAT ACT GGA TCC AAA TAA GTC CTA ATT TCA ATG TTG GGC ATC TTT ACA GAG
6943 AGA AAG ACA TTA AAA ATG AAG AGA CAT GCA GAG AGT GCA CCA TGC CAT CGT GGA GAC AGA CTG AAG TGA CAC AAC TGT
7021 TAG TCA AAG AGG ATT AAG GAC TTC CAG AAG CCA CCA AAG GAA GGA GGT ATG AAG TGG TTT CTC CCT CAG AGT ATC CAG
7099 AGG AGA CTA AAC CAA CCA ACA CCT TTT TGC TTA AGA CTT CTT GCC TTC AGG ACT GTG AGA AGG TAG CTT CCT ATT GTT
7177 CTA AGC CCC AGT ATG TGG CAT TTT GTT AAG GTA GAG TCA AGA AAC CAA TAA AAT GCA GAC AGA CAA AAG GAT AGC TGA
7255 GTT TTC CAG GCC CTT CCT TCT TAT TTT TGG TTT TGT TGG TGG TGG TGG TGG TGG TGG TGA TGG TGG TGG TTT TGT TTA
7333 TGT TTT GTT TGG GGA GTT TTT TGG GGT TTT TTT GGG TTT TGT TTT TGT TGT TGT TTT GGG GGT TTT TGT TGT TGT TGT
7411 TGT TTG CTT TTT TGT TTT TTG TTT TTT GTT TTT TTG AGA CAG TGT TTC TCT GTA TAG CCC TGG CTG TCC TGG AGT TCC
7489 TTC TAT CTC TAA TGT CTA CAT CTC AGA GGG GAT CCT CTA ATT TCA AAT GAG CAG TAG CTC TCC ATT TTT AGC TCT TAT
7567 TTA TTC ATT TAT TTA CTT ACT TAC TTA TTG TCT GTA GAT GAA AGA ATT TTG GAG TGG GAA AGG GTT CAT GAG CCC CCA
7645 GCA ACT AAT GAG GAG CTA CAG ACA ATT GAT GTT TCT GGG GAA AGG AGA CTC AGT TTC TTT GAG AGT ATA GCT TCT GAT
7723 GGG TCA ACC ATG TTC CTG TGG CTG ATG TCA CAC CCA GGA GTA TGC AGA CAA CAG AAA CTG GAG TTA ATG AGT TGT TTT
7801 AAA AAT AAA AAA GGG CAT GAA GCT TGG GAT AGA AAT TAA GGA TAA ATA CAA TTA AAT ACA GGA AAT TCT GAA AGA ATT
7879 AAT AAA AAC ATT TCT TTT TTT AAA AAA AAA TCC AGA ATT AGC TAT GCT TCT TCA AAA TTG CTT CTG GAG AAC TTT ACA

Fig. 12, contd.

7957 AGT TAA ATA AGT TAT ATT GTA GAA AAG GTA GAG AGG AGA ATA GTG GAA GAG AGA GAT AAG GAG ACT TCA AAA GGA GTG
8035 GAG GGA GAT AGA GGA GGA GAA AGC AGA AGC AAT GGC TGA TAG ACA CAG GAT AAG AGG GAA CAG AAA GGA GAA AGA GGA
8113 AGC CAG GAT GGG TAT TTC TTT GCC TAT CTG TGA CTT GCA CAT GGT CTT GGC AAT TAT TGA TGA GTT CAA GGC TTA ATT
8191 CTT CAC TTG TGC CAA CTC AAC AGA GTC TTT CTT TCT TAT AAC CAG GCC CCC AGT ATG CTC ATG TAT GTA TCA GGT CCT
8269 CTT ATC TCC TTA TAG CAA TCC TGT TTA TAA CTG GGT AAC TTT GTG AAG GGA AGG AAG TGC ACA CTG AGA TGT GCT ACA
8347 ACT TTT TAA TAC AAA ATT TTG AAG AGT TTG TAC AAT GTA TGT ATA ATT AAT AAT TAA TAT TAT GCA CTT TAG ATT TTG
8425 ATT TCA ACT CAA GAT ACT AAT TCT ATA TAT ATG GGT TAA ATC AAT ATA TTA ATA AGT TTA ATT TCA CAT GCT TAT TTT
8503 TAT TGT GGT TTT CGA GAC AGG GTT TCT CTG TAT AGC CCT GGC TGT CCT GGA ACC CAC TTT GTA GAC CAG GCT GGC CTC
8581 AAA CTC AGA AAC CTA CCT GCC TCT GCC TCT GCC TCT GCC TCT GCC TCT GCC TCT GCC TCT GCC TCT GCC TCT GCC TCT
8659 GCC TCT GCC TCT GCC TCT GCC TCT GCC TCT GCC TCT GCC TCT GCC TCT GCC TCT GCC TCT GCC TCT GCC TCT GCC TCT
8737 GCC TCT GCC TCT GCC TCT GCC TCT GCC TCT GCC TCT GCC TAG TGC TGG AAT TAA AGG TTT GCG CCA CCA CGC CCG GTG
8815 AAA TTT TTA AAC TTT ATA TAT GTC TCA TTC TAT TTC TAT CAG ATA GGA CTG TGT AGA CTG TGC TAA ACT AAT AAA TGT
8893 GCC CTC AAA AGT AAT CGC AAG TTG TAT TGT TGT TGT TTT GCT TTG CTT TGC TTT GCT TTG CTT TGC TTT GCT TTG CTT
8971 TGC TTT GCT TTG CTT TGC TTT GCT TTG CTT TGC TTT GCT TTG CTT TGC TTT GCT TTG CTT TGC TTT TTT GTT TTG GGT
9049 TTT TTT CCG GGG GAG GGA GGG TGG AGA AAG AAT CTT ACT ATG AAG CTC TGA CTG TCC TGG GAA CTC ACT ATA TAG ATC
9127 AGG CTT GAT TCA ACT CAT AGA GAT CTG CCT TCT TCT GCC TCC CAA GTG CTG GGA ATA AAG GCA TAC ACC TCC ATG CCC
9205 AGA TAG TGA TCC CAA GTT TTA GCA AAA GTT TCT AGA CTT GAC ATT AAT CGA TGG AGA TAG ACA TGA ATT ACA CAA AGA
9283 ACT AAT GTG GAG TTT ACC TGA ATC ATA CTC TAT ACT TTA CCA GAG ATT AAA TTA ACA TTT AAT AAT CCA GTG CCA GGC
9361 TAG AGG CAC CAT TCA ATG GCA GTG TTT GCC ATC ATG CAT AGG CTT AGT CTT CAG TGC TGA AAG GCA TTG GGG GCA ATA
9439 TTA CTC ATT ATA CAG ATG AGA AAC TGG GAA AGA CTT GCC TCA GAT TCT CTA CTG AAA GGC TGA GTT TGT GGC TTC TAG
9517 AAA ATC TTT TAC TTT CAA TAT TTT TAA TGT ATA ATT TTT TTA TTT CCA CTG ATT TTA TTT TTT ATT TTT AAC ATT TAT
9595 AAG AAA TAA ATG CAA TAA ACC AAA TAC ATG GAC AAA AAA ATA CAA GAA TCA TAT GAT CAC CTC AAT GGA AGG AAA AAA
9673 AAA GAA AGA AAA AGT CTT TGA TAA GAT TCA ACA TTC ATT CTT TTT TTA TTA GAT ATT TTC TTC ATT TAC ATT TCA AAT
9751 GCT ATC CCC AAA GCC CCC TAT ACC TTC CCC TGC CCT GCT CCC CAA CCC ACC CAC TCC TGC TTT CTG GCC CTG GCA TTC
9829 CTC TGT ACT GAG GCA TAT GAT CTT CAA AAA ACC AAG GGC CTC TCC TCT CAT TGG TGG CCG ACT ATT AGG CCA TCT TTT
9907 GCT ACA TAT GCA ACT AGA GAC ACA GCT CTG GGG GTT ACT GGT TAG TTC ATA TTG TTA GTC CTC CTA TAG AGT TGC AGA
9985 CCC CTT TAG CTC CTT GGA TAC TTT CTC TAG TTC CTT CAT TAG GGG CCC TGT GTC CCA TCC AAT AGA TGA CTG TGA GCA
10063 TCC ACT TCT GTA TTT GCC AGG CAC TGG CAT AGC CTC ACG AGA AAG AGA GAG CTA TGT CAG GAT CCT GTC AGT AAA ATC
10141 TTT CTG GCA TAT GCA ATA GTA TCT GGG TTT GGT GGT TGT ATA TGG GAT GGA TCC CCA AGT GGA GCA GTC TCT GAA TGG
10219 TCC TTC CTT CCA TCT CAG CTC CAA ACT TTG TCT CTA TAA CTC CTT CCA TGG GTA TTT TGT TCC CCA TTC TAA GAA GGA
10297 GTG AAG AAT CCA CAC TTT GGT CTT CCT TCT TCT TGA GTT TCA TAT GTT GCA TCT TGG ATA TTC TAA GTT TCT GGG TTA
10375 ATA TCC ACG TAT CAG TGA GTG CAT ATC ATG CGT GTT ATT TTG TGA TTA GTT TAC CTC ACT CAG GAT GAT ATC CTC CAG
10453 ATG CAT CCA TTT GCC TAA GAA TTT CAT TAA TTC ACT GTT TTT AAT TGC TGA ATA GTA CTC CAT TGT GTA AAT GTA CCA
10531 CAT TTT CTG TAT CCA TTC CTC TGT TGA GGG GCA TCT GGG TTC TTT CCA GCT TCT GGC TAT TAT AAA TAA GGC TGC TAT
10609 GAG CAT AGC GGA GCA TGT GTC CTT ATC AAG TTG GAA CAT CTT CTA GGT ATA TGC CCA GGA GAG GAA TTG CTG GAT CTT
10687 CCG GTA GTA CCA TCA ACA TGC ATT CTT AAT AAA AGC CCT AGA ACA AGG AGG ACT GTA GGA AAC ATA TTC CAA CAT AAT
10765 AAA GGT TAT GTA TGA CAA ACT CAT GAC CAA TAT CAT CCT AAA TGA ATG AAA CCA TTA ATA AGC TCC ATT AAA ATC AGA
10843 GGA CTG CCC ACT ATC CCT ACT TCT CAT CCA TAA TGA GAT TGA AGC ATT AGC TGG AGC AAT AAG GCA AGA GAA GGG ATA
10921 CAA ATG GGA AAA TAT TAA GTC AAA TTG TTT TCA ATT GAA GAT TAT ATT ATC TTA TAC CCA ATG ACC TCA AAT TTT GAC
10999 TAG AAA AAT TGT AGA AAT TAT CAA TAA TTT CAG CAA AGT GTT ATG ATG CAC CAC ATC CTT ATT CTT CTC CCC AGC TTC
11077 TGC TTG CTT CTC TCT TCT TGC TCT TCA TCC TTT CTG TCC TTC CAT CTG CCT GCA CTC TTG TCT CAA GAC TGA GTG CAG

Fig. 12, contd.

```
11155 CGT GTA ACT CTC CTG TGA CTG AGT ATC TCA CAA AAC GTT CTA CCT GCC AAA CCT GGA TGA GCC CTT TGT CTT TCT GAA
11233 GCT ATG AGG CTC TCT ACA TAG ACT CAA GAA GGA AAT GAC AGG GAG GAG GTA ATA ATG AAG TGG GGA AGG CTG ACA TTA
11311 GCA TTG CTC CTG TGT GGC TCC TTA ATT TCT CAT ACT TCA CAC TGA GAT GTT ATT AAC TGT GAC TCA TAG GTG AAG AAG
11389 CCA GAG CTA AGG TTC TCA TAT TTG AGT GTT ATA GAA TGA GTA GAG CAG TAG TTC TCA AAC TAT GGG TCA TGA CTC CTT
11467 TAT GGG TCA AAC TAC CCT TTC ACA CAG GTT GCA TAT CAG ATA TCC TAA TTT TAT ATA CAT ATA TAT ATG CAT ATG TAT
11545 ATA TAT ATA TTT CAC AAC AGT AGG AAA ATT ATT TAG TAA TCA TTT TAT AGT TGT GGG TCA TGG CAA CAT GAG GAA CTG
11623 TAT TAA AGG GTT GCA GCA TTA GGA ATG TTG AGA CCC ACT GTA ATA GAG AAT GAG GCT TAA GGC AGG GCT ATA AAG CCC
11701 AAT GGA CCA TGT GCC TTT TCC AAC ATT TGC CAC ATG GTA AGC TCT GTA TAG ACT TTT TAA AGA ACA TTG GTT TGT AAT
11779 TTT AAA TGG ATA AGG GTC TTC ACT GTC TAT CAC CCA TCT ATA TAA TAA ATA CAT AAG TTT TGA TTC CAC CAT GGA TTC
11857 AAA TGC AAA AAT CCT CAA CCT AAG ACA TAG CAG TGA AAC ATT GAT GAC CAA ATA GGA AAT CCA TGT AGA GAC CTT CTA
11935 TCT TCT GAT GGC TCC ACA GGC ACC ATC TTG CAA CAG AGT TCT ACT TTG CTA CCA GTA ATG AAT ACA GTG TCT CAA CTC
12013 CTG CCA TTG AAT CTT CAG GAA GCC CCT GAA ATG ACT TGT ACT ACA CCA TTT CTT AAA GAC AGA AAA GCT AAG ACT TAG
12091 AGG GAA TAA ATG TCA TGC CTG AGA TCA TGC AAC CAA TTA AGT CCA ACT TGG CCT GAT CAA GAG GCA CAA TTC AAA AGC
12169 AAT GTT GTT CCT TCA CTA GCT CTT GTG TAT GGT TGC TGA TTC CGG AAG CAA AGT ATC AGT GAA TAT CCC TAG TGG GAA
12247 AAG ACT TGG AAA TCA AAT GTC TCA TTT AAC AGA TTA GGA GAT GAA ACG GTA GAC TCT GTG TAG TTG TAC ACC CCT GTG
12325 ATC CCA TCG CTA GGA AGA CTG AGG CAG GAA GTC CTC GAG CTC AAA CCA GCT TAG GCT ACA CAG AGA AAC TAT CTA AAA
12403 AAT AAT TAC TAA CTA CTT AAT AGG AGA TTG GAT GTT AAG ATC TGG TCA CTA AGA GGC AGA ATT GAG ATT CGA AGC CAG
12481 TAT TTT CTA CCT GGT ATG TTT TAA ATT GCA GTA AGG ATC TAA GTG TAG ATA TAT AAT AAT AAG ATT CTA TTG ATC TCT
12559 GCA ACA ACA GAG AGT GTT AGA TTT GTT TGG AAA AAA ATA TTA TCA GCC AAC ATC TTC TAC CAT TTC AGT ATA GCA CAG
12637 AGT ACC CAC CCA TAT CTC CCC ACC CAT CCC CCA TAC CAG ACT GGT TAT TGA TTT TCA TGG TGA CTG GCC TGA GAA GAT
12715 TAA AAA AAG TAA TGC TAC CTT ATT GGG AGT GTC CCA TGG ACC AAG ATA GCA ACT GTC ATA GCT ACC GTC ACA CTG CTT
12793 TGA TCA AGA AGA CCC TTT GAG GAA CTG AAA ACA GAA CCT TAG GCA CAT CTG TTG CTT TCG CTC CCA TCC TCC TCC AAC
12871 AGC CTG GGT GGT GCA CTC CAC ACC CTT TCA AGT TTC CAA AGC CTC ATA CAC CTG CTC CCT ACC CCA GCA CCT GGC CAA
12949 GGC TGT ATC CAG CAC TGG GAT GAA AAT GAT ACC CCA CCT CCA TCT TGT TTG ATA TTA CTC TAT CTC AAG CCC CAG GTT
13027 AGT CCC CAG TCC CAA TGC TTT TGC ACA GTC AAA ACT CAA CTT GGA ATA ATC AGT ATC CTT GAA GAG TTC TGA TAT GGT
13105 CAC TGG GCC CAT ATA CCA TGT AAG ACA TGT GGA AAA GAT GTT TCA TGG GGC CCA GAC ACG TTC TAG AAG TAC CTG AGA
13183 GTG GCA AAA AAT AGT TGT GCT AAA TAG TTT GGC CAT CTT TAG GCT GAG AGA CTA GGA AAT ACA GCG ATG GAC TAT ATC
13261 AGC ATT GCA GGA TAG TTG TCA GTA AAC ACC CCA CAA CCC ATA ACA GAA GTA TTC TCT TCT TTC TAT ATC CCT TTT CCA
13339 TCC ATG TAG ATG GCT GTC TTC ATA TTT GTT CTA GAC GGC CGG CC
```

pSELECT-IGKV1-39/J-Ck

```
  1   GCG GCC GCA ATA AAA TAT CTT TAT TTT CAT TAC ATC TGT GTG TTG GTT TTT TGT GTG AAT CGT AAC TAA CAT ACG CTC
 79   TCC ATC AAA ACA AAA CGA AAC AAA ACA AAC TAG CAA AAT AGG CTG TCC CCA GTG CAA GTG CAG GTG CCA GAA CAT TTC
157   TCT ATC GAA GGA TCT GCG ATC GCT CCG GTG CCC GTC AGT GGG CAG AGC GCA CAT CGC CCA CAG TCC CCG AGA AGT TGG
235   GGG GAG GGG TCG GCA ATT GAA CGG GTG CCT AGA GAA GGT GGC GCG GGG TAA ACT GGG AAA GTG ATG TCG TGT ACT GGC
313   TCC GCC TTT TTC CCG AGG GTG GGG GAG AAC CGT ATA TAA GTG CAG TAG TCG CCG TGA ACG TTC TTT TTC GCA ACG GGT
391   TTG CCG CCA GAA CAC AGC TGA AGC TTC GAG GGG CTC GCA TCT CTC CTT CAC GCG CCC GCC GCC CTA CCT GAG GCC GCC
469   ATC CAC GCC GGT TGA GTC GCG TTC TGC CGC CTC CCG CCT GTG GTG CCT CCT GAA CTG CGT CCG CCG TCT AGG TAA GTT
547   TAA AGC TCA GGT CGA GAC CGG GCC TTT GTC CGG CGC TCC CTT GGA GCC TAC CTA GAC TCA GCC GGC TCT CCA CGC TTT
625   GCC TGA CCC TGC TTG CTC AAC TCT ACG TCT TTG TTT CGT TTT CTG TTC TGC GCC GTT ACA GAT CCA AGC TGT GAC CGG
```

Fig. 12, contd.

```
 703  CGC CTA CCT GAG ATC ACC GGC GTG TCG ACG CCA CCA TGG ACA TGA GAG TGC CCG CCC AGC TCC TGG GGC TCC TGC TAC
 781  TCT GGC TCC GAG GTA AGG ATG GAG AAC ACT AGG AAT TTA CTC AGC CAG TGT GCT CAG TAC TGA CTG GAA CTT CAG GGA
 859  AGT TCT CTG ATA ACA TGA TTA ATA GTA AGA ATA TTT GTT TTT ATG TTT CCA ATC TCA GGT GCC AGA TGT GAC ATC CAG
 937  ATG ACC CAG AGC CCC AGC AGC CTG AGC GCC AGC GTG GGC GAC AGA GTG ACC ATC ACC TGC AGA GCC AGC CAG AGC ATC
1015  AGC AGC TAC CTG AAC TGG TAT CAG CAG AAG CCC GGC AAG GCC CCC AAG CTG CTG ATC TAC GCC GCC AGC TCC CTG CAG
1093  AGC GGC GTG CCC AGC AGA TTC AGC GGC AGC GGC TCC GGC ACC GAC TTC ACC CTG ACC ATC AGC AGC CTG CAG CCC GAG
1171  GAC TTC GCC ACC TAC TAC TGC CAG CAG AGC TAC AGC ACC CCC CCC ACC TTC GGC CAG GGC ACC AAG GTG GAG ATC AAG
1249  AGA GCC GAC GCC GCT CCC ACC GTG TCC ATC TTC CCC CCC AGC ATG GAA CAG CTG ACC TCT GGC GGA GCC ACC GTG GTC
1327  TGC TTC GTG AAC AAC TTC TAC CCC AGA GAC ATC AGC GTG AAG TGG AAG ATC GAC GGC AGC GAG CAG AGG GAC GGC GTG
1405  CTG GAC AGC GTG ACC GAC CAG GAC AGC AAG GAC TCC ACC TAC AGC ATG AGC AGC ACC CTG AGC CTG ACC AAG GTG GAG
1483  TAC GAG AGG CAC AAC CTG TAC ACC TGC GAG GTG GTG CAC AAG ACC AGC TCC AGC CCC GTG GTC AAG TCC TTC AAC CGG
1561  AAC GAG TGT TGA GCT AGC TGG CCA GAC ATG ATA AGA TAC ATT GAT GAG TTT GGA CAA ACC ACA ACT AGA ATG CAG TGA
1639  AAA AAA TGC TTT ATT TGT GAA ATT TGT GAT GCT ATT GCT TTA TTT GTA ACC ATT ATA AGC TGC AAT AAA CAA GTT AAC
1717  AAC AAC AAT TGC ATT CAT TTT ATG TTT CAG GTT CAG GGG GAG GTG TGG GAG GTT TTT TAA AGC AAG TAA AAC CTC TAC
1795  AAA TGT GGT ATG GAA TTC TAA AAT ACA GCA TAG CAA AAC TTT AAC CTC CAA ATC AAG CCT CTA CTT GAA TCC TTT TCT
1873  GAG GGA TGA ATA AGG CAT AGG CAT CAG GGG CTG TTG CCA ATG TGC ATT AGC TGT TTG CAG CCT CAC CTT CTT TCA TGG
1951  AGT TTA AGA TAT AGT GTA TTT TCC CAA GGT TTG AAC TAG CTC TTC ATT TCT TTA TGT TTT AAA TGC ACT GAC CTC CCA
2029  CAT TCC CTT TTT AGT AAA ATA TTC AGA AAT AAT TTA AAT ACA TCA TTG CAA TGA AAA TAA ATG TTT TTT ATT AGG CAG
2107  AAT CCA GAT GCT CAA GGC CCT TCA TAA TAT CCC CCA GTT TAG TAG TTG GAC TTA GGG AAC AAA GGA ACC TTT AAT AGA
2185  AAT TGG ACA GCA AGA AAG CGA GCT TCT AGC GAA TTC TCG ACT CAT TCC TTT GCC CTC GGA CGA GTG CTG GGG CGT CGG
2263  TTT CCA CTA TCG GCG AGT ACT TCT ACA CAG CCA TCG GTC CAG ACG GCC GCG CTT CTG CGG GCG ATT TGT GTA CGC CCG
2341  ACA GTC CCG GCT CCG GAT CGG ACG ATT GCG TCG CAT CGA CCC TGC GCC CAA GCT GCA TCA TCG AAA TTG CCG TCA ACC
2419  AAG CTC TGA TAG AGT TGG TCA AGA CCA ATG CGG AGC ATA TAC GCC CGG AGC CGC GGC GAT CCT GCA AGC TCC GGA TGC
2497  CTC CGC TCG AAG TAG CGC GTC TGC TGC TCC ATA CAA GCC AAC CAC GGC CTC CAG AAG AAG ATG TTG GCG ACC TCG TAT
2575  TGG GAA TCC CCG AAC ATC GCC TCG CTC CAG TCA ATG ACC GCT GTT ATG CGG CCA TTG TCC GTC AGG ACA TTG TTG GAG
2653  CCG AAA TCC GCG TGC ACG AGG TGC CGG ACT TCG GGG CAG TCC TCG GCC CAA AGC ATC AGC TCA TCG AGA GCC TGC GCG
2731  ACG GAC GCA CTG ACG GTG TCG TCC ATC ACA GTT TGC CAG TGA TAC ACA TGG GGA TCA GCA ATC GCG CAT ATG AAA TCA
2809  CGC CAT GTA GTG TAT TGA CCG ATT CCT TGC GGT CCG AAT GGG CCG AAC CCG CTC GTC TGG CTA AGA TCG GCC GCA GCG
2887  ATC GCA TCC ATG AGC TCC GCG ACG GGT TGC AGA ACA GCG GGC AGT TCG GTT TCA GGC AGG TCT TGC AAC GTG ACA CCC
2965  TGT GCA CGG CGG GAG ATG CAA TAG GTC AGG CTC TCG CTG AAT TCC CCA ATG TCA AGC ACT TCC GGA ATC GGG AGC GCG
3043  GCC GAT GCA AAG TGC CGA TAA ACA TAA CGA TCT TTG TAG AAA CCA TCG GCG CAG CTA TTT ACC CGC AGG ACA TAT CCA
3121  CGC CCT CCT ACA TCG AAG CTG AAA GCA CGA GAT TCT TCG CCC TCC GAG AGC TGC ATC AGG TCG GAG ACG CTG TCG AAC
3199  TTT TCG ATC AGA AAC TTC TCG ACA GAC GTC GCG GTG AGT TCA GGC TTT TTC ATG ATG GCC CTC CTA TAG TGA GTC GTA
3277  TTA TAC TAT GCC GAT ATA CTA TGC CGA TGA TTA ATT GTC AAA ACA GCG TGG ATG GCG TCT CCA GCT TAT CTG ACG GTT
3355  CAC TAA ACG AGC TCT GCT TAT ATA GAC CTC CCA CCG TAC ACG CCT ACC GCC CAT TTG CGT CAA TGG GGC GGA GTT GTT
3433  ACG ACA TTT TGG AAA GTC CCG TTG ATT TAC TAG TCA AAA CAA ACT CCC ATT GAC GTC AAT GGG GTG GAG ACT TGG AAA
3511  TCC CCG TGA GTC AAA CCG CTA TCC ACG CCC ATT GAT GTA CTG CCA AAA CCG CAT CAT CAT GGT AAT AGC GAT GAC TAA
3589  TAC GTA GAT GTA CTG CCA AGT AGG AAA GTC CCA TAA GGT CAT GTA CTG GGC ATA ATG CCA GGC GGG CCA TTT ACC GTC
3667  ATT GAC GTC AAT AGG GGG CGT ACT TGG CAT ATG ATA CAC TTG ATG TAC TGC CAA GTG GGC AGT TTA CCG TAA ATA CTC
3745  CAC CCA TTG ACG TCA ATG GAA AGT CCC TAT TGG CGT TAC TAT GGG AAC ATA CGT CAT TAT TGA CGT CAA TGG GCG GGG
3823  GTC GTT GGG CGG TCA GCC AGG CGG GCC ATT TAC CGT AAG TTA TGT AAC GCC TGC AGG TTA ATT AAG AAC ATG TGA GCA
```

Fig. 12, contd.

```
3901    AAA GGC CAG CAA AAG GCC AGG AAC CGT AAA AAG GCC GCG TTG CTG GCG TTT TTC CAT AGG CTC CGC CCC CCT GAC GAG
3979    CAT CAC AAA AAT CGA CGC TCA AGT CAG AGG TGG CGA AAC CCG ACA GGA CTA TAA AGA TAC CAG GCG TTT CCC CCT GGA
4057    AGC TCC CTC GTG CGC TCT CCT GTT CCG ACC CTG CCG CTT ACC GGA TAC CTG TCC GCC TTT CTC CCT TCG GGA AGC GTG
4135    GCG CTT TCT CAT AGC TCA CGC TGT AGG TAT CTC AGT TCG GTG TAG GTC GTT CGC TCC AAG CTG GGC TGT GTG CAC GAA
4213    CCC CCC GTT CAG CCC GAC CGC TGC GCC TTA TCC GGT AAC TAT CGT CTT GAG TCC AAC CCG GTA AGA CAC GAC TTA TCG
4291    CCA CTG GCA GCA GCC ACT GGT AAC AGG ATT AGC AGA GCG AGG TAT GTA GGC GGT GCT ACA GAG TTC TTG AAG TGG TGG
4369    CCT AAC TAC GGC TAC ACT AGA AGA ACA GTA TTT GGT ATC TGC GCT CTG CTG AAG CCA GTT ACC TTC GGA AAA AGA GTT
4447    GGT AGC TCT TGA TCC GGC AAA CAA ACC ACC GCT GGT AGC GGT GGT TTT TTT GTT TGC AAG CAG CAG ATT ACG CGC AGA
4525    AAA AAA GGA TCT CAA GAA GAT CCT TTG ATC TTT TCT ACG GGG TCT GAC GCT CAG TGG AAC GAA AAC TCA CGT TAA GGG
4603    ATT TTG GTC ATG GCT AGT TAA TTA ACA TTT AAA TCA
```

pSelect-IGLV2-14/J-Ck

```
   1    GCG GCC GCA ATA AAA TAT CTT TAT TTT CAT TAC ATC TGT GTG TTG GTT TTT TGT GTG AAT CGT AAC TAA CAT ACG CTC
  79    TCC ATC AAA ACA AAA CGA AAC AAA ACA AAC TAG CAA AAT AGG CTG TCC CCA GTG CAA GTG CAG GTG CCA GAA CAT TTC
 157    TCT ATC GAA GGA TCT GCG ATC GCT CCG GTG CCC GTC AGT GGG CAG AGC GCA CAT CGC CCA CAG TCC CCG AGA AGT TGG
 235    GGG GAG GGG TCG GCA ATT GAA CGG GTG CCT AGA GAA GGT GGC GCG GGG TAA ACT GGG AAA GTG ATG TCG TGT ACT GGC
 313    TCC GCC TTT TTC CCG AGG GTG GGG GAG AAC CGT ATA TAA GTG CAG TAG TCG CCG TGA ACG TTC TTT TTC GCA ACG GGT
 391    TTG CCG CCA GAA CAC AGC TGA AGC TTC GAG GGG CTC GCA TCT CTC CTT CAC GCG CCC GCC GCC CTA CCT GAG GCC GCC
 469    ATC CAC GCC GGT TGA GTC GCG TTC TGC CGC CTC CCG CCT GTG GTG CCT CCT GAA CTG CGT CCG CCG TCT AGG TAA GTT
 547    TAA AGC TCA GGT CGA GAC CGG GCC TTT GTC CGG CGC TCC CTT GGA GCC TAC CTA GAC TCA GCC GGC TCT CCA CGC TTT
 625    GCC TGA CCC TGC TTG CTC AAC TCT ACG TCT TTG TTT CGT TTT CTG TTC TGC GCC GTT ACA GAT CCA AGC TGT GAC CGG
 703    CGC CTA CCT GAG ATC ACC GGC GTG TCG ACG CCA CCA TGG ACA TGA GAG TGC CCG CCC AGC TCC TGG GGC TCC TGC TAC
 781    TCT GGC TCC GAG GTA AGG ATG GAG AAC ACT AGG AAT TTA CTC AGC CAG TGT GCT CAG TAC TGA CTG GAA CTT CAG GGA
 859    AGT TCT CTG ATA ACA TGA TTA ATA GTA AGA ATA TTT GTT TTT ATG TTT CCA ATC TCA GGT GCC AGA TGT CAG TCT GCC
 937    CTG ACC CAG CCC GCC TCT GTG TCT GGC AGC CCT GGC CAG AGC ATC ACC ATC AGC TGC ACC GGC ACC AGC AGC GAC GTG
1015    GGC GGC TAC AAC TAC GTG TCC TGG TAT CAG CAG CAC CCC GGC AAG GCC CCC AAG CTG ATG ATC TAC GAG GTG TCC AAC
1093    AGA CCC AGC GGC GTG AGC AAC AGA TTC AGC GGC AGC AAG AGC GGC AAC ACC GCC AGC CTG ACC ATC AGC GGC CTC CAG
1171    GCT GAG GAC GAG GCC GAC TAC TAC TGC AGC AGC TAC ACC AGC AGC TCC ACC CTG GTG TTT GGC GGC GGA ACA AAG CTG
1249    ACC GTG CTG AGA GCC GAC GCC GCT CCC ACC GTG TCC ATC TTC CCC CCC AGC ATG GAA CAG CTG ACC TCT GGC GGA GCC
1327    ACC GTG GTC TGC TTC GTG AAC AAC TTC TAC CCC AGA GAC ATC AGC GTG AAG TGG AAG ATC GAC GGC AGC GAG CAG AGG
1405    GAC GGC GTG CTG GAC AGC GTG ACC GAC CAG GAC AGC AAG GAC TCC ACC TAC AGC ATG AGC AGC ACC CTG AGC CTG ACC
1483    AAG GTG GAG TAC GAG AGG CAC AAC CTG TAC ACC TGC GAG GTG GTG CAC AAG ACC AGC TCC AGC CCC GTG GTC AAG TCC
1561    TTC AAC CGG AAC GAG TGT TGA GCT AGC TGG CCA GAC ATG ATA AGA TAC ATT GAT GAG TTT GGA CAA ACC ACA ACT AGA
 937    CTG ACT CAG CCT GCC TCC GTG TCT GGG TCT CCT GGA CAG TCG ATC ACC ATC TCC TGC ACT GGA ACC AGC AGT GAC GTT
1015    GGT GGT TAT AAC TAT GTC TCC TGG TAC CAA CAG CAC CCA GGC AAA GCC CCC AAA CTC ATG ATT TAT GAG GTC AGT AAT
1093    CGG CCC TCA GGG GTT TCT AAT CGC TTC TCT GGC TCC AAG TCT GGC AAC ACG GCC TCC CTG ACC ATC TCT GGG CTC CAG
1171    GCT GAG GAC GAG GCT GAT TAT TAC TGC AGC TCA TAT ACA AGC AGC AGC ACT CTC GTA TTC GGC GGA GGG ACC AAG CTG
1249    ACC GTC CTA CGG GCT GAT GCT GCA CCA ACT GTA TCC ATC TTC CCA CCA TCC ATG GAA CAG TTA ACA TCT GGA GGT GCC
1327    ACA GTC GTG TGC TTC GTG AAC AAC TTC TAT CCC AGA GAC ATC AGT GTC AAG TGG AAG ATT GAT GGC AGT GAA CAA CGA
1405    GAT GGT GTC CTG GAC AGT GTT ACT GAT CAG GAC AGC AAA GAC AGC ACG TAC AGC ATG AGC AGC ACC CTC TCG TTG ACC
```

Fig. 12, contd.

```
1483  AAG GTT GAA TAT GAA AGG CAT AAC CTC TAT ACC TGT GAG GTT GTT CAT AAG ACA TCA TCC TCA CCC GTC GTC AAG AGC
1561  TTC AAC AGG AAT GAG TGT TAG GCT AGC TGG CCA GAC ATG ATA AGA TAC ATT GAT GAG TTT GGA CAA ACC ACA ACT AGA
1639  ATG CAG TGA AAA AAA TGC TTT ATT TGT GAA ATT TGT GAT GCT ATT GCT TTA TTT GTA ACC ATT ATA AGC TGC AAT AAA
1717  CAA GTT AAC AAC AAC AAT TGC ATT CAT TTT ATG TTT CAG GTT CAG GGG GAG GTG TGG GAG GTT TTT TAA AGC AAG TAA
1795  AAC CTC TAC AAA TGT GGT ATG GAA TTC TAA AAT ACA GCA TAG CAA AAC TTT AAC CTC CAA ATC AAG CCT CTA CTT GAA
1873  TCC TTT TCT GAG GGA TGA ATA AGG CAT AGG CAT CAG GGG CTG TTG CCA ATG TGC ATT AGC TGT TTG CAG CCT CAC CTT
1951  CTT TCA TGG AGT TTA AGA TAT AGT GTA TTT TCC CAA GGT TTG AAC TAG CTC TTC ATT TCT TTA TGT TTT AAA TGC ACT
2029  GAC CTC CCA CAT TCC CTT TTT AGT AAA ATA TTC AGA AAT AAT TTA AAT ACA TCA TTG CAA TGA AAA TAA ATG TTT TTT
2107  ATT AGG CAG AAT CCA GAT GCT CAA GGC CCT TCA TAA TAT CCC CCA GTT TAG TAG TTG GAC TTA GGG AAC AAA GGA ACC
2185  TTT AAT AGA AAT TGG ACA GCA AGA AAG CGA GCT TCT AGC GAA TTC TCG ACT CAT TCC TTT GCC CTC GGA CGA GTG CTG
2263  GGG CGT CGG TTT CCA CTA TCG GCG AGT ACT TCT ACA CAG CCA TCG GTC CAG ACG GCC GCG CTT CTG CGG GCG ATT TGT
2341  GTA CGC CCG ACA GTC CCG GCT CCG GAT CGG ACG ATT GCG TCG CAT CGA CCC TGC GCC CAA GCT GCA TCA TCG AAA TTG
2419  CCG TCA ACC AAG CTC TGA TAG AGT TGG TCA AGA CCA ATG CGG AGC ATA TAC GCC CGG AGC CGC GGC GAT CCT GCA AGC
2497  TCC GGA TGC CTC CGC TCG AAG TAG CGC GTC TGC TGC TCC ATA CAA GCC AAC CAC GGC CTC CAG AAG AAG ATG TTG GCG
2575  ACC TCG TAT TGG GAA TCC CCG AAC ATC GCC TCG CTC CAG TCA ATG ACC GCT GTT ATG CGG CCA TTG TCC GTC AGG ACA
2653  TTG TTG GAG CCG AAA TCC GCG TGC ACG AGG TGC CGG ACT TCG GGG CAG TCC TCG GCC CAA AGC ATC AGC TCA TCG AGA
2731  GCC TGC GCG ACG GAC GCA CTG ACG GTG TCG TCC ATC ACA GTT TGC CAG TGA TAC ACA TGG GGA TCA GCA ATC GCG CAT
2809  ATG AAA TCA CGC CAT GTA GTG TAT TGA CCG ATT CCT TGC GGT CCG AAT GGG CCG AAC CCG CTC GTC TGG CTA AGA TCG
2887  GCC GCA GCG ATC GCA TCC ATG AGC TCC GCG ACG GGT TGC AGA ACA GCG GGC AGT TCG GTT TCA GGC AGG TCT TGC AAC
2965  GTG ACA CCC TGT GCA CGG CGG GAG ATG CAA TAG GTC AGG CTC TCG CTG AAT TCC CCA ATG TCA AGC ACT TCC GGA ATC
3043  GGG AGC GCG GCC GAT GCA AAG TGC CGA TAA ACA TAA CGA TCT TTG TAG AAA CCA TCG GCG CAG CTA TTT ACC CGC AGG
3121  ACA TAT CCA CGC CCT CCT ACA TCG AAG CTG AAA GCA CGA GAT TCT TCG CCC TCC GAG AGC TGC ATC AGG TCG GAG ACG
3199  CTG TCG AAC TTT TCG ATC AGA AAC TTC TCG ACA GAC GTC GCG GTG AGT TCA GGC TTT TTC ATG ATG GCC CTC CTA TAG
3277  TGA GTC GTA TTA TAC TAT GCC GAT ATA CTA TGC CGA TGA TTA ATT GTC AAA ACA GCG TGG ATG GCG TCT CCA GCT TAT
3355  CTG ACG GTT CAC TAA ACG AGC TCT GCT TAT ATA GAC CTC CCA CCG TAC ACG CCT ACC GCC CAT TTG CGT CAA TGG GGC
3433  GGA GTT GTT ACG ACA TTT TGG AAA GTC CCG TTG ATT TAC TAG TCA AAA CAA ACT CCC ATT GAC GTC AAT GGG GTG GAG
3511  ACT TGG AAA TCC CCG TGA GTC AAA CCG CTA TCC ACG CCC ATT GAT GTA CTG CCA AAA CCG CAT CAT CAT GGT AAT AGC
3589  GAT GAC TAA TAC GTA GAT GTA CTG CCA AGT AGG AAA GTC CCA TAA GGT CAT GTA CTG GGC ATA ATG CCA GGC GGG CCA
3667  TTT ACC GTC ATT GAC GTC AAT AGG GGG CGT ACT TGG CAT ATG ATA CAC TTG ATG TAC TGC CAA GTG GGC AGT TTA CCG
3745  TAA ATA CTC CAC CCA TTG ACG TCA ATG GAA AGT CCC TAT TGG CGT TAC TAT GGG AAC ATA CGT CAT TAT TGA CGT CAA
3823  TGG GCG GGG GTC GTT GCG CGG TCA GCC AGG CGG GCC ATT TAC CGT AAG TTA TGT AAC GCC TGC AGG TTA ATT AAG AAC
3901  ATG TGA GCA AAA GGC CAG CAA AAG GCC AGG AAC CGT AAA AAG GCC GCG TTG CTG GCG TTT TTC CAT AGG CTC CGC CCC
3979  CCT GAC GAG CAT CAC AAA AAT CGA CGC TCA AGT CAG AGG TGG CGA AAC CCG ACA GGA CTA TAA AGA TAC CAG GCG TTT
4057  CCC CCT GGA AGC TCC CTC GTG CGC TCT CCT GTT CCG ACC CTG CCG CTT ACC GGA TAC CTG TCC GCC TTT CTC CCT TCG
4135  GGA AGC GTG GCG CTT TCT CAT AGC TCA CGC TGT AGG TAT CTC AGT TCG GTG TAG GTC GTT CGC TCC AAG CTG GGC TGT
4213  GTG CAC GAA CCC CCC GTT CAG CCC GAC CGC TGC GCC TTA TCC GGT AAC TAT CGT CTT GAG TCC AAC CCG GTA AGA CAC
4291  GAC TTA TCG CCA CTG GCA GCA GCC ACT GGT AAC AGG ATT AGC AGA GCG AGG TAT GTA GGC GGT GCT ACA GAG TTC TTG
4369  AAG TGG TGG CCT AAC TAC GGC TAC ACT AGA AGA ACA GTA TTT GGT ATC TGC GCT CTG CTG AAG CCA GTT ACC TTC GGA
4447  AAA AGA GTT GGT AGC TCT TGA TCC GGC AAA CAA ACC ACC GCT GGT AGC GGT GGT TTT TTT GTT TGC AAG CAG CAG ATT
4525  ACG CGC AGA AAA AAA GGA TCT CAA GAA GAT CCT TTG ATC TTT TCT ACG GGG TCT GAC GCT CAG TGG AAC GAA AAC TCA
4603  CGT TAA GGG ATT TTG GTC ATG GCT AGT TAA CTA ACA TTT AAA TCA
```

Fig. 12, contd.

MV1043

```
   1 CTT GAT TTG GGT GAT GGT TCA CGT AGT GGG CCA TCG CCC TGA TAG ACG GTT TTT CGC CCT TTG ACG TTG GAG TCC ACG
  79 TTC TTT AAT AGT GGA CTC TTG TTC CAA ACT GGA ACA ACA CTC AAC TCT ATC TCG GGC TAT TCT TTT GAT TTA TAA GGG
 157 ATT TTG CCG ATT TCG GTC TAT TGG TTA AAA AAT GAG CTG ATT TAA CAA AAA TTT AAC GCG AAT TTT AAC AAA ATA TTA
 235 ACG TTT ACA ATT TTA TGG TGC AGT CTC AGT ACA ATC TGC TCT GAT GCC GCA TAG TTA AGC CAG CCC CGA CAC CCG CCA
 313 ACA CCC GCT GAC GCG CCC TGA CGG GCT TGT CTG CTC CCG GCA TCC GCT TAC AGA CAA GCT GTG ACC GTC TCC GGG AGC
 391 TGC ATG TGT CAG AGG TTT TCA CCG TCA TCA CCG AAA CGC GCG AGA CGA AAG GGC CTC GTG ATA CGC CTA TTT TTA TAG
 469 GTT AAT GTC ATG ATA ATA ATG GTT TCT TAG ACG TCA GGT GGC ACT TTT CGG GGA AAT GTG CGC GGA ACC CCT ATT TGT
 547 TTA TTT TTC TAA ATA CAT TCA AAT ATG TAT CCG CTC ATG AGA CAA TAA CCC TGA TAA ATG CTT CAA TAA TAT TGA AAA
 625 AGG AAG AGT ATG AGT ATT CAA CAT TTC CGT GTC GCC CTT ATT CCC TTT TTT GCG GCA TTT TGC CTT CCT GTT TTT GCT
 703 CAC CCA GAA ACG CTG GTG AAA GTA AAA GAT GCT GAA GAT CAG TTG GGT GCC CGA GTG GGT TAC ATC GAA CTG GAT CTC
 781 AAC AGC GGT AAG ATC CTT GAG AGT TTT CGC CCC GAA GAA CGT TTT CCA ATG ATG AGC ACT TTT AAA GTT CTG CTA TGT
 859 GGC GCG GTA TTA TCC CGT ATT GAC GCC GGG CAA GAG CAA CTC GGT CGC CGC ATA CAC TAT TCT CAG AAT GAC TTG GTT
 937 GAG TAC TCA CCA GTC ACA GAA AAG CAT CTT ACG GAT GGC ATG ACA GTA AGA GAA TTA TGC AGT GCT GCC ATA ACC ATG
1015 AGT GAT AAC ACT GCG GCC AAC TTA CTT CTG ACA ACG ATC GGA GGA CCG AAG GAG CTA ACC GCT TTT TTG CAC AAC ATG
1093 GGG GAT CAT GTA ACT CGC CTT GAT CGT TGG GAA CCG GAG CTG AAT GAA GCC ATA CCA AAC GAC GAG CGT GAC ACC ACG
1171 ATG CCT GTA GCA ATG GCA ACA ACG TTG CGC AAA CTA TTA ACT GGC GAA CTA CTT ACT CTA GCT TCC CGG CAA CAA TTA
1249 ATA GAC TGG ATG GAG GCG GAT AAA GTT GCA GGA CCA CTT CTG CGC TCG GCC CTT CCG GCT GGC TGG TTT ATT GCT GAT
1327 AAA TCT GGA GCC GGT GAG CGT GGG TCT CGC GGT ATC ATT GCA GCA CTG GGG CCA GAT GGT AAG CCC TCC CGT ATC GTA
1405 GTT ATC TAC ACG ACG GGG AGT CAG GCA ACT ATG GAT GAA CGA AAT AGA CAG ATC GCT GAG ATA GGT GCC TCA CTG ATT
1483 AAG CAT TGG TAA CTG TCA GAC CAA GTT TAC TCA TAT ATA CTT TAG ATT GAT TTA AAA CTT CAT TTT TAA TTT AAA AGG
1561 ATC TAG GTG AAG ATC CTT TTT GAT AAT CTC ATG ACC AAA ATC CCT TAA CGT GAG TTT TCG TTC CAC TGA GCG TCA GAC
1639 CCC GTA GAA AAG ATC AAA GGA TCT TCT TGA GAT CCT TTT TTT CTG CGC GTA ATC TGC TGC TTG CAA ACA AAA AAA CCA
1717 CCG CTA CCA GCG GTG GTT TGT TTG CCG GAT CAA GAG CTA CCA ACT CTT TTT CCG AAG GTA ACT GGC TTC AGC AGA GCG
1795 CAG ATA CCA AAT ACT GTT CTT CTA GTG TAG CCG TAG TTA GGC CAC CAC TTC AAG AAC TCT GTA GCA CCG CCT ACA TAC
1873 CTC GCT CTG CTA ATC CTG TTA CCA GTG GCT GCT GCC AGT GGC GAT AAG TCG TGT CTT ACC GGG TTG GAC TCA AGA CGA
1951 TAG TTA CCG GAT AAG GCG CAG CGG TCG GGC TGA ACG GGG GGT TCG TGC ATA CAG CCC AGC TTG GAG CGA ACG ACC TAC
2029 ACC GAA CTG AGA TAC CTA CAG CGT GAG CTA TGA GAA AGC GCC ACG CTT CCC GAA GGG AGA AAG GCG GAC AGG TAT CCG
2107 GTA AGC GGC AGG GTC GGA ACA GGA GAG CGC ACG AGG GAG CTT CCA GGG GGA AAC GCC TGG TAT CTT TAT AGT CCT GTC
2185 GGG TTT CGC CAC CTC TGA CTT GAG CGT CGA TTT TTG TGA TGC TCG TCA GGG GGG CGG AGC CTA TGG AAA AAC GCC AGC
2263 AAC GCG GCC TTT TTA CGG TTC CTG GCC TTT TGC TGG CCT TTT GCT CAC ATG TTC TTT CCT GCG TTA TCC CCT GAT TCT
2341 GTG GAT AAC CGT ATT ACC GCC TTT GAG TGA GCT GAT ACC GCT CGC CGC AGC CGA ACG ACC GAG CGC AGC GAG TCA GTG
2419 AGC GAG GAA GCG GAA GAG CGC CCA ATA CGC AAA CCG CCT CTC CCC GCG CGT TGG CCG ATT CAT TAA TGC AGC TGG CAC
2497 GAC AGG TTT CCC GAC TGG AAA GCG GGC AGT GAG CGC AAC GCA ATT AAT GTG AGT TAG CTC ACT CAT TAG GCA CCC CAG
2575 GCT TTA CAC TTT ATG CTT CCG GCT CGT ATG TTG TGT GGA ATT GTG AGC GGA TAA CAA TTT CAC ACA GGA AAC AGC TAT
2653 GAC CAT GAT TAC GCC AAG CTT TGG AGC CTT TTT TTT GGA GAT TTT CAA CGT GAA AAA ATT ATT ATT CGC AAT TCC TTT
2731 AGT TGT TCC TTT CTA TTC TCA CAG TGC ACA GAT CCA AAT GAC CCA GTC TCC ATC CTC CCT GTC TGC ATC TGT AGG AGA
2809 CAG AGT CAC CAT CAC TTG CCG GGC AAG TCA GAG CAT TAG CAG CTA CTT AAA TTG GTA TCA GCA GAA ACC AGG GAA AGC
2887 CCC TAA GCT CCT GAT CTA TGC TGC ATC CAG TTT GCA AAG TGG GGT CCC ATC AAG GTT CAG TGG CAG TGG ATC TGG GAC
2965 AGA TTT CAC TCT CAC CAT CAG CAG TCT GCA ACC TGA AGA TTT TGC AAC TTA CTA CTG TCA ACA GAG TTA CAG TAC CCC
3043 TCC AAC GTT CGG CCA AGG GAC CAA GCT CGA GAT CAA ACG TAC TGT GGC TGC ACC ATC TGT CTT CAT CTT CCC GCC ATC
```

Fig. 12, contd.

3121 TGA TGA GCA GTT GAA ATC TGG AAC TGC CTC TGT TGT GTG CCT GCT GAA TAA CTT CTA TCC CAG AGA GGC CAA AGT ACA
3199 GTG GAA GGT GGA TAA CGC CCT CCA ATC GGG TAA CTC CCA GGA GAG TGT CAC AGA GCA GGA CAG CAA GGA CAG CAC CTA
3277 CAG CCT CAG CAG CAC CCT GAC GCT GAG CAA AGC AGA CTA CGA GAA ACA CAA AGT CTA CGC CTG CGA AGT CAC CCA TCA
3355 GGG CCT GAG CTC GCC CGT CAC AAA GAG CTT CAA CAG GGG AGA GTG TTA GTA AGG CGC GCC AAT TCT ATT TCA AGG AGA
3433 CAG TCA TAA TGA AAT ACC TAT TGC CTA CGG CAG CCG CTG GAT TGT TAT TAC TCG CGG CCC AGC CGG CCA TGG CGA TGC
3511 CTG CTT GCC GAA TAT CAT GGT GGA AAA TGG CCG CTT TTC TGG ATT CAT CGA CTG TGG CCG GCT GGG TGT GGC GGA CCG
3589 CTA TCA GGA CAT AGC GTT GGC TAC CCG TGA TAT TGC TGA AGA GCT TGG CGG CGA ATG GGC TGA CCG CTT CCT CGT GCT
3667 TTA CGG TAT CGC CGC TCC CGA TTC GCA GCG CAT CGC CTT CTA TCG CCT TCT TGA CGA GTT CTT CTG AGC GGG ACT CTG
3745 GGG TTC GGT GCT ACG AGA TTT CGA TTC CAC CGC CGC CTT CTA TGA AAG GTT GGG CTT CGG AAT CGT TTT CCG GGA CGC
3823 CGG CTG GAT GAT CCT CCA GCG CGG GGA TCT CAT GCT GGA GTT CTT CGC CCA CCC CAA CTT GTT TAT TGC AGC TTA TAA
3901 TGG TTA CAA ATA AAG CAA TAG CAT CAC AAA TTT CAC AAA TAA AGC ATT TTT TTC ACT GCA TTC TAG TTG TGG TTT GTC
3979 CAA ACT CAT CAA TGT ATC TTA TCA TGT CTG TAT ACC GTC GAC CTC TAG CTA GAG CTT GGC GTA ATC ATG GTC ATA GCT
4057 GTT TCC TGT GTG AAA TTG TTA TCC GCT CAC AAT TCC ACA CAA CAT ACG AGC CGG AAG CAT AAA GTG TAA AGC CTG GGG
4135 TGC CTA ATG AGT GAG CTA ACT CAC ATT AAT TGC GTT GCG CTC ACT GCC CGC TTT CCA GTC GGG AAA CCT GTC GTG CCA
4213 GAA TTG CAT GAA GAA TCT GCT TAG GGT TAG GCG TTT TGC GCT GCT TCG CTA GGT GGT CAA TAT TGG CCA TTA GCC ATA
4291 TTA TTC ATT GGT TAT ATA GCA TAA ATC AAT ATT GGC TAT TGG CCA TTG CAT ACG TTG TAT CCA TAT CAT AAT ATG TAC
4369 ATT TAT ATT GGC TCA TGT CCA ACA TTA CCG CCA TGT TGA CAT TGA TTA TTG ACT AGT TAT TAA TAG TAA TCA ATT ACG
4447 GGG TCA TTA GTT CAT AGC CCA TAT ATG GAG TTC CGC GTT ACA TAA CTT ACG GTA AAT GGC CCG CCT GGC TGA CCG CCC
4525 AAC GAC CCC CGC CCA TTG ACG TCA ATA ATG ACG TAT GTT CCC ATA GTA ACG CCA ATA GGG ACT TTC CAT TGA CGT CAA
4603 TGG GTG GAG TAT TTA CGG TAA ACT GCC CAC TTG GCA GTA CAT CAA GTG TAT CAT ATG CCA AGT ACG CCC CCT ATT GAC
4681 GTC AAT GAC GGT CAC CGT CTC AAG CGC CTC CAC CAA GGG CCC ATC GGT CTT CCC CCT GGC ACC CTC CTC CAA GAG CAC
4759 CTC TGG GGG CAC AGC GGC CCT GGG CTG CCT GGT CAA GGA CTA CTT CCC CGA ACC GGT GAC GGT GTC GTG GAA CTC AGG
4837 CGC CCT GAC CAG CGG CGT CCA CAC CTT CCC GGC TGT CCT ACA GTC CTC AGG ACT CTA CTC CCT CAG CAG CGT AGT GAC
4915 CGT GCC CTC CAG CAG CTT GGG CAC CCA GAC CTA CAT CTG CAA CGT GAA TCA CAA GCC CAG CAA CAC CAA GGT GGA CAA
4993 GAA AGT TGA GCC CAA ATC TTG TGC GGC CGC ACA TCA TCA TCA CCA TCA CGG GGC CGC AGA ACA AAA ACT CAT CTC AGA
5071 AGA GGA TCT GAA TGG GGC CGC ATA GAC TGT TGA AAG TTG TTT AGC AAA ACC TCA TAC AGA AAA TTC ATT TAC TAA CGT
5149 CTG GAA AGA CGA CAA AAC TTT AGA TCG TTA CGC TAA CTA TGA GGG CTG TCT GTG GAA TGC TAC AGG CGT TGT GGT TTG
5227 TAC TGG TGA CGA AAC TCA GTG TTA CGG TAC ATG GGT TCC TAT TGG GCT TGC TAT CCC TGA AAA TGA GGG TGG TGG CTC
5305 TGA GGG TGG CGG TTC TGA GGG TGG CGG TTC TGA GGG TGG CGG TAC TAA ACC TCC TGA GTA CGG TGA TAC ACC TAT TCC
5383 GGG CTA TAC TTA TAT CAA CCC TCT CGA CGG CAC TTA TCC GCC TGG TAC TGA GCA AAA CCC CGC TAA TCC TAA TCC TTC
5461 TCT TGA GGA GTC TCA GCC TCT TAA TAC TTT CAT GTT TCA GAA TAA TAG GTT CCG AAA TAG GCA GGG TGC ATT AAC TGT
5539 TTA TAC GGG CAC TGT TAC TCA AGG CAC TGA CCC CGT TAA AAC TTA TTA CCA GTA CAC TCC TGT ATC ATC AAA AGC CAT
5617 GTA TGA CGC TTA CTG GAA CGG TAA ATT CAG AGA CTG CGC TTT CCA TTC TGG CTT TAA TGA GGA TCC ATT CGT TTG TGA
5695 ATA TCA AGG CCA ATC GTC TGA CCT GCC TCA ACC TCC TGT CAA TGC TGG CGG CGG CTC TGG TGG TGG TTC TGG TGG CGG
5773 CTC TGA GGG TGG CGG CTC TGA GGG TGG CGG CTC TGA GGG TGG CGG TTC TGA GGG TGG CGG CTC TGA GGG TGG CGG TTC
5851 CGG TGG CGG CTC CGG TTC CGG TGA TTT TGA TTA TGA AAA AAT GGC AAA CGC TAA TAA GGG GGC TAT GAC GGA AAA TGC
5929 CGA TGA AAA CGC GCT ACA GTC TGA CGC TAA AGG CAA ACT TGA TTC TGT CGC TAC TGA TTA CGG TGC TGC TAT CGA TGG
6007 TTT CAT TGG TGA CGT TTC CGG CCT TGC TAA TGG TAA TGG TGC TAC TGG TGA TTT TGC TGG CTC TAA TTC CCA AAT GGC
6085 TCA AGT CGG TGA CGG TGA TAA TTC ACC TTT AAT GAA TAA TTT CCG TCA ATA TTT ACC TTC TTT GCC TCA GTC GGT TGA
6163 ATG TCG CCC TTA TGT CTT TGG CGC TGG TAA ACC ATA TGA ATT TTC TAT TGA TTG TGA CAA AAT AAA CTT ATT CCG TGG
6241 TGT CTT TGC GTT TCT TTT ATA TGT TGC CAC CTT TAT GTA TGT ATT TTC GAC GTT TGC TAA CAT ACT GCG TAA TAA GGA

Fig. 12, contd.

6319 GTC TTA ATA AGA ATT CAC TGG CCG TCG TTT TAC AAC GTC GTG ACT GGG AAA ACC CTG GCG TTA CCC AAC TTA ATC GCC
6397 TTG CAG CAC ATC CCC CTT TCG CCA GCT GGC GTA ATA GCG AAG AGG CCC GCA CCG ATC GCC CTT CCC AAC AGT TGC GCA
6475 GCC TGA ATG GCG AAT GGC GCC TGA TGC GGT ATT TTC TCC TTA CGC ATC TGT GCG GTA TTT CAC ACC GCA TAC GTC AAA
6553 GCA ACC ATA GTA CGC GCC CTG TAG CGG CGC ATT AAG CGC GGC GGG TGT GGT GGT TAC GCG CAG CGT GAC CGC TAC ACT
6631 TGC CAG CGC CTT AGC GCC CGC TCC TTT CGC TTT CTT CCC TTC CTT TCT CGC CAC GTT CGC CGG CTT TCC CCG TCA AGC
6709 TCT AAA TCG GGG GCT CCC TTT AGG GTT CCG ATT TAG TGC TTT ACG GCA CCT CGA CCC CAA AAA A

MV1057

1 TAC TCT TCC TTT TTC AAT ATT ATT GAA GCA TTT ATC AGG GTT ATT GTC TCA TGA GCG GAT ACA TAT TTG AAT GTA TTT
79 AGA AAA ATA AAC AAA TAG GGG TTC CGC GCA CAT TTC CCC GAA AAG TGC CAC CTG ACG TCG ACG GAT CGG GAG ATC TCC
157 CGA TCC CCT ATG GTG CAC TCT CAG TAC AAT CTG CTC TGA TGC CGC ATA GTT AAG CCA GTA TCT GCT CCC TGC TTG TGT
235 GTT GGA GGT CGC TGA GTA GTG CGC GAG CAA AAT TTA AGC TAC AAC AAG GCA AGG CTT GAC CGA CAA TTG CAT GAA GAA
313 TCT GCT TAG GGT TAG GCG TTT TGC GCT GCT TCG CTA GGT GGT CAA TAT TGG CCA TTA GCC ATA TTA TTC ATT GGT TAT
391 ATA GCA TAA ATC AAT ATT GGC TAT TGG CCA TTG CAT ACG TTG TAT CCA TAT CAT AAT ATG TAC ATT TAT ATT GGC TCA
469 TGT CCA ACA TTA CCG CCA TGT TGA CAT TGA TTA TTG ACT AGT TAT TAA TAG TAA TCA ATT ACG GGG TCA TTA GTT CAT
547 AGC CCA TAT ATG GAG TTC CGC GTT ACA TAA CTT ACG GTA AAT GGC CCG CCT GGC TGA CCG CCC AAC GAC CCC CGC CCA
625 TTG ACG TCA ATA ATG ACG TAT GTT CCC ATA GTA ACG CCA ATA GGG ACT TTC CAT TGA CGT CAA TGG GTG GAG TAT TTA
703 CGG TAA ACT GCC CAC TTG GCA GTA CAT CAA GTG TAT CAT ATG CCA AGT ACG CCC CCT ATT GAC GTC AAT GAC GGT AAA
781 TGG CCC GCC TGG CAT TAT GCC CAG TAC ATG ACC TTA TGG GAC TTT CCT ACT TGG CAG TAC ATC TAC GTA TTA GTC ATC
859 GCT ATT ACC ATG GTG ATG CGG TTT TGG CAG TAC ATC AAT GGG CGT GGA TAG CGG TTT GAC TCA CGG GGA TTT CCA AGT
937 CTC CAC CCC ATT GAC GTC AAT GGG AGT TTG TTT TGG CAC CAA AAT CAA CGG GAC TTT CCA AAA TGT CGT AAC AAC TCC
1015 GCC CCA TTG ACG CAA ATG GGC GGT AGG CGT GTA CGG TGG GAG GTC TAT ATA AGC AGA GCT CGT TTA GTG AAC CGT CAG
1093 ATC GCC TGG AGA CGC CAT CCA CGC TGT TTT GAC CTC CAT AGA AGA CAC CGG GAC CGA TCC AGC CTC CGC GGC CGG GAA
1171 CGG TGC ATT GGA AGC TTG GTA CCG GTG AAT TGG CCG GCC CGC GCC GTC GAG GTT ATC GAT CCG ACC GAC GCG TTC GCG
1249 AGA GGC CGC AAT TCC CTA GCC ACC ATG GGA TGG AGC TGT ATC ATC CTC TTC TTG GTA CTG CTG CTG GCC CAG CCG GCC
1327 ATG GGG CGG AGA ATG GGC GGA ACT GGG CGG AGT TAG GGG CGG GAT GGG CGG AGT TAG GGG CGG GAC TAT GGT TGC TGA
1405 CTA ATT GAG ATG CGG ATC CGC TGG CAC GAC AGG TTT CCC GAC TGG AAA GCG GGC AGT GAG CGC AAC GCA ATT AAT GTG
1483 AGT TAG CTC ACT CAT TAG GCA CCC CAG GCT TTA CAC TTT ATG CTT CCG GCT CGT ATG TTG TGT GGA ATT GTG AGC GGA
1561 TAA CAA TTT CAC ACA GGA AAC AGC TAT GAC CAT GAT TAC GCC AAG CTT GGG CTG CAG GTT CTT TCC GCC TCA GAA GCC
1639 ATA GAG CCC ACC GCA TCC CCA GCA TGC CTG CTA TTG TCT TCC CAA TCC TCC CCC TTG CTG TCC TGC CCC ACC CCA CCC
1717 CCC AGA ATA GAA TGA CAC CTA CTC AGA CAA TGC GAT GCA ATT TCC TCA TTT TAT TAG GAA AGG ACA GTG GGA GTG GCA
1795 CCT TCC AGG GTC AAG GAA GGC ACG GGG GAG GGG CAA ACA ACA GAT GGC TGG CAA CTA GAA GGC ACA GTC GAG GCT GAT
1873 CAG CGA GCT CTA GAT CAT CGA TGC ATG GGG TCG TGC GCT CCT TTC GGT CGG GCG CTG CGG GTC GTG GGG CGG GCG TCA
1951 GGC ACC GGG CTT GCG GGT CAT GCA CCA GGT GCG CGG TCC TTC GGG CAC CTC GAC GTC GGC GGT GAC GGT GAA GCC GAG
2029 CCG CTC GTA GAA GGG GAG GTT GCG GGG CGC GGA GGT CTC CAG GAA GGC GGG CAC CCC GGC GCG CTC GGC CGC CTC CAC
2107 TCC GGG GAG CAC GAC GGC GCT GCC CAG ACC CTT GCC CTG GTG GTC GGG CGA GAC GCC GAC GGT GGC CAG GAA CCA CGC
2185 GGG CTC CTT GGG CCG GTG CGG CGC CAG GAG GCC TTC CAT CTG TTG CTG CGC GGC CAG CCG GGA ACC GCT CAA CTC GGC
2263 CAT GCG CGG GCC GAT CTC GGC GAA CAC CGC CCC CGC TTC GAC GCT CTC CGG CGT GGT CCA GAC CGC CAC CGC GGC GCC
2341 GTC GTC CGC GAC CCA CAC CTT GCC GAT GTC GAG CCC GAC GCG CGT GAG GAA GAG TTC TTG CAG CTC GGT CAC CGT CTC
2419 CAG TGC TAG CAC CAA GGG CCC ATC GGT CTT CCC CCT GGC ACC CTC CTC CAA GAG CAC CTC TGG GGG CAC AGC GGC CCT

Fig. 12, contd.

2497 GGG CTG CCT GGT CAA GGA CTA CTT CCC CGA ACC GGT GAC GGT GTC GTG GAA CTC AGG CGC CCT GAC CAG CGG CGT GCA
2575 CAC CTT CCC GGC TGT CCT ACA GTC CTC AGG ACT CTA CTC CCT CAG CAG CGT CGT GAC CGT GCC CTC CAG CAG CTT GGG
2653 CAC CCA GAC CTA CAT CTG CAA CGT GAA TCA CAA GCC CAG CAA CAC CAA GGT GGA CAA GAG AGT TGG TGA GAG GCC AGC
2731 ACA GGG AGG GAG GGT GTC TGC TGG AAG CCA GGC TCA GCG CTC CTG CCT GGA CGC ATC CCG GCT ATG CAG TCC CAG TCC
2809 AGG GCA GCA AGG CAG GCC CCG TCT GCC TCT TCA CCC GGA GGC CTC TGC CCG CCC CAC TCA TGC TCA GGG AGA GGG TCT
2887 TCT GGC TTT TTC CCC AGG CTC TGG GCA GGC ACA GGC TAG GTG CCC CTA ACC CAG GCC CTG CAC ACA AAG GGG CAG GTG
2965 CTG GGC TCA GAC CTG CCA AGA GCC ATA TCC GGG AGG ACC CTG CCC CTG ACC TAA GCC CAC CCC AAA GGC CAA ACT CTC
3043 CAC TCC CTC AGC TCG GAC ACC TTC TCT CCT CCC AGA TTC CAG TAA CTC CCA ATC TTC TCT CTG CAG AGC CCA AAT CTT
3121 GTG ACA AAA CTC ACA CAT GCC CAC CGT GCC CAG CAC CTG AAC TCC TGG GGG GAC CGT CAG TCT TCC TCT TCC CCC CAA
3199 AAC CCA AGG ACA CCC TCA TGA TCT CCC GGA CCC CTG AGG TCA CAT GCG TGG TGG TGG ACG TGA GCC ACG AAG ACC CTG
3277 AGG TCA AGT TCA ACT GGT ACG TGG ACG GCG TGG AGG TGC ATA ATG CCA AGA CAA AGC CGC GGG AGG AGC AGT ACA ACA
3355 GCA CGT ACC GTG TGG TCA GCG TCC TCA CCG TCC TGC ACC AGG ACT GGC TGA ATG GCA AGG AGT ACA AGT GCA AGG TCT
3433 CCA ACA AAG CCC TCC CAG CCC CCA TCG AGA AAA CCA TCT CCA AAG CCA AAG GGC AGC CCC GAG AAC CAC AGG TGT ACA
3511 CCC TGC CCC CAT CCC GGG AGG AGA TGA CCA AGA ACC AGG TCA GCC TGA CCT GCC TGG TCA AAG GCT TCT ATC CCA GCG
3589 ACA TCG CCG TGG AGT GGG AGA GCA ATG GGC AGC CGG AGA ACA ACT ACA AGA CCA CGC CTC CCG TGC TGG ACT CCG ACG
3667 GCT CCT TCT TCC TCT ATA GCA AGC TCA CCG TGG ACA AGA GCA GGT GGC AGC AGG GGA ACG TCT TCT CAT GCT CCG TGA
3745 TGC ATG AGG CTC TGC ACA ACC ACT ACA CGC AGA AGA GCC TCT CCC TGT CTC CGG GTA AAT GAG TTT AAC GGA TCT TAA
3823 TTA ATC CGA GCT CGG TAC CAA GCT TAA GTT TAA ACC GCT GAT CAG CCT CGA CTG TGC CTT CTA GTT GCC AGC CAT CTG
3901 TTG TTT GCC CCT CCC CCG TGC CTT CCT TGA CCC TGG AAG GTG CCA CTC CCA CTG TCC TTT CCT AAT AAA ATG AGG AAA
3979 TTG CAT CGC ATT GTC TGA GTA GGT GTC ATT CTA TTC TGG GGG GTG GGG TGG GGC AGG ACA GCA AGG GGG AGG ATT GGG
4057 AAG ACA ATA GCA GGC ATG CTG GGG ATG CGG TGG GCT CTA TGG CTT CTG AGG CGG AAA GAA CCA GCT GGG GCT CTA GGG
4135 GGT ATC CCC ACG CGC CCT GTA GCG GCG CAT TAA GCG CGG CGG GTG TGG TGG TTA CGC GCA GCG TGA CCG CTA CAC TTG
4213 CCA GCG CCT AGC GCC CGC TCC TTT CGC TTT CTT CCC TTC CTT TCT CGC CAC GTT CGC CGG CTT TCC CCG TCA AGC TCT
4291 AAA TCG GGG GCT CCC TTT AGG GTT CCG ATT TAG TGC TTT ACG GCA CCT CGA CCC CAA AAA ACT TGA TTA GGG TGA TGG
4369 TTC ACG TAG TGG GCC ATC GCC CTG ATA GAC GGT TTT TCG CCC TTT GAC GTT GGA GTC CAC GTT CTT TAA TAG TGG ACT
4447 CTT GTT CCA AAC TGG AAC AAC ACT CAA CCC TAT CTC GGT CTA TTC TTT TGA TTT ATA AGG GAT TTT GCC GAT TTC GGC
4525 CTA TTG GTT AAA AAA TGA GCT GAT TTA ACA AAA ATT TAA CGC GAA TTA ATT CTG TGG AAT GTG TGT CAG TTA GGG TGT
4603 GGA AAG TCC CCA GGC TCC CCA GCA GGC AGA AGT ATG CAA AGC ATG CAT CTC AAT TAG TCA GCA ACC AGG TGT GGA AAG
4681 TCC CCA GGC TCC CCA GCA GGC AGA AGT ATG CAA AGC ATG CAT CTC AAT TAG TCA GCA ACC ATA GTC CCG CCC CTA ACT
4759 CCG CCC ATC CCG CCC CTA ACT CCG CCC AGT TCC GCC CAT TCT CCG CCC CAT GGC TGA CTA ATT TTT TTT ATT TAT GCA
4837 GAG GCC GAG GCC GCC TCT GCC TCT GAG CTA TTC CAG AAG TAG TGA GGA GGC TTT TTT GGA GGC CTA GGC TTT TGC AAA
4915 AAG CTC CCG GGA GCT TGG ATA TCC ATT TTC GGA TCT GAT CAA GAG ACA GGA TGA GGA TCG TTT CGC ATG ATT GAA CAA
4993 GAT GGA TTG CAC GCA GGT TCT CCG GCC GCT TGG GTG GAG AGG CTA TTC GGC TAT GAC TGG GCA CAA CAG ACA ATC GGC
5071 TGC TCT GAT GCC GCC GTG TTC CGG CTG TCA GCG CAG GGG CGC CCG GTT CTT TTT GTC AAG ACC GAC CTG TCC GGT GCC
5149 CTG AAT GAA CTG CAG GAC GAG GCA GCG CGG CTA TCG TGG CTG GCC ACG ACG GGC GTC CCT TGC GCA GCT GTG CTC GAC
5227 GTT GTC ACT GAA GCG GGA AGG GAC TGG CTG CTA TTG GGC GAA GTG CCG GGG CAG GAT CTC CTG TCA TCT CAC CTT GCT
5305 CCT GCC GAG AAA GTA TCC ATC ATG GCT GAT GCA ATG CGG CGG CTG CAT ACG CTT GAT CCG GCT ACC TGC CCA TTC GAC
5383 CAC CAA GCG AAA CAT CGC ATC GAG CGA GCA CGT ACT CGG ATG GAA GCC GGT CTT GTC GAT CAG GAT GAT CTG GAC GAA
5461 GAG CAT CAG GGG CTC GCG CCA GCC GAA CTG TTC GCC AGG CTC AAG GCG CGC ATG CCC GAC GGC GAG GAT CTC GTC GTG
5539 ACC CAT GGC GAT GCC TGC TTG CCG AAT ATC ATG GTG GAA AAT GGC CGC TTT TCT GGA TTC ATC GAC TGT GGC CGC CTG
5617 GGT GTG GCG GAC CGC TAT CAG GAC ATA GCG TTG GCT ACC CGT GAT ATT GCT GAA GAG CTT GGC GGC GAA TGG GCT GAC

Fig. 12, contd.

5695 CGC TTC CTC GTG CTT TAC GGT ATC GCC GCT CCC GAT TCG CAG CGC ATC GCC TTC TAT CGC CTT CTT GAC GAG TTC TTC
5773 TGA GCG GGA CTC TGG GGT TCG GTG CTA CGA GAT TTC GAT TCC ACC GCC GCC TTC TAT GAA AGG TTG GGC TTC GGA ATC
5851 GTT TTC CGG GAC GCC GGC TGG ATG ATC CTC CAG CGC GGG GAT CTC ATG CTG GAG TTC TTC GCC CAC CCC AAC TTG TTT
5929 ATT GCA GCT TAT AAT GGT TAC AAA TAA AGC AAT AGC ATC ACA AAT TTC ACA AAT AAA GCA TTT TTT TCA CTG CAT TCT
6007 AGT TGT GGT TTG TCC AAA CTC ATC AAT GTA TCT TAT CAT GTC TGT ATA CCG TCG ACC TCT AGC TAG AGC TTG GCG TAA
6085 TCA TGG TCA TAG CTG TTT CCT GTG TGA AAT TGT TAT CCG CTC ACA ATT CCA CAC AAC ATA CGA GCC GGA AGC ATA AAG
6163 TGT AAA GCC TGG GGT GCC TAA TGA GTG AGC TAA CTC ACA TTA ATT GCG TTG CGC TCA CTG CCC GCT TTC CAG TCG GGA
6241 AAC CTG TCG TGC CAG AAT TGC ATG AAG AAT CTG CTT AGG GTT AGG CGT TTT GCG CTG CTT CGC TAG GTG GTC AAT ATT
6319 GGC CAT TAG CCA TAT TAT TCA TTG GTT ATA TAG CAT AAA TCA ATA TTG GCT ATT GGC CAT TGC ATA CGT TGT ATC CAT
6397 ATC ATA ATA TGT ACA TTT ATA TTG GCT CAT GTC CAA CAT TAC CGC CAT GTT GAC ATT GAT TAT TGA CTA GTT ATT AAT
6475 AGT AAT CAA TTA CGG GGT CAT TAG TTC ATA GCC CAT ATA TGG AGT TCC GCG TTA CAT AAC TTA CGG TAA ATG GCC CGC
6553 CTG GCT GAC CGC CCA ACG ACC CCC GCC CAT TGA CGT CAA TAA TGA CGT ATG TTC CCA TAG TAA CGC CAA TAG GGA CTT
6631 TCC ATT GAC GTC AAT GGG TGG AGT ATT TAC GGT AAA CTG CCC ACT TGG CAG TAC ATC AAG TGT ATC ATA TGC CAA GTA
6709 CGC CCC CTA TTG ACG TCA ATG ACG GTA AAT GGC CCG CCT GGC ATT ATG CCC AGT ACA TGA CCT TAT GGG ACT TTC CTA
6787 CTT GGC AGT ACA TCT ACG TAT TAG TCA TCG CTA TTA CCA TGG TGA TGC GGT TTT GGC AGT ACA TCA ATG GGC GTG GAT
6865 AGC GGT TTG ACT CAC GGG GAT TTC CAA GTC TCC ACC CCA TTG ACG TCA ATG GGA GTT TGT TTT GGC ACC AAA ATC AAC
6943 GGG ACT TTC CAA AAT GTC GTA ACA ACT CCG CCC CAT TGA CGC AAA TGG GCG GTA GGC GTG TAC GGT GGG AGG TCT ATA
7021 TAA GCA GAG CTC GTT TAG TGA ACC GTC AGA TCG CCT GGA GAC GCC ATC CAC GCT GTT TTG ACC TCC ATA GAA GAC ACC
7099 GGG ACC GAT CCA GCC TCC GCG GCC GGG AAC GGT GCA TTG GAA GCT TGG TAC CGG TGA ATT AGG CGC GCC GTC GAG GTT
7177 ATC GAT CCG ACC GAC GCG TTC GCG AGA GGC CGC AAT TCC CTA GCC ACC ATG GCA TGC CCT GGC TTC CTG TGG GCA CTT
7255 GTG ATC TCC ACC TGT CTT GAA TTC TCC ATG GCT GAC ATC CAG ATG ACC CAG TCT CCA TCC TCC CTG TCT GCA TCT GTA
7333 GGA GAC AGA GTC ACC ATC ACT TGC CGG GCA AGT CAG AGC ATT AGC AGC TAC TTA AAT TGG TAT CAG CAG AAA CCA GGG
7411 AAA GCC CCT AAG CTC CTG ATC TAT GCT GCA TCC AGT TTG CAA AGT GGG GTC CCA TCA AGG TTC AGT GGC AGT GGA TCT
7489 GGG ACA GAT TTC ACT CTC ACC ATC AGC AGT CTG CAA CCT GAA GAT TTT GCA ACT TAC TAC TGT CAA CAG AGT TAC AGT
7567 ACC CCT CCA ACG TTC GGC CAA GGG ACC AAG GTG GAG ATC AAA CGT AAG TGC ACT TTG CGG CCG CTA GGA AGA AAC TCA
7645 AAA CAT CAA GAT TTT AAA TAC GCT TCT TGG TCT CCT TGC TAT AAT TAT CTG GGA TAA GCA TGC TGT TTT CTG TCT GTC
7723 CCT AAC ATG CCC TGT GAT TAT CCG CAA ACA ACA CAC CCA AGG GCA GAA CTT TGT TAC TTA AAC ACC ATC CTG TTT GCT
7801 TCT TTC CTC AGG AAC TGT GGC TGC ACC ATC TGT CTT CAT CTT CCC GCC ATC TGA TGA GCA GTT GAA ATC TGG AAC TGC
7879 CTC TGT TGT GTG CCT GCT GAA TAA CTT CTA TCC CAG AGA GGC CAA AGT ACA GTG GAA GGT GGA TAA CGC CCT CCA ATC
7957 GGG TAA CTC CCA GGA GAG TGT CAC AGA GCA GGA CAG CAA GGA CAG CAC CTA CAG CCT CAG CAG CAC CCT GAC GCT GAG
8035 CAA AGC AGA CTA CGA GAA ACA CAA AGT CTA CGC CTG CGA AGT CAC CCA TCA GGG CCT GAG CTC GCC CGT CAC AAA GAG
8113 CTT CAA CAG GGG AGA GTG TTA GGT TTA ACG GAT CCG AGC TCG GTA CCA AGC TCA AGT TTA AAC CGC TGA TCA GCC TCG
8191 ACT GTG CCT TCT AGT TGC CAG CCA TCT GTT GTT TGC CCC TCC CCC GTG CCT TCC TTG ACC CTG GAA GGT GCC ACT CCC
8269 ACT GTC CTT TCC TAA TAA AAT GAG GAA ATT GCA TCG CAT TGT CTG AGT AGG TGT CAT TCT ATT CTG GGG GGT GGG GTG
8347 GGG CAG GAC AGC AAG GGG GAG GAT TGG GAA GAC AAT AGC AGG CAT GCT GGG GAT GCG GTG GGC TCT ATG GCT TCT GAG
8425 GCG GAA AGA ACC AGC TGC ATT AAT GAA TCG GCC AAC GCG CGG GGA GAG GCG GTT TGC GTA TTG GGC GCT CTT CCG CTT
8503 CCT CGC TCA CTG ACT CGC TGC GCT CGG TCG TTC GGC TGC GGC GAG CGG TAT CAG CTC ACT CAA AGG CGG TAA TAC GGT
8581 TAT CCA CAG AAT CAG GGG ATA ACG CAG GAA AGA ACA TGT GAG CAA AAG GCC AGC AAA AGG CCA GGA ACC GTA AAA AGG
8659 CCG CGT TGC TGG CGT TTT TCC ATA GGC TCC GCC CCC CTG ACG AGC ATC ACA AAA ATC GAC GCT CAA GTC AGA GGT GGC
8737 GAA ACC CGA CAG GAC TAT AAA GAT ACC AGG CGT TTC CCC CTG GAA GCT CCC TCG TGC GCT CTC CTG TTC CGA CCC TGC
8815 CGC TTA CCG GAT ACC TGT CCG CCT TTC TCC CTT CGG GAA GCG TGG CGC TTT CTC ATA GCT CAC GCT GTA GGT ATC TCA

Fig. 12, contd.

8893 GTT CGG TGT AGG TCG TTC GCT CCA AGC TGG GCT GTG TGC ACG AAC CCC CCG TTC AGC CCG ACC GCT GCG CCT TAT CCG
8971 GTA ACT ATC GTC TTG AGT CCA ACC CGG TAA GAC ACG ACT TAT CGC CAC TGG CAG CAG CCA CTG GTA ACA GGA TTA GCA
9049 GAG CGA GGT ATG TAG GCG GTG CTA CAG AGT TCT TGA AGT GGT GGC CTA ACT ACG GCT ACA CTA GAA GAA CAG TAT TTG
9127 GTA TCT GCG CTC TGC TGA AGC CAG TTA CCT TCG GAA AAA GAC TTG GTA GCT CTT GAT CCG GCA AAC AAA CCA CCG CTG
9205 GTA GCG GTG GTT TTT TTG TTT GCA AGC AGC AGA TTA CGC GCA GAA AAA AAG GAT CTC AAG AAG ATC CTT TGA TCT TTT
9283 CTA CGG GGT CTG ACG CTC AGT GGA ACG AAA ACT CAC GTT AAG GGA TTT TGG TCA TGA GAT TAT CAA AAA GGA TCT TCA
9361 CCT AGA TCC TTT TAA ATT AAA AAT GAA GTT TTA AAT CAA TCT AAA GTA TAT ATG AGT AAA CTT GGT CTG ACA GTT ACC
9439 AAT GCT TAA TCA GTG AGG CAC CTA TCT CAG CGA TCT GTC TAT TTC GTT CAT CCA TAG TTG CCT GAC TCC CCG TCG TGT
9517 AGA TAA CTA CGA TAC GGG AGG GCT TAC CAT CTG GCC CCA GTG CTG CAA TGA TAC CGC GAG ACC CAC GCT CAC CGG CTC
9595 CAG ATT TAT CAG CAA TAA ACC AGC CAG CCG GAA GGG CCG AGC GCA GAA GTG GTC CTG CAA CTT TAT CCG CCT CCA TCC
9673 AGT CTA TTA ATT GTT GCC GGG AAG CTA GAG TAA GTA GTT CGC CAG TTA ATA GTT TGC GCA ACG TTG TTG CCA TTG CTA
9751 CAG GCA TCG TGG TGT CAC GCT CGT CGT TTG GTA TGG CTT CAT TCA GCT CCG GTT CCC AAC GAT CAA GGC GAG TTA CAT
9829 GAT CCC CCA TGT TGT GCA AAA AAG CGG TTA GCT CCT TCG GTC CTC CGA TCG TTG TCA GAA GTA AGT TGG CCG CAG TGT
9907 TAT CAC TCA TGG TTA TGG CAG CAC TGC ATA ATT CTC TTA CTG TCA TGC CAT CCG TAA GAT GCT TTT CTG TGA CTG GTG
9985 AGT ACT CAA CCA AGT CAT TCT GAG AAT AGT GTA TGC GGC GAC CGA GTT GCT CTT GCC CGG CGT CAA TAC GGG ATA ATA
10063 CCG CGC CAC ATA GCA GAA CTT TAA AAG TGC TCA TCA TTG GAA AAC GTT CTT CGG GGC GAA AAC TCT CAA GGA TCT TAC
10141 CGC TGT TGA GAT CCA GTT CGA TGT AAC CCA CTC GTG CAC CCA ACT GAT CTT CAG CAT CTT TTA CTT TCA CCA GCG TTT
10219 CTG GGT GAG CAA AAA CAG GAA GGC AAA ATG CCG CAA AAA AGG GAA TAA GGG CGA CAC GGA AAT GTT GAA TAC TCA

Fig. 13B

```
   1 atccaggcgc ggatcaataa aagatcatta ttttcaatag atctgtgtgt tggttttttg
  61 tgtgccttgg gggaggggga ggccagaatg aggcgcggcc aagggggagg gggaggccag
 121 aatgaccttg ggggaggggg aggccagaat gaccttgggg gagggggagg ccagaatgag
 181 gcgcggatcc ggagaagttc ctattccgaa gttcctattc ttcaaatagt ataggaactt
 241 cgctcgaggg atcggccatt gaacaagatg gattgcacgc aggttctccg gccgcttggg
 301 tggagaggct attcggctat gactgggcac aacagacaat cggctgctct gatgccgccg
 361 tgttccggct gtcagcgcag gggcgcccgg ttctttttgt caagaccgac ctgtccggtg
 421 ccctgaatga actgcaggac gaggcagcgc ggctatcgtg gctggccacg acgggcgttc
 481 cttgcgcagc tgtgctcgac gttgtcactg aagcgggaag ggactggctg ctattgggcg
 541 aagtgccggg gcaggatctc ctgtcatctc accttgctcc tgccgagaaa gtatccatca
 601 tggctgatgc aatgcggcgg ctgcatacgc ttgatccggc tacctgccca ttcgaccacc
 661 aagcgaaaca tcgcatcgag cgagcacgta ctcggatgga agccggtctt gtcgatcagg
 721 atgatctgga cgaagagcat caggggctcg cgccagccga actgttcgcc aggctcaagg
 781 cgcgcatgcc cgacggcgag gatctcgtcg tgacccatgg cgatgcctgc ttgccgaata
 841 tcatggtgga aaatggccgc ttttctggat tcatcgactg tggccggctg ggtgtggcgg
 901 accgctatca ggacatagcg ttggctaccc gtgatattgc tgaagagctt ggcggcgaat
 961 gggctgaccg cttcctcgtg ctttacggta tcgccgctcc cgattcgcag cgcatcgcct
1021 tctatcgcct tcttgacgag ttcttctgag gggatcgatc cgctgtaagt ctgcagaaat
1081 tgatgatcta ttaaacaata aagatgtcca ctaaaatgga agtttttcct gtcatacttt
1141 gttaagaagg gtgagaacag agtacctaca ttttgaatgg aaggattgga gctacggggg
1201 tgggggtggg gtgggattag ataaatgcct gctctttact gaaggctctt tactattgct
1261 ttatgataat gtttcatagt tggatatcat aatttaaaca agcaaaacca aattaagggc
1321 cagctcattc ctcccactca tgatctatag atctatagat ctctcgtggg atcattgttt
1381 ttctcttgat tcccactttg tggttctaag tactgtggtt tccaaatgtg tcagtttcat
1441 agcctgaaga acgagatcag cagcctctgt tccacataca cttcattctc agtattgttt
1501 tgccaagttc taattccatc agaagctgac tctagatggc gcgtatgcag gttttcgaca
1561 ttgattattg actagttatt aatagtaatc aattacgggg tcattagttc atagcccata
1621 tatggagttc cgcgttacat aacttacggt aaatggcccg cctggctgac cgcccaacga
1681 cccccgccca ttgacgtcaa taatgacgta tgttcccata gtaacgccaa tagggacttt
1741 ccattgacgt caatgggtgg agtatttacg gtaaactgcc cacttggcag tacatcaagt
1801 gtatcatatg ccaagtacgc cccctattga cgtcaatgac ggtaaatggc ccgcctggca
1861 ttatgcccag tacatgacct tatgggactt tcctacttgg cagtacatct acgtattagt
1921 catcgctatt accatggtcg aggtgagccc cacgttctgc ttcactctcc ccatctcccc
1981 ccccticccca cccccaattt tgtatttatt tattttttaa ttattttgtg cagcgatggg
2041 ggcgggggg gggggggcgc gcgccaggcg gggcggggcg gggcgagggg cggggcgggg
2101 cgaggcggag aggtgcggcg gcagccaatc agagcggcgc gctccgaaag tttcctttta
2161 tggcgaggcg gcggcggcgg cggccctata aaaagcgaag cgcgcggcgg gcgggagtcg
2221 ctgcgttgcc ttcgccccgt gccccgctcc gcgccgcctc gcgccgcccg ccccggctct
```

Fig. 13B, contd.

2281 gactgaccgc gttactccca caggtgagcg ggcgggacgg ccctctcct ccgggctgta
2341 attagcgctt ggtttaatga cggctcgttt cttttctgtg gctgcgtgaa agccttaaag
2401 ggctccggga gggccctttg tgcgggggg agcggctcgg ggggtgcgtg cgtgtgtgtg
2461 tgcgtgggga gcgccgcgtg cggcccgcgc tgcccggcgg ctgtgagcgc tgcgggcgcg
2521 gcgcggggct ttgtgcgctc cgcgtgtgcg cgaggggagc gcggccgggg gcggtgcccc
2581 gcggtgcggg ggggctgcga ggggaacaaa ggctgcgtgc ggggtgtgtg cgtgggggg
2641 tgagcagggg gtgtgggcgc ggcggtcggg ctgtaacccc ccccctgcacc cccctccccg
2701 agttgctgag cacggcccgg cttcgggtgc ggggctccgt gcggggcgtg gcgcggggct
2761 cgccgtgccg ggcgggggt ggcggcaggt gggggtgccg ggcggggcgg ggccgcctcg
2821 ggccggggag ggctcggggg aggggcgcgg cggccccgga gcgccggcgg ctgtcgaggc
2881 gcggcgagcc gcagccattg ccttttatgg taatcgtgcg agagggcgca gggacttcct
2941 ttgtcccaaa tctgtgcgga gccgaaatct gggaggcgcc gccgcacccc ctctagcggg
3001 cgcggggcga agcggtgcgg cgccggcagg aaggaaatgg gcggggaggg ccttcgtgcg
3061 tcgccgcgcc gccgtcccct tctccctctc cagcctcggg gctgtccgcg gggggacggc
3121 tgccttcggg ggggacgggg cagggcgggg ttcggcttct ggcgtgtgac cggcggctct
3181 agaagcgttg gggtgagtac tccctctcaa aagcgggcat gacttctgcg ctaagattgt
3241 cagtttccaa aaacgaggag gatttgatat tcacctggcc cgcggtgatg cctttgaggg
3301 tggccgcgtc catctggtca gaaaagacaa tctttttgtt gtcaagcttg aggtgtggca
3361 ggcttgagat ctggccatac acttgagtga cattgacatc cactttgcct ttctctccac
3421 aggtgtccac tcccagggcg gcctccggag cgatcgccga tccgcctagg caattgttta
3481 aatcggccgg ccataacttc gtataatgta tgctatacga agttatggat cctcacagta
3541 ggtggcatcg ttcctttctg actgcccgcc ccccgcatgc cgtcccgcga tattgagctc
3601 cgaacctctc gccctgccgc cgccggtgct ccgtcgccgc cgcgccgcca tggaatcgaa
3661 gccaccatgg atcttaccgg aaaactcgac gcaagaaaaa tcagagagat cctcataaag
3721 gtcaagaagg gcggaaagat cgccgtgtaa ttctagaccg gttcgagatc caggcgcgga
3781 tcaataaaag atcattattt tcaatagatc tgtgtgttgg ttttttgtgt gccttggggg
3841 agggggaggc cagaatgagg cgcggccaag ggggaggggg aggccagaat gaccttgggg
3901 qaggggggagg ccagaatgac cttgggggag ggggaggcca gaatgaggcg cgccctccgt
3961 cgacctataa cttcgtataa tgtatgctat acgaagttat ggcggccgcc accatggaca
4021 tgagagtgcc cgcccagctc ctggggctcc tgctactctg gctccgaggt aaggatggag
4081 aacactagga atttactcag ccagtgtgct cagtactgac tggaacttca gggaagttct
4141 ctgataacat gattaatagt aagaatattt gtttttatgt ttccaatctc aggtgccaga
4201 tgtgacatcc agatgaccca gagccccagc agcctgagcg ccagcgtggg cgacagagtg
4261 accatcacct gcagagccag ccagagcatc agcagctacc tgaactggta tcagcagaag
4321 cccggcaagg cccccaagct gctgatctac gccgccagct ccctgcagag cggcgtgccc
4381 agcagattca gcggcagcgg ctccggcacc gacttcaccc tgaccatcag cagcctgcag
4441 cccgaggact tcgccacctc ctactgccag cagagctaca gcacccccc cacctcggc

Fig. 13B, contd.

4501 cagggcacca aggtggagat caagagagcc gacgccgctc ccaccgtgtc catcttcccc
4561 cccagcatgg aacagctgac ctctggcgga gccaccgtgg tctgcttcgt gaacaacttc
4621 taccccagag acatcagcgt gaagtggaag atcgacggca gcgagcagag ggacggcgtg
4681 ctggacagcg tgaccgacca ggacagcaag gactccacct acagcatgag cagcaccctg
4741 agcctgacca aggtggagta cgagaggcac aacctgtaca cctgcgaggt ggtgcacaag
4801 accagctcca gccccgtggt caagtccttc aaccggaacg agtgttgagc tagcttaaga
4861 tttaaatagg ccggccgcgt cgacctcgag atccaggcgc ggatcaataa aagatcatta
4921 ttttcaatag atctgtgtgt tggttttttg tgtgccttgg gggaggggga ggccagaatg
4981 aggcgcggcc aagggggagg gggaggccag aatgaccttg ggggaggggg aggccagaat
5041 gaccttgggg gagggggagg ccagaatgag gcgcgccccc gggtaccgag ctcgaattag
5101 tggatcctca cagtaggtgg catcgttcct ttctgactgc ccgcccccccg catgccgtcc
5161 cgcgatattg agctccgaac ctctcgccct gccgccgccg gtgctccgtc gccgccgcgc
5221 cgccatggaa tcgcgccggt aaccgaagtt cctatacttt ctagagaata ggaacttcgg
5281 aataggaact tcaagccggt acccagcttt tgttcccttt agtgagggtt aatttcgagc
5341 ttggcgtaat catggtcata gctgtttcct gtgtgaaatt gttatccgct cacaattcca
5401 cacaacatac gagccgggag cataaagtgt aaagcctggg gtgcctaatg agtgagctaa
5461 ctcacattaa ttgcgttgcg ctcactgccc gctttccagt cgggaaacct gtcgtgccag
5521 ctgcattaat gaatcggcca acgcgcgggg agaggcggtt tgcgtattgg gcgctcttcc
5581 gcttcctcgc tcactgactc gctgcgctcg gtcgttcggc tgcggcgagc ggtatcagct
5641 cactcaaagg cggtaatacg gttatccaca gaatcagggg ataacgcagg aaagaacatg
5701 tgagcaaaag gccagcaaaa ggccaggaac cgtaaaaagg ccgcgttgct ggcgtttttc
5761 cataggctcc gcccccctga cgagcatcac aaaaatcgac gctcaagtca gaggtggcga
5821 aacccgacag gactataaag ataccaggcg tttccccctg gaagctccct cgtgcgctct
5881 cctgttccga ccctgccgct taccggatac ctgtccgcct ttctcccttc gggaagcgtg
5941 gcgctttctc atagctcacg ctgtaggtat ctcagttcgg tgtaggtcgt tcgctccaag
6001 ctgggctgtg tgcacgaacc cccgttcag cccgaccgct gcgccttatc cggtaactat
6061 cgtcttgagt ccaacccggt aagacacgac ttatcgccac tggcagcagc cactggtaac
6121 aggattagca gagcgaggta tgtaggcggt gctacagagt tcttgaagtg gtggcctaac
6181 tacggctaca ctagaaggac agtatttggt atctgcgctc tgctgaagcc agttaccttc
6241 ggaaaaagag ttggtagctc ttgatccggc aaacaaacca ccgctggtag cggtggtttt
6301 tttgtttgca agcagcagat tacgcgcaga aaaaaaggat ctcaagaaga tcctttgatc
6361 ttttctacgg ggtctgacgc tcagtggaac gaaaactcac gttaagggat tttggtcatg
6421 agattatcaa aaaggatctt cacctagatc cttttaaatt aaaaatgaag ttttaaatca
6481 atctaaagta tatatgagta aacttggtct gacagttacc aatgcttaat cagtgaggca
6541 cctatctcag cgatctgtct atttcgttca tccatagttg cctgactccc cgtcgtgtag
6601 ataactacga tacgggaggg cttaccatct ggccccagtg ctgcaatgat accgcgagac
6661 ccacgctcac cggctccaga tttatcagca ataaaccagc cagccggaag ggccgagcgc

Fig. 13B, contd.

6721 agaagtggtc ctgcaacttt atccgcctcc atccagtcta ttaattgttg ccgggaagct
6781 agagtaagta gttcgccagt taatagtttg cgcaacgttg ttgccattgc tacaggcatc
6841 gtggtgtcac gctcgtcgtt tggtatggct tcattcagct ccggttccca acgatcaagg
6901 cgagttacat gatcccccat gttgtgcaaa aaagcggtta gctccttcgg tcctccgatc
6961 gttgtcagaa gtaagttggc cgcagtgtta tcactcatgg ttatggcagc actgcataat
7021 tctcttactg tcatgccatc cgtaagatgc ttttctgtga ctggtgagta ctcaaccaag
7081 tcattctgag aatagtgtat gcggcgaccg agttgctctt gcccggcgtc aatacgggat
7141 aataccgcgc cacatagcag aactttaaaa gtgctcatca ttggaaaacg ttcttcgggg
7201 cgaaaactct caaggatctt accgctgttg agatccagtt cgatgtaacc cactcgtgca
7261 cccaactgat cttcagcatc ttttactttc accagcgttt ctgggtgagc aaaaacagga
7321 aggcaaaatg ccgcaaaaaa gggaataagg gcgacacgga aatgttgaat actcatactc
7381 ttcctttttc aatattattg aagcatttat cagggttatt gtctcatgag cggatacata
7441 tttgaatgta tttagaaaaa taaacaaata ggggttccgc gcacatttcc ccgaaaagtg
7501 ccacctaaat tgtaagcgtt aatattttgt taaaattcgc gttaaatttt tgttaaatca
7561 gctcattttt taaccaatag gccgaaatcg gcaaaatccc ttataaatca aaagaataga
7621 ccgagatagg gttgagtgtt gttccagttt ggaacaagag tccactatta aagaacgtgg
7681 actccaacgt caaagggcga aaaaccgtct atcagggcga tggcccacta cgtgaaccat
7741 caccctaatc aagttttttg gggtcgaggt gccgtaaagc actaaatcgg aaccctaaag
7801 ggagcccccg atttagagct tgacggggaa agccggcgaa cgtggcgaga aaggaaggga
7861 agaaagcgaa aggagcgggc gctagggcgc tggcaagtgt agcggtcacg ctgcgcgtaa
7921 ccaccacacc cgccgcgctt aatgcgccgc tacagggcgc gtcccattcg ccattcaggc
7981 tgcgcaactg ttgggaaggg cgatcggtgc gggcctcttc gctattacgc cagctggcga
8041 aagggggatg tgctgcaagg cgattaagtt gggtaacgcc agggttttcc cagtcacgac
8101 gttgtaaaac gacggccagt gagcgcgcgt aatacgactc actatagggc gaattggggg
8161 taactaagta aggatcgag

Fig. 15B

```
   1 atccaggcgc ggatcaataa aagatcatta ttttcaatag atctgtgtgt tggtttttg
  61 tgtgccttgg gggaggggga ggccagaatg aggcgcggcc aagggggagg gggaggccag
 121 aatgaccttg ggggaggggg aggccagaat gaccttgggg gagggggagg ccagaatgag
 181 gcgcggatcc ggagaagttc ctattccgaa gttcctattc ttcaaatagt ataggaactt
 241 cgctcgaggg atcggccatt gaacaagatg gattgcacgc aggttctccg gccgcttggg
 301 tggagaggct attcggctat gactgggcac aacagacaat cggctgctct gatgccgccg
 361 tgttccggct gtcagcgcag gggcgcccgg ttctttttgt caagaccgac ctgtccggtg
 421 ccctgaatga actgcaggac gaggcagcgc ggctatcgtg gctggccacg acgggcgttc
 481 cttgcgcagc tgtgctcgac gttgtcactg aagcgggaag ggactggctg ctattgggcg
 541 aagtgccggg gcaggatctc ctgtcatctc accttgctcc tgccgagaaa gtatccatca
 601 tggctgatgc aatgcggcgg ctgcatacgc ttgatccggc tacctgccca ttcgaccacc
 661 aagcgaaaca tcgcatcgag cgagcacgta ctcggatgga agccggtctt gtcgatcagg
 721 atgatctgga cgaagagcat caggggctcg cgccagccga actgttcgcc aggctcaagg
 781 cgcgcatgcc cgacggcgag gatctcgtcg tgacccatgg cgatgcctgc ttgccgaata
 841 tcatggtgga aaatggccgc ttttctggat tcatcgactg tggccggctg ggtgtggcgg
 901 accgctatca ggacatagcg ttggctaccc gtgatattgc tgaagagctt ggcggcgaat
 961 gggctgaccg cttcctcgtg ctttacggta tcgccgctcc cgattcgcag cgcatcgcct
1021 tctatcgcct cttgacgag ttcttctgag gggatcgatc cgctgtaagt ctgcagaaat
1081 tgatgatcta ttaaacaata aagatgtcca ctaaaatgga agtttttcct gtcatacttt
1141 gttaagaagg gtgagaacag agtacctaca ttttgaatgg aaggattgga gctacggggg
1201 tgggggtggg gtgggattag ataaatgcct gctctttact gaaggctctt tactattgct
1261 ttatgataat gtttcatagt tggatatcat aatttaaaca agcaaaacca aattaagggc
1321 cagctcattc ctcccactca tgatctatag atctatagat ctctcgtggg atcattgttt
1381 ttctcttgat tcccactttg tggttctaag tactgtggtt tccaaatgtg tcagtttcat
1441 agcctgaaga acgagatcag cagcctctgt tccacataca cttcattctc agtattgttt
1501 tgccaagttc taattccatc agaagctgac tctagatggc gcgtatgcag gttttcgaca
1561 ttgattattg actagttatt aatagtaatc aattacgggg tcattagttc atagcccata
1621 tatggagttc cgcgttacat aacttacggt aaatggcccg cctggctgac cgcccaacga
1681 cccccgccca ttgacgtcaa taatgacgta tgttcccata gtaacgccaa tagggacttt
1741 ccattgacgt caatgggtgg agtatttacg gtaaactgcc cacttggcag tacatcaagt
1801 gtatcatatg ccaagtacgc cccctattga cgtcaatgac ggtaaatggc ccgcctggca
1861 ttatgcccag tacatgacct tatgggactt tcctacttgg cagtacatct acgtattagt
1921 catcgctatt accatggtcg aggtgagccc cacgttctgc ttcactctcc ccatctcccc
1981 cccctcccca cccccaattt tgtatttatt tattttttaa ttattttgtg cagcgatggg
2041 ggcgggggg gggggggcgc gcgccaggcg gggcggggcg gggcgagggg cggggcgggg
2101 cgaggcggag aggtgcggcg gcagccaatc agagcggcgc gctccgaaag tttccttttta
```

Fig. 15B, contd.

2161 tggcgaggcg gcggcggcgg cggccctata aaaagcgaag cgcgcggcgg gcgggagtcg
2221 ctgcgttgcc ttcgccccgt gccccgctcc gcgccgcctc gcgccgcccg ccccggctct
2281 gactgaccgc gttactccca caggtgagcg ggcgggacgg cccttctcct ccgggctgta
2341 attagcgctt ggtttaatga cggctcgttt cttttctgtg gctgcgtgaa agccttaaag
2401 ggctccggga gggccctttg tgcgggggg agcggctcgg ggggtgcgtg cgtgtgtgtg
2461 tgcgtgggga gcgccgcgtg cggcccgcgc tgcccggcgg ctgtgagcgc tgcgggcgcg
2521 gcgcggggct ttgtgcgctc cgcgtgtgcg cgagggagc gcggccgggg gcggtgcccc
2581 gcggtgcggg ggggctgcga ggggaacaaa ggctgcgtgc ggggtgtgtg cgtgggggg
2641 tgagcagggg gtgtgggcgc ggcggtcggg ctgtaacccc cccctgcacc cccctccccg
2701 agttgctgag cacggcccgg cttcgggtgc ggggctccgt gcggggcgtg gcgcggggct
2761 cgccgtgccg ggcgggggt ggcggcaggt gggggtgccg ggcggggcgg ggccgcctcg
2821 ggccggggag ggctcggggg aggggcgcgg cggccccgga gcgccggcgg ctgtcgaggc
2881 gcggcgagcc gcagccattg ccttttatgg taatcgtgcg agagggcgca gggacttcct
2941 ttgtcccaaa tctgtgcgga gccgaaatct gggaggcgcc gccgcacccc ctctagcggg
3001 cgcggggcga agcggtgcgg cgccggcagg aaggaaatgg gcggggaggg ccttcgtgcg
3061 tcgccgcgcc gccgtcccct tctccctctc cagcctcggg gctgtccgcg gggggacggc
3121 tgccttcggg ggggacgggg cagggcgggg ttcggcttct ggcgtgtgac cggcggctct
3181 agaagcgttg gggtgagtac tccctctcaa aagcgggcat gacttctgcg ctaagattgt
3241 cagtttccaa aaacgaggag gatttgatat tcacctggcc cgcggtgatg cctttgaggg
3301 tggccgcgtc catctggtca gaaaagacaa tctttttgtt gtcaagcttg aggtgtggca
3361 ggcttgagat ctggccatac acttgagtga cattgacatc cactttgcct ttctctccac
3421 aggtgtccac tcccagggcg gcctccggag cgatcgccga tccgcctagg caattgttta
3481 aatcggccgg ccataacttc gtataatgta tgctatacga agttatggat cctcacagta
3541 ggtggcatcg ttcctttctg actgcccgcc ccccgcatgc cgtcccgcga tattgagctc
3601 cgaacctctc gccctgccgc cgccggtgct ccgtcgccgc cgcgccgcca tggaatcgaa
3661 gccaccatgg atcttaccgg aaaactcgac gcaagaaaaa tcagagagat cctcataaag
3721 gtcaagaagg gcggaaagat cgccgtgtaa ttctagaccg gttcgagatc caggcgcgga
3781 tcaataaaag atcattattt tcaatagatc tgtgtgttgg ttttttgtgt gccttggggg
3841 agggggaggc cagaatgagg cgcggccaag ggggaggggg aggccagaat gaccttgggg
3901 gagggggagg ccagaatgac cttgggggag ggggaggcca gaatgaggcg cgccctccgt
3961 cgacctataa cttcgtataa tgtatgctat acgaagttat ggcggccgcc accatggaca
4021 tgagagtgcc cgcccagctc ctggggctcc tgctactctg gctccgaggt aaggatggag
4081 aacactagga atttactcag ccagtgtgct cagtactgac tggaacttca gggaagttct
4141 ctgataacat gattaatagt aagaatattt gtttttatgt ttccaatctc aggtgccaga
4201 tgtcagtctg ccctgaccca gcccgcctct gtgtctggca gccctggcca gagcatcacc
4261 atcagctgca ccggcaccag cagcgacgtg ggcggctaca actacgtgtc ctggtatcag
4321 cagcaccccg gcaaggcccc caagctgatg atctacgagg tgtccaacag acccagcggc

Fig. 15B, contd.

4381 gtgagcaaca gattcagcgg cagcaagagc ggcaacaccg ccagcctgac catcagcggc
4441 ctccaggctg aggacgaggc cgactactac tgcagcagct acaccagcag ctccaccctg
4501 gtgtttggcg gcggaacaaa gctgaccgtg ctgagagccg acgccgctcc caccgtgtcc
4561 atcttccccc ccagcatgga acagctgacc tctggcggag ccaccgtggt ctgcttcgtg
4621 aacaacttct gccccagaga catcagcgtg aagtggaaga tcgacggcag cgagcagagg
4681 gacggcgtgc tggacagcgt gaccgaccag gacagcaagg actccaccta cagcatgagc
4741 agcaccctga gcctgaccaa ggtggagtac gagaggcaca acctgtacac ctgcgaggtg
4801 gtgcacaaga ccagctccag ccccgtggtc aagtccttca accggaacga gtgttgagct
4861 agcttaagat ttaaataggc cggccgcgtc gacctcgaga tccaggcgcg gatcaataaa
4921 agatcattat tttcaataga tctgtgtgtt ggttttttgt gtgccttggg ggagggggag
4981 gccagaatga ggcgcggcca agggggaggg ggaggccaga atgaccttgg gggagggggga
5041 ggccagaatg accttggggg agggggaggc cagaatgagg cgcgcccccg ggtaccgagc
5101 tcgaattagt ggatcctcac agtaggtggc atcgttcctt tctgactgcc cgcccccccgc
5161 atgccgtccc gcgatattga gctccgaacc tctcgccctg ccgccgccgg tgctccgtcg
5221 ccgccgcgcc gccatggaat cgcgccggta accgaagttc ctatactttc tagagaatag
5281 gaacttcgga ataggaactt caagccggta cccagctttt gttcccttta gtgagggtta
5341 atttcgagct tggcgtaatc atggtcatag ctgtttcctg tgtgaaattg ttatccgctc
5401 acaattccac acaacatacg agccgggagc ataaagtgta aagcctgggg tgcctaatga
5461 gtgagctaac tcacattaat tgcgttgcgc tcactgcccg ctttccagtc gggaaacctg
5521 tcgtgccagc tgcattaatg aatcggccaa cgcgcgggga gaggcggttt gcgtattggg
5581 cgctcttccg cttcctcgct cactgactcg ctgcgctcgg tcgttcggct gcggcgagcg
5641 gtatcagctc actcaaaggc ggtaatacgg ttatccacag aatcagggga taacgcagga
5701 aagaacatgt gagcaaaagg ccagcaaaag gccaggaacc gtaaaaaggc cgcgttgctg
5761 gcgtttttcc ataggctccg cccccctgac gagcatcaca aaaatcgacg ctcaagtcag
5821 aggtggcgaa acccgacagg actataaaga taccaggcgt ttccccctgg aagctccctc
5881 gtgcgctctc ctgttccgac cctgccgctt accggatacc tgtccgcctt tctcccttcg
5941 ggaagcgtgg cgctttctca tagctcacgc tgtaggtatc tcagttcggt gtaggtcgtt
6001 cgctccaagc tgggctgtgt gcacgaaccc cccgttcagc ccgaccgctg cgccttatcc
6061 ggtaactatc gtcttgagtc caacccggta agacacgact tatcgccact ggcagcagcc
6121 actggtaaca ggattagcag agcgaggtat gtaggcggtg ctacagagtt cttgaagtgg
6181 tggcctaact acggctacac tagaaggaca gtatttggta tctgcgctct gctgaagcca
6241 gttaccttcg gaaaaagagt tggtagctct tgatccggca aacaaaccac cgctggtagc
6301 ggtggttttt ttgtttgcaa gcagcagatt acgcgcagaa aaaaaggatc tcaagaagat
6361 cctttgatct tttctacggg gtctgacgct cagtggaacg aaaactcacg ttaagggatt
6421 ttggtcatga gattatcaaa aaggatcttc acctagatcc ttttaaatta aaaatgaagt
6481 tttaaatcaa tctaaagtat atatgagtaa acttggtctg acagttacca atgcttaatc
6541 agtgaggcac ctatctcagc gatctgtcta tttcgttcat ccatagttgc ctgactcccc

Fig. 15B, contd.

6601 gtcgtgtaga taactacgat acgggagggc ttaccatctg gccccagtgc tgcaatgata
6661 ccgcgagacc cacgctcacc ggctccagat ttatcagcaa taaaccagcc agccggaagg
6721 gccgagcgca gaagtggtcc tgcaacttta tccgcctcca tccagtctat taattgttgc
6781 cgggaagcta gagtaagtag ttcgccagtt aatagtttgc gcaacgttgt tgccattgct
6841 acaggcatcg tggtgtcacg ctcgtcgttt ggtatggctt cattcagctc cggttcccaa
6901 cgatcaaggc gagttacatg atcccccatg ttgtgcaaaa aagcggttag ctccttcggt
6961 cctccgatcg ttgtcagaag taagttggcc gcagtgttat cactcatggt tatggcagca
7021 ctgcataatt ctcttactgt catgccatcc gtaagatgct tttctgtgac tggtgagtac
7081 tcaaccaagt cattctgaga atagtgtatg cggcgaccga gttgctcttg cccggcgtca
7141 atacgggata ataccgcgcc acatagcaga actttaaaag tgctcatcat tggaaaacgt
7201 tcttcggggc gaaaactctc aaggatctta ccgctgttga gatccagttc gatgtaaccc
7261 actcgtgcac ccaactgatc ttcagcatct tttactttca ccagcgtttc tgggtgagca
7321 aaaacaggaa ggcaaaatgc cgcaaaaaag ggaataaggg cgacacggaa atgttgaata
7381 ctcatactct tcctttttca atattattga agcatttatc agggttattg tctcatgagc
7441 ggatacatat ttgaatgtat ttagaaaaat aaacaaatag gggttccgcg cacatttccc
7501 cgaaaagtgc cacctaaatt gtaagcgtta atattttgtt aaaattcgcg ttaaattttt
7561 gttaaatcag ctcatttttt aaccaatagg ccgaaatcgg caaaatcccct tataaatcaa
7621 aagaatagac cgagataggg ttgagtgttg ttccagtttg gaacaagagt ccactattaa
7681 agaacgtgga ctccaacgtc aaagggcgaa aaaccgtcta tcagggcgat ggcccactac
7741 gtgaaccatc accctaatca agttttttgg ggtcgaggtg ccgtaaagca ctaaatcgga
7801 accctaaagg gagcccccga tttagagctt gacggggaaa gccggcgaac gtggcgagaa
7861 aggaagggaa gaaagcgaaa ggagcgggcg ctagggcgct ggcaagtgta gcggtcacgc
7921 tgcgcgtaac caccacaccc gccgcgctta atgcgccgct acagggcgcg tcccattcgc
7981 cattcaggct gcgcaactgt tgggaagggc gatcggtgcg ggcctcttcg ctattacgcc
8041 agctggcgaa agggggatgt gctgcaaggc gattaagttg ggtaacgcca gggttttccc
8101 agtcacgacg ttgtaaaacg acggccagtg agcgcgcgta atacgactca ctatagggcg
8161 aattggggct aactaagtaa ggatcgag pVkP-O12-del2_Final(ML104)

Mice
Cell populations
T cells
WT
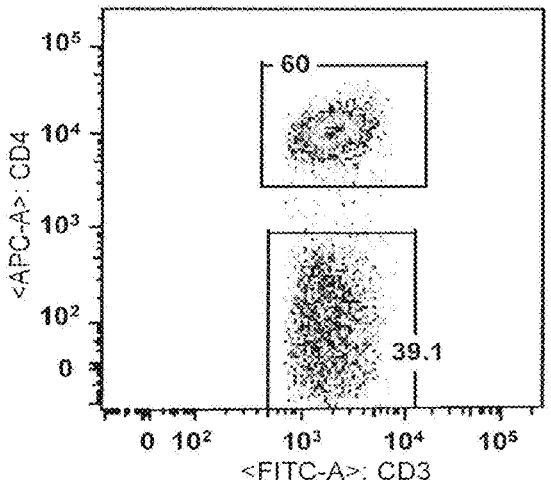
T cells
220609 st11 #_007
Event Count: 10055
CD19 Cre
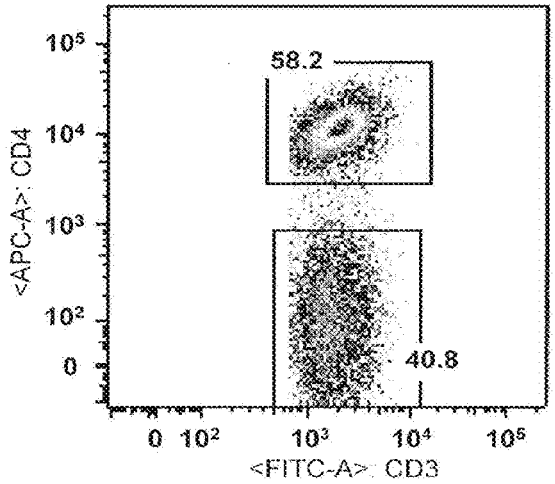
T cells
220609 st11 #_009
Event Count: 24247
CD19 Cre
HuVk1
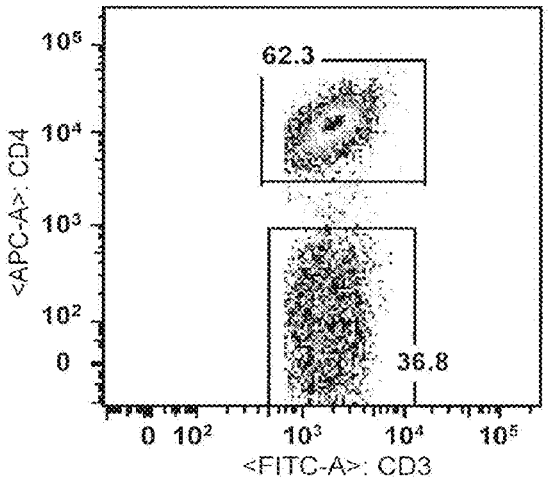
T cells
220609 st11 #_103
Event Count: 19929
Fig. 23

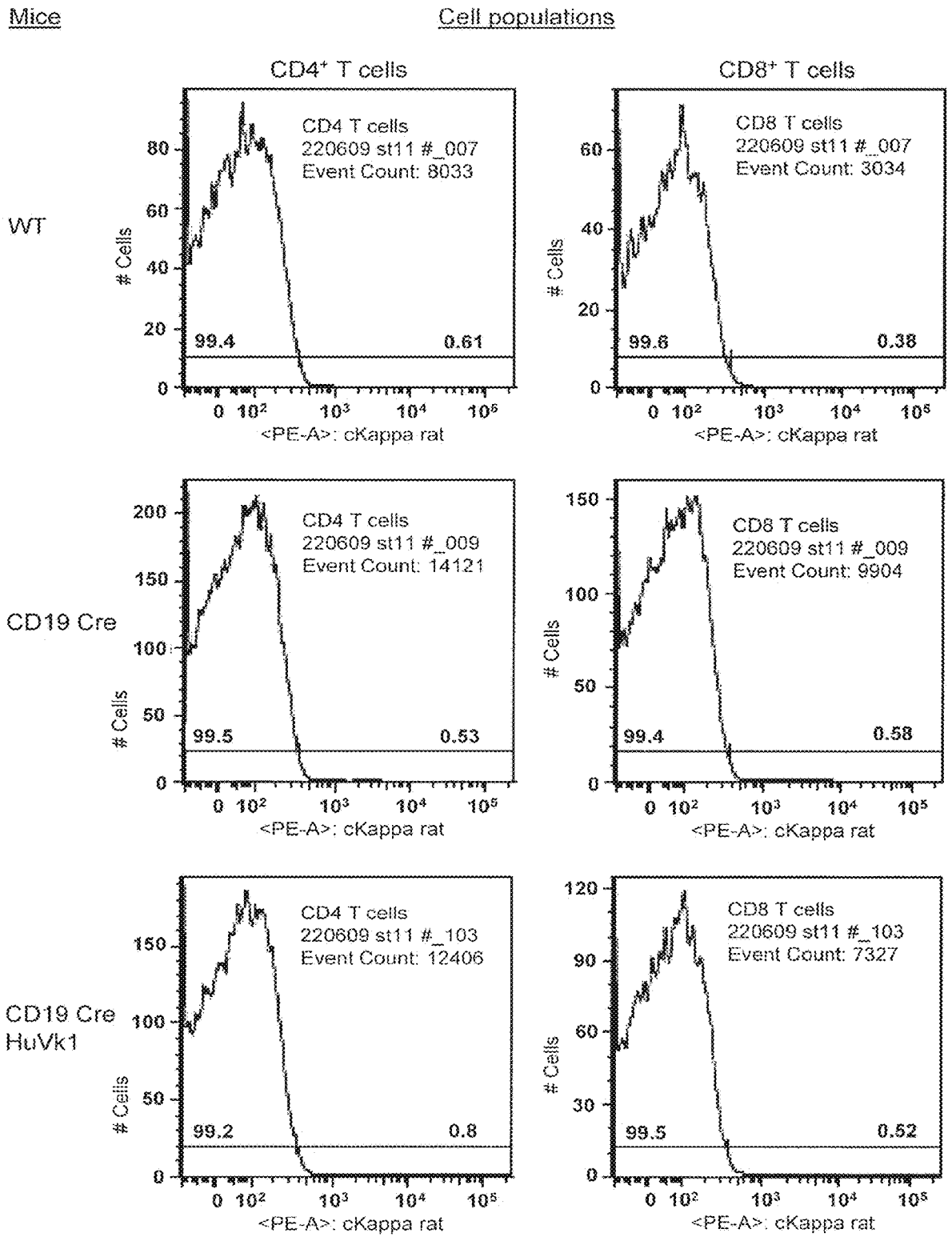
Fig. 23, contd.

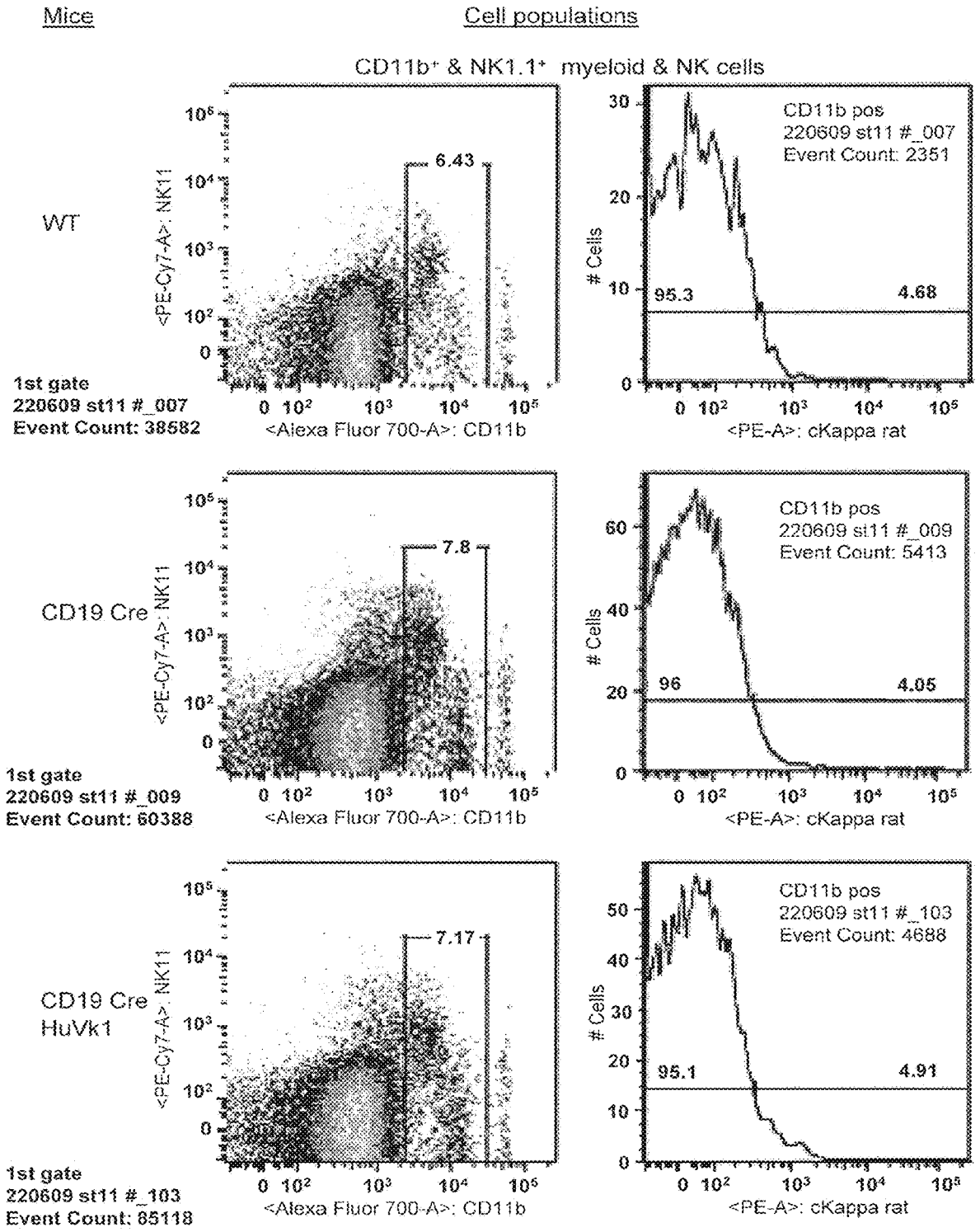
Fig. 23, contd.

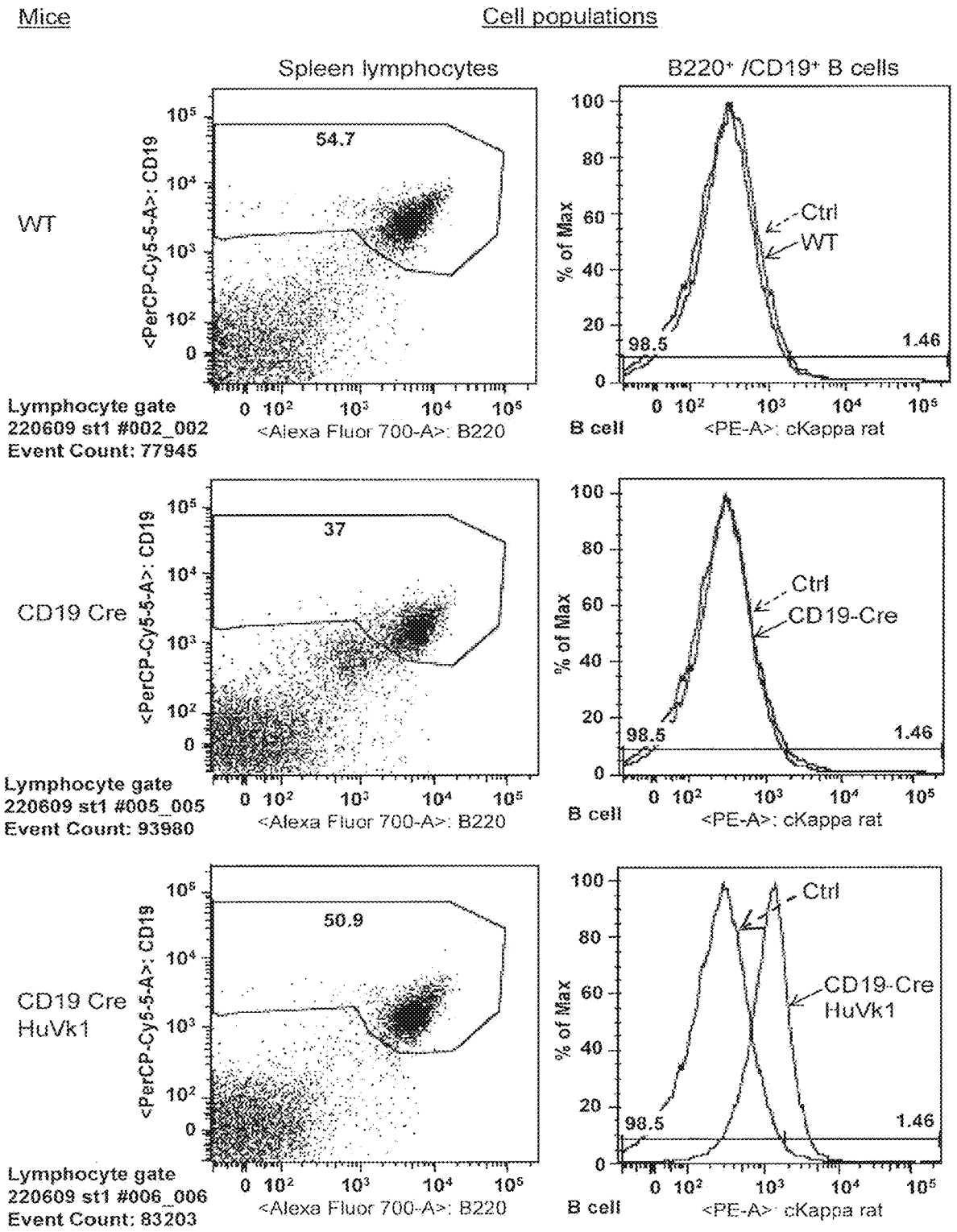
Fig. 24, contd.

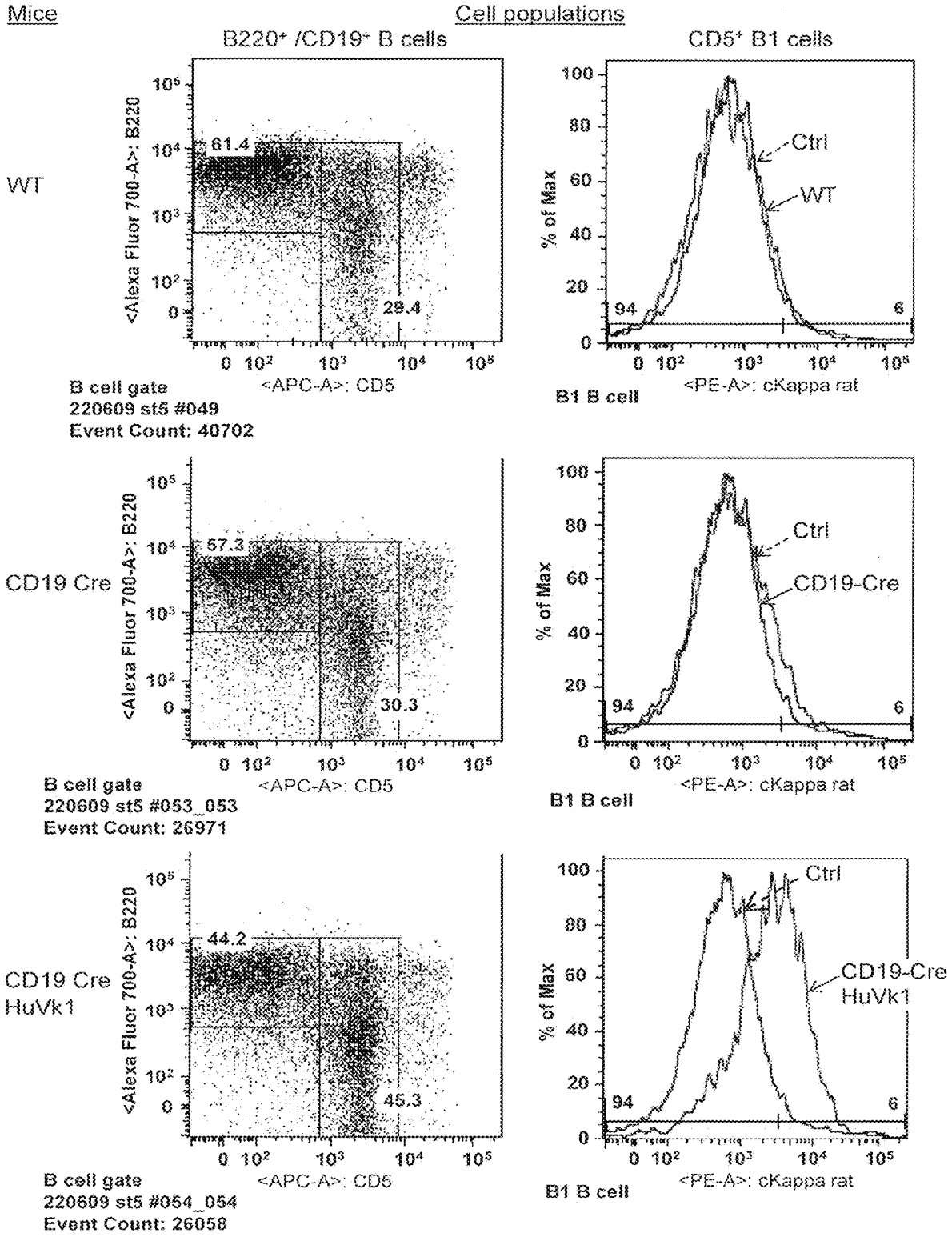
Fig. 25, contd.

Mice
Cell populations
B220⁺ cells
WT
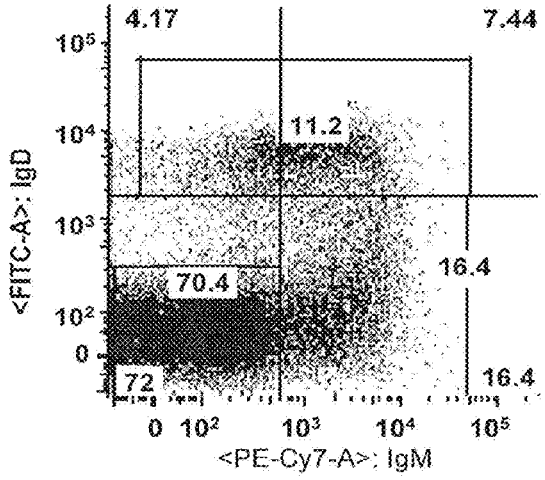
B cell gate
220609 st2 #018_018
Event Count: 35099
CD19 Cre
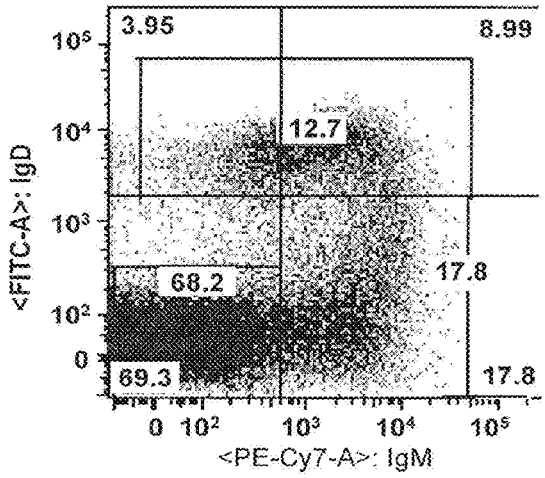
B cell gate
220609 st2 #021_021
Event Count: 41656
CD19 Cre
HuVk1
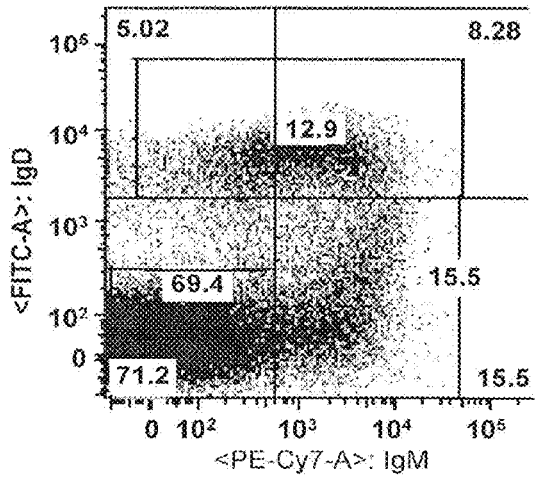
B cell gate
220609 st2 #022_022
Event Count: 44884
Fig. 26A, contd.

Mice
Cell populations
Recirculating B cells
WT
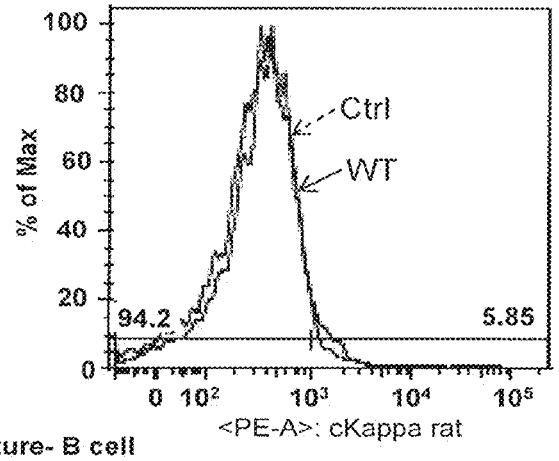
mature- B cell
CD19 Cre
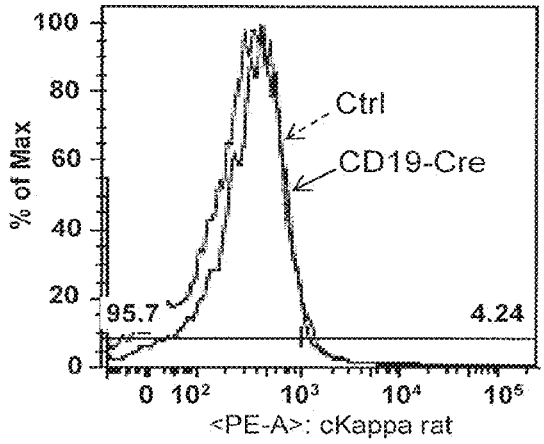
mature- B cell
CD19 Cre
HuVk1
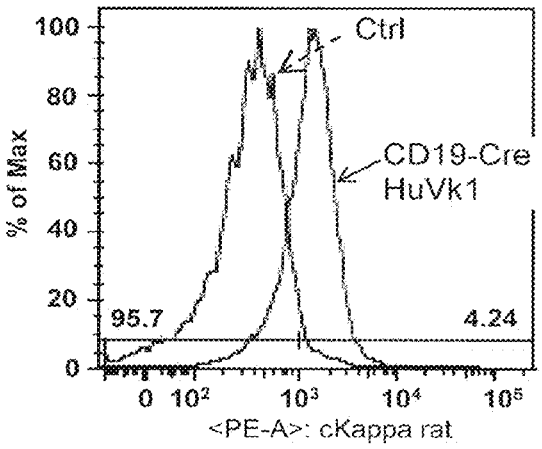
mature- B cell
Fig. 26B, contd.

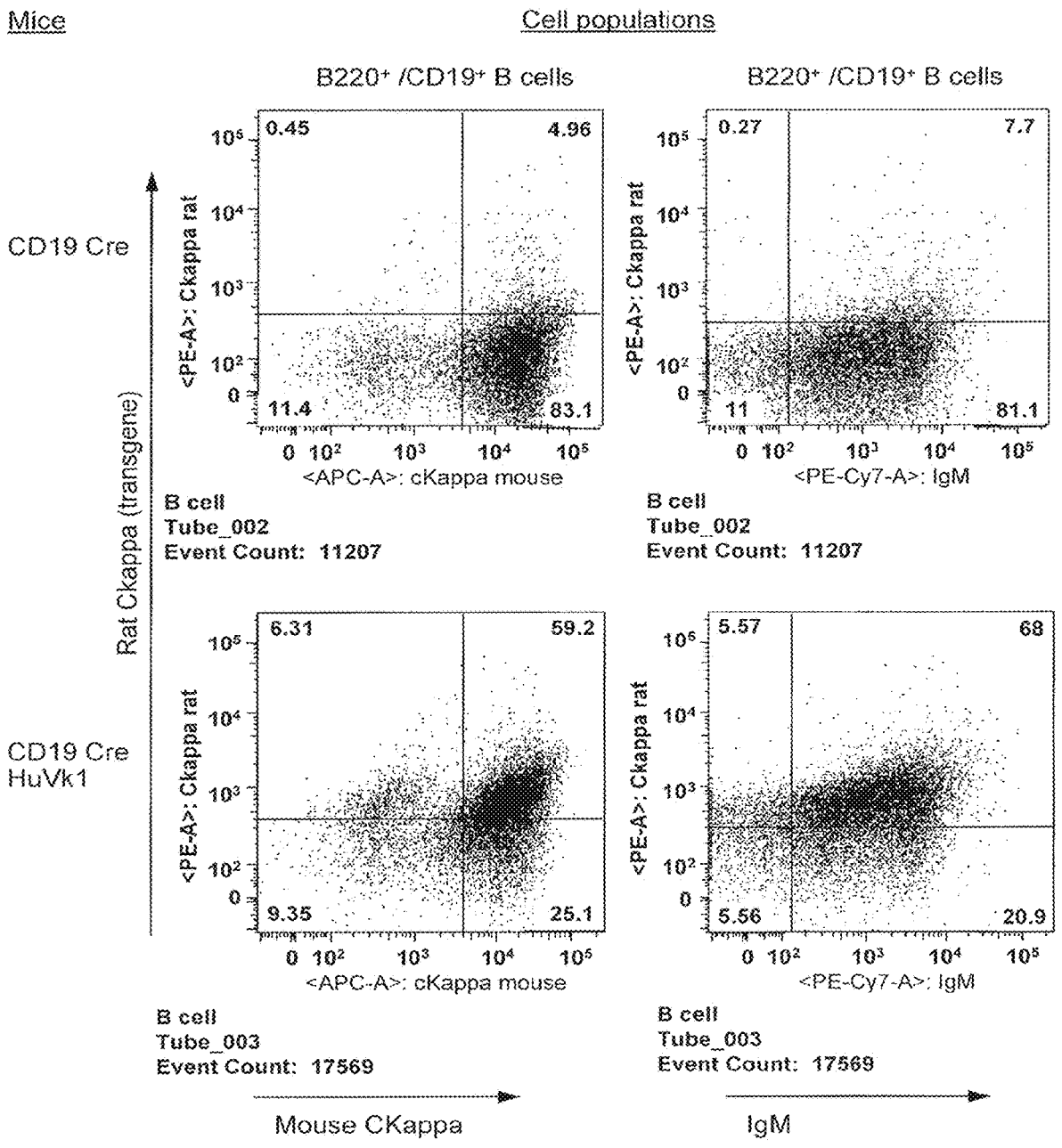
Fig. 27, contd.

| subclone | culture days at start batch run | avg pdt in previous 14 days | ± SD | % avg | batch started at population doublings | maximum viable cell density ($\times 10^6$ cells/ml) | % avg | IVC at maximum IgG concentration ($10^3$ cells/hr/L) | % avg | qAb (pg/cell/day) | % avg | maximum IgG concentration (mg/L) | % avg | correlation TF | correlation FH | correlation TH |
|---|---|---|---|---|---|---|---|---|---|---|---|---|---|---|---|---|
| 838.1 | 21 | 35 | 1,1 | 99 | 15 | 3 | 91 | 530 | 92 | 9,5 | 97 | 122 | 79 | 0,99 | 0,95 | 0,92 |
| | 40 | 41 | 1,3 | 115 | 31 | 3,7 | 112 | 568 | 99 | 10,5 | 107 | 188 | 122 | 1 | 0,99 | 0,99 |
| | 79 | 36 | 0,2 | 101 | 61 | 3,2 | 97 | 627 | 109 | 9,4 | 95 | 154 | 100 | 0,92 | 0,99 | 0,96 |
| avg | | 36 | | | | 3,3 | | 575 | | 9,8 | | 155 | | | | |
| 838.4 | 21 | 35 | 1 | 101 | 15 | 2,1 | 114 | 324 | 134 | 14,1 | 116 | 182 | 122 | 1 | 0,96 | 0,97 |
| | 40 | 35 | 0,3 | 101 | 29 | 1,8 | 98 | 247 | 78 | 12,5 | 102 | 96 | 86 | 1 | 1 | 1 |
| | 79 | 34 | 0,2 | 99 | 59 | 1,7 | 88 | 278 | 88 | 9,9 | 81 | 97 | 87 | 0,99 | 1 | 0,99 |
| avg | | 35 | | | | 1,9 | | 316 | | 12,3 | | 111 | | | | |
| 838.15 | 21 | 35 | 1,6 | 105 | 18 | 2,2 | 90 | 497 | 101 | 7,8 | 93 | 97 | 93 | 0,99 | 0,95 | 0,93 |
| | 40 | 32 | 0,3 | 97 | 30 | 2,7 | 134 | 557 | 114 | 7,3 | 91 | 114 | 109 | 1 | 0,97 | 0,97 |
| | 79 | 31 | 0,2 | 94 | 63 | 2,1 | 76 | 415 | 89 | 8,8 | 110 | 102 | 98 | 0,96 | 0,96 | 0,99 |
| avg | | 33 | | | | 2,3 | | 490 | | 8 | | 104 | | | | |
| 838.30 | 21 | 38 | 0,2 | 97 | 15 | 1,6 | 81 | 335 | 89 | 14,5 | 112 | 160 | 91 | 0,99 | 1 | 0,99 |
| | 40 | 51 | 2,7 | 131 | 30 | 2,7 | 137 | 472 | 125 | 13,9 | 107 | 206 | 117 | 1 | 0,99 | 0,99 |
| | 79 | 40 | 0,7 | 103 | 64 | 1,6 | 81 | 325 | 86 | 10,8 | 83 | 114 | 81 | 0,98 | 0,98 | 0,99 |
| avg | | 39 | | | | 2,0 | | 377 | | 13 | | 140 | | | | |
| 8224.18 | 23 | 34 | 2,8 | 100 | 17 | 3,1 | 103 | 567 | 103 | 15,8 | 98 | 208 | 81 | 1 | 0,99 | 0,99 |
| | 42 | 37 | 0,7 | 109 | 33 | 3,6 | 120 | 575 | 117 | 18,1 | 112 | 218 | 124 | 1 | 0,99 | 0,99 |
| | 81 | 33 | 0,7 | 100 | 63 | 2,3 | 77 | 363 | 80 | 14,5 | 90 | 188 | 95 | 1 | 1 | 0,99 |
| avg | | 34 | | | | 3,0 | | 492 | | 16,2 | | 257 | | | | |
| 8224.47 | 23 | 32 | 0,4 | 102 | 17 | 3,3 | 98 | 695 | 109 | 22,5 | 114 | 387 | 122 | 0,99 | 0,93 | 0,88 |
| | 42 | 33 | 0,3 | 105 | 31 | 3,6 | 101 | 578 | 91 | 20 | 101 | 357 | 112 | 0,99 | 0,92 | 0,95 |
| | 81 | 31 | 0,2 | 96 | 64 | 3,6 | 101 | 634 | 100 | 16,8 | 85 | 209 | 66 | 1 | 0,99 | 0,99 |
| avg | | 32 | | | | 3,6 | | 636 | | 19,9 | | 316 | | | | |
| 8224.53 | 23 | 33 | 0,5 | 100 | 17 | 3,9 | 110 | 553 | 99 | 20,6 | 102 | 372 | 114 | 0,98 | 0,92 | 0,95 |
| | 42 | 32 | 0,4 | 97 | 33 | 3,7 | 105 | 605 | 108 | 24,3 | 121 | 379 | 116 | 0,98 | 0,95 | 0,94 |
| | 81 | 33 | 0,1 | 100 | 63 | 3 | 85 | 525 | 94 | 15,4 | 77 | 251 | 77 | 0,98 | 0,99 | 0,94 |
| avg | | 33 | | | | 3,5 | | 561 | | 20,1 | | 327 | | | | |
| 8224.59 | 23 | 36 | 0,6 | 104 | 16 | 4,3 | 115 | 750 | 107 | 16,4 | 106 | 301 | 104 | 0,99 | 0,98 | 0,94 |
| | 42 | 34 | 0,2 | 96 | 30 | 4,4 | 118 | 779 | 111 | 18,6 | 95 | 348 | 119 | 0,98 | 0,92 | 0,96 |
| | 81 | 33 | 0,3 | 96 | 61 | 2,5 | 67 | 583 | 83 | 15,2 | 98 | 228 | 77 | 0,97 | 0,99 | 0,96 |
| avg | | 35 | | | | 3,7 | | 704 | | 16,4 | | 290 | | | | |
| 8280.3 | 23 | 34 | 0,6 | 105 | 17 | 4,3 | 105 | 840 | 108 | 13 | 109 | 293 | 117 | 0,99 | 0,98 | 0,95 |
| | 42 | 32 | 0,4 | 98 | 33 | 4 | 98 | 841 | 108 | 12,3 | 103 | 292 | 116 | 0,99 | 0,98 | 0,98 |
| | 81 | 31 | 0,1 | 95 | 67 | 4 | 98 | 660 | 85 | 10,5 | 88 | 168 | 67 | 0,99 | 0,98 | 1 |
| avg | | 33 | | | | 4,1 | | 780 | | 11,9 | | 251 | | | | |
| 8280.12 | 23 | 36 | 1,7 | 104 | 15 | 2 | 92 | 426 | 77 | 5,8 | 95 | 64 | 81 | 0,98 | 0,98 | 0,98 |
| | 42 | 37 | 0,7 | 107 | 30 | 3,2 | 116 | 675 | 122 | 8,2 | 101 | 96 | 121 | 1 | 0,97 | 0,97 |
| | 81 | 33 | 0,3 | 96 | 63 | 3,3 | 112 | 552 | 100 | 6,4 | 104 | 78 | 98 | 0,98 | 0,98 | 0,98 |
| avg | | 35 | | | | 2,8 | | 550 | | 6,1 | | 79 | | | | |
| 8280.21 | 23 | 32 | 0,6 | 102 | 18 | 3,3 | 103 | 555 | 97 | 8,3 | 128 | 113 | 93 | 0,97 | 0,92 | 0,93 |
| | 42 | 31 | 0,4 | 98 | 34 | 3,4 | 113 | 588 | 104 | 3,6 | 56 | 137 | 113 | 1 | 0,98 | 0,99 |
| | 81 | 31 | 0,4 | 98 | 68 | 2,5 | 83 | 566 | 100 | 8,8 | 121 | 114 | 94 | 0,97 | 0,99 | 1 |
| avg | | 32 | | | | 3,0 | | 568 | | 7,1 | | 123 | | | | |
| 8280.36 | 23 | 33 | 1 | 99 | 17 | 3 | 81 | 596 | 75 | 10 | 186 | 143 | 158 | 1 | 0,99 | 0,98 |
| | 42 | 36 | 0,5 | 107 | 30 | 4,6 | 124 | 1163 | 146 | 5,6 | 104 | 122 | 135 | 1 | 0,98 | 0,97 |
| | 81 | 33 | 0,3 | 101 | 62 | 3,5 | 95 | 635 | 79 | 0,56 | 10 | 6 | 5 | 0,97 | 0,98 | 1 |
| avg | | 34 | | | | 3,7 | | 800 | | 5,4 | | 92 | | | | |

FIG. 28

| | Stainings | | | | | Mixtures | | | | |
|---|---|---|---|---|---|---|---|---|---|---|
| | # | Facs tubes # | Monoclonal | Work dilution | | volume | 1st step | 2nd step | 3rd step | Final diltion |
| A | | | | | | | | | | |
| Spleen | 1 | 1-8 | CD21$^{FITC}$ | 640 | | 320 | | 0.50 | | |
| | | | Ckappa rat$^{PE}$ | 160 | | | 2.00 | | | |
| | | | CD19$^{PerCP-Cy5.5}$ | 640 | | | | 0.50 | | |
| | | | CD23$^{PE-Cy7}$ | 50 | 1:20 | | | 6.40 | | 1000 |
| | | | DAPI | | | | | | | |
| | | | Ckappa mouse$^{BIO-APC}$ | 100 | 1:50 | | | 3.20 | APC | 5000 |
| | | | Clambda mouse$^{BIO-APC}$ | 100 | 1:30 | | | 3.20 | APC | 3000 |
| | | | B220$^{Alex-700}$ | 160 | | | | 2.00 | | |
| | | | FC block | 400 | | | | 0.80 | | |
| | | | | | | | | | | |
| Spleen | 2 | 9-16 | IgD$^{FITC}$ | 640 | | 640 | | 1.00 | | |
| BM | | 17-24 | Ckappa rat$^{PE}$ | 160 | | | 4.00 | | | |
| | | | CD19$^{PerCP-Cy5.5}$ | 500 | | | | 1.28 | | |
| | | | IgM$^{PE-Cy7}$ | 640 | | | | 1.00 | | |
| | | | DAPI | | | | | | | |
| | | | Ckappa mouse$^{BIO-APC}$ | 100 | 1:50 | | | 6.40 | APC | 5000 |
| | | | Clambda mouse$^{BIO-APC}$ | 100 | 1:30 | | | 6.40 | APC | 3000 |
| | | | B220$^{Alex-700}$ | 160 | | | | 4.00 | | |
| | | | FC block | 400 | | | | 1.60 | | |
| | | | | | | | | | | |
| Spleen | 3 | 25-32 | Ckappa mouse$^{FITC}$ | 400 | | 320 | | 0.80 | | |
| | | | Ckappa rat$^{PE}$ | 160 | | | 2.00 | | | |
| | | | CD19$^{PerCP-Cy5.5}$ | 500 | | | | 0.64 | | |
| | | | IgM$^{PE-Cy7}$ | 640 | | | | 0.50 | | |
| | | | DAPI | | | | | | | |
| | | | Clambda mouse$^{BIO-APC}$ | 100 | 1:30 | | | 3.20 | APC | 3000 |
| | | | B220$^{Alex-700}$ | 160 | | | | 2.00 | | |
| | | | FC block | 400 | | | | 0.80 | | |
| | | | | | | | | | | |
| Spleen | 4 | 33-40 | Ckappa mouse$^{FITC}$ | 400 | | 640 | | 1.60 | | |
| | | 41-48 | lambda$^{FITC}$ | 600 | | | | 1.07 | | |
| PP | | | Ckappa rat$^{PE}$ | 160 | | | 4.00 | | | |
| | | | CD19$^{PerCP-Cy5.5}$ | 500 | | | | 1.28 | | |

FIG. 29A

| | | | | | | | | | | |
|---|---|---|---|---|---|---|---|---|---|---|
| | | | IgM$^{PE-Cy7}$ | 640 | | | | 1.00 | | |
| | | | DAPI | | | | | | | |
| | | | IgD$^{A647}$ | 1280 | | | | 0.50 | | |
| | | | B220$^{Alex-700}$ | 160 | | | | 4.00 | | |
| | | | PNA$^{BIO-SAV-APC-Cy7}$ | 300 | | | | 2.13 | APC-Cy7 | |
| | | | FC block | 400 | | | | 1.60 | | |
| PC | 5 | 49-56 | IgM$^{FITC}$ | 160 | | 320 | | 2.00 | | |
| | | | Ckappa rat$^{PE}$ | 160 | | | 2.00 | | | |
| | | | CD19$^{PerCP-Cy5.5}$ | 500 | | | | 0.64 | | |
| | | | Ckappa mouse$^{BIO-PE-Cy7}$ | 100 | 1:50 | | | 3.20 | PE-Cy7 | 5000 |
| | | | Clambda mouse$^{BIO-PE-Cy7}$ | 100 | 1:30 | | | 3.20 | PE-Cy7 | 3000 |
| | | | DAPI | | | | | | | |
| | | | CD5$^{APC}$ | 320 | | | | 1.00 | | |
| | | | B220$^{Alex-700}$ | 160 | | | | 2.00 | | |
| | | | FC block | 400 | | | | 0.80 | | |
| | | | | | | | | | | |
| BM | 6 | 57-64 | IgM$^{FITC}$ | 160 | | 640 | | 4.00 | | |
| | | | Ckappa rat$^{PE}$ | 160 | | | 4.00 | | | |
| | | | CD19$^{PerCP-Cy5.5}$ | 500 | | | | 1.28 | | |
| | | | Ckappa mouse$^{BIO-PE-Cy7}$ | 100 | 1:50 | | | 6.40 | PE-Cy7 | 5000 |
| | | | Clambda mouse$^{BIO-PE-Cy7}$ | 100 | 1:30 | | | 6.40 | PE-Cy7 | 3000 |
| | | | DAPI | | | | | | | |
| | | | CD25$^{APC}$ | 80 | | | | 8.00 | | |
| | | | B220$^{Alex-700}$ | 160 | | | | 4.00 | | |
| | | | FC block | 400 | | | | 1.60 | | |
| RAT spleen | | | | | | | | | | |
| | 7 | 144 | Ckappa rat$^{PE}$ | 160 | | 80 | 0.5 | | | |
| | | | rat B220$^{FITC}$ | 160 | | | 0.5 | | | |
| Spleen | 8 | 97-104 | cyt CD3$^{FITC}$ | 320 | | 320 | | 1 | | |
| | | | cyt Ckappa rat$^{PE}$ | 80 | | | 4.00 | | | |
| | | | cyt CD11c$^{PE-TexasRED}$ | 75 | | | | 4.27 | | |
| | | | cyt NK1.1$^{BIO-PE-Cy7}$ | 200 | | | | 1.6 | PE-Cy7 | |
| | | | cyt CD19$^{PerCP-Cy5.5}$ | 320 | | | | 1 | | |
| | | | cyt CD4$^{APC}$ | 500 | | | | 0.64 | | |
| | | | cyt CD11b$^{Alex-700}$ | 50 | | | | 6.40 | | |

FIG. 29B

ANTIBODY PRODUCING NON-HUMAN ANIMALS

CROSS-REFERENCE TO RELATED APPLICATION

This application is a continuation of U.S. patent application Ser. No. 12/589,181, filed Oct. 19, 2009, pending, which application is a continuation of U.S. patent application Ser. No. 12/459,285, filed Jun. 29, 2009, abandoned, which applications claim the benefit, under 35 U.S.C. § 119(e), to U.S. Provisional Patent Application Ser. No. 61/133,274, filed Jun. 27, 2008, for "Antibody Producing Non-Human Mammals," the entire contents of each of which are hereby incorporated herein by this reference.

STATEMENT ACCORDING TO 37 C.F.R. § 1.821(c) or (e)-SEQUENCE LISTING SUBMITTED AS ASCII TEXT FILE

Pursuant to 37 C.F.R. § 1.821(c) or (e), files containing a TXT version and a PDF version of the Sequence Listing have been submitted concomitant with this application, the contents of which are hereby incorporated by reference.

TECHNICAL FIELD

The invention relates to the production and use of non-human animals capable of producing antibodies or derivatives thereof, which are expressed from at least partially exogenous nucleic acids (transgenes). Transgenes to produce such transgenic animals and methods to produce such heterologous antibodies; methods and vectors for producing such transgenic animals are disclosed.

BACKGROUND

B cells mediate humoral immunity by producing specific antibodies. The basic structural subunit of an antibody (Ab) is an immunoglobulin (Ig) molecule. Ig molecules consist of a complex of two identical heavy (H) and two identical light (L) polypeptide chains. At the amino terminus of each H chain and L chain is a region that varies in amino acid sequence named the variable (V) region. The remaining portion of the H and L chains is relatively constant in amino acid sequence and is named the constant (C) region. In an Ig molecule, the H and L chain V regions (VH and VL) are juxtaposed to form the potential antigen-binding site. The genes that encode H and L chain V regions are assembled somatically from segments of germline DNA during precursor B (pre-B) cell differentiation: V, D and J gene segments for the H chain and V and J gene segments for the L chain. Within Ig V regions are three regions of greatest amino acid sequence variability that interact to form the antigen-recognition site and are thus referred to as complementarity determining regions (CDRs).

The V gene segment encodes the bulk of the V region domain, including CDR1 and CDR2. Diversity in CDR1 and CDR2 derives from sequence heterogeneity among multiple different germline-encoded V segments. CDR3 is encoded by sequences that are formed by the joining of H chain V, D, and J gene segments and L chain V and J segments and by mechanisms that create nucleotide sequence heterogeneity where these segments are combined. Additional diversity may be derived from pairing of different H and L chain V regions. Collectively these processes yield a primary repertoire of antibodies encoded by germline gene segments and expressed by newly formed B cells.

An additional source of antibody diversity is imposed on top of the diversity generated by recombination of Ig gene segments. B cells are able to introduce mutations into the antibody V regions that they express, a process called somatic hypermutation. Thus, when an animal first encounters an antigen, the antigen binds to a specific B cell which happens to carry antibodies which have a V domain which binds the antigen. This primary response may activate this B cell to go on to secrete the cognate antibody. These activated B cells can also now target a somatic mutation process to their rearranged antibody gene segments and thus allow the production of daughter cells which make variants of the antibodies of the primary response. A selection process amplifies those variant B cell descendants which make an antibody of improved affinity of the antigen. In B cells, somatic hypermutations are targeted to a restricted genomic region including both the rearranged VH and VL genes. Thus somatic mutation allows affinity maturation—the production and selection of high affinity antibodies. Therefore, somatic mutation is important for the generation of high affinity antibodies.

The exquisite specificity and high affinity of antibodies and the discovery of hybridoma technology allowing the generation of monoclonal antibodies (mAbs) has generated great expectations for their utilization as targeted therapeutics for human diseases. MAbs are identical because they are produced by a single B cell and its progeny. MAbs are made by fusing the spleen cells from a mouse that has been immunized with the desired antigen with myeloma cells to generate immortalized hybridomas. One of the major impediments facing the development of in vivo applications for mAbs in humans is the intrinsic immunogenicity of non-human Igs. Patients respond to therapeutic doses of mouse mAbs by making antibodies against the mouse Ig sequences (Human Anti Mouse Antibodies; HAMA), causing acute toxicity, alter their biodistribution and accelerate clearance, thus reducing the efficacy of subsequent administrations (Mirick et al. (2004), *Q. Nucl. Med. Mol. Imaging* 48:251-257).

To circumvent the generation of HAMA, antibody humanization methods have been developed in an attempt to produce mAbs with decreased immunogenicity when applied to humans. These endeavors have yielded various recombinant DNA-based approaches aimed at increasing the content of human amino acid sequences in mAbs while retaining the specificity and affinity of the parental non-human antibody. Humanization began with the construction of mouse-human chimeric mAbs (S. L. Morrison et al. (1984), *Proc. Natl. Acad. Sci. USA* 81:6851-5), in which the Ig C regions in murine mAbs were replaced by human C regions. Chimeric mAbs contain 60-70% of human amino acid sequences and are considerably less immunogenic than their murine counterparts when injected into humans, albeit that a human anti-chimeric antibody response was still observed (W. Y. Hwang et al. (2005), *Methods* 36:3-10).

In attempts to further humanize murine mAbs, CDR grafting was developed. In CDR grafting, murine antibodies are humanized by grafting their CDRs onto the VL and VH frameworks of human Ig molecules, while retaining those murine framework residues deemed essential for specificity and affinity (P. T. Jones et al. (1986), *Nature* 321:522). Overall, CDR-grafted antibodies consist of more than 80% human amino acid sequences (C. Queen et al. (1989), *Proc. Natl. Acad. Sci. U.S.A.* 86:10029; P. Carter et al. (1992), *Proc. Natl. Acad. Sci. U.S.A.* 89:4285). Despite these efforts, CDR-grafted, humanized antibodies were shown to still evoke an antibody response against the grafted V region (W. Y. Hwang et al. (2005), *Methods* 36:3).

Subsequently to CDR grafting, humanization methods based on different paradigms such as resurfacing (E. A. Padlan et al. (1991), *Mol. Immunol.* 28:489), superhumanization (P. Tan D. A. et al. (2002), *J. Immunol.* 169:1119), human string content optimization (G. A. Lazar et al. (2007), *Mol. Immunol.* 44:1986) and humaneering have been developed in an attempt to further decrease the content of non-human sequences in therapeutic mAbs (J. C. Almagro et al. (2008), *Frontiers in Bioscience* 13:1619). As in CDR grafting approaches, these methods rely on analyses of the antibody structure and sequence comparison of the non-human and human mAbs in order to evaluate the impact of the humanization process into immunogenicity of the final product. When comparing the immunogenicity of chimeric and humanized antibodies, humanization of variable regions appears to decrease immunogenicity further (W. Y. Hwang et al. (2005), *Methods* 36:3-10).

De-immunization is another approach developed to reduce the immunogenicity of chimeric or mouse antibodies. It involves the identification of linear T-cell epitopes in the antibody of interest, using bioinformatics, and their subsequent replacement by site-directed mutagenesis to human or non-immunogenic sequences (WO 9852976 A1, the contents of which are incorporated by this reference). Although de-immunized antibodies exhibited reduced immunogenicity in primates, compared with their chimeric counterparts, some loss of binding affinity was observed (M. Jain et al. (2007), *Trends in Biotechnol.* 25:307).

The development of phage display technology complemented and extended humanization approaches in attempts to obtain less immunogenic mAbs for therapy in humans. In phage display, large collections ("libraries") of human antibody VH and VL regions are expressed on the surface of filamentous bacteriophage particles. From these libraries, rare phages are selected through binding interaction with antigen; soluble antibody fragments are expressed from infected bacteria and the affinity of binding of selected antibodies is improved by mutation (G. Winter et al. (1994), *Annu. Rev. Immunol.* 12:433). The process mimics immune selection, and antibodies with many different bindings specificities have been isolated using this approach (H. R. Hoogenboom et al. (2005), *Nat. Biotechnol.* 23:1105). Various sources of H and L chain V regions have been used to construct phage display libraries including those isolated from non-immune or immune donors. In addition, phage display libraries have been constructed of V regions that contain artificially randomized synthetic CDR regions in order to create additional diversity. Often, antibodies obtained from phage display libraries are subjected to in vitro affinity maturation to obtain high affinity antibodies (H. R. Hoogenboom et al. (2005), *Nat. Biotechnol.* 23:1105).

The creation of transgenic mouse strains producing human antibodies in the absence of mouse antibodies has provided another technology platform for the generation of specific and high affinity human mAbs for application in humans. In these transgenic animals, the endogenous mouse antibody machinery is inactivated and replaced by human Ig loci to substantially reproduce the human humoral immune system in mice (A. Jakobovits et al. (2007), *Nat. Biotechnol.* 25:1134; N. Lonberg (2005), *Nat. Biotechnol.* 23:1117). B cell development as well as Ig diversification by recombination of gene segments is faithfully reproduced in these mice, leading to a diverse repertoire of murine B cells expressing human Igs. By immunizing these mice with antigens, it was further demonstrated that these transgenic animals accumulated somatic mutations in the V regions of both heavy and light chains to produce a wide diversity of high-affinity human mAbs (N. Lonberg (2005), *Nat. Biotechnol.* 23:1117).

The question, whether "fully human" mAbs such as derived from phage display libraries or transgenic mice are less immunogenic than humanized mAbs cannot be answered yet, because full immunogenicity data are available for just two human mAbs. An anti-tumor necrosis factor mAb, developed from phage-displayed human libraries induced antibody responses in 12% of patients—at the higher end of the incidence of anti-antibody responses of the humanized antibodies (W. Y. Hwang et al. (2005), *Methods* 36:3-10).

Evaluation of the immunogenicity of the first registered human mAb generated by the transgenic approach demonstrated that mAb treatment resulted in the generation of antibodies in approximately 5.5% of treated cancer patients (A. Jakobovits et al. (2007), *Nat. Biotechnol.* 25:1134; J. A. Lofgren et al. (2007), *J. Immunol.* 178:7467).

DISCLOSURE OF THE INVENTION

Disclosed are a method and means for producing antibodies that are specific for their targets, but are less immunogenic. Described herein, the reduction of immunogenicity is at least partially achieved by providing a transgenic non-human mammal comprising, at least in its B cell lineage, a nucleic acid encoding at least an immunoglobulin light chain or heavy chain, wherein the heavy- or light chain encoding sequence is provided with a means that renders it resistant to DNA rearrangements and/or somatic hypermutations, preferably such a non-human animal is a rodent, more specifically a mouse. In certain embodiments, the nucleic acid encodes a human, human-like, or humanized immunoglobulin chain.

In the remainder of this specification, mice are typically used as examples of the non-human mammals. The transgenic, non-human, mammalian hosts are capable of mounting an immune response to an antigen, where the response produces antibodies having primate, particularly human, variable regions. Various transgenic hosts may be employed, particularly murine, lagomorpha, ovine, avine, porcine, equine, canine, feline, or the like. Mice have been used for the production of B-lymphocytes for immortalization for the production of antibodies. Since mice are easy to handle, can be bred in large numbers, and are known to have an extensive immune repertoire, mice will usually be the animal of choice. Therefore, in the following discussion, the discussion will refer to mice, but it should be understood that other animals, particularly non-primate mammals, may be readily substituted for the mice, following the same procedures.

The reason for preventing rearrangements and hypermutation is that in this manner a non-immunogenic polypeptide can be chosen beforehand knowing that this polypeptide chain will remain non-immunogenic. At least one of the chains of the resulting immunoglobulin is thus less immunogenic. The resulting antibody needs to have (usually) both a light- and a heavy chain. The non-immunogenic chain must therefore be capable of pairing with the other chain. The other chain may be an endogenous chain, an exogenous chain or a hybrid of both. For human therapy, the non-immunogenic chain should be as close to human as possible.

A means for rendering a gene encoding an immunoglobulin chain (or chains) resistant to DNA rearrangement and/or mutation is of course removal of all genetic elements responsible for the rearrangement and/or mutation. The drawback thereof is that the variability of the two chains is eliminated, whereas the invention preferably retains the variability in one chain (preferably the heavy chain) and inhibits and/or prevents the rearrangement-mutation of the other chain (preferably the light chain).

The elements for rearrangement and/or hypermutation characterized so far are located within the loci for immunoglobulins. Therefore the means for rendering the immunoglobulin encoding sequence resistant to DNA rearrangement and/or mutation is inserting the gene in a locus outside the immunoglobulin loci.

Thus, described herein, a transgenic non-human mammal is provided wherein the light/heavy chain encoding sequence is integrated in the genome of the non-human mammal in a locus outside the immunoglobulin loci. Preferably the insertion is in a locus that is resistant to gene silencing. Described herein, the integration is in the Rosa-locus or a comparable locus.

In certain embodiments, provided is an expression cassette that can be inserted into a Rosa locus or comparable locus with a means that allows expression of the immunoglobulin chain(s) essentially limited to cells of B cell lineage, preferably with a means that allows expression of the light chain encoding nucleic acid during a certain stage of the development of B cells. The term "essentially limited expression" indicates that expression is predominantly in cells of the B-cell lineage, but that lower levels of expression in other cells, as compared to the level of expression in B-cells, is possible. In certain embodiments, the term "essentially limited expression" indicates that the expression is exclusively present in cells of the B-cell lineage. Such means typically and preferably include B cell (developmental stage) specific promoters such as CD19, CD20, μHC (all V-genes), VpreB1, VpreB2, VpreB3, λ5, Igα, Igβ, κLC (all genes), λLC (all genes), BSAP (Pax5). Although it is very well possible to direct the expression of the DNA rearrangement and/or mutation resistant chain by such promoters, they are relatively weak. A strong promoter will typically be required to ensure adequate surface expression of the B cell receptor (made up of the membrane attached Ig H and L chain) and to compete with the expression and pairing of endogenous chains (if present) through allelic exclusion. Such a promoter, however is usually not tissue specific. To confer tissue specificity, an indirect system employing Cre/lox or the like is preferred. The desired chain is put under control of a strong promoter inhibited by an element that can be removed by the action of a Cre-protein, leading to activation of the desired immunoglobulin encoding gene. This system is described in detail in F. T. Wunderlich (2004), "Generation of inducible Cre systems for conditional gene inactivation in mice," Inauguraldissertation zur Erlangung des Doktorgrades der Mathematisch-Naturwissenschaftlichen Fakultät der Universität zu Köln; on the internet at deposit.ddb.de/cgi-bin/dokserv?idn=97557230x&dok_var=d1&dok_ext=pdf&filename=975572 30x.pdf.

Preferably the immunoglobulin chain produced in a manner resistant to rearrangements and hypermutation is a light chain capable of pairing with different heavy chains encoded by the non-human mammal. The light chain will then be the same (and less immunogenic) in all antibodies, but variety in specificity is retained through rearrangements and hypermutations in the heavy chains. It may in that case be preferable to silence at least one of the endogenous loci encoding a light chain, although allelic exclusion may render this unnecessary.

According to this embodiment, preferably the endogenous kappa (κ) light chain locus is functionally silenced.

If the endogenous κ light chain locus is silenced, but also for other reasons, it is preferred that the resistant light chain is a κ light chain, preferably a light chain that has a germline-like sequence. Described herein such a light chain would lead to an antibody with reduced immunogenicity. The preferred germline sequence is based on the human IGKV1-39 (O12) as this light chain is very frequently observed in the human repertoire (de Wildt et al. 1999, *J. Mol. Biol.* 285(3):895) and has superior thermodynamic stability, yield and solubility (Ewert et al. 2003, *J. Mol. Biol.* 325(3):531).

The following gives more specific embodiments of the expression cassette with which the non-human animal can be provided described herein. Although this is typically advantageous for immunoglobulins, other genes of interest are also contemplated.

Thus, provided in a specific embodiment, is a transgenic non-human mammal wherein the light chain encoding nucleic acid comprises in 5'-3' direction: a B cell specific promoter, a leader, a rearranged human V gene, optionally a mouse κ-intron enhancer (MoEκi), a constant region (κ) and optionally a (truncated) mouse κ-3' enhancer (MoEκ3'). Neuberger identified and examined a novel B-cell specific enhancer located downstream of the kappa constant region (Neuberger, EP 00469025 B1, the contents of which are incorporated herein by this reference). This enhancer has been shown to play a crucial role in the expression of kappa genes as removal of the 808 bp enhancer strongly reduced expression. Deletion of the 3' kappa enhancer also strongly reduced the level of somatic hypermutations (SHM). In transgenic and cell expression studies, it has been revealed that reduced, mutated or deleted 3' kappa enhancers not only lowered expression levels, but also decreased the level of somatic hypermutations. Currently, it cannot be determined whether the 3' kappa enhancer is involved in SHM processes, expression regulation or both (review V. H. Odegard et al. (2006), *Nat. Rev. Immunol.* 6:573; M. Inlay et al. (2002), *Nat. Immunol.* 3:463).

Detailed expression studies using engineered variants of the 3' kappa enhancer indicated that a 50 nucleotide region is sufficient to drive expression. However for proper expression a reduced sequence of 145 nucleotides is preferred (EP04690251; K. B. Meyer et al. (1990), *Nucleic Acids Res.* 18(19):5609-15).

Thus, the invention in one aspect provides a nucleic acid for insertion into the genome of a non human animal that is an expression cassette for the expression of a desired proteinaceous molecule in cells developing into mature B cells during a certain stage of development, the cassette comprising means for preventing silencing of expression of the desired proteinaceous molecule after introduction into a host cell, and means for timing expression of the desired proteinaceous molecule with the desired developmental stage of the host cell.

An expression cassette is defined as a nucleic acid that has been provided with means for introduction into the genome of a host cell, such as sequences which allow for homologous recombination with a certain site in the genome. Usually the nucleic acid will be DNA, typically double stranded. Typically the expression cassette will be provided to the cell in a vector from which it is transferred to the genome of the cell. The expression cassette further comprises all elements necessary for expression of the gene in a host cell, although in certain embodiments some of such elements may be present on a second nucleic acid to be introduced, whereby these elements act in trans. Elements necessary for expression in a host cell include promoters, enhancers and other regulatory elements. Only those elements are necessary that are not provided by the host cell.

The expression of the gene of interest should not be silenced in the genome of the host cell, especially not in the development stage where expression is required. This can be done by various means, such as insertion into the endogenous locus or by providing the cassette with nucleic acid elements that prevent silencing (Kwaks et al. (2006), *Trends Biotechnol.* 24(3):137-142, which is incorporated herein by reference). It is preferred that the expression cassette is inserted in a locus that is not silenced in the host cells (EP 01439234; which is incorporated herein by reference).

The means for prevention of silencing comprise STabilizing Anti-Repression-sequences (STAR®-sequences) and Matrix Attachment Regions (MARs). A STAR sequence is a nucleic acid sequence that comprises a capacity to influence transcription of genes in cis. Typically, although not necessarily, a STAR sequence does not code by itself for a functional protein element. In one embodiment one STAR element is used. Preferably, however, more than one STAR element is used. In a particularly preferred embodiment an expression cassette described herein is provided with two STAR sequences; one STAR sequence at the 5' side of the coding sequence of the immunoglobulin gene and one STAR sequence at the 3' side of the coding sequence of the immunoglobulin gene. MARs are DNA sequences that are involved in anchoring DNA/chromatin to the nuclear matrix and they have been described in both mammalian and plant species. MARs possess a number of features that facilitate the opening and maintenance of euchromatin. MARs can increase transgene expression and limit position-effects.

Expression from the cassette should only occur during a certain period in the development of a cell, in particular a developing B cell, more in particular a B cell in a transgenic non-human animal, in particular a mouse. In this particular case the developmental period is chosen such that the expression of the gene from the cassette (typically a light- or heavy chain-like polypeptide) does not significantly interfere with the normal differentiation and/or maturation of the cell and when applicable, allows for pairing of the polypeptide chain produced with its counterpart.

This may, in one embodiment, be achieved by providing a nucleic acid described herein, wherein the means for timing expression is a promoter of which the activity is essentially limited to the certain stage of development. In a developing B cell, which, e.g., after immunization is maturing and/or differentiating, the expression of the gene of interest, when it is one of the polypeptide chains of an immunoglobulin, must not interfere (significantly) with the maturation and/or differentiation and it needs to be timed such that the resulting polypeptide can pair with its counterparts. Therefore, provided is a nucleic acid described herein wherein the certain stage starts at a stage immediately preceding or coinciding with the onset of the expression of light chain molecules by the cells at a certain stage of development into a mature B cell. This may be achieved by selecting a promoter which is active only during the suitable period. Such a promoter may be a CD19 promoter, the Ig-α promoter, the Ig-β promoter, the phc (all genes) promoter, the Vk promoter or analogues or homologues thereof.

In a specific embodiment, the promoter as disclosed above does not drive the expression of the gene of interest directly. Instead it drives the expression of a gene of which the product activates in trans the expression of the gene of interest. Such an activating gene may be a gene encoding a so-called Cre recombinase or Cre-like protein. The expression cassette for the gene of interest may, e.g., be provided with a sequence that inhibits expression of the gene of interest. The sequence can be removed by the action of the Cre recombinase, which is under control of the desired promoter (active during the proper stage of development). In this embodiment a set of expression cassettes is required.

Therefore, provided is a set of nucleic acids that are expression cassettes, wherein one nucleic acid comprises an expression cassette encoding a Cre-like protein under control of a promoter active during the desired stage of development of the host cell and the second nucleic acid comprises a sequence encoding a desired proteinaceous molecule under control of a constitutive promoter which can be activated by the action of a Cre-like protein. The activation is preferably achieved by removal of a stop sequence flanked by loxP sites. The Cre/lox system is described in detail in Rajewsky et al. (1996), *J. Clin. Invest.* 98:600-603, which is incorporated herein by reference. Such systems are reviewed in F. T. Wunderlich (2004), "Generation of inducible Cre systems for conditional gene inactivation in mice," Inauguraldissertation zur Erlangung des Doktorgrades der Mathematisch-Naturwissenschaftlichen Fakultät der Universitit zu Köln; on the World Wide Web at deposit.ddb.de/cgi-bin/dokserv?idn=97557230x&dok_var=d1&dok_ ext=pdf&filename=97557230x.pd, which is incorporated herein by reference.

Further provided is a transgenic non-human animal that has been provided with an expression cassette hereof, wherein the desired proteinaceous molecule is a polypeptide chain of an immunoglobulin. A preferred polypeptide chain is a light chain. A more preferred polypeptide is a germline or germline-like light chain. A most preferred polypeptide is encoded by the immunoglobulin kappa variable 1-39 (IGKV1-39, also known as O12) gene segment, preferably the rearranged germline kappa light chain IGKV1-39*01/IGKJ1*01 (nomenclature according to the IMGT database, at [worldwideweb].imgt.org).

In certain embodiments, the polypeptide chain is rendered essentially incapable of rearrangement and/or of excluded of any sequence modification such as normally operating on Ig during the process of B cell affinity maturation. Therefore, provided is a transgenic non-human animal that has been provided with an expression cassette described herein, wherein the rearrangement and/or sequence modifications are prevented by the absence of elements at least partially responsible for somatic hypermutation such as, for example, the MoEκi enhancer.

A preferred expression cassette described herein comprises means for prevention of silencing. In one embodiment, the means for prevention of silencing are means for insertion into a locus in the genome of the host cell that is resistant to silencing. The means for insertion are preferably means for homologous recombination into the site resistant to silencing. A preferred locus when the non-human animal is a mouse is the rosa-locus.

A further preferred expression cassette described herein comprises in 5'-3' direction: a $V_\kappa$ promoter, a mouse leader, a human V gene, optionally a MoEκi enhancer, a rat constant region ($C_\kappa$) and optionally a (truncated) MoEκ3' enhancer.

Yet a further preferred expression cassette described herein comprises in 5'-3' direction: a $V_\kappa$ promoter, a human leader, a human V gene, optionally a MoEκi enhancer, a rat constant region ($C_\kappa$) and optionally a (truncated) MoEκ3' enhancer.

Certain antibodies produced as described herein may be used in human therapeutics and diagnostics. Thus, provided is a method for producing a desired antibody comprising exposing a non-human mammal described herein to an antigen such that an antibody response is induced and isolating the antibodies specific for the antigen.

In certain embodiments, provided are methods for producing a desired antibody comprising exposing a non-human mammal described herein to an antigen such that an antibody response is induced and isolating cells producing such antibodies, culturing and optionally immortalizing the cells and harvesting the antibodies.

In certain embodiments, provided is a method for producing a desired antibody comprising exposing a non-human mammal described herein to an antigen such that an antibody response is induced and isolating a nucleic acid encoding at least part of such an antibody, inserting the nucleic acid or a copy or a derivative thereof in an expression cassette and expressing the antibody in a host cell.

The methods for producing antibodies from transgenic mice are known to a person skilled in the art. Particularly preferred are methods for production of mixtures of antibodies from one cell, whereby the nucleic acids encoding these antibodies have been derived from mice described herein.

These so-called oligoclonics are disclosed in WO04106375 and WO05068622, which are incorporated herein by reference.

Described herein are transgenic non-human mammals, preferably mice, capable of generating specific and high affinity hybrid mouse-human antibodies with preferably human immunoglobulin light chain variable (VL) regions in or near germline configuration and preferably murine immunoglobulin heavy chain variable (VH) regions that may have accumulated somatic mutations during the process of antigen-driven affinity maturation. It is envisaged that the murine VH regions of the hybrid antibodies may be subjected to humanization procedures to yield mAbs that have reduced immunogenicity when applied in humans based on germline or near-germline VL regions and murine VH regions that have been humanized.

In particular, we have shown that transgenic mice that harbor a DNA expression construct that encodes a rearranged human VL region under the control of cis-acting genetic elements that provide timely and regulated expression of the transgene on a significant proportion of B cells during B cell development, yet lack elements that direct the somatic hypermutation machinery to the transgene, are capable of generating specific and high affinity mouse-human hybrid antibodies with essentially unmutated L chains. It is shown that the rearranged human transgene is capable of pairing with a diversity of endogenous murine immunoglobulin H chains to form mouse-human hybrid immunoglobulins expressed on the surface of B cells and to sufficiently facilitate murine B cell development to obtain a sizeable and diverse peripheral B cell compartment.

In certain embodiments, the transgene expression construct harbors the coding sequences of a human rearranged L chain V region under the control of a human VL promoter to direct B-cell specific expression. In addition, the construct harbors the murine 3' Ck enhancer sequence for B cell specific and inducible and high level expression of the transgene. Furthermore, the construct is designed to lack regulatory elements that facilitate the recruitment of the somatic hypermutation machinery to the transgene, such as the intron enhancer and the 3' C-kappa enhancer.

In a related embodiment, the rearranged human VL gene is inserted in the murine Rosa26 locus by site-specific integration. The Rosa26 locus is useful in the context of the "targeted transgenesis" approach for efficient generation of transgenic organisms (such as mice) with a predictable transgene expression pattern.

In certain embodiments, the rearranged human VL region is selected for its capacity to pair with many different murine VH genes so as to ensure the generation of a population of B cells with a diverse VH gene repertoire. A method of obtaining such VL regions comprises amplifying a repertoire of rearranged VH genes from the B cells of mice and a repertoire of human rearranged germline VL regions from the B cells of humans and cloning them into phagemid display vectors to prepare diverse libraries of hybrid immunoglobulins in bacteria. By nucleotide sequence analysis of collections of unselected and antigen-selected VH/VL pairs, human germline VL genes that pair with many different murine VH genes are identified. A collection of human germline VL genes with this capacity is described.

In one embodiment, it is shown that upon immunization with antigen, the B cells are capable of mounting an immune response, leading to the generation of B cells that secrete hybrid antibodies with high specificity and affinity. The V regions encoding these antibodies are characterized by the human transgenic light chain that harbors no or very few mutations and a murine heavy chain that harbors a variable number of mutations introduced by the somatic hypermutation machinery.

In a related embodiment, strategies to obtain high affinity hybrid monoclonal antibodies from the transgenic mice by hybridoma and display technologies are contemplated as well as procedures to humanize the murine VH regions to obtain less immunogenic antibodies for application in humans.

In one embodiment, provided is an immunoglobulin L chain transgene construct comprising DNA sequences that encode a human immunoglobulin VL region in combination with a light chain constant region (CL) of an animal immunoglobulin protein, which sequences are operably linked to transcription regulatory sequences that, when integrated in a non-human transgenic animal, produce an Ig VL-CL polypeptide with a human VL region that is not or marginally subject to somatic hypermutation. The Ig VL is capable of pairing with rearranged VH-CH polypeptides that are generated during B cell development in the non-human transgenic animal, with the VH-CH polypeptides retaining the capacity to undergo somatic hypermutation upon stimulation. The CL region may be of any animal species and is generally capable of pairing with the CH regions of the non-human transgenic animal.

Also included is the use of a transgene construct as above in producing a transgenic non-human animal capable of the production of hybrid antibodies consisting of VL-CL polypeptides and VH-CH polypeptides in which the VL region is of human origin and the CL, VH and CH may be of any animal species, including human. Upon immunization, these transgenic animals are capable of generating high affinity antibodies encoded by somatically hypermutated VH genes and essentially non-mutated VL genes encoded by the transgene.

In another aspect, provided is a process for the production of a transgenic non-human animal capable of the production of hybrid antibodies in response to antigenic challenge, comprising functionally disrupting the endogenous immunoglobulin light chain locus and inserting into the animal genome a transgene construct of the invention.

Included is the use of animals obtainable by this process in the production of B cells that produce immunoglobulin having human VL light chain. In another aspect of the invention there is provided a process for the production of B cells that produce immunoglobulin having human VL and binding to a selected antigen, comprising challenging an animal obtainable by a process as above with the antigen and screening for B cells from the animal that bind the antigen. Further included is B cells obtainable by this process and hybridomas obtainable by immortalizing such B cells, e.g., hybridomas obtained by fusing B cells as above with myeloma cells. Also included is a process for producing monoclonal antibody comprising cultivating such a hybridoma. In yet a further aspect, provided is the use of the above B cells in producing a hybridoma or corresponding monoclonal antibody.

Described herein is a process for the production of immunoglobulin having human VL chain and binding to a selected antigen, comprising challenging an animal obtainable as above with the antigen and obtaining immunoglobulin there from.

In one strategy, as an individual step, a rearranged VL region encoded by human germline V and J gene segments and a light chain constant region of any animal species but preferably a murine constant region is introduced into the mouse germ line. The transgene DNA may be introduced into the pronuclei of fertilized oocytes or embryonic stem cells. The integration may be random or homologous depending on the particular strategy to be employed. For example, the VL transgene may be introduced by random insertion, resulting in mice that bear one or multiple copies of the transgene in the genome. Alternatively, the human VL transgene may be targeted to a specific genomic locus using site-specific recombination as described in the art.

In certain embodiments, the VL transgene is targeted to the murine ROSA26 locus which is a suitable integration site allowing strong and predictable expression of inserted transgenes (European Patent Office document EP 1,439,234 A1, the contents of which are incorporated herein by this reference). The targeting vector allows insertion of a single copy of a gene expression cassette, thus avoiding modulation of transgene expression by the arrangement of multiple copies. By choosing the autosomal Rosa26 locus as insertion site, the expression pattern of the inserted transgene in the non-human animal is predictable. Furthermore, random X inactivation and/or modulation by chromosomal position effects are avoided. This also eliminates the need to generate and analyze multiple transgenic strains for any given transgene. Finally, the Rosa26 targeting vector for the site-specific integration can be used for multiple gene expression cassettes. Thus, it may be envisaged that two or more different rearranged germline human VL regions are inserted into the Rosa26 locus to further increase the diversity of the repertoire of hybrid or human antibodies.

In another embodiment, a rearranged human VL region may be targeted to the murine Ig kappa or lambda light chain locus so as to functionally inactivate the endogenous locus or mice containing the rearranged human VL region may be bred with mice that lack functional kappa or lambda Ig loci or both. Thus, by using transformation, using repetitive steps or in combination with breeding, transgenic animals may be obtained which are able to produce antibodies harboring the human VL transgene in the substantial absence of endogenous host immunoglobulin light chains.

In one embodiment, a human VL transgene is selected for its capacity to pair with a substantial portion of murine VH regions to form a diverse repertoire of functional mouse-human hybrid antibodies expressed on the surface of B cells. By a substantial portion of murine VH regions is meant that the human VL pairs with at least with 0.1% of the murine VH regions generated during B cell development, more preferably with at least 1% and most preferably with at least 10%. Methods to identify human VL genes with this characteristic include randomly pairing a repertoire of human VL regions with a repertoire of murine VH regions, co-expression of VH and VL regions in appropriate eukaryotic or prokaryotic expression vectors and screening for human VL regions that pair with a substantial portion of murine VH regions. In one embodiment, phagemid vectors may be used to direct expression of mouse-human antibody fragments in bacterial cells or to the surface of filamentous phage and analysis of binding capacity of antibody fragments by methods known in the art.

In another embodiment, a human VL transgene is selected for its capacity to pair with a substantial portion of human VH regions to form a diverse repertoire of human antibodies expressed on the surface of B cells. By a substantial portion of human VH regions is meant that the human VL pairs with at least with 0.1% of the human VH regions generated during B cell development, more preferably with at least 1% and most preferably with at least 10%.

In the latter embodiment, the human VL transgenic mice are crossed with mice that harbor functional rearranged or non-rearranged human H chain immunoglobulin loci and functionally inactivated endogenous H chain Ig loci as described in the art. The functional inactivation of the two copies of each of the three host Ig loci (heavy chain, kappa and lambda light chain), where the host contains the human IgH and the rearranged human VL transgene would allow for the production of purely human antibody molecules without the production of host or host human chimeric antibodies. Such a host strain, by immunization with specific antigens, would respond by the production of mouse B-cells producing specific human antibodies, which B-cells are subsequently fused with mouse myeloma cells or are immortalized in any other manner for the continuous stable production of human monoclonal antibodies. Alternatively, the population of B cells is used as a source of VH regions that can be obtained by constructing cDNA libraries or by PCR amplification using primers for human VH regions as is known in the art.

A human rearranged VL gene is reconstructed in an appropriate eukaryotic or prokaryotic microorganism and the resulting DNA fragments can be introduced into pronuclei of fertilized mouse oocytes or embryonic stem cells. Various constructs that direct B cell specific expression of VL transgenes have been described in the art and have the following general format: a leader sequence and relevant upstream sequences to direct B cell specific expression of the transgene, a coding sequence of a human VL transgene, an enhancer sequence that directs B cell specific and high level expression of the transgene and a murine constant region gene. In a preferred format, the enhancer is the C-kappa 3' enhancer because it directs high level expression in B-lineage cells, but does not recruit somatic hypermutation when used in transgene constructs.

In one embodiment, animals, preferably mice, comprising one or multiple copies of the transgene in the genome are isolated and analyzed for stable expression. Animals are selected that show stable expression of the transgene over longer periods of time, preferably in B-cells. If required, different animal lines comprising independent insertions of one or multiple copies of the transgene, preferably on different chromosomes, are crossed to obtain animals with different insertions of one or multiple copies of the transgene to increase expression of the transgene in animals, preferably in B-cells.

Further provided is progeny of a transgenic non-human animal described herein, the progeny comprising, at least in its B-cell lineage, a heavy- or light chain encoding sequence together with a means that renders the sequence resistant to DNA rearrangements and/or somatic hypermutations.

Further provided is progeny of a transgenic non-human animal described herein, the progeny comprising an expression cassette for the expression of a desired proteinaceous molecule in cells during a certain stage of development in cells developing into mature B cells.

In addition, provided is a cell that is isolated from a transgenic non-human animal described herein, the cell comprising a heavy- or light chain encoding sequence together with a means that renders the sequence resistant to DNA rearrangements and/or somatic hypermutations. In addition, provided is a cell that is isolated from a transgenic non-human animal described herein, the cell comprising an expression cassette for the expression of a desired proteinaceous molecule in cells during a certain stage of development in cells developing into mature B cells. A cell described herein, preferably an antibody-producing B-cell or a cell that is capable of differentiating or maturating into an antibody-producing B-cell, can be used for in vitro production of antibodies, as is known to the skilled person, for example, from Gascan et al. 1991, *J. Exp. Med.* 173:747-750. Methods for immortalization of a cell described herein are known in the art and include the generation of hybridomas, for example, by fusion with a myeloma cell, transformation with Epstein Barr Virus; expression of the signal transducer of activation and transcription (STAT), activation via CD40 and IL4 receptor signaling, and/or expression of Bcl6 (Shvarts et al. 2002, *Genes Dev.* 16: 681-686).

In a separate step, the mouse endogenous Kappa and Lambda light chain loci are rendered essentially non-functional such that at least the majority of B cells in the transgenic mice bear Ig receptors that contain the transgenic human VL region. Inactivation of the endogenous mouse immunoglobulin loci is achieved by targeted disruption of the appropriate loci by homologous recombination in mouse embryonic stem cells. The targeted disruption comprises alteration of the genomic sequence such that substantially no functional endogenous mouse immunoglobulin Kappa and/or Lambda light chain is produced. The term "substantially no functional endogenous mouse immunoglobulin" indicates that the endogenous Kappa and/or Lambda light chain loci are functionally silenced such that the level of functional protein expression of the endogenous Kappa and/or Lambda light chain loci, preferably the endogenous Kappa light chain locus, is reduced to about 20% of the level of expression in a reference mouse, more preferred to about 10%, more preferred to about 5%, more preferred to about 2% and more preferred to about 1%. In a most preferred embodiment, the level of functional protein expression of the endogenous Kappa and/or Lambda light chain loci is reduced to 0%. The level of functional protein expression can be determined by means known to the skilled person, including western blotting and pairing with a mouse heavy chain. The reference mouse is a mouse in which the endogenous Kappa and/or Lambda light chain loci is not disrupted. The alteration comprises mutation and/or deletion of gene sequences that are required for functional expression of the endogenous immunoglobulin genes. Alternatively, the alteration comprises insertion of a nucleic acid into the endogenous mouse immunoglobulin Kappa and/or Lambda light chain loci such that the functional expression of the endogenous immunoglobulin genes is reduced. In one embodiment, the nucleic acid comprises a silencing element resulting in transcriptional silencing of the endogenous immunoglobulin gene. In a further embodiment, or in addition, the nucleic acid comprises a sequence that disrupts splicing and/or translation of the endogenous immunoglobulin gene, for example, by introducing an exon that renders a frame shift in the coding sequence, or that comprises a premature stop codon. In each case chimeric animals are generated which are derived in part from the modified embryonic stem cells and are capable of transmitting the genetic modifications through the germ line. The mating of mouse strains with human immunoglobulin loci to strains with inactivated mouse loci yields animals which produce antibodies comprising essentially only human light chains.

A construct for homologous recombination is prepared by means known in the art and any undesirable sequences are removed, e.g., procaryotic sequences. Any convenient technique for introducing a construct for homologous recombination into a target cell may be employed. These techniques include spheroplast fusion, lipofection, electroporation, calcium phosphate-mediated DNA transfer or direct microinjection. After transformation or transfection of the target cells, target cells are selected by means of positive and/or negative markers, for example, by neomycin resistance and/or acyclovir and/or gancyclovir resistance. Those cells which show the desired phenotype may then be further analyzed by restriction analysis, electrophoresis, Southern analysis, PCR, or the like. By identifying fragments which show the presence of the lesion(s) at the target locus, cells in which homologous recombination has occurred to inactivate a copy of the target locus are identified.

Furthermore, it is shown that upon immunization, the murine and human VH regions in the afore-mentioned transgenic mice but not the VL regions are capable of undergoing somatic hypermutations to generate high affinity antibodies. Advantageously, these antibodies encoded by germline VL regions are predicted to contribute to lower immunogenicity when applied in humans and result in more stable antibodies that are less prone to aggregation and thus safer for therapeutic use in humans.

MAbs derived from the afore-mentioned non-human transgenic animals or cells all share the same identical human VL regions. It has been described that mAbs that share the same identical VL region may be co-expressed in a single clonal cell for the production of mixtures of recombinant antibodies with functional binding sites (see the incorporated WO04106375 and WO05068622). Thus, provided is a platform for the generation of specific and high affinity mAbs that constitute the basis for mixtures of mAbs produced by clonal cells.

It is preferred that mAbs derived from the afore-mentioned non-human transgenic animals or cells are directed against cellular targets. Preferred targets are human surface-expressed or soluble proteins or carbohydrate molecules. Further preferred targets are surface-expressed proteins or carbohydrate molecules that are expressed on the surface of bacteria, viruses, and other pathogens, especially of humans.

More specifically, preferred targets include cytokines and chemokines, including but not limited to InterLeukin 1beta (IL1beta), IL2, IL4, IL5, IL7, IL8, IL12, IL13, IL15, IL18, IL21, IL23 and chemokines such as, for example, CXC chemokines, CC chemokines, C chemokines (or γ chemokines) such as XCL1 (lymphotactin-α) and XCL2 (lymphotactin-β), and CX3C chemokines. Further included as preferred targets are receptor molecules of the cytokines and chemokines, including type I cytokine receptors such as, for example, the IL-2 receptor, type II cytokine receptors such as, for example, interferon receptors, immunoglobulin (Ig) superfamily receptors, tumor necrosis factor receptor family including receptors for CD40, CD27 and CD30, serine/threonine-protein kinase receptors such as TGF beta receptors, G-protein coupled receptors such as CXCR1-CXCR7, and tyrosine kinase receptors such as fibroblast growth factor receptor (FGFR) family members, EGF receptor family members including erbB1 (EGF-R; HER1), erbB2, (HER2), erbB3 (HER3), and erbB4 (HER4), insulin receptor family members including IGF-R1 and IGF-RII, PDGF receptor family members, Hepatocyte growth factor receptor family members including c-Met (HGF-R), Trk receptor family members, AXL receptor family members, LTK receptor family members, TIE receptor family members, ROR receptor family members, DDR receptor family members, KLG receptor family members, RYK receptor family members, MuSK receptor family members, and vascular endothelial growth factor receptor (VEGFR) family members.

Further preferred targets are targets that are over-expressed or selectively expressed in tumors such as, for example, VEGF, CD20, CD38, CD33, CEA, EpCAM, PSMA, CD54, Lewis Y, CD52, CD40, CD22, CD51/CD61, CD74, MUC-1, CD38, CD19, CD262 (TRAIL-R2), RANKL, CTLA4, and CD30; targets that are involved in chronic inflammation such as, for example, CD25, CD11a, TNF, CD4, CD80, CD23, CD3, CD14, IFNgamma, CD40L, CD50, CD122, TGFbeta and TGFalpha.

Preferred surface-expressed proteins or carbohydrate molecules that are expressed on the surface of bacteria, viruses, and other parasitic pathogens, especially of humans, include surface markers of influenza A and B viruses such as hemagglutinin (HA) and neuraminidase (NA), filoviruses such as Ebola virus, rabies, measles, rubella, mumps, flaviviruses such as Dengue virus types 1-4, tick-borne encephalitis virus, West Nile virus, Japanese encephalitis virus, and Yellow fever virus, Paramyxoviruses including Paramyxovirus such as Parainfluenza 1, 3, Rubulavirus such as Mumpsvirus and Parainfluenza 2, 4, Morbillivirus, and Pneumovirus such as Respiratory syncytial virus, Vaccinia, small pox, coronaviruses, including Severe Acute Respiratory Syndrome (SARS) virus, hepatitis virus A, B and C, Human Immunodeficiency Virus, Herpes viruses, including cytomegalovirus, Epstein Barr virus, Herpes simplex virus, and Varicella zoster virus, parvoviruses such as, for example, B19; *Legionella pneumophila; Listeria monocytogenes; Campylobacter jejuni; Staphylococcus aureus; E. coli* O157:H7; *Borrelia burgdorferi; Helicobacter pylori; Ehrlichia chaffeensis; Clostridium difficile; Vibrio cholera; Salmonella enterica* Serotype *Typhimurium; Bartonella henselae; Streptococcus pyogenes* (Group A Strep); *Streptococcus agalactiae* (Group B Strep); Multiple drug resistant *S. aureus* (e.g., MRSA); *Chlamydia pneumoniae; Clostridium botulinum; Vibrio vulnificus; Parachlamydia pneumonia; Corynebacterium amycolatum; Klebsiella pneumonia*; Linezolid-resistant enterococci (*E. faecalis* and *E. faecium*); and Multiple drug resistant *Acinetobacter baumannii.*

Most preferred targets are IL-6 and its receptor, IL-6Ralpha, glycoprotein-denominated gp130, RSV, especially the surface proteins F, G and SH and non-structural proteins such as N and M, and receptor tyrosine kinases, in particular erbB1 (EGF-R; HER1), erbB2, (HER2), erbB3 (HER3), erbB4 (HER4), IGF-R1 and IGF-RII, c-Met (HGF-R).

Therefore, provided is a platform for the generation of specific and high affinity mAbs against the above mentioned targets that constitute the basis for mixtures of mAbs produced by clonal cells. In certain embodiments, the specific and high affinity mAbs comprise mAbs that are directed against different epitopes on at least one of the targets. In a further preferred embodiment, the specific and high affinity mAbs comprise mAbs that are directed against different targets, such as, for example, one or more members of the EGF-receptor family, including erbB1 (EGF-R; HER1), erbB2, (HER2), erbB3 (HER3) and erbB4 (HER4).

Unless otherwise defined, scientific and technical terms used in connection with the present invention shall have the meanings that are commonly understood by those of ordinary skill in the art. Further, unless otherwise required by context, singular terms shall include pluralities and plural terms shall include the singular. Generally, nomenclatures utilized in connection with, and techniques of, cell and tissue culture, molecular biology, and protein and oligo- or polynucleotide chemistry and hybridization described herein are those well known and commonly used in the art. Standard techniques are used for recombinant DNA, oligonucleotide synthesis, and tissue culture and transformation (e.g., electroporation, lipofection). Enzymatic reactions and purification techniques are performed according to manufacturer's specifications or as commonly accomplished in the art or as described herein. The foregoing techniques and procedures are generally performed according to conventional methods well known in the art and as described in various general and more specific references that are cited and discussed throughout the present specification. See, e.g., Sambrook et al., *Molecular Cloning: A Laboratory Manual* (3rd edition, Cold Spring Harbor Laboratory Press, Cold Spring Harbor, N.Y. (2001)), which is incorporated herein by reference. The nomenclatures utilized in connection with, and the laboratory procedures and techniques of, analytical chemistry, synthetic organic chemistry, and medicinal and pharmaceutical chemistry described herein are those well known and commonly used in the art. Standard techniques are used for chemical syntheses, chemical analyses, pharmaceutical preparation, formulation, and delivery, and treatment of patients.

DESCRIPTION OF THE DRAWINGS

The patent or application file contains at least one drawing executed in color. Copies of this patent or patent application publication with color drawing(s) will be provided by the Office upon request and payment of the necessary fee.

FIG. 12: Overview of the sequences used or referred to in this application: Human germline IGKV1-39/J DNA (SEQ ID NO:84); human germline IGKV1-39/J Protein (SEQ ID NO:85); human germline IGLV2-14/J DNA (SEQ ID NO:86); human germline IGLV2-14/J Protein (SEQ ID NO:87); Rat IGCK allele a DNA (SEQ ID NO:88); Rat IGCK allele a protein (SEQ ID NO:89); IGKV1-39/J-Ck (SEQ ID NO:90); IGLV2-14/J-Ck (SEQ ID NO:91); VkP-IGKV1-39/J-Ck (SEQ ID NO:92); VkP-IGKV1-39/J-Ck-Δ1 (SEQ ID NO:93); VkP-IGKV1-39/J-Ck-Δ2 (SEQ ID NO:94); VkP-IGLV2-14/J-Ck (SEQ ID NO:95); pSELECT-IGKV1-39/J-Ck (SEQ ID NO:96); pSelect-IGLV2-14/J-Ck (SEQ ID NO:97); MV1043 (SEQ ID NO:98); and MV1057 (SEQ ID NO:99).

FIGS. 13A-C: Generation of Rosa26-IgVk1-39 KI allele. FIG. 13A Schematic drawing of the pCAGGS-IgVK1-39 targeting vector. FIG. 13B Nucleotide sequence of the pCAGGS-IgVK1-39 targeting vector (SEQ ID NO:100). FIG. 13C Targeting strategy.

FIG. 14A Southern blot analysis of genomic DNA of ES clones comprising an insertion of the pCAGGS-IgVK1-39 targeting vector. Genomic DNA of four independent clones was digested with AseI and probed with 5e1 indicating the 5'-border of the targeting vector. All clones comprise a correct insertion of the targeting vector at the 5' end. FIG. 14B Southern blot analysis of genomic DNA of ES clones comprising an insertion of the pCAGGS-IgVK1-39 targeting vector. Genomic DNA of four independent clones was digested with MscI and probed with 3e1 indicating the 3'-border of the targeting vector. All clones comprise a correct insertion of the targeting vector at the 3' end. FIG. 14C Southern blot analysis of genomic DNA of ES clones comprising an insertion of the pCAGGS-IgVK1-39 targeting vector. Genomic DNA of four independent clones was digested with BamHI and probed with an internal Neo probe indicating the 5'-border of the targeting vector. All clones comprise a correct, single insertion of the targeting vector.

FIGS. 15A-C: Generation of Rosa26-IgV12-14 KI allele. FIG. 15A Schematic drawing of the pCAGGS-IgVL2-14 targeting vector. FIG. 15B Nucleotide sequence of the pCAGGS-IgVL2-14 targeting vector containing the CAGGS expression insert (SEQ ID NO:101) based on the rearranged germline IGLV2-14/J V lambda region (IGLV2-14/J-Ck). FIG. 15C Targeting strategy.

FIG. 16A displays the binding strength for DRB1 allotypes, while FIG. 16C displays the binding strength for DRB3/4/5, DQ and DP allotypes. The values in the figure represent dissociation constants (Kds) and are plotted on a logarithmic scale in the range 0.01 μM-0.1 μM (very strong binders may have run off the plot). For medium binding peptides, qualitative values are given only, and weak and non-binders are not shown. Values are plotted on the first residue of the peptide in the target sequence (the peptide itself extends by another nine residues). Importantly, only the strongest binding receptor for each peptide is shown: cross-reacting allotypes with lower affinity are not visible in this plot. The strongest binding receptor is indicated by its serotypic name. Finally, any germline-filtered peptides are plotted with a lighter color in the epitope map (in this case, no non-self epitopes were found). FIG. 16B shows the HLA binding promiscuity for every decameric peptide (Y-axis: the number of HLA allotypes recognizing critical epitopes in each of the peptides starting at the indicated residue shown on the X-axis). The promiscuity is measured as the number of allotypes out of the total of 47 for which the peptide is a critical binder. White columns refer to self-peptides, and black columns (absent here) to non-self peptides.

FIG. 18A Targeting strategy. FIG. 18B Schematic drawing of the pIgKappa targeting vector.

FIG. 19A First step of the targeting strategy. FIG. 19B Second step of the targeting strategy.

FIG. 20A pVkP-O12 (VkP-IGKV1-39/J-Ck); FIG. 20B pVkP-O12-del1 (VkP-IGKV1-39/J-Ck-Δ1); FIG. 20C pVkP-O12-del2 (VkP-IGKV1-39/J-Ck-Δ2).

FIG. 21A VkP-O12 (VkP-IGKV1-39/J-Ck); FIG. 21B VkP-O12-del1 (VkP-IGKV1-39/J-Ck-Δ1); FIG. 21C VkP-O12-del2 (VkP-IGKV1-39/J-Ck-Δ2).

FIG. 23: Lack of transgenic human Vk1 light chain expression in non-B cell populations of the spleen.

FIG. 26A Gating of bone marrow cells. FIG. 26B Histograms of transgene expression with overlay from one WT control.

FIG. 28: Parameters of stability for stable clones containing the germline IGKV1-39 gene.

FIG. 29A-B: Antibody mixtures used for staining of lymphocyte populations. BM=bone marrow, PC=peritoneal cavity, PP=Peyer's patches.

DETAILED DESCRIPTION OF THE INVENTION

Examples

Figure 1:
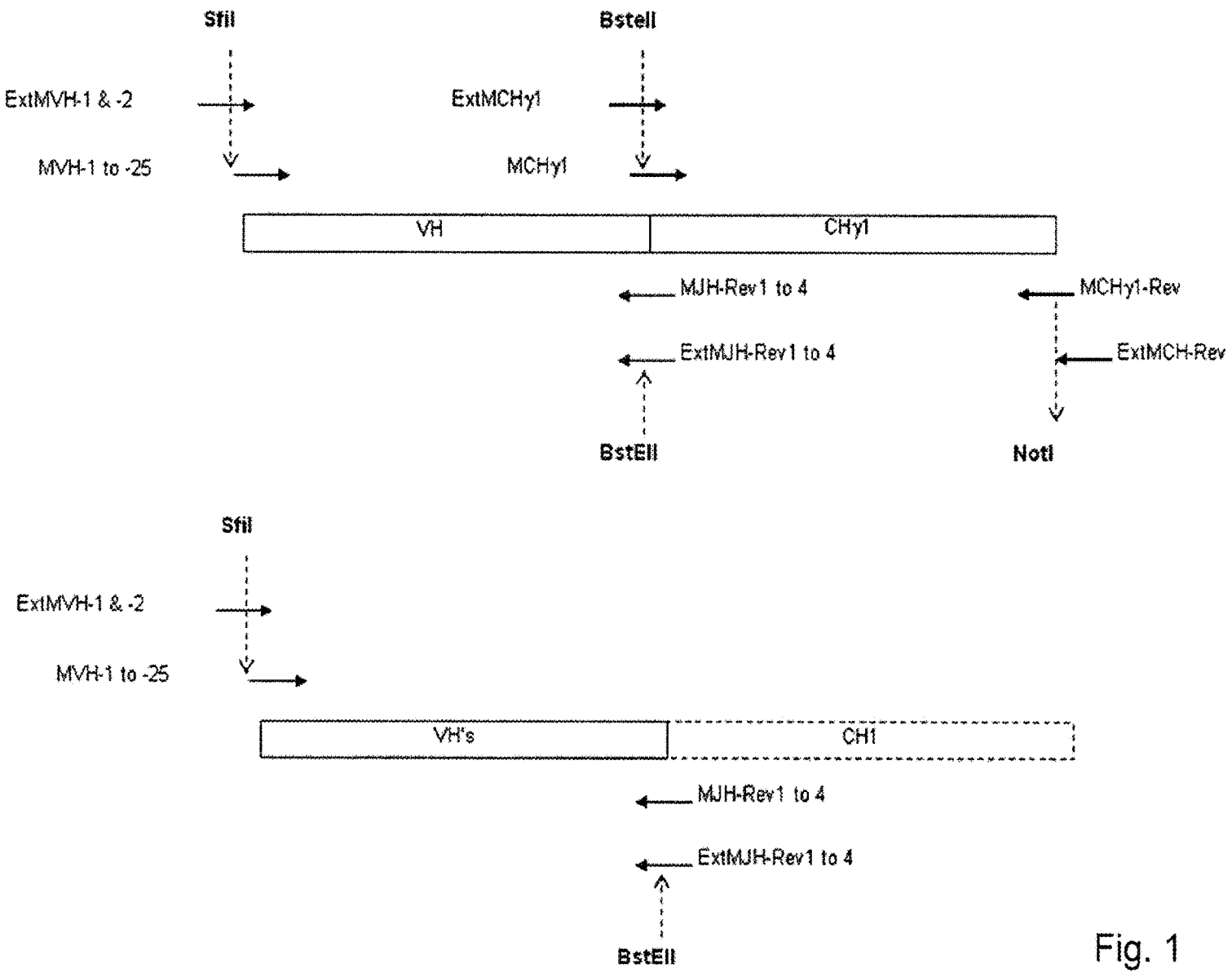
FIG. 1: A topology map of the annealing locations of mouse specific VH primers and the position of required restriction sites that are introduced by overhanging sequences at the 3' end of primers.

Example 1: Human Light Chain V-Gene Clones

This example describes the rationale behind the choice of two human light chain V-genes, one gene of the kappa type and one gene of the lambda type, that are used as a proof of concept for light chain expressing transgenic mice. De Wildt et al. 1999 (de Wildt et al. (1999), *J. Mol. Biol.* 285(3):895) analyzed the expression of human light chains in peripheral IgG-positive B-cells. Based on these data, IGKV1-39 (O12) and IGLV2-14 (2a2) were chosen as light chains as they were well represented in the B-cell repertoire. The J-segment sequence of the light chains has been chosen based upon sequences as presented in GenBank ABA26122 for IGKV1-39 (B. J. Rabquer, S. L. Smithson, A. K. Shriner and M. A. J. Westerink) and GenBank AAF20450 for IGLV2-14 (O. Ignatovich, I. M. Tomlinson, A. V. Popov, M. Bruggemann and G. J. Winter, *J. Mol. Biol.* 294 (2):457-465 (1999)).

All framework segments are converted into germline amino acid sequences to provide the lowest immunogenicity possible in potential clinical applications.

Example 2: Obtaining Mouse Heavy Chain V-Genes that Pair with Human IGKV1-39 Gene Segment to Form Functional Antibody Binding Sites This example describes the identification of mouse heavy chain V-genes that are capable of pairing with a single, rearranged human germline IGKV1-39/J region. A spleen VH repertoire from mice that were immunized with tetanus toxoid was cloned in a phage display Fab vector with a single human IGKV1-39-C kappa light chain and subjected to panning against tetanus toxoid. Clones obtained after a single round of panning were analyzed for their binding specificity. The murine VH genes encoding tetanus toxoid-specific Fab fragments were subjected to sequence analysis to identify unique clones and assign VH, DH and JH utilization.

Many of the protocols described here are standard protocols for the construction of phage display libraries and the panning of phages for binding to an antigen of interest and described in Antibody Phage Display: Methods and Protocols (editor(s): Philippa M. O'Brien and Robert Aitken).

Immunizations

BALB/c mice received one immunization with tetanus toxoid and were boosted after six weeks with tetanus toxoid.

Splenocyte Isolation

Preparation of spleen cell suspension. After dissection, the spleen was washed with PBS and transferred to a 60 mm Petri dish with 20 ml PBS. A syringe capped with 20 ml PBS and a G20 needle was used to repeatedly flush the spleen. After washing the flushed cells with PBS, the cells were carefully brought into suspension using 20 ml PBS and left on a bench for five minutes to separate the splenocytes from the debris and cell clusters. The splenocytes suspension was transferred on top of a Ficoll-Paque™ PLUS-filled tube and processed according to the manufacturer's procedures for lymphocyte isolation (Amersham Biosciences).

RNA Isolation and cDNA Synthesis

After isolation and pelleting of lymphocytes, the cells were suspended in TRIzol LS Reagent (Invitrogen) for the isolation of total RNA according to the accompanying manufacturer's protocol and subjected to reverse transcription reaction using 1 microgram of RNA, Superscript III RT in combination with dT20 according to manufacturer's procedures (Invitrogen).

PCR Amplification of cDNA

The cDNA was amplified in a PCR reaction using primer combinations that allow the amplification of approximately 110 different murine V-genes belonging to 15 VH families (Table 1; RefSeq NG_005838; Thiebe et al. 1999, *European Journal of Immunology* 29:2072-2081). In the first round, primer combinations that bind to the 5' end of the V-genes and 3' end of the J regions were used. In the second round, PCR products that were generated with the MJH-Rev2 primer were amplified in order to introduce modifications in the 3' region to enable efficient cloning of the products. In the last round of amplification, all PCR products were amplified using primers that introduce a SfiI restriction site at the 5' end and a BstEII restriction site at the 3' end (see FIGS. 1 and 2, and Table 1).

Figure 2:
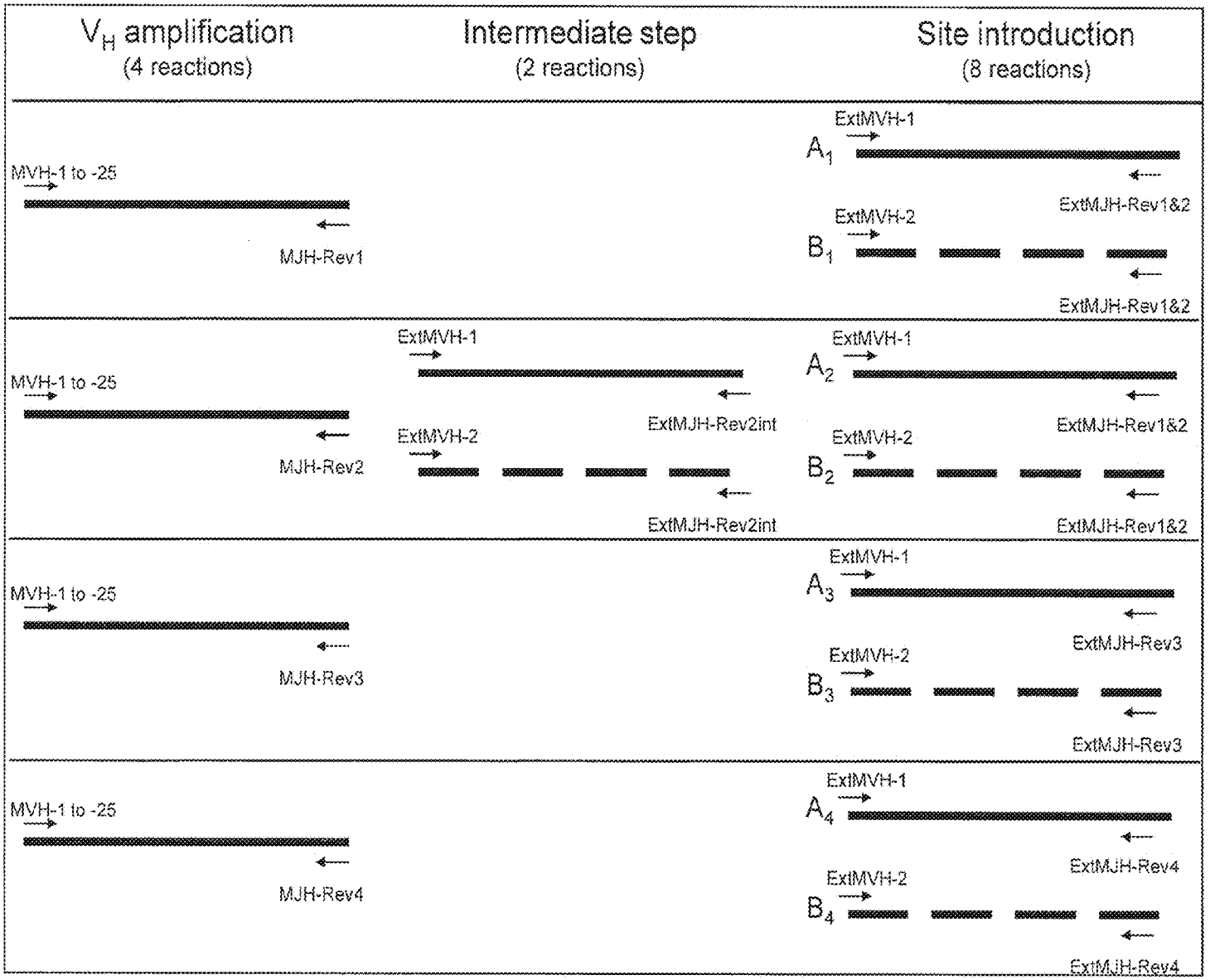
FIG. 2: PCR amplification steps (Amplification, Intermediate and Site introduction). The location and names of the mouse VH amplification primers (and mixtures of primers) are indicated per step.

Reaction conditions for 1st round PCR: four different reactions combining all 25 forward primers (MVH1 to MVH25, Table 1 and FIG. 2) and one reverse primer per reaction (MJH-Rev1, MJH-Rev2, MJH-Rev3 or MJH-Rev4; see Table 1 and FIG. 2). Fifty microliters PCR volumes were composed of 2 microliters cDNA (from RT reactions), 10 microliters 5* Phusion polymerase HF buffer, 40 nM of each of the 25 forward primers (total concentration of 1 micromolar), 1 micromolar reverse primer, 1 microliter 10 mM dNTP stock, 1.25 unit Phusion polymerase and sterile MQ water. The thermocycler program consisted of a touch down program: one cycle 98° C. for 30 seconds, 30 cycles 98° C. for ten seconds, 58° C. decreasing 0.2° C. per cycle ten seconds, 72° C. 20 seconds and one cycle 72° C. for three minutes. The second round PCR program was set up only for the products of the first PCR that contain the MJH-Rev2 primer: two different reactions combining either the ExtMVH-1 or ExtMVH-2 primers (Table 1 and FIG. 2) in combination with the reverse primer ExtMJH-Rev2int (Table 1 and FIG. 2). Fifty microliters PCR volumes were composed of 50 ng PCR product (from first PCR round), 10 microliters 5* Phusion polymerase HF buffer, 500 nM of each forward primer, 1 micromolar reverse primer, 1 microliter 10 mM dNTP stock, 1.25 unit Phusion polymerase and sterile MQ water. The thermocycler program consisted of a touch down program followed by a regular amplification step: one cycle 98° C. for 30 seconds, ten cycles 98° C. for ten seconds, 65° C. decreasing 1.5° C. per cycle ten seconds, 72° C. 20 seconds, ten cycles 98° C. for ten seconds, 55° C. ten seconds, 72° C. 20 seconds and one cycle 72° C. for three minutes. The third round PCR program was setup as described in FIG. 2. Fifty microliters PCR volumes were composed of 50 ng PCR product (from earlier PCR rounds, FIG. 2), 10 microliters 5* Phusion polymerase HF buffer, 1 micromolar forward primer (Table 1 and FIG. 2), 1 micromolar reverse primer, 1 microliter 10 mM dNTP stock, 1.25 unit Phusion polymerase and sterile MQ water. The program consists of a touch down program followed by a regular amplification step: one cycle 98° C. for 30 seconds, ten cycles 98° C. for ten seconds, 65° C. decreasing 1.5° C. per cycle ten seconds, 72° C. 20 seconds, ten cycles 98° C. for ten seconds, 55° C. ten seconds, 72° C. 20 seconds and one cycle 72° C. for three minutes. After PCR amplifications, all PCR products were gel purified using Qiaex II according to the manufacturer's protocols.

Restriction Enzyme Digestions

Figure 3:
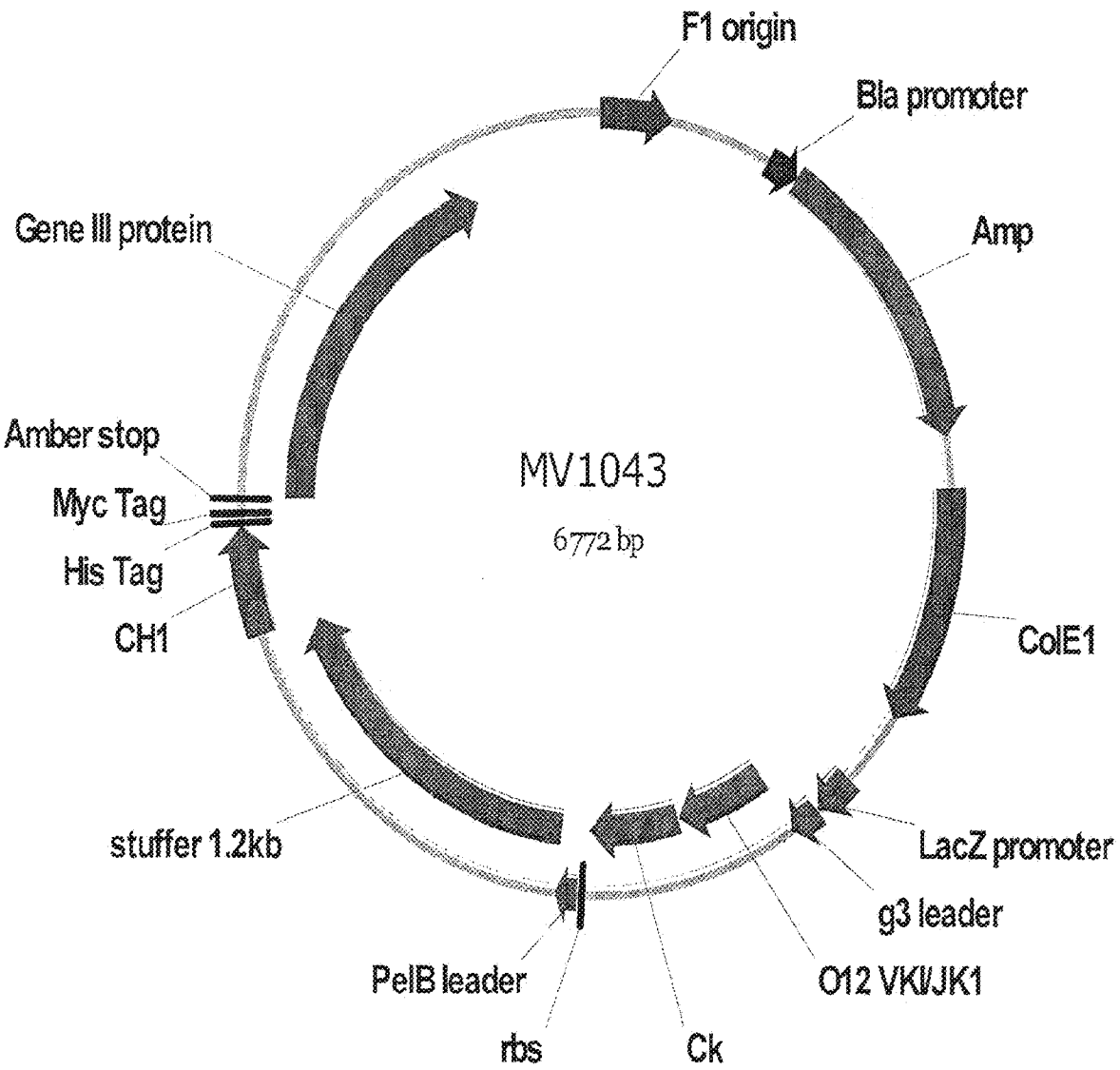
FIG. 3: Topology of the MV1043 vector. This vector is used for the cloning of human or murine VH fragments. O12 (IGKV1-39) is indicated as the VL gene. Products of this vector in combination with helper phages in *E. coli* cells allow the generation of phages that display Fab fragments on the surface of the phage particles as a fusion product to the g3 protein and presence of the vector in the phage as the genetic content (F1 ORI).

Purified products were digested with BstEII and SfiI in two steps. First 1 microgram of DNA was digested in 100 microliters reactions consisting of 10 microliters of 10* NEB buffer 3 (New England Biolabs), 1 microliter 100* BSA, 12.5 unit BstEII and sterile water for six hours at 60° C. in a stove. The products were purified using Qiaquick PCR Purification kit from Qiagen according to the manual instructions and eluted in 40 microliters water. Next all products were further digested with SfiI in 100 microliters reactions consisting of 10 microliters of 10* NEB buffer 2 (New England Biolabs), 1 microliter 100* BSA, 12.5 unit SfiI and sterile water for 12 hours at 50° C. in a stove. The digested fragments were purified by Qiaquick Gel Extraction kit following gel separation on a 20 cm 1.5% agarose TBE plus ethidium bromide gel at 80 V. 100 micrograms of the acceptor vector (MV1043, FIGS. 3 and 12) was digested with 50 units Eco91I in 600 microliters under standard conditions (Tango buffer) and next purified on a 0.9% agarose gel. After a second digestion step under prescribed conditions with 400 units SfiI in 500 microliters for 12 hours, 100 units BsrGI were added for three hours at 50° C.

Ligations

Each PCR product was ligated separately according to the following scheme: 70 ng digested PCR products, 300 ng digested acceptor vector, 100 units T4 Ligase (NEB), 1* ligase buffer in 30 microliters for 16 hours at 12° C. The ligation reactions were purified with phenol/chloroform/isoamyl alcohol extractions followed by glycogen precipitations (Sigma Aldrich #G1767) according to the manufacturer's protocol and finally dissolved in 25 microliters sterile water.

Transformations and Library Storage

The purified ligation products were transformed by electroporation using 1200 microliters TG1 electrocompetent bacteria (Stratagene #200123) per ligation batch and plated on LB carbenicillin plates containing 4% glucose. Libraries were harvested by scraping the bacteria in 50 ml LB carbenicillin. After centrifugation at 2000 g for 20 minutes at 4° C., the bacterial pellets were resuspended carefully in 2 ml ice cold 2*TY/30% glycerol on ice water and frozen on dry ice/ethanol before storage at −80° C.

Library Amplification

Libraries were grown and harvested according to procedures as described by Kramer et al. 2003 (Kramer et al. (2003), *Nucleic Acids Res.* 31(11):e59) using VCSM13 (Stratagene) as helper phage strain.

Selection of Phages on Coated Immunotubes

Tetanus toxoid was dissolved in PBS in a concentration of 2 μg/ml and coated to MAXISORP™ Nunc-Immuno Tube (Nunc 444474) overnight at 4° C. After discarding the coating solution, the tubes were blocked with 2% skim milk (ELK) in PBS (blocking buffer) for one hour at RT. In parallel, 0.5 ml of the phage library was mixed with 1 ml blocking buffer and incubated for 20 minutes at room temperature. After blocking the phages, the phage solution was added to the tetanus toxoid-coated tubes and incubated for two hours at RT on a slowly rotating platform to allow binding. Next, the tubes were washed ten times with PBS/0.05% TWEEN™-20 detergent followed by phage elution by an incubation with 1 ml 50 mM glycine-HCl pH 2.2 ten minutes at RT on rotating wheel and directly followed by neutralization of the harvested eluent with 0.5 ml 1 M Tris-HCl pH 7.5.

Harvesting Phage Clones

Five ml XL1-Blue MRF (Stratagene) culture at O.D. 0.4 was added to the harvested phage solution and incubated for 30 minutes at 37° C. without shaking to allow infection of the phages. Bacteria were plated on Carbenicillin/Tetracycline 4% glucose 2*TY plates and grown overnight at 37° C.

Phage Production

Phages were grown and processed as described by Kramer et al. 2003 (Kramer et al. 2003, *Nucleic Acids Res.* 31(11):e59) using VCSM13 as helper phage strain.

Phage ELISA

ELISA plates were coated with 100 microliters tetanus toxoid per well at a concentration of 2 micrograms/ml in PBS overnight at 4° C. Plates coated with 100 microliters thyroglobulin at a concentration of 2 micrograms/ml in PBS were used as a negative control. Wells were emptied, dried by tapping on a paper towel, filled completely with PBS-4% skimmed milk (ELK) and incubated for one hour at room temperature to block the wells. After discarding the block solution, phage minipreps pre-mixed with 50 μl blocking solution were added and incubated for one hour at RT. Next five washing steps with PBS-0.05% Tween-20 removed unbound phages. Bound phages were detected by incubating the wells with 100 microliters anti-M13-HRP antibody conjugate (diluted 1/5000 in blocking buffer) for one hour at room temperature. Free antibody was removed by repeating the washing steps as described above, followed by TMB substrate incubation until color development was visible. The reaction was stopped by adding 100 microliters of 2 M $H_2SO_4$ per well and analyzed on an ELISA reader at 450 nm emission wavelength (Table 2). Higher numbers indicate stronger signals and thus higher incidence of specific binding of the phage-Fab complex.

Sequencing

Clones that gave signals at least three times above the background signal (Table 2) were propagated, used for DNA miniprep procedures (see procedures Qiagen miniPrep manual) and subjected to nucleotide sequence analysis. Sequencing was performed according to the Big Dye 1.1 kit accompanying manual (Applied Biosystems) using a reverse primer (CH1_Rev1, Table 1) recognizing a 5' sequence of the CH1 region of the human IgG1 heavy chain (present in the Fab display vector MV1043, FIGS. 3 and 12). Mouse VH sequences of 28 tetanus toxoid binding clones are depicted in Table 3. The results show that the selected murine VH genes belong to different gene families, and different individual members from these gene families are able to pair with the rearranged human IGKV1-39/J VH region to form functional tetanus toxoid-specific antibody binding sites. From the sequence analyses, it was concluded that the murine VH regions utilize a diversity of DH and JH gene segments.

Example 3: Silencing of the Mouse Kappa Light Chain Locus

This example describes the silencing of the mouse endogenous kappa light chain locus. The endogenous kappa locus is modified by homologous recombination in ES cells, followed by the introduction of genetically modified ES cells in mouse embryos to obtain genetically adapted offspring.

Figure 4:
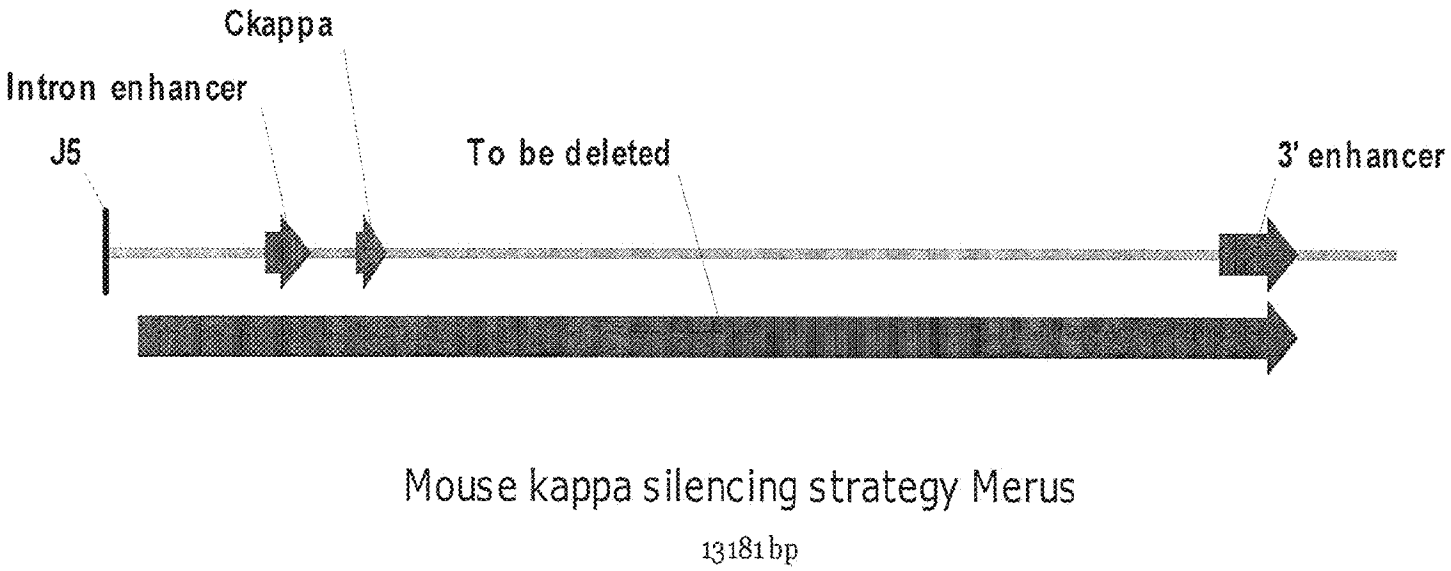
FIG. 4: The topology of the mouse Ckappa locus downstream of the J-segments. Both enhancers and Ckappa region are indicated. The lower arrow indicates the region that is removed in order to silence the locus.
Figure 18A:
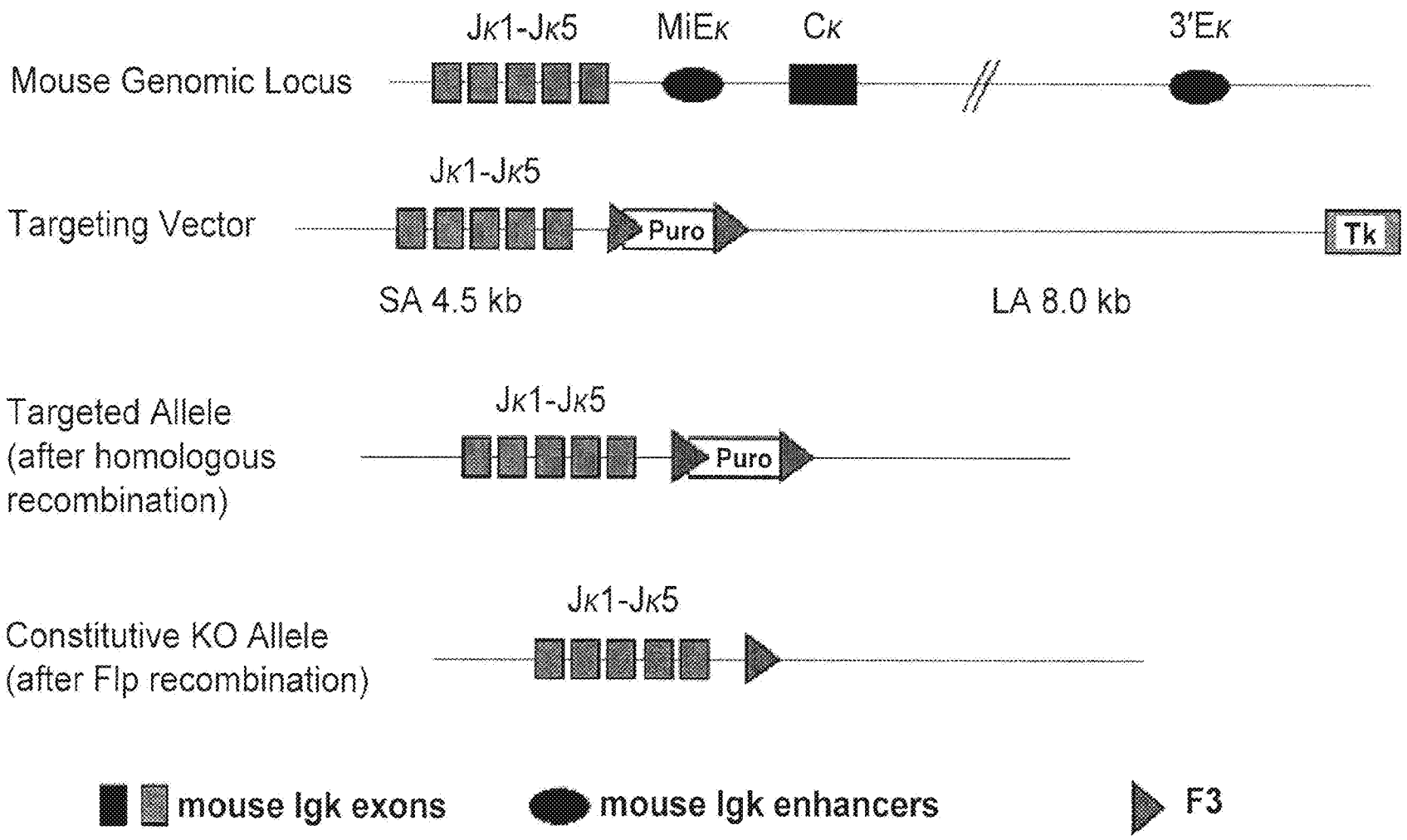
FIGS. 18A-B: Constitutive knock-out (KO) of the Ig kappa locus.
Figure 18B:
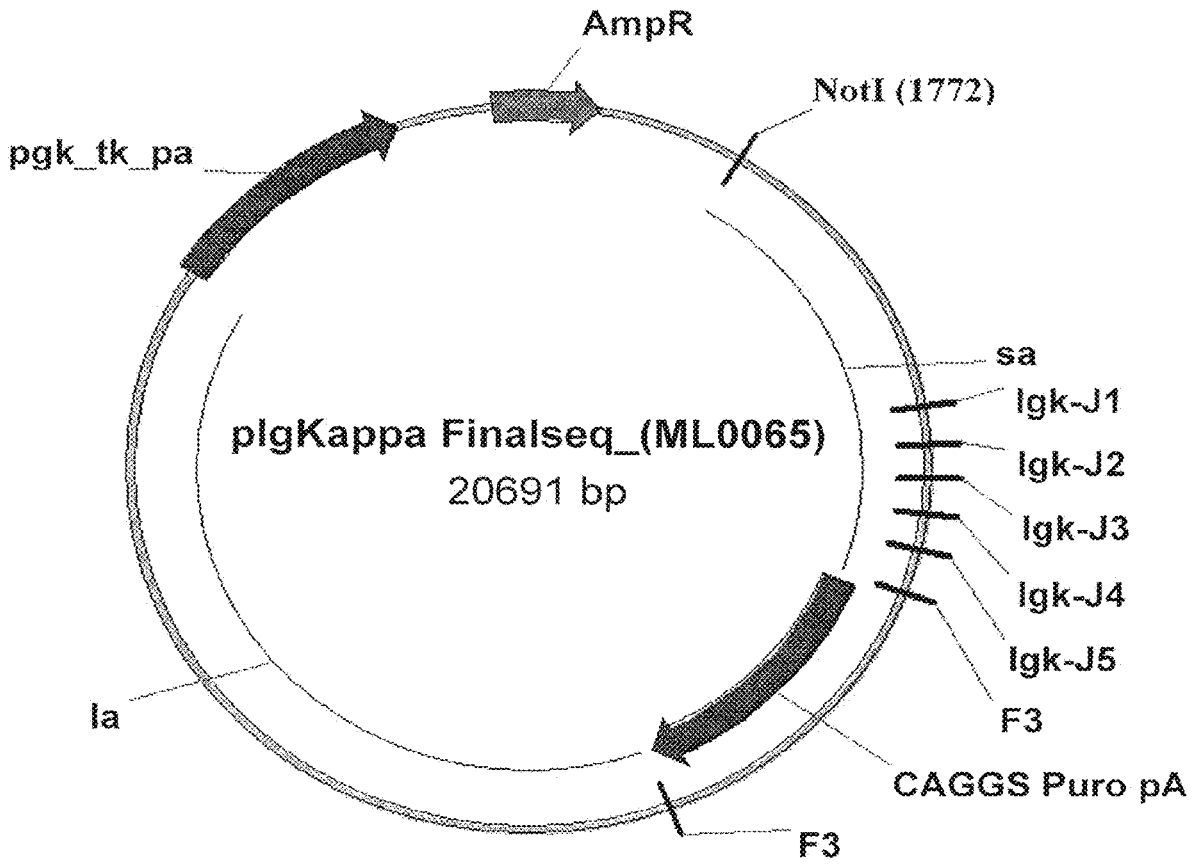

A vector that contains an assembled nucleotide sequence consisting of a part comprising the J-region to 338 bp downstream of the J5 gene segment fused to a sequence ending 3' of the 3' CK enhancer is used for homologous recombination in ES cells. The assembled sequence is used to delete a genomic DNA fragment spanning from 3' of the JK region to just 3' of the 3' CK enhancer. As a consequence of this procedure, the CK constant gene, the 3' enhancer and some intergenic regions are removed (see FIGS. 4 and 18A-B).

Construction of the Targeting Vector

A vector that received 4.5-8 kb flanking arms on the 3' and 5' end fused to the deletion segment was used for targeted homologous recombination in an ES cell line. Both arms were obtained by PCR means ensuring maximum homology. The targeting strategy allows generation of constitutive KO allele. The mouse genomic sequence encompassing the Igk intronic enhancer, Igk constant region and the Igk 3' enhancer was replaced with a PuroR cassette, which was flanked by F3 sites and inserted downstream of the Jk elements. Flp-mediated removal of the selection marker resulted in a constitutive KO allele. The replacement of the Igk MiEk-Igk C-Igk 3'E genomic region (approximately 10 kb) with a F3-Puro cassette (approx. 3 kb) was likely to decrease the efficiency of homologous recombination. Therefore, the arms of homology were extended accordingly and more ES cell colonies were analyzed after transfection in order to identify homologous recombinant clones.

Generation of ES Cells Bearing the Deleted Kappa Fragment

The generation of genetically modified ES cells was essentially performed as described (Seibler et al. (2003), *Nucleic Acids Res*. February 15; 31(4):e12). See also Example 14 for a detailed description.

Generation of ES Mice by Tetraploid Embryo Complementation

The production of mice by tetraploid embryo complementation using genetically modified ES cells was essentially performed as described (Eggan et al., *PNAS* 98:6209-6214; J. Seibler et al. (2003), *Nucleic Acids Res*. February 15; 31(4):e12; Hogan et al. (1994), Summary of mouse development, *Manipulating the Mouse Embryo*, Cold Spring Harbor Laboratory Press, Cold Spring Harbor N. Y., pp. 253-289).

Example 4: Silencing of the Mouse Lambda Light Chain Locus

This example describes the silencing of the mouse endogenous lambda light chain locus. The endogenous lambda locus is modified by homologous recombination in ES cells followed by the introduction of genetically modified ES cells in mouse embryos to obtain genetically adapted offspring.

Two regions of the murine lambda locus that together contain all functional lambda V regions are subject to deletion.

Figure 5:
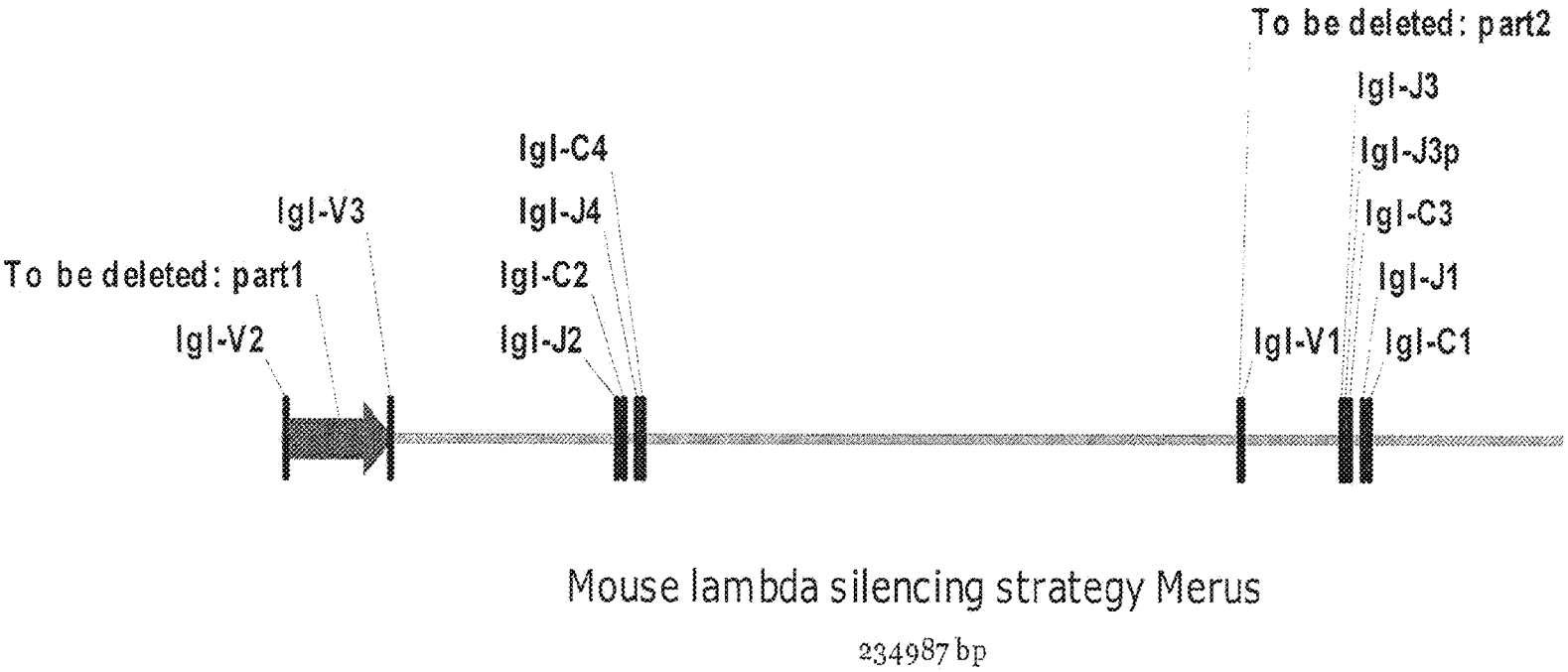
FIG. 5: The topology of the mouse C-lambda locus. All three active V-regions are indicated (Igl-V1, V2 and V3) as are the J-segments (Igl-J1, Igl-J2, Igl-J3, Igl-J4 and the pseudo segment Igl-J3p) and constant regions (Igl-C1, Igl-C2, Igl-C3 and Igl-C4). The regions that are deleted in order to silence the locus are indicated by deletion markers. These deletions include all active V genes (1, 2 and 3) and the intergenic segment between V2 and V3.
Figure 19A:
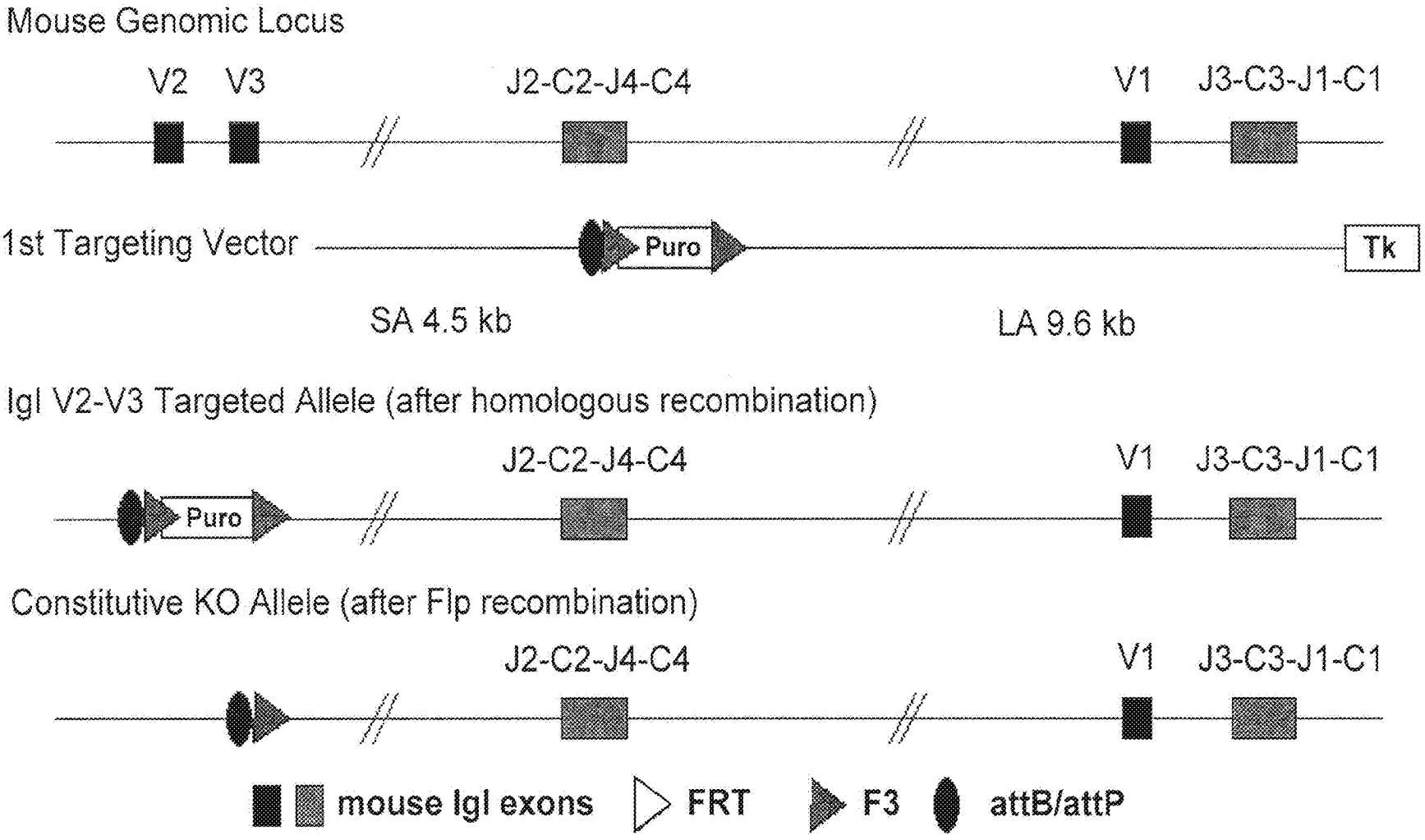
FIGS. 19A-B: Constitutive KO of the Ig lambda locus.
Figure 19B:
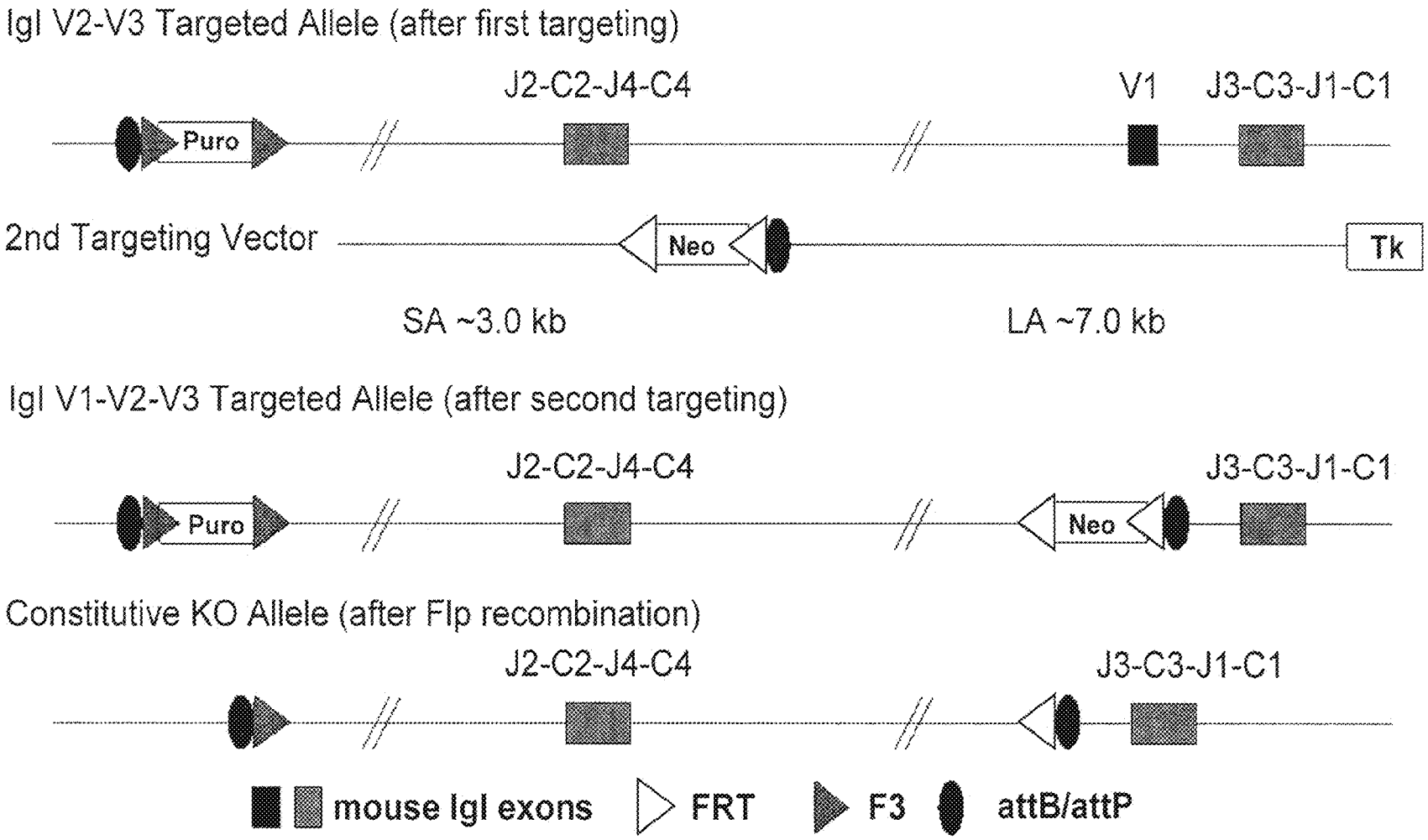

The first region targeted for homologous recombination-based deletion is a region that is located 408 bp upstream of the start site of the IGLV2 gene segment and ends 215 bp downstream of IGLV3 gene segment, including the intergenic sequence stretch between these IGLV gene segments. The second region that is subject to a deletion involves the IGLV1 gene segment consisting of a fragment spanning from 392 bp upstream to 171 bp downstream of the IGLV1 gene segment. As a consequence of these two deletion steps, all functional V-lambda genes segments are deleted, rendering the locus functionally inactive (FIGS. 5 and 19A-B).

Construction of the Targeting Vectors

Vectors that received 3-9.6 kb flanking arms on the 3' and 5' end fused to the deletion segment were used for targeted homologous recombination in an ES cell line. Both arms were obtained by PCR means ensuring maximum homology. In a first step, the mouse genomic sequence encompassing the Igl V2-V3 regions were replaced with a PuroR cassette flanked by F3 sites, which yields a constitutive KO allele after Flp-mediated removal of selection marker (see FIG. 19A). In a second step, the mouse genomic sequence encompassing the Igl V1 region was replaced with a Neo cassette in ES cell clones which already carried a deletion of the Igl V2-V3 regions (see FIG. 19B). The selection marker (NeoR) was flanked by FRT sites. A constitutive KO allele was obtained after Flp-mediated removal of selection markers.

Generation of ES Cells Bearing the Deleted Lambda Fragment

The generation of genetically modified ES cells was essentially performed as described (J. Seibler, B. Zevnik, B. Küter-Luks, S. Andreas, H. Kern, T. Hennek, A. Rode, C. Heimann, N. Faust, G. Kauselmann, M. Schoor, R. Jaenisch, K. Rajewsky, R. Kühn, F. Schwenk (2003), *Nucleic Acids Res*., February 15; 31(4):e12). See also, Example 14 for a detailed description. To show that both targeting events occurred on the same chromosome several double targeted clones were selected for the in vitro deletion with pCMV C31deltaCpG. The clones were expanded under antibiotic pressure on a mitotically inactivated feeder layer comprised of mouse embryonic fibroblasts in DMEM High Glucose medium containing 20% FCS (PAN) and 1200 μ/mL Leukemia Inhibitory Factor (Millipore ESG 1107). $1\times10^7$ cells from each clone were electroporated with 20 μg of circular pCMV C31deltaCpG at 240 V and 500 μF and plated on four 10 cm dishes each. Two to three days after electroporation, cells were harvested and analyzed by PCR. Primers used were:

```
                                    (SEQ ID NO: 1)
2005_5: CCCTTTCCAATCTTTATGGG

                                    (SEQ ID NO: 2)
2005_7: AGGTGGATTGGTGTCTTTTTCTC

                                    (SEQ ID NO: 3)
2005_9: GTCATGTCGGCGACCCTACGCC
```

PCR reactions were performed in mixtures comprising 5 μl PCR Buffer 10× (Invitrogen), 2 μl $MgCl_2$ (50 mM), 1 μl dNTPs (10 mM), 1 μl first primer (5 μM), 1 μl second primer (5 μM), 0.4 μl Taq (5 U/ul, Invitrogen), 37.6 μl $H_2O$, and 2 μl DNA. The program used was 95° C. for five minutes;

followed by 35 cycles of 95° C. for 30 seconds; 60° C. for 30 seconds; 72° C. for 1 minute; followed by 72° C. for ten minutes.

Generation of ES Mice by Tetraploid Embryo Complementation

The production of mice by tetraploid embryo complementation using genetically modified ES cells was essentially performed as described (Eggan et al., *PNAS* 98:6209-6214; J. Seibler, B. Zevnik, B. Küter-Luks, S. Andreas, H. Kern, T. Hennek, A. Rode, C. Heimann, N. Faust, G. Kauselmann, M. Schoor, R. Jaenisch, K. Rajewsky, R. Kühn, and F. Schwenk (2003), *Nucleic Acids Res.*, February 15; 31(4):e12; Hogan et al. (Cold Spring Harbor Laboratory Press, Cold Spring Harbor N. Y.), pp. 253-289).

Example 5: Construction of the CAGGS Expression Insert Based on a Rearranged Human Germline IGKV1-39/J-Ck Gene (IGKV1-39/J-Ck)

Figure 6:
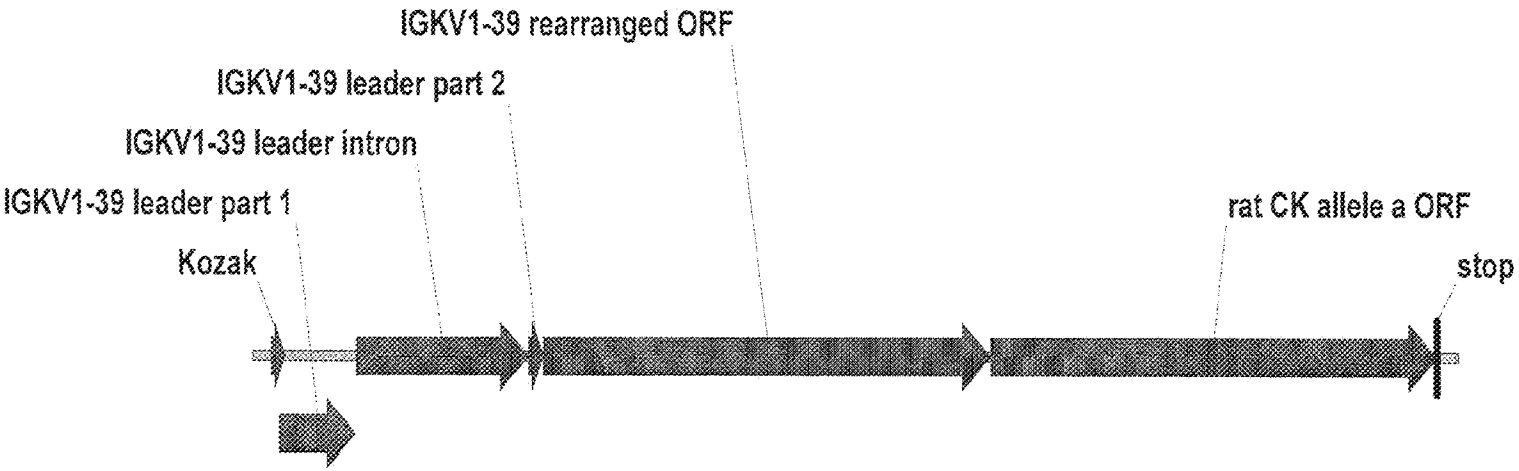
FIG. 6: Construct topology of IGKV1-39/J-Ck with an intron located in the leader open reading frame (ORF).

This example describes the construction of a CAGGS expression cassette incorporating the rearranged human germline IGKV1-39/J region. This insert expression cassette encompasses cloning sites, a Kozak sequence, a leader sequence containing an intron, an open reading frame of the rearranged IGKV1-39 region, a rat CK constant region from allele a and a translational stop sequence (IGKV1-39/J-Ck; FIG. 6). The primary construct consists of naturally occurring sequences and has been analyzed and optimized by removing undesired cis acting elements like internal TATA-boxes, poly adenylation signals, chi-sites, ribosomal entry sites, AT-rich or GC-rich sequence stretches, ARE-, INS- and CRS sequence elements, repeat sequences, RNA secondary structures, (cryptic) splice donor and acceptor sites and splice branch points (GeneArt GmbH). In addition, the codon usage in the open reading frame regions is optimized for expression in mice. The intron sequence is unchanged and thus represents the sequence identical to the coding part of the human IGKV1-39 leader intron.

Figure 13A:
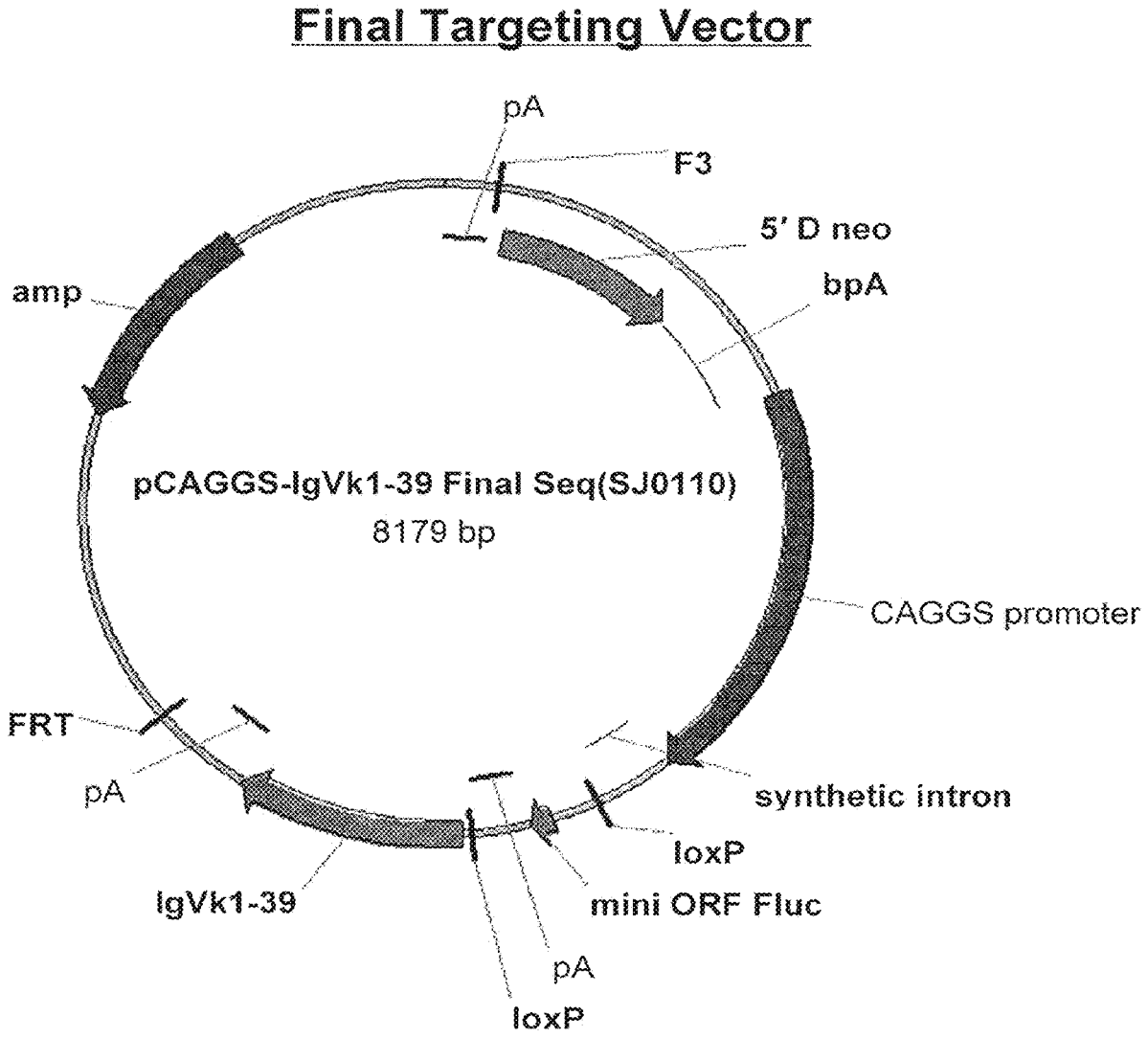
Figure 13C:
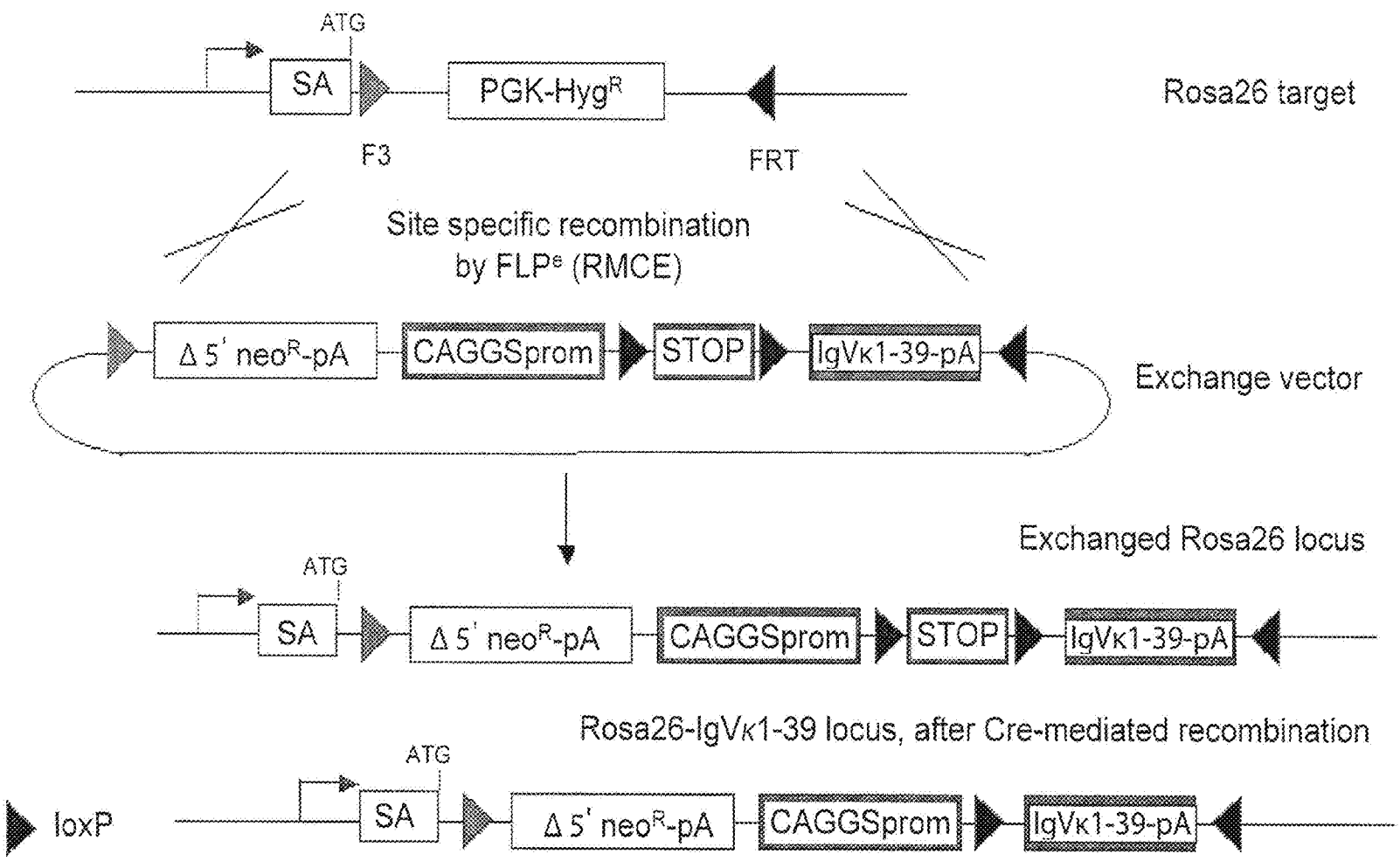

At the 5' end of the expression cassette, a NotI site was introduced and on the 3' site a NheI site. Both sites are used for cloning in the CAGGS expression module. After gene assembly according to methods used by GeneArt, the insert is digested with NotI-NheI and cloned into the expression module containing a CAGGS promoter, a stopper sequence flanked by LoxP sites ("floxed"), a polyadenylation signal sequence and, at the 5' and 3' end, sequences to facilitate homologous recombination into the Rosa26 locus of mouse ES cell lines. Promoter and/or cDNA fragments were amplified by PCR, confirmed by sequencing and/or cloned directly from delivered plasmids into an RMCE exchange vector harboring the indicated features. A schematic drawing and the confirmed sequence of the final targeting vector pCAGGS-IgVK1-39 are shown in FIGS. 13A and 13B. The targeting strategy is depicted in FIG. 13C.

Example 6: CAGGS Expression Insert Based on the Rearranged Germline IGLV2-14/J V Lambda Region (IGLV2-14/J-Ck)

Figure 7:
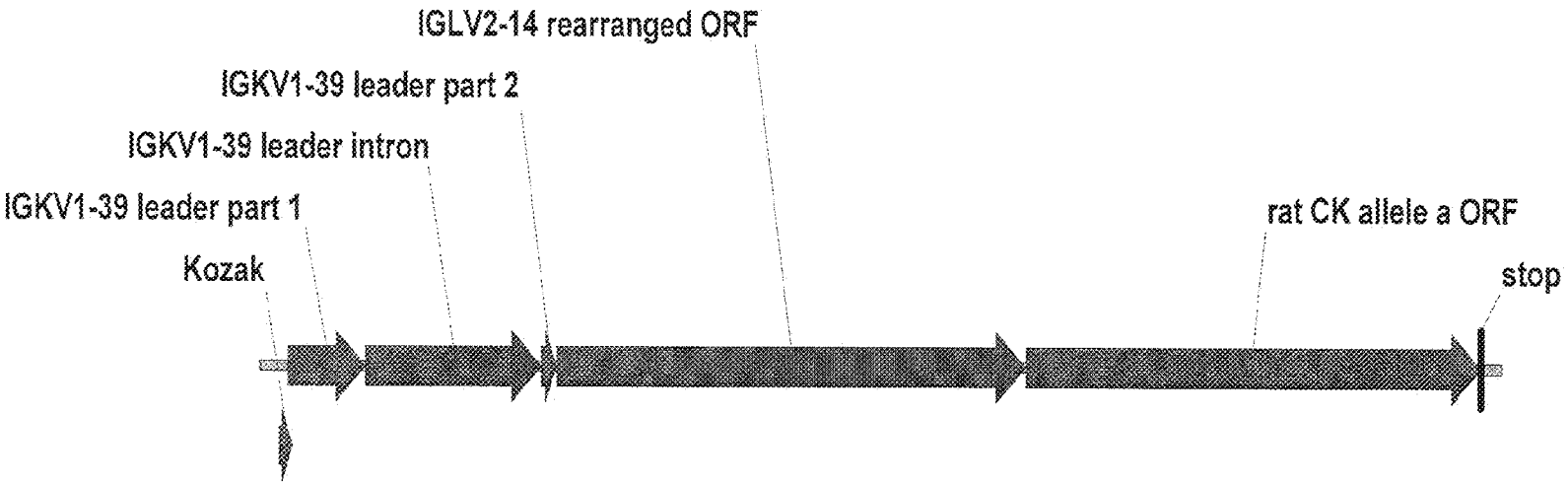
FIG. 7: Construct topology of IGLV2-14/J-Ck with an intron located in the leader open reading frame (ORF).

This example describes the sequence and insertion of an expression cassette incorporating the rearranged germline IGLV2-14/J V lambda region. This insert encompasses cloning sites, a Kozak sequence, a leader sequence containing an intron, an open reading frame of the rearranged IGLV2-14/J region, a rat CK constant region from allele a and a translational stop sequence (IGLV2-14/J-Ck; FIG. 7). The primary construct consists of naturally-occurring sequences and has been analyzed and optimized by removing undesired cis acting elements like: internal TATA-boxes, poly adenylation signals, chi-sites, ribosomal entry sites, AT-rich or GC-rich sequence stretches, ARE-, INS- and CRS sequence elements, repeat sequences, RNA secondary structures, (cryptic) splice donor and acceptor sites and splice branch points (GeneArt GmbH). In addition, the codon usage in the open reading frame regions was optimized for expression in mice. The intron sequence is unchanged and thus represents the sequence identical to the human IGKV1-39 leader intron.

Figure 15A:
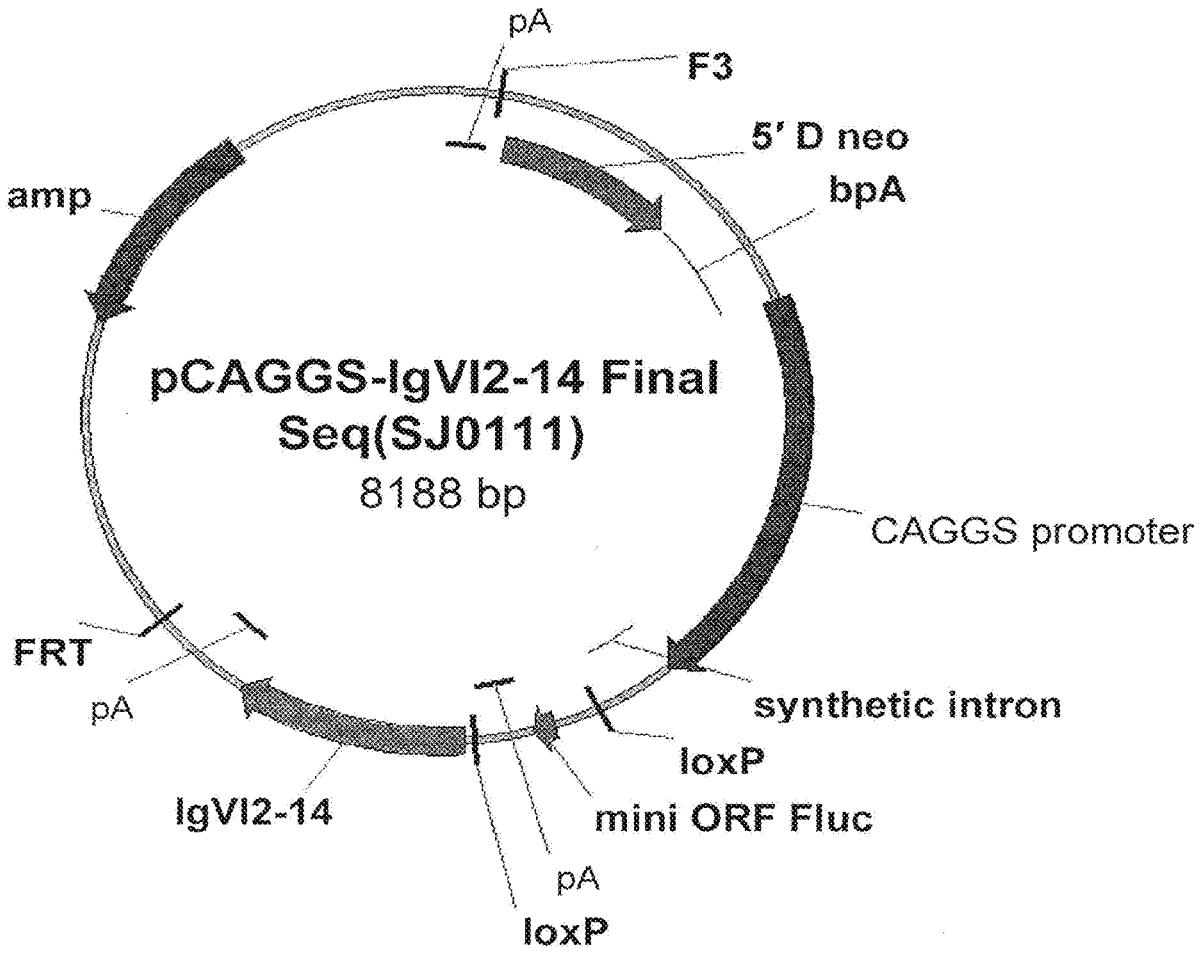
Figure 15C:
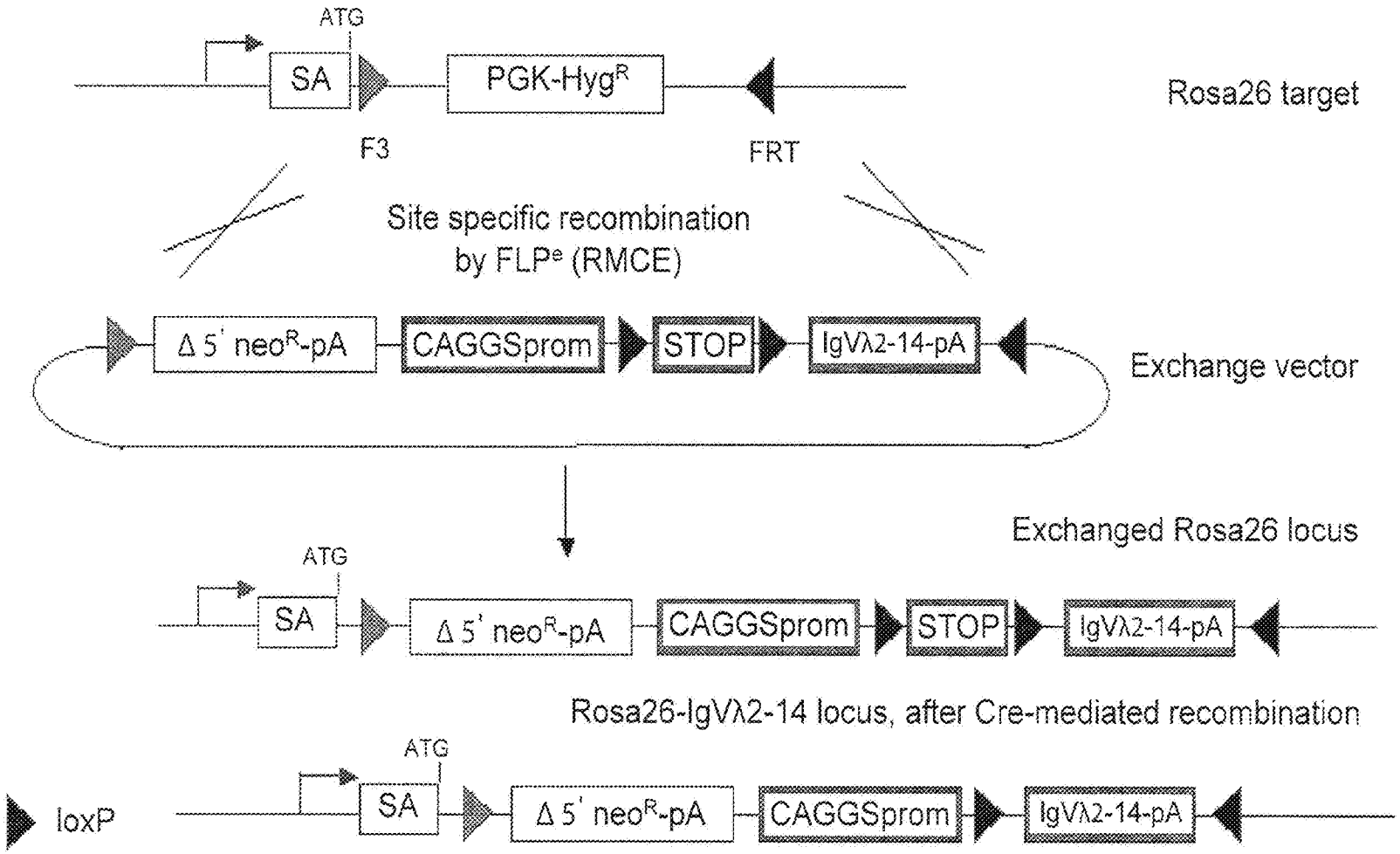
Figure 16A:
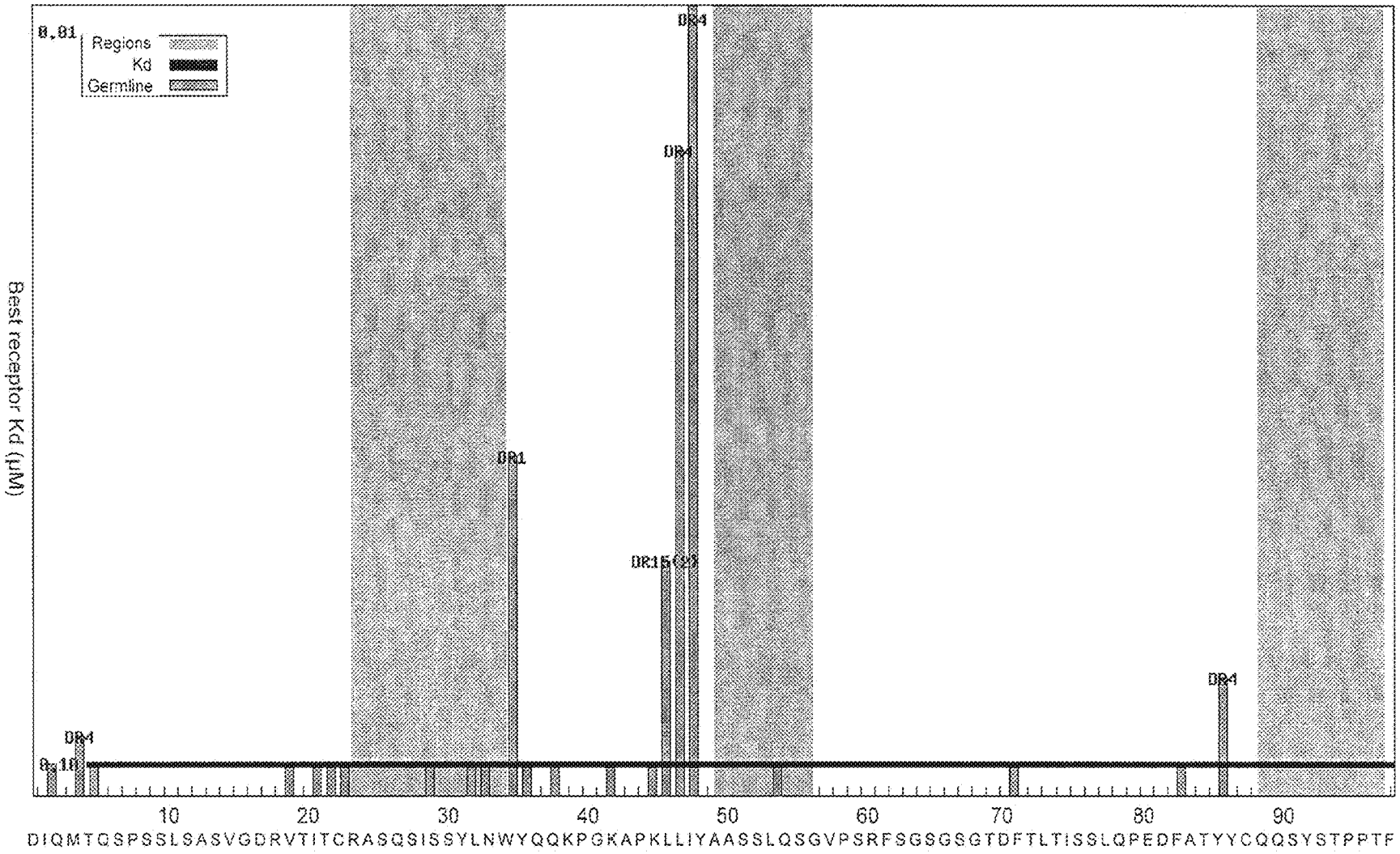
FIGS. 16A-C: Epibase® profile of IGKV1-39 residues 1-107 (SEQ ID NO:85).
Figure 16B:
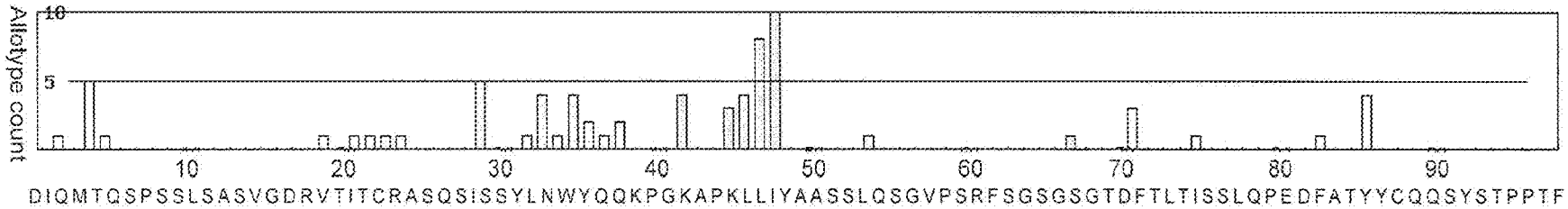
Figure 16C:
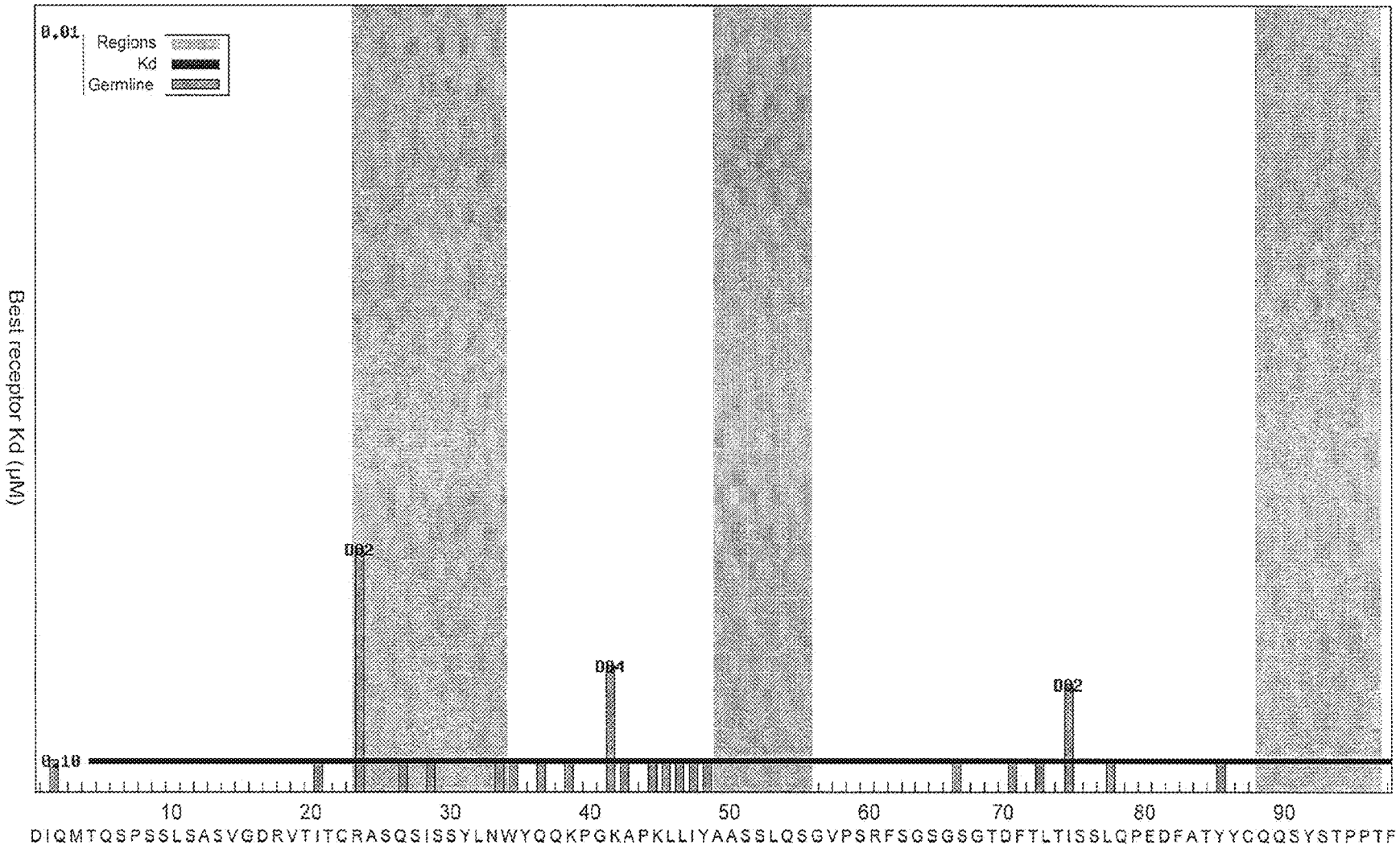
Figure 17:
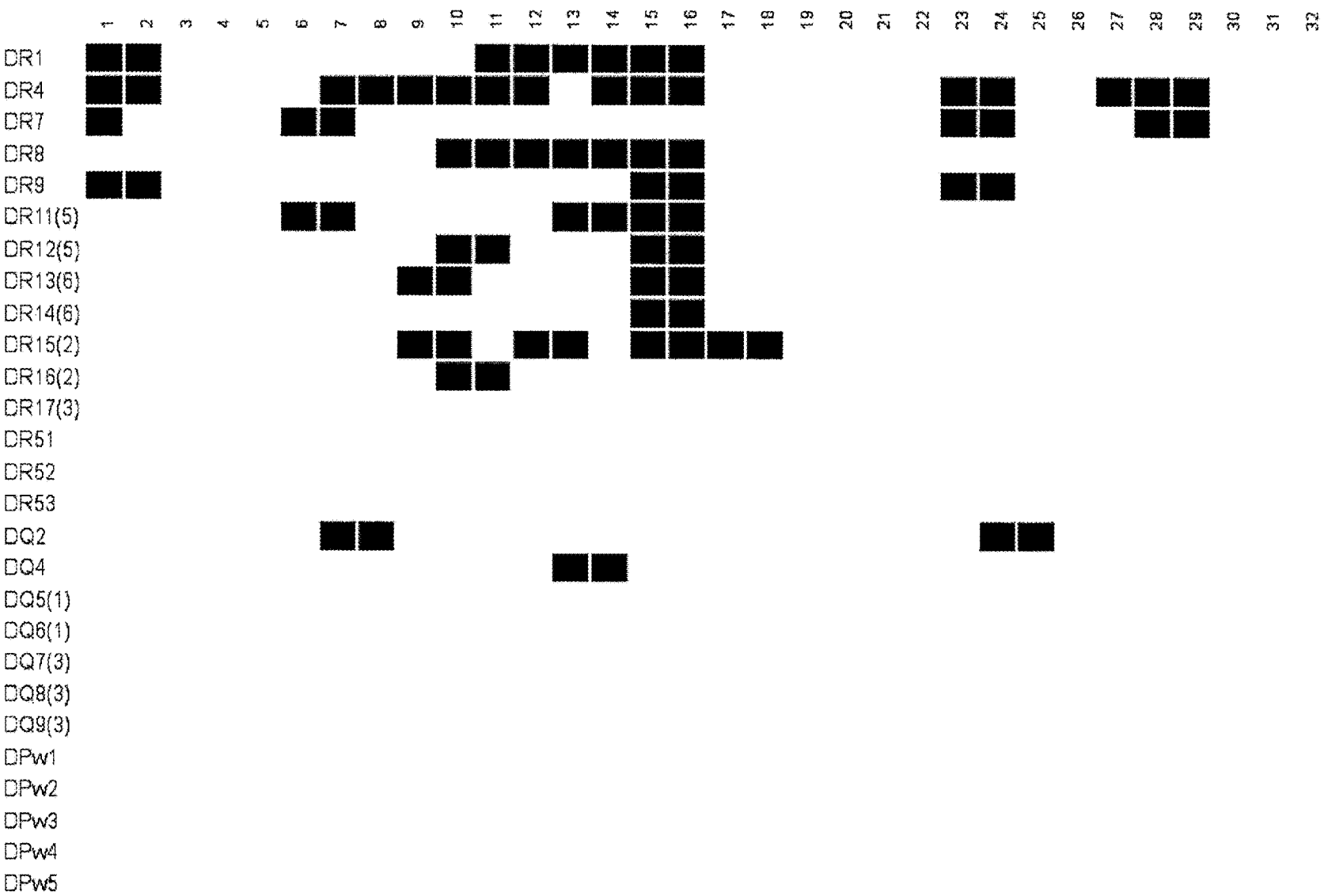
FIG. 17: Epitope map of IGKV1-39 showing the presence of peptide binders predicted in the sequence of IGKV1-39 by serotype in the 15-mer format. Each 15-mer is numbered as indicated in the top of the figure. The full sequence of the corresponding 15-mer is listed in Table 7. Black boxes indicate the presence of one or more critical self-epitopes in the 15-mer for the serotype listed on the left. Critical epitopes are operationally defined as strong or medium DRB1 binders and strong DRB3/4/5 or DP or DQ binders.

At the 5' end of the expression cassette, a NotI site was introduced and on the 3' site a NheI site. Both sites are used for cloning in the CAGGS expression module as described by TaconicArtemis. After gene assembly according to methods used by GeneArt, the insert was digested with NotI-NheI and cloned into the expression module containing a CAGGS promoter, a stopper sequence flanked by LoxP sites ("floxed"), a polyadenylation signal sequence and, at the 5' and 3' end, sequences to facilitate homologous recombination into the Rosa26 locus of mouse ES cell lines. To construct the final ROSA26 RMCE targeting vector, promoter and/or cDNA fragments were amplified by PCR. Amplified products were confirmed by sequencing and/or cloned directly from delivered plasmids into an RMCE exchange vector harboring the indicated features. A schematic drawing and the confirmed sequence of the final targeting vector pCAGGS-IgVL2-14 is shown in FIGS. 15A and 15B. The targeting strategy is depicted in FIG. 15C.

Example 7: Expression of IGKV1-39/J-Ck in HEK293 Cell Lines (pSELECT-IGKV1-39/J-Ck)

This example describes a method to verify that the IGKV1-39/J-Ck constructs described in Example 5 enable expression and detection of the IGKV1-39/J-Ck L chain in HEK293 cells. The IGKV1-39/J insert (FIG. 6) was modified at the 5' end by changing the NotI site into a SalI site. This change is required for cloning of the product into the expression cassette plasmid pSELECT-hygro (InvivoGen). The CAGGS expression insert IGKV1-39/J-Ck and pSELECT-hygro were digested with SalI and NheI, ligated and used to transform competent XL1-Blue cells using standard techniques. Colonies were picked and DNA purified using Qiagen Midi-prep columns according to the manufacturer's procedures. The resulting light chain (LC) expressing vector named 0817676_pSELECT_0815426 was used to transfect HEK293 cells with Fugene6 (Roche) according to the manufacturer's protocols. Supernatants were screened for the presence of IGKV1-39/J-Ck light chains by ELISA and western blot using anti-rat-Ck antibodies (Beckton Dickinson #550336 and 553871) and protocols used in the art.

The VH of anti-tetanus toxoid (TT) IgG MG1494 was cloned into IgG expression vector MV1056 using restriction sites SfiI and BstEII. The resulting clone was sequence verified. HEK293T cells were transfected with five different vector combinations as shown in Table 4 (see Example 8 for details of vector 0817678_pSELECT_0815427). Supernatants were harvested and IgG concentrations determined (see Table 4). No IgG could be detected for supernatants A and B containing light chain only as expected (detection antibody recognized Fc part of IgG). IgG concentration in supernatants C and D was comparable to that of positive control supernatant E, indicating correct expression of the light chain constructs.

Binding to T was analyzed by ELISA to check functionality of the produced antibodies, using hemoglobin as negative control antigen. No TT-specific binding could be detected for supernatants A and B containing light chain only, as expected. TT-specific binding for supernatants C and D was at least as good as for positive control supernatant E, confirming correct expression of the light chain constructs and functional assembly with heavy chain. Antibodies were detected not only using an anti-human IgG secondary antibody, but also an anti-rat Ckappa light chain secondary antibody. The results confirm that the anti-rat Ckappa antibody (BD Pharmingen #553871, clone MRK-1) recognizes the light chain expressed by the pSELECT vectors.

Supernatants were analyzed by non-reducing SDS-PAGE and Western blot (not shown). Detection using an anti-human IgG heavy chain antibody did not show bands for supernatants A and B containing light chain only, as expected. Results for supernatants C and D were comparable to positive control supernatant E, with a band close to the 170 kD marker as expected for intact IgG. Additional lower molecular weight bands were observed as well for supernatants C, D and E, which might represent degradation products, IgG fragments resulting from (partial) reduction and/or irrelevant protein bands due to non-specific binding of the detection antibody.

Detection using an anti-rat Ckappa light chain antibody showed a band close to the 26 kD marker for supernatants A and B, as expected for light chain only. This band was much more intense for A compared to B, indicating that the free IGKV1-39 light chain may be better expressed and/or more stable than the free IGLV2-14 light chain. No bands were detected for control supernatant E as expected, since the expressed IgG contains a human Ckappa light chain. For supernatants C and D, expected bands close to the 170 kD marker were observed; lower molecular weight bands were also observed, but to a lesser extent than above using the anti-human IgG antibody.

In conclusion, transfection of the light chain expression constructs combined with the heavy chain of anti-tetanus toxoid (TT) IgG MG1494 resulted in IgG production comparable to the positive control construct for both the pSELECT kappa and lambda light chain constructs. Both IgG productions yielded ELISA signals in a TT ELISA that were better than or comparable to the control IgG. SDS-PAGE and Western blot analysis confirmed the presence of intact IgG. The tested anti-rat Ckappa antibody worked efficiently in both ELISA and Western blot. Culture supernatant from cells transfected with light chain constructs only did not result in detectable IgG production nor in detectable TT-specific binding, while free light chain was detected on Western blot.

Example 8: Expression of IGLV2-14/J-Ck in HEK293 Cell Lines (pSELECT-IGLV2-14/J-Ck)

This example describes a method to verify that the IGLV2-14/J constructs described in Example 6 enable expression and detection of the IGLV2-14/J-Ck L chain in HEK293 cells. The IGLV2-14/J-Ck insert (FIG. 7) was modified at the 5' end by changing the NotI site into a SalI site. This change is required for cloning of the product into the expression cassette plasmid pSELECT-hygro (InvivoGen). The CAGGS expression insert IGLV2-14/J-Ck and pSELECT-hygro were digested with SalI and NheI ligated and used to transform competentXL1-Blue cells using standard techniques. Colonies were picked and DNA purified using Qiagen Midi-prep columns according to the manufacturer's procedures. The resulting light chain (LC) expressing vector named 0817678_pSELECT_0815427 was used to transfect HEK293 cells with Fugene6 (Roche) according to the manufacturer's protocols. Supernatants were screened for the presence of IGLV2-14/J-Ck light chains by ELISA and western blot using anti-rat-Ck antibodies (Becton Dickinson #550336 and 553871) and protocols used in the art. See Example 7 for details and results.

Example 9: Construction of a VK Promoter-Driven Expression Construct Containing an IGKV1-39/J Insert and Multiple Enhancer Elements Derived from the Murine CK Locus (VkP-IGKV1-39/J-Ck; VkP-O12)

This example describes the construction of an expression cassette that contains relevant elements to enable B-cell and developmental/differentiation stage-specific expression of the rearranged human IGKV1-39 VK region, based on the IGKV1-39 VK promoter region, leader containing an intron, germline V-gene, CDR3, IGKJ segment, mouse intergenic region located between Jk and CK, rat Ck allele a open reading frame, and a mouse intergenic fragment from the 3' end of the mouse CK gene ending just 3' of the 3' CK enhancer.

Optimized open reading frames of the leader, IGKV1-39 rearranged gene, and rat CK allele a gene, as described in Example 5, was used for the construction of the expression cassette. The VK promoter region was obtained by gene synthesis procedures (GeneArt, GmbH) and is almost identical to the sequence of the human IGKV1-39 region between −500 bp and the ATG (start site) of the gene. The only deviation from the natural sequence is the introduction of a GCCACCATGG Kozak sequence (SEQ ID NO:102) at the ATG (start) site in order to promote translation. A genomic fragment from a mouse BAC clone (TaconicArtemis) is used as the basis for the introduction of individual elements. This fragment is identical to the sequence of the mouse VK locus starting with the intron donor site located directly 3' of the JK5 region and ending just 3' of the 3' CK enhancer and covers approximately 12.5 kb.

Figure 8:
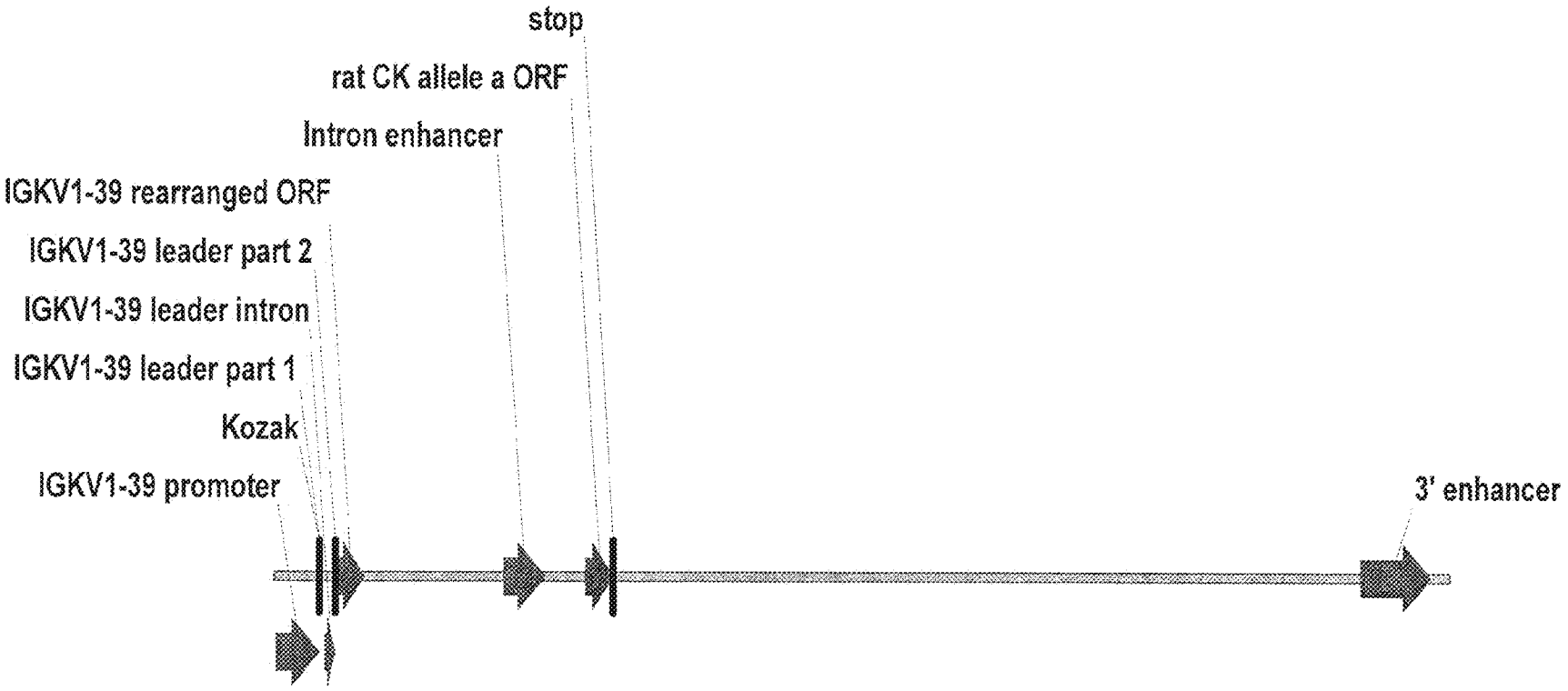
FIG. 8: Construct topology of VkP-IGKV1-39/J-Ck (VkP-O12). The promoter originates from the IGKV1-39 gene and is placed directly in front of the required elements for efficient transcription and translation. Intergenic sequences (including the enhancers) are derived from mice and obtained from BAC clones. The C-kappa sequence codes for the kappa constant region of rat.
Figure 20A:
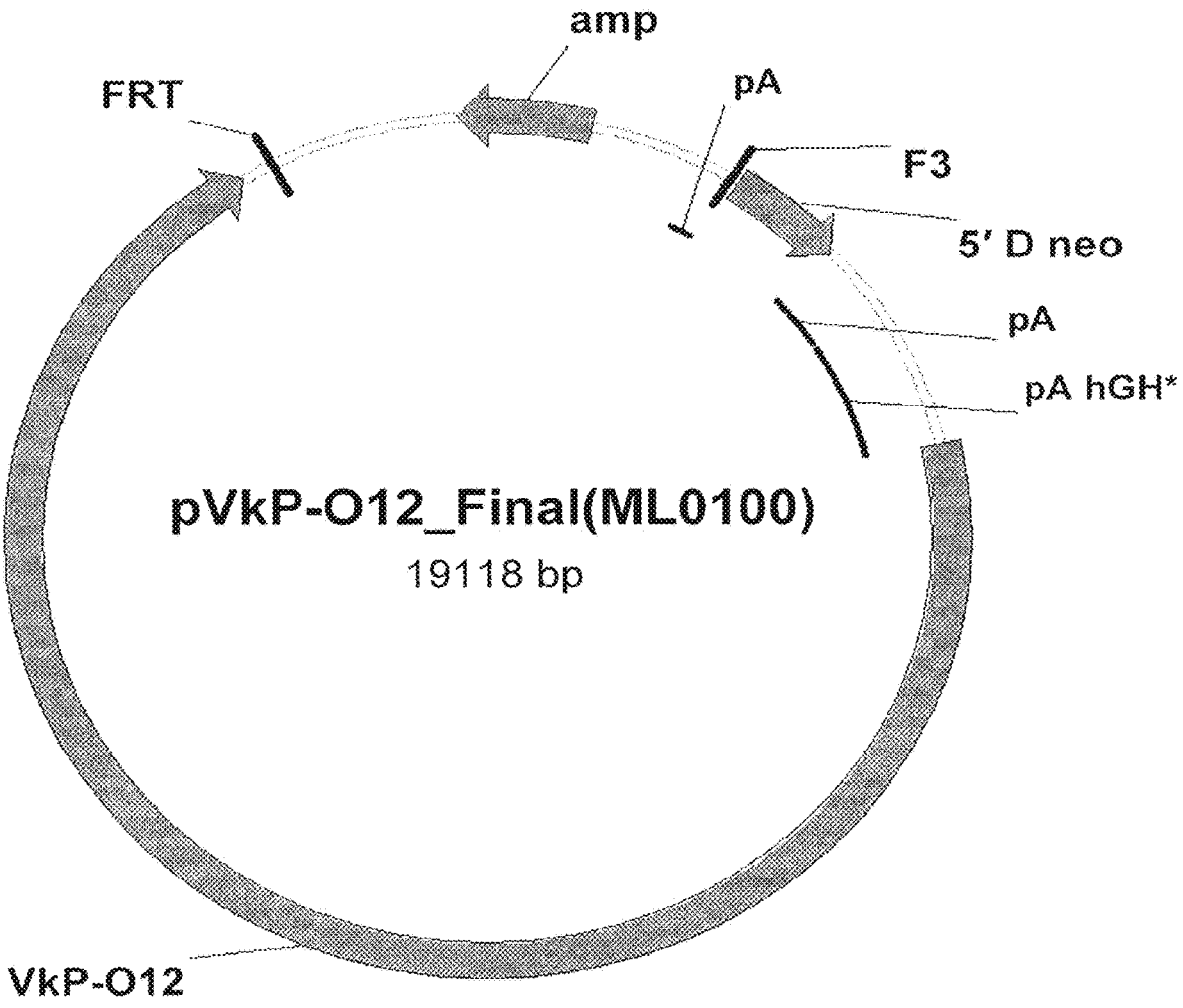
FIGS. 20A-C: Schematic drawing of targeting vectors.
Figure 21A:
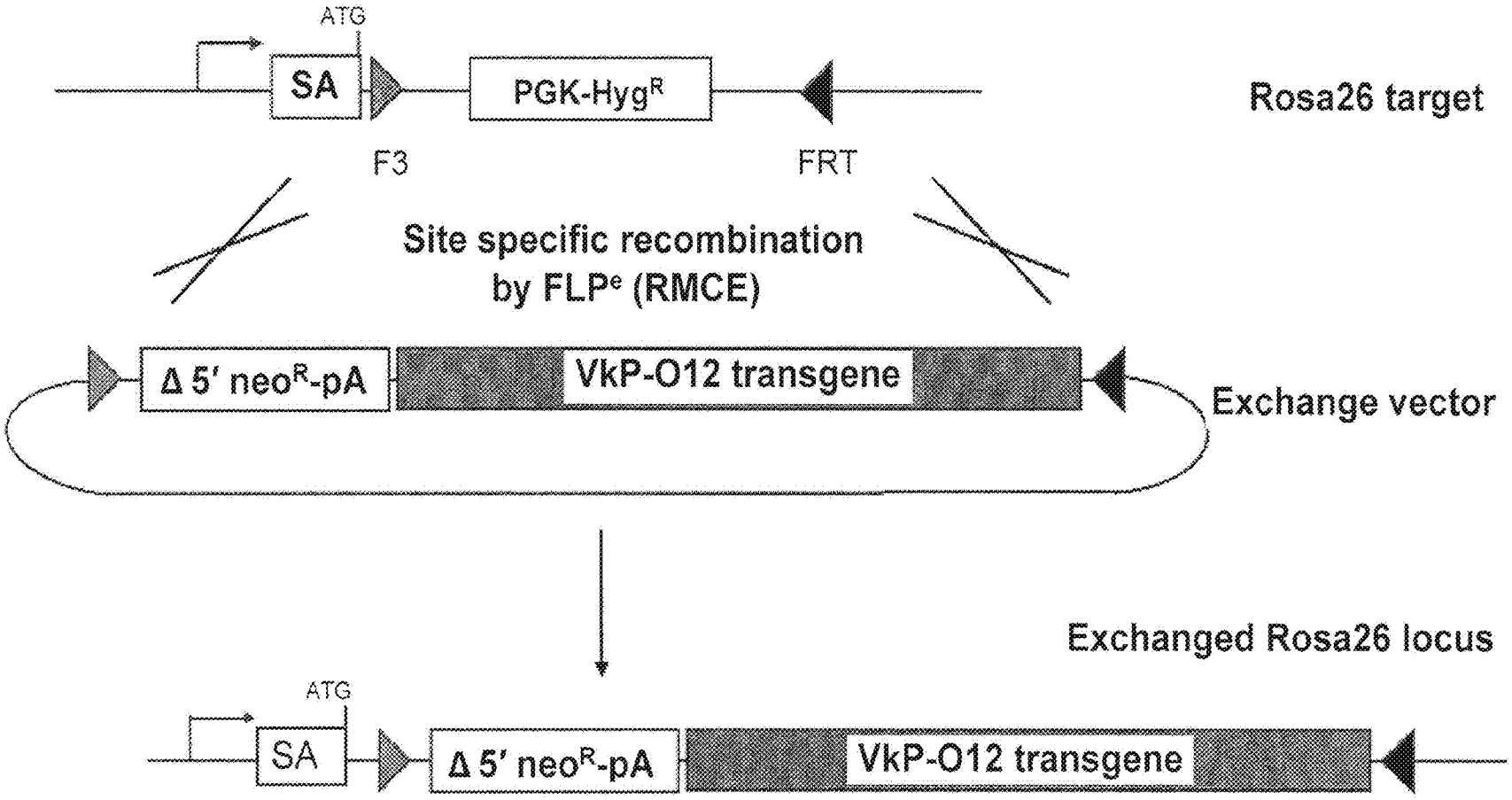
FIGS. 21A-C: Targeting strategies for insertion of transgene into the Rosa26 locus by targeted transgenesis using RMCE.

The final construct contains from 5' to 3' end the following elements: human genomic IGKV1-39 promoter (500 bp), a Kozak sequence, a human IGKV1-39 leader part 1 (optimized), a human IGKV1-39 leader intron, a human IGKV1-39 leader part 2 (optimized), a human IGKV1-39 germline gene (optimized), a human J-region (optimized), a mouse intergenic region including the intron enhancer element, a rat (*Rattus norvegicus*) kappa constant region (optimized), and a mouse intergenic region including the 3' kappa enhancer. The elements of this expression cassette are shown in FIG. 8 and named VkP-IGKV1-39/J-Ck (VkP-O12). An outline of the pVkP-O12 vector and the targeting strategy is depicted in FIGS. 20A and 21A. The vector was introduced into ES cells following standard procedures (see Example 14).

Example 10: Construction of a VK Promoter-Driven Expression Construct Containing an IGLV2-14/J Clone and Multiple CK Locus-Derived Enhancer Elements (VkP-IGLVL2-14/J-Ck; VkP-2a2)

Figure 9:
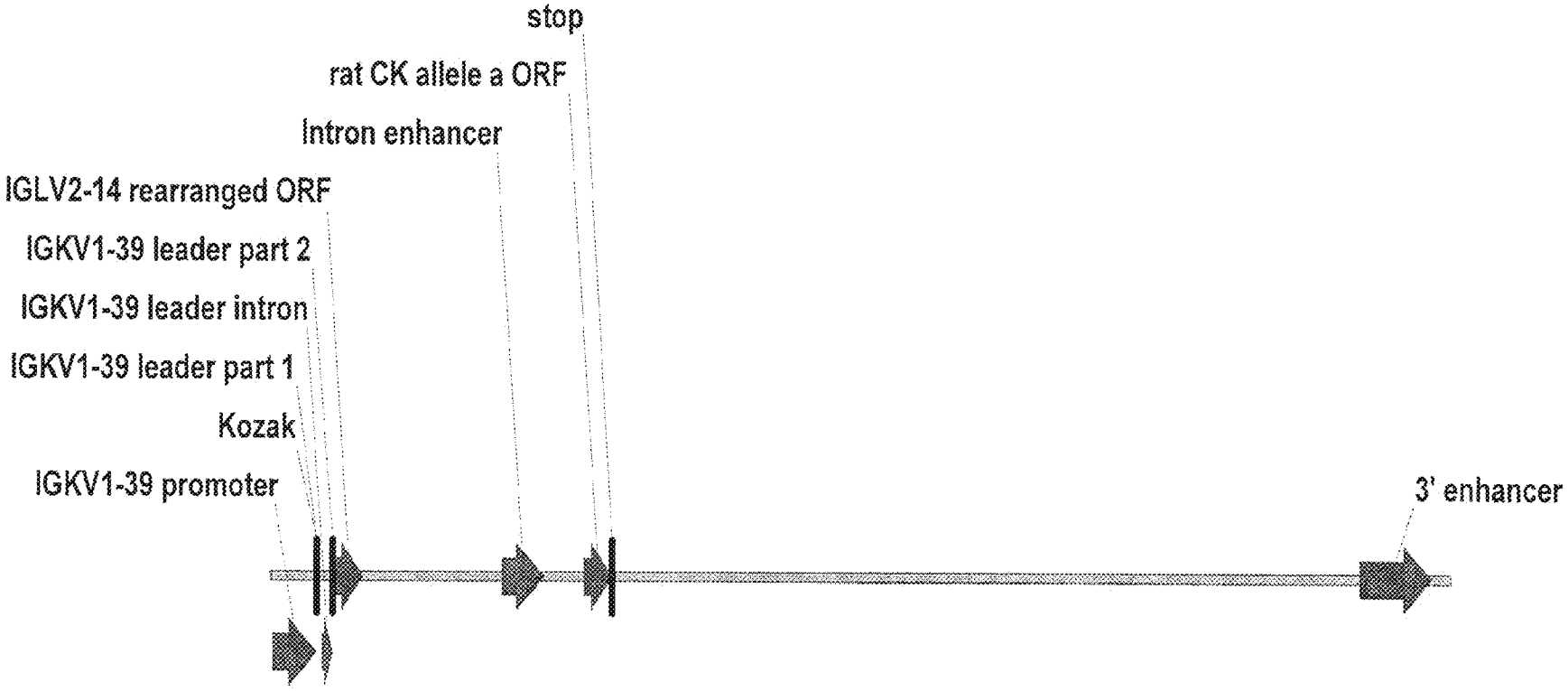
FIG. 9: Construct topology of VkP-IGLV2-14/J-Ck (VkP-2a2). The promoter originates from the IGKV1-39 gene and is placed directly in front of the required elements for efficient transcription and translation. Intergenic sequences (including the enhancers) are derived from mice and obtained from BAC clones. The C-kappa sequence codes for the kappa constant region of rat.

This example describes the same construct as described in Example 9, except that the IGKV1-39 gene and J-region are replaced by the optimized human IGLV2-14 germline gene including a unique V-J region (VkP-IGLV2-14/J-Ck; VkP-2a2; FIG. 9).

Example 11: Construction of a VK Promoter-Driven Expression Construct Containing an IGKV1-39 Clone Lacking the CK Intron Enhancer Element (VkP-IGKV1-39/J-Ck-Δ1; VkP-O12-Del1)

Figure 10:
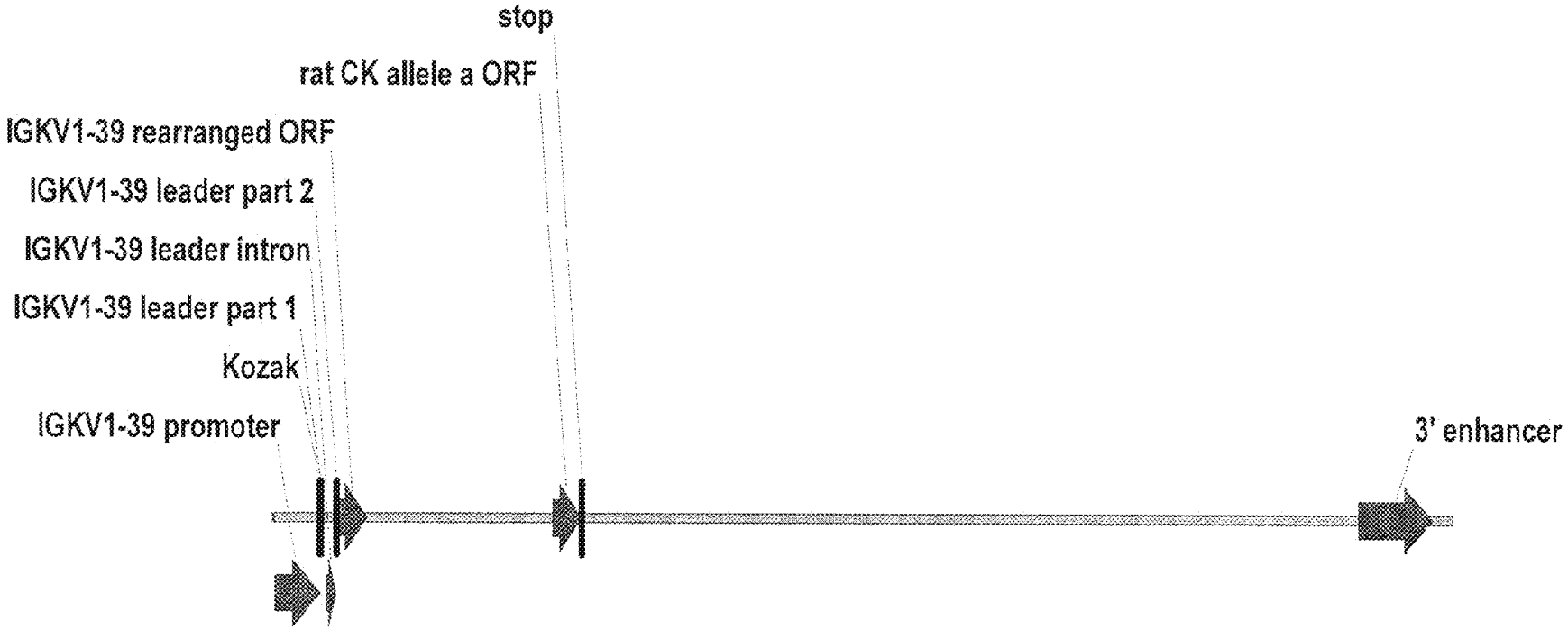
FIG. 10: Construct topology of VkP-IGKV1-39/J-Ck-Δ1 (VkP-O12-del1) is identical to VkP-IGKV1-39/J-Ck from FIG. 9 except that the intron enhancer region is removed.

The construct described in Example 9 was modified by removing the CK intron enhancer element, located in the intergenic region between the human J region and the rat CK region by standard PCR modification and DNA cloning methodologies (GeneArt, GmBH). The resulting expression cassette is shown in FIG. 10 and named VkP-IGKV1-39/J-Ck-Δ1 (VkP-O12-del1).

Figure 20B:
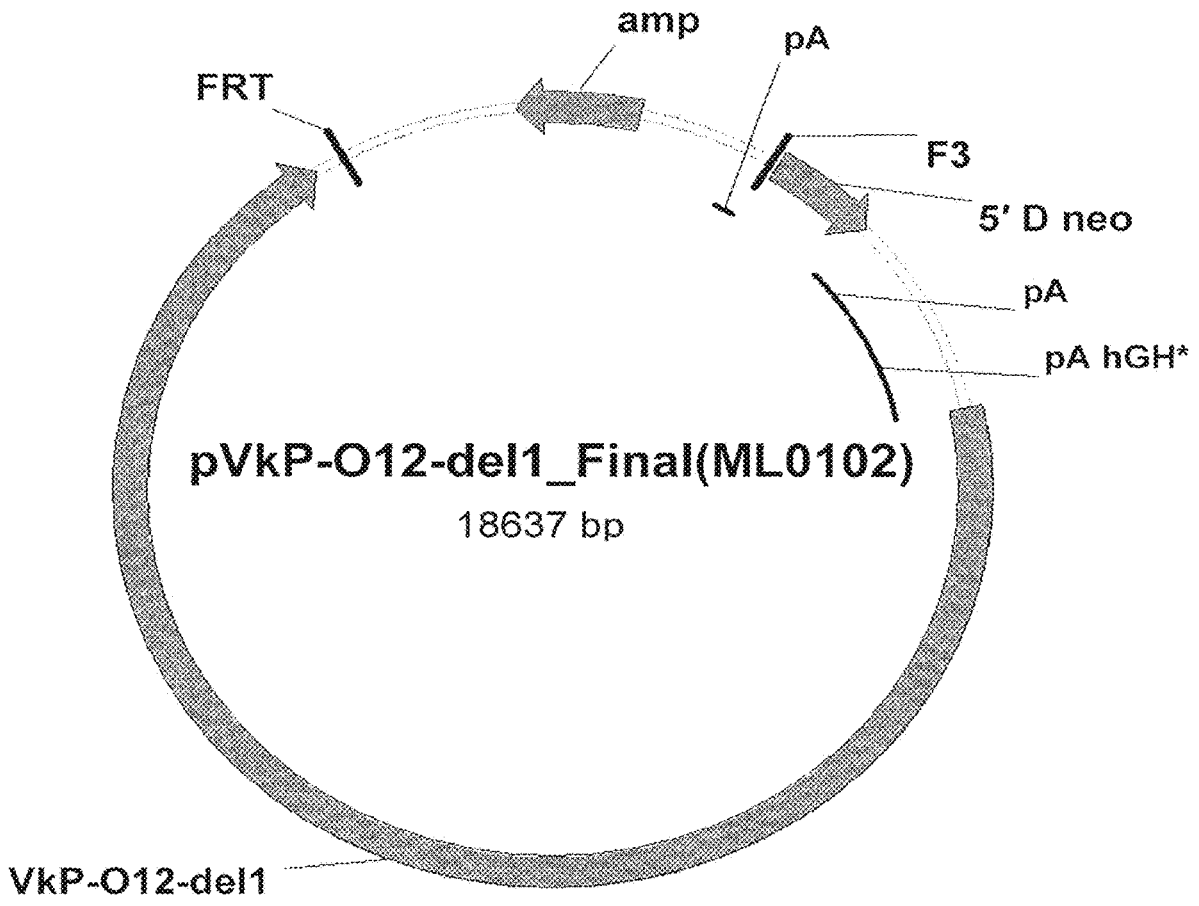
Figure 21B:
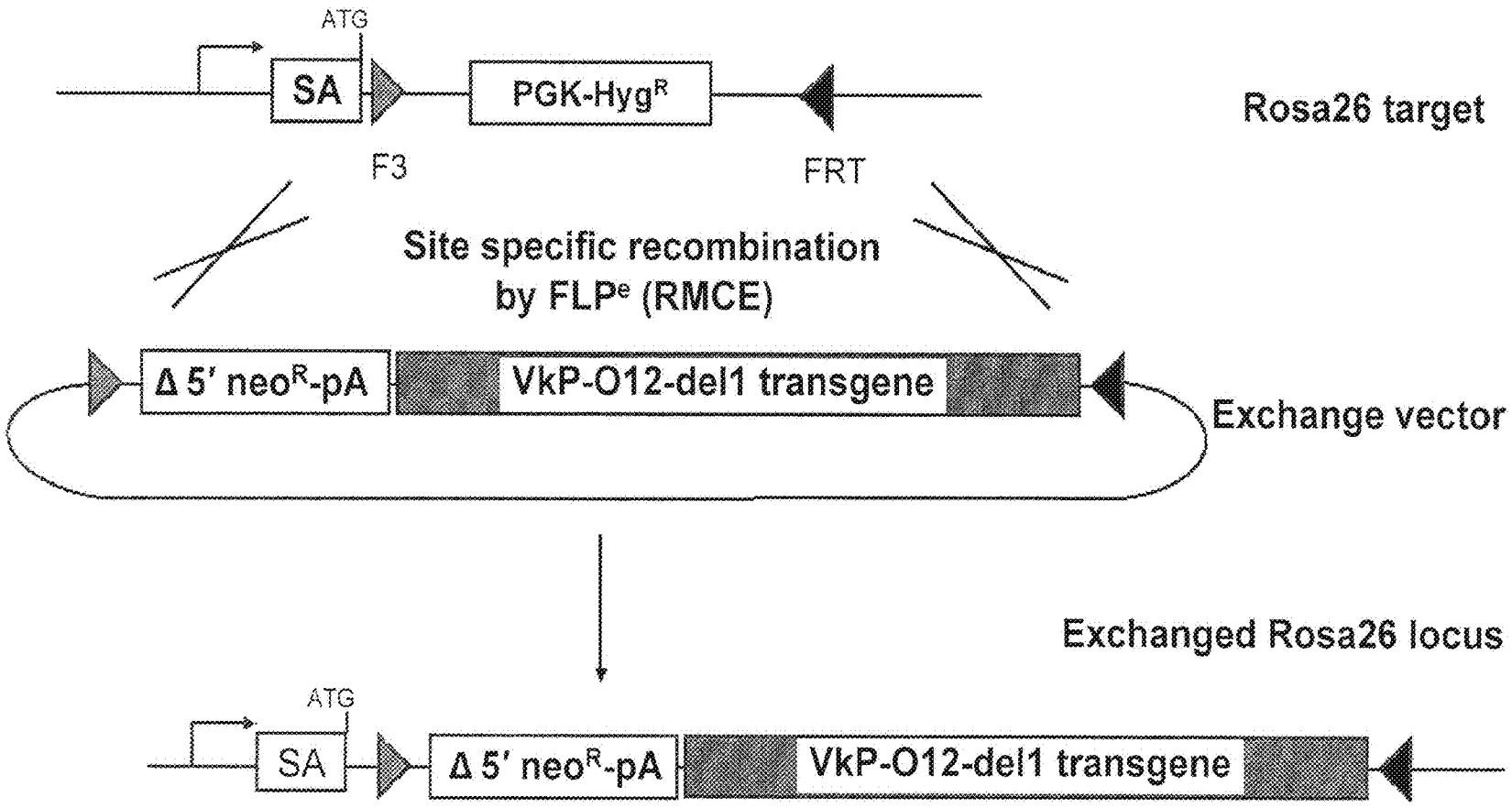

An outline of the pVkP-O12-del1 vector and the targeting strategy is depicted in FIGS. 20B and 21B. The vector was introduced into ES cells following standard procedures (see Example 14).

Example 12: Construction of a VK Promoter-Driven Expression Construct Containing an IGKV1-39 Clone Lacking the CK Intron Enhancer Element and a Truncated 3' CK Enhancer Element (VkP-IGKV1-39/J-Ck-Δ2; VkP-O12-Del2)

Figure 11:
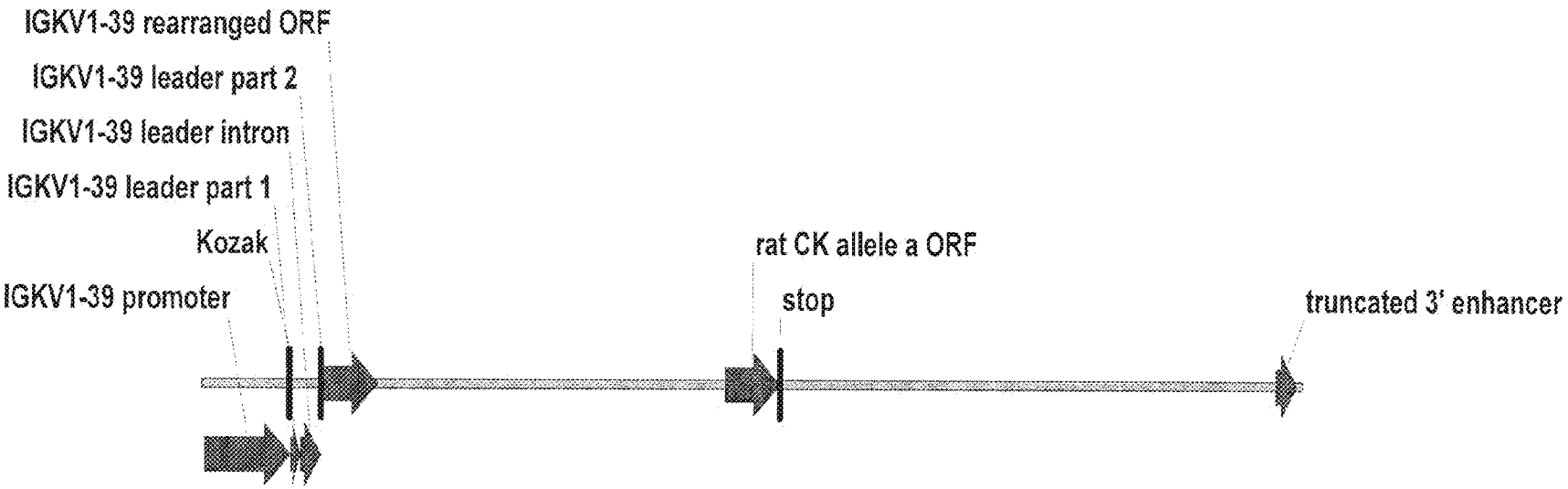
FIG. 11: Construct topology of VkP-IGKV1-39/J-Ck-Δ2 VkP-O12-del2) is identical to VkP-IGKV1-39/J-Ck-Δ1 from FIG. 10 except that a large piece of the intergenic region between the Ck gene and 3' enhancer is deleted. In addition, the 3' enhancer is reduced in size from 809 bp to 125 bp.

The construct described in Example 11 was modified by truncating the 3' CK enhancer element and deleting part of the intergenic region 3' of the rat Ck gene, to remove potential inhibitory elements. This was achieved by removing the intergenic sequence between an EcoRV site (located 3' of the rat Ck gene) and the NcoI site present in the 3' enhancer (5993 bp) and further removing the sequence between the 3' enhancer BstXI site and the BstXI site 3' of the 3' enhancer (474 bp) using standard methods. The resulting expression cassette is shown in FIG. 11 and named VkP-IGKV1-39/J-Ck-Δ2 (VkP-O12-del2).

Figure 20C:
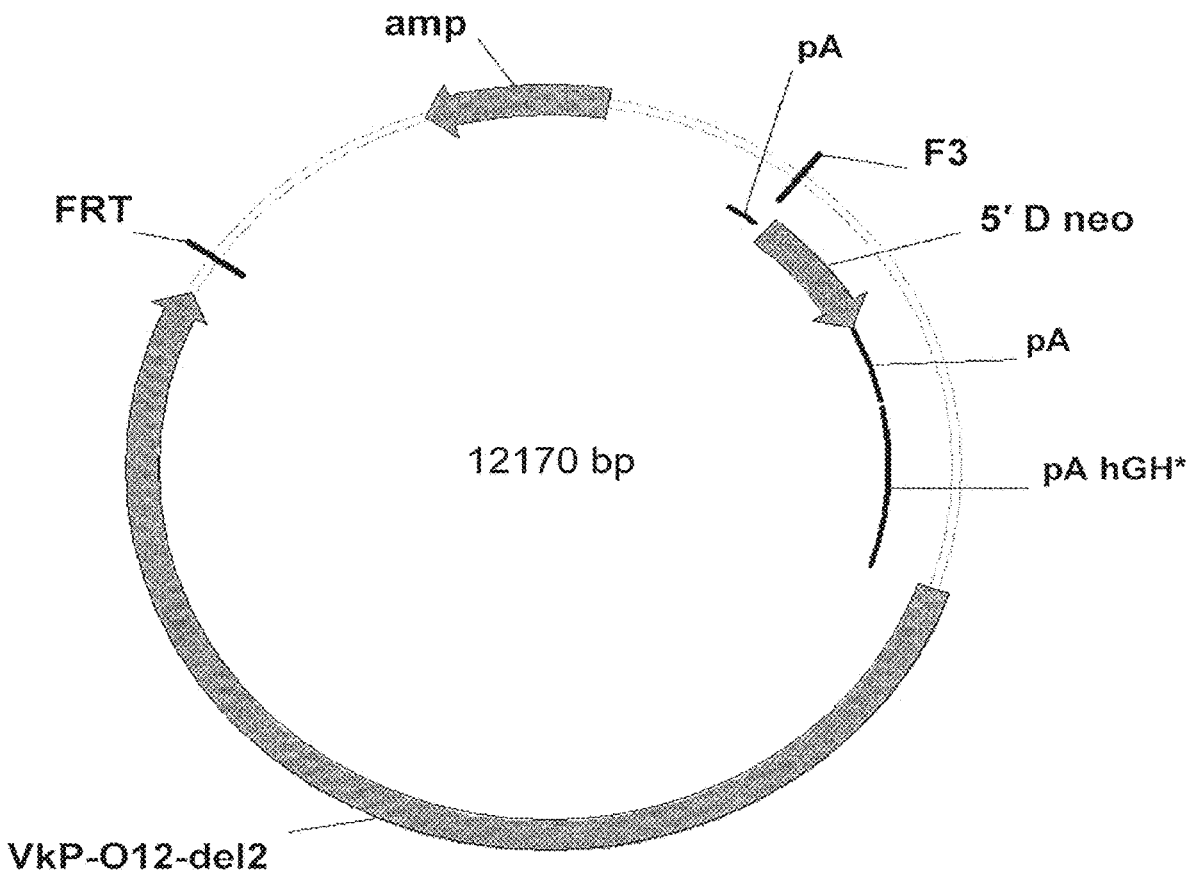
Figure 21C:
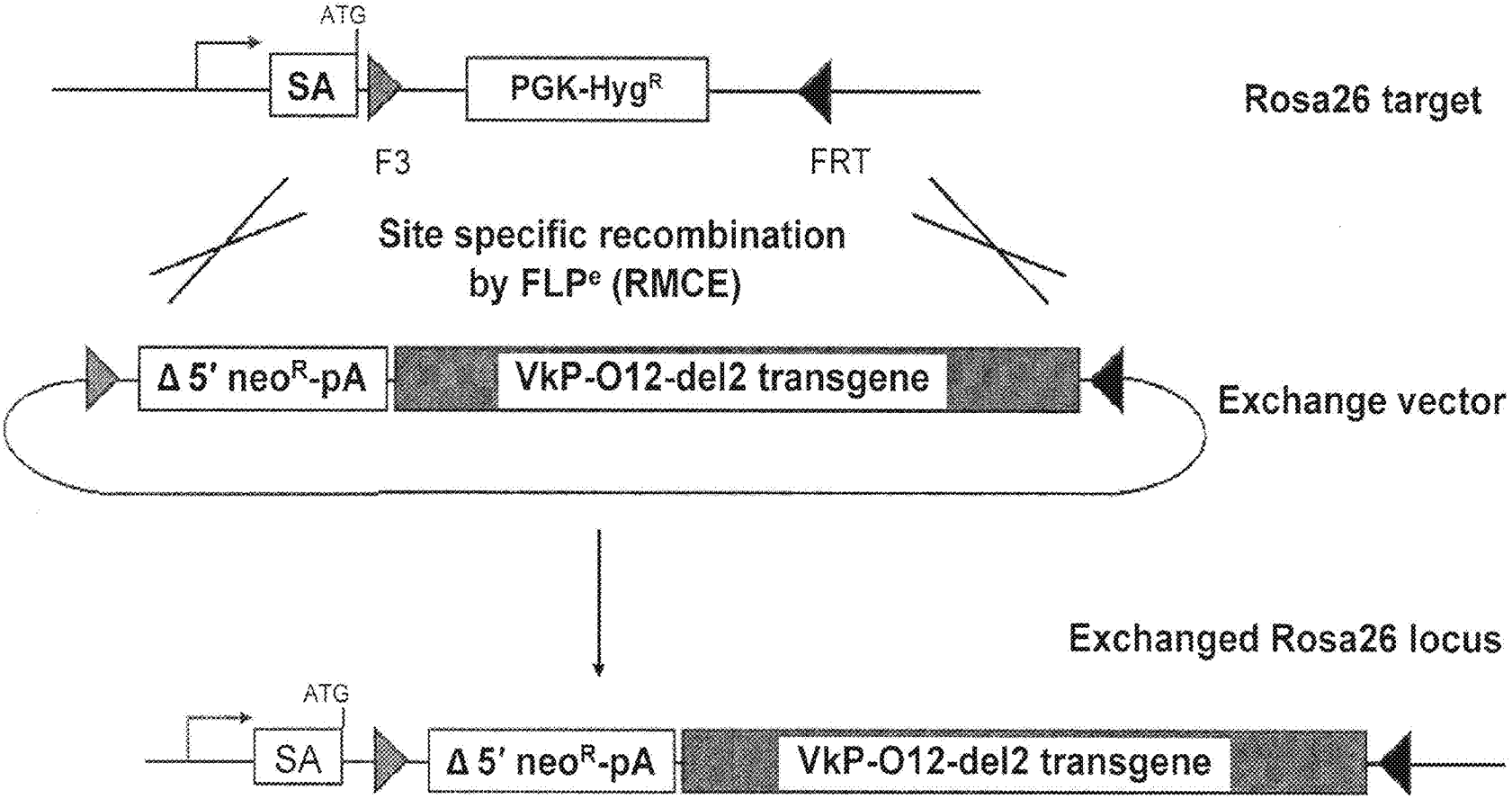

An outline of the pVkP-O12-del2 vector and the targeting strategy is depicted in FIGS. 20C and 21C. The vector was introduced into ES cells following standard procedures (see Example 14).

Example 13: Expression of Vk Constructs in Cell Lines

The constructs described in Examples 9-12 are tested for their ability to produce light chain proteins in the myeloma cell lines MPC11 (ATCC CCL167), B-cell lymphoma WEHI231 (ATCC CRL-1702), the T-cell lymphoma EL4 (ATCC TIB-39) and in HEK293 (ATCC CRL1573). The enhancer and promoter elements in the construct enable expression in the B-cell lines but not in cell lines derived from other tissues. After transfection of the cell lines using purified linearized DNA and Fugene6 (Roche) cells are cultured for transient expression. Cells and supernatant are harvested and subjected to SDS-PAGE analysis followed by western blotting using a specific anti-rat-C-kappa antibody. Supernatants are analyzed in ELISA for secreted L chains using the anti-rat CK antibody (Beckton Dickinson #550336).

Example 14: Generation of Transgenic ES Lines

All constructs as described in Examples 3, 4, 5, 6, 9, 10, 11 and 12 were used to generate individual stable transgenic ES lines by means of homologous recombination. The methods for generation of transgenic ES lines via homologous recombination are known in the field (e.g., Eggan et al., *PNAS* 98:6209-6214; J. Seibler, B. Zevnik, B. Kiiter-Luks, S. Andreas, H. Kern, T. Hennek, A. Rode, C. Heimann, N. Faust, G. Kauselmann, M. Schoor, R. Jaenisch, K. Rajewsky, R. Kiihn, F. Schwenk (2003), *Nucleic Acids Res.*, February 15; 31(4):e12; Hogan et al. (Cold Spring Harbor Laboratory Press, Cold Spring Harbor N. Y.), pp. 253-289).

For all constructs described in Examples 5 and 6, and Examples 9-12, the RMCE ES cell line (derived from mouse strain 129S6B6F1-Gt(ROSA)26Sortm10Arte) was grown on a mitotically inactivated feeder layer comprised of mouse embryonic fibroblasts (MEF) in DMEM High Glucose medium containing 15% FBS (PAN 1302-P220821). Leukemia Inhibitory Factor (Chemicon ESG 1107) was added to the medium at a concentration of 900 U/mL. For manipulation, $2\times10^5$ ES-cells were plated on 3.5 cm dishes in 2 ml medium. Directly before transfection, 2 ml fresh medium was added to the cells. Three μl Fugene6 Reagent (Roche; Catalog No. 1 814 443) was mixed with 100 μl serum free medium (OptiMEM I with Glutamax I; Invitrogen; Catalog No. 51985-035) and incubated for five minutes. One hundred μl of the Fugene/OptiMEM solution was added to 2 μg circular vector and 2 μg CAGGS-Flp and incubated for 20 minutes. This transfection complex was added dropwise to the cells and mixed. Fresh medium was added to the cells the following day. From day 2 onwards, the medium was replaced daily with medium containing 250 μg/mL G418 (Geneticin; Invitrogen; Catalog No. 10131-019). Seven days after transfection, single clones were isolated, expanded, and molecular analyzed by Southern blotting according to standard procedures.

Figure 14A:
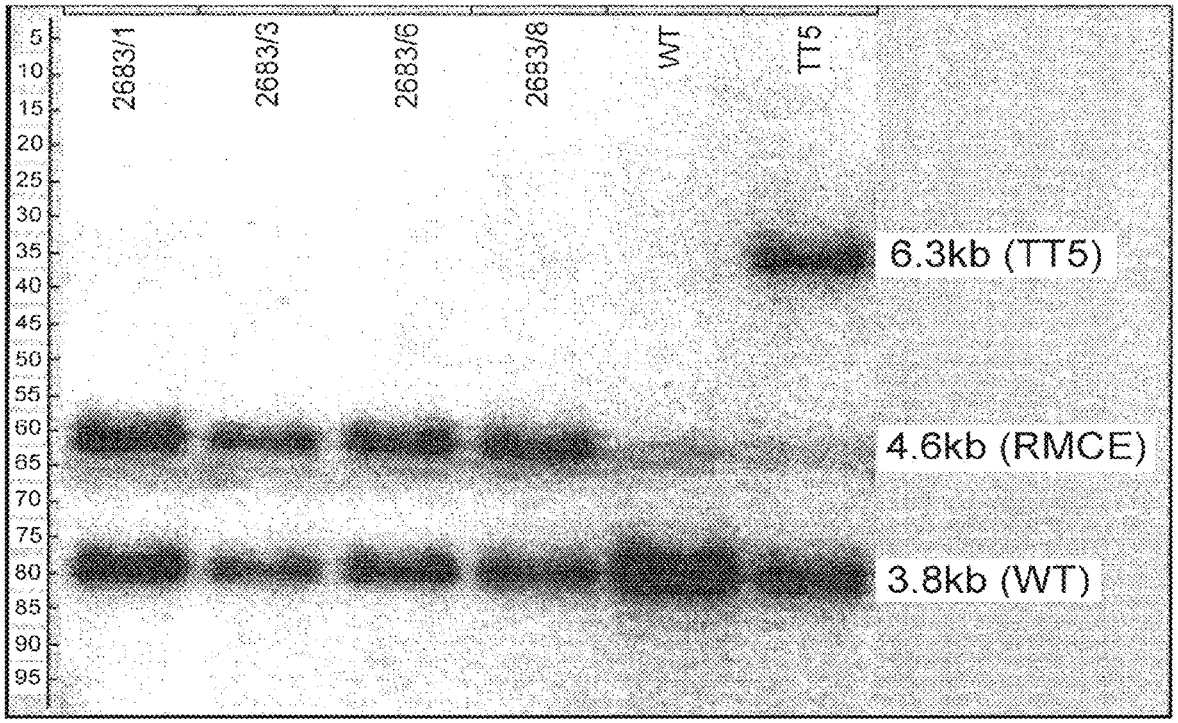
FIGS. 14A-C.
Figure 14B:
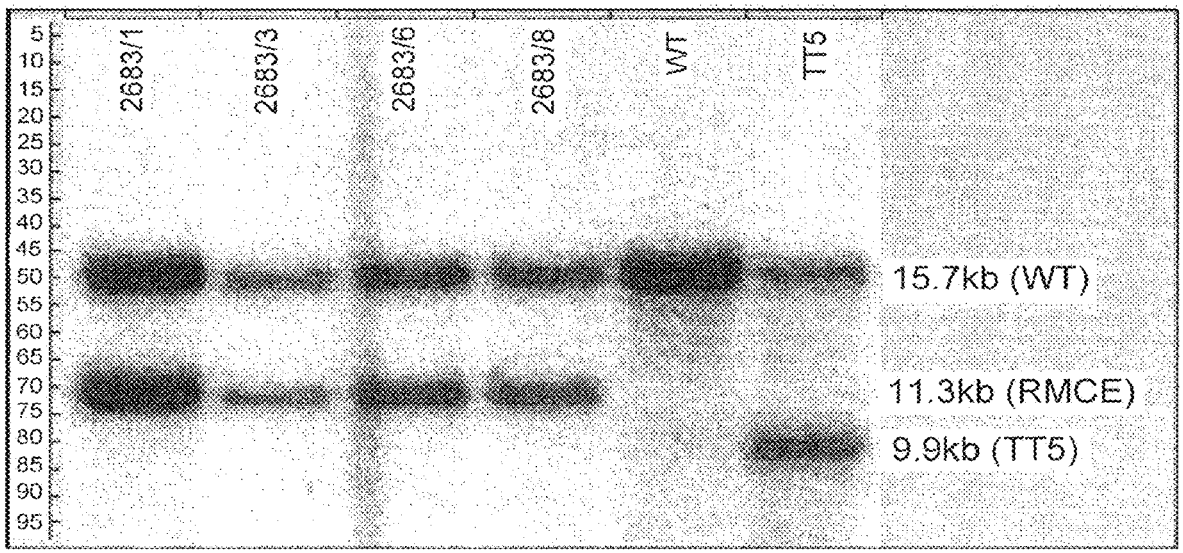
Figure 14C:
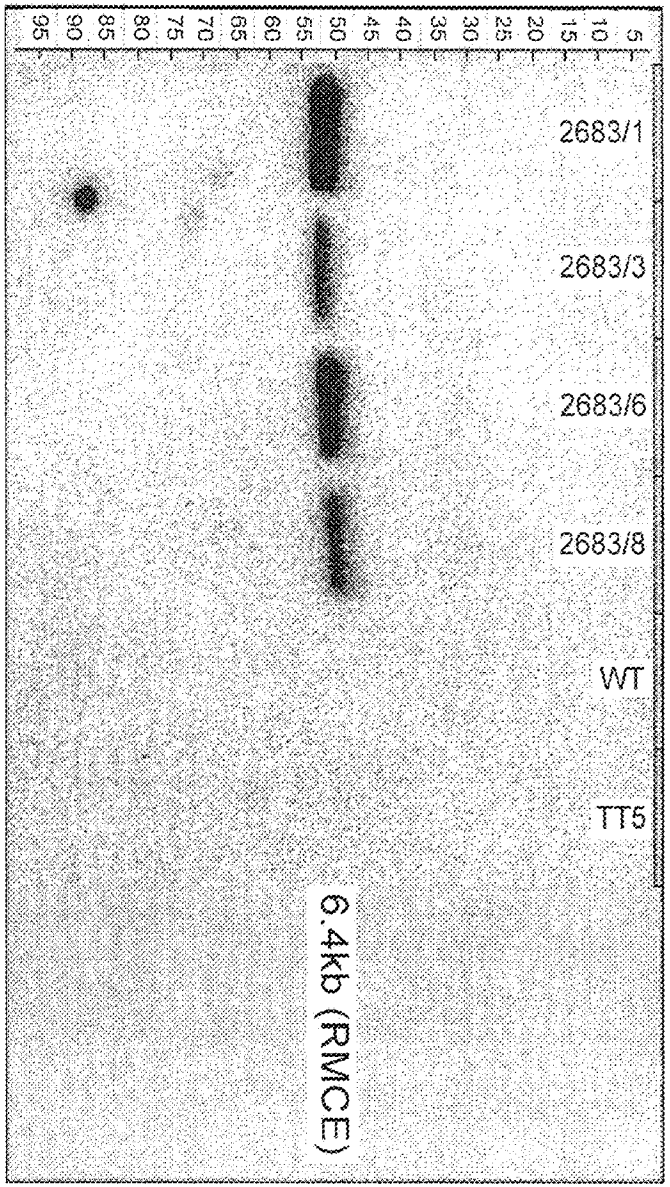

For each construct, analysis of multiple clones by restriction enzyme digestion of genomic DNA of single clones followed by hybridization with 5' probes, 3' probes, and internal probes resulted in clones that comprised a correct, single insertion at the correct position in the Rosa26 locus. An example is provided in FIGS. 14A-C.

Example 15: Generation of Transgenic Mouse Strains

All ES cell lines that were generated and verified for their modifications as described in Example 14 were used to generate stable transgenic mice by means of tetraploid recombination. The methods are known in the field. In general, after administration of hormones, superovulated Balb/c females were mated with Balb/c males. Blastocysts were isolated from the uterus at dpc 3.5. For microinjection, blastocysts were placed in a drop of DMEM with 15% FCS under mineral oil. A flat tip, piezo actuated microinjection-pipette with an internal diameter of 12-15 micrometers was used to inject 10-15 targeted C57BL/6 N.tac ES cells into each blastocyst. After recovery, injected blastocysts were transferred to each uterine horn of 2.5 days post coitum, pseudopregnant NMRI females. Chimerism was measured in chimeras (G0) by coat color contribution of ES cells to the Balb/c host (black/white). Highly chimeric mice were bred to strain C57BL/6 females. Depending on the project requirements, the C57BL/6 mating partners are non-mutant (W) or mutant for the presence of a recombinase gene (Flp-Deleter or Cre-deleter or CreER inducible deleter or combination of Flp-deleter/CreER). Germline transmission was identified by the presence of black, strain C57BL/6, offspring (G1).

For example, ESC clone IgVK1-39 2683 8 (see Examples 5 and 14) was injected in a total of 62 blastocysts in three independent experiments. Three litters were obtained with a total of six pups. All pups were chimeric. Three heterozygous offspring pups were obtained that were used for further crossing.

ESC Clone Kappa 2692 A-CIO (see Examples 3 and 14) was injected in a total of 54 blastocysts in three independent experiments. Three litters were obtained with a total of eleven pups, of which ten were chimeric. Eight heterozygous offspring pups were obtained that were used for further crossing.

ESC Clone Kappa 2692 B-C1 (see Examples 3 and 14) was injected in a total of 51 blastocysts in three independent experiments. Two litters were obtained with a total of six pups, of which four were chimeric. Three heterozygous offspring pups were obtained that were used for further crossing.

Example 16: Breeding

This example describes the breeding for obtaining mice that contain transgenic expression cassettes as described Example 14 and knock-out mice in which the endogenous lambda and kappa loci have been silenced. The localization of V-lambda on chromosome 16 and CD19 on chromosome 7 allow standard breeding procedures. The breeding of the co-localized Vk locus and Rosa26 locus on chromosome 6 with a distance of about 24 cM requires special attention during the screening as only a percentage of the offspring shows crossover in a way that both modifications are brought together on one chromosome.

All four loci have to be combined in a single mouse strain that is homo- or heterozygous for CD19-cre (not described) and modified Rosa26 transgene and homozygous for the other loci. Breeding is performed by standard breeding and screening techniques as appropriate and offered by commercial breeding companies (e.g., TaconicArtemis).

Example 17: Immunizations of Mice

Primary and booster immunization of mice are performed using standard protocols.

To validate the transgenic expression of human rearranged $V_\kappa$ O12 (IGKV1-39)—rat $C_\kappa$ light chains (see Examples 5, 14-16) in B cells from CD19-Hu$V_\kappa$1 mice and to assess its impact on VH repertoire size, diversity of VH family usage and V(D)J recombination after immunization, the CD19-Hu$V_\kappa$1 transgenic mice are immunized with tetanus toxin vaccine (TT vaccine) and VH sequence diversity of randomly picked clones from CD19-Hu$V_\kappa$1 mice are compared with TT-immunized wt mice and CD19-Cre HuVk1 negative littermates. Data on the SHM frequency of the human $V_\kappa$ O12 transgene in the immunized mice are obtained. A diverse collection of at least 40 TT-specific, clonally-unrelated mAbs containing the human $V_\kappa$ O12 are recovered from CD19-Hu$V_\kappa$1 mice by phage display.

For this, three adult CD19-Hu$V_\kappa$1 mice are vaccinated with TT vaccine using standard immunization procedures. After immunization, serum titers are measured using TT specific ELISA (TT: Statens Serum Institute, Art. no. 2674) and spleen suspensions subjected to cell sorting by the FACS procedure after staining with a rat $C_\kappa$-specific monoclonal antibody to isolate transgenic B cells (clone RG7/9.1; BD Pharmingen #553901, Lot #06548). RNA from rat $C_\kappa$-positive B cells are extracted and the resulting cDNA material used for library building and SHM analysis.

The standard monoclonal mouse anti-rat CK antibody (clone RG7/9.1; BD Pharmingen #553901, Lot #06548) is used in FACS analysis of transgene expressing B cells (Meyer et al. (1996), *Int. Immunol.* 8:1561). The clone RG7/9.1 antibody reacts with a monotypic (common) kappa chain determinant. This anti-rat CK antibody (clone RG7/9.1 (BD Pharmingen #553901, Lot #06548) is labeled with R-phycoerythrin (PE) using the LYNX rapid conjugation kit according to the manufacturer's instructions for FACS analysis and sorting. The labeled antibody is firstly tested by flow cytometry for binding to rat $C_\kappa$-containing functional light chain proteins produced into transiently transfected HEK-293T cells; the un-conjugated antibody serves as a positive control. Two other antibodies shown to bind to rat $C_\kappa$ by ELISA and Western-blot (see Example 7) are tested as well by flow cytometry.

Fab-phage display library building is carried out with a set of optimized degenerate PCR primers designed to amplify C57BL/6 VH genes; the minimal library size is $10^6$ clones, and minimal insert frequency is 80%. The vector used, MV1043 (FIGS. 3 and 12), contains the human VK O12 fused to a human CK region. The rat CK is therefore exchanged for the human counterpart in the library generation process.

Before selection, VH sequencing of 96 randomly picked clones is performed to validate VH repertoire diversity that is compared to diversity obtained from an unselected library previously generated using the same procedures from BALB/c mice immunized with TT. A library from C57Bl/6 wt mice that are immunized in the same way allows diversity comparison between two preselected libraries sharing the same vaccine and the same genetic background.

Several independent selections are performed on TT coated in immunotubes. Variables that may be included are selections using biotinylated antigens in solution or selections on captured TT. Based on the number and diversity of ELISA-positive clones obtained in the first selections, decisions on additional rounds of selection are made. Clones are considered positive when>3× positive over a negative control clone. Positive clones are analyzed by ELISA against a panel of negative control antigens to verify antigen specificity. The aim is to identify at least 40 unique VH regions, as based on unique CDR3 sequences and $V_HDJ_H$ rearrangements.

Amplification of the cDNA material from rat CK-positive sorted B cells is performed with a PCR forward primer specific to the human leader sequence and a PCR reverse primer specific to the rat CK sequence, in a region not redundant with the mouse CK sequence, as reported in a recent study (Brady et al. (2006), *JIM* 315:61). Primer combinations and annealing temperatures are firstly tested on cDNA from HEK-293T cells transfected with 0817676_pSELECT_0815426=pSELECT vector with IGKV1-39 DNA cassette (see Example 7).

The amplification products is cloned in pJET-1 vector and after XL1-blue transformation, 96 colonies are sequenced for assessing VL SHM frequency by direct comparison to the $V_\kappa$ O12 (IGKV1-39) germline sequence. The R/S ratio method, as described in our study on human TT-specific antibodies (de Kruif et al. (2009), *J. Mol. Biol.* 387:548) allows discrimination between random mutations and antigen-driven mutations that occurred on VL sequences.

Example 18: Immunofluorescent Analysis of B Cell Populations in Transgenic Mouse Lines This example describes the use of antibodies and flow cytometry to analyze B cell populations in primary (bone marrow) and secondary (spleen, peritoneal) lymphoid organs and blood. Methods and reagents are described in Middendorp et al. (2002), *J. Immunol.* 168:2695; and Middendorp et al. (2004), *J. Immunol.* 172:1371. For analysis of early B cell development in bone marrow, cells were surface stained with combinations of antibodies (Becton Dickinson) specific for B220, CD19, CD25, IgM, IgD, mouse Ckappa, mouse Clambda and rat Ckappa to detect pro-B cells, pre-B cells, large pre-B cells, early and late immature B cells and recirculating B cell populations expressing the transgene on their surface. DAPI staining (Invitrogen) was included to exclude dead cells from the analysis and FC block (Becton Dickinson) to inhibit antibody interaction with Fc receptors on myeloid cells. For analysis of surface transgene expression on B cell populations in peripheral lymphoid organs and blood, cells were stained with combinations of antibodies (Becton Dickinson) specific for B220, CD5, CD19, CD21, CD23, IgM, IgD, mouse Ckappa, mouse Clambda and rat Ckappa. DAPI staining was included to exclude dead cells from the analysis and FC block to inhibit antibody interaction with Fc receptors on myeloid cells. In addition, combinations of antibodies (Becton Dickinson) specific for CD3, CD4, CD11b, CD11c and NK1.1 were included to determine if transgene expression occurred in cell types outside of the B cell compartment.

Three mice heterozygous for the human IGKV1-39/rat Ckappa transgene and heterozygous for the CD19-Cre transgene on a C57BL6 background (HuVk1/CD19-Cre) were analyzed. As controls for the FACS analysis, three littermate mice wild-type for the human IGKV1-39/rat Ckappa transgene and heterozygous for the CD19-Cre transgene on a C57BL6 background (CD19-Cre) and two C57BL6/NTac mice (Wt) were included. All animals were allowed to acclimatize in the animal facility for one week before analysis and all mice were male and six weeks of age. Lymphocytes were isolated from the femurs, spleens, peritoneal cavity and blood of mice using conventional techniques as previously described (Middendorp et al. (2002), *J. Immunol.* 168:2695; and Middendorp et al. (2004), *J. Immunol.* 172:1371). Antibodies were pre-combined as shown in FIGS. 29A-B and staining was carried out in 96-well plates. Incubation with the PE-conjugated anti-rat C kappa (described above) was carried out before staining with the rat anti-murine antibodies to avoid non-specific binding. After completion of cell staining, labeled cells were analyzed on a Becton Dickinson LSR II FACS machine and the acquired data analyzed with FlowJo software (v6.4.7).

Transgenic mice were similar in weight, appearance and activity to wild-type mice. No gross anatomical alterations were observed during the harvesting of tissues. No difference was observed in the numbers of B cells in the bone marrow (BM) and spleen (Table 9) or in the numbers of B cells, T cells and myeloid cells in peripheral organs between transgenic and wild-type mice. In addition, the frequency or proportion of the cells in the different lymphocyte developmental pathways was not altered in transgenic mice when compared to wild-type mice. Thus in the double transgenic (HuVk1/CD19-Cre) and transgenic (CD19-Cre) mice lymphoid and most importantly B cell development was indistinguishable from wild-type mice.

Figure 24:
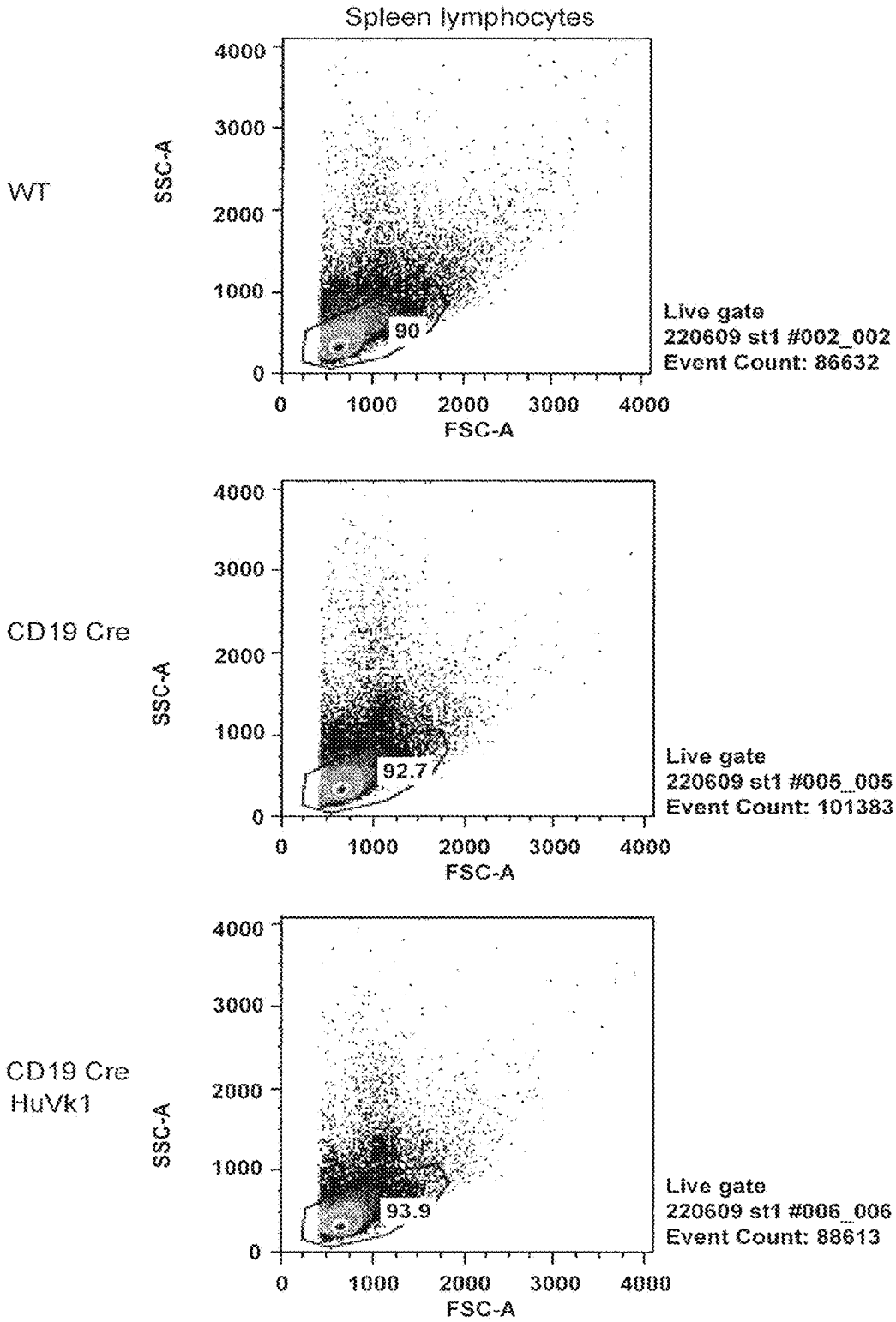
FIG. 24: Transgenic human Vk1 light chain is expressed in all B cell populations of the spleen.
Figure 25:
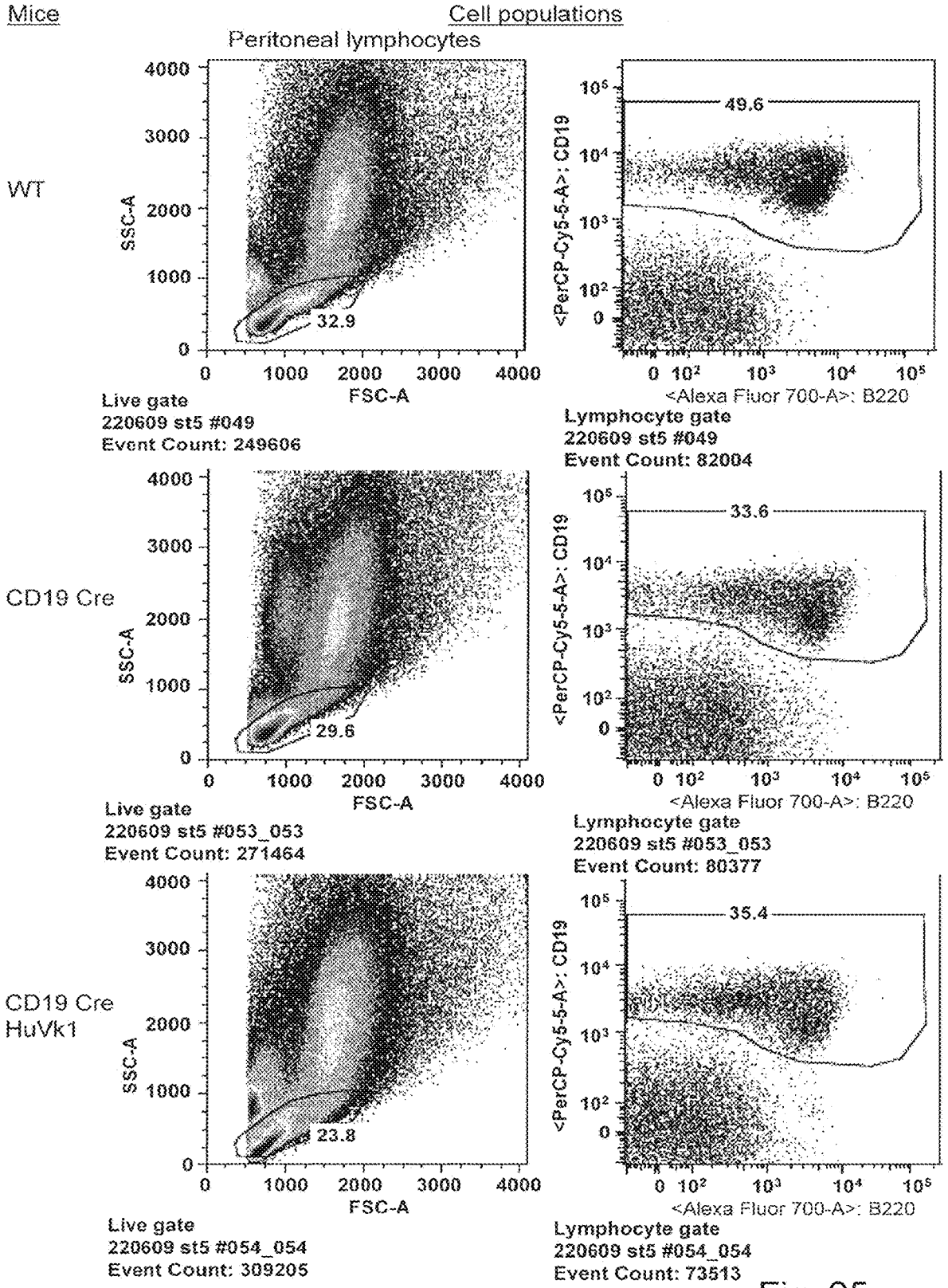
FIG. 25: Transgenic human Vk1 light chain is expressed in B1 cells of the peritoneal cavity.

In the peripheral lymphoid organs, staining with the transgene specific antibody (anti-ratCkappa-PE) was only observed in the B cell populations. T cell, myeloid cell and NK cell populations were all negative for surface expression of the transgene in the spleen (FIG. 23). In contrast, in cells stained with the pan B cell markers B220 and CD19 all cells were shifted to the right in the FACS plot indicating cell surface expression of the transgene (FIG. 24). A similar transgene-specific staining was measured in $CD5^+$ B1 cells of the peritoneum, a developmentally distinct population of B cells (FIG. 25).

Figure 26A:
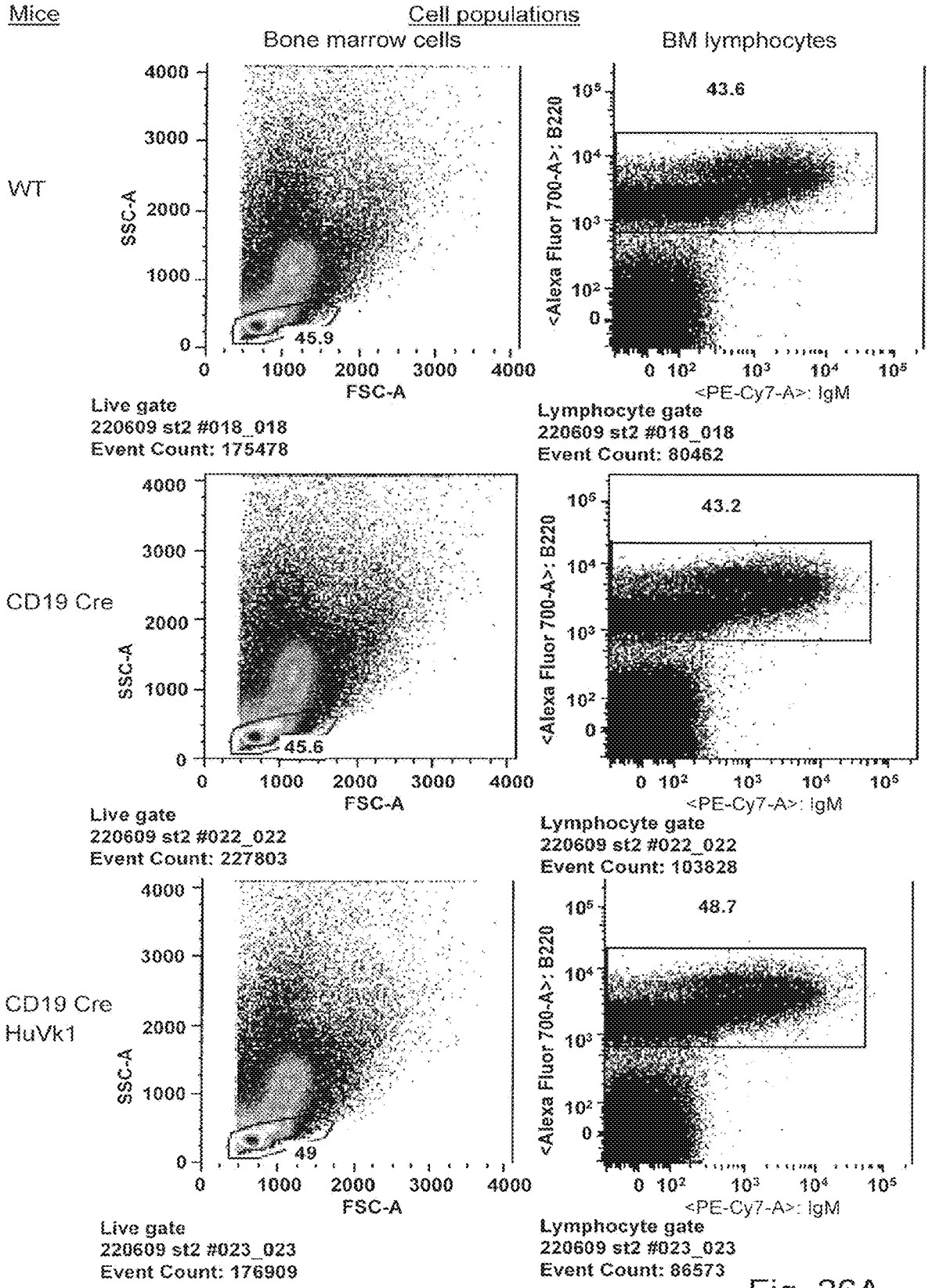
FIGS. 26A-B: Transgenic human Vk1 light chain is not expressed in pro- and pre-B cells but in the immature and recirculating populations B cells in the bone marrow.
Figure 26B:
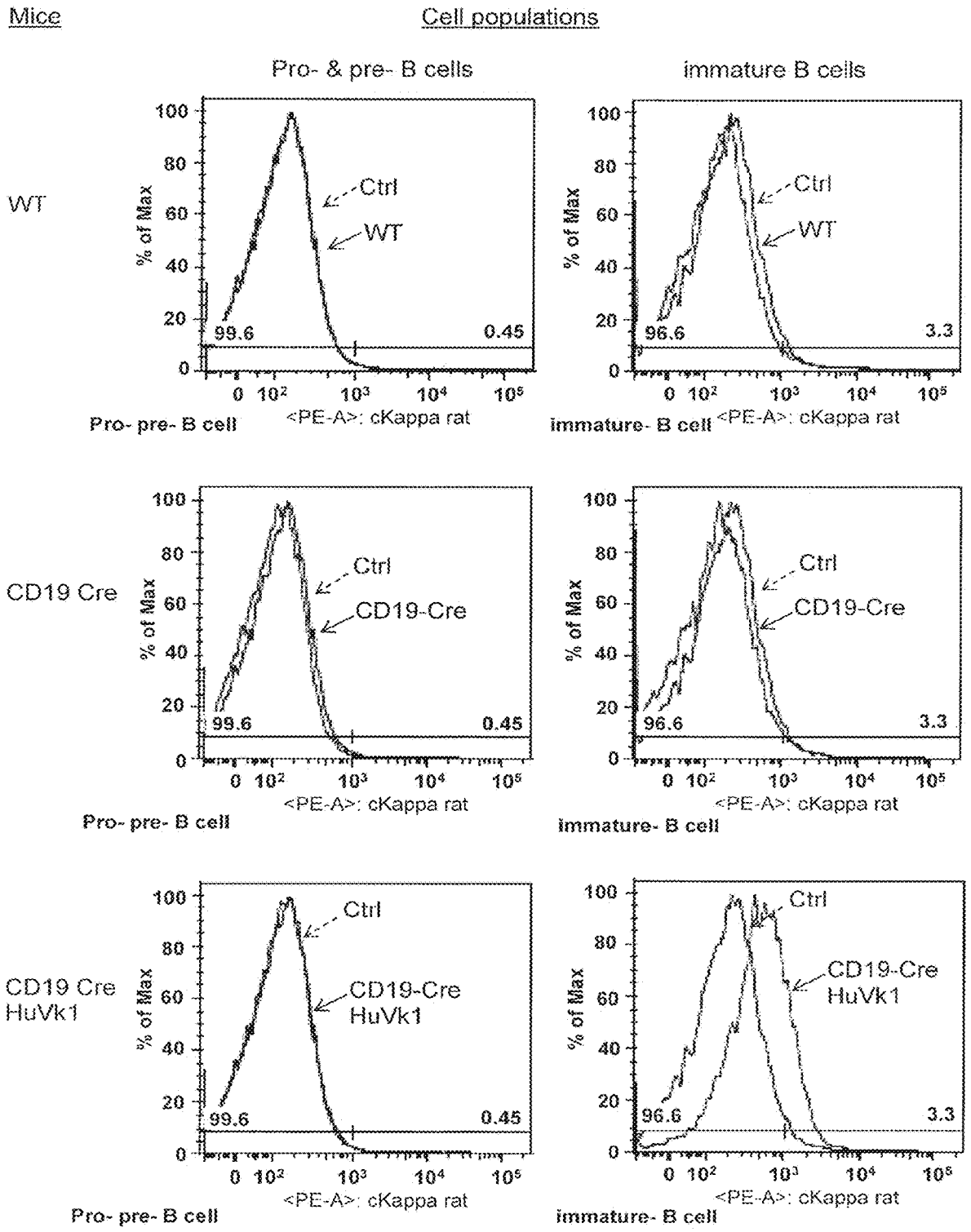
Figure 27:
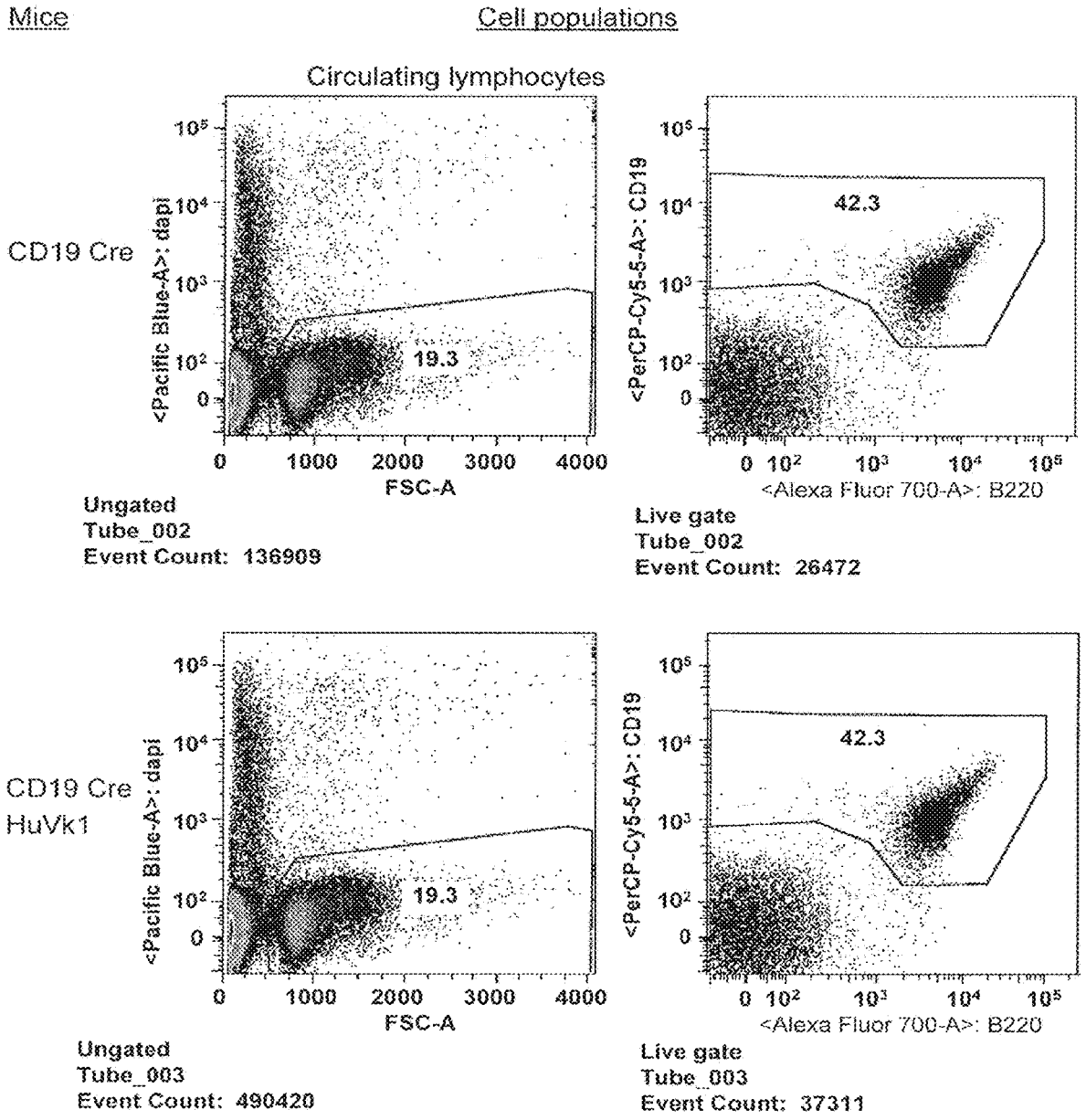
FIG. 27: Transgenic human Vk1 light chain is directly correlated with endogenous light chain and IgM expression in circulating B cells in the blood.

Differentiation of B cells from multilineage precursors to mature B cells occurs in the bone marrow. In the lymphocytes analyzed from the bone marrow, extracellular and transgene expression was not detectable in the earliest B cell progenitors the pro- and pre-B cell consistent with the pattern of normal light chain expression (FIGS. 26A-B). Transgene expression first becomes detectable in immature B cells, the developmental stage at which the germline murine light chain undergoes rearrangement and is expressed at the cell surface in the context of the preselected heavy chain (FIGS. 26A-B). Consistent with the staining in the spleen transgenic light chain expression is also detected on mature recirculating B cells (FIGS. 26A-B). Thus the CD19-Cre driven expression of the transgene is consistent with the normal pattern of light chain expression. The staining with the endogenous light chain-specific antibody is more intense than that of the transgene-specific light chain antibody. This may indicate a higher expression level of the endogenous light chain, a more sensitive staining with the endogenous light chain-specific antibody or a combination of both. Importantly, the intensity of the surface expression of the transgenic light chain is correlated with both endogenous light chain and IgM surface expression as observed in staining of circulating B cells in the blood (FIG. 27).

Thus, overall this analysis demonstrates that expression of the human IGKV1-39/Ckappa transgene is restricted to the B cell compartment and the temporal regulation of its expression is similar to the endogenous kappa and lambda light chains resulting in normal development of all B cell populations. The apparent lower level of expression of the transgene could be explained by the strength of the promoter in comparison to the promoter and enhancers present on endogenous light chain genes or by a delay in transgene expression that gives the endogenous light chains a competitive advantage in pairing with the rearranged heavy chain. This is consistent with the observation that as B cells mature the relative intensity of transgene staining increases compared to the endogenous light chains. In addition, the observation that B cells numbers are normal and that every surface Ig+ B cell co-expresses an endogenous and transgenic light chain supports the conclusion that the IGKV1-39 variable region is capable of pairing with a normal repertoire of different murine heavy chain variable regions. We conclude from this analysis that insertion of the IGKV1-39/rat Ckappa transgene driven by the CD19-Cre activated CAGGS promoter in the Rosa locus facilitates timely and B cell-specific expression of the transgene and that the transgene is capable of pairing with a normal repertoire of murine heavy chains.

Example 19: Epibase® T-Cell Epitope Profile for IGKV1-39

The protein sequence of IGKV1-39 (FIG. 12, human germline IGKV1-39/J Protein) was scanned for the presence of putative HLA class II restricted epitopes, also known as $T_H$-epitopes. For this, Algonomics' Epibase® platform was applied to IGKV1-39. In short, the platform analyzes the HLA binding specificities of all possible 10-mer peptides derived from a target sequence (Desmet et al. (1992), *Nature* 356:539-542; Desmet et al. (1997), *FASEB J.* 11:164-172; Desmet et al. (2002), *Proteins* 48:31-43; Desmet et al. (2005), *Proteins* 58:53-69). Profiling is done at the allotype level for 20 DRB1, 7 DRB3/4/5, 13 DQ and 7 DP, i.e., 47

HLA class II receptors in total (see Table 5). Epibase® calculates a quantitative estimate of the free energy of binding $\Delta G_{bind}$ of a peptide for each of the 47 HLA class II receptors. These data were then further processed as follows:

Free energies were converted into Kd-values through $\Delta G_{bind}$=RT ln(Kd).

Peptides were classified as strong (S), medium (M), weak and non (N) binders. The following cutoffs were applied:

S: strong binder: Kd<0.1 μM.

M: medium binder: 0.1 μM≤Kd<0.8 μM.

N: weak and non-binder: 0.8 μM≤Kd.

Peptides corresponding to self-peptides were treated separately. The list of self-peptides was taken from 293 antibody germline sequences. They are referred to as "germline-filtered" peptides.

S- and M-peptides are mapped onto the target sequence in so-called epitope maps; S-affinities are plotted quantitatively; M-values are presented qualitatively. As a general overview of the results, Table 6 lists the number of strong and medium binders in the analyzed proteins, for the groups of HLA class II receptors corresponding to the DRB1, DQ, DP and DRB3/4/5 genes. Counting was done separately for strong and medium affinity binders. Peptides binding to multiple allotypes of the same group were counted as one. Values between brackets refer to germline-filtered peptides. In Table 7, the sequence is shown in a format suitable for experimental work. The sequence is broken down in consecutive 15-mers overlapping by 12 residues. For each 15-mer, the promiscuity is listed (the number of allotypes out of a total of 47 for which the 15-mer contains a critical binder), as well as the implied serotypes. The Epibase® profile and epitope maps are shown in FIGS. 16A-C and 17.

It was concluded that IGKV1-39 contains no strong non-self DRB1 binders. Typically, significantly more binders were found for DRB1 than for other HLA genes. This is in agreement with experimental evidence that allotypes belonging to the DRB1 group are more potent peptide binders. Medium strength epitopes for DRB1 allotypes are expected to contribute to the population response, and cannot be disregarded. Again, no non-self DRB1 binders were found in IGKV1-39.

In the humoral response raised against an antigen, the observed $T_H$ cell activation/proliferation is generally interpreted in terms of the DRB1 specificity. However, one cannot ignore the possible contribution of the DRB3/4/5, DQ and DP genes. Given the lower expression levels of these genes as compared to DRB1, the focus was on the class of strong epitopes for DRB3/4/5, DQ and DP. "Critical epitopes" are those epitopes that are strong binders for any DRB1, DRB3/4/5, DQ or DP allotype or are medium binders for DRB1. IGKV1-39 contains no strong or medium non-self binders for DRB3/4/5, DQ, or DP.

A number of peptides are also present in germline sequences (values between brackets in Table 6). Such peptides may very well bind to HLA but they are assumed to be self and, hence, non-immunogenic. In total, six strong and 16 medium germline-filtered DRB1 binders were found in IGKV1-39. Framework region 1 up to framework region 3 is an exact match for germline V-segment VKI 2-1-(1) O12 (VBase), a.k.a. IGKV1-39*01 (IMGT). Framework region 4 is an exact match for germline J-segment JK1 (V-base) a.k.a. IGKJ1*01(IMGT). It is hardly surprising that these segments do not contain any non-self epitopes.

Example 20: Production Characteristics of IGKV1-39

There is a great demand for antibody discovery platforms that yield therapeutic antibodies that are thermodynamically stable and give good expression yields. These characteristics are important in ensuring the stability of the drug substance during production and after injection of the drug product into the patient. In addition good expression yields impact directly on the cost of drug manufacture and thus pricing, patient access and profitability. Virtually all therapeutic antibodies in clinical use today are composed of human IgG1 and kappa constant regions but use different heavy and light chain variable regions that confer specificity. Human variable heavy and light chain domains can be divided into families that have greater than 80% sequence divergence. When rearranged examples of these families in germline configuration are combined and compared for stability and yield it is clear that the gene families are not equal in terms of biophysical properties. In particular $V_H3$, $V_H1$ and $V_H5$ have favourable stability for the heavy chains and Vk1 and Vk3 have the best stability and yield of light chains. In addition when mutations are introduced as part of the somatic hypermutation process they can interfere with $V_H/V_L$ pairing. To assess the effect that different light chain genes with different rates of mutation have on the production characteristics of a fixed $V_H$ chain, a Fab phage display library was built of light chains (kappa and lambda) from six naïve healthy donors combined with a panel of 44 TT binding heavy chains from immunized donors. After one round of selection TT binding Fab clones were isolated. Several of these shared the same $V_H$ gene as the TT clone PG1433 in combination with different light chains. The Fab light chain fragments were recloned into a kappa expression vector and transfected in combination with DNA encoding the heavy chain of PG1433 into 293 cells and specific IgG production measured by ELISA. As demonstrated in Table 8 the selected clones containing PG1433 $V_H$ combined with different light chains had between five- and ten-fold lower protein expression PG1433 $V_H$ combined with IGKV1-39. Note that all of the light chains contained amino acid mutations within their coding regions that might disrupt $V_H$ paring and reduce production stability. Thus, in addition to reducing the chances of unwanted immunogenicity, it is expected that the use of the light chain IGKV1-39 without mutations contributes to improved production stability and yields of various specificity-contributing $V_H$ genes. Indeed stable clones generated by the transfection of different $V_H$ genes all paired with IGKV1-39 are able to be passaged extensively and still retain robust production characteristics as shown in FIG. 28.

Example 21: Generation of Mice Expressing Fully Human VH and VL Regions

Transgenic mice described herein are crossed with mice that already contain a human VH locus. Examples of appropriate mice comprising a human VH locus are disclosed in Taylor et al. (1992), *Nucleic Acids Res.* 20:6287-95; Lonberg et al. (1994), *Nature* 368:856-9; Green et al. (1994), *Nat. Genet.* 7:13-21; Dechiara et al. (2009), *Methods Mol. Biol.* 530:311-24.).

After crossing and selecting for mice that are at least heterozygous for the IGKV1-39 transgene and the human VH locus, selected mice are immunized with a target. VH genes are harvested as described hereinabove. This method has the advantage that the VH genes are already fully human and thus do not require humanization.

Example 22: Isolation, Characterization, Oligoclonics Formatting and Production of Antibodies Targeting Human IL6 for Treatment of Chronic Inflammatory Diseases Such as Rheumatoid Arthritis A spleen VH repertoire from transgenic mice that are immunized with human recombinant IL6 is cloned in a phage display Fab vector with a single human IGKV1-39-C kappa light chain (identical to the mouse transgene) and subjected to panning against the immunogen human IL6. Clones that are obtained after two to four rounds of panning are analyzed for their binding specificity. VH genes encoding IL6-specific Fab fragments are subjected to sequence analysis to identify unique clones and assign VH, DH and JH utilization. The Fab fragments are reformatted as IgG1 molecules and transiently expressed. Unique clones are then grouped based on non-competition in binding assays and subjected to affinity and functional analysis. The most potent anti-IL6 IgG1 mAbs are subsequently expressed as combinations of two, three, four or five heavy chains comprising different VH-regions in the Oligoclonics format, together with one IGKV1-39-C-based kappa light chain and tested in vitro for complex formation with IL-6. The Oligoclonics are also tested in vivo for clearance of human IL-6 from mice. An Oligoclonic with the most potent clearance activity is chosen and the murine VH genes humanized according to conventional methods. The humanized IgG1 are transfected into a mammalian cell line to generate a stable clone. An optimal subclone is selected for the generation of a master cell bank and the generation of clinical trial material.

Many of the protocols described here are standard protocols for the construction of phage display libraries and the panning of phages for binding to an antigen of interest and are described, for example, in *Antibody Phage Display: Methods and Protocols* (2002), Editor(s) Philippa M. O'Brien, Robert Aitken, Humana Press, Totowa, N.J., USA.

Immunizations

Transgenic mice receive three immunizations with human IL6 every two weeks using the adjuvant Sigma titerMax according to manufacturer's instructions.

RNA Isolation and cDNA Synthesis

Three days after the last immunization, spleens and lymphnodes from the mice are removed and passed through a 70 micron filter into a tube containing PBS pH 7.4 to generate a single cell suspension. After washing and pelleting of lymphocytes, cells are suspended in TRIzol LS Reagent (Invitrogen) for the isolation of total RNA according to the manufacturer's protocol and subjected to reverse transcription reaction using 1 microgram of RNA, Superscript III RT in combination with dT20 according to manufacturer's procedures (Invitrogen).

The generation of Fab phage display libraries is carried out as described in Example 2.

Selection of Phages on Coated Immunotubes

Human recombinant IL6 is dissolved in PBS in a concentration of 5 μg/ml and coated to MAXISORP™ Nunc-Immuno Tube (Nunc 444474) overnight at 4° C. After discarding the coating solution, the tubes are blocked with 2% skim milk (ELK) in PBS (blocking buffer) for one hour at Room Temperature (RT). In parallel, 0.5 ml of the phage library is mixed with 1 ml blocking buffer and incubated for 20 minutes at room temperature. After blocking the phages, the phage solution is added to the IL6-coated tubes and incubated for two hours at RT on a slowly rotating platform to allow binding. Next, the tubes are washed ten times with PBS/0.05% TWEEN™-20 detergent followed by phage elution by incubating with 1 ml 50 mM glycine-HCl pH 2.2 ten minutes at RT on rotating wheel and directly followed by neutralization of the harvested eluent with 0.5 ml 1 M Tris-HCl pH 7.5.

Harvesting Phage Clones

A 5 ml XL1-Blue MRF (Stratagene) culture at O.D. 0.4 is added to the harvested phage solution and incubated for 30 minutes at 37° C. without shaking to allow infection of the phages. Bacteria are plated on Carbenicillin/Tetracycline 4% glucose 2*TY plates and grown overnight at 37° C.

Phage Production

Phages are grown and processed as described by Kramer et al. 2003 (Kramer et al. 2003, *Nucleic Acids Res.* 31(11): e59) using VCSM13 as helper phage strain.

Phage ELISA

ELISA plates are coated with 100 microliters human recombinant IL6 per well at a concentration of 2.5 micrograms/ml in PBS overnight at 4° C. Plates coated with 100 microliters thyroglobulin at a concentration of 2 micrograms/ml in PBS are used as a negative control. Wells are emptied, dried by tapping on a paper towel, filled completely with PBS-4% skimmed milk (ELK) and incubated for one hour at room temperature to block the wells. After discarding the block solution, phage minipreps pre-mixed with 50 μl blocking solution are added and incubated for one hour at RT. Unbound phages are subsequently removed by five washing steps with PBS-0.05% Tween-20. Bound phages are detected by incubating the wells with 100 microliters anti-M13-HRP antibody conjugate (diluted 1/5000 in blocking buffer) for one hour at room temperature. Free antibody is removed by repeating the washing steps as described above, followed by TMB substrate incubation until color development was visible. The reaction is stopped by adding 100 microliters of 2 M H2SO4 per well and analyzed on an ELISA reader at 450 nm emission wavelength.

Sequencing

Clones that give signals at least three times above the background signal are propagated, used for DNA miniprep procedures (see procedures Qiagen miniPrep manual) and subjected to nucleotide sequence analysis. Sequencing is performed according to the Big Dye 1.1 kit accompanying manual (Applied Biosystems) using a reverse primer (CH1_Rev1, Table 1) recognizing a 5' sequence of the CH1 region of the human IgG1 heavy chain (present in the Fab display vector MV1043, FIGS. 3 and 12). The sequences of the murine VH regions are analyzed for diversity of DH and JH gene segments.

Construction and Expression of Chimeric IgG1

Figure 22:
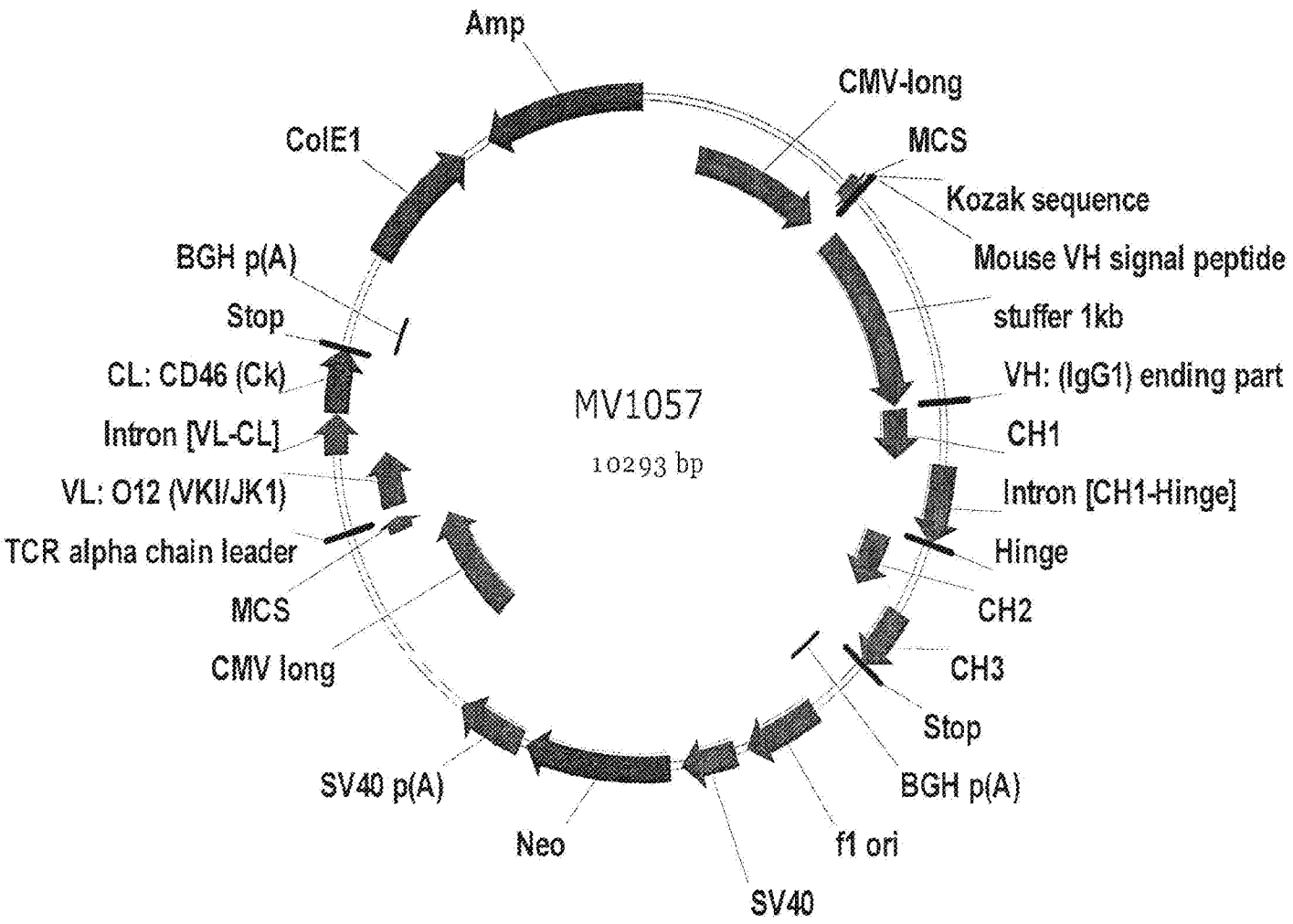
FIG. 22: Topology of the MV1057 vector. Replacing the indicated stuffer fragment with a VH fragment yields an expression vector that can be transfected to eukaryotic cells for the production of IgG1 antibodies with light chains containing an O12 (IGKV1-39) VL gene.

Vector MV1057 (FIGS. 12 and 22) was generated by cloning the transgene (IGKV1-39) L chain fragment into a derivative of vector pcDNA3000Neo (Crucell, Leiden, The Netherlands) that contains the human IgG1- and kappa constant regions. VH regions are cloned into MV1057 and nucleotide sequences for all constructs are verified according to standard techniques. The resulting constructs are transiently expressed in HEK293T cells and supernatants containing chimeric IgG1 are obtained and purified using standard procedures as described before (M. Throsby 2006, *J. Virol.* 80:6982-92).

IgG1 Binding and Competition Analysis

IgG1 antibodies are titrated in ELISA using IL6-coated plates as described above and an anti-human IgG peroxidase conjugate. Competition ELISAs to group antibodies based on epitope recognition are performed by incubating Fab phages together with IgG1 or with commercial antibodies against IL6 (e.g., Abcam cat. no. ab9324) in IL6-coated plates, followed by detection of bound Fab phage using an anti-M13 peroxidase conjugate.

IgG1 Affinity Measurements

The affinities of the antibodies to IL6 are determined with the Quantitative kinetic protocol on the Octet (ForteBio). Antibodies are captured onto an Anti-Human IgG Fc Capture biosensor and exposed to free IL6 and analyzed using proprietary software to calculate the Kd of each antibody.

Functional Activity of IL6 Antibodies

To test the ability of the selected antibodies to inhibit binding between IL6 and IL6 receptor (IL6R), an ELISA based assay is used. Various concentrations of antibody are mixed with a fixed concentration (10 ng/ml) of biotinylated IL6 as described by Naoko et al. 2007, *Can. Res.* 67:817-875. The IL6-antibody immune complex is added to immobilized IL6R. The binding of biotinylated IL6 to IL6R is detected with horseradish peroxidase-conjugated streptavidin. The reduction of ELISA signal is a measurement of inhibition. As positive control for inhibition of binding between IL6 and IL6R either anti-IL6R antibody (Abcam cat. no. ab34351; clone B-R6) or anti IL6 antibody (Abcam cat. no. ab9324) is used.

In vitro blocking activity of the selected anti-IL6 antibodies is measured in a proliferation assay using the IL6-dependent cell line 7TD1. Briefly, cells are incubated with different concentrations of human IL6 with or without the anti-IL6 antibody. The available amount of IL6 determines the degree of proliferation. Thus if an added antibody blocks IL6 binding the proliferation readout is reduced compared to a non binding antibody control. Proliferation is measured by the incorporation of 5-bromo-2'-deoxy-uridine (BrdU) into the DNA using the BrdU proliferation kit (Roche cat. no. 11444611001) according to the manufacturer's instructions.

Generation of Anti-IL6 Oligoclonics

The most potent anti-IL6 antibodies are selected from each epitope group. The expression constructs expressing these antibodies are transfected into HEK293T cells in non-competing groups of three in different ratios (1:1:1; 3:1:1; 1:3:1; 1:1:3; 3:3:1; 1:3:3; 3:1:3; 10:1:1; 1:10:1; 1:1:10; 10:10:1; 1:10:10; 10:1:10; 3:10:1; 10:3:1; 1:10:3; 3:1:10; 10:1:3; 1:3:10). Antibody containing supernatants are harvested and purified and characterized as above.

Complex Formation and In Vivo Clearance of Anti-IL6 Oligoclonics

To measure the ability of anti-IL6 Oligoclonics to form immune complexes and to analyze these complexes Size Exclusion Chromatography (SEC) is used according to the approach disclosed by Min-Soo Kim et al. (2007), *JMB* 374:1374-1388, to characterize the immune-complexes formed with different antibodies to TNFα. Different molar ratios of the anti-IL6 Oligoclonics are mixed with human IL6 and incubated for 20 hours at 4° C. or 25° C. The mixture is analyzed on an HPLC system fitted with a size exclusion column; different elution times are correlated to molecular weight using a molecular weight standards.

The ability of antibodies to form complexes with IL6 is correlated with their ability to rapidly clear the cytokine from the circulation in vivo. This is confirmed by measuring the clearance of radiolabelled IL6 from mice. Briefly, female, six- to eight-week-old Balb/c mice are obtained and 18 hours before the experiment, the animals are injected intravenously (IV) via the lateral tail vein with different doses of purified anti-IL6 Oligoclonics. On day 0, the mice are injected IV with 50 microliters of radiolabeled IL-6 (1×10E7 cpm/mL) under the same conditions. Blood samples (approximately 50 microliters) are collected at several time intervals and stored at 4° C. The samples are centrifuged for five minutes at 4000×g and the radioactivity of the serum determined. All pharmacokinetic experiments are performed simultaneously with three animals for each treatment.

Generation of Anti-IL6 Oligoclonics Stable Clones and Preclinical Development

A lead anti-IL6 Oligoclonic is selected based on the in vitro and in vivo potency as determined above. The murine VH genes are humanized according to standard methods and combined with the fully human IGKV1-39 light chain in an expression vector as described above. Examples of humanization methods include those based on paradigms such as resurfacing (E. A. Padlan et al. (1991), *Mol. Immunol.* 28:489), superhumanization (P. Tan, D. A., et al. (2002), *J. Immunol.* 169:1119) and human string content optimization (G. A. Lazar et al. (2007), *Mol. Immunol.* 44:1986). The three constructs are transfected into PER.C6 cells at the predetermined optimal ratio (described above) under the selective pressure of G418 according to standard methods. A stable high producing anti-IL6 Oligoclonic clone is selected and a working and qualified master cell bank generated.

TABLE 1

List of primers

| DO- | Primer | Sequence |
|---|---|---|
| 0012 | CH1_Rev1 | TGCCAGGGGGAAGACCGATG (SEQ ID NO: 4) |
| 0656 | MVH-1 | GCCGGCCATGGCC**GAGGTRMAGCTTCAGGAGTCAGGAC** (SEQ ID NO: 5) |
| 0657 | MVH-2 | GCCGGCCATGGCC**GAGGTSCAGCTKCAGCAGTCAGGAC** (SEQ ID NO: 6) |
| 0658 | MVH-3 | GCCGGCCATGGCC**CAGGTGCAGCTGAAGSASTCAGG** (SEQ ID NO: 7) |
| 0659 | MVH-4 | GCCGGCCATGGCC**GAGGTGCAGCTTCAGGAGTCSGGAC** (SEQ ID NO: 8) |
| 0660 | MVH-5 | GCCGGCCATGGCC**GARGTCCAGCTGCAACAGTCYGGAC** (SEQ ID NO: 9) |
| 0661 | MVH-6 | GCCGGCCATGGCC**CAGGTCCAGCTKCAGCAATCTGG** (SEQ ID NO: 10) |
| 0662 | MVH-7 | GCCGGCCATGGCC**CAGSTBCAGCTGCAGCAGTCTGG** (SEQ ID NO: 11) |
| 0663 | MVH-8 | GCCGGCCATGGCC**CAGGTYCAGCTGCAGCAGTCTGGRC** (SEQ ID NO: 12) |
| 0664 | MVH-9 | GCCGGCCATGGCC**CAGGTYCAGCTYCAGCAGTCTGG** (SEQ ID NO: 13) |

TABLE 1-continued

List of primers

| DO- | Primer | Sequence |
|---|---|---|
| 0665 | MVH-10 | GCCGGCCATGGCC**GAGGTCCARCTGCAACAATCTGGACC** (SEQ ID NO: 14) |
| 0666 | MVH-11 | GCCGGCCATGGCC**CAGGTCCACGTGAAGCAGTCTGGG** (SEQ ID NO: 15) |
| 0667 | MVH-12 | GCCGGCCATGGCC**GAGGTGAASSTGGTGGAATCTG** (SEQ ID NO: 16) |
| 0668 | MVH-13 | GCCGGCCATGGCC**GAVGTGAAGYTGGTGGAGTCTG** (SEQ ID NO: 17) |
| 0669 | MVH-14 | GCCGGCCATGGCC**GAGGTGCAGSKGGTGGAGTCTGGGG** (SEQ ID NO: 18) |
| 0670 | MVH-15 | GCCGGCCATGGCC**GAKGTGCAMCTGGTGGAGTCTGGG** (SEQ ID NO: 19) |
| 0671 | MVH-16 | GCCGGCCATGGCC**GAGGTGAAGCTGATGGARTCTGG** (SEQ ID NO: 20) |
| 0672 | MVH-17 | GCCGGCCATGGCC**GAGGTGCARCTTGTTGAGTCTGGTG** (SEQ ID NO: 21) |
| 0673 | MVH-18 | GCCGGCCATGGCC**GARGTRAAGCTTCTCGAGTCTGGA** (SEQ ID NO: 22) |
| 0674 | MVH-19 | GCCGGCCATGGCC**GAAGTGAARSTTGAGGAGTCTGG** (SEQ ID NO: 23) |
| 0675 | MVH-20 | GCCGGCCATGGCC**GAAGTGATGCTGGTGGAGTCTGGG** (SEQ ID NO: 24) |
| 0676 | MVH-21 | GCCGGCCATGGCC**CAGGTTACTCTRAAAGWGTSTGGCC** (SEQ ID NO: 25) |
| 0677 | MVH-22 | GCCGGCCATGGCC**CAGGTCCAACTVCAGCARCCTGG** (SEQ ID NO: 26) |
| 0678 | MVH-23 | GCCGGCCATGGCC**CAGGTYCARCTGCAGCAGTCTG** (SEQ ID NO: 27) |
| 0679 | MVH-24 | GCCGGCCATGGCC**GATGTGAACTTGGAAGTGTCTGG** (SEQ ID NO: 28) |
| 0680 | MVH-25 | GCCGGCCATGGCC**GAGGTGAAGGTCATCGAGTCTGG** (SEQ ID NO: 29) |
| 0681 | ExtMVH-1 | CAGTCACAGATCCTCGCGAATT*GGCCCA**GCCGGCC***ATGGCCSANG (SEQ ID NO: 30) |
| 0682 | ExtMVH-2 | CAGTCACAGATCCTCGCGAATT*GGCCCA**GCCGGCC***ATGGCCSANC (SEQ ID NO: 31) |
| 0683 | MJH-Rev1 | GGGGGTGTCGT**TTTGGCTGAGGAGAC *GGTGACC* GTGG** (SEQ ID NO: 32) |
| 0684 | MJH-Rev2 | GGGGGTGTCGT**TTTGGCTGAGGAGAC *TGTGAGA* GTGG** (SEQ ID NO: 33) |
| 0685 | MJH-Rev3 | GGGGGTGTCGT**TTTGGCTGCAGAGAC *AGTGACC* AGAG** (SEQ ID NO: 34) |
| 0686 | MJH-Rev4 | GGGGGTGTCGT**TTTGGCTGAGGAGAC *GGTGACT* GAGG** (SEQ ID NO: 35) |
| 0687 | ExtMJH-Rev1& | GGGGGTGTCGT**TTTGGCTGAGGAGAC *GGTGACC* GTGG** (SEQ ID NO: 36) |
| 0688 | ExtMJH-Rev2in | GGGGGTGTCGT**TTTGGCTGAGGAGAC *GGTGACA* GTGG** (SEQ ID NO: 37) |
| 0690 | ExtMJH-Rev3 | GGGGGTGTCGT**TTTGGCTGAGGAGAC *GGTGACC* AGAG** (SEQ ID NO: 38) |
| 0691 | ExtMJH-Rev4 | GGGGGTGTCGT**TTTGGCTGAGGAGAC *GGTGACC* GAGG** (SEQ ID NO: 39) |

TABLE 2

Phage ELISA signal levels as measured at 450 nm. TT-coated plates represent plates that were coated with tetanus toxoid. Thyroglobulin-coated plates are used as negative controls. 10/10 and 15/15 indicate the number of wash steps with PBS-Tween ® during panning procedures. The 10/10 tetanus toxoid and 10/10 thyroglobulin plates and the 15/15 tetanus toxoid and 15/15 thyroglobulin plates are duplicates from each other except for the coating agent. OD values higher than three times the background are assumed specific.

| | 1 | 2 | 3 | 4 | 5 | 6 | 7 | 8 | 9 | 10 | 11 | 12 |
|---|---|---|---|---|---|---|---|---|---|---|---|---|
| | TT-coated plate 10/10 washings | | | | | | | | | | | |
| A | 0.139 | 0.093 | 0.089 | 0.121 | 0.117 | 0.598 | 0.146 | 0.115 | 0.18 | 0.155 | 0.543 | 0.601 |
| B | 0.136 | 0.404 | 0.159 | 0.187 | 0.489 | 0.134 | 0.216 | 0.092 | 0.222 | 0.108 | 0.181 | 0.484 |
| C | 0.197 | 0.526 | 0.09 | 0.213 | 0.395 | 0.155 | 0.108 | 0.12 | 0.183 | 0.136 | 0.092 | 0.866 |
| D | 0.143 | 0.258 | 0.101 | 0.422 | 0.088 | 0.243 | 0.485 | 0.251 | 0.304 | 0.198 | 0.478 | 0.091 |

TABLE 2-continued

Phage ELISA signal levels as measured at 450 nm. TT-coated plates represent plates that were coated with tetanus toxoid. Thyroglobulin-coated plates are used as negative controls. 10/10 and 15/15 indicate the number of wash steps with PBS-Tween ® during panning procedures. The 10/10 tetanus toxoid and 10/10 thyroglobulin plates and the 15/15 tetanus toxoid and 15/15 thyroglobulin plates are duplicates from each other except for the coating agent. OD values higher than three times the background are assumed specific.

| | 1 | 2 | 3 | 4 | 5 | 6 | 7 | 8 | 9 | 10 | 11 | 12 |
|---|---|---|---|---|---|---|---|---|---|---|---|---|
| E | 0.445 | 0.169 | 0.526 | 0.481 | 0.206 | 0.285 | 0.111 | 0.119 | 0.128 | 0.2 | 0.118 | 0.098 |
| F | 0.237 | 0.291 | 0.594 | 0.139 | 0.206 | 0.565 | 0.543 | 0.091 | 0.136 | 0.227 | 0.228 | 0.099 |
| G | 0.459 | 0.102 | 0.152 | 0.659 | 0.203 | 0.452 | 0.152 | 0.133 | 0.094 | 0.102 | 0.375 | 0.098 |
| H | 0.341 | 0.623 | 0.745 | 0.415 | 0.682 | 0.527 | 0.655 | 0.114 | 0.258 | 0.284 | 0.685 | 0.113 |
| TT-coated plate 15/15 washings | | | | | | | | | | | | |
| A | 0.247 | 0.582 | 0.421 | 0.428 | 0.133 | 0.082 | 0.262 | 0.079 | 0.343 | 0.414 | 0.095 | 0.292 |
| B | 0.065 | 0.364 | 0.073 | 0.042 | 0.049 | 0.071 | 0.046 | 0.103 | 0.078 | 0.057 | 0.048 | 0.155 |
| C | 0.081 | 0.044 | 0.066 | 0.082 | 0.225 | 0.444 | 0.203 | 0.362 | 0.122 | 0.047 | 0.052 | 0.309 |
| D | 0.092 | 0.11 | 0.59 | 0.22 | 0.33 | 0.544 | 0.058 | 0.159 | 0.047 | 0.174 | 0.086 | 0.05 |
| E | 0.469 | 0.577 | 0.206 | 0.304 | 0.13 | 0.749 | 0.431 | 0.062 | 0.167 | 0.049 | 0.056 | 0.049 |
| F | 0.846 | 0.07 | 0.561 | 0.656 | 0.882 | 0.094 | 0.383 | 0.13 | 0.152 | 0.098 | 0.134 | 0.048 |
| G | 0.537 | 0.052 | 0.49 | 0.105 | 0.337 | 0.193 | 0.514 | 0.294 | 0.068 | 0.35 | 0.525 | 0.05 |
| H | 0.061 | 0.306 | 0.157 | 0.853 | 0.054 | 0.534 | 0.102 | 0.235 | 0.441 | 0.412 | 0.565 | 0.061 |
| Thyroglobulin-coated plate 10/10 washings | | | | | | | | | | | | |
| A | 0.047 | 0.051 | 0.045 | 0.043 | 0.051 | 0.044 | 0.046 | 0.042 | 0.047 | 0.048 | 0.049 | 0.05 |
| B | 0.042 | 0.042 | 0.042 | 0.042 | 0.043 | 0.041 | 0.041 | 0.042 | 0.043 | 0.045 | 0.042 | 0.046 |
| C | 0.044 | 0.043 | 0.043 | 0.044 | 0.043 | 0.044 | 0.043 | 0.042 | 0.043 | 0.041 | 0.044 | 0.046 |
| D | 0.045 | 0.044 | 0.044 | 0.044 | 0.045 | 0.046 | 0.045 | 0.056 | 0.045 | 0.049 | 0.048 | 0.73 |
| E | 0.046 | 0.045 | 0.046 | 0.044 | 0.045 | 0.044 | 0.044 | 0.044 | 0.047 | 0.046 | 0.047 | 0.926 |
| F | 0.048 | 0.045 | 0.044 | 0.046 | 0.044 | 0.043 | 0.044 | 0.046 | 0.046 | 0.046 | 0.046 | 0.792 |
| G | 0.051 | 0.048 | 0.045 | 0.045 | 0.044 | 0.043 | 0.048 | 0.045 | 0.048 | 0.051 | 0.045 | 0.053 |
| H | 0.064 | 0.05 | 0.049 | 0.047 | 0.05 | 0.051 | 0.047 | 0.046 | 0.047 | 0.047 | 0.047 | 0.056 |
| Thyroglobulin-coated plate 15/15 washings | | | | | | | | | | | | |
| A | 0.036 | 0.049 | 0.045 | 0.044 | 0.046 | 0.047 | 0.046 | 0.042 | 0.042 | 0.043 | 0.042 | 0.041 |
| B | 0.045 | 0.042 | 0.041 | 0.043 | 0.043 | 0.043 | 0.045 | 0.045 | 0.047 | 0.048 | 0.044 | 0.045 |
| C | 0.049 | 0.047 | 0.047 | 0.046 | 0.046 | 0.046 | 0.045 | 0.047 | 0.046 | 0.045 | 0.045 | 0.052 |
| D | 0.047 | 0.049 | 0.048 | 0.048 | 0.048 | 0.048 | 0.047 | 0.052 | 0.048 | 0.046 | 0.048 | 0.456 |
| E | 0.049 | 0.047 | 0.047 | 0.047 | 0.047 | 0.049 | 0.047 | 0.048 | 0.047 | 0.046 | 0.048 | 0.412 |
| F | 0.05 | 0.047 | 0.046 | 0.046 | 0.046 | 0.046 | 0.046 | 0.046 | 0.046 | 0.047 | 0.048 | 0.528 |
| G | 0.05 | 0.048 | 0.045 | 0.045 | 0.046 | 0.049 | 0.048 | 0.046 | 0.053 | 0.049 | 0.05 | 0.057 |
| H | 0.057 | 0.05 | 0.046 | 0.045 | 0.047 | 0.049 | 0.047 | 0.047 | 0.046 | 0.047 | 0.053 | 0.048 |

TABLE 3

Protein sequence analysis of ELISA positive tetanus toxoid binders. CDR3 sequence, CDR3 length, VH family members and specific name, JH origin and DH origin of the clones is indicated.

| CDR3 / SEQ ID NO: | CDR3 length | VH | DH | JH | V Gene family |
|---|---|---|---|---|---|
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAYYTYDEKAWFAY (SEQ ID NO: 40) | 15 | musIGHV192 | DSP2.11 | JH3 mouse | VH7183 |
| HGAFYTYDEKPWFAY (SEQ ID NO: 41) | 15 | musIGHV192 | IGHD2-14*01 | JH3 mouse | VH7183 |
| HISYYRYDEEVSFAY (SEQ ID NO: 42) | 15 | musIGHV192 | IGHD2-14*01 | JH3 mouse | VH7183 |
| HISYYRYDEEVSFAY (SEQ ID NO: 42) | 15 | musIGHV192 | IGHD2-14*01 | JH3 mouse | VH7183 |
| GWRAFAY (SEQ ID NO: 43) | 7 | musIGHV131 | DSP2.9 | JH3 mouse | VH7183 |
| GWRAFAY (SEQ ID NO: 43) | 7 | musIGHV131 | DSP2.9 | JH3 mouse | VH7183 |
| GWRAFAY (SEQ ID NO: 43) | 7 | musIGHV131 | DSP2.9 | JH3 mouse | VH7183 |
| DRGNYYGMDY (SEQ ID NO: 44) | 10 | musIGHV178 | DSP2.1 | JH4 mouse | VH7183 |
| LGDYYVDWFFAV (SEQ ID NO: 45) | 12 | musIGHV165 | DFL16.1 | JH1 mouse | VH7183 |
| NFPAWFAF (SEQ ID NO: 46) | 8 | musIGHV547 | DST4.3inv | JH3 mouse | VJH558 |
| NFPAWFAY (SEQ ID NO: 46) | 8 | musIGHV547 | DSP2.1 | JH3 mouse | VJH558 |
| NFPAWFVY (SEQ ID NO: 46) | 8 | musIGHV547 | DSP2.1 | JH3 mouse | VJH558 |
| SFTPVPFYYGYDWYFDV (SEQ ID NO: 47) | 17 | musIGHV532 | DSP2.3 | JH1 mouse | VJH558 |
| SFTPVPFYYGYDWYFDV (SEQ ID NO: 47) | 17 | musIGHV532 | DSP2.3 | JH1 mouse | VJH558 |
| SDYDWYFDV (SEQ ID NO: 48) | 9 | musIGHV286 | DSP2.2 | JH1 mouse | VJH558 |

TABLE 3-continued

Protein sequence analysis of ELISA positive tetanus toxoid binders. CDR3 sequence, CDR3 length, VH family members and specific name, JH origin and DH origin of the clones is indicated.

| CDR3 / SEQ ID NO: | CDR3 length | VH | DH | JH | V Gene family |
|---|---|---|---|---|---|
| SDYDWYFDV (SEQ ID NO: 48) | 9 | musIGHV286 | DSP2.2 | JH1 mouse | VJH558 |
| DSKWAYYFDY (SEQ ID NO: 49) | 10 | musIGHV532 | DST4.3 | JH2 mouse | VJH558 |
| GDYTGYGMDY (SEQ ID NO: 50) | 10 | musIGHV125 | DSP2.13 | JH4 mouse | VHSM7 |
| GDYTGYGMDY (SEQ ID NO: 50) | 10 | musIGHV125 | DSP2.13 | JH4 mouse | VHSM7 |
| GGYDGYWFPY (SEQ ID NO: 51) | 10 | musIGHV125 | DSP2.9 | JH3 mouse | VHSM7 |

TABLE 4

Vector combinations that were transfected to HEK293T.

| Code | HC vector | LC vector | Combined vector | Prep name | Conc. (μg/ml) |
|---|---|---|---|---|---|
| A | x | 0817676_pSELECT_0815426 (IGKV1-39) | x | PIGKV1-39/ P1 | — |
| B | x | 0817678_pSELECT_0815427 (IGLV2-14) | x | PIGLV2-14/ P1 | — |
| C | MV1110 | 0817676_pSELECT_0815426 (IGKV1-39) | x | PMV1110/ IGKV1-39/P1 | 11.0 |
| D | MV1110 | 0817678_pSELECT_0815427 (IGLV2-14) | x | PMV1110/ IGLV2-14/P1 | 15.4 |
| E | x | x | MG1494 | MG1494/P2 | 16.1 |

TABLE 5

HLA allotypes considered in $T_H$-epitope profiling. The corresponding serotypes are shown, as well as allotype frequencies in the Caucasian population (Klitz et al. (2003), *Tissue Antigens* 62: 296-307; Gjertson and Terasake (eds) in: *HLA* 1997; Gjertson and Terasake (eds) in: *HLA* 1998; Castelli et al. (2002), *J. Immunol.* 169: 6928-6934). Frequencies can add up to more than 100% since each individual has two alleles for each gene. If all allele frequencies of a single gene were known, they would add up to slightly less than 200% due to homozygous individuals.

| HLA type | Serotype | Population % | HLA type | Serotype | Population % |
|---|---|---|---|---|---|
| DRB1*0101 | DR1 | 17.4 | DRB4*0103 | DR53 | 21 |
| DRB1*0102 | DR1 | 4.9 | DR35*0101 | DR51 | 15.8 |
| DRB1*0301 | DR17(3) | 21.2 | DRB5*0202 | DR51 | 5.7 |
| DRB1*0401 | DR4 | 11.5 | DQA1*0101/DQB1*0501 | DQ5(1) | 20.5 |
| DRB1*0402 | DR4 | 3.1 | DQA1*0102/DQB1*0502 | DQ5(1) | 2.6 |
| DRB1*0404 | DR4 | 5.5 | DQA1*0102/DQB1*0602 | DQ6(1) | 26.5 |
| DRB1*0405 | DR4 | 2.2 | DQA1*0102/DQB1*0604 | DQ6(1) | 6.7 |
| DRB1*0407 | DR4 | <2 | DQA1*0103/DQB1*0603 | DQ6(1) | 11 |
| DRB1*0701 | DR7 | 23.4 | DQA1*0104/DQB1*0503 | DQ5(1) | 4 |
| DRB1*0801 | DR8 | 3.3 | DQA1*0201/DQB1*0202 | DQ2 | 20.9 |
| DRB1*0802 | DR8 | <2 | DQA1*0201/DQB1*0303 | DQ9(3) | 7.2 |
| DRB1*0901 | DR9 | <2 | DQA1*0301/DQB1*0301 | DQ7(3) | 12.5 |
| DRB1*1101 | DR11(5) | 17 | DQA1*0301/DQB1*0302 | DQ8(3) | 18.3 |
| DRB1*1104 | DR11(5) | 5.7 | DQA1*0401/DQB1*0402 | DQ4 | 4.5 |
| DRB1*1201 | DR12(5) | 3.1 | DQA1*0501/DQB1*0201 | DQ2 | 24.6 |
| DRB1*1301 | DR13(6) | 15.4 | DQA1*0501/DQB1*0301 | DQ7(3) | 20.9 |
| DRB1*1302 | DR13(6) | 10.8 | DPA1*0103/DPB1*0201 | DPw2 | 19.9 |
| DRB1*1401 | DR14(6) | 4.2 | DPA1*0103/DPB1*0401 | DPw4 | 65.1 |
| DRB1*1501 | DR15(2) | 13.2 | DPA1*0103/DPB1*0402 | DPw4 | 24.3 |
| DRB1*1601 | DR16(2) | 5.5 | DPA1*0201/DPB1*0101 | DPw1 | 6.3 |
| DRB3*0101 | DR52 | 24.6 | DPA1*0201/DPB1*0301 | DPw3 | <2 |
| DRB3*0202 | DR52 | 43 | DPA1*0201/DPB1*0501 | DPw5 | <2 |
| DRB3*0301 | DR52 | 10 | DPA1*0201/DPB1*0901 | — | 2.4 |
| DPB4*0101 | DR53 | 25.5 | | | |

TABLE 6

$T_H$ epitope counts for IGKV1-39. Peptides binding to multiple HLAs of the same group (DRB1, DRB3/4/5, DP, DQ) are counted as one. Values between brackets refer to germline-filtered peptides.

| | DRB1 | | DRB3/4/5 | | DQ | | DP | |
|---|---|---|---|---|---|---|---|---|
| | Strong | Medium | Strong | Medium | Strong | Medium | Strong | Medium |
| Merus IGKV1-39 | 0 (+6) | 0 (+16) | 0 (+0) | 0 (+5) | 0 (+3) | 0 (+9) | 0 (+0) | 0 (+9) |

TABLE 7

Mapping of Epibase ® predictions for Merus IGKV1-39 in the classical 15-mer peptide format. This table shows the allotype count of critical epitopes (SEQ ID NOs: 52-83) and implicated serotypes for each of the 15-mers spanning the Merus IGKV1-39 sequence.

| 15 mer | Start Position | 15-mer sequence | Allotype count | Implicated serotypes |
|---|---|---|---|---|
| 1 | 1 | DIQMTQSPSSLSASV | 6 | DR1, DR4, DR7, DR9 |
| 2 | 4 | MTQSPSSLSASVGDR | 5 | DR1, DR4, DR9 |
| 3 | 7 | SPSSLSASVGDRVTI | 0 | |
| 4 | 10 | SLSASVGDRVTITCR | 0 | |
| 5 | 13 | ASVGDRVTITCRASQ | 0 | |
| 6 | 16 | GDRVTITCRASQSIS | 2 | DR11(5), DR7 |
| 7 | 19 | VTITCRASQSISSYL | 4 | DQ2, DR11(5), DR4, DR7 |
| 8 | 22 | TCRASQSISSYLNWY | 2 | DQ2, DR4 |
| 9 | 25 | ASQSISSYLNWYQQK | 5 | DR13(6), DR15(2), DR4 |
| 10 | 28 | SISSYLNWYQQKPGK | 8 | DR12(5), DR13(6), DR15(2), DR16(2), DR4, DR8 |
| 11 | 31 | SYLNWYQQKPGKAPK | 10 | DR1, DR12(5), DR16(2), DR4, DR51, DR8 |
| 12 | 34 | NWYQQKPGKAPKLLI | 9 | DR1, DR15(2), DR4, DR51, DR8 |
| 13 | 37 | QQKPGKAPKLLIYAA | 7 | DQ4, DR1, DR11(5), DR15(2), DR51, DR8 |
| 14 | 40 | PGKAPKLLIYAASSL | 7 | DQ4, DR1, DR11(5), DR4, DR8 |
| 15 | 43 | APKLLIYAASSLQSG | 15 | DR1, DR11(5), DR12(5), DR13(6), DR14(6), DR15(2), DR4, DR51, DR8, DR9 |
| 16 | 46 | LLIYAASSLQSGVPS | 15 | DR1, DR11(5), DR12(5), DR13(6), DR14(6), DR15(2), DR4, DR51, DR8, DR9 |
| 17 | 49 | YAASSLQSGVPSRFS | 1 | DR15(2) |
| 18 | 52 | SSLQSGVPSRFSGSG | 1 | DR15(2) |
| 19 | 55 | QSGVPSRFSGSGSGT | 0 | |
| 20 | 58 | VPSRFSGSGSGTDFT | 0 | |
| 21 | 61 | RFSGSGSGTDFTLTI | 0 | |
| 22 | 64 | GSGSGTDFTLTISSL | 1 | DR52 |
| 23 | 67 | SGTDFTLTISSLQPE | 4 | DR4, DR52, DR7, DR9 |
| 24 | 70 | DFTLTISSLQPEDFA | 4 | DQ2, DR4, DR7, DR9 |
| 25 | 73 | LTISSLQPEDFATYY | 1 | DQ2 |
| 26 | 76 | SSLQPEDFATYYCQQ | 0 | |
| 27 | 79 | QPEDFATYYCQQSYS | 1 | DR4 |
| 28 | 82 | DFATYYCQQSYSTPP | 5 | DR4, DR51, DR7 |

TABLE 7-continued

Mapping of Epibase ® predictions for Merus IGKV1-39 in the classical 15-mer peptide format. This table shows the allotype count of critical epitopes (SEQ ID NOs: 52-83) and implicated serotypes for each of the 15-mers spanning the Merus IGKV1-39 sequence.

| 15 mer | Start Position | 15-mer sequence | Allotype count | Implicated serotypes |
|---|---|---|---|---|
| 29 | 85 | TYYCQQSYSTPPTFG | 4 | DR4, DR51, DR7 |
| 30 | 88 | CQQSYSTPPTFGQGT | 0 | |
| 31 | 91 | SYSTPPTFGQGTKVE | 0 | |
| 32 | 94 | TPPTFGQGTKVEIK | 0 | |

TABLE 8

The $V_H$ gene from PG1433 paired with various light chain genes with differing rates of amino acid mutation were compared for production levels with the original clone containing the IGKV1-39 gene.

| IgG name | Light chain gene | Number of amino acid mutations | concentration (μg/ml) |
|---|---|---|---|
| PG1433 | 1-39 | 0 | 63, 45.5, 38.6 (avg = 49) |
| PG1631 | 1-12 | 4 | 10.5 |
| PG1632 | 1-27 | 7 | 9.3 |
| PG1634 | 1D-12 | 10 | 10.8 |
| PG1635 | 1D-33 | 6 | 10.2 |
| PG1642 | 1-5 | 8 | 7.1 |
| PG1644 | 1-9 | 3 | 7.8 |
| PG1650 | 1D-39 | 3 | 9.1 |
| PG1652 | 2D-28 | 3 | 7.1 |
| PG1653 | 3-15 | 14 | 7 |
| PG1654 | 3-20 | 2 | 5.2 |
| PG1674 | 1-40 | 7 | 8.2 |
| PG1678 | 2-11 | 2 | 8.1 |
| PG1680 | 2-14 | 15 | 10.8 |
| PG1682 | 3-1 | 13 | 9.9 |
| PG1683 | 6-57 | 6 | 13.9 |

TABLE 9

Numbers of lymphocytes harvested from the bone marrow and spleen of wild-type and transgenic mice

| | *10e6/ml cells | total vol (ml) | total cells $*10^6$ |
|---|---|---|---|
| Bone Marrow | | | |
| Wt | 18.82 | 5.05 | 95.0 |
| Wt | 19.24 | 4.96 | 95.4 |
| CD19-Cre | 23.42 | 5.08 | 119.0 |
| CD19-Cre | 20.58 | 4.82 | 99.2 |
| CD19-Cre | 25.77 | 5.15 | 132.7 |
| CD19-Cre/HuVk1 | 17.71 | 5.06 | 89.6 |
| CD19-Cre/HuVk1 | 12.60 | 5.33 | 67.2 |
| CD19-Cre/HuVk1 | 18.13 | 5.27 | 95.5 |
| Spleen | | | |
| Wt | 41.70 | 5.36 | 223.5 |
| Wt | 37.85 | 4.71 | 178.3 |
| CD19-Cre | 60.19 | 3.77 | 226.9 |
| CD19-Cre | 35.06 | 3.66 | 128.3 |
| CD19-Cre | 80.69 | 4.60 | 371.2 |
| CD19-Cre/HuVk1 | 51.67 | 4.48 | 231.5 |
| CD19-Cre/HuVk1 | 58.80 | 6.24 | 366.9 |
| CD19-Cre/HuVk1 | 24.37 | 6.25 | 152.3 |

SEQUENCE LISTING

```
<160> NUMBER OF SEQ ID NOS: 102

<210> SEQ ID NO 1
<211> LENGTH: 20
<212> TYPE: DNA
<213> ORGANISM: Artificial Sequence
<220> FEATURE:
<223> OTHER INFORMATION: primer

<400> SEQUENCE: 1

ccctttccaa tctttatggg                                                20


<210> SEQ ID NO 2
<211> LENGTH: 23
<212> TYPE: DNA
<213> ORGANISM: Artificial Sequence
<220> FEATURE:
<223> OTHER INFORMATION: primer

<400> SEQUENCE: 2

aggtggattg gtgtcttttt ctc                                            23


<210> SEQ ID NO 3
```

<211> LENGTH: 22
<212> TYPE: DNA
<213> ORGANISM: Artificial Sequence
<220> FEATURE:
<223> OTHER INFORMATION: primer

<400> SEQUENCE: 3 gtcatgtcgg cgaccctacg cc 22

<210> SEQ ID NO 4
<211> LENGTH: 20
<212> TYPE: DNA
<213> ORGANISM: Artificial Sequence
<220> FEATURE:
<223> OTHER INFORMATION: primer

<400> SEQUENCE: 4 tgccaggggg aagaccgatg 20

<210> SEQ ID NO 5
<211> LENGTH: 38
<212> TYPE: DNA
<213> ORGANISM: Artificial Sequence
<220> FEATURE:
<223> OTHER INFORMATION: primer

<400> SEQUENCE: 5 gccggccatg gccgaggtrm agcttcagga gtcaggac 38

<210> SEQ ID NO 6
<211> LENGTH: 38
<212> TYPE: DNA
<213> ORGANISM: Artificial Sequence
<220> FEATURE:
<223> OTHER INFORMATION: primer

<400> SEQUENCE: 6 gccggccatg gccgaggtsc agctkcagca gtcaggac 38

<210> SEQ ID NO 7
<211> LENGTH: 36
<212> TYPE: DNA
<213> ORGANISM: Artificial Sequence
<220> FEATURE:
<223> OTHER INFORMATION: primer

<400> SEQUENCE: 7 gccggccatg gcccaggtgc agctgaagsa stcagg 36

<210> SEQ ID NO 8
<211> LENGTH: 38
<212> TYPE: DNA
<213> ORGANISM: Artificial Sequence
<220> FEATURE:
<223> OTHER INFORMATION: primer

<400> SEQUENCE: 8 gccggccatg gccgaggtgc agcttcagga gtcsggac 38

<210> SEQ ID NO 9
<211> LENGTH: 38
<212> TYPE: DNA
<213> ORGANISM: Artificial Sequence
<220> FEATURE:
<223> OTHER INFORMATION: primer

<400> SEQUENCE: 9 gccggccatg gccgargtcc agctgcaaca gtcyggac 38

<210> SEQ ID NO 10
<211> LENGTH: 36
<212> TYPE: DNA
<213> ORGANISM: Artificial Sequence
<220> FEATURE:
<223> OTHER INFORMATION: primer

<400> SEQUENCE: 10 gccggccatg gcccaggtcc agctkcagca atctgg 36

<210> SEQ ID NO 11
<211> LENGTH: 36
<212> TYPE: DNA
<213> ORGANISM: Artificial Sequence
<220> FEATURE:
<223> OTHER INFORMATION: primer

<400> SEQUENCE: 11 gccggccatg gcccagstbc agctgcagca gtctgg 36

<210> SEQ ID NO 12
<211> LENGTH: 38
<212> TYPE: DNA
<213> ORGANISM: Artificial Sequence
<220> FEATURE:
<223> OTHER INFORMATION: primer

<400> SEQUENCE: 12 gccggccatg gcccaggtyc agctgcagca gtctggrc 38

<210> SEQ ID NO 13
<211> LENGTH: 36
<212> TYPE: DNA
<213> ORGANISM: Artificial Sequence
<220> FEATURE:
<223> OTHER INFORMATION: primer

<400> SEQUENCE: 13 gccggccatg gcccaggtyc agctycagca gtctgg 36

<210> SEQ ID NO 14
<211> LENGTH: 39
<212> TYPE: DNA
<213> ORGANISM: Artificial Sequence
<220> FEATURE:
<223> OTHER INFORMATION: primer

<400> SEQUENCE: 14 gccggccatg gccgaggtcc arctgcaaca atctggacc 39

<210> SEQ ID NO 15
<211> LENGTH: 37
<212> TYPE: DNA
<213> ORGANISM: Artificial Sequence
<220> FEATURE:
<223> OTHER INFORMATION: primer

<400> SEQUENCE: 15 gccggccatg gcccaggtcc acgtgaagca gtctggg 37

<210> SEQ ID NO 16
<211> LENGTH: 35
<212> TYPE: DNA

<213> ORGANISM: Artificial Sequence
<220> FEATURE:
<223> OTHER INFORMATION: primer

<400> SEQUENCE: 16 gccggccatg gccgaggtga asstggtgga atctg 35

<210> SEQ ID NO 17
<211> LENGTH: 35
<212> TYPE: DNA
<213> ORGANISM: Artificial Sequence
<220> FEATURE:
<223> OTHER INFORMATION: primer

<400> SEQUENCE: 17 gccggccatg gccgavgtga agytggtgga gtctg 35

<210> SEQ ID NO 18
<211> LENGTH: 38
<212> TYPE: DNA
<213> ORGANISM: Artificial Sequence
<220> FEATURE:
<223> OTHER INFORMATION: primer

<400> SEQUENCE: 18 gccggccatg gccgaggtgc agskggtgga gtctgggg 38

<210> SEQ ID NO 19
<211> LENGTH: 37
<212> TYPE: DNA
<213> ORGANISM: Artificial Sequence
<220> FEATURE:
<223> OTHER INFORMATION: primer

<400> SEQUENCE: 19 gccggccatg gccgakgtgc amctggtgga gtctggg 37

<210> SEQ ID NO 20
<211> LENGTH: 36
<212> TYPE: DNA
<213> ORGANISM: Artificial Sequence
<220> FEATURE:
<223> OTHER INFORMATION: primer

<400> SEQUENCE: 20 gccggccatg gccgaggtga agctgatgga rtctgg 36

<210> SEQ ID NO 21
<211> LENGTH: 38
<212> TYPE: DNA
<213> ORGANISM: Artificial Sequence
<220> FEATURE:
<223> OTHER INFORMATION: primer

<400> SEQUENCE: 21 gccggccatg gccgaggtgc arcttgttga gtctggtg 38

<210> SEQ ID NO 22
<211> LENGTH: 37
<212> TYPE: DNA
<213> ORGANISM: Artificial Sequence
<220> FEATURE:
<223> OTHER INFORMATION: primer

<400> SEQUENCE: 22 gccggccatg gccgargtra agcttctcga gtctgga 37

<210> SEQ ID NO 23
<211> LENGTH: 36
<212> TYPE: DNA
<213> ORGANISM: Artificial Sequence
<220> FEATURE:
<223> OTHER INFORMATION: primer

<400> SEQUENCE: 23 gccggccatg gccgaagtga arsttgagga gtctgg 36

<210> SEQ ID NO 24
<211> LENGTH: 37
<212> TYPE: DNA
<213> ORGANISM: Artificial Sequence
<220> FEATURE:
<223> OTHER INFORMATION: primer

<400> SEQUENCE: 24 gccggccatg gccgaagtga tgctggtgga gtctggg 37

<210> SEQ ID NO 25
<211> LENGTH: 38
<212> TYPE: DNA
<213> ORGANISM: Artificial Sequence
<220> FEATURE:
<223> OTHER INFORMATION: primer

<400> SEQUENCE: 25 gccggccatg gcccaggtta ctctraaagw gtstggcc 38

<210> SEQ ID NO 26
<211> LENGTH: 36
<212> TYPE: DNA
<213> ORGANISM: Artificial Sequence
<220> FEATURE:
<223> OTHER INFORMATION: primer

<400> SEQUENCE: 26 gccggccatg gcccaggtcc aactvcagca rcctgg 36

<210> SEQ ID NO 27
<211> LENGTH: 35
<212> TYPE: DNA
<213> ORGANISM: Artificial Sequence
<220> FEATURE:
<223> OTHER INFORMATION: primer

<400> SEQUENCE: 27 gccggccatg gcccaggtyc arctgcagca gtctg 35

<210> SEQ ID NO 28
<211> LENGTH: 36
<212> TYPE: DNA
<213> ORGANISM: Artificial Sequence
<220> FEATURE:
<223> OTHER INFORMATION: primer

<400> SEQUENCE: 28 gccggccatg gccgatgtga acttggaagt gtctgg 36

<210> SEQ ID NO 29
<211> LENGTH: 36
<212> TYPE: DNA
<213> ORGANISM: Artificial Sequence
<220> FEATURE:

<223> OTHER INFORMATION: primer

<400> SEQUENCE: 29 gccggccatg gccgaggtga aggtcatcga gtctgg 36

<210> SEQ ID NO 30
<211> LENGTH: 45
<212> TYPE: DNA
<213> ORGANISM: Artificial Sequence
<220> FEATURE:
<223> OTHER INFORMATION: primer
<220> FEATURE:
<221> NAME/KEY: misc_feature
<222> LOCATION: (44)..(44)
<223> OTHER INFORMATION: n is a, c, g, or t

<400> SEQUENCE: 30 cagtcacaga tcctcgcgaa ttggcccagc cggccatggc csang 45

<210> SEQ ID NO 31
<211> LENGTH: 45
<212> TYPE: DNA
<213> ORGANISM: Artificial Sequence
<220> FEATURE:
<223> OTHER INFORMATION: primer
<220> FEATURE:
<221> NAME/KEY: misc_feature
<222> LOCATION: (44)..(44)
<223> OTHER INFORMATION: n is a, c, g, or t

<400> SEQUENCE: 31 cagtcacaga tcctcgcgaa ttggcccagc cggccatggc csanc 45

<210> SEQ ID NO 32
<211> LENGTH: 37
<212> TYPE: DNA
<213> ORGANISM: Artificial Sequence
<220> FEATURE:
<223> OTHER INFORMATION: primer

<400> SEQUENCE: 32 gggggtgtcg ttttggctga ggagacggtg accgtgg 37

<210> SEQ ID NO 33
<211> LENGTH: 37
<212> TYPE: DNA
<213> ORGANISM: Artificial Sequence
<220> FEATURE:
<223> OTHER INFORMATION: primer

<400> SEQUENCE: 33 gggggtgtcg ttttggctga ggagactgtg agagtgg 37

<210> SEQ ID NO 34
<211> LENGTH: 37
<212> TYPE: DNA
<213> ORGANISM: Artificial Sequence
<220> FEATURE:
<223> OTHER INFORMATION: primer

<400> SEQUENCE: 34 gggggtgtcg ttttggctgc agagacagtg accagag 37

<210> SEQ ID NO 35
<211> LENGTH: 37
<212> TYPE: DNA
<213> ORGANISM: Artificial Sequence <220> FEATURE:
<223> OTHER INFORMATION: primer

<400> SEQUENCE: 35 ggggggtgtcg ttttggctga ggagacggtg actgagg 37

<210> SEQ ID NO 36
<211> LENGTH: 37
<212> TYPE: DNA
<213> ORGANISM: Artificial Sequence
<220> FEATURE:
<223> OTHER INFORMATION: primer

<400> SEQUENCE: 36 ggggggtgtcg ttttggctga ggagacggtg accgtgg 37

<210> SEQ ID NO 37
<211> LENGTH: 37
<212> TYPE: DNA
<213> ORGANISM: Artificial Sequence
<220> FEATURE:
<223> OTHER INFORMATION: primer

<400> SEQUENCE: 37 ggggggtgtcg ttttggctga ggagacggtg acagtgg 37

<210> SEQ ID NO 38
<211> LENGTH: 37
<212> TYPE: DNA
<213> ORGANISM: Artificial Sequence
<220> FEATURE:
<223> OTHER INFORMATION: primer

<400> SEQUENCE: 38 ggggggtgtcg ttttggctga ggagacggtg accagag 37

<210> SEQ ID NO 39
<211> LENGTH: 37
<212> TYPE: DNA
<213> ORGANISM: Artificial Sequence
<220> FEATURE:
<223> OTHER INFORMATION: primer

<400> SEQUENCE: 39 ggggggtgtcg ttttggctga ggagacggtg accgagg 37

<210> SEQ ID NO 40
<211> LENGTH: 15
<212> TYPE: PRT
<213> ORGANISM: Artificial Sequence
<220> FEATURE:
<223> OTHER INFORMATION: CDR3

<400> SEQUENCE: 40

His Gly Ala Tyr Tyr Thr Tyr Asp Glu Lys Ala Trp Phe Ala Tyr
1 5 10 15

<210> SEQ ID NO 41
<211> LENGTH: 15
<212> TYPE: PRT
<213> ORGANISM: Artificial Sequence
<220> FEATURE:
<223> OTHER INFORMATION: CDR3

<400> SEQUENCE: 41

His Gly Ala Phe Tyr Thr Tyr Asp Glu Lys Pro Trp Phe Ala Tyr 1 5 10 15

<210> SEQ ID NO 42
<211> LENGTH: 15
<212> TYPE: PRT
<213> ORGANISM: Artificial Sequence
<220> FEATURE:
<223> OTHER INFORMATION: CDR3

<400> SEQUENCE: 42

His Ile Ser Tyr Tyr Arg Tyr Asp Glu Glu Val Ser Phe Ala Tyr
1 5 10 15

<210> SEQ ID NO 43
<211> LENGTH: 7
<212> TYPE: PRT
<213> ORGANISM: Artificial Sequence
<220> FEATURE:
<223> OTHER INFORMATION: CDR3

<400> SEQUENCE: 43

Gly Trp Arg Ala Phe Ala Tyr
1 5

<210> SEQ ID NO 44
<211> LENGTH: 10
<212> TYPE: PRT
<213> ORGANISM: Artificial Sequence
<220> FEATURE:
<223> OTHER INFORMATION: CDR3

<400> SEQUENCE: 44

Asp Arg Gly Asn Tyr Tyr Gly Met Asp Tyr
1 5 10

<210> SEQ ID NO 45
<211> LENGTH: 12
<212> TYPE: PRT
<213> ORGANISM: Artificial Sequence
<220> FEATURE:
<223> OTHER INFORMATION: CDR3

<400> SEQUENCE: 45

Leu Gly Asp Tyr Tyr Val Asp Trp Phe Phe Ala Val
1 5 10

<210> SEQ ID NO 46
<211> LENGTH: 8
<212> TYPE: PRT
<213> ORGANISM: Artificial Sequence
<220> FEATURE:
<223> OTHER INFORMATION: CDR3

<400> SEQUENCE: 46

Asn Phe Pro Ala Trp Phe Ala Phe
1 5

<210> SEQ ID NO 47
<211> LENGTH: 17
<212> TYPE: PRT
<213> ORGANISM: Artificial Sequence
<220> FEATURE:
<223> OTHER INFORMATION: CDR3

<400> SEQUENCE: 47

Ser Phe Thr Pro Val Pro Phe Tyr Tyr Gly Tyr Asp Trp Tyr Phe Asp
1 5 10 15

Val

<210> SEQ ID NO 48
<211> LENGTH: 9
<212> TYPE: PRT
<213> ORGANISM: Artificial Sequence
<220> FEATURE:
<223> OTHER INFORMATION: CDR3

<400> SEQUENCE: 48

Ser Asp Tyr Asp Trp Tyr Phe Asp Val
1 5

<210> SEQ ID NO 49
<211> LENGTH: 10
<212> TYPE: PRT
<213> ORGANISM: Artificial Sequence
<220> FEATURE:
<223> OTHER INFORMATION: CDR3

<400> SEQUENCE: 49

Asp Ser Lys Trp Ala Tyr Tyr Phe Asp Tyr
1 5 10

<210> SEQ ID NO 50
<211> LENGTH: 10
<212> TYPE: PRT
<213> ORGANISM: Artificial Sequence
<220> FEATURE:
<223> OTHER INFORMATION: CDR3

<400> SEQUENCE: 50

Gly Asp Tyr Thr Gly Tyr Gly Met Asp Tyr
1 5 10

<210> SEQ ID NO 51
<211> LENGTH: 10
<212> TYPE: PRT
<213> ORGANISM: Artificial Sequence
<220> FEATURE:
<223> OTHER INFORMATION: CDR3

<400> SEQUENCE: 51

Gly Gly Tyr Asp Gly Tyr Trp Phe Pro Tyr
1 5 10

<210> SEQ ID NO 52
<211> LENGTH: 15
<212> TYPE: PRT
<213> ORGANISM: Artificial Sequence
<220> FEATURE:
<223> OTHER INFORMATION: epitope IGKV1-39

<400> SEQUENCE: 52

Asp Ile Gln Met Thr Gln Ser Pro Ser Ser Leu Ser Ala Ser Val
1 5 10 15

<210> SEQ ID NO 53
<211> LENGTH: 15
<212> TYPE: PRT
<213> ORGANISM: Artificial Sequence
<220> FEATURE:
<223> OTHER INFORMATION: epitope IGKV1-39

<400> SEQUENCE: 53

Met Thr Gln Ser Pro Ser Ser Leu Ser Ala Ser Val Gly Asp Arg 1 5 10 15

<210> SEQ ID NO 54
<211> LENGTH: 15
<212> TYPE: PRT
<213> ORGANISM: Artificial Sequence
<220> FEATURE:
<223> OTHER INFORMATION: epitope IGKV1-39

<400> SEQUENCE: 54

Ser Pro Ser Ser Leu Ser Ala Ser Val Gly Asp Arg Val Thr Ile
1 5 10 15

<210> SEQ ID NO 55
<211> LENGTH: 15
<212> TYPE: PRT
<213> ORGANISM: Artificial Sequence
<220> FEATURE:
<223> OTHER INFORMATION: epitope IGKV1-39

<400> SEQUENCE: 55

Ser Leu Ser Ala Ser Val Gly Asp Arg Val Thr Ile Thr Cys Arg
1 5 10 15

<210> SEQ ID NO 56
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 56

Ala Ser Val Gly Asp Arg Val Thr Ile Thr Cys Arg Ala Ser Gln
1 5 10 15

<210> SEQ ID NO 57
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 57

Gly Asp Arg Val Thr Ile Thr Cys Arg Ala Ser Gln Ser Ile Ser
1 5 10 15

<210> SEQ ID NO 58
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 58

Val Thr Ile Thr Cys Arg Ala Ser Gln Ser Ile Ser Ser Tyr Leu
1 5 10 15

<210> SEQ ID NO 59
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 59

Thr Cys Arg Ala Ser Gln Ser Ile Ser Ser Tyr Leu Asn Trp Tyr
1 5 10 15

<210> SEQ ID NO 60
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 60

Ala Ser Gln Ser Ile Ser Ser Tyr Leu Asn Trp Tyr Gln Gln Lys
1 5 10 15

<210> SEQ ID NO 61
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 61

Ser Ile Ser Ser Tyr Leu Asn Trp Tyr Gln Gln Lys Pro Gly Lys
1 5 10 15

<210> SEQ ID NO 62
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 62

Ser Tyr Leu Asn Trp Tyr Gln Gln Lys Pro Gly Lys Ala Pro Lys
1 5 10 15

<210> SEQ ID NO 63
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 63

Asn Trp Tyr Gln Gln Lys Pro Gly Lys Ala Pro Lys Leu Leu Ile
1 5 10 15

<210> SEQ ID NO 64
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 64

Gln Gln Lys Pro Gly Lys Ala Pro Lys Leu Leu Ile Tyr Ala Ala
1 5 10 15

<210> SEQ ID NO 65
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 65

Pro Gly Lys Ala Pro Lys Leu Leu Ile Tyr Ala Ala Ser Ser Leu
1 5 10 15

<210> SEQ ID NO 66
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 66

Ala Pro Lys Leu Leu Ile Tyr Ala Ala Ser Ser Leu Gln Ser Gly
1 5 10 15

<210> SEQ ID NO 67
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 67

Leu Leu Ile Tyr Ala Ala Ser Ser Leu Gln Ser Gly Val Pro Ser
1 5 10 15

<210> SEQ ID NO 68
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 68

Tyr Ala Ala Ser Ser Leu Gln Ser Gly Val Pro Ser Arg Phe Ser
1 5 10 15

<210> SEQ ID NO 69
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 69

Ser Ser Leu Gln Ser Gly Val Pro Ser Arg Phe Ser Gly Ser Gly
1 5 10 15

<210> SEQ ID NO 70
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 70

Gln Ser Gly Val Pro Ser Arg Phe Ser Gly Ser Gly Ser Gly Thr
1 5 10 15

<210> SEQ ID NO 71
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 71

Val Pro Ser Arg Phe Ser Gly Ser Gly Ser Gly Thr Asp Phe Thr
1 5 10 15

<210> SEQ ID NO 72
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 72

Arg Phe Ser Gly Ser Gly Ser Gly Thr Asp Phe Thr Leu Thr Ile
1 5 10 15

<210> SEQ ID NO 73
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 73

Gly Ser Gly Ser Gly Thr Asp Phe Thr Leu Thr Ile Ser Ser Leu
1 5 10 15

<210> SEQ ID NO 74
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 74

Ser Gly Thr Asp Phe Thr Leu Thr Ile Ser Ser Leu Gln Pro Glu
1 5 10 15

<210> SEQ ID NO 75
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 75

Asp Phe Thr Leu Thr Ile Ser Ser Leu Gln Pro Glu Asp Phe Ala
1 5 10 15

<210> SEQ ID NO 76
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 76

Leu Thr Ile Ser Ser Leu Gln Pro Glu Asp Phe Ala Thr Tyr Tyr
1 5 10 15

<210> SEQ ID NO 77
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 77

Ser Ser Leu Gln Pro Glu Asp Phe Ala Thr Tyr Tyr Cys Gln Gln
1 5 10 15

<210> SEQ ID NO 78

<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 78

Gln Pro Glu Asp Phe Ala Thr Tyr Tyr Cys Gln Gln Ser Tyr Ser
1 5 10 15

<210> SEQ ID NO 79
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 79

Asp Phe Ala Thr Tyr Tyr Cys Gln Gln Ser Tyr Ser Thr Pro Pro
1 5 10 15

<210> SEQ ID NO 80
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 80

Thr Tyr Tyr Cys Gln Gln Ser Tyr Ser Thr Pro Pro Thr Phe Gly
1 5 10 15

<210> SEQ ID NO 81
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 81

Cys Gln Gln Ser Tyr Ser Thr Pro Pro Thr Phe Gly Gln Gly Thr
1 5 10 15

<210> SEQ ID NO 82
<211> LENGTH: 15
<212> TYPE: PRT
<213> ORGANISM: Artificial Sequence
<220> FEATURE:
<223> OTHER INFORMATION: Epitope IGKV1-39

<400> SEQUENCE: 82

Ser Tyr Ser Thr Pro Pro Thr Phe Gly Gln Gly Thr Lys Val Glu
1 5 10 15

<210> SEQ ID NO 83
<211> LENGTH: 14
<212> TYPE: PRT
<213> ORGANISM: Artificial Sequence
<220> FEATURE:
<223> OTHER INFORMATION: Epitope IGKV1-39

<400> SEQUENCE: 83

Thr Pro Pro Thr Phe Gly Gln Gly Thr Lys Val Glu Ile Lys
1 5 10

<210> SEQ ID NO 84
<211> LENGTH: 321

<212> TYPE: DNA
<213> ORGANISM: Homo sapiens
<220> FEATURE:
<221> NAME/KEY: CDS
<222> LOCATION: (1)..(321)

<400> SEQUENCE: 84

```
gac atc cag atg acc cag agc ccc agc agc ctg agc gcc agc gtg ggc       48
Asp Ile Gln Met Thr Gln Ser Pro Ser Ser Leu Ser Ala Ser Val Gly
1               5                   10                  15

gac aga gtg acc atc acc tgc aga gcc agc cag agc atc agc agc tac       96
Asp Arg Val Thr Ile Thr Cys Arg Ala Ser Gln Ser Ile Ser Ser Tyr
            20                  25                  30

ctg aac tgg tat cag cag aag ccc ggc aag gcc ccc aag ctg ctg atc      144
Leu Asn Trp Tyr Gln Gln Lys Pro Gly Lys Ala Pro Lys Leu Leu Ile
        35                  40                  45

tac gcc gcc agc tcc ctg cag agc ggc gtg ccc agc aga ttc agc ggc      192
Tyr Ala Ala Ser Ser Leu Gln Ser Gly Val Pro Ser Arg Phe Ser Gly
    50                  55                  60

agc ggc tcc ggc acc gac ttc acc ctg acc atc agc agc ctg cag ccc      240
Ser Gly Ser Gly Thr Asp Phe Thr Leu Thr Ile Ser Ser Leu Gln Pro
65                  70                  75                  80

gag gac ttc gcc acc tac tac tgc cag cag agc tac agc acc ccc ccc      288
Glu Asp Phe Ala Thr Tyr Tyr Cys Gln Gln Ser Tyr Ser Thr Pro Pro
                85                  90                  95

acc ttc ggc cag ggc acc aag gtg gag atc aag                          321
Thr Phe Gly Gln Gly Thr Lys Val Glu Ile Lys
            100                 105
```

<210> SEQ ID NO 85
<211> LENGTH: 107
<212> TYPE: PRT
<213> ORGANISM: Homo sapiens

<400> SEQUENCE: 85

```
Asp Ile Gln Met Thr Gln Ser Pro Ser Ser Leu Ser Ala Ser Val Gly
1               5                   10                  15

Asp Arg Val Thr Ile Thr Cys Arg Ala Ser Gln Ser Ile Ser Ser Tyr
            20                  25                  30

Leu Asn Trp Tyr Gln Gln Lys Pro Gly Lys Ala Pro Lys Leu Leu Ile
        35                  40                  45

Tyr Ala Ala Ser Ser Leu Gln Ser Gly Val Pro Ser Arg Phe Ser Gly
    50                  55                  60

Ser Gly Ser Gly Thr Asp Phe Thr Leu Thr Ile Ser Ser Leu Gln Pro
65                  70                  75                  80

Glu Asp Phe Ala Thr Tyr Tyr Cys Gln Gln Ser Tyr Ser Thr Pro Pro
                85                  90                  95

Thr Phe Gly Gln Gly Thr Lys Val Glu Ile Lys
            100                 105
```

<210> SEQ ID NO 86
<211> LENGTH: 330
<212> TYPE: DNA
<213> ORGANISM: Homo sapiens
<220> FEATURE:
<221> NAME/KEY: CDS
<222> LOCATION: (1)..(330)

<400> SEQUENCE: 86

```
cag tct gcc ctg acc cag ccc gcc tct gtg tct ggc agc cct ggc cag       48
Gln Ser Ala Leu Thr Gln Pro Ala Ser Val Ser Gly Ser Pro Gly Gln
1               5                   10                  15
```

```
agc atc acc atc agc tgc acc ggc acc agc agc gac gtg ggc ggc tac       96
Ser Ile Thr Ile Ser Cys Thr Gly Thr Ser Ser Asp Val Gly Gly Tyr
            20                  25                  30

aac tac gtg tcc tgg tat cag cag cac ccc ggc aag gcc ccc aag ctg      144
Asn Tyr Val Ser Trp Tyr Gln Gln His Pro Gly Lys Ala Pro Lys Leu
        35                  40                  45

atg atc tac gag gtg tcc aac aga ccc agc ggc gtg agc aac aga ttc      192
Met Ile Tyr Glu Val Ser Asn Arg Pro Ser Gly Val Ser Asn Arg Phe
    50                  55                  60

agc ggc agc aag agc ggc aac acc gcc agc ctg acc atc agc ggc ctc      240
Ser Gly Ser Lys Ser Gly Asn Thr Ala Ser Leu Thr Ile Ser Gly Leu
65                  70                  75                  80

cag gct gag gac gag gcc gac tac tac tgc agc agc tac acc agc agc      288
Gln Ala Glu Asp Glu Ala Asp Tyr Tyr Cys Ser Ser Tyr Thr Ser Ser
                85                  90                  95

tcc acc ctg gtg ttt ggc ggc gga aca aag ctg acc gtg ctg              330
Ser Thr Leu Val Phe Gly Gly Gly Thr Lys Leu Thr Val Leu
            100                 105                 110


<210> SEQ ID NO 87
<211> LENGTH: 110
<212> TYPE: PRT
<213> ORGANISM: Homo sapiens

<400> SEQUENCE: 87

Gln Ser Ala Leu Thr Gln Pro Ala Ser Val Ser Gly Ser Pro Gly Gln
1               5                   10                  15

Ser Ile Thr Ile Ser Cys Thr Gly Thr Ser Ser Asp Val Gly Gly Tyr
            20                  25                  30

Asn Tyr Val Ser Trp Tyr Gln Gln His Pro Gly Lys Ala Pro Lys Leu
        35                  40                  45

Met Ile Tyr Glu Val Ser Asn Arg Pro Ser Gly Val Ser Asn Arg Phe
    50                  55                  60

Ser Gly Ser Lys Ser Gly Asn Thr Ala Ser Leu Thr Ile Ser Gly Leu
65                  70                  75                  80

Gln Ala Glu Asp Glu Ala Asp Tyr Tyr Cys Ser Ser Tyr Thr Ser Ser
                85                  90                  95

Ser Thr Leu Val Phe Gly Gly Gly Thr Lys Leu Thr Val Leu
            100                 105                 110


<210> SEQ ID NO 88
<211> LENGTH: 321
<212> TYPE: DNA
<213> ORGANISM: Rattus norvegicus
<220> FEATURE:
<221> NAME/KEY: CDS
<222> LOCATION: (1)..(321)

<400> SEQUENCE: 88

aga gcc gac gcc gct ccc acc gtg tcc atc ttc ccc ccc agc atg gaa       48
Arg Ala Asp Ala Ala Pro Thr Val Ser Ile Phe Pro Pro Ser Met Glu
1               5                   10                  15

cag ctg acc tct ggc gga gcc acc gtg gtc tgc ttc gtg aac aac ttc       96
Gln Leu Thr Ser Gly Gly Ala Thr Val Val Cys Phe Val Asn Asn Phe
            20                  25                  30

tac ccc aga gac atc agc gtg aag tgg aag atc gac ggc agc gag cag      144
Tyr Pro Arg Asp Ile Ser Val Lys Trp Lys Ile Asp Gly Ser Glu Gln
        35                  40                  45

agg gac ggc gtg ctg gac agc gtg acc gac cag gac agc aag gac tcc      192
Arg Asp Gly Val Leu Asp Ser Val Thr Asp Gln Asp Ser Lys Asp Ser
```

```
    50                  55                  60

acc tac agc atg agc agc acc ctg agc ctg acc aag gtg gag tac gag      240
Thr Tyr Ser Met Ser Ser Thr Leu Ser Leu Thr Lys Val Glu Tyr Glu
65                  70                  75                  80

agg cac aac ctg tac acc tgc gag gtg gtg cac aag acc agc tcc agc      288
Arg His Asn Leu Tyr Thr Cys Glu Val Val His Lys Thr Ser Ser Ser
                85                  90                  95

ccc gtg gtc aag tcc ttc aac cgg aac gag tgt                          321
Pro Val Val Lys Ser Phe Asn Arg Asn Glu Cys
            100                 105


<210> SEQ ID NO 89
<211> LENGTH: 107
<212> TYPE: PRT
<213> ORGANISM: Rattus norvegicus

<400> SEQUENCE: 89

Arg Ala Asp Ala Ala Pro Thr Val Ser Ile Phe Pro Pro Ser Met Glu
1               5                   10                  15

Gln Leu Thr Ser Gly Gly Ala Thr Val Val Cys Phe Val Asn Asn Phe
            20                  25                  30

Tyr Pro Arg Asp Ile Ser Val Lys Trp Lys Ile Asp Gly Ser Glu Gln
        35                  40                  45

Arg Asp Gly Val Leu Asp Ser Val Thr Asp Gln Asp Ser Lys Asp Ser
    50                  55                  60

Thr Tyr Ser Met Ser Ser Thr Leu Ser Leu Thr Lys Val Glu Tyr Glu
65                  70                  75                  80

Arg His Asn Leu Tyr Thr Cys Glu Val Val His Lys Thr Ser Ser Ser
                85                  90                  95

Pro Val Val Lys Ser Phe Asn Arg Asn Glu Cys
            100                 105


<210> SEQ ID NO 90
<211> LENGTH: 865
<212> TYPE: DNA
<213> ORGANISM: Artificial Sequence
<220> FEATURE:
<223> OTHER INFORMATION: IGKV1-39/J-Ck

<400> SEQUENCE: 90

ggtaccgcgg ccgccaccat ggacatgaga gtgcccgccc agctcctggg gctcctgcta     60

ctctggctcc gaggtaagga tggagaacac taggaattta ctcagccagt gtgctcagta    120

ctgactggaa cttcagggaa gttctctgat aacatgatta atagtaagaa tatttgtttt    180

tatgtttcca atctcaggtg ccagatgtga catccagatg acccagagcc ccagcagcct    240

gagcgccagc gtgggcgaca gagtgaccat cacctgcaga gccagccaga gcatcagcag    300

ctacctgaac tggtatcagc agaagcccgg caaggccccc aagctgctga tctacgccgc    360

cagctccctg cagagcggcg tgcccagcag attcagcggc agcggctccg gcaccgactt    420

caccctgacc atcagcagcc tgcagcccga ggacttcgcc acctactact gccagcagag    480

ctacagcacc ccccccacct tcggccaggg caccaaggtg gagatcaaga gagccgacgc    540

cgctcccacc gtgtccatct tccccccag catggaacag ctgacctctg gcggagccac    600

cgtggtctgc ttcgtgaaca acttctaccc cagagacatc agcgtgaagt ggaagatcga    660

cggcagcgag cagagggacg gcgtgctgga cagcgtgacc gaccaggaca gcaaggactc    720

cacctacagc atgagcagca ccctgagcct gaccaaggtg gagtacgaga ggcacaacct    780
```

gtacacctgc gaggtggtgc acaagaccag ctccagcccc gtggtcaagt ccttcaaccg 840 gaacgagtgt tgagctagcg agctc 865

<210> SEQ ID NO 91
<211> LENGTH: 874
<212> TYPE: DNA
<213> ORGANISM: Artificial Sequence
<220> FEATURE:
<223> OTHER INFORMATION: IGLV2-14/J-Ck

<400> SEQUENCE: 91 ggtaccgcgg ccgccaccat ggacatgaga gtgcccgccc agctcctggg gctcctgcta 60 ctctggctcc gaggtaagga tggagaacac taggaattta ctcagccagt gtgctcagta 120 ctgactggaa cttcagggaa gttctctgat aacatgatta atagtaagaa tatttgtttt 180 tatgtttcca atctcaggtg ccagatgtca gtctgccctg acccagcccg cctctgtgtc 240 tggcagccct ggccagagca tcaccatcag ctgcaccggc accagcagcg acgtgggcgg 300 ctacaactac gtgtcctggt atcagcagca ccccggcaag gcccccaagc tgatgatcta 360 cgaggtgtcc aacagaccca gcggcgtgag caacagattc agcggcagca agagcggcaa 420 caccgccagc ctgaccatca gcggcctcca ggctgaggac gaggccgact actactgcag 480 cagctacacc agcagctcca ccctggtgtt tggcggcgga acaaagctga ccgtgctgag 540 agccgacgcc gctcccaccg tgtccatctt cccccccagc atggaacagc tgacctctgg 600 cggagccacc gtggtctgct tcgtgaacaa cttctacccc agagacatca gcgtgaagtg 660 gaagatcgac ggcagcgagc agagggacgg cgtgctggac agcgtgaccg accaggacag 720 caaggactcc acctacagca tgagcagcac cctgagcctg accaaggtgg agtacgagag 780 gcacaacctg tacacctgcg aggtggtgca caagaccagc tccagccccg tggtcaagtc 840 cttcaaccgg aacgagtgtt gagctagcga gctc 874

<210> SEQ ID NO 92
<211> LENGTH: 13373
<212> TYPE: DNA
<213> ORGANISM: Artificial Sequence
<220> FEATURE:
<223> OTHER INFORMATION: VkP-IGKV1-39/J-Ck

<400> SEQUENCE: 92 ggccggccca catgaaacaa tgggaaccat gtgacaatca cagaggtgtt gttactatag 60 caaaagggat tgttactctc cacatccctt taagtaactt gaaggcctga tagacccacc 120 ctctaagact tcattagaca ttccctacga atggttatac tctcctgtat actcccaata 180 caactctaaa atatattatt ccatatagtc cttaggtttg tattaaagtt tgactttttt 240 ccttcaaaat atctcttgtc acaacagcgg ctctagagag aaatacattc cctccaggca 300 aatctatgct gcgctggtct gacctgggac cctggggaca ttgcccctgt gctgagttac 360 taagatgagc cagccctgca gctgtgctca gcctgcccca tgccctgctg attgatttgc 420 atgttccaga gcacagcccc ctgccctgaa gactttttta tgggctggtc gcaccctgtg 480 caggagtcag tctcagtcag gagccaccat ggacatgaga gtgcccgccc agctcctggg 540 gctcctgcta ctctggctcc gaggtaagga tggagaacac taggaattta ctcagccagt 600 gtgctcagta ctgactggaa cttcagggaa gttctctgat aacatgatta atagtaagaa 660 tatttgtttt tatgtttcca atctcaggtg ccagatgtga catccagatg acccagagcc 720 ccagcagcct gagcgccagc gtgggcgaca gagtgaccat cacctgcaga gccagccaga 780

```
gcatcagcag ctacctgaac tggtatcagc agaagcccgg caaggccccc aagctgctga    840
tctacgccgc cagctccctg cagagcggcg tgcccagcag attcagcggc agcggctccg    900
gcaccgactt caccctgacc atcagcagcc tgcagcccga ggacttcgcc acctactact    960
gccagcagag ctacagcacc ccccccacct tcggccaggg caccaaggtg gagatcaaac   1020
gtaagtacac ttttctcatc tttttttatg tgtaagacac aggttttcat gttaggagtt   1080
aaagtcagtt cagaaaatct tgagaaaatg gagagggctc attatcagtt gacgtggcat   1140
acagtgtcag attttctgtt tatcaagcta gtgagattag gggcaaaaag aggctttagt   1200
tgagaggaaa gtaattaata ctatggtcac catccaagag attggatcgg agaataagca   1260
tgagtagtta ttgagatctg ggtctgactg caggtagcgt ggtcttctag acgtttaagt   1320
gggagatttg gaggggatga ggaatgaagg aacttcagga tagaaaaggg ctgaagtcaa   1380
gttcagctcc taaaatggat gtgggagcaa actttgaaga taaactgaat gacccagagg   1440
atgaaacagc gcagatcaaa gaggggcctg gagctctgag aagagaagga gactcatccg   1500
tgttgagttt ccacaagtac tgtcttgagt tttgcaataa aagtgggata gcagagttga   1560
gtgagccgta ggctgagttc tctcttttgt ctcctaagtt tttatgacta caaaaatcag   1620
tagtatgtcc tgaaataatc attaagctgt ttgaaagtat gactgcttgc catgtagata   1680
ccatggcttg ctgaataatc agaagaggtg tgactcttat tctaaaattt gtcacaaaat   1740
gtcaaaatga gagactctgt aggaacgagt ccttgacaga cagctcaagg ggtttttttc   1800
ctttgtctca tttctacatg aaagtaaatt tgaaatgatc ttttttatta taagagtaga   1860
aatacagttg ggtttgaact atatgtttta atggccacgg ttttgtaaga catttggtcc   1920
tttgttttcc cagttattac tcgattgtaa ttttatatcg ccagcaatgg actgaaacgg   1980
tccgcaacct cttctttaca actgggtgac ctcgcggctg tgccagccat ttggcgttca   2040
ccctgccgct aagggccatg tgaacccccg cggtagcatc ccttgctccg cgtggaccac   2100
tttcctgagg cacagtgata ggaacagagc cactaatctg aagagaacag agatgtgaca   2160
gactacacta atgtgagaaa aacaaggaaa gggtgactta ttggagattt cagaaataaa   2220
atgcatttat tattatattc ccttatttta attttctatt agggaattag aaagggcata   2280
aactgcttta tccagtgtta tattaaaagc ttaatgtata taatctttta gaggtaaaat   2340
ctacagccag caaaagtcat ggtaaatatt ctttgactga actctcacta aactcctcta   2400
aattatatgt catattaact ggttaaatta atataaattt gtgacatgac cttaactggt   2460
taggtaggat atttttcttc atgcaaaaat atgactaata ataatttagc acaaaaatat   2520
ttcccaatac tttaattctg tgatagaaaa atgtttaact cagctactat aatcccataa   2580
ttttgaaaac tatttattag cttttgtgtt tgacccttcc ctagccaaag gcaactattt   2640
aaggaccctt taaaactctt gaaactactt tagagtcatt aagttattta accactttta   2700
attactttaa aatgatgtca attccctttt aactattaat ttattttaag gggggaaagg   2760
ctgctcataa ttctattgtt tttcttggta aagaactctc agttttcgtt tttactacct   2820
ctgtcaccca agagttggca tctcaacaga ggggactttc cgagaggcca tctggcagtt   2880
gcttaagatc agaagtgaag tctgccagtt cctcccaggc aggtggccca gattacagtt   2940
gacctgttct ggtgtggcta aaaattgtcc catgtggtta caaaccatta gaccagggtc   3000
tgatgaattg ctcagaatat ttctggacac ccaaatacag accctggctt aaggccctgt   3060
ccatacagta ggtttagctt ggctacacca aaggaagcca tacagaggct aatatcagag   3120
```

```
tattcttgga agagacagga gaaaatgaaa gccagtttct gctcttacct tatgtgcttg   3180
tgttcagact cccaaacatc aggagtgtca gataaactgg tctgaatctc tgtctgaagc   3240
atggaactga aaagaatgta gtttcaggga agaaaggcaa tagaaggaag cctgagaata   3300
tcttcaaagg gtcagactca atttactttc taaagaagta gctaggaact agggaataac   3360
ttagaaacaa caagattgta tatatgtgca tcctggcccc attgttcctt atctgtaggg   3420
ataagcgtgc ttttttgtgt gtctgtatat aacataactg tttacacata atacactgaa   3480
atggagccct tccttgttac ttcataccat cctctgtgct tccttcctca ggggccgacg   3540
ccgctcccac cgtgtccatc ttcccccccca gcatggaaca gctgacctct ggcggagcca   3600
ccgtggtctg cttcgtgaac aacttctacc ccagagacat cagcgtgaag tggaagatcg   3660
acggcagcga gcagagggac ggcgtgctgg acagcgtgac cgaccaggac agcaaggact   3720
ccacctacag catgagcagc accctgagcc tgaccaaggt ggagtacgag aggcacaacc   3780
tgtacacctg cgaggtggtg cacaagacca gctccagccc cgtggtcaag tccttcaacc   3840
ggaacgagtg ttgaagacaa aggtcctgag acgccaccac cagctcccca gctccatcct   3900
atcttccctt ctaaggtctt ggaggcttcc ccacaagcga cctaccactg ttgcggtgct   3960
ccaaacctcc tccccacctc cttctcctcc tcctcccttt ccttggcttt tatcatgcta   4020
atatttgcag aaaatattca ataaagtgag tctttgcact tgagatctct gtctttctta   4080
ctaaatggta gtaatcagtt gtttttccag ttacctgggt ttctcttcta aagaagttaa   4140
atgtttagtt gccctgaaat ccaccacact taaaggataa ataaaaccct ccacttgccc   4200
tggttggctg tccactacat ggcagtcctt tctaaggttc acgagtacta ttcatggctt   4260
atttctctgg gccatggtag gtttgaggag gcatacttcc tagttttctt cccctaagtc   4320
gtcaaagtcc tgaaggggga cagtctttac aagcacatgt tctgtaatct gattcaacct   4380
acccagtaaa cttggcgaag caaagtagaa tcattatcac aggaagcaaa ggcaacctaa   4440
atgtgcaagc aataggaaaa tgtggaagcc catcatagta cttggacttc atctgctttt   4500
gtgccttcac taagttttta aacatgagct ggctcctatc tgccattggc aaggctgggc   4560
actacccaca acctacttca aggacctcta taccgtgaga ttacacacat acatcaaaat   4620
ttgggaaaag ttctaccaag ctgagagctg atcaccccac tcttaggtgc ttatctctgt   4680
acaccagaaa ccttaagaag caaccagtat tgagagactc atttatgaaa gtctaaaact   4740
ggatacaacc aaaatgtcca ccaacagtta aattatgaca tgttcacaat tgagctatta   4800
cttaataagg agaattaata aaataaaact taagagcata gtttaatctc ataaacaaga   4860
taataagcaa aacaaaacat tttttcatcc atgtaagttt aaaagcaggt aaaatttaaa   4920
attaagagag acataagttt tgaggtagca agatggaaac tctggggctt ggggaatgtt   4980
ctgtctctct gtatgggatg tgaaagttac tattgtggaa ttgggatcta tgttcttcct   5040
gtatatattg tatacttcat aataacttca cctaaagaaa tatctaatac ccagtgcata   5100
cataaaagag gatacaagga atgaatcata cgtcaaggcc agaaagacaa taaagtaggg   5160
gatccaggat caaatctccc acaaccttga gccttctact attctgcctt ccagagctca   5220
aagtacaaaa cacataattc aaacacatga tccctccttg gggtctcttc cttcatgcat   5280
cgaattagaa atagccatgt ataaaatgag atagaagaga ccttcatcaa caggtcaaag   5340
aatataggta attttgtctg ggtatgaaga gcccacgtat caaaggttac attagggaag   5400
gaagaggaca ctaacagtga ctttcattct ccccctcttc ctggaggccc ctgcatttag   5460
tccctcgtgg gctcatccac tcagcacaca tttactaagc atcttctcag cctacactct   5520
```

gaaggcagtg cagaataatg ttagtgtccc ttcccccagt taatatgcag tccagtttcc 5580
ctgctccttc cctttctcag tccacataag gatgatggga aaggacagtc accaaatagg 5640
agagggcaac cctttgcctt cctacctctt gagaatgtac attattatcc actttttgaa 5700
acttctttta attgcttttt tttaatttgt cttttcaaat agcataacct tgttcatcca 5760
tttctgggaa ccaaatttat caatcaacag tgcctctaat ctggctatta atacaaaaat 5820
gcctcctcaa aatatatatg ttcgagtctt atctaaaaca gaacccacaa taaaaaagaa 5880
gaaagaatac atataagcat ttatataatt ctgagcaacc ttgtgctttg tgaaaaaaat 5940
ataatctaat gtcacatgct gtattctttt tatttaacac tggtgaaatt ataccattag 6000
agagaaagag gacagatcac tgatcctagg atctagggat gttacagata agaaaacaaa 6060
tgtgacaaag agctgtcaca aggaggatct tcaaggtcac agaatcactg tcttgatttc 6120
agtggtggtt acatacattt aaatatgtga taaaatgttg ttgaactata ttcatatatt 6180
gtaccaatgt caaatgctta attttggctc tatagtataa ttatgcacta aataactatt 6240
tggacaaaga aaatgatgtt tacatcaaag gtgaggccat atttgttagg aacataactt 6300
aaaaaccatt ttggataact aatgaaaagc cattttgtgt gccttggcat atcatgccta 6360
agctgtcacc agatagatct aataagacct aagcctcaga agcaagcccc tgcccagcaa 6420
gcaggcagca cagataagag ctaaacccag gacaggccat gatatgctaa tgaactacct 6480
tcaaggtggt gttgctgacc tagtgaacca gccccaagct gtgagcccca atagcacaaa 6540
gctactgccc aaagaaatta tacaaaaatt ggaactttgg gaatggtgtg caggatcgct 6600
ctgctgtatg cctggaacac agcttctcta tgttttgtat tgataccagt ctagaagctt 6660
ccaaaacttt ctcactgaag aagattcccc atgtgggacc cctacagact cttttgccca 6720
aacaactgct tccctcctgg tgtgatatct gttttgcttt tatgttagca taatattata 6780
aggaatgttt gtgtgaataa accaaacata ttttaaaagc aaatattgta tgcacatcct 6840
aattgctaaa aagtttacag ctaatagtcc catgctctcc acaatactgg atccaaataa 6900
gtcctaattt caatgttggg catctttaca gagagaaaga cattaaaaat gaagagacat 6960
gcagagagtg caccatgcca tcgtggagac agactgaagt gacacaactg ttagtcaaag 7020
aggattaagg acttccagaa gccaccaaag gaaggaggta tgaagtggtt tctccctcag 7080
agtatccaga ggagactaaa ccaaccaaca cctttttgct taagacttct tgccttcagg 7140
actgtgagaa ggtagcttcc tattgttcta agccccagta tgtggcattt tgttaaggta 7200
gagtcaagaa accaataaaa tgcagacaga caaaaggata gctgagtttt ccaggccctt 7260
ccttcttatt tttggttttg ttggtggtgg tggtggtggt ggtgatggtg gtggttttgt 7320
ttatgttttg tttggggagt tttttggggt ttttttgggt tttgtttttg ttgttgtttt 7380
gggggttttt gttgttgttg ttgtttgctt ttttgttttt tgtttttttgt ttttttgaga 7440
cagtgtttct ctgtatagcc ctggctgtcc tggagttcct tctatctcta atgtctacat 7500
ctcagagggg atcctctaat ttcaaatgag cagtagctct ccatttttag ctcttattta 7560
ttcatttatt tacttactta cttattgtct gtagatgaaa gaattttgga gtgggaaagg 7620
gttcatgagc ccccagcaac taatgaggag ctacagacaa ttgatgtttc tggggaaagg 7680
agactcagtt tctttgagag tatagcttct gatgggtcaa ccatgttcct gtggctgatg 7740
tcacacccag gagtatgcag acaacagaaa ctggagttaa tgagttgttt taaaaataaa 7800
aaagggcatg aagcttggga tagaaattaa ggataaatac aattaaatac aggaaattct 7860 gaaagaatta ataaaaacat ttctttttt aaaaaaaaat ccagaattag ctatgcttct 7920
tcaaaattgc ttctggagaa ctttacaagt taaataagtt atattgtaga aaaggtagag 7980
aggagaatag tggaagagag agataaggag acttcaaaag gagtggaggg agatagagga 8040
ggagaaagca gaagcaatgg ctgatagaca caggataaga gggaacagaa aggagaaaga 8100
ggaagccagg atgggtattt ctttgcctat ctgtgacttg cacatggtct tggcaattat 8160
tgatgagttc aaggcttaat tcttcacttg tgccaactca acagagtctt tctttcttat 8220
aaccaggccc ccagtatgct catgtatgta tcaggtcctc ttatctcctt atagcaatcc 8280
tgtttataac tgggtaactt tgtgaaggga aggaagtgca cactgagatg tgctacaact 8340
ttttaataca aaattttgaa gagtttgtac aatgtatgta taattaataa ttaatattat 8400
gcactttaga ttttgatttc aactcaagat actaattcta tatatatggg ttaaatcaat 8460
atattaataa gtttaatttc acatgcttat ttttattgtg gttttcgaga cagggtttct 8520
ctgtatagcc ctggctgtcc tggaacccac tttgtagacc aggctggcct caaactcaga 8580
aacctacctg cctctgcctc tgcctctgcc tctgcctctg cctctgcctc tgcctctgcc 8640
tctgcctctg cctctgcctc tgcctctgcc tctgcctctg cctctgcctc tgcctctgcc 8700
tctgcctctg cctctgcctc tgcctctgcc tctgcctctg cctctgcctc tgcctctgcc 8760
tctgcctagt gctggaatta aaggtttgcg ccaccacgcc cggtgaaatt tttaaacttt 8820
atatatgtct cattctattt ctatcagata ggactgtgta gactgtgcta aactaataaa 8880
tgtgccctca aaagtaatcg caagttgtat tgttgttgtt ttgctttgct ttgctttgct 8940
ttgctttgct ttgctttgct ttgctttgct ttgctttgct ttgctttgct ttgctttgct 9000
ttgctttgct ttgctttgct ttgctttttt gttttgggtt tttttccggg ggagggaggg 9060
tggagaaaga atcttactat gaagctctga ctgtcctggg aactcactat atagatcagg 9120
cttgattcaa ctcatagaga tctgccttct tctgcctccc aagtgctggg aataaaggca 9180
tacacctcca tgcccagata gtgatcccaa gttttagcaa aagtttctag acttgacatt 9240
aatcgatgga gatagacatg aattacacaa agaactaatg tggagtttac ctgaatcata 9300
ctctatactt tatcagagat taaattaaca tttaataatc cagtgccagg ctagaggcac 9360
cattcaatgg cagtgtttgc catcatgcat aggcttagtc ttcagtgctg aaaggcattg 9420
ggggcaatat tactcattat acagatgaga aactgggaaa gacttgcctc agattctcta 9480
ctgaaaggct gagtttgtgg cttctagaaa atcttttact ttcaatattt ttaatgtata 9540
atttttttat ttccactgat tttatttttt atttttaaca tttataagaa ataaatgcaa 9600
taaaccaaat acatggacaa aaaaatacaa gaatcatatg atcacctcaa tggaaggaaa 9660
aaaaaagaaa gaaaaagtct ttgataagat tcaacattca ttctttttt attagatatt 9720
ttcttcattt acatttcaaa tgctatcccc aaagcccccct ataccttccc ctgccctgct 9780
ccccaaccca cccactcctg ctttctggcc ctggcattcc tctgtactga ggcatatgat 9840
cttcaaaaaa ccaagggcct ctcctctcat tggtggccga ctattaggcc atcttttgct 9900
acatatgcaa ctagagacac agctctgggg gttactggtt agttcatatt gttagtcctc 9960
ctatagagtt gcagacccct ttagctcctt ggatactttc tctagttcct tcattagggg 10020
ccctgtgtcc catccaatag atgactgtga gcatccactt ctgtatttgc caggcactgg 10080
catagcctca cgagaaagag agagctatgt caggatcctg tcagtaaaat ctttctggca 10140
tatgcaatag tatctgggtt tggtggttgt atatgggatg gatccccaag tggagcagtc 10200
tctgaatggt ccttccttcc atctcagctc caaactttgt ctctataact ccttccatgg 10260 gtattttgtt ccccattcta agaaggagtg aagaatccac actttggtct tccttcttct 10320
tgagtttcat atgttgcatc ttggatattc taagtttctg ggttaatatc cacgtatcag 10380
tgagtgcata tcatgcgtgt tattttgtga ttagtttacc tcactcagga tgatatcctc 10440
cagatgcatc catttgccta agaatttcat taattcactg tttttaattg ctgaatagta 10500
ctccattgtg taaatgtacc acattttctg tatccattcc tctgttgagg ggcatctggg 10560
ttctttccag cttctggcta ttataaataa ggctgctatg agcatagcgg agcatgtgtc 10620
cttatcaagt tggaacatct tctaggtata tgcccaggag aggaattgct ggatcttccg 10680
gtagtaccat caacatgcat tcttaataaa agccctagaa caaggaggac tgtaggaaac 10740
atattccaac ataataaagg ttatgtatga caaactcatg accaatatca tcctaaatga 10800
atgaaaccat taataagctc cattaaaatc agaggactgc ccactatccc tacttctcat 10860
ccataatgag attgaagcat tagctggagc aataaggcaa gagaagggat acaaatggga 10920
aaatattaag tcaaattgtt ttcaattgaa gattatatta tcttataccc aatgacctca 10980
aattttgact agaaaaattg tagaaattat caataatttc agcaaagtgt tatgatgcac 11040
cacatcctta ttcttctccc cagcttctgc ttgcttctct cttcttgctc ttcatccttt 11100
ctgtccttcc atctgcctgc actcttgtct caagactgag tgcagcgtgt aactctcctg 11160
tgactgagta tctcacaaaa cgttctacct gccaaacctg gatgagccct ttgtctttct 11220
gaagctatga ggctctctac atagactcaa gaaggaaatg acagggagga ggtaataatg 11280
aagtggggaa ggctgacatt agcattgctc ctgtgtggct ccttaatttc tcatacttca 11340
cactgagatg ttattaactg tgactcatag gtgaagaagc cagagctaag gttctcatat 11400
ttgagtgtta tagaatgagt agagcagtag ttctcaaact atgggtcatg actcctttat 11460
gggtcaaact acccttttcac acaggttgca tatcagatat cctaatttta tatacatata 11520
tatatgcata tgtatatata tatatttcac aacagtagga aaattattta gtaatcattt 11580
tatagttgtg ggtcatggca acatgaggaa ctgtattaaa gggttgcagc attaggaatg 11640
ttgagaccca ctgtaataga gaatgaggct taaggcaggg ctataaagcc caatggacca 11700
tgtgcctttt ccaacatttg ccacatggta agctctgtat agacttttta aagaacattg 11760
gtttgtaatt ttaaatggat aagggtcttc actgtctatc acccatctat ataataaata 11820
cataagtttt gattccacca tggattcaaa tgcaaaaatc ctcaacctaa gacatagcag 11880
tgaaacattg atgaccaaat aggaaatcca tgtagagacc ttctatcttc tgatggctcc 11940
acaggcacca tcttgcaaca gagttctact ttgctaccag taatgaatac agtgtctcaa 12000
ctcctgccat tgaatcttca ggaagcccct gaaatgactt gtactacacc atttcttaaa 12060
gacagaaaag ctaagactta gagggaataa atgtcatgcc tgagatcatg caaccaatta 12120
agtccaactt ggcctgatca agaggcacaa ttcaaaagca atgttgttcc ttcactagct 12180
cttgtgtatg gttgctgatt ccggaagcaa agtatcagtg aatatcccta gtgggaaaag 12240
acttggaaat caaatgtctc atttaacaga ttaggagatg aaacggtaga ctctgtgtag 12300
ttgtacaccc ctgtgatccc atcgctagga agactgaggc aggaagtcct cgagctcaaa 12360
ccagcttagg ctacacagag aaactatcta aaaaataatt actaactact taataggaga 12420
ttggatgtta agatctggtc actaagaggc agaattgaga ttcgaagcca gtattttcta 12480
cctggtatgt tttaaattgc agtaaggatc taagtgtaga tatataataa taagattcta 12540
ttgatctctg caacaacaga gagtgttaga tttgtttgga aaaaaatatt atcagccaac 12600

```
atcttctacc atttcagtat agcacagagt acccacccat atctccccac ccatccccca  12660

taccagactg gttattgatt ttcatggtga ctggcctgag aagattaaaa aaagtaatgc  12720

taccttattg ggagtgtccc atggaccaag atagcaactg tcatagctac cgtcacactg  12780

ctttgatcaa gaagaccctt tgaggaactg aaaacagaac cttaggcaca tctgttgctt  12840

tcgctcccat cctcctccaa cagcctgggt ggtgcactcc acaccctttc aagtttccaa  12900

agcctcatac acctgctccc taccccagca cctggccaag gctgtatcca gcactgggat  12960

gaaaatgata ccccacctcc atcttgtttg atattactct atctcaagcc ccaggttagt  13020

ccccagtccc aatgcttttg cacagtcaaa actcaacttg gaataatcag tatccttgaa  13080

gagttctgat atggtcactg ggcccatata ccatgtaaga catgtggaaa agatgtttca  13140

tggggcccag acacgttcta gaagtacctg agagtggcaa aaaatagttg tgctaaatag  13200

tttggccatc tttaggctga gagactagga aatacagcga tggactatat cagcattgca  13260

ggatagttgt cagtaaacac cccacaaccc ataacagaag tattctcttc tttctatatc  13320

ccttttccat ccatgtagat ggctgtcttc atatttgttc tagacggccg gcc         13373
```

<210> SEQ ID NO 93
<211> LENGTH: 12892
<212> TYPE: DNA
<213> ORGANISM: Artificial Sequence
<220> FEATURE:
<223> OTHER INFORMATION: VkP-IGKV1-39/J-Ck-delta1

<400> SEQUENCE: 93

```
ggccggccca catgaaacaa tgggaaccat gtgacaatca cagaggtgtt gttactatag     60

caaaagggat tgttactctc cacatccctt taagtaactt gaaggcctga tagacccacc    120

ctctaagact tcattagaca ttccctacga atggttatac tctcctgtat actcccaata    180

caactctaaa atatattatt ccatatagtc cttaggtttg tattaaagtt tgactttttt    240

ccttcaaaat atctcttgtc acaacagcgg ctctagagag aaatacattc cctccaggca    300

aatctatgct gcgctggtct gacctgggac cctggggaca ttgcccctgt gctgagttac    360

taagatgagc cagccctgca gctgtgctca gcctgcccca tgccctgctg attgatttgc    420

atgttccaga gcacagcccc ctgccctgaa gactttttta tgggctggtc gcaccctgtg    480

caggagtcag tctcagtcag gagccaccat ggacatgaga gtgcccgccc agctcctggg    540

gctcctgcta ctctggctcc gaggtaagga tggagaacac taggaattta ctcagccagt    600

gtgctcagta ctgactggaa cttcagggaa gttctctgat aacatgatta atagtaagaa    660

tatttgtttt tatgtttcca atctcaggtg ccagatgtga catccagatg acccagagcc    720

ccagcagcct gagcgccagc gtgggcgaca gagtgaccat cacctgcaga gccagccaga    780

gcatcagcag ctacctgaac tggtatcagc agaagcccgg caaggccccc aagctgctga    840

tctacgccgc cagctccctg cagagcggcg tgcccagcag attcagcggc agcggctccg    900

gcaccgactt caccctgacc atcagcagcc tgcagcccga ggacttcgcc acctactact    960

gccagcagag ctacagcacc ccccccacct tcggccaggg caccaaggtg gagatcaaac   1020

gtaagtacac ttttctcatc tttttttatg tgtaagacac aggttttcat gttaggagtt   1080

aaagtcagtt cagaaaatct tgagaaaatg gagagggctc attatcagtt gacgtggcat   1140

acagtgtcag attttctgtt tatcaagcta gtgagattag gggcaaaaag aggctttagt   1200

tgagaggaaa gtaattaata ctatggtcac catccaagag attggatcgg agaataagca   1260

tgagtagtta ttgagatctg ggtctgactg caggtagcgt ggtcttctag acgtttaagt   1320
```

gggagatttg gaggggatga ggaatgaagg aacttcagga tagaaaaggg ctgaagtcaa 1380
gttcagctcc taaaatggat gtgggagcaa actttgaaga taaactgaat gacccagagg 1440
atgaaacagc gcagatcaaa gaggggcctg gagctctgag aagagaagga gactcatccg 1500
tgttgagttt ccacaagtac tgtcttgagt tttgcaataa aagtgggata gcagagttga 1560
gtgagccgta ggctgagttc tctcttttgt ctcctaagtt tttatgacta caaaaatcag 1620
tagtatgtcc tgaaataatc attaagctgt ttgaaagtat gactgcttgc catgtagata 1680
ccatggcttg ctgaataatc agaagaggtg tgactcttat tctaaaattt gtcacaaaat 1740
gtcaaaatga gagactctgt aggaacgagt ccttgacaga cagctcaagg ggtttttttc 1800
ctttgtctca tttctacatg aaagtaaatt tgaaatgatc ttttttatta taagagtaga 1860
aatacagttg ggtttgaact atatgtttta atggccacgg ttttgtaaga catttggtcc 1920
tttgttttcc cagttattac tcgattgtaa ttttatatcg ccagcaatgg actgaaacgg 1980
tccgcaacct cttctttaca actgggtgac ctcgcggctg tgccagccat ttggcgttca 2040
ccctgccgct aagggccatg tgaacccccg cggtagcatc ccttgctccg cgtggaccac 2100
tttcctgagg cacagtgata ggaacagagc cactaatctg aagagaacag agatgtgaca 2160
gactacacta atgtgagaaa aacaaggaaa gggtgactta ttggagattt cagaaataaa 2220
atgcatttat tattatattc ccttatttta attttctatt agggaattag aaagggcata 2280
aactgcttta tccagtgtta tattaaaagc ttaatgtata taatctttta gaggtaaaat 2340
ctacagccag caaaagtcat ggtaaatatt ctttgactga actctcacta aactcctcta 2400
aattatatgt catattaact ggttaaatta atataaattt gtgacatgac cttaactggt 2460
taggtaggat atttttcttc atgcaaaaat atgactaata ataatttagc acaaaaatat 2520
ttcccaatac tttaattctg tgatagaaaa atgtttaact cagctactat aatcccataa 2580
ttttgaaaac tatttatttg gctacaccaa aggaagccat acagaggcta atatcagagt 2640
attcttggaa gagacaggag aaaatgaaag ccagtttctg ctcttacctt atgtgcttgt 2700
gttcagactc ccaaacatca ggagtgtcag ataaactggt ctgaatctct gtctgaagca 2760
tggaactgaa aagaatgtag tttcagggaa gaaaggcaat agaaggaagc ctgagaatat 2820
cttcaaaggg tcagactcaa tttactttct aaagaagtag ctaggaacta gggaataact 2880
tagaaacaac aagattgtat atatgtgcat cctggcccca ttgttcctta tctgtaggga 2940
taagcgtgct tttttgtgtg tctgtatata acataactgt ttacacataa tacactgaaa 3000
tggagccctt ccttgttact tcataccatc ctctgtgctt ccttcctcag gggccgacgc 3060
cgctcccacc gtgtccatct tccccccag catggaacag ctgacctctg gcggagccac 3120
cgtggtctgc ttcgtgaaca acttctaccc cagagacatc agcgtgaagt ggaagatcga 3180
cggcagcgag cagagggacg gcgtgctgga cagcgtgacc gaccaggaca gcaaggactc 3240
cacctacagc atgagcagca ccctgagcct gaccaaggtg gagtacgaga ggcacaacct 3300
gtacacctgc gaggtggtgc acaagaccag ctccagcccc gtggtcaagt ccttcaaccg 3360
gaacgagtgt tgaagacaaa ggtcctgaga cgccaccacc agctccccag ctccatccta 3420
tcttcccttc taaggtcttg gaggcttccc cacaagcgac ctaccactgt tgcggtgctc 3480
caaacctcct ccccacctcc ttctcctcct cctccctttc cttggctttt atcatgctaa 3540
tatttgcaga aaatattcaa taaagtgagt ctttgcactt gagatctctg tctttcttac 3600
taaatggtag taatcagttg tttttccagt tacctgggtt tctcttctaa agaagttaaa 3660

```
tgtttagttg ccctgaaatc caccacactt aaaggataaa taaaaccctc cacttgccct   3720
ggttggctgt ccactacatg gcagtccttt ctaaggttca cgagtactat tcatggctta   3780
tttctctggg ccatggtagg tttgaggagg catacttcct agttttcttc ccctaagtcg   3840
tcaaagtcct gaagggggac agtctttaca agcacatgtt ctgtaatctg attcaaccta   3900
cccagtaaac ttggcgaagc aaagtagaat cattatcaca ggaagcaaag gcaacctaaa   3960
tgtgcaagca ataggaaaat gtggaagccc atcatagtac ttggacttca tctgcttttg   4020
tgccttcact aagtttttaa acatgagctg gctcctatct gccattggca aggctgggca   4080
ctacccacaa cctacttcaa ggacctctat accgtgagat tacacacata catcaaaatt   4140
tgggaaaagt tctaccaagc tgagagctga tcaccccact cttaggtgct tatctctgta   4200
caccagaaac cttaagaagc aaccagtatt gagagactca tttatgaaag tctaaaactg   4260
gatacaacca aaatgtccac caacagttaa attatgacat gttcacaatt gagctattac   4320
ttaataagga gaattaataa aataaaactt aagagcatag tttaatctca taaacaagat   4380
aataagcaaa acaaaacatt ttttcatcca tgtaagttta aaagcaggta aaatttaaaa   4440
ttaagagaga cataagtttt gaggtagcaa gatggaaact ctggggcttg gggaatgttc   4500
tgtctctctg tatgggatgt gaaagttact attgtggaat tgggatctat gttcttcctg   4560
tatatattgt atacttcata ataacttcac ctaaagaaat atctaatacc cagtgcatac   4620
ataaaagagg atacaaggaa tgaatcatac gtcaaggcca gaaagacaat aaagtagggg   4680
atccaggatc aaatctccca caaccttgag ccttctacta ttctgccttc cagagctcaa   4740
agtacaaaac acataattca aacacatgat ccctccttgg ggtctcttcc ttcatgcatc   4800
gaattagaaa tagccatgta taaaatgaga tagaagagac cttcatcaac aggtcaaaga   4860
atataggtaa ttttgtctgg gtatgaagag cccacgtatc aaaggttaca ttagggaagg   4920
aagaggacac taacagtgac tttcattctc cccctcttcc tggaggcccc tgcatttagt   4980
ccctcgtggg ctcatccact cagcacacat ttactaagca tcttctcagc ctacactctg   5040
aaggcagtgc agaataatgt tagtgtccct tcccccagtt aatatgcagt ccagtttccc   5100
tgctccttcc ctttctcagt ccacataagg atgatgggaa aggacagtca ccaaatagga   5160
gagggcaacc ctttgccttc ctacctcttg agaatgtaca ttattatcca ctttttgaaa   5220
cttcttttaa ttgctttttt ttaatttgtc ttttcaaata gcataacctt gttcatccat   5280
ttctgggaac caaatttatc aatcaacagt gcctctaatc tggctattaa tacaaaaatg   5340
cctcctcaaa atatatatgt tcgagtctta tctaaaacag aacccacaat aaaaaagaag   5400
aaagaataca tataagcatt tatataattc tgagcaacct tgtgctttgt gaaaaaaata   5460
taatctaatg tcacatgctg tattcttttt atttaacact ggtgaaatta taccattaga   5520
gagaaagagg acagatcact gatcctagga tctagggatg ttacagataa gaaaacaaat   5580
gtgacaaaga gctgtcacaa ggaggatctt caaggtcaca gaatcactgt cttgatttca   5640
gtggtggtta catacattta aatatgtgat aaaatgttgt tgaactatat tcatatattg   5700
taccaatgtc aaatgcttaa ttttggctct atagtataat tatgcactaa ataactattt   5760
ggacaaagaa aatgatgttt acatcaaagg tgaggccata tttgttagga acataactta   5820
aaaaccattt tggataacta atgaaaagcc attttgtgtg ccttggcata tcatgcctaa   5880
gctgtcacca gatagatcta ataagaccta agcctcagaa gcaagcccct gcccagcaag   5940
caggcagcac agataagagc taaacccagg acaggccatg atatgctaat gaactacctt   6000
caaggtggtg ttgctgacct agtgaaccag ccccaagctg tgagccccaa tagcacaaag   6060
```

```
ctactgccca aagaaattat acaaaaattg gaactttggg aatggtgtgc aggatcgctc   6120
tgctgtatgc ctggaacaca gcttctctat gttttgtatt gataccagtc tagaagcttc   6180
caaaactttc tcactgaaga agattcccca tgtgggaccc ctacagactc ttttgcccaa   6240
acaactgctt ccctcctggt gtgatatctg ttttgctttt atgttagcat aatattataa   6300
ggaatgtttg tgtgaataaa ccaaacatat tttaaaagca aatattgtat gcacatccta   6360
attgctaaaa agtttacagc taatagtccc atgctctcca caatactgga tccaaataag   6420
tcctaatttc aatgttgggc atctttacag agagaaagac attaaaaatg aagagacatg   6480
cagagagtgc accatgccat cgtggagaca gactgaagtg acacaactgt tagtcaaaga   6540
ggattaagga cttccagaag ccaccaaagg aaggaggtat gaagtggttt ctccctcaga   6600
gtatccagag gagactaaac caaccaacac ctttttgctt aagacttctt gccttcagga   6660
ctgtgagaag gtagcttcct attgttctaa gccccagtat gtggcatttt gttaaggtag   6720
agtcaagaaa ccaataaaat gcagacagac aaaaggatag ctgagttttc caggcccttc   6780
cttcttattt ttggttttgt tggtggtggt ggtggtggtg gtgatggtgg tggttttgtt   6840
tatgttttgt ttggggagtt ttttggggtt tttttgggtt ttgtttttgt tgttgttttg   6900
ggggtttttg ttgttgttgt tgtttgcttt tttgtttttt gtttttttgtt tttttgagac   6960
agtgtttctc tgtatagccc tggctgtcct ggagttcctt ctatctctaa tgtctacatc   7020
tcagagggga tcctctaatt tcaaatgagc agtagctctc catttttagc tcttatttat   7080
tcatttattt acttacttac ttattgtctg tagatgaaag aattttggag tgggaaaggg   7140
ttcatgagcc cccagcaact aatgaggagc tacagacaat tgatgtttct ggggaaagga   7200
gactcagttt ctttgagagt atagcttctg atgggtcaac catgttcctg tggctgatgt   7260
cacacccagg agtatgcaga caacagaaac tggagttaat gagttgtttt aaaaataaaa   7320
aagggcatga agcttgggat agaaattaag gataaataca attaaataca ggaaattctg   7380
aaagaattaa taaaaacatt tctttttta aaaaaaaatc cagaattagc tatgcttctt   7440
caaaattgct tctggagaac tttacaagtt aaataagtta tattgtagaa aaggtagaga   7500
ggagaatagt ggaagagaga gataaggaga cttcaaaagg agtggaggga gatagaggag   7560
gagaaagcag aagcaatggc tgatagacac aggataagag ggaacagaaa ggagaaagag   7620
gaagccagga tgggtatttc tttgcctatc tgtgacttgc acatggtctt ggcaattatt   7680
gatgagttca aggcttaatt cttcacttgt gccaactcaa cagagtcttt ctttcttata   7740
accaggcccc cagtatgctc atgtatgtat caggtcctct tatctcctta tagcaatcct   7800
gtttataact gggtaacttt gtgaagggaa ggaagtgcac actgagatgt gctacaactt   7860
tttaatacaa aattttgaag agtttgtaca atgtatgtat aattaataat taatattatg   7920
cactttagat tttgatttca actcaagata ctaattctat atatatgggt taaatcaata   7980
tattaataag tttaatttca catgcttatt tttattgtgg ttttcgagac agggtttctc   8040
tgtatagccc tggctgtcct ggaacccact ttgtagacca ggctggcctc aaactcagaa   8100
acctacctgc ctctgcctct gcctctgcct ctgcctctgc ctctgcctct gcctctgcct   8160
ctgcctctgc ctctgcctct gcctctgcct ctgcctctgc ctctgcctct gcctctgcct   8220
ctgcctctgc ctctgcctct gcctctgcct ctgcctctgc ctctgcctct gcctctgcct   8280
ctgcctagtg ctggaattaa aggtttgcgc caccacgccc ggtgaaattt ttaaacttta   8340
tatatgtctc attctatttc tatcagatag gactgtgtag actgtgctaa actaataaat   8400
```

gtgccctcaa aagtaatcgc aagttgtatt gttgttgttt tgctttgctt tgctttgctt 8460
tgctttgctt tgctttgctt tgctttgctt tgctttgctt tgctttgctt tgctttgctt 8520
tgctttgctt tgctttgctt tgctttttg ttttgggttt ttttccgggg gagggagggt 8580
ggagaaagaa tcttactatg aagctctgac tgtcctggga actcactata tagatcaggc 8640
ttgattcaac tcatagagat ctgccttctt ctgcctccca agtgctggga ataaaggcat 8700
acacctccat gcccagatag tgatcccaag ttttagcaaa agtttctaga cttgacatta 8760
atcgatggag atagacatga attacacaaa gaactaatgt ggagtttacc tgaatcatac 8820
tctatacttt atcagagatt aaattaacat ttaataatcc agtgccaggc tagaggcacc 8880
attcaatggc agtgtttgcc atcatgcata ggcttagtct tcagtgctga aaggcattgg 8940
gggcaatatt actcattata cagatgagaa actgggaaag acttgcctca gattctctac 9000
tgaaaggctg agtttgtggc ttctagaaaa tcttttactt tcaatatttt taatgtataa 9060
tttttttatt tccactgatt ttatttttta tttttaacat ttataagaaa taaatgcaat 9120
aaaccaaata catggacaaa aaaatacaag aatcatatga tcacctcaat ggaaggaaaa 9180
aaaaagaaag aaaaagtctt tgataagatt caacattcat tctttttta ttagatattt 9240
tcttcattta catttcaaat gctatcccca aagcccccta taccttcccc tgccctgctc 9300
cccaacccac ccactcctgc tttctggccc tggcattcct ctgtactgag gcatatgatc 9360
ttcaaaaaac caagggcctc tcctctcatt ggtggccgac tattaggcca tcttttgcta 9420
catatgcaac tagagacaca gctctggggg ttactggtta gttcatattg ttagtcctcc 9480
tatagagttg cagacccctt tagctccttg gatactttct ctagttcctt cattaggggc 9540
cctgtgtccc atccaataga tgactgtgag catccacttc tgtatttgcc aggcactggc 9600
atagcctcac gagaaagaga gagctatgtc aggatcctgt cagtaaaatc tttctggcat 9660
atgcaatagt atctgggttt ggtggttgta tatgggatgg atccccaagt ggagcagtct 9720
ctgaatggtc cttccttcca tctcagctcc aaactttgtc tctataactc cttccatggg 9780
tattttgttc cccattctaa gaaggagtga agaatccaca ctttggtctt ccttcttctt 9840
gagtttcata tgttgcatct tggatattct aagtttctgg gttaatatcc acgtatcagt 9900
gagtgcatat catgcgtgtt attttgtgat tagtttacct cactcaggat gatatcctcc 9960
agatgcatcc atttgcctaa gaatttcatt aattcactgt ttttaattgc tgaatagtac 10020
tccattgtgt aaatgtacca cattttctgt atccattcct ctgttgaggg gcatctgggt 10080
tctttccagc ttctggctat tataaataag gctgctatga gcatagcgga gcatgtgtcc 10140
ttatcaagtt ggaacatctt ctaggtatat gcccaggaga ggaattgctg gatcttccgg 10200
tagtaccatc aacatgcatt cttaataaaa gccctagaac aaggaggact gtaggaaaca 10260
tattccaaca taataaaggt tatgtatgac aaactcatga ccaatatcat cctaaatgaa 10320
tgaaaccatt aataagctcc attaaaatca gaggactgcc cactatccct acttctcatc 10380
cataatgaga ttgaagcatt agctggagca ataaggcaag agaagggata caaatgggaa 10440
aatattaagt caaattgttt tcaattgaag attatattat cttataccca atgacctcaa 10500
attttgacta gaaaaattgt agaaattatc aataatttca gcaaagtgtt atgatgcacc 10560
acatccttat tcttctcccc agcttctgct tgcttctctc ttcttgctct tcatcctttc 10620
tgtccttcca tctgcctgca ctcttgtctc aagactgagt gcagcgtgta actctcctgt 10680
gactgagtat ctcacaaaac gttctacctg ccaaacctgg atgagccctt tgtctttctg 10740
aagctatgag gctctctaca tagactcaag aaggaaatga cagggaggag gtaataatga 10800

```
agtggggaag gctgacatta gcattgctcc tgtgtggctc cttaatttct catacttcac  10860
actgagatgt tattaactgt gactcatagg tgaagaagcc agagctaagg ttctcatatt  10920
tgagtgttat agaatgagta gagcagtagt tctcaaacta tgggtcatga ctcctttatg  10980
ggtcaaacta ccctttcaca caggttgcat atcagatatc ctaattttat atacatatat  11040
atatgcatat gtatatatat atatttcaca acagtaggaa aattatttag taatcatttt  11100
atagttgtgg gtcatggcaa catgaggaac tgtattaaag ggttgcagca ttaggaatgt  11160
tgagacccac tgtaatagag aatgaggctt aaggcagggc tataaagccc aatggaccat  11220
gtgccttttc caacatttgc cacatggtaa gctctgtata gactttttaa agaacattgg  11280
tttgtaattt taaatggata agggtcttca ctgtctatca cccatctata taataaatac  11340
ataagttttg attccaccat ggattcaaat gcaaaaatcc tcaacctaag acatagcagt  11400
gaaacattga tgaccaaata ggaaatccat gtagagacct tctatcttct gatggctcca  11460
caggcaccat cttgcaacag agttctactt tgctaccagt aatgaataca gtgtctcaac  11520
tcctgccatt gaatcttcag gaagcccctg aaatgacttg tactacacca tttcttaaag  11580
acagaaaagc taagacttag agggaataaa tgtcatgcct gagatcatgc aaccaattaa  11640
gtccaacttg gcctgatcaa gaggcacaat tcaaaagcaa tgttgttcct tcactagctc  11700
ttgtgtatgg ttgctgattc cggaagcaaa gtatcagtga atatccctag tgggaaaaga  11760
cttggaaatc aaatgtctca tttaacagat taggagatga aacggtagac tctgtgtagt  11820
tgtacacccc tgtgatccca tcgctaggaa gactgaggca ggaagtcctc gagctcaaac  11880
cagcttaggc tacacagaga aactatctaa aaaataatta ctaactactt aataggagat  11940
tggatgttaa gatctggtca ctaagaggca gaattgagat tcgaagccag tattttctac  12000
ctggtatgtt ttaaattgca gtaaggatct aagtgtagat atataataat aagattctat  12060
tgatctctgc aacaacagag agtgttagat ttgtttggaa aaaaatatta tcagccaaca  12120
tcttctacca tttcagtata gcacagagta cccacccata tctccccacc catcccccat  12180
accagactgg ttattgattt tcatggtgac tggcctgaga agattaaaaa aagtaatgct  12240
accttattgg gagtgtccca tggaccaaga tagcaactgt catagctacc gtcacactgc  12300
tttgatcaag aagacccttt gaggaactga aaacagaacc ttaggcacat ctgttgcttt  12360
cgctcccatc ctcctccaac agcctgggtg gtgcactcca cacccttca agtttccaaa  12420
gcctcataca cctgctccct accccagcac ctggccaagg ctgtatccag cactgggatg  12480
aaaatgatac cccacctcca tcttgtttga tattactcta tctcaagccc caggttagtc  12540
cccagtccca atgcttttgc acagtcaaaa ctcaacttgg aataatcagt atccttgaag  12600
agttctgata tggtcactgg gcccatatac catgtaagac atgtggaaaa gatgtttcat  12660
ggggcccaga cacgttctag aagtacctga gagtggcaaa aaatagttgt gctaaatagt  12720
ttggccatct ttaggctgag agactaggaa atacagcgat ggactatatc agcattgcag  12780
gatagttgtc agtaaacacc ccacaaccca taacagaagt attctcttct ttctatatcc  12840
cttttccatc catgtagatg gctgtcttca tatttgttct agacggccgg cc          12892
```

<210> SEQ ID NO 94
<211> LENGTH: 6425
<212> TYPE: DNA
<213> ORGANISM: Artificial Sequence
<220> FEATURE:
<223> OTHER INFORMATION: VkP-IGKV1-39/J-Ck-delta2

<400> SEQUENCE: 94 ggccggccca catgaaacaa tgggaaccat gtgacaatca cagaggtgtt gttactatag 60
caaaagggat tgttactctc cacatccctt taagtaactt gaaggcctga tagacccacc 120
ctctaagact tcattagaca ttccctacga atggttatac tctcctgtat actcccaata 180
caactctaaa atatattatt ccatatagtc cttaggtttg tattaaagtt tgactttttt 240
ccttcaaaat atctcttgtc acaacagcgg ctctagagag aaatacattc cctccaggca 300
aatctatgct gcgctggtct gacctgggac cctggggaca ttgcccctgt gctgagttac 360
taagatgagc cagccctgca gctgtgctca gcctgcccca tgccctgctg attgatttgc 420
atgttccaga gcacagcccc ctgccctgaa gactttttta tgggctggtc gcaccctgtg 480
caggagtcag tctcagtcag gagccaccat ggacatgaga gtgcccgccc agctcctggg 540
gctcctgcta ctctggctcc gaggtaagga tggagaacac taggaattta ctcagccagt 600
gtgctcagta ctgactggaa cttcagggaa gttctctgat aacatgatta atagtaagaa 660
tatttgtttt tatgtttcca atctcaggtg ccagatgtga catccagatg acccagagcc 720
ccagcagcct gagcgccagc gtgggcgaca gagtgaccat cacctgcaga gccagccaga 780
gcatcagcag ctacctgaac tggtatcagc agaagcccgg caaggccccc aagctgctga 840
tctacgccgc cagctccctg cagagcggcg tgcccagcag attcagcggc agcggctccg 900
gcaccgactt caccctgacc atcagcagcc tgcagcccga ggacttcgcc acctactact 960
gccagcagag ctacagcacc ccccccacct tcggccaggg caccaaggtg gagatcaaac 1020
gtaagtacac ttttctcatc tttttttatg tgtaagacac aggttttcat gttaggagtt 1080
aaagtcagtt cagaaaatct tgagaaaatg gagagggctc attatcagtt gacgtggcat 1140
acagtgtcag attttctgtt tatcaagcta gtgagattag gggcaaaaag aggctttagt 1200
tgagaggaaa gtaattaata ctatggtcac catccaagag attggatcgg agaataagca 1260
tgagtagtta ttgagatctg ggtctgactg caggtagcgt ggtcttctag acgtttaagt 1320
gggagatttg gaggggatga ggaatgaagg aacttcagga tagaaaaggg ctgaagtcaa 1380
gttcagctcc taaaatggat gtgggagcaa actttgaaga taaactgaat gacccagagg 1440
atgaaacagc gcagatcaaa gaggggcctg gagctctgag aagagaagga gactcatccg 1500
tgttgagttt ccacaagtac tgtcttgagt tttgcaataa aagtgggata gcagagttga 1560
gtgagccgta ggctgagttc tctcttttgt ctcctaagtt tttatgacta caaaaatcag 1620
tagtatgtcc tgaaataatc attaagctgt ttgaaagtat gactgcttgc catgtagata 1680
ccatggcttg ctgaataatc agaagaggtg tgactcttat tctaaaattt gtcacaaaat 1740
gtcaaaatga gagactctgt aggaacgagt ccttgacaga cagctcaagg ggtttttttc 1800
ctttgtctca tttctacatg aaagtaaatt tgaaatgatc ttttttatta taagagtaga 1860
aatacagttg ggtttgaact atatgtttta atggccacgg ttttgtaaga catttggtcc 1920
tttgttttcc cagttattac tcgattgtaa ttttatatcg ccagcaatgg actgaaacgg 1980
tccgcaacct cttctttaca actgggtgac ctcgcggctg tgccagccat ttggcgttca 2040
ccctgccgct aagggccatg tgaacccccg cggtagcatc ccttgctccg cgtggaccac 2100
tttcctgagg cacagtgata ggaacagagc cactaatctg aagagaacag agatgtgaca 2160
gactacacta atgtgagaaa aacaaggaaa gggtgactta ttggagattt cagaaataaa 2220
atgcatttat tattatattc ccttatttta attttctatt agggaattag aaagggcata 2280
aactgcttta tccagtgtta tattaaaagc ttaatgtata taatctttta gaggtaaaat 2340

```
ctacagccag caaaagtcat ggtaaatatt ctttgactga actctcacta aactcctcta   2400
aattatatgt catattaact ggttaaatta atataaattt gtgacatgac cttaactggt   2460
taggtaggat atttttcttc atgcaaaaat atgactaata ataatttagc acaaaaatat   2520
ttcccaatac tttaattctg tgatagaaaa atgtttaact cagctactat aatcccataa   2580
ttttgaaaac tatttatttg gctacaccaa aggaagccat acagaggcta atatcagagt   2640
attcttggaa gagacaggag aaaatgaaag ccagtttctg ctcttacctt atgtgcttgt   2700
gttcagactc ccaaacatca ggagtgtcag ataaactggt ctgaatctct gtctgaagca   2760
tggaactgaa aagaatgtag tttcagggaa gaaaggcaat agaaggaagc ctgagaatat   2820
cttcaaaggg tcagactcaa tttactttct aaagaagtag ctaggaacta gggaataact   2880
tagaaacaac aagattgtat atatgtgcat cctggcccca ttgttcctta tctgtaggga   2940
taagcgtgct tttttgtgtg tctgtatata acataactgt ttacacataa tacactgaaa   3000
tggagccctt ccttgttact tcataccatc ctctgtgctt ccttcctcag gggccgacgc   3060
cgctcccacc gtgtccatct tcccccccag catggaacag ctgacctctg gcggagccac   3120
cgtggtctgc ttcgtgaaca acttctaccc cagagacatc agcgtgaagt ggaagatcga   3180
cggcagcgag cagagggacg gcgtgctgga cagcgtgacc gaccaggaca gcaaggactc   3240
cacctacagc atgagcagca ccctgagcct gaccaaggtg gagtacgaga ggcacaacct   3300
gtacacctgc gaggtggtgc acaagaccag ctccagcccc gtggtcaagt ccttcaaccg   3360
gaacgagtgt tgaagacaaa ggtcctgaga cgccaccacc agctccccag ctccatccta   3420
tcttcccttc taaggtcttg gaggcttccc cacaagcgac ctaccactgt tgcggtgctc   3480
caaacctcct ccccacctcc ttctcctcct cctccctttc cttggctttt atcatgctaa   3540
tatttgcaga aaatattcaa taaagtgagt ctttgcactt gagatctctg tctttcttac   3600
taaatggtag taatcagttg tttttccagt tacctgggtt tctcttctaa agaagttaaa   3660
tgtttagttg ccctgaaatc caccacactt aaaggataaa taaaaccctc cacttgccct   3720
ggttggctgt ccactacatg gcagtccttt ctaaggttca cgagtactat tcatggctta   3780
tttctctggg ccatggtagg tttgaggagg catacttcct agttttcttc ccctaagtcg   3840
tcaaagtcct gaagggggac agtctttaca agcacatgtt ctgtaatctg attcaaccta   3900
cccagtaaac ttggcgaagc aaagtagaat cattatcaca ggaagcaaag gcaacctaaa   3960
tgtgcaagca ataggaaaat gtggaagccc atcatagtac ttggacttca tctgcttttg   4020
tgccttcact aagtttttaa acatgagctg gctcctatct gccattggca aggctgggca   4080
ctacccacaa cctacttcaa ggacctctat accgtgagat tacacacata catcaaaatt   4140
tgggaaaagt tctaccaagc tgagagctga tcaccccact cttaggtgct tatctctgta   4200
caccagaaac cttaagaagc aaccagtatt gagagactca tttatgaaag tctaaaactg   4260
gatacaacca aaatgtccac caacagttaa attatgacat gttcacaatt gagctattac   4320
ttaataagga gaattaataa aataaaactt aagagcatag tttaatctca taaacaagat   4380
aataagcaaa acaaaacatt ttttcatcca tgtaagttta aaagcaggta aaatttaaaa   4440
ttaagagaga cataagtttt gaggtagcaa gatggaaact ctggggcttg gggaatgttc   4500
tgtctctctg tatgggatgt gaaagttact attgtggaat tgggatctat gttcttcctg   4560
tatatattgt atacttcata ataacttcac ctaaagaaat atctaatacc cagtgcatac   4620
ataaaagagg atacaaggaa tgaatcatac gtcaaggcca gaaagacaat aaagtagggg   4680
```

```
atccaggatc aaatctccca caaccttgag ccttctacta ttctgccttc cagagctcaa   4740
agtacaaaac acataattca aacacatgat ccctccttgg ggtctcttcc ttcatgcatc   4800
gaattagaaa tagccatgta taaaatgaga tagaagagac cttcatcaac aggtcaaaga   4860
atataggtaa ttttgtctgg gtatgaagag cccacgtatc aaaggttaca ttagggaagg   4920
aagaggacac taacagtgac tttcattctc cccctcttcc tggaggcccc tgcatttagt   4980
ccctcgtggg ctcatccact cagcacacat ttactaagca tcttctcagc ctacactctg   5040
aaggcagtgc agaataatgt tagtgtccct tcccccagtt aatatgcagt ccagtttccc   5100
tgctccttcc ctttctcagt ccacataagg atgatgggaa aggacagtca ccaaatagga   5160
gagggcaacc ctttgccttc ctacctcttg agaatgtaca ttattatcca ctttttgaaa   5220
cttcttttaa ttgctttttt ttaatttgtc ttttcaaata gcataacctt gttcatccat   5280
ttctgggaac caaatttatc aatcaacagt gcctctaatc tggctattaa tacaaaaatg   5340
cctcctcaaa atatatatgt tcgagtctta tctaaaacag aacccacaat aaaaaagaag   5400
aaagaataca tataagcatt tatataattc tgagcaacct tgtgctttgt gaaaaaaata   5460
taatctaatg tcacatgctg tattcttttt atttaacact ggtgaaatta taccattaga   5520
gagaaagagg acagatcact gatcctagga tctagggatg ttacagataa gaaaacaaat   5580
gtgacaaaga gctgtcacaa ggaggatctt caaggtcaca gaatcactgt cttgatttca   5640
gtggtggtta catacattta aatatgtgat aaaatgttgt tgaactatat tcatatattg   5700
taccaatgtc aaatgcttaa ttttggctct atagtataat tatgcactaa ataactattt   5760
ggacaaagaa aatgatgttt acatcaaagg tgaggccata tttgttagga acataactta   5820
aaaaccattt tggataacta atgaaaagcc attttgtgtg ccttggcata tcatgcctaa   5880
gctgtcacca gatagatcta ataagaccta agcctcagaa gcaagcccct gcccagcaag   5940
caggcagcac agataagagc taaacccagg acaggccatg atatgctaat gaactacctt   6000
caaggtggtg ttgctgacct agtgaaccag ccccaagctg tgagccccaa tagcacaaag   6060
ctactgccca aagaaattat acaaaaattg gaactttggg aatggtgtgc aggatcgctc   6120
tgctgtatgc ctggaacaca gcttctctat gttttgtatt gataccagtc tagaagcttc   6180
caaaactttc tcactgaaga agattcccca tgtgggaccc ctacagactc ttttgcccaa   6240
acaactgctt ccctcctggt gtgatcatgg accaagatag caactgtcat agctaccgtc   6300
acactgcttt gatcaagaag acccttttgag gaactgaaaa cagaacctta ggcacatctg   6360
ttgctttcgc tcccatcctc ctccaacagc atggctgtct tcatatttgt tctagacggc   6420
cggcc                                                               6425
```

<210> SEQ ID NO 95
<211> LENGTH: 13382
<212> TYPE: DNA
<213> ORGANISM: Artificial Sequence
<220> FEATURE:
<223> OTHER INFORMATION: VkP-IGLV2-14/J-Ck

<400> SEQUENCE: 95

```
ggccggccca catgaaacaa tgggaaccat gtgacaatca cagaggtgtt gttactatag     60
caaaagggat tgttactctc cacatccctt taagtaactt gaaggcctga tagacccacc    120
ctctaagact tcattagaca ttccctacga atggttatac tctcctgtat actcccaata    180
caactctaaa atatattatt ccatatagtc cttaggtttg tattaaagtt tgactttttt    240
ccttcaaaat atctcttgtc acaacagcgg ctctagagag aaatacattc cctccaggca    300
```

```
aatctatgct gcgctggtct gacctgggac cctggggaca ttgcccctgt gctgagttac    360
taagatgagc cagccctgca gctgtgctca gcctgcccca tgccctgctg attgatttgc    420
atgttccaga gcacagcccc ctgccctgaa gactttttta tgggctggtc gcaccctgtg    480
caggagtcag tctcagtcag gagccaccat ggacatgaga gtgcccgccc agctcctggg    540
gctcctgcta ctctggctcc gaggtaagga tggagaacac taggaattta ctcagccagt    600
gtgctcagta ctgactggaa cttcagggaa gttctctgat aacatgatta atagtaagaa    660
tatttgtttt tatgtttcca atctcaggtg ccagatgtca gtctgccctg acccagcccg    720
cctctgtgtc tggcagccct ggccagagca tcaccatcag ctgcaccggc accagcagcg    780
acgtgggcgg ctacaactac gtgtcctggt atcagcagca ccccggcaag gcccccaagc    840
tgatgatcta cgaggtgtcc aacagaccca gcggcgtgag caacagattc agcggcagca    900
agagcggcaa caccgccagc ctgaccatca gcggcctcca ggctgaggac gaggccgact    960
actactgcag cagctacacc agcagctcca ccctggtgtt tggcggcgga acaaagctga   1020
ccgtgctgcg taagtacact tttctcatct ttttttatgt gtaagacaca ggttttcatg   1080
ttaggagtta aagtcagttc agaaaatctt gagaaaatgg agagggctca ttatcagttg   1140
acgtggcata cagtgtcaga ttttctgttt atcaagctag tgagattagg ggcaaaaaga   1200
ggctttagtt gagaggaaag taattaatac tatggtcacc atccaagaga ttggatcgga   1260
gaataagcat gagtagttat tgagatctgg gtctgactgc aggtagcgtg gtcttctaga   1320
cgtttaagtg ggagatttgg aggggatgag gaatgaagga acttcaggat agaaaagggc   1380
tgaagtcaag ttcagctcct aaaatggatg tgggagcaaa ctttgaagat aaactgaatg   1440
acccagagga tgaaacagcg cagatcaaag aggggcctgg agctctgaga agagaaggag   1500
actcatccgt gttgagtttc cacaagtact gtcttgagtt ttgcaataaa agtgggatag   1560
cagagttgag tgagccgtag gctgagttct ctcttttgtc tcctaagttt ttatgactac   1620
aaaaatcagt agtatgtcct gaaataatca ttaagctgtt tgaaagtatg actgcttgcc   1680
atgtagatac catggcttgc tgaataatca gaagaggtgt gactcttatt ctaaaatttg   1740
tcacaaaatg tcaaaatgag agactctgta ggaacgagtc cttgacagac agctcaaggg   1800
gtttttttcc tttgtctcat ttctacatga aagtaaattt gaaatgatct tttttattat   1860
aagagtagaa atacagttgg gtttgaacta tatgttttaa tggccacggt tttgtaagac   1920
atttggtcct ttgttttccc agttattact cgattgtaat tttatatcgc cagcaatgga   1980
ctgaaacggt ccgcaacctc ttctttacaa ctgggtgacc tcgcggctgt gccagccatt   2040
tggcgttcac cctgccgcta agggccatgt gaacccccgc ggtagcatcc cttgctccgc   2100
gtggaccact ttcctgaggc acagtgatag gaacagagcc actaatctga agagaacaga   2160
gatgtgacag actacactaa tgtgagaaaa acaaggaaag ggtgacttat tggagatttc   2220
agaaataaaa tgcatttatt attatattcc cttattttaa ttttctatta gggaattaga   2280
aagggcataa actgctttat ccagtgttat attaaaagct taatgtatat aatcttttag   2340
aggtaaaatc tacagccagc aaaagtcatg gtaaatattc tttgactgaa ctctcactaa   2400
actcctctaa attatatgtc atattaactg gttaaattaa tataaatttg tgacatgacc   2460
ttaactggtt aggtaggata tttttcttca tgcaaaaata tgactaataa taatttagca   2520
caaaaatatt tcccaatact ttaattctgt gatagaaaaa tgtttaactc agctactata   2580
atcccataat tttgaaaact atttattagc ttttgtgttt gacccttccc tagccaaagg   2640
```

caactattta aggacccttt aaaactcttg aaactacttt agagtcatta agttatttaa 2700
ccacttttaa ttactttaaa atgatgtcaa ttccctttta actattaatt tattttaagg 2760
ggggaaaggc tgctcataat tctattgttt ttcttggtaa agaactctca gttttcgttt 2820
ttactacctc tgtcacccaa gagttggcat ctcaacagag gggactttcc gagaggccat 2880
ctggcagttg cttaagatca gaagtgaagt ctgccagttc ctcccaggca ggtggcccag 2940
attacagttg acctgttctg gtgtggctaa aaattgtccc atgtggttac aaaccattag 3000
accagggtct gatgaattgc tcagaatatt tctggacacc caaatacaga ccctggctta 3060
aggccctgtc catacagtag gtttagcttg gctacaccaa aggaagccat acagaggcta 3120
atatcagagt attcttggaa gagacaggag aaaatgaaag ccagtttctg ctcttacctt 3180
atgtgcttgt gttcagactc ccaaacatca ggagtgtcag ataaactggt ctgaatctct 3240
gtctgaagca tggaactgaa aagaatgtag tttcagggaa gaaaggcaat agaaggaagc 3300
ctgagaatat cttcaaaggg tcagactcaa tttactttct aaagaagtag ctaggaacta 3360
gggaataact tagaaacaac aagattgtat atatgtgcat cctggcccca ttgttcctta 3420
tctgtaggga taagcgtgct tttttgtgtg tctgtatata acataactgt ttacacataa 3480
tacactgaaa tggagccctt ccttgttact tcataccatc ctctgtgctt ccttcctcag 3540
gggccgacgc cgctcccacc gtgtccatct tcccccccag catggaacag ctgacctctg 3600
gcggagccac cgtggtctgc ttcgtgaaca acttctaccc cagagacatc agcgtgaagt 3660
ggaagatcga cggcagcgag cagagggacg gcgtgctgga cagcgtgacc gaccaggaca 3720
gcaaggactc cacctacagc atgagcagca ccctgagcct gaccaaggtg gagtacgaga 3780
ggcacaacct gtacacctgc gaggtggtgc acaagaccag ctccagcccc gtggtcaagt 3840
ccttcaaccg gaacgagtgt tgaagacaaa ggtcctgaga cgccaccacc agctccccag 3900
ctccatccta tcttcccttc taaggtcttg gaggcttccc cacaagcgac ctaccactgt 3960
tgcggtgctc caaacctcct ccccacctcc ttctcctcct cctccctttc cttggctttt 4020
atcatgctaa tatttgcaga aaatattcaa taaagtgagt ctttgcactt gagatctctg 4080
tctttcttac taaatggtag taatcagttg tttttccagt tacctgggtt tctcttctaa 4140
agaagttaaa tgtttagttg ccctgaaatc caccacactt aaaggataaa taaaaccctc 4200
cacttgccct ggttggctgt ccactacatg gcagtccttt ctaaggttca cgagtactat 4260
tcatggctta tttctctggg ccatggtagg tttgaggagg catacttcct agttttcttc 4320
ccctaagtcg tcaaagtcct gaagggggac agtctttaca agcacatgtt ctgtaatctg 4380
attcaaccta cccagtaaac ttggcgaagc aaagtagaat cattatcaca ggaagcaaag 4440
gcaacctaaa tgtgcaagca ataggaaaat gtggaagccc atcatagtac ttggacttca 4500
tctgcttttg tgccttcact aagtttttaa acatgagctg gctcctatct gccattggca 4560
aggctgggca ctacccacaa cctacttcaa ggacctctat accgtgagat tacacacata 4620
catcaaaatt tgggaaaagt tctaccaagc tgagagctga tcaccccact cttaggtgct 4680
tatctctgta caccagaaac cttaagaagc aaccagtatt gagagactca tttatgaaag 4740
tctaaaactg gatacaacca aaatgtccac caacagttaa attatgacat gttcacaatt 4800
gagctattac ttaataagga gaattaataa aataaaactt aagagcatag tttaatctca 4860
taaacaagat aataagcaaa acaaaacatt ttttcatcca tgtaagttta aaagcaggta 4920
aaatttaaaa ttaagagaga cataagtttt gaggtagcaa gatggaaact ctggggcttg 4980
gggaatgttc tgtctctctg tatgggatgt gaaagttact attgtggaat tgggatctat 5040 gttcttcctg tatatattgt atacttcata ataacttcac ctaaagaaat atctaatacc 5100
cagtgcatac ataaaagagg atacaaggaa tgaatcatac gtcaaggcca gaaagacaat 5160
aaagtagggg atccaggatc aaatctccca caaccttgag ccttctacta ttctgccttc 5220
cagagctcaa agtacaaaac acataattca aacacatgat ccctccttgg ggtctcttcc 5280
ttcatgcatc gaattagaaa tagccatgta taaaatgaga tagaagagac cttcatcaac 5340
aggtcaaaga atataggtaa ttttgtctgg gtatgaagag cccacgtatc aaaggttaca 5400
ttagggaagg aagaggacac taacagtgac tttcattctc cccctcttcc tggaggcccc 5460
tgcatttagt ccctcgtggg ctcatccact cagcacacat ttactaagca tcttctcagc 5520
ctacactctg aaggcagtgc agaataatgt tagtgtccct tcccccagtt aatatgcagt 5580
ccagtttccc tgctccttcc ctttctcagt ccacataagg atgatgggaa aggacagtca 5640
ccaaatagga gagggcaacc ctttgccttc ctacctcttg agaatgtaca ttattatcca 5700
ctttttgaaa cttcttttaa ttgctttttt ttaatttgtc ttttcaaata gcataacctt 5760
gttcatccat ttctgggaac caaatttatc aatcaacagt gcctctaatc tggctattaa 5820
tacaaaaatg cctcctcaaa atatatatgt tcgagtctta tctaaaacag aacccacaat 5880
aaaaaagaag aaagaataca tataagcatt tatataattc tgagcaacct tgtgctttgt 5940
gaaaaaaata taatctaatg tcacatgctg tattcttttt atttaacact ggtgaaatta 6000
taccattaga gagaaagagg acagatcact gatcctagga tctagggatg ttacagataa 6060
gaaaacaaat gtgacaaaga gctgtcacaa ggaggatctt caaggtcaca gaatcactgt 6120
cttgatttca gtggtggtta catacattta aatatgtgat aaaatgttgt tgaactatat 6180
tcatatattg taccaatgtc aaatgcttaa ttttggctct atagtataat tatgcactaa 6240
ataactattt ggacaaagaa aatgatgttt acatcaaagg tgaggccata tttgttagga 6300
acataactta aaaaccattt tggataacta atgaaaagcc attttgtgtg ccttggcata 6360
tcatgcctaa gctgtcacca gatagatcta ataagaccta agcctcagaa gcaagcccct 6420
gcccagcaag caggcagcac agataagagc taaacccagg acaggccatg atatgctaat 6480
gaactacctt caaggtggtg ttgctgacct agtgaaccag ccccaagctg tgagccccaa 6540
tagcacaaag ctactgccca aagaaattat acaaaaattg gaactttggg aatggtgtgc 6600
aggatcgctc tgctgtatgc ctggaacaca gcttctctat gttttgtatt gataccagtc 6660
tagaagcttc caaaactttc tcactgaaga agattcccca tgtgggaccc ctacagactc 6720
ttttgcccaa acaactgctt ccctcctggt gtgatatctg ttttgctttt atgttagcat 6780
aatattataa ggaatgtttg tgtgaataaa ccaaacatat tttaaaagca aatattgtat 6840
gcacatccta attgctaaaa agtttacagc taatagtccc atgctctcca caatactgga 6900
tccaaataag tcctaatttc aatgttgggc atctttacag agagaaagac attaaaaatg 6960
aagagacatg cagagagtgc accatgccat cgtggagaca gactgaagtg acacaactgt 7020
tagtcaaaga ggattaagga cttccagaag ccaccaaagg aaggaggtat gaagtggttt 7080
ctccctcaga gtatccagag gagactaaac caaccaacac ctttttgctt aagacttctt 7140
gccttcagga ctgtgagaag gtagcttcct attgttctaa gccccagtat gtggcatttt 7200
gttaaggtag agtcaagaaa ccaataaaat gcagacagac aaaaggatag ctgagttttc 7260
caggcccttc cttcttattt ttggttttgt tggtggtggt ggtggtggtg gtgatggtgg 7320
tggttttgtt tatgttttgt ttggggagtt ttttggggtt tttttgggtt ttgtttttgt 7380

```
tgttgttttg ggggtttttg ttgttgttgt tgtttgcttt tttgtttttt gtttttttgtt   7440
tttttgagac agtgtttctc tgtatagccc tggctgtcct ggagttcctt ctatctctaa   7500
tgtctacatc tcagagggga tcctctaatt tcaaatgagc agtagctctc catttttagc   7560
tcttatttat tcatttattt acttacttac ttattgtctg tagatgaaag aattttggag   7620
tgggaaaggg ttcatgagcc cccagcaact aatgaggagc tacagacaat tgatgtttct   7680
ggggaaagga gactcagttt ctttgagagt atagcttctg atgggtcaac catgttcctg   7740
tggctgatgt cacacccagg agtatgcaga caacagaaac tggagttaat gagttgtttt   7800
aaaaataaaa aagggcatga agcttgggat agaaattaag gataaataca attaaataca   7860
ggaaattctg aaagaattaa taaaaacatt tctttttta aaaaaaaatc cagaattagc   7920
tatgcttctt caaaattgct tctggagaac tttacaagtt aaataagtta tattgtagaa   7980
aaggtagaga ggagaatagt ggaagagaga gataaggaga cttcaaaagg agtggaggga   8040
gatagaggag gagaaagcag aagcaatggc tgatagacac aggataagag ggaacagaaa   8100
ggagaaagag gaagccagga tgggtatttc tttgcctatc tgtgacttgc acatggtctt   8160
ggcaattatt gatgagttca aggcttaatt cttcacttgt gccaactcaa cagagtcttt   8220
ctttcttata accaggcccc cagtatgctc atgtatgtat caggtcctct tatctcctta   8280
tagcaatcct gtttataact gggtaacttt gtgaagggaa ggaagtgcac actgagatgt   8340
gctacaactt tttaatacaa aattttgaag agtttgtaca atgtatgtat aattaataat   8400
taatattatg cactttagat tttgatttca actcaagata ctaattctat atatatgggt   8460
taaatcaata tattaataag tttaatttca catgcttatt tttattgtgg ttttcgagac   8520
agggtttctc tgtatagccc tggctgtcct ggaacccact ttgtagacca ggctggcctc   8580
aaactcagaa acctacctgc ctctgcctct gcctctgcct ctgcctctgc ctctgcctct   8640
gcctctgcct ctgcctctgc ctctgcctct gcctctgcct ctgcctctgc ctctgcctct   8700
gcctctgcct ctgcctctgc ctctgcctct gcctctgcct ctgcctctgc ctctgcctct   8760
gcctctgcct ctgcctagtg ctggaattaa aggtttgcgc caccacgccc ggtgaaattt   8820
ttaaacttta tatatgtctc attctatttc tatcagatag gactgtgtag actgtgctaa   8880
actaataaat gtgccctcaa aagtaatcgc aagttgtatt gttgttgttt tgctttgctt   8940
tgctttgctt tgctttgctt tgctttgctt tgctttgctt tgctttgctt tgctttgctt   9000
tgctttgctt tgctttgctt tgctttgctt tgctttttg ttttgggttt ttttccgggg   9060
gagggagggt ggagaaagaa tcttactatg aagctctgac tgtcctggga actcactata   9120
tagatcaggc ttgattcaac tcatagagat ctgccttctt ctgcctccca agtgctggga   9180
ataaaggcat acacctccat gcccagatag tgatcccaag ttttagcaaa agtttctaga   9240
cttgacatta atcgatggag atagacatga attacacaaa gaactaatgt ggagtttacc   9300
tgaatcatac tctatacttt atcagagatt aaattaacat ttaataatcc agtgccaggc   9360
tagaggcacc attcaatggc agtgtttgcc atcatgcata ggcttagtct tcagtgctga   9420
aaggcattgg gggcaatatt actcattata cagatgagaa actgggaaag acttgcctca   9480
gattctctac tgaaaggctg agtttgtggc ttctagaaaa tcttttactt tcaatatttt   9540
taatgtataa tttttttatt tccactgatt ttatttttta tttttaacat ttataagaaa   9600
taaatgcaat aaaccaaata catggacaaa aaaatacaag aatcatatga tcacctcaat   9660
ggaaggaaaa aaaaagaaag aaaaagtctt tgataagatt caacattcat tctttttta   9720
ttagatattt tcttcattta catttcaaat gctatcccca aagcccccta taccttcccc   9780
```

```
tgccctgctc cccaacccac ccactcctgc tttctggccc tggcattcct ctgtactgag   9840
gcatatgatc ttcaaaaaac caagggcctc tcctctcatt ggtggccgac tattaggcca   9900
tcttttgcta catatgcaac tagagacaca gctctggggg ttactggtta gttcatattg   9960
ttagtcctcc tatagagttg cagacccctt tagctccttg gatactttct ctagttcctt  10020
cattaggggc cctgtgtccc atccaataga tgactgtgag catccacttc tgtatttgcc  10080
aggcactggc atagcctcac gagaaagaga gagctatgtc aggatcctgt cagtaaaatc  10140
tttctggcat atgcaatagt atctgggttt ggtggttgta tatgggatgg atccccaagt  10200
ggagcagtct ctgaatggtc cttccttcca tctcagctcc aaactttgtc tctataactc  10260
cttccatggg tattttgttc cccattctaa gaaggagtga agaatccaca ctttggtctt  10320
ccttcttctt gagtttcata tgttgcatct tggatattct aagtttctgg gttaatatcc  10380
acgtatcagt gagtgcatat catgcgtgtt attttgtgat tagtttacct cactcaggat  10440
gatatcctcc agatgcatcc atttgcctaa gaatttcatt aattcactgt ttttaattgc  10500
tgaatagtac tccattgtgt aaatgtacca cattttctgt atccattcct ctgttgaggg  10560
gcatctgggt tctttccagc ttctggctat tataaataag gctgctatga gcatagcgga  10620
gcatgtgtcc ttatcaagtt ggaacatctt ctaggtatat gcccaggaga ggaattgctg  10680
gatcttccgg tagtaccatc aacatgcatt cttaataaaa gccctagaac aaggaggact  10740
gtaggaaaca tattccaaca taataaaggt tatgtatgac aaactcatga ccaatatcat  10800
cctaaatgaa tgaaaccatt aataagctcc attaaaatca gaggactgcc cactatccct  10860
acttctcatc cataatgaga ttgaagcatt agctggagca ataaggcaag agaagggata  10920
caaatgggaa aatattaagt caaattgttt tcaattgaag attatattat cttataccca  10980
atgacctcaa attttgacta gaaaaattgt agaaattatc aataatttca gcaaagtgtt  11040
atgatgcacc acatccttat tcttctcccc agcttctgct tgcttctctc ttcttgctct  11100
tcatcctttc tgtccttcca tctgcctgca ctcttgtctc aagactgagt gcagcgtgta  11160
actctcctgt gactgagtat ctcacaaaac gttctacctg ccaaacctgg atgagccctt  11220
tgtctttctg aagctatgag gctctctaca tagactcaag aaggaaatga cagggaggag  11280
gtaataatga agtggggaag gctgacatta gcattgctcc tgtgtggctc cttaatttct  11340
catacttcac actgagatgt tattaactgt gactcatagg tgaagaagcc agagctaagg  11400
ttctcatatt tgagtgttat agaatgagta gagcagtagt tctcaaacta tgggtcatga  11460
ctcctttatg ggtcaaacta ccctttcaca caggttgcat atcagatatc ctaattttat  11520
atacatatat atatgcatat gtatatatat atatttcaca acagtaggaa aattatttag  11580
taatcatttt atagttgtgg gtcatggcaa catgaggaac tgtattaaag ggttgcagca  11640
ttaggaatgt tgagacccac tgtaatagag aatgaggctt aaggcagggc tataaagccc  11700
aatggaccat gtgccttttc caacatttgc cacatggtaa gctctgtata gactttttaa  11760
agaacattgg tttgtaattt taaatggata agggtcttca ctgtctatca cccatctata  11820
taataaatac ataagttttg attccaccat ggattcaaat gcaaaaatcc tcaacctaag  11880
acatagcagt gaaacattga tgaccaaata ggaaatccat gtagagacct tctatcttct  11940
gatggctcca caggcaccat cttgcaacag agttctactt tgctaccagt aatgaataca  12000
gtgtctcaac tcctgccatt gaatcttcag gaagcccctg aaatgacttg tactacacca  12060
tttcttaaag acagaaaagc taagacttag agggaataaa tgtcatgcct gagatcatgc  12120
```

```
aaccaattaa gtccaacttg gcctgatcaa gaggcacaat tcaaaagcaa tgttgttcct  12180
tcactagctc ttgtgtatgg ttgctgattc cggaagcaaa gtatcagtga atatccctag  12240
tgggaaaaga cttggaaatc aaatgtctca tttaacagat taggagatga aacggtagac  12300
tctgtgtagt tgtacacccc tgtgatccca tcgctaggaa gactgaggca ggaagtcctc  12360
gagctcaaac cagcttaggc tacacagaga aactatctaa aaaataatta ctaactactt  12420
aataggagat tggatgttaa gatctggtca ctaagaggca gaattgagat tcgaagccag  12480
tattttctac ctggtatgtt ttaaattgca gtaaggatct aagtgtagat atataataat  12540
aagattctat tgatctctgc aacaacagag agtgttagat ttgtttggaa aaaaatatta  12600
tcagccaaca tcttctacca tttcagtata gcacagagta cccacccata tctccccacc  12660
catcccccat accagactgg ttattgattt tcatggtgac tggcctgaga agattaaaaa  12720
aagtaatgct accttattgg gagtgtccca tggaccaaga tagcaactgt catagctacc  12780
gtcacactgc tttgatcaag aagacccttt gaggaactga aaacagaacc ttaggcacat  12840
ctgttgcttt cgctcccatc ctcctccaac agcctgggtg gtgcactcca cacccttttca  12900
agtttccaaa gcctcataca cctgctccct accccagcac ctggccaagg ctgtatccag  12960
cactgggatg aaaatgatac cccacctcca tcttgtttga tattactcta tctcaagccc  13020
caggttagtc cccagtccca atgcttttgc acagtcaaaa ctcaacttgg aataatcagt  13080
atccttgaag agttctgata tggtcactgg gcccatatac catgtaagac atgtggaaaa  13140
gatgtttcat ggggcccaga cacgttctag aagtacctga gagtggcaaa aaatagttgt  13200
gctaaatagt ttggccatct ttaggctgag agactaggaa atacagcgat ggactatatc  13260
agcattgcag gatagttgtc agtaaacacc ccacaaccca taacagaagt attctcttct  13320
ttctatatcc cttttccatc catgtagatg gctgtcttca tatttgttct agacggccgg  13380
cc                                                                 13382
```

<210> SEQ ID NO 96
<211> LENGTH: 4638
<212> TYPE: DNA
<213> ORGANISM: Artificial Sequence
<220> FEATURE:
<223> OTHER INFORMATION: pSELECT-IGKV1-39/J-Ck

<400> SEQUENCE: 96

```
gcggccgcaa taaaatatct ttattttcat tacatctgtg tgttggtttt ttgtgtgaat     60
cgtaactaac atacgctctc catcaaaaca aaacgaaaca aaacaaacta gcaaaatagg    120
ctgtccccag tgcaagtgca ggtgccagaa catttctcta tcgaaggatc tgcgatcgct    180
ccggtgcccg tcagtgggca gagcgcacat cgcccacagt ccccgagaag ttgggggggag   240
gggtcggcaa ttgaacgggt gcctagagaa ggtggcgcgg ggtaaactgg gaaagtgatg    300
tcgtgtactg gctccgcctt tttcccgagg gtgggggaga accgtatata agtgcagtag    360
tcgccgtgaa cgttcttttt cgcaacgggt ttgccgccag aacacagctg aagcttcgag    420
gggctcgcat ctctccttca cgcgcccgcc gccctacctg aggccgccat ccacgccggt    480
tgagtcgcgt tctgccgcct cccgcctgtg gtgcctcctg aactgcgtcc gccgtctagg    540
taagtttaaa gctcaggtcg agaccgggcc tttgtccggc gctcccttgg agcctaccta    600
gactcagccg gctctccacg ctttgcctga ccctgcttgc tcaactctac gtctttgttt    660
cgttttctgt tctgcgccgt tacagatcca agctgtgacc ggcgcctacc tgagatcacc    720
ggcgtgtcga cgccaccatg gacatgagag tgcccgccca gctcctgggg ctcctgctac    780
```

```
tctggctccg aggtaaggat ggagaacact aggaatttac tcagccagtg tgctcagtac    840
tgactggaac ttcagggaag ttctctgata acatgattaa tagtaagaat atttgttttt    900
atgtttccaa tctcaggtgc cagatgtgac atccagatga cccagagccc cagcagcctg    960
agcgccagcg tgggcgacag agtgaccatc acctgcagag ccagccagag catcagcagc   1020
tacctgaact ggtatcagca gaagcccggc aaggccccca agctgctgat ctacgccgcc   1080
agctccctgc agagcggcgt gcccagcaga ttcagcggca gcggctccgg caccgacttc   1140
accctgacca tcagcagcct gcagcccgag gacttcgcca cctactactg ccagcagagc   1200
tacagcaccc cccccacctt cggccagggc accaaggtgg agatcaagag agccgacgcc   1260
gctcccaccg tgtccatctt cccccccagc atggaacagc tgacctctgg cggagccacc   1320
gtggtctgct tcgtgaacaa cttctacccc agagacatca gcgtgaagtg gaagatcgac   1380
ggcagcgagc agagggacgg cgtgctggac agcgtgaccg accaggacag caaggactcc   1440
acctacagca tgagcagcac cctgagcctg accaaggtgg agtacgagag gcacaacctg   1500
tacacctgcg aggtggtgca caagaccagc tccagccccg tggtcaagtc cttcaaccgg   1560
aacgagtgtt gagctagctg gccagacatg ataagataca ttgatgagtt tggacaaacc   1620
acaactagaa tgcagtgaaa aaaatgcttt atttgtgaaa tttgtgatgc tattgcttta   1680
tttgtaacca ttataagctg caataaacaa gttaacaaca acaattgcat tcattttatg   1740
tttcaggttc agggggaggt gtgggaggtt ttttaaagca agtaaaacct ctacaaatgt   1800
ggtatggaat tctaaaatac agcatagcaa aactttaacc tccaaatcaa gcctctactt   1860
gaatcctttt ctgagggatg aataaggcat aggcatcagg ggctgttgcc aatgtgcatt   1920
agctgtttgc agcctcacct tctttcatgg agtttaagat atagtgtatt ttcccaaggt   1980
ttgaactagc tcttcatttc tttatgtttt aaatgcactg acctcccaca ttccctttt   2040
agtaaaatat tcagaaataa tttaaataca tcattgcaat gaaaataaat gtttttttatt   2100
aggcagaatc cagatgctca aggcccttca taatatcccc cagtttagta gttggactta   2160
gggaacaaag gaacctttaa tagaaattgg acagcaagaa agcgagcttc tagcgaattc   2220
tcgactcatt cctttgccct cggacgagtg ctggggcgtc ggtttccact atcggcgagt   2280
acttctacac agccatcggt ccagacggcc gcgcttctgc gggcgatttg tgtacgcccg   2340
acagtcccgg ctccggatcg gacgattgcg tcgcatcgac cctgcgccca agctgcatca   2400
tcgaaattgc cgtcaaccaa gctctgatag agttggtcaa gaccaatgcg gagcatatac   2460
gcccggagcc gcggcgatcc tgcaagctcc ggatgcctcc gctcgaagta gcgcgtctgc   2520
tgctccatac aagccaacca cggcctccag aagaagatgt tggcgacctc gtattgggaa   2580
tccccgaaca tcgcctcgct ccagtcaatg accgctgtta tgcggccatt gtccgtcagg   2640
acattgttgg agccgaaatc cgcgtgcacg aggtgccgga cttcggggca gtcctcggcc   2700
caaagcatca gctcatcgag agcctgcgcg acggacgcac tgacggtgtc gtccatcaca   2760
gtttgccagt gatacacatg gggatcagca atcgcgcata tgaaatcacg ccatgtagtg   2820
tattgaccga ttccttgcgg tccgaatggg ccgaacccgc tcgtctggct aagatcggcc   2880
gcagcgatcg catccatgag ctccgcgacg ggttgcagaa cagcgggcag ttcggtttca   2940
ggcaggtctt gcaacgtgac accctgtgca cggcgggaga tgcaataggt caggctctcg   3000
ctgaattccc caatgtcaag cacttccgga atcgggagcg cggccgatgc aaagtgccga   3060
taaacataac gatctttgta gaaaccatcg gcgcagctat ttacccgcag gacatatcca   3120
```

```
cgccctccta catcgaagct gaaagcacga gattcttcgc cctccgagag ctgcatcagg   3180

tcggagacgc tgtcgaactt ttcgatcaga aacttctcga cagacgtcgc ggtgagttca   3240

ggctttttca tgatggccct cctatagtga gtcgtattat actatgccga tatactatgc   3300

cgatgattaa ttgtcaaaac agcgtggatg gcgtctccag cttatctgac ggttcactaa   3360

acgagctctg cttatataga cctcccaccg tacacgccta ccgcccattt gcgtcaatgg   3420

ggcggagttg ttacgacatt ttggaaagtc ccgttgattt actagtcaaa acaaactccc   3480

attgacgtca atggggtgga gacttggaaa tccccgtgag tcaaaccgct atccacgccc   3540

attgatgtac tgccaaaacc gcatcatcat ggtaatagcg atgactaata cgtagatgta   3600

ctgccaagta ggaaagtccc ataaggtcat gtactgggca taatgccagg cgggccattt   3660

accgtcattg acgtcaatag ggggcgtact tggcatatga tacacttgat gtactgccaa   3720

gtgggcagtt taccgtaaat actccaccca ttgacgtcaa tggaaagtcc ctattggcgt   3780

tactatggga acatacgtca ttattgacgt caatgggcgg gggtcgttgg gcggtcagcc   3840

aggcgggcca tttaccgtaa gttatgtaac gcctgcaggt taattaagaa catgtgagca   3900

aaaggccagc aaaaggccag gaaccgtaaa aaggccgcgt tgctggcgtt tttccatagg   3960

ctccgccccc ctgacgagca tcacaaaaat cgacgctcaa gtcagaggtg gcgaaacccg   4020

acaggactat aaagatacca ggcgtttccc cctggaagct ccctcgtgcg ctctcctgtt   4080

ccgaccctgc cgcttaccgg atacctgtcc gcctttctcc cttcgggaag cgtggcgctt   4140

tctcatagct cacgctgtag gtatctcagt tcggtgtagg tcgttcgctc caagctgggc   4200

tgtgtgcacg aaccccccgt tcagcccgac cgctgcgcct tatccggtaa ctatcgtctt   4260

gagtccaacc cggtaagaca cgacttatcg ccactggcag cagccactgg taacaggatt   4320

agcagagcga ggtatgtagg cggtgctaca gagttcttga agtggtggcc taactacggc   4380

tacactagaa gaacagtatt tggtatctgc gctctgctga agccagttac cttcggaaaa   4440

agagttggta gctcttgatc cggcaaacaa accaccgctg gtagcggtgg tttttttgtt   4500

tgcaagcagc agattacgcg cagaaaaaaa ggatctcaag aagatccttt gatcttttct   4560

acggggtctg acgctcagtg gaacgaaaac tcacgttaag ggattttggt catggctagt   4620

taattaacat ttaaatca                                                 4638
```

<210> SEQ ID NO 97
<211> LENGTH: 5349
<212> TYPE: DNA
<213> ORGANISM: Artificial Sequence
<220> FEATURE:
<223> OTHER INFORMATION: pSelect-IGVL2-14/J-Ck

<400> SEQUENCE: 97

```
gcggccgcaa taaaatatct ttattttcat tacatctgtg tgttggtttt ttgtgtgaat     60

cgtaactaac atacgctctc catcaaaaca aaacgaaaca aaacaaacta gcaaaatagg    120

ctgtccccag tgcaagtgca ggtgccagaa catttctcta tcgaaggatc tgcgatcgct    180

ccggtgcccg tcagtgggca gagcgcacat cgcccacagt ccccgagaag ttgggggggag   240

gggtcggcaa ttgaacgggt gcctagagaa ggtggcgcgg ggtaaactgg gaaagtgatg    300

tcgtgtactg gctccgcctt tttcccgagg gtgggggaga accgtatata agtgcagtag    360

tcgccgtgaa cgttcttttt cgcaacgggt ttgccgccag aacacagctg aagcttcgag    420

gggctcgcat ctctccttca cgcgcccgcc gccctacctg aggccgccat ccacgccggt    480

tgagtcgcgt tctgccgcct cccgcctgtg gtgcctcctg aactgcgtcc gccgtctagg    540
```

```
taagtttaaa gctcaggtcg agaccgggcc tttgtccggc gctcccttgg agcctaccta    600
gactcagccg gctctccacg ctttgcctga ccctgcttgc tcaactctac gtctttgttt    660
cgttttctgt tctgcgccgt tacagatcca agctgtgacc ggcgcctacc tgagatcacc    720
ggcgtgtcga cgccaccatg gacatgagag tgcccgccca gctcctgggg ctcctgctac    780
tctggctccg aggtaaggat ggagaacact aggaatttac tcagccagtg tgctcagtac    840
tgactggaac ttcagggaag ttctctgata acatgattaa tagtaagaat atttgttttt    900
atgtttccaa tctcaggtgc cagatgtcag tctgccctga cccagcccgc ctctgtgtct    960
ggcagccctg gccagagcat caccatcagc tgcaccggca ccagcagcga cgtgggcggc   1020
tacaactacg tgtcctggta tcagcagcac cccggcaagg cccccaagct gatgatctac   1080
gaggtgtcca acagacccag cggcgtgagc aacagattca gcggcagcaa gagcggcaac   1140
accgccagcc tgaccatcag cggcctccag gctgaggacg aggccgacta ctactgcagc   1200
agctacacca gcagctccac cctggtgttt ggcggcggaa caaagctgac cgtgctgaga   1260
gccgacgccg ctcccaccgt gtccatcttc ccccccagca tggaacagct gacctctggc   1320
ggagccaccg tggtctgctt cgtgaacaac ttctacccca gagacatcag cgtgaagtgg   1380
aagatcgacg gcagcgagca gagggacggc gtgctggaca gcgtgaccga ccaggacagc   1440
aaggactcca cctacagcat gagcagcacc ctgagcctga ccaaggtgga gtacgagagg   1500
cacaacctgt acacctgcga ggtggtgcac aagaccagct ccagccccgt ggtcaagtcc   1560
ttcaaccgga acgagtgttg agctagctgg ccagacatga taagatacat tgatgagttt   1620
ggacaaacca caactagact gactcagcct gcctccgtgt ctgggtctcc tggacagtcg   1680
atcaccatct cctgcactgg aaccagcagt gacgttggtg gttataacta tgtctcctgg   1740
taccaacagc acccaggcaa agcccccaaa ctcatgattt atgaggtcag taatcggccc   1800
tcaggggttt ctaatcgctt ctctggctcc aagtctggca acacggcctc cctgaccatc   1860
tctgggctcc aggctgagga cgaggctgat tattactgca gctcatatac aagcagcagc   1920
actctcgtat tcggcggagg gaccaagctg accgtcctac gggctgatgc tgcaccaact   1980
gtatccatct tcccaccatc catggaacag ttaacatctg gaggtgccac agtcgtgtgc   2040
ttcgtgaaca acttctatcc cagagacatc agtgtcaagt ggaagattga tggcagtgaa   2100
caacgagatg gtgtcctgga cagtgttact gatcaggaca gcaaagacag cacgtacagc   2160
atgagcagca ccctctcgtt gaccaaggtt gaatatgaaa ggcataacct ctatacctgt   2220
gaggttgttc ataagacatc atcctcaccc gtcgtcaaga gcttcaacag gaatgagtgt   2280
taggctagct ggccagacat gataagatac attgatgagt ttggacaaac cacaactaga   2340
atgcagtgaa aaaaatgctt tatttgtgaa atttgtgatg ctattgcttt atttgtaacc   2400
attataagct gcaataaaca agttaacaac aacaattgca ttcattttat gtttcaggtt   2460
caggggggagg tgtgggaggt tttttaaagc aagtaaaacc tctacaaatg tggtatggaa   2520
ttctaaaata cagcatagca aaactttaac ctccaaatca agcctctact tgaatccttt   2580
tctgagggat gaataaggca taggcatcag gggctgttgc caatgtgcat tagctgtttg   2640
cagcctcacc ttctttcatg gagtttaaga tatagtgtat tttcccaagg tttgaactag   2700
ctcttcattt ctttatgttt taaatgcact gacctcccac attccctttt tagtaaaata   2760
ttcagaaata atttaaatac atcattgcaa tgaaaataaa tgtttttat taggcagaat   2820
ccagatgctc aaggcccttc ataatatccc ccagtttagt agttggactt agggaacaaa   2880
```

```
ggaaccttta atagaaattg gacagcaaga aagcgagctt ctagcgaatt ctcgactcat   2940
tcctttgccc tcggacgagt gctggggcgt cggtttccac tatcggcgag tacttctaca   3000
cagccatcgg tccagacggc cgcgcttctg cgggcgattt gtgtacgccc gacagtcccg   3060
gctccggatc ggacgattgc gtcgcatcga ccctgcgccc aagctgcatc atcgaaattg   3120
ccgtcaacca agctctgata gagttggtca agaccaatgc ggagcatata cgcccggagc   3180
cgcggcgatc ctgcaagctc cggatgcctc cgctcgaagt agcgcgtctg ctgctccata   3240
caagccaacc acggcctcca gaagaagatg ttggcgacct cgtattggga atccccgaac   3300
atcgcctcgc tccagtcaat gaccgctgtt atgcggccat tgtccgtcag gacattgttg   3360
gagccgaaat ccgcgtgcac gaggtgccgg acttcggggc agtcctcggc ccaaagcatc   3420
agctcatcga gagcctgcgc gacggacgca ctgacggtgt cgtccatcac agtttgccag   3480
tgatacacat ggggatcagc aatcgcgcat atgaaatcac gccatgtagt gtattgaccg   3540
attccttgcg gtccgaatgg gccgaacccg ctcgtctggc taagatcggc cgcagcgatc   3600
gcatccatga gctccgcgac gggttgcaga acagcgggca gttcggtttc aggcaggtct   3660
tgcaacgtga caccctgtgc acggcgggag atgcaatagg tcaggctctc gctgaattcc   3720
ccaatgtcaa gcacttccgg aatcgggagc gcggccgatg caaagtgccg ataaacataa   3780
cgatctttgt agaaaccatc ggcgcagcta tttacccgca ggacatatcc acgccctcct   3840
acatcgaagc tgaaagcacg agattcttcg ccctccgaga gctgcatcag gtcggagacg   3900
ctgtcgaact tttcgatcag aaacttctcg acagacgtcg cggtgagttc aggctttttc   3960
atgatggccc tcctatagtg agtcgtatta tactatgccg atatactatg ccgatgatta   4020
attgtcaaaa cagcgtggat ggcgtctcca gcttatctga cggttcacta aacgagctct   4080
gcttatatag acctcccacc gtacacgcct accgcccatt tgcgtcaatg gggcggagtt   4140
gttacgacat tttggaaagt cccgttgatt tactagtcaa aacaaactcc cattgacgtc   4200
aatggggtgg agacttggaa atccccgtga gtcaaaccgc tatccacgcc cattgatgta   4260
ctgccaaaac cgcatcatca tggtaatagc gatgactaat acgtagatgt actgccaagt   4320
aggaaagtcc cataaggtca tgtactgggc ataatgccag gcgggccatt taccgtcatt   4380
gacgtcaata gggggcgtac ttggcatatg atacacttga tgtactgcca agtgggcagt   4440
ttaccgtaaa tactccaccc attgacgtca atggaaagtc cctattggcg ttactatggg   4500
aacatacgtc attattgacg tcaatgggcg ggggtcgttg ggcggtcagc caggcgggcc   4560
atttaccgta agttatgtaa cgcctgcagg ttaattaaga acatgtgagc aaaaggccag   4620
caaaaggcca ggaaccgtaa aaaggccgcg ttgctggcgt ttttccatag gctccgcccc   4680
cctgacgagc atcacaaaaa tcgacgctca agtcagaggt ggcgaaaccc gacaggacta   4740
taaagatacc aggcgtttcc ccctggaagc tccctcgtgc gctctcctgt tccgaccctg   4800
ccgcttaccg gatacctgtc cgcctttctc ccttcgggaa gcgtggcgct ttctcatagc   4860
tcacgctgta ggtatctcag ttcggtgtag gtcgttcgct ccaagctggg ctgtgtgcac   4920
gaaccccccg ttcagcccga ccgctgcgcc ttatccggta actatcgtct tgagtccaac   4980
ccggtaagac acgacttatc gccactggca gcagccactg gtaacaggat tagcagagcg   5040
aggtatgtag gcggtgctac agagttcttg aagtggtggc ctaactacgg ctacactaga   5100
agaacagtat ttggtatctg cgctctgctg aagccagtta ccttcggaaa aagagttggt   5160
agctcttgat ccggcaaaca aaccaccgct ggtagcggtg gtttttttgt ttgcaagcag   5220
cagattacgc gcagaaaaaa aggatctcaa gaagatcctt tgatcttttc tacggggtct   5280
```

gacgctcagt ggaacgaaaa ctcacgttaa gggattttgg tcatggctag ttaattaaca 5340 tttaaatca 5349

<210> SEQ ID NO 98
<211> LENGTH: 6772
<212> TYPE: DNA
<213> ORGANISM: Artificial Sequence
<220> FEATURE:
<223> OTHER INFORMATION: MV1043

<400> SEQUENCE: 98 cttgatttgg gtgatggttc acgtagtggg ccatcgccct gatagacggt ttttcgccct 60 ttgacgttgg agtccacgtt ctttaatagt ggactcttgt tccaaactgg aacaacactc 120 aactctatct cgggctattc ttttgattta taagggattt tgccgatttc ggtctattgg 180 ttaaaaaatg agctgattta acaaaaattt aacgcgaatt ttaacaaaat attaacgttt 240 acaattttat ggtgcagtct cagtacaatc tgctctgatg ccgcatagtt aagccagccc 300 cgacacccgc caacacccgc tgacgcgccc tgacgggctt gtctgctccc ggcatccgct 360 tacagacaag ctgtgaccgt ctccgggagc tgcatgtgtc agaggttttc accgtcatca 420 ccgaaacgcg cgagacgaaa gggcctcgtg atacgcctat ttttataggt taatgtcatg 480 ataataatgg tttcttagac gtcaggtggc acttttcggg gaaatgtgcg cggaacccct 540 atttgtttat ttttctaaat acattcaaat atgtatccgc tcatgagaca ataaccctga 600 taaatgcttc aataatattg aaaaaggaag agtatgagta ttcaacattt ccgtgtcgcc 660 cttattccct tttttgcggc attttgcctt cctgtttttg ctcacccaga aacgctggtg 720 aaagtaaaag atgctgaaga tcagttgggt gcccgagtgg gttacatcga actggatctc 780 aacagcggta agatccttga gagttttcgc cccgaagaac gttttccaat gatgagcact 840 tttaaagttc tgctatgtgg cgcggtatta tcccgtattg acgccgggca agagcaactc 900 ggtcgccgca tacactattc tcagaatgac ttggttgagt actcaccagt cacagaaaag 960 catcttacgg atggcatgac agtaagagaa ttatgcagtg ctgccataac catgagtgat 1020 aacactgcgg ccaacttact tctgacaacg atcggaggac cgaaggagct aaccgctttt 1080 ttgcacaaca tgggggatca tgtaactcgc cttgatcgtt gggaaccgga gctgaatgaa 1140 gccataccaa acgacgagcg tgacaccacg atgcctgtag caatggcaac aacgttgcgc 1200 aaactattaa ctggcgaact acttactcta gcttcccggc aacaattaat agactggatg 1260 gaggcggata aagttgcagg accacttctg cgctcggccc ttccggctgg ctggtttatt 1320 gctgataaat ctggagccgg tgagcgtggg tctcgcggta tcattgcagc actggggcca 1380 gatggtaagc cctcccgtat cgtagttatc tacacgacgg ggagtcaggc aactatggat 1440 gaacgaaata gacagatcgc tgagataggt gcctcactga ttaagcattg gtaactgtca 1500 gaccaagttt actcatatat actttagatt gatttaaaac ttcattttta atttaaaagg 1560 atctaggtga agatcctttt tgataatctc atgaccaaaa tcccttaacg tgagttttcg 1620 ttccactgag cgtcagaccc cgtagaaaag atcaaaggat cttcttgaga tccttttttt 1680 ctgcgcgtaa tctgctgctt gcaaacaaaa aaaccaccgc taccagcggt ggtttgtttg 1740 ccggatcaag agctaccaac tctttttccg aaggtaactg gcttcagcag agcgcagata 1800 ccaaatactg ttcttctagt gtagccgtag ttaggccacc acttcaagaa ctctgtagca 1860 ccgcctacat acctcgctct gctaatcctg ttaccagtgg ctgctgccag tggcgataag 1920

-continued

```
tcgtgtctta ccgggttgga ctcaagacga tagttaccgg ataaggcgca gcggtcgggc   1980
tgaacggggg gttcgtgcat acagcccagc ttggagcgaa cgacctacac cgaactgaga   2040
tacctacagc gtgagctatg agaaagcgcc acgcttcccg aagggagaaa ggcggacagg   2100
tatccggtaa gcggcagggt cggaacagga gagcgcacga gggagcttcc agggggaaac   2160
gcctggtatc tttatagtcc tgtcgggttt cgccacctct gacttgagcg tcgatttttg   2220
tgatgctcgt caggggggcg gagcctatgg aaaaacgcca gcaacgcggc ctttttacgg   2280
ttcctggcct tttgctggcc ttttgctcac atgttctttc ctgcgttatc ccctgattct   2340
gtggataacc gtattaccgc ctttgagtga gctgataccg ctcgccgcag ccgaacgacc   2400
gagcgcagcg agtcagtgag cgaggaagcg gaagagcgcc caatacgcaa accgcctctc   2460
cccgcgcgtt ggccgattca ttaatgcagc tggcacgaca ggtttcccga ctggaaagcg   2520
ggcagtgagc gcaacgcaat taatgtgagt tagctcactc attaggcacc ccaggcttta   2580
cactttatgc ttccggctcg tatgttgtgt ggaattgtga gcggataaca atttcacaca   2640
ggaaacagct atgaccatga ttacgccaag ctttggagcc tttttttgg agattttcaa   2700
cgtgaaaaaa ttattattcg caattccttt agttgttcct ttctattctc acagtgcaca   2760
gatccaaatg acccagtctc catcctccct gtctgcatct gtaggagaca gagtcaccat   2820
cacttgccgg gcaagtcaga gcattagcag ctacttaaat tggtatcagc agaaaccagg   2880
gaaagcccct aagctcctga tctatgctgc atccagtttg caaagtgggg tcccatcaag   2940
gttcagtggc agtggatctg ggacagattt cactctcacc atcagcagtc tgcaacctga   3000
agattttgca acttactact gtcaacagag ttacagtacc cctccaacgt tcggccaagg   3060
gaccaagctc gagatcaaac gtactgtggc tgcaccatct gtcttcatct tcccgccatc   3120
tgatgagcag ttgaaatctg gaactgcctc tgttgtgtgc ctgctgaata acttctatcc   3180
cagagaggcc aaagtacagt ggaaggtgga taacgccctc caatcgggta actcccagga   3240
gagtgtcaca gagcaggaca gcaaggacag cacctacagc ctcagcagca ccctgacgct   3300
gagcaaagca gactacgaga aacacaaagt ctacgcctgc gaagtcaccc atcagggcct   3360
gagctcgccc gtcacaaaga gcttcaacag gggagagtgt tagtaaggcg cgccaattct   3420
atttcaagga gacagtcata atgaaatacc tattgcctac ggcagccgct ggattgttat   3480
tactcgcggc ccagccggcc atggcgatgc ctgcttgccg aatatcatgg tggaaaatgg   3540
ccgcttttct ggattcatcg actgtggccg gctgggtgtg gcggaccgct atcaggacat   3600
agcgttggct acccgtgata ttgctgaaga gcttggcggc gaatgggctg accgcttcct   3660
cgtgctttac ggtatcgccg ctcccgattc gcagcgcatc gccttctatc gccttcttga   3720
cgagttcttc tgagcgggac tctggggttc ggtgctacga gatttcgatt ccaccgccgc   3780
cttctatgaa aggttgggct tcggaatcgt tttccgggac gccggctgga tgatcctcca   3840
gcgcggggat ctcatgctgg agttcttcgc ccaccccaac ttgtttattg cagcttataa   3900
tggttacaaa taaagcaata gcatcacaaa tttcacaaat aaagcatttt tttcactgca   3960
ttctagttgt ggtttgtcca aactcatcaa tgtatcttat catgtctgta taccgtcgac   4020
ctctagctag agcttggcgt aatcatggtc atagctgttt cctgtgtgaa attgttatcc   4080
gctcacaatt ccacacaaca tacgagccgg aagcataaag tgtaaagcct ggggtgccta   4140
atgagtgagc taactcacat taattgcgtt gcgctcactg cccgctttcc agtcgggaaa   4200
cctgtcgtgc cagaattgca tgaagaatct gcttagggtt aggcgttttg cgctgcttcg   4260
ctaggtggtc aatattggcc attagccata ttattcattg gttatatagc ataaatcaat   4320
```

```
attggctatt ggccattgca tacgttgtat ccatatcata atatgtacat ttatattggc   4380
tcatgtccaa cattaccgcc atgttgacat tgattattga ctagttatta atagtaatca   4440
attacggggt cattagttca tagcccatat atggagttcc gcgttacata acttacggta   4500
aatggcccgc ctggctgacc gcccaacgac ccccgcccat tgacgtcaat aatgacgtat   4560
gttcccatag taacgccaat agggactttc cattgacgtc aatgggtgga gtatttacgg   4620
taaactgccc acttggcagt acatcaagtg tatcatatgc caagtacgcc ccctattgac   4680
gtcaatgacg gtcaccgtct caagcgcctc caccaagggc ccatcggtct tccccctggc   4740
accctcctcc aagagcacct ctgggggcac agcggccctg ggctgcctgg tcaaggacta   4800
cttccccgaa ccggtgacgg tgtcgtggaa ctcaggcgcc ctgaccagcg gcgtccacac   4860
cttcccggct gtcctacagt cctcaggact ctactccctc agcagcgtag tgaccgtgcc   4920
ctccagcagc ttgggcaccc agacctacat ctgcaacgtg aatcacaagc ccagcaacac   4980
caaggtggac aagaaagttg agcccaaatc ttgtgcggcc gcacatcatc atcaccatca   5040
cggggccgca gaacaaaaac tcatctcaga agaggatctg aatggggccg catagactgt   5100
tgaaagttgt ttagcaaaac ctcatacaga aaattcattt actaacgtct ggaaagacga   5160
caaaacttta gatcgttacg ctaactatga gggctgtctg tggaatgcta caggcgttgt   5220
ggtttgtact ggtgacgaaa ctcagtgtta cggtacatgg gttcctattg ggcttgctat   5280
ccctgaaaat gagggtggtg gctctgaggg tggcggttct gagggtggcg gttctgaggg   5340
tggcggtact aaacctcctg agtacggtga tacacctatt ccgggctata cttatatcaa   5400
ccctctcgac ggcacttatc cgcctggtac tgagcaaaac cccgctaatc ctaatccttc   5460
tcttgaggag tctcagcctc ttaatacttt catgtttcag aataataggt tccgaaatag   5520
gcagggtgca ttaactgttt atacgggcac tgttactcaa ggcactgacc ccgttaaaac   5580
ttattaccag tacactcctg tatcatcaaa agccatgtat gacgcttact ggaacggtaa   5640
attcagagac tgcgctttcc attctggctt taatgaggat ccattcgttt gtgaatatca   5700
aggccaatcg tctgacctgc ctcaacctcc tgtcaatgct ggcggcggct ctggtggtgg   5760
ttctggtggc ggctctgagg gtggcggctc tgagggtggc ggctctgagg gtggcggttc   5820
tgagggtggc ggctctgagg gtggcggttc cggtggcggc tccggttccg gtgattttga   5880
ttatgaaaaa atggcaaacg ctaataaggg ggctatgacc gaaaatgccg atgaaaacgc   5940
gctacagtct gacgctaaag gcaaacttga ttctgtcgct actgattacg gtgctgctat   6000
cgatggtttc attggtgacg tttccggcct tgctaatggt aatggtgcta ctggtgattt   6060
tgctggctct aattcccaaa tggctcaagt cggtgacggt gataattcac ctttaatgaa   6120
taatttccgt caatatttac cttctttgcc tcagtcggtt gaatgtcgcc cttatgtctt   6180
tggcgctggt aaaccatatg aattttctat tgattgtgac aaaataaact tattccgtgg   6240
tgtctttgcg tttcttttat atgttgccac ctttatgtat gtattttcga cgtttgctaa   6300
catactgcgt aataaggagt cttaataaga attcactggc cgtcgtttta caacgtcgtg   6360
actgggaaaa ccctggcgtt acccaactta atcgccttgc agcacatccc cctttcgcca   6420
gctggcgtaa tagcgaagag gcccgcaccg atcgcccttc ccaacagttg cgcagcctga   6480
atggcgaatg gcgcctgatg cggtattttc tccttacgca tctgtgcggt atttcacacc   6540
gcatacgtca aagcaaccat agtacgcgcc ctgtagcggc gcattaagcg cggcgggtgt   6600
ggtggttacg cgcagcgtga ccgctacact tgccagcgcc ttagcgcccg ctcctttcgc   6660
```

```
tttcttccct tcctttctcg ccacgttcgc cggctttccc cgtcaagctc taaatcgggg   6720

gctcccttta gggttccgat ttagtgcttt acggcacctc gaccccaaaa aa           6772


<210> SEQ ID NO 99
<211> LENGTH: 10293
<212> TYPE: DNA
<213> ORGANISM: Artificial Sequence
<220> FEATURE:
<223> OTHER INFORMATION: MV1057

<400> SEQUENCE: 99

tactcttcct ttttcaatat tattgaagca tttatcaggg ttattgtctc atgagcggat     60

acatatttga atgtatttag aaaaataaac aaataggggt tccgcgcaca tttccccgaa    120

aagtgccacc tgacgtcgac ggatcgggag atctcccgat cccctatggt gcactctcag    180

tacaatctgc tctgatgccg catagttaag ccagtatctg ctccctgctt gtgtgttgga    240

ggtcgctgag tagtgcgcga gcaaaattta agctacaaca aggcaaggct tgaccgacaa    300

ttgcatgaag aatctgctta gggttaggcg ttttgcgctg cttcgctagg tggtcaatat    360

tggccattag ccatattatt cattggttat atagcataaa tcaatattgg ctattggcca    420

ttgcatacgt tgtatccata tcataatatg tacatttata ttggctcatg tccaacatta    480

ccgccatgtt gacattgatt attgactagt tattaatagt aatcaattac ggggtcatta    540

gttcatagcc catatatgga gttccgcgtt acataactta cggtaaatgg cccgcctggc    600

tgaccgccca acgacccccg cccattgacg tcaataatga cgtatgttcc catagtaacg    660

ccaataggga ctttccattg acgtcaatgg gtggagtatt tacggtaaac tgcccacttg    720

gcagtacatc aagtgtatca tatgccaagt acgcccccta ttgacgtcaa tgacggtaaa    780

tggcccgcct ggcattatgc ccagtacatg accttatggg actttcctac ttggcagtac    840

atctacgtat tagtcatcgc tattaccatg gtgatgcggt tttggcagta catcaatggg    900

cgtggatagc ggtttgactc acggggattt ccaagtctcc accccattga cgtcaatggg    960

agtttgtttt ggcaccaaaa tcaacgggac tttccaaaat gtcgtaacaa ctccgcccca   1020

ttgacgcaaa tgggcggtag gcgtgtacgg tgggaggtct atataagcag agctcgttta   1080

gtgaaccgtc agatcgcctg gagacgccat ccacgctgtt ttgacctcca tagaagacac   1140

cgggaccgat ccagcctccg cggccgggaa cggtgcattg gaagcttggt accggtgaat   1200

tggccggccc gcgccgtcga ggttatcgat ccgaccgacg cgttcgcgag aggccgcaat   1260

tccctagcca ccatgggatg gagctgtatc atcctcttct tggtactgct gctggcccag   1320

ccggccatgg ggcggagaat gggcggaact gggcggagtt aggggcggga tgggcggagt   1380

taggggcggg actatggttg ctgactaatt gagatgcgga tccgctggca cgacaggttt   1440

cccgactgga aagcgggcag tgagcgcaac gcaattaatg tgagttagct cactcattag   1500

gcaccccagg ctttacactt tatgcttccg gctcgtatgt tgtgtggaat tgtgagcgga   1560

taacaatttc acacaggaaa cagctatgac catgattacg ccaagcttgg gctgcaggtt   1620

ctttccgcct cagaagccat agagcccacc gcatccccag catgcctgct attgtcttcc   1680

caatcctccc ccttgctgtc ctgccccacc ccaccccccca gaatagaatg acacctactc   1740

agacaatgcg atgcaatttc ctcattttat taggaaagga cagtgggagt ggcaccttcc   1800

agggtcaagg aaggcacggg ggaggggcaa acaacagatg gctggcaact agaaggcaca   1860

gtcgaggctg atcagcgagc tctagatcat cgatgcatgg ggtcgtgcgc tcctttcggt   1920

cgggcgctgc gggtcgtggg gcgggcgtca ggcaccgggc ttgcgggtca tgcaccaggt   1980
```

```
gcgcggtcct tcgggcacct cgacgtcggc ggtgacggtg aagccgagcc gctcgtagaa   2040
ggggaggttg cggggcgcgg aggtctccag gaaggcgggc accccggcgc gctcggccgc   2100
ctccactccg gggagcacga cggcgctgcc cagacccttg ccctggtggt cgggcgagac   2160
gccgacggtg gccaggaacc acgcgggctc cttgggccgg tgcggcgcca ggaggccttc   2220
catctgttgc tgcgcggcca gccgggaacc gctcaactcg gccatgcgcg ggccgatctc   2280
ggcgaacacc gcccccgctt cgacgctctc cggcgtggtc cagaccgcca ccgcggcgcc   2340
gtcgtccgcg acccacacct tgccgatgtc gagcccgacg cgcgtgagga agagttcttg   2400
cagctcggtc accgtctcca gtgctagcac caagggccca tcggtcttcc ccctggcacc   2460
ctcctccaag agcacctctg ggggcacagc ggccctgggc tgcctggtca aggactactt   2520
ccccgaaccg gtgacggtgt cgtggaactc aggcgccctg accagcggcg tgcacacctt   2580
cccggctgtc ctacagtcct caggactcta ctccctcagc agcgtcgtga ccgtgccctc   2640
cagcagcttg ggcacccaga cctacatctg caacgtgaat cacaagccca gcaacaccaa   2700
ggtggacaag agagttggtg agaggccagc acagggaggg agggtgtctg ctggaagcca   2760
ggctcagcgc tcctgcctgg acgcatcccg gctatgcagt cccagtccag ggcagcaagg   2820
caggccccgt ctgcctcttc acccggaggc ctctgcccgc cccactcatg ctcagggaga   2880
gggtcttctg gctttttccc caggctctgg gcaggcacag gctaggtgcc cctaacccag   2940
gccctgcaca caaaggggca ggtgctgggc tcagacctgc caagagccat atccgggagg   3000
accctgcccc tgacctaagc ccaccccaaa ggccaaactc tccactccct cagctcggac   3060
accttctctc ctcccagatt ccagtaactc ccaatcttct ctctgcagag cccaaatctt   3120
gtgacaaaac tcacacatgc ccaccgtgcc cagcacctga actcctgggg ggaccgtcag   3180
tcttcctctt ccccccaaaa cccaaggaca ccctcatgat ctcccggacc cctgaggtca   3240
catgcgtggt ggtggacgtg agccacgaag accctgaggt caagttcaac tggtacgtgg   3300
acggcgtgga ggtgcataat gccaagacaa agccgcggga ggagcagtac aacagcacgt   3360
accgtgtggt cagcgtcctc accgtcctgc accaggactg gctgaatggc aaggagtaca   3420
agtgcaaggt ctccaacaaa gccctcccag cccccatcga gaaaaccatc tccaaagcca   3480
aagggcagcc ccgagaacca caggtgtaca ccctgccccc atcccgggag gagatgacca   3540
agaaccaggt cagcctgacc tgcctggtca aaggcttcta tcccagcgac atcgccgtgg   3600
agtgggagag caatgggcag ccggagaaca actacaagac cacgcctccc gtgctggact   3660
ccgacggctc cttcttcctc tatagcaagc tcaccgtgga caagagcagg tggcagcagg   3720
ggaacgtctt ctcatgctcc gtgatgcatg aggctctgca caaccactac acgcagaaga   3780
gcctctccct gtctccgggt aaatgagttt aacggatctt aattaatccg agctcggtac   3840
caagcttaag tttaaaccgc tgatcagcct cgactgtgcc ttctagttgc cagccatctg   3900
ttgtttgccc ctcccccgtg ccttccttga ccctggaagg tgccactccc actgtccttt   3960
cctaataaaa tgaggaaatt gcatcgcatt gtctgagtag gtgtcattct attctggggg   4020
gtggggtggg gcaggacagc aagggggagg attgggaaga caatagcagg catgctgggg   4080
atgcggtggg ctctatggct tctgaggcgg aaagaaccag ctggggctct agggggtatc   4140
cccacgcgcc ctgtagcggc gcattaagcg cggcgggtgt ggtggttacg cgcagcgtga   4200
ccgctacact tgccagcgcc tagcgcccgc tcctttcgct ttcttccctt cctttctcgc   4260
cacgttcgcc ggctttcccc gtcaagctct aaatcggggg ctccctttag ggttccgatt   4320
```

```
tagtgcttta cggcacctcg accccaaaaa acttgattag ggtgatggtt cacgtagtgg   4380
gccatcgccc tgatagacgg tttttcgccc tttgacgttg gagtccacgt tctttaatag   4440
tggactcttg ttccaaactg gaacaacact caaccctatc tcggtctatt cttttgattt   4500
ataagggatt ttgccgattt cggcctattg gttaaaaaat gagctgattt aacaaaaatt   4560
taacgcgaat taattctgtg gaatgtgtgt cagttagggt gtggaaagtc cccaggctcc   4620
ccagcaggca gaagtatgca aagcatgcat ctcaattagt cagcaaccag gtgtggaaag   4680
tccccaggct ccccagcagg cagaagtatg caaagcatgc atctcaatta gtcagcaacc   4740
atagtcccgc ccctaactcc gcccatcccg cccctaactc cgcccagttc cgcccattct   4800
ccgccccatg gctgactaat ttttttatt tatgcagagg ccgaggccgc ctctgcctct   4860
gagctattcc agaagtagtg aggaggcttt tttggaggcc taggcttttg caaaaagctc   4920
ccgggagctt ggatatccat tttcggatct gatcaagaga caggatgagg atcgtttcgc   4980
atgattgaac aagatggatt gcacgcaggt tctccggccg cttgggtgga gaggctattc   5040
ggctatgact gggcacaaca gacaatcggc tgctctgatg ccgccgtgtt ccggctgtca   5100
gcgcaggggc gcccggttct ttttgtcaag accgacctgt ccggtgccct gaatgaactg   5160
caggacgagg cagcgcggct atcgtggctg gccacgacgg gcgttccttg cgcagctgtg   5220
ctcgacgttg tcactgaagc gggaagggac tggctgctat tgggcgaagt gccggggcag   5280
gatctcctgt catctcacct tgctcctgcc gagaaagtat ccatcatggc tgatgcaatg   5340
cggcggctgc atacgcttga tccggctacc tgcccattcg accaccaagc gaaacatcgc   5400
atcgagcgag cacgtactcg gatggaagcc ggtcttgtcg atcaggatga tctggacgaa   5460
gagcatcagg ggctcgcgcc agccgaactg ttcgccaggc tcaaggcgcg catgcccgac   5520
ggcgaggatc tcgtcgtgac ccatggcgat gcctgcttgc cgaatatcat ggtggaaaat   5580
ggccgctttt ctggattcat cgactgtggc cggctgggtg tggcggaccg ctatcaggac   5640
atagcgttgg ctacccgtga tattgctgaa gagcttggcg gcgaatgggc tgaccgcttc   5700
ctcgtgcttt acggtatcgc cgctcccgat tcgcagcgca tcgccttcta tcgccttctt   5760
gacgagttct tctgagcggg actctggggt tcggtgctac gagatttcga ttccaccgcc   5820
gccttctatg aaaggttggg cttcggaatc gttttccggg acgccggctg gatgatcctc   5880
cagcgcgggg atctcatgct ggagttcttc gcccacccca acttgtttat tgcagcttat   5940
aatggttaca aataaagcaa tagcatcaca aatttcacaa ataaagcatt tttttcactg   6000
cattctagtt gtggtttgtc caaactcatc aatgtatctt atcatgtctg tataccgtcg   6060
acctctagct agagcttggc gtaatcatgg tcatagctgt ttcctgtgtg aaattgttat   6120
ccgctcacaa ttccacacaa catacgagcc ggaagcataa agtgtaaagc ctggggtgcc   6180
taatgagtga gctaactcac attaattgcg ttgcgctcac tgcccgcttt ccagtcggga   6240
aacctgtcgt gccagaattg catgaagaat ctgcttaggg ttaggcgttt tgcgctgctt   6300
cgctaggtgg tcaatattgg ccattagcca tattattcat tggttatata gcataaatca   6360
atattggcta ttggccattg catacgttgt atccatatca taatatgtac atttatattg   6420
gctcatgtcc aacattaccg ccatgttgac attgattatt gactagttat taatagtaat   6480
caattacggg gtcattagtt catagcccat atatggagtt ccgcgttaca taacttacgg   6540
taaatggccc gcctggctga ccgcccaacg acccccgccc attgacgtca ataatgacgt   6600
atgttcccat agtaacgcca atagggactt tccattgacg tcaatgggtg gagtatttac   6660
ggtaaactgc ccacttggca gtacatcaag tgtatcatat gccaagtacg ccccctattg   6720
```

acgtcaatga cggtaaatgg cccgcctggc attatgccca gtacatgacc ttatgggact 6780
ttcctacttg gcagtacatc tacgtattag tcatcgctat taccatggtg atgcggtttt 6840
ggcagtacat caatgggcgt ggatagcggt ttgactcacg gggatttcca agtctccacc 6900
ccattgacgt caatgggagt ttgttttggc accaaaatca acgggacttt ccaaaatgtc 6960
gtaacaactc cgccccattg acgcaaatgg gcggtaggcg tgtacggtgg gaggtctata 7020
taagcagagc tcgtttagtg aaccgtcaga tcgcctggag acgccatcca cgctgttttg 7080
acctccatag aagacaccgg gaccgatcca gcctccgcgg ccgggaacgg tgcattggaa 7140
gcttggtacc ggtgaattag gcgcgccgtc gaggttatcg atccgaccga cgcgttcgcg 7200
agaggccgca attccctagc caccatggca tgccctggct tcctgtgggc acttgtgatc 7260
tccacctgtc ttgaattctc catggctgac atccagatga cccagtctcc atcctccctg 7320
tctgcatctg taggagacag agtcaccatc acttgccggg caagtcagag cattagcagc 7380
tacttaaatt ggtatcagca gaaaccaggg aaagccccta agctcctgat ctatgctgca 7440
tccagtttgc aaagtggggt cccatcaagg ttcagtggca gtggatctgg gacagatttc 7500
actctcacca tcagcagtct gcaacctgaa gattttgcaa cttactactg tcaacagagt 7560
tacagtaccc ctccaacgtt cggccaaggg accaaggtgg agatcaaacg taagtgcact 7620
ttgcggccgc taggaagaaa ctcaaaacat caagatttta aatacgcttc ttggtctcct 7680
tgctataatt atctgggata agcatgctgt tttctgtctg tccctaacat gccctgtgat 7740
tatccgcaaa caacacaccc aagggcagaa ctttgttact taaacaccat cctgtttgct 7800
tctttcctca ggaactgtgg ctgcaccatc tgtcttcatc ttcccgccat ctgatgagca 7860
gttgaaatct ggaactgcct ctgttgtgtg cctgctgaat aacttctatc ccagagaggc 7920
caaagtacag tggaaggtgg ataacgccct ccaatcgggt aactcccagg agagtgtcac 7980
agagcaggac agcaaggaca gcacctacag cctcagcagc accctgacgc tgagcaaagc 8040
agactacgag aaacacaaag tctacgcctg cgaagtcacc catcagggcc tgagctcgcc 8100
cgtcacaaag agcttcaaca ggggagagtg ttaggtttaa cggatccgag ctcggtacca 8160
agctcaagtt taaaccgctg atcagcctcg actgtgcctt ctagttgcca gccatctgtt 8220
gtttgcccct cccccgtgcc ttccttgacc ctggaaggtg ccactcccac tgtcctttcc 8280
taataaaatg aggaaattgc atcgcattgt ctgagtaggt gtcattctat tctggggggt 8340
ggggtggggc aggacagcaa gggggaggat tgggaagaca atagcaggca tgctggggat 8400
gcggtgggct ctatggcttc tgaggcggaa agaaccagct gcattaatga atcggccaac 8460
gcgcggggag aggcggtttg cgtattgggc gctcttccgc ttcctcgctc actgactcgc 8520
tgcgctcggt cgttcggctg cggcgagcgg tatcagctca ctcaaaggcg gtaatacggt 8580
tatccacaga atcaggggat aacgcaggaa agaacatgtg agcaaaaggc cagcaaaagg 8640
ccaggaaccg taaaaaggcc gcgttgctgg cgtttttcca taggctccgc ccccctgacg 8700
agcatcacaa aaatcgacgc tcaagtcaga ggtggcgaaa cccgacagga ctataaagat 8760
accaggcgtt tccccctgga agctccctcg tgcgctctcc tgttccgacc ctgccgctta 8820
ccggatacct gtccgccttt ctcccttcgg gaagcgtggc gctttctcat agctcacgct 8880
gtaggtatct cagttcggtg taggtcgttc gctccaagct gggctgtgtg cacgaacccc 8940
ccgttcagcc cgaccgctgc gccttatccg gtaactatcg tcttgagtcc aacccggtaa 9000
gacacgactt atcgccactg gcagcagcca ctggtaacag gattagcaga gcgaggtatg 9060

```
taggcggtgc tacagagttc ttgaagtggt ggcctaacta cggctacact agaagaacag   9120
tatttggtat ctgcgctctg ctgaagccag ttaccttcgg aaaaagagtt ggtagctctt   9180
gatccggcaa acaaaccacc gctggtagcg gtggtttttt tgtttgcaag cagcagatta   9240
cgcgcagaaa aaaaggatct caagaagatc ctttgatctt ttctacgggg tctgacgctc   9300
agtggaacga aaactcacgt taagggattt tggtcatgag attatcaaaa aggatcttca   9360
cctagatcct tttaaattaa aaatgaagtt ttaaatcaat ctaaagtata tatgagtaaa   9420
cttggtctga cagttaccaa tgcttaatca gtgaggcacc tatctcagcg atctgtctat   9480
ttcgttcatc catagttgcc tgactccccg tcgtgtagat aactacgata cgggagggct   9540
taccatctgg ccccagtgct gcaatgatac cgcgagaccc acgctcaccg gctccagatt   9600
tatcagcaat aaaccagcca gccggaaggg ccgagcgcag aagtggtcct gcaactttat   9660
ccgcctccat ccagtctatt aattgttgcc gggaagctag agtaagtagt tcgccagtta   9720
atagtttgcg caacgttgtt gccattgcta caggcatcgt ggtgtcacgc tcgtcgtttg   9780
gtatggcttc attcagctcc ggttcccaac gatcaaggcg agttacatga tcccccatgt   9840
tgtgcaaaaa agcggttagc tccttcggtc ctccgatcgt tgtcagaagt aagttggccg   9900
cagtgttatc actcatggtt atggcagcac tgcataattc tcttactgtc atgccatccg   9960
taagatgctt ttctgtgact ggtgagtact caaccaagtc attctgagaa tagtgtatgc  10020
ggcgaccgag ttgctcttgc ccggcgtcaa tacgggataa taccgcgcca catagcagaa  10080
ctttaaaagt gctcatcatt ggaaaacgtt cttcggggcg aaaactctca aggatcttac  10140
cgctgttgag atccagttcg atgtaaccca ctcgtgcacc caactgatct tcagcatctt  10200
ttactttcac cagcgtttct gggtgagcaa aaacaggaag gcaaaatgcc gcaaaaaagg  10260
gaataagggc gacacggaaa tgttgaatac tca                               10293
```

<210> SEQ ID NO 100
<211> LENGTH: 8179
<212> TYPE: DNA
<213> ORGANISM: Artificial Sequence
<220> FEATURE:
<223> OTHER INFORMATION: pCAGGS-IgVK1-39 targeting vector

<400> SEQUENCE: 100

```
atccaggcgc ggatcaataa aagatcatta ttttcaatag atctgtgtgt tggtttttg     60
tgtgccttgg gggagggga ggccagaatg aggcgcggcc aagggggagg gggaggccag    120
aatgaccttg ggggagggg aggccagaat gaccttgggg gagggggagg ccagaatgag    180
gcgcggatcc ggagaagttc ctattccgaa gttcctattc ttcaaatagt ataggaactt    240
cgctcgaggg atcggccatt gaacaagatg gattgcacgc aggttctccg gccgcttggg    300
tggagaggct attcggctat gactgggcac aacagacaat cggctgctct gatgccgccg    360
tgttccggct gtcagcgcag gggcgcccgg ttctttttgt caagaccgac ctgtccggtg    420
ccctgaatga actgcaggac gaggcagcgc ggctatcgtg gctggccacg acgggcgttc    480
cttgcgcagc tgtgctcgac gttgtcactg aagcgggaag ggactggctg ctattgggcg    540
aagtgccggg gcaggatctc ctgtcatctc accttgctcc tgccgagaaa gtatccatca    600
tggctgatgc aatgcggcgg ctgcatacgc ttgatccggc tacctgccca ttcgaccacc    660
aagcgaaaca tcgcatcgag cgagcacgta ctcggatgga agccggtctt gtcgatcagg    720
atgatctgga cgaagagcat caggggctcg cgccagccga actgttcgcc aggctcaagg    780
cgcgcatgcc cgacggcgag gatctcgtcg tgacccatgg cgatgcctgc ttgccgaata    840
```

```
tcatggtgga aaatggccgc ttttctggat tcatcgactg tggccggctg ggtgtggcgg    900
accgctatca ggacatagcg ttggctaccc gtgatattgc tgaagagctt ggcggcgaat    960
gggctgaccg cttcctcgtg ctttacggta tcgccgctcc cgattcgcag cgcatcgcct   1020
tctatcgcct tcttgacgag ttcttctgag gggatcgatc cgctgtaagt ctgcagaaat   1080
tgatgatcta ttaaacaata aagatgtcca ctaaaatgga agtttttcct gtcatacttt   1140
gttaagaagg gtgagaacag agtacctaca ttttgaatgg aaggattgga gctacggggg   1200
tgggggtggg gtgggattag ataaatgcct gctctttact gaaggctctt tactattgct   1260
ttatgataat gtttcatagt tggatatcat aatttaaaca agcaaaacca aattaagggc   1320
cagctcattc ctcccactca tgatctatag atctatagat ctctcgtggg atcattgttt   1380
ttctcttgat tcccactttg tggttctaag tactgtggtt tccaaatgtg tcagtttcat   1440
agcctgaaga acgagatcag cagcctctgt tccacataca cttcattctc agtattgttt   1500
tgccaagttc taattccatc agaagctgac tctagatggc gcgtatgcag gttttcgaca   1560
ttgattattg actagttatt aatagtaatc aattacgggg tcattagttc atagcccata   1620
tatggagttc cgcgttacat aacttacggt aaatggcccg cctggctgac cgcccaacga   1680
cccccgccca ttgacgtcaa taatgacgta tgttcccata gtaacgccaa tagggacttt   1740
ccattgacgt caatgggtgg agtatttacg gtaaactgcc cacttggcag tacatcaagt   1800
gtatcatatg ccaagtacgc cccctattga cgtcaatgac ggtaaatggc ccgcctggca   1860
ttatgcccag tacatgacct tatgggactt tcctacttgg cagtacatct acgtattagt   1920
catcgctatt accatggtcg aggtgagccc cacgttctgc ttcactctcc ccatctcccc   1980
cccctcccca cccccaattt tgtatttatt tatttttaa ttattttgtg cagcgatggg   2040
ggcgggggg gggggggcgc gcgccaggcg gggcggggcg gggcgagggg cggggcgggg   2100
cgaggcggag aggtgcggcg gcagccaatc agagcggcgc gctccgaaag tttcctttta   2160
tggcgaggcg gcggcggcgg cggccctata aaaagcgaag cgcgcggcgg gcgggagtcg   2220
ctgcgttgcc ttcgccccgt gccccgctcc gcgccgcctc gcgccgcccg ccccggctct   2280
gactgaccgc gttactccca caggtgagcg ggcgggacgg cccttctcct ccgggctgta   2340
attagcgctt ggtttaatga cggctcgttt cttttctgtg gctgcgtgaa agccttaaag   2400
ggctccggga gggccctttg tgcgggggg agcggctcgg ggggtgcgtg cgtgtgtgtg   2460
tgcgtgggga gcgccgcgtg cggcccgcgc tgcccggcgg ctgtgagcgc tgcgggcgcg   2520
gcgcggggct ttgtgcgctc cgcgtgtgcg cgaggggagc gcggccgggg gcggtgcccc   2580
gcggtgcggg ggggctgcga ggggaacaaa ggctgcgtgc ggggtgtgtg cgtgggggg   2640
tgagcagggg gtgtgggcgc ggcggtcggg ctgtaacccc cccctgcacc cccctccccg   2700
agttgctgag cacggcccgg cttcgggtgc ggggctccgt gcggggcgtg gcgcggggct   2760
cgccgtgccg ggcgggggt ggcggcaggt gggggtgccg ggcggggcgg ggccgcctcg   2820
ggccggggag ggctcggggg aggggcgcgg cggccccgga gcgccggcgg ctgtcgaggc   2880
gcggcgagcc gcagccattg ccttttatgg taatcgtgcg agagggcgca gggacttcct   2940
ttgtcccaaa tctgtgcgga gccgaaatct gggaggcgcc gccgcacccc ctctagcggg   3000
cgcggggcga agcggtgcgg cgccggcagg aaggaaatgg gcggggaggg ccttcgtgcg   3060
tcgccgcgcc gccgtcccct tctccctctc cagcctcggg gctgtccgcg gggggacggc   3120
tgccttcggg ggggacgggg cagggcgggg ttcggcttct ggcgtgtgac cggcggctct   3180
```

agaagcgttg gggtgagtac tccctctcaa aagcgggcat gacttctgcg ctaagattgt 3240
cagtttccaa aaacgaggag gatttgatat tcacctggcc cgcggtgatg cctttgaggg 3300
tggccgcgtc catctggtca gaaaagacaa tctttttgtt gtcaagcttg aggtgtggca 3360
ggcttgagat ctggccatac acttgagtga cattgacatc cactttgcct ttctctccac 3420
aggtgtccac tcccagggcg gcctccggag cgatcgccga tccgcctagg caattgttta 3480
aatcggccgg ccataacttc gtataatgta tgctatacga agttatggat cctcacagta 3540
ggtggcatcg ttcctttctg actgcccgcc ccccgcatgc cgtcccgcga tattgagctc 3600
cgaacctctc gccctgccgc cgccggtgct ccgtcgccgc cgcgccgcca tggaatcgaa 3660
gccaccatgg atcttaccgg aaaactcgac gcaagaaaaa tcagagagat cctcataaag 3720
gtcaagaagg gcggaaagat cgccgtgtaa ttctagaccg gttcgagatc caggcgcgga 3780
tcaataaaag atcattattt tcaatagatc tgtgtgttgg ttttttgtgt gccttggggg 3840
agggggaggc cagaatgagg cgcggccaag ggggaggggg aggccagaat gaccttgggg 3900
gagggggagg ccagaatgac cttgggggag ggggaggcca gaatgaggcg cgccctccgt 3960
cgacctataa cttcgtataa tgtatgctat acgaagttat ggcggccgcc accatggaca 4020
tgagagtgcc cgcccagctc ctggggctcc tgctactctg gctccgaggt aaggatggag 4080
aacactagga atttactcag ccagtgtgct cagtactgac tggaacttca gggaagttct 4140
ctgataacat gattaatagt aagaatattt gtttttatgt ttccaatctc aggtgccaga 4200
tgtgacatcc agatgaccca gagccccagc agcctgagcg ccagcgtggg cgacagagtg 4260
accatcacct gcagagccag ccagagcatc agcagctacc tgaactggta tcagcagaag 4320
cccggcaagg cccccaagct gctgatctac gccgccagct ccctgcagag cggcgtgccc 4380
agcagattca gcggcagcgg ctccggcacc gacttcaccc tgaccatcag cagcctgcag 4440
cccgaggact tcgccaccta ctactgccag cagagctaca gcaccccccc caccttcggc 4500
cagggcacca aggtggagat caagagagcc gacgccgctc ccaccgtgtc catcttcccc 4560
cccagcatgg aacagctgac ctctggcgga gccaccgtgg tctgcttcgt gaacaacttc 4620
taccccagag acatcagcgt gaagtggaag atcgacggca gcgagcagag ggacggcgtg 4680
ctggacagcg tgaccgacca ggacagcaag gactccacct acagcatgag cagcaccctg 4740
agcctgacca aggtggagta cgagaggcac aacctgtaca cctgcgaggt ggtgcacaag 4800
accagctcca gccccgtggt caagtccttc aaccggaacg agtgttgagc tagcttaaga 4860
tttaaatagg ccggccgcgt cgacctcgag atccaggcgc ggatcaataa aagatcatta 4920
ttttcaatag atctgtgtgt tggttttttg tgtgccttgg gggaggggga ggccagaatg 4980
aggcgcggcc aagggggagg gggaggccag aatgaccttg ggggaggggg aggccagaat 5040
gaccttgggg gagggggagg ccagaatgag gcgcgccccc gggtaccgag ctcgaattag 5100
tggatcctca cagtaggtgg catcgttcct ttctgactgc ccgccccccg catgccgtcc 5160
cgcgatattg agctccgaac ctctcgccct gccgccgccg gtgctccgtc gccgccgcgc 5220
cgccatggaa tcgcgccggt aaccgaagtt cctatacttt ctagagaata ggaacttcgg 5280
aataggaact tcaagccggt acccagcttt tgttcccttt agtgagggtt aatttcgagc 5340
ttggcgtaat catggtcata gctgtttcct gtgtgaaatt gttatccgct cacaattcca 5400
cacaacatac gagccgggag cataaagtgt aaagcctggg gtgcctaatg agtgagctaa 5460
ctcacattaa ttgcgttgcg ctcactgccc gctttccagt cgggaaacct gtcgtgccag 5520
ctgcattaat gaatcggcca acgcgcgggg agaggcggtt tgcgtattgg gcgctcttcc 5580 gcttcctcgc tcactgactc gctgcgctcg gtcgttcggc tgcggcgagc ggtatcagct 5640
cactcaaagg cggtaatacg gttatccaca gaatcagggg ataacgcagg aaagaacatg 5700
tgagcaaaag gccagcaaaa ggccaggaac cgtaaaaagg ccgcgttgct ggcgtttttc 5760
cataggctcc gcccccctga cgagcatcac aaaaatcgac gctcaagtca gaggtggcga 5820
aacccgacag gactataaag ataccaggcg tttccccctg gaagctccct cgtgcgctct 5880
cctgttccga ccctgccgct taccggatac ctgtccgcct ttctcccttc gggaagcgtg 5940
gcgctttctc atagctcacg ctgtaggtat ctcagttcgg tgtaggtcgt tcgctccaag 6000
ctgggctgtg tgcacgaacc ccccgttcag cccgaccgct gcgccttatc cggtaactat 6060
cgtcttgagt ccaacccggt aagacacgac ttatcgccac tggcagcagc cactggtaac 6120
aggattagca gagcgaggta tgtaggcggt gctacagagt tcttgaagtg gtggcctaac 6180
tacggctaca ctagaaggac agtatttggt atctgcgctc tgctgaagcc agttaccttc 6240
ggaaaaagag ttggtagctc ttgatccggc aaacaaacca ccgctggtag cggtggtttt 6300
tttgtttgca agcagcagat tacgcgcaga aaaaaaggat ctcaagaaga tcctttgatc 6360
ttttctacgg ggtctgacgc tcagtggaac gaaaactcac gttaagggat tttggtcatg 6420
agattatcaa aaaggatctt cacctagatc cttttaaatt aaaaatgaag ttttaaatca 6480
atctaaagta tatatgagta aacttggtct gacagttacc aatgcttaat cagtgaggca 6540
cctatctcag cgatctgtct atttcgttca tccatagttg cctgactccc cgtcgtgtag 6600
ataactacga tacgggaggg cttaccatct ggccccagtg ctgcaatgat accgcgagac 6660
ccacgctcac cggctccaga tttatcagca ataaaccagc cagccggaag ggccgagcgc 6720
agaagtggtc ctgcaacttt atccgcctcc atccagtcta ttaattgttg ccgggaagct 6780
agagtaagta gttcgccagt taatagtttg cgcaacgttg ttgccattgc tacaggcatc 6840
gtggtgtcac gctcgtcgtt tggtatggct tcattcagct ccggttccca acgatcaagg 6900
cgagttacat gatcccccat gttgtgcaaa aaagcggtta gctccttcgg tcctccgatc 6960
gttgtcagaa gtaagttggc cgcagtgtta tcactcatgg ttatggcagc actgcataat 7020
tctcttactg tcatgccatc cgtaagatgc ttttctgtga ctggtgagta ctcaaccaag 7080
tcattctgag aatagtgtat gcggcgaccg agttgctctt gcccggcgtc aatacgggat 7140
aataccgcgc cacatagcag aactttaaaa gtgctcatca ttggaaaacg ttcttcgggg 7200
cgaaaactct caaggatctt accgctgttg agatccagtt cgatgtaacc cactcgtgca 7260
cccaactgat cttcagcatc ttttactttc accagcgttt ctgggtgagc aaaaacagga 7320
aggcaaaatg ccgcaaaaaa gggaataagg gcgacacgga aatgttgaat actcatactc 7380
ttcctttttc aatattattg aagcatttat cagggttatt gtctcatgag cggatacata 7440
tttgaatgta tttagaaaaa taaacaaata ggggttccgc gcacatttcc ccgaaaagtg 7500
ccacctaaat tgtaagcgtt aatattttgt taaaattcgc gttaaatttt tgttaaatca 7560
gctcattttt taaccaatag gccgaaatcg gcaaaatccc ttataaatca aaagaataga 7620
ccgagatagg gttgagtgtt gttccagttt ggaacaagag tccactatta aagaacgtgg 7680
actccaacgt caaagggcga aaaaccgtct atcagggcga tggcccacta cgtgaaccat 7740
caccctaatc aagttttttg gggtcgaggt gccgtaaagc actaaatcgg aaccctaaag 7800
ggagcccccg atttagagct tgacggggaa agccggcgaa cgtggcgaga aaggaaggga 7860
agaaagcgaa aggagcgggc gctagggcgc tggcaagtgt agcggtcacg ctgcgcgtaa 7920

```
ccaccacacc cgccgcgctt aatgcgccgc tacagggcgc gtcccattcg ccattcaggc   7980

tgcgcaactg ttgggaaggg cgatcggtgc gggcctcttc gctattacgc cagctggcga   8040

aagggggatg tgctgcaagg cgattaagtt gggtaacgcc agggttttcc cagtcacgac   8100

gttgtaaaac gacggccagt gagcgcgcgt aatacgactc actatagggc gaattggggg   8160

taactaagta aggatcgag                                                8179
```

<210> SEQ ID NO 101
<211> LENGTH: 8188
<212> TYPE: DNA
<213> ORGANISM: Artificial Sequence
<220> FEATURE:
<223> OTHER INFORMATION: pCAGGS-IgVL2-14 targeting vector

<400> SEQUENCE: 101

```
atccaggcgc ggatcaataa aagatcatta ttttcaatag atctgtgtgt tggtttttg     60

tgtgccttgg gggagggggga ggccagaatg aggcgcggcc aagggggagg gggaggccag   120

aatgaccttg ggggagggggg aggccagaat gaccttgggg gagggggagg ccagaatgag   180

gcgcggatcc ggagaagttc ctattccgaa gttcctattc ttcaaatagt ataggaactt    240

cgctcgaggg atcggccatt gaacaagatg gattgcacgc aggttctccg gccgcttggg    300

tggagaggct attcggctat gactgggcac aacagacaat cggctgctct gatgccgccg    360

tgttccggct gtcagcgcag gggcgcccgg ttctttttgt caagaccgac ctgtccggtg    420

ccctgaatga actgcaggac gaggcagcgc ggctatcgtg gctggccacg acgggcgttc    480

cttgcgcagc tgtgctcgac gttgtcactg aagcgggaag ggactggctg ctattgggcg    540

aagtgccggg gcaggatctc ctgtcatctc accttgctcc tgccgagaaa gtatccatca    600

tggctgatgc aatgcggcgg ctgcatacgc ttgatccggc tacctgccca ttcgaccacc    660

aagcgaaaca tcgcatcgag cgagcacgta ctcggatgga agccggtctt gtcgatcagg    720

atgatctgga cgaagagcat caggggctcg cgccagccga actgttcgcc aggctcaagg    780

cgcgcatgcc cgacggcgag gatctcgtcg tgacccatgg cgatgcctgc ttgccgaata    840

tcatggtgga aaatggccgc ttttctggat tcatcgactg tggccggctg ggtgtggcgg    900

accgctatca ggacatagcg ttggctaccc gtgatattgc tgaagagctt ggcggcgaat    960

gggctgaccg cttcctcgtg ctttacggta tcgccgctcc cgattcgcag cgcatcgcct   1020

tctatcgcct tcttgacgag ttcttctgag gggatcgatc cgctgtaagt ctgcagaaat   1080

tgatgatcta ttaaacaata aagatgtcca ctaaaatgga agtttttcct gtcatacttt   1140

gttaagaagg gtgagaacag agtacctaca ttttgaatgg aaggattgga gctacggggg   1200

tgggggtggg gtgggattag ataaatgcct gctctttact gaaggctctt tactattgct   1260

ttatgataat gtttcatagt tggatatcat aatttaaaca agcaaaacca aattaagggc   1320

cagctcattc ctcccactca tgatctatag atctatagat ctctcgtggg atcattgttt   1380

ttctcttgat tcccactttg tggttctaag tactgtggtt tccaaatgtg tcagtttcat   1440

agcctgaaga acgagatcag cagcctctgt tccacataca cttcattctc agtattgttt   1500

tgccaagttc taattccatc agaagctgac tctagatggc gcgtatgcag gttttcgaca   1560

ttgattattg actagttatt aatagtaatc aattacgggg tcattagttc atagcccata   1620

tatggagttc cgcgttacat aacttacggt aaatggcccg cctggctgac cgcccaacga   1680

cccccgccca ttgacgtcaa taatgacgta tgttcccata gtaacgccaa tagggacttt   1740

ccattgacgt caatgggtgg agtatttacg gtaaactgcc cacttggcag tacatcaagt   1800
```

```
gtatcatatg ccaagtacgc cccctattga cgtcaatgac ggtaaatggc ccgcctggca   1860
ttatgcccag tacatgacct tatgggactt tcctacttgg cagtacatct acgtattagt   1920
catcgctatt accatggtcg aggtgagccc cacgttctgc ttcactctcc ccatctcccc   1980
cccctcccca cccccaattt tgtatttatt tatttttaa ttattttgtg cagcgatggg   2040
ggcgggggg gggggggcgc gcgccaggcg gggcggggcg gggcgagggg cggggcgggg   2100
cgaggcggag aggtgcggcg gcagccaatc agagcggcgc gctccgaaag tttcctttta   2160
tggcgaggcg gcggcggcgg cggccctata aaaagcgaag cgcgcggcgg gcgggagtcg   2220
ctgcgttgcc ttcgccccgt gccccgctcc gcgccgcctc gcgccgcccg ccccggctct   2280
gactgaccgc gttactccca caggtgagcg ggcgggacgg cccttctcct ccgggctgta   2340
attagcgctt ggtttaatga cggctcgttt cttttctgtg gctgcgtgaa agccttaaag   2400
ggctccggga gggccctttg tgcgggggg agcggctcgg ggggtgcgtg cgtgtgtgtg   2460
tgcgtgggga gcgccgcgtg cggcccgcgc tgcccggcgg ctgtgagcgc tgcgggcgcg   2520
gcgcggggct ttgtgcgctc cgcgtgtgcg cgaggggagc gcggccgggg gcggtgcccc   2580
gcggtgcggg ggggctgcga ggggaacaaa ggctgcgtgc ggggtgtgtg cgtgggggg   2640
tgagcagggg gtgtgggcgc ggcggtcggg ctgtaacccc cccctgcacc cccctccccg   2700
agttgctgag cacggcccgg cttcgggtgc ggggctccgt gcggggcgtg gcgcggggct   2760
cgccgtgccg ggcgggggt ggcggcaggt gggggtgccg ggcggggcgg ggccgcctcg   2820
ggccggggag ggctcggggg aggggcgcgg cggccccgga gcgccggcgg ctgtcgaggc   2880
gcggcgagcc gcagccattg ccttttatgg taatcgtgcg agagggcgca gggacttcct   2940
ttgtcccaaa tctgtgcgga gccgaaatct gggaggcgcc gccgcacccc ctctagcggg   3000
cgcggggcga agcggtgcgg cgccggcagg aaggaaatgg gcggggaggg ccttcgtgcg   3060
tcgccgcgcc gccgtcccct tctccctctc cagcctcggg gctgtccgcg gggggacggc   3120
tgccttcggg ggggacgggg cagggcgggg ttcggcttct ggcgtgtgac cggcggctct   3180
agaagcgttg gggtgagtac tccctctcaa aagcgggcat gacttctgcg ctaagattgt   3240
cagtttccaa aaacgaggag gatttgatat tcacctggcc cgcggtgatg cctttgaggg   3300
tggccgcgtc catctggtca gaaaagacaa tctttttgtt gtcaagcttg aggtgtggca   3360
ggcttgagat ctggccatac acttgagtga cattgacatc cactttgcct ttctctccac   3420
aggtgtccac tcccagggcg gcctccggag cgatcgccga tccgcctagg caattgttta   3480
aatcggccgg ccataacttc gtataatgta tgctatacga agttatggat cctcacagta   3540
ggtggcatcg ttcctttctg actgcccgcc ccccgcatgc cgtcccgcga tattgagctc   3600
cgaacctctc gccctgccgc cgccggtgct ccgtcgccgc cgcgccgcca tggaatcgaa   3660
gccaccatgg atcttaccgg aaaactcgac gcaagaaaaa tcagagagat cctcataaag   3720
gtcaagaagg gcggaaagat cgccgtgtaa ttctagaccg gttcgagatc caggcgcgga   3780
tcaataaaag atcattattt tcaatagatc tgtgtgttgg ttttttgtgt gccttggggg   3840
agggggaggc cagaatgagg cgcggccaag ggggaggggg aggccagaat gaccttgggg   3900
gagggggagg ccagaatgac cttgggggag ggggaggcca gaatgaggcg cgccctccgt   3960
cgacctataa cttcgtataa tgtatgctat acgaagttat ggcggccgcc accatggaca   4020
tgagagtgcc cgcccagctc ctggggctcc tgctactctg gctccgaggt aaggatggag   4080
aacactagga atttactcag ccagtgtgct cagtactgac tggaacttca gggaagttct   4140
```

```
ctgataacat gattaatagt aagaatattt gtttttatgt ttccaatctc aggtgccaga   4200
tgtcagtctg ccctgaccca gcccgcctct gtgtctggca gccctggcca gagcatcacc   4260
atcagctgca ccggcaccag cagcgacgtg ggcggctaca actacgtgtc ctggtatcag   4320
cagcaccccg gcaaggcccc caagctgatg atctacgagg tgtccaacag acccagcggc   4380
gtgagcaaca gattcagcgg cagcaagagc ggcaacaccg ccagcctgac catcagcggc   4440
ctccaggctg aggacgaggc cgactactac tgcagcagct acaccagcag ctccaccctg   4500
gtgtttggcg gcggaacaaa gctgaccgtg ctgagagccg acgccgctcc caccgtgtcc   4560
atcttccccc ccagcatgga acagctgacc tctggcggag ccaccgtggt ctgcttcgtg   4620
aacaacttct accccagaga catcagcgtg aagtggaaga tcgacggcag cgagcagagg   4680
gacggcgtgc tggacagcgt gaccgaccag gacagcaagg actccaccta cagcatgagc   4740
agcaccctga gcctgaccaa ggtggagtac gagaggcaca acctgtacac ctgcgaggtg   4800
gtgcacaaga ccagctccag ccccgtggtc aagtccttca accggaacga gtgttgagct   4860
agcttaagat ttaaataggc cggccgcgtc gacctcgaga tccaggcgcg gatcaataaa   4920
agatcattat tttcaataga tctgtgtgtt ggtttttgt gtgccttggg ggagggggag   4980
gccagaatga ggcgcggcca agggggaggg ggaggccaga atgaccttgg gggagggggga   5040
ggccagaatg accttggggg agggggaggc cagaatgagg cgcgcccccg ggtaccgagc   5100
tcgaattagt ggatcctcac agtaggtggc atcgttcctt tctgactgcc cgcccccccgc   5160
atgccgtccc gcgatattga gctccgaacc tctcgccctg ccgccgccgg tgctccgtcg   5220
ccgccgcgcc gccatggaat cgcgccggta accgaagttc ctatactttc tagagaatag   5280
gaacttcgga ataggaactt caagccggta cccagctttt gttcccttta gtgagggtta   5340
atttcgagct tggcgtaatc atggtcatag ctgtttcctg tgtgaaattg ttatccgctc   5400
acaattccac acaacatacg agccgggagc ataaagtgta aagcctgggg tgcctaatga   5460
gtgagctaac tcacattaat tgcgttgcgc tcactgcccg ctttccagtc gggaaacctg   5520
tcgtgccagc tgcattaatg aatcggccaa cgcgcgggga gaggcggttt gcgtattggg   5580
cgctcttccg cttcctcgct cactgactcg ctgcgctcgg tcgttcggct gcggcgagcg   5640
gtatcagctc actcaaaggc ggtaatacgg ttatccacag aatcagggga taacgcagga   5700
aagaacatgt gagcaaaagg ccagcaaaag gccaggaacc gtaaaaaggc cgcgttgctg   5760
gcgtttttcc ataggctccg cccccctgac gagcatcaca aaaatcgacg ctcaagtcag   5820
aggtggcgaa acccgacagg actataaaga taccaggcgt ttccccctgg aagctccctc   5880
gtgcgctctc ctgttccgac cctgccgctt accggatacc tgtccgcctt tctcccttcg   5940
ggaagcgtgg cgctttctca tagctcacgc tgtaggtatc tcagttcggt gtaggtcgtt   6000
cgctccaagc tgggctgtgt gcacgaaccc cccgttcagc ccgaccgctg cgccttatcc   6060
ggtaactatc gtcttgagtc caacccggta agacacgact tatcgccact ggcagcagcc   6120
actggtaaca ggattagcag agcgaggtat gtaggcggtg ctacagagtt cttgaagtgg   6180
tggcctaact acggctacac tagaaggaca gtatttggta tctgcgctct gctgaagcca   6240
gttaccttcg gaaaaagagt tggtagctct tgatccggca aacaaaccac cgctggtagc   6300
ggtggttttt ttgtttgcaa gcagcagatt acgcgcagaa aaaaaggatc tcaagaagat   6360
cctttgatct tttctacggg gtctgacgct cagtggaacg aaaactcacg ttaagggatt   6420
ttggtcatga gattatcaaa aaggatcttc acctagatcc ttttaaatta aaaatgaagt   6480
tttaaatcaa tctaaagtat atatgagtaa acttggtctg acagttacca atgcttaatc   6540
```

```
agtgaggcac ctatctcagc gatctgtcta tttcgttcat ccatagttgc ctgactcccc   6600
gtcgtgtaga taactacgat acgggagggc ttaccatctg gccccagtgc tgcaatgata   6660
ccgcgagacc cacgctcacc ggctccagat ttatcagcaa taaaccagcc agccggaagg   6720
gccgagcgca gaagtggtcc tgcaacttta tccgcctcca tccagtctat taattgttgc   6780
cgggaagcta gagtaagtag ttcgccagtt aatagtttgc gcaacgttgt tgccattgct   6840
acaggcatcg tggtgtcacg ctcgtcgttt ggtatggctt cattcagctc cggttcccaa   6900
cgatcaaggc gagttacatg atcccccatg ttgtgcaaaa aagcggttag ctccttcggt   6960
cctccgatcg ttgtcagaag taagttggcc gcagtgttat cactcatggt tatggcagca   7020
ctgcataatt ctcttactgt catgccatcc gtaagatgct tttctgtgac tggtgagtac   7080
tcaaccaagt cattctgaga atagtgtatg cggcgaccga gttgctcttg cccggcgtca   7140
atacgggata ataccgcgcc acatagcaga actttaaaag tgctcatcat tggaaaacgt   7200
tcttcggggc gaaaactctc aaggatctta ccgctgttga gatccagttc gatgtaaccc   7260
actcgtgcac ccaactgatc ttcagcatct tttactttca ccagcgtttc tgggtgagca   7320
aaaacaggaa ggcaaaatgc cgcaaaaaag ggaataaggg cgacacggaa atgttgaata   7380
ctcatactct tccttttca atattattga agcatttatc agggttattg tctcatgagc   7440
ggatacatat ttgaatgtat ttagaaaaat aaacaaatag gggttccgcg cacatttccc   7500
cgaaaagtgc cacctaaatt gtaagcgtta atattttgtt aaaattcgcg ttaaattttt   7560
gttaaatcag ctcatttttt aaccaatagg ccgaaatcgg caaaatccct tataaatcaa   7620
aagaatagac cgagataggg ttgagtgttg ttccagtttg gaacaagagt ccactattaa   7680
agaacgtgga ctccaacgtc aaagggcgaa aaaccgtcta tcagggcgat ggcccactac   7740
gtgaaccatc accctaatca agttttttgg ggtcgaggtg ccgtaaagca ctaaatcgga   7800
accctaaagg gagcccccga tttagagctt gacggggaaa gccggcgaac gtggcgagaa   7860
aggaagggaa gaaagcgaaa ggagcgggcg ctagggcgct ggcaagtgta gcggtcacgc   7920
tgcgcgtaac caccacaccc gccgcgctta atgcgccgct acagggcgcg tcccattcgc   7980
cattcaggct gcgcaactgt tgggaagggc gatcggtgcg ggcctcttcg ctattacgcc   8040
agctggcgaa agggggatgt gctgcaaggc gattaagttg ggtaacgcca gggttttccc   8100
agtcacgacg ttgtaaaacg acggccagtg agcgcgcgta atacgactca ctatagggcg   8160
aattgggggt aactaagtaa ggatcgag                                      8188
```

```
<210> SEQ ID NO 102
<211> LENGTH: 10
<212> TYPE: DNA
<213> ORGANISM: Artificial Sequence
<220> FEATURE:
<223> OTHER INFORMATION: Kozak sequence

<400> SEQUENCE: 102

gccaccatgg                                                          10
```

The invention claimed is:

1. A transgenic mouse that has been immunized to generate an immune response against an antigen, wherein the genome of said mouse comprises a transgene encoding a rearranged immunoglobulin light chain variable region, wherein the transgene comprises a single human immunoglobulin light chain V gene segment fused to a single human immunoglobulin light chain J gene segment, wherein the transgene lacks a regulatory element that contributes to somatic hypermutation of the light chain variable region, and wherein said rearranged immunoglobulin light chain variable region is linked to an endogenous immunoglobulin light chain constant region gene segment, and wherein said transgenic mouse comprises a population of B cells that secrete a repertoire of antibodies that bind said antigen, said repertoire of antibodies comprising the immunoglobulin light chain variable region encoded by said transgene and further comprising a counterpart heavy chain variable region resulting from somatic hypermutation in response to said antigen.

2. The transgenic mouse of claim 1, wherein said transgene comprises a single human immunoglobulin light chain germline V gene segment fused to a single immunoglobulin light chain germline J gene segment.

3. A transgenic murine animal that has been immunized to generate an immune response against an antigen, wherein the genome of said animal comprises a transgene encoding a rearranged immunoglobulin light chain variable region, wherein the transgene comprises a single human immunoglobulin light chain V gene segment fused to a single human immunoglobulin light chain J gene segment, wherein the transgene lacks a regulatory element that contributes to somatic hypermutation of the light chain variable region, and wherein the transgene comprises a nucleic acid sequence encoding an immunoglobulin light chain constant region, and wherein said transgenic animal comprises a population of B cells that secrete a repertoire of antibodies that bind said antigen, said repertoire of antibodies comprising the immunoglobulin light chain variable region encoded by said transgene and further comprising a counterpart heavy chain variable region resulting from somatic hypermutation in response to said antigen.

4. The transgenic animal of claim 3, that is a mouse.

5. The transgenic animal of claim 3, wherein the transgene comprises a nucleic acid sequence encoding a murine light chain constant region.

6. The transgenic animal of claim 3, wherein the transgene comprises a nucleic acid sequence encoding a human light chain constant region.

7. The transgenic animal of claim 3, wherein said transgene comprises a single human immunoglobulin light chain germline V gene segment fused to a single immunoglobulin light chain germline J gene segment.

* * * * *